US012796876B2

(12) United States Patent
Freese et al.

(10) Patent No.: US 12,796,876 B2
(45) Date of Patent: Nov. 17, 2026

(54) CLEANING APPARATUS

(71) Applicant: SHARKNINJA OPERATING LLC, Needham, MA (US)

(72) Inventors: John Freese, Chestnut Hill, MA (US); Street Barnett, Watertown, MA (US); Leo Yamazaki, Astoria, NY (US); Steven Gacin, Pawtucket, RI (US); Pengfei Liu, Suzhou (CN); Yang Zhao, Suzhou (CN); Minjie Jiang, Suzhou (CN); Wenxiu Gao, Suzhou (CN); Jiancheng Wang, Suzhou (CN); Kai Xu, Suzhou (CN); Li Tan, Suzhou (CN); Jikang Lu, Shenzhen (CN); Li Song, Shenzhen (CN); Wenbin Yao, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 1 day.

(21) Appl. No.: 19/393,258

(22) Filed: Nov. 18, 2025

(65) Prior Publication Data

US 2026/0090686 A1 Apr. 2, 2026

Related U.S. Application Data

(63) Continuation of application No. PCT/CN2025/011705, filed on Aug. 29, 2025.
(Continued)

(51) Int. Cl.
*A47L 5/14* (2006.01)
*A47L 5/22* (2006.01)
(Continued)

(52) U.S. Cl.
CPC ..... *A47L 5/225* (2013.01); *A47L 5/24* (2013.01); *A47L 9/149* (2013.01); *A47L 9/2836* (2013.01); *A47L 9/04* (2013.01); *A47L 9/2863* (2013.01)

(58) Field of Classification Search
CPC . A47L 9/28; A47L 9/1608; A47L 5/24; A47L 9/04
See application file for complete search history.

(56) References Cited

U.S. PATENT DOCUMENTS 5,355,549 A 10/1994 Steinberg et al.
6,122,796 A 9/2000 Downham et al.
(Continued)

FOREIGN PATENT DOCUMENTS

CN 101146470 A 3/2008
CN 101484059 A 7/2009
(Continued)

OTHER PUBLICATIONS

International Search Report and Written Opinion, re PCT Application No. PCT/CN2025/117705, dated Dec. 10, 2025.

*Primary Examiner* — Michael D Jennings
(74) *Attorney, Agent, or Firm* — Knobbe, Martens, Olson & Bear, LLP

(57) ABSTRACT

Various implementations of cleaning apparatuses are described. Some implementations include a floor-based vacuum cleaner, a wand, a cleaning head, and a handheld vacuum cleaner. The floor-based vacuum cleaner can be removably attachable to the cleaning head and wand. The handheld vacuum cleaner can be removably attachable to the wand. In some implementations, the cleaning apparatus can be transitioned between: a first mode of operation in which debris are collected from the cleaning head and are directed into the floor-based vacuum cleaner; a second mode of operation in which debris are collected from the cleaning
(Continued)

head and are directed into the handheld vacuum cleaner; and a third mode of operation in which debris from the handheld vacuum cleaner are emptied into the floor-based vacuum cleaner. In various implementations, the cleaning apparatus includes one or more valves which can open and close flow passages to facilitate the above-described operational modes.

20 Claims, 121 Drawing Sheets

Related U.S. Application Data

(60) Provisional application No. 63/727,606, filed on Dec. 3, 2024, provisional application No. 63/694,440, filed on Sep. 13, 2024.

(51) Int. Cl.

| | |
|---|---|
| ***A47L 5/24*** | (2006.01) |
| ***A47L 9/14*** | (2006.01) |
| ***A47L 9/28*** | (2006.01) |
| *A47L 9/04* | (2006.01) |

(56) References Cited

U.S. PATENT DOCUMENTS

| | | | |
|---|---|---|---|
| 6,442,791 | B1 | 9/2002 | McRae et al. |
| 6,572,078 | B1 | 6/2003 | Thomson et al. |
| 7,367,085 | B2 | 5/2008 | Anderson et al. |
| 7,437,799 | B2 | 10/2008 | Rocke |
| 7,533,441 | B2 | 5/2009 | Yoo |
| 7,651,544 | B1 | 1/2010 | Fester et al. |
| 7,676,883 | B2 | 3/2010 | Macleod et al. |
| 7,861,367 | B2 | 1/2011 | Eckstein et al. |
| 7,861,368 | B2 | 1/2011 | Hackwell et al. |
| 7,862,637 | B2 | 1/2011 | Han et al. |
| 7,867,304 | B2 | 1/2011 | Stewen et al. |
| 7,908,707 | B2 | 3/2011 | Yacobi et al. |
| 7,976,614 | B2 | 7/2011 | Eckstein et al. |
| 8,142,554 | B2 | 3/2012 | Eckstein et al. |
| 8,186,005 | B2 | 5/2012 | Stewen et al. |
| 8,327,503 | B2 | 12/2012 | Worker et al. |
| 8,375,511 | B2 | 2/2013 | Dyson et al. |
| 8,393,048 | B2 | 3/2013 | Rentschler et al. |
| 8,468,646 | B2 | 6/2013 | Yoo |
| 8,468,647 | B2 | 6/2013 | Lambourn |
| 8,484,797 | B2 | 7/2013 | Yoo |
| 8,510,908 | B2 | 8/2013 | Maguire et al. |
| 8,516,654 | B1 | 8/2013 | McCutchen et al. |
| 8,544,145 | B2 | 10/2013 | Arthey et al. |
| 8,567,003 | B2 | 10/2013 | Mcleod et al. |
| 8,572,803 | B2 | 11/2013 | Inge et al. |
| 8,650,708 | B2 | 2/2014 | Dyson et al. |
| 8,650,709 | B2 | 2/2014 | McLeod et al. |
| 8,671,517 | B2 | 3/2014 | Ventress et al. |
| 8,677,553 | B2 | 3/2014 | Dyson et al. |
| 8,769,765 | B2 | 7/2014 | Worker et al. |
| 8,793,836 | B2 | 8/2014 | Postle et al. |
| 8,943,674 | B2 | 2/2015 | Chen et al. |
| 8,959,708 | B2 | 2/2015 | Ventress et al. |
| 8,961,633 | B2 | 2/2015 | Kienzle et al. |
| 9,044,129 | B2 | 6/2015 | McLuckie et al. |
| 9,247,853 | B2 | 2/2016 | Dyson et al. |
| 9,254,069 | B2 | 2/2016 | Kim et al. |
| 9,770,152 | B2 | 9/2017 | Demaus et al. |
| 9,795,261 | B2 | 10/2017 | Krebs |
| 9,826,869 | B2 | 11/2017 | Kettle et al. |
| 9,888,817 | B2 | 2/2018 | Conrad |
| 10,105,022 | B2 | 10/2018 | Lim et al. |
| 10,136,778 | B2 | 11/2018 | Conrad |
| 10,149,585 | B2 | 12/2018 | Conrad |
| 10,165,920 | B2 | 1/2019 | Blanchard et al. |
| 10,219,660 | B2 | 3/2019 | Conrad |
| 10,470,632 | B2 | 11/2019 | Foenss |
| 10,596,508 | B2 | 3/2020 | Krogsgaard |
| 10,646,084 | B2 | 5/2020 | Hinchliffe et al. |
| 10,667,660 | B2 | 6/2020 | McIntosh et al. |
| 11,229,332 | B2 | 1/2022 | Lim et al. |
| 11,297,987 | B2 | 4/2022 | Campbell-Hill |
| 11,350,806 | B2 | 6/2022 | Terry et al. |
| 11,653,799 | B2 | 5/2023 | Burgess et al. |
| 11,672,389 | B2 | 6/2023 | Terry et al. |
| 11,690,488 | B2 | 7/2023 | Thomas et al. |
| 11,903,547 | B1 | 2/2024 | Conrad |
| 11,998,150 | B2 | 6/2024 | Innes et al. |
| 2004/0237246 | A1 | 12/2004 | Nam et al. |
| 2007/0174993 | A1 | 8/2007 | Dever et al. |
| 2009/0144929 | A1 | 6/2009 | Yoo |
| 2009/0205159 | A1 | 8/2009 | Stewen et al. |
| 2010/0095476 | A1 | 4/2010 | Kim et al. |
| 2011/0219567 | A1 | 9/2011 | Conrad |
| 2011/0219568 | A1 | 9/2011 | Conrad |
| 2012/0030896 | A1 | 2/2012 | Crouch et al. |
| 2012/0137467 | A1 | 6/2012 | Treitz |
| 2012/0180252 | A1 | 7/2012 | Lee |
| 2013/0081222 | A1 | 4/2013 | Wills et al. |
| 2013/0263406 | A1 | 10/2013 | Amisani et al. |
| 2013/0319478 | A1 | 12/2013 | Hensel et al. |
| 2014/0259520 | A1 | 9/2014 | Sutrina |
| 2015/0059118 | A1 | 3/2015 | Lim et al. |
| 2015/0351596 | A1 | 12/2015 | Thorne |
| 2017/0020352 | A1 | 1/2017 | Amisani et al. |
| 2017/0367551 | A1 | 12/2017 | Krebs |
| 2018/0177363 | A1 | 6/2018 | Ni |
| 2020/0345196 | A1 | 11/2020 | Innes et al. |
| 2020/0367707 | A1 | 11/2020 | Dahlbeck et al. |
| 2021/0204768 | A1* | 7/2021 | Scott ..... A47L 9/322 |
| 2022/0273149 | A1* | 9/2022 | Conrad ..... A47L 9/1666 |
| 2022/0322896 | A1 | 10/2022 | Lhoste-Clos et al. |
| 2022/0322900 | A1* | 10/2022 | Cho ..... A47L 5/28 |
| 2023/0118892 | A1 | 4/2023 | Conrad |
| 2023/0182062 | A1 | 6/2023 | Sjberg et al. |
| 2023/0355051 | A1 | 11/2023 | Wesley |
| 2024/0057834 | A1* | 2/2024 | Kim ..... A47L 9/0063 |
| 2024/0172909 | A1 | 5/2024 | Conrad |
| 2024/0188775 | A1* | 6/2024 | Conrad ..... A47L 9/327 |
| 2024/0292992 | A1 | 9/2024 | Innes et al. |
| 2024/0374091 | A1* | 11/2024 | Conrad ..... A47L 9/1683 |
| 2024/0415344 | A1 | 12/2024 | Lhoste-Clos et al. |
| 2024/0423430 | A1* | 12/2024 | Hyun ..... A47L 9/00 |
| 2025/0000314 | A1* | 1/2025 | Conrad ..... A47L 5/28 |
| 2025/0194877 | A1 | 6/2025 | Chen |
| 2025/0288172 | A1 | 9/2025 | Gugala et al. |

FOREIGN PATENT DOCUMENTS

| | | | |
|---|---|---|---|
| CN | 101484060 | A | 7/2009 |
| CN | 101489462 | A | 7/2009 |
| CN | 100531643 | C | 8/2009 |
| CN | 102196756 | A | 9/2011 |
| CN | 102421503 | A | 4/2012 |
| CN | 103239189 | A | 8/2013 |
| CN | 104414586 | A | 3/2015 |
| CN | 104840150 | A | 8/2015 |
| CN | 105142481 | A | 12/2015 |
| CN | 105311890 | A | 2/2016 |
| CN | 105747993 | A | 7/2016 |
| CN | 106999828 | A | 8/2017 |
| CN | 108283459 | A | 7/2018 |
| CN | 108309148 | A | 7/2018 |
| CN | 108618704 | A | 10/2018 |
| CN | 108652516 | A | 10/2018 |
| CN | 108742295 | A | 11/2018 |
| CN | 108852151 | A | 11/2018 |
| CN | 208625568 | U | 3/2019 |
| CN | 208677257 | U | 4/2019 |
| CN | 208677258 | U | 4/2019 |
| CN | 208677259 | U | 4/2019 |
| CN | 208876377 | U | 5/2019 |
| CN | 110200548 | A | 9/2019 |
| CN | 209404602 | U | 9/2019 |
| CN | 110916560 | A | 3/2020 |

(56) References Cited

FOREIGN PATENT DOCUMENTS

| | | | |
|---|---|---|---|
| CN | 114072032 | A | 2/2022 |
| CN | 216060388 | U | 3/2022 |
| CN | 216060389 | U | 3/2022 |
| CN | 216060390 | U | 3/2022 |
| CN | 114468840 | A | 5/2022 |
| CN | 216907854 | U | 7/2022 |
| CN | 115315208 | A | 11/2022 |
| CN | 115399686 | A | 11/2022 |
| CN | 115399687 | A | 11/2022 |
| CN | 115399689 | A | 11/2022 |
| CN | 115399690 | A | 11/2022 |
| CN | 218899299 | U | 4/2023 |
| CN | 116250762 | A | 6/2023 |
| CN | 219183541 | U | 6/2023 |
| CN | 119451609 | A | 2/2025 |
| CN | 120076746 | A | 5/2025 |
| DE | 102017126393 | A1 | 5/2019 |
| EP | 0134654 | A1 | 3/1985 |
| EP | 1868479 | A1 | 12/2007 |
| EP | 2046182 | A1 | 4/2009 |
| EP | 2046183 | A1 | 4/2009 |
| EP | 2046184 | A1 | 4/2009 |
| EP | 2421630 | A1 | 2/2012 |
| EP | 2457485 | A1 | 5/2012 |
| EP | 2575585 | B1 | 12/2013 |
| EP | 2848173 | A1 | 3/2015 |
| EP | 2352409 | B1 | 7/2015 |
| EP | 2988642 | A1 | 3/2016 |
| EP | 3240619 | B1 | 12/2020 |
| EP | 4039352 | A1 | 8/2022 |
| EP | 4084663 | A1 | 11/2022 |
| EP | 4551082 | A1 | 5/2025 |
| GB | 2423466 | A | 8/2006 |
| GB | 2466100 | A | 6/2010 |
| GB | 2477598 | A | 8/2011 |
| GB | 2535604 | A | 8/2016 |
| JP | 2002-028107 | A | 1/2002 |
| JP | 2012-050564 | A | 3/2012 |
| JP | 2015-119879 | A | 7/2015 |
| WO | 2011/150957 | A1 | 12/2011 |
| WO | 2023/214165 | A1 | 11/2023 |
| WO | 2023/214166 | A1 | 11/2023 |
| WO | 2024/003563 | A1 | 1/2024 |
| WO | 2024/010509 | A1 | 1/2024 |
| WO | 2024/084016 | A1 | 4/2024 |
| WO | 2024/104801 | A1 | 5/2024 |
| WO | 2024/120544 | A1 | 6/2024 |
| WO | 2024/153473 | A1 | 7/2024 |
| WO | 2024/175209 | A1 | 8/2024 |

* cited by examiner

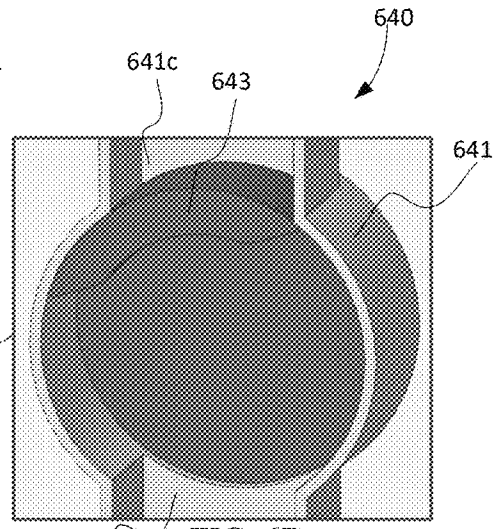
FIG. 6A
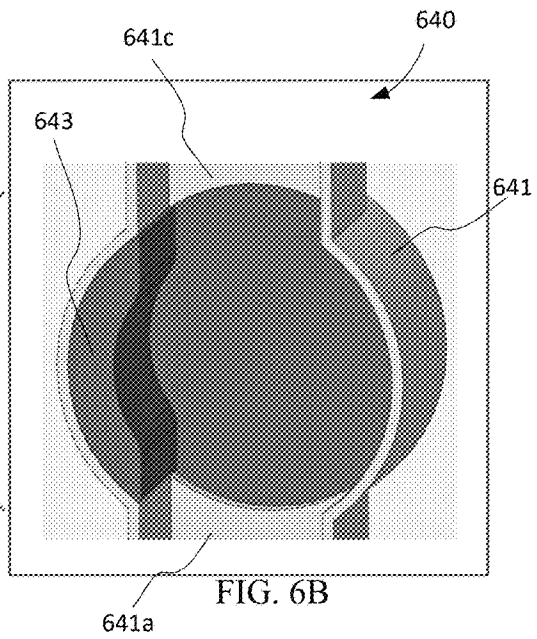
FIG. 6B
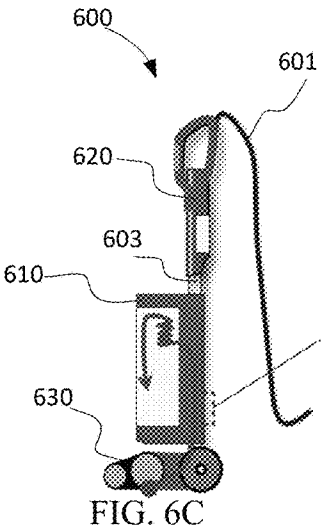
FIG. 6C
FIG. 6D
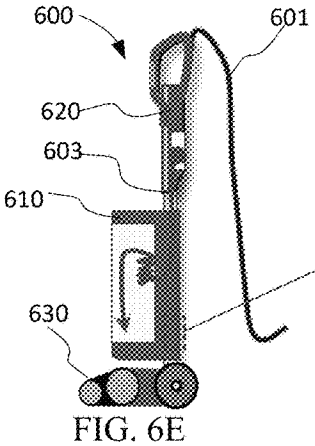
FIG. 6E
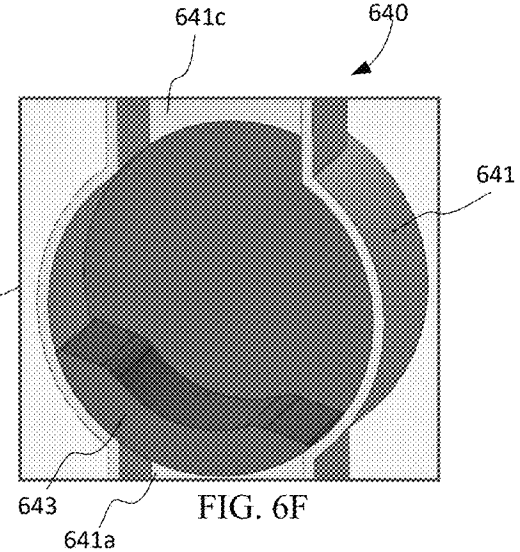
FIG. 6F

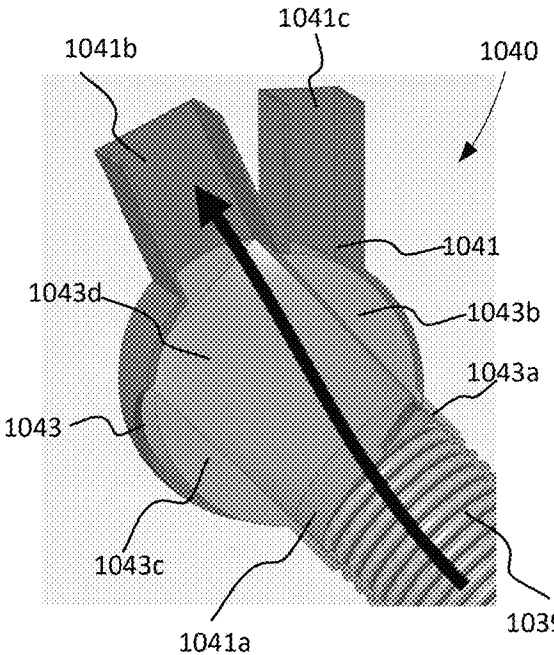
FIG. 10D
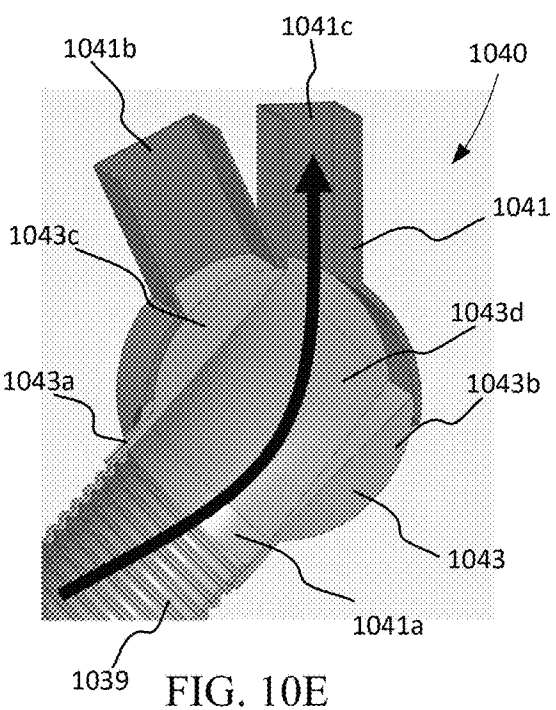
FIG. 10E
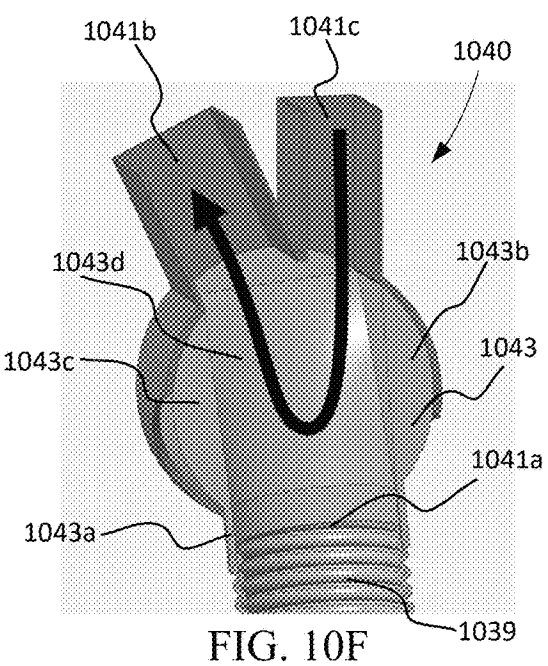
FIG. 10F
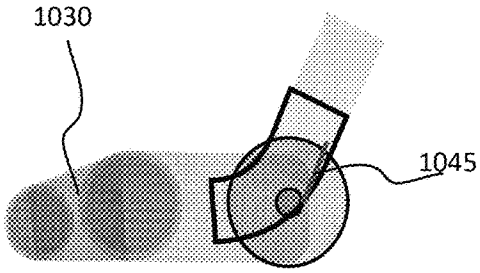
FIG. 10G
FIG. 10H
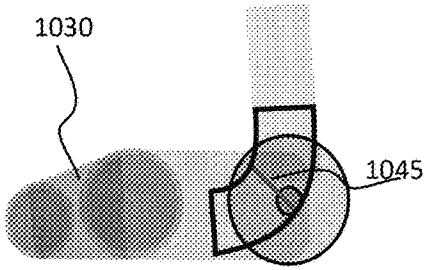
FIG. 10I

CLEANING APPARATUS

CROSS REFERENCE TO RELATED APPLICATIONS

The present application claims priority to International Application No. PCT/CN2025/0117705, filed Aug. 29, 2025, which claims priority to U.S. Provisional Application No. 63/694,440, filed Sep. 13, 2024, and U.S. Provisional Application No. 63/727,606, filed Dec. 3, 2024. All of the above-listed applications and any and all other applications for which a foreign or domestic priority claim is identified in the Application Data Sheet as filed with the present application are hereby incorporated by reference under 37 CFR 1.57.

TECHNICAL FIELD

The present disclosure generally relates to cleaning apparatuses for cleaning debris from one or more surfaces.

BACKGROUND

Surface treatment apparatuses can be configured to clean one or more surfaces, such as a floor. Surface treatment apparatuses may include, for example, a vacuum cleaner, a mop, a steam cleaning apparatus, and a sweeper (for example, a powered sweeper). One example of a vacuum cleaner is a handheld vacuum cleaner. Handheld vacuum cleaners typically include a housing defining handle, a suction motor disposed within the housing, and a debris container fluidly coupled to the suction motor for storing debris. A handheld vacuum cleaner is particularly suited for cleaning tasks that require increased maneuverability and/or involve surfaces that are not on the floor. Another example of a vacuum cleaner is an upright vacuum cleaner. An upright vacuum cleaner may include a handle, a suction motor, and a cleaning head. Upright vacuum cleaners typically include a larger debris container and/or a more powerful suction motor compared to a handheld vacuum cleaner since the weight of the upright vacuum cleaner is generally intended to be supported by the floor.

SUMMARY

The present disclosure describes various implementations of cleaning apparatuses which are configured for multiple modes of operation. Various implementations include a cleaning head (which also may be referred to as a "surface cleaning head" or "floor nozzle"), a floor-based vacuum cleaner, and a handheld vacuum cleaner that may be removably attachable to one another. Some implementations include a support member (which also may be referred to as a "support", "support structure", or "neck") that is connected (for example, pivotably connected) to the cleaning head. Various implementations include a wand that is removably attachable to the cleaning head (for example, via the support member) and removably attachable to the handheld vacuum cleaner. Such wand can connect (mechanically, electrically, and/or fluidly) the handheld vacuum cleaner to the cleaning head (for example, via the support member).

Various implementations of cleaning apparatuses disclosed herein are configured to be transitioned between and operated in: a first mode in which the floor-based vacuum cleaner is utilized to collect debris via the cleaning head (an "upright mode"); and a second mode in which the floor-based vacuum cleaner is detached from the handheld vacuum cleaner and the cleaning head (for example, detached from the wand and/or the support member) and the handheld vacuum cleaner is utilized to collect debris via the cleaning head (a "stick mode"). Accordingly, such implementations can perform the function of an upright vacuum cleaner and stick vacuum cleaner. In various implementations, the handheld vacuum cleaner is removably attachable to the wand, in which case the handheld vacuum cleaner can be utilized in a standalone manner to clean surfaces independent from the wand, cleaning head, and floor-based vacuum cleaner. Additionally, various implementations of cleaning apparatus disclosed herein are configured to be transitioned to and operated in a third mode in which the floor-based vacuum cleaner and the handheld vacuum cleaner are in flow communication with one another and debris from the handheld vacuum cleaner are directed into the floor-based vacuum cleaner (an "empty mode", which also may be referred to as an "auto-empty mode"). Such mode is especially advantageous given that the floor-based vacuum cleaner may have a larger debris container than the handheld vacuum cleaner and the debris container of the handheld vacuum cleaner may fill up relatively fast compared to the debris container of the floor-based vacuum cleaner. The debris container of the floor-based vacuum cleaner may be at least 50% larger, at least 100% larger, at least 200% larger, or at least 300% larger than the debris container of the handheld vacuum cleaner (for example, by volume). In various implementations, a suction motor of the floor-based vacuum cleaner is larger and/or has greater airflow capacity than a suction motor of the handheld vacuum cleaner, for example, at least 50%, at least 100%, at least 200%, or at least 300% greater airflow capacity than the handheld suction motor.

Various implementations of cleaning apparatuses disclosed herein include one or more valves, a valve assembly, and/or other structure that enable or disable flow communication between the cleaning head, the floor-based vacuum cleaner, and the handheld vacuum cleaner to facilitate the above-described upright, stick, and empty modes of operation. By way of non-limiting example, some implementations of cleaning apparatuses disclosed herein include a first valve arranged within the handheld vacuum cleaner and a second valve arranged within a support member connected to the cleaning head, each of such first and second valves configured to be opened or closed to facilitate the upright, stick, and empty modes of operation. Handheld vacuum cleaner can include a handle and provide maneuverability of the cleaning apparatus, for example, in any of the above-described modes of operation.

In various implementations, the debris container and suction motor of the floor-based vacuum cleaner are utilized and operated independently of the debris container and suction motor of the handheld vacuum cleaner during certain floor cleaning operations, for example, during the "upright" and "stick" modes of operation described above. For example, during some floor cleaning operations, the debris container and suction motor of the floor-based vacuum cleaner debris container may not be utilized at the same time as the debris container and suction motor of the handheld vacuum cleaner. In some variants, however, the debris container and suction motor of the floor-based vacuum cleaner debris container may be utilized in combination with the debris container and suction motor of the handheld vacuum cleaner. For example, in some cases, the debris container and suction motor of the floor-based vacuum cleaner debris container are utilized simultaneously with the debris container and suction motor of the handheld vacuum cleaner during floor cleaning operations to further increase suction performance.

Various implementations of cleaning apparatuses disclosed herein provide a user with significant flexibility to perform surface cleaning tasks, for example, by utilizing the floor-based vacuum cleaner, the handheld vacuum cleaner (in the above-described stick mode" or as a standalone handheld vacuum cleaner separate from the cleaning head), and, if desired, to conveniently an efficiently empty contents from the handheld vacuum cleaner into the floor-based vacuum cleaner. Various implementations allow for convenient attachment and detachment of the floor-based vacuum cleaner, wand, handheld vacuum cleaner, support member, and cleaning from one another to further enhance usability.

Disclosed herein is a cleaning apparatus comprising: a first vacuum cleaner; and a second vacuum cleaner combinable with and separable from the first vacuum cleaner, each of the first and second vacuum cleaners operable to remove debris from a surface. The first vacuum cleaner comprises a first dirty air inlet, a first debris separator, a first debris container, a first suction motor, and a first clean air outlet. The second vacuum cleaner comprises a second dirty air inlet, a second debris separator, a second debris container, a second suction motor, and a second clean air outlet, wherein the second debris container comprises a smaller volume than the first debris container; The cleaning apparatus is configured to be transitioned between a first mode of operation, a second mode of operation, and a third mode of operation, and wherein: in the first mode of operation, the first suction motor causes air to flow through the first dirty air inlet, the first debris separator, and the first clean air outlet, thereby directing debris through the first dirty air inlet and into the first debris container; in the second mode of operation, the second suction motor causes air to flow through the second dirty air inlet, the second debris separator, and the second clean air outlet, thereby directing debris through the second dirty air inlet and into the second debris container; and in the third mode of operation, the first suction motor causes air to flow into and through the second vacuum cleaner and through the first dirty air inlet, the first debris separator, and the first clean air outlet, thereby directing debris from the second debris container into the first debris container.

In some implementations, the cleaning apparatus further comprises a cleaning head supportable by and movable with respect to said surface and comprising a cleaning head dirty air inlet, wherein: the first suction motor causes air to flow from the cleaning head dirty air inlet through the first dirty air inlet when the cleaning apparatus is in the first mode of operation; and the second suction motor causes air to flow from the cleaning head dirty air inlet through the second dirty air inlet when the cleaning apparatus is in the second mode of operation. In some implementations, the cleaning apparatus further comprises a wand connecting the second vacuum cleaner to the cleaning head, wherein: the second suction motor causes air to flow from the cleaning head dirty air inlet through the wand when the cleaning apparatus is in the second mode of operation; and the first suction motor causes air to flow from the second vacuum cleaner through the wand when the cleaning apparatus is in the third mode of operation. In some implementations, when the cleaning apparatus is in the third mode of operation, flow communication between the cleaning head dirty air inlet and each of the first and second vacuum cleaners is blocked. In some implementations, the cleaning apparatus further comprises: a support member connected to the cleaning head and configured to attach to the wand; and a valve arranged within the support member and configured to move between an open position and a closed position, wherein the valve is in said closed position and blocks flow communication between the cleaning head dirty air inlet and each of the first and second vacuum cleaners when the cleaning apparatus is in the third mode of operation, and wherein the valve is in the said open position when the cleaning apparatus is in the first and second modes of operation, said valve allowing flow communication between the cleaning head dirty air inlet and each of the first and second vacuum cleaners when in said open position.

In some implementations, in the first mode of operation, the first and second vacuum cleaners are attached to one another but flow communication between the first and second debris containers is blocked.

In some implementations, the cleaning apparatus further comprises a valve arranged within the second vacuum cleaner and configured to be moved between a closed position and an open position, said valve in said closed position when the cleaning apparatus is in the first mode of operation and in said open position when the cleaning apparatus is in the second mode of operation, wherein, when in said closed position the valve blocks at least one flow path extending through the second vacuum cleaner, and wherein said at least one flow path is open when the valve is in said open position. In some implementations, the valve is biased toward said closed position. In some implementations, when the cleaning apparatus is in the second mode of operation, the second suction motor causes the valve to move to said open position. In some implementations, the second vacuum cleaner comprises a filter and the valve is arranged between the filter and the second suction motor. In some implementations, said at least one flow path is defined by at least a portion of an interior cavity of the filter. In some implementations, the filter comprises an opening in fluid communication with the interior cavity, and wherein the valve covers said opening when in said closed position and is spaced from the opening when in said open position. In some implementations, the valve is configured to seal said opening when in said closed position. In some implementations, the valve is in said open position when the cleaning apparatus is in the third mode of operation. In some implementations: the valve comprises a magnet; and the second vacuum cleaner further comprises an electromagnet configured magnetically couple with the magnet of the valve and cause the valve to remain in said open position when the cleaning apparatus is in the third mode of operation. In some implementations, the electromagnet is activated when the cleaning apparatus is in the third mode of operation and deactivated when the cleaning apparatus is in the first and/or second modes of operation. In some implementations, the electromagnet is activated only when the cleaning apparatus is in the third mode of operation. In some implementations: said valve is a first valve of the cleaning apparatus; and the cleaning apparatus further comprises a second valve arranged within the second vacuum cleaner, the second valve configured to inhibit debris from falling out of the second debris container through the second dirty air inlet when the cleaning apparatus is in the first mode of operation. In some implementations, the second valve is arranged closer to the second dirty air inlet than the first valve. In some implementations: when the cleaning apparatus is in the first mode of operation, the second valve is in a first position in which the second valve blocks a flow passage that extends through the second dirty air inlet; the second valve is moved from said first position to a second position when the cleaning apparatus is transitioned from the first mode of operation to the second mode of operation; the second valve is moved from said first position to a third position when the cleaning apparatus is transitioned from the first mode of operation to the third mode of operation; and the second valve does not block said flow passage when in said second and third position. In some implementations, the second valve is pivotably connected to a portion of the second vacuum cleaner and is pivoted away from the second dirty air inlet when in said second position and is pivoted toward the second dirty air inlet when in said third position. In some implementations, said at least one flow path extends from the second clean air outlet to the second dirty air inlet. In some implementations, said at least one flow path extends from the auxiliary air inlet to the second dirty air inlet. In some implementations, said at least one flow path comprises a first flow path extending from the second clean air outlet to the second dirty air inlet and a second flow path extending from the auxiliary air inlet to the second dirty air inlet, and wherein the valve blocks both of the first and second flow paths when in said closed position. In some implementations, each of the first and second flow paths extends through a filter of the second vacuum cleaner, said filter arranged between the second dirty air inlet and the second suction motor.

In some implementations, in the third mode of operation, the first suction motor causes air to flow into the second vacuum cleaner via the second clean air outlet. In some implementations, the second vacuum cleaner further comprises an auxiliary air inlet, and wherein, in the third mode of operation, the first suction motor causes air to flow into the second vacuum cleaner via the auxiliary air inlet. In some implementations, in the third mode of operation, the first suction motor causes air to flow into the second vacuum cleaner via both of the auxiliary air inlet and the second clean air outlet. In some implementations, in the third mode of operation, an amount of air flowing into the second vacuum cleaner from the auxiliary air inlet is greater than an amount of air flowing into the second vacuum cleaner from the second clean air outlet. In some implementations, in the third mode of operation, a majority of air flowing out of the second vacuum cleaner via the second dirty air inlet comes from the auxiliary air inlet.

Disclosed herein is a cleaning apparatus comprising: a floor-based vacuum cleaner removably attachable to at least one of a wand and a cleaning head, the cleaning head supportable by and movable with respect to a surface, the wand attachable to the cleaning head, the floor-based vacuum cleaner movable with the cleaning head to remove debris from said surface and comprising a floor-based vacuum dirty air inlet, a floor-based vacuum debris separator, a floor-based vacuum debris container, a floor-based vacuum suction motor, and a floor-based vacuum clean air outlet; and a handheld vacuum cleaner removably attachable to the wand, the handheld vacuum cleaner comprising a handheld vacuum dirty air inlet, a handheld vacuum debris separator, a handheld vacuum debris container, a handheld vacuum suction motor, and a handheld vacuum clean air outlet, wherein the handheld vacuum debris container comprises a smaller volume than the floor-based vacuum debris container. The cleaning apparatus is configured to be transitioned between at least a first mode of operation and a second mode of operation, and wherein: in the first mode of operation, the floor-based vacuum suction motor causes air to flow from a cleaning head dirty air inlet of the cleaning head and through the floor-based vacuum dirty air inlet, the floor-based vacuum debris separator, and the floor-based vacuum clean air outlet, thereby directing debris from said surface through the floor-based vacuum dirty air inlet and into the floor-based vacuum debris container; and in second mode of operation, the handheld vacuum suction motor causes air to flow from the cleaning head dirty air inlet and through the handheld vacuum dirty air inlet, the handheld vacuum debris separator, and the handheld vacuum clean air outlet, thereby directing debris from said surface through the handheld vacuum dirty air inlet and into the handheld vacuum debris container.

In some implementations, the floor-based vacuum cleaner is detached from the cleaning head and wand when the cleaning apparatus is in said second mode of operation. In some implementations, when the cleaning apparatus is in said first mode of operation, flow communication between the floor-based vacuum cleaner and the handheld vacuum cleaner is blocked.

In some implementations, the cleaning apparatus further comprises a support member connected to the cleaning wand and configured to removably attach to the wand. In some implementations: each of the support member and the wand comprise an air flow passage; the floor-based vacuum suction motor causes air to flow from the cleaning head dirty air inlet through at least a portion of the air flow passage of the support member when the cleaning apparatus is in the first mode of operation; and the handheld vacuum suction motor causes air to flow from the cleaning head dirty air inlet through the air flow passages of the support member and wand when the cleaning apparatus is in the second mode of operation.

In some implementations, the cleaning apparatus is further configured to be transitioned to a third mode of operation in which the floor-based vacuum suction motor causes air to flow into and through the handheld vacuum cleaner, the wand, the floor-based vacuum dirty air inlet, the floor-based vacuum debris separator, and the floor-based vacuum clean air outlet, thereby directing debris from the handheld vacuum debris container into the floor-based vacuum debris container. In some implementations, when the cleaning apparatus is in the third mode of operation, flow communication between the cleaning head dirty air inlet and each of the floor-based and handheld vacuum cleaners is blocked. In some implementations, the cleaning apparatus further comprises a valve configured to block flow communication between the cleaning head dirty air inlet and each of the floor-based and handheld vacuum cleaners when the cleaning apparatus is in the third mode of operation.

In some implementations, said valve is arranged within a portion of the support member. In some implementations: the support member is pivotably connected to the cleaning head; the valve is configured to move between an open position and a closed position responsive to pivotable movement of the support member relative to the cleaning head; the valve is in said closed position when the cleaning apparatus is in the third mode of operation; and the valve is in said open position when the cleaning apparatus is in the first and second modes of operation. In some implementations, the wand and support member are configured to pivot together relative to the cleaning head.

In some implementations, the cleaning apparatus further comprises a valve arranged within the handheld vacuum cleaner and configured to be moved between a closed position and an open position, said valve in said closed position when the cleaning apparatus is in the first mode of operation and in said open position when the cleaning apparatus is in the second mode of operation, wherein, when in said closed position the valve blocks at least one flow path extending through the handheld vacuum cleaner, and wherein said at least one flow path is open when the valve is in said open position. In some implementations, the valve is biased toward said closed position. In some implementations, when the cleaning apparatus is in the second mode of operation, the handheld vacuum suction motor causes the valve to move to said open position. In some implementations, the cleaning apparatus further comprises the handheld vacuum cleaner comprises a filter and the valve is arranged between the filter and the handheld vacuum suction motor. In some implementations, said at least one flow path is defined by at least a portion of an interior cavity of the filter. In some implementations, the filter comprises an opening in fluid communication with the interior cavity, and wherein the valve covers said opening when in said closed position and is spaced from the opening when in said open position. In some implementations, the valve is configured to seal said opening when in said closed position. In some implementations, the valve is in said open position when the cleaning apparatus is in the third mode of operation. In some implementations: the valve comprises a magnet; and the handheld vacuum cleaner further comprises an electromagnet configured magnetically couple with the magnet of the valve and cause the valve to remain in said open position when the cleaning apparatus is in the third mode of operation. In some implementations, the electromagnet is activated when the cleaning apparatus is in the third mode of operation and deactivated when the cleaning apparatus is in the first and/or second modes of operation. In some implementations, the electromagnet is activated only when the cleaning apparatus is in the third mode of operation.

In some implementations: said valve is a first valve of the cleaning apparatus; and the cleaning apparatus further comprises a second valve arranged within the handheld vacuum cleaner, the second valve configured to inhibit debris from falling out of the handheld vacuum debris container through the handheld vacuum dirty air inlet when the cleaning apparatus is in the first mode of operation. In some implementations, the second valve is arranged closer to the handheld vacuum dirty air inlet than the first valve. In some implementations: when the cleaning apparatus is in the first mode of operation, the second valve is in a first position in which the second valve blocks a flow passage that extends through the handheld vacuum dirty air inlet; the second valve is moved from said first position to a second position when the cleaning apparatus is transitioned from the first mode of operation to the second mode of operation; the second valve is moved from said first position to a third position when the cleaning apparatus is transitioned from the first mode of operation to the third mode of operation; and the second valve does not block said flow passage when in said second and third position. In some implementations, the second valve is pivotably connected to a portion of the handheld vacuum cleaner and is pivoted away from the handheld vacuum dirty air inlet when in said second position and is pivoted toward the handheld vacuum dirty air inlet when in said third position.

In some implementations, in the third mode of operation, the floor-based vacuum suction motor causes air to flow into the handheld vacuum cleaner via the handheld vacuum clean air outlet and/or an auxiliary air inlet of the handheld vacuum cleaner. In some implementations, in the third mode of operation, the floor-based vacuum suction motor causes air to flow into the handheld vacuum cleaner via both of the auxiliary air inlet and the handheld vacuum clean air outlet. In some implementations, the cleaning apparatus further comprises in the third mode of operation, an amount of air flowing into the handheld vacuum cleaner from the auxiliary air inlet is greater than an amount of air flowing into the handheld vacuum cleaner from the handheld vacuum clean air outlet.

In some implementations, the cleaning apparatus further comprises in the third mode of operation, a majority of air flowing out of the handheld vacuum cleaner via the handheld vacuum dirty air inlet comes from the auxiliary air inlet. In some implementations, the cleaning apparatus activates the handheld vacuum suction motor during at least a portion of said third mode of operation. In some implementations, during the third mode of operation: the cleaning apparatus activates the handheld vacuum suction motor for a first time period; and the cleaning apparatus activates the floor-based vacuum suction motor for a second time period. In some implementations, the first time period is less than the second time period. In some implementations, the first time period is between 1 and 5 seconds and the second time period is between 10 and 20 seconds. In some implementations, the cleaning apparatus activates the electromagnet during the third mode of operation.

Disclosed herein is a cleaning apparatus comprising: a first vacuum cleaner; and a second vacuum cleaner combinable with and separable from the first vacuum cleaner, each of the first and second vacuum cleaners operable to remove debris from a surface. The first vacuum cleaner comprises a first dirty air inlet, a first debris separator, a first debris container, a first suction motor, and a first clean air outlet. The second vacuum cleaner comprises a second dirty air inlet, a second debris separator, a second debris container, a second suction motor, and a second clean air outlet, wherein the second debris container comprises a smaller volume than the first debris container. The cleaning apparatus is configured to be transitioned between a first mode of operation, a second mode of operation, and a third mode of operation, and wherein: in the first mode of operation, the first suction motor causes air to flow through the first dirty air inlet, the first debris separator, and the first clean air outlet, thereby directing debris through the first dirty air inlet and into the first debris container; in the second mode of operation, the second suction motor causes air to flow through the second dirty air inlet, the second debris separator, and the second clean air outlet, thereby directing debris through the second dirty air inlet and into the second debris container; and in the third mode of operation, the first suction motor causes air to flow into and through the second vacuum cleaner and through the first dirty air inlet, the first debris separator, and the first clean air outlet, thereby directing debris from the second debris container into the first debris container.

In some implementations, the cleaning apparatus further comprises a cleaning head supportable by and movable with respect to said surface and comprising a cleaning head dirty air inlet, wherein: the first suction motor causes air to flow from the cleaning head dirty air inlet through the first dirty air inlet when the cleaning apparatus is in the first mode of operation; and the second suction motor causes air to flow from the cleaning head dirty air inlet through the second dirty air inlet when the cleaning apparatus is in the second mode of operation. In some implementations, the cleaning apparatus further comprises a wand connecting the second vacuum cleaner to the cleaning head, wherein: the second suction motor causes air to flow from the cleaning head dirty air inlet through the wand when the cleaning apparatus is in the second mode of operation; and the first suction motor causes air to flow from the second vacuum cleaner through the wand when the cleaning apparatus is in the third mode of operation. In some implementations, the wand is removably attached to at least one of the cleaning head and the second vacuum cleaner. In some implementations, the first vacuum cleaner is removably attachable to the cleaning head at least partially via the wand. In some implementations, the cleaning apparatus further comprises a support member connected to the cleaning head and configured to connect the wand to the cleaning head. In some implementations, the first vacuum cleaner is removably attachable to the cleaning head at least partially via the support member. In some implementations: each of the support member and the wand comprises an air flow passage; the first suction motor causes air to flow from the cleaning head dirty air inlet through the air flow passage of the support member when the cleaning apparatus is in the first mode of operation; the second suction motor causes air to flow from the cleaning head dirty air inlet through the air flow passages of the support member and wand when the cleaning apparatus is in the second mode of operation; and the first suction motor causes air to flow from the second vacuum cleaner through the air flow passages of the wand and support member when the cleaning apparatus is in the third mode of operation.

In some implementations, when the cleaning apparatus is in the third mode of operation, flow communication between the cleaning head dirty air inlet and each of the first and second vacuum cleaners is blocked. In some implementations, the cleaning apparatus further comprises a valve configured to block flow communication between the cleaning head dirty air inlet and each of the first and second vacuum cleaners when the cleaning apparatus is in the third mode of operation.

In some implementations, said valve is arranged within a portion of a support member connected to the cleaning head. In some implementations: the support member is pivotably connected to the cleaning head; said valve comprises a pivotable door configured to pivot between an open position and a closed position responsive to pivotable movement of the support member relative to the cleaning head; said valve is in said closed position when the cleaning apparatus is in the third mode of operation; and said valve is in said open position when the cleaning apparatus is in the first and second modes of operation. In some implementations, the wand and support member are configured to pivot together relative to the cleaning head. In some implementations, the first vacuum cleaner is detached from the cleaning head, support member, wand, and second vacuum cleaner when the cleaning apparatus is in the second mode of operation.

In some implementations, the second vacuum cleaner further comprises a valve configured to inhibit debris from falling out of the second debris container of the second vacuum cleaner, and wherein, when the cleaning apparatus in said first mode of operation, flow communication between the first and second debris containers is blocked by the valve. In some implementations, the valve is pivotably mounted within an air flow passage between the second debris container and the second dirty air inlet and configured to be moved to a closed position when the cleaning apparatus is transitioned to said first mode of operation and moved to an open position when the cleaning apparatus is transitioned to said third mode of operation. In some implementations, the valve is biased toward said closed position. In some implementations: the valve comprises an outer door and an inner door that is independently pivotable relative to the outer door, said outer door comprising an opening, said inner door configured to cover said opening when the valve is in said closed position; when the cleaning apparatus is in said second mode of operation, said inner door is in a first open position such that the opening of the outer door is not covered by the inner door and air flows from the cleaning head dirty air inlet through the opening of the outer door and the second debris container; and when the cleaning apparatus is in said third mode of operation, said inner door is pivoted to a second open position together with the outer door and air flows from the second vacuum cleaner past the inner and outer doors and to the first vacuum cleaner.

In some implementations, the cleaning apparatus further comprises: a first valve configured to block flow communication between the first and second vacuum cleaners when the cleaning apparatus is in said first mode of operation; and a second valve configured to block flow communication between the cleaning head dirty air inlet and each of the first and second vacuum cleaners when the cleaning apparatus is in said third mode of operation.

In some implementations, in the first mode of operation, the first and second vacuum cleaners are attached to one another but flow communication between the first and second debris containers is blocked.

Disclosed herein is a cleaning apparatus comprising: a floor-based vacuum cleaner removably attachable to at least one of a wand and a cleaning head, the cleaning head supportable by and movable with respect to a surface, the wand attachable to the cleaning head, the floor-based vacuum cleaner movable with the cleaning head to remove debris from said surface and comprising a floor-based vacuum dirty air inlet, a floor-based vacuum debris separator, a floor-based vacuum debris container, a floor-based vacuum suction motor, and a floor-based vacuum clean air outlet; and a handheld vacuum cleaner removably attachable to the wand, the handheld vacuum cleaner comprising a handheld vacuum dirty air inlet, a handheld vacuum debris separator, a handheld vacuum debris container, a handheld vacuum suction motor, and a handheld vacuum clean air outlet, wherein the handheld vacuum debris container comprises a smaller volume than the floor-based vacuum debris container. The cleaning apparatus is configured to be transitioned between at least a first mode of operation and a second mode of operation, wherein: in the first mode of operation, the floor-based vacuum suction motor causes air to flow from a cleaning head dirty air inlet of the cleaning head and through the floor-based vacuum dirty air inlet, the floor-based vacuum debris separator, and the floor-based vacuum clean air outlet, thereby directing debris from said surface through the floor-based vacuum dirty air inlet and into the floor-based vacuum debris container; and in second mode of operation, the handheld vacuum suction motor causes air to flow from the cleaning head dirty air inlet and through the handheld vacuum dirty air inlet, the handheld vacuum debris separator, and the handheld vacuum clean air outlet, thereby directing debris from said surface through the handheld vacuum dirty air inlet and into the handheld vacuum debris container.

In some implementations, the floor-based vacuum cleaner is detached from the cleaning head and wand when the cleaning apparatus is in said second mode of operation. In some implementations, when the cleaning apparatus is in said first mode of operation, flow communication between the floor-based vacuum cleaner and the handheld vacuum cleaner is blocked.

In some implementations, the cleaning apparatus further comprises a support member connected to the cleaning wand and configured to removably attach to the wand. In some implementations: each of the support member and the wand comprise an air flow passage; the floor-based vacuum suction motor causes air to flow from the cleaning head dirty air inlet through at least a portion of the air flow passage of the support member when the cleaning apparatus is in the first mode of operation; and the handheld vacuum suction motor causes air to flow from the cleaning head dirty air inlet through the air flow passages of the support member and wand when the cleaning apparatus is in the second mode of operation. In some implementations, the support member comprises a support member outlet configured to be in flow communication with the floor-based vacuum dirty air inlet when the cleaning apparatus is in said first mode of operation, and wherein the floor-based vacuum suction motor causes air to flow from the cleaning head dirty air inlet through the support member outlet and the floor-based vacuum dirty air inlet when the cleaning apparatus is in said first mode of operation. In some implementations: the floor-based vacuum cleaner is configured to removably attach to the cleaning head via said support member; the cleaning apparatus further comprises a lid configured to be moved between an open position when the floor-based vacuum cleaner is attached to said support member and a closed position when the floor-based vacuum cleaner is detached from said support member; and said lid closes the support member outlet when in said closed position. In some implementations, the floor-based vacuum cleaner further comprises a duct configured to connect to the support member outlet and provide flow communication between the floor-based vacuum dirty air inlet and the support member outlet when the floor-based vacuum cleaner is attached to the support member.

In some implementations, the cleaning apparatus is further configured to be transitioned to a third mode of operation in which the floor-based vacuum suction motor causes air to flow from the handheld vacuum cleaner through the wand, the floor-based vacuum dirty air inlet, the floor-based vacuum debris separator, and the floor-based vacuum clean air outlet, thereby directing debris from the handheld vacuum debris container into the floor-based vacuum debris container. In some implementations, when the cleaning apparatus is in the third mode of operation, flow communication between the cleaning head dirty air inlet and each of the floor-based and handheld vacuum cleaners is blocked. In some implementations, the cleaning apparatus further comprises a valve configured to block flow communication between the cleaning head dirty air inlet and each of the floor-based and handheld vacuum cleaners when the cleaning apparatus is in the third mode of operation. In some implementations, said valve is arranged within a portion of a support member of the cleaning apparatus that is connected to the cleaning head. In some implementations: the support member is pivotably connected to the cleaning head; the valve is configured to move between an open position and a closed position responsive to pivotable movement of the support member relative to the cleaning head; the valve is in said closed position when the cleaning apparatus is in the third mode of operation; and the valve is in said open position when the cleaning apparatus is in the first and second modes of operation. In some implementations, the wand and support member are configured to pivot together relative to the cleaning head. In some implementations: the valve is configured to move from said open position to said closed position when the wand and/or support member are pivoted from a first position to a second position; in said first position, a first axis extending through the wand is oriented at a first angle relative to a second axis that is perpendicular to a plane extending along a bottom portion of the cleaning head and/or said surface; in said second position, said first axis is oriented at a second angle relative to said second axis; and said second angle is less than said first angle. In some implementations, said second angle is between 0 degrees and 20 degrees. In some implementations, said first angle is between 20 degrees and 60 degrees.

In some implementations, the handheld vacuum cleaner further comprises a valve configured to inhibit debris from falling out of the handheld vacuum debris container, and wherein, when the cleaning apparatus is in said first mode of operation, flow communication between the floor-based vacuum debris container and the handheld vacuum debris container is blocked by the valve. In some implementations, the valve is pivotably mounted within an air flow passage between the handheld vacuum debris container and the handheld vacuum dirty air inlet and is configured to be moved to a closed position when the cleaning apparatus is transitioned to said first mode of operation and moved to an open position when the cleaning apparatus is transitioned to said third mode of operation. In some implementations, the valve is biased toward said closed position.

In some implementations, the handheld vacuum cleaner further comprises one or more actuators configured to move the valve to said open position when the cleaning apparatus is transitioned from the first mode of operation to the third mode of operation. In some implementations, the wand comprises one or more actuators configured to engage the one or more actuators of the handheld vacuum cleaner to move the valve to said open position when the cleaning apparatus is transitioned from the first mode of operation to the third mode of operation. In some implementations, the cleaning apparatus further comprises a support member connected to the cleaning head and further configured to removably attach to the wand, wherein the support member comprises one or more actuators configured to engage the one or more actuators of the wand and cause the one or more actuators of the wand to engage the one or more actuators of the handheld vacuum cleaner to move the valve to said open position when the cleaning apparatus is transitioned from the first mode of operation to the third mode of operation. In some implementations: the floor-based vacuum cleaner is configured to removably attach to the support member; and the one or more actuators of the support member do not engage the one or more actuators of the wand unless the floor-based vacuum cleaner is attached to the support member. In some implementations: the support member is pivotably connected to the cleaning head; the wand and support member are configured to pivot together relative to the cleaning head between at least a first position and a second position; and the one or more actuators of the support member do not engage the one or more actuators of the wand unless the floor-based vacuum cleaner is attached to the support member and the wand and support member are in said second position. In some implementations: in said first position, a first axis extending through the wand is oriented at a first angle relative to a second axis that is perpendicular to a plane extending along a bottom portion of the cleaning head and/or said surface; in said second position, said first axis is oriented at a second angle relative to said second axis; and said second angle is less than said first angle. In some implementations, said second angle is between 0 degrees and 20 degrees. In some implementations, said first angle is between 20 degrees and 60 degrees. In some implementations, the wand comprises a conduit and/or housing, and wherein at least one of the one or more actuators of the wand are arranged within said conduit and/or housing. In some implementations: the valve comprises an outer door and an inner door that is independently pivotable relative to the outer door, said outer door comprising an opening, said inner door configured to cover said opening when the valve is in said closed position; when the cleaning apparatus is in said second mode of operation, said inner door is in a first open position such that the opening of the outer door is not covered by the inner door and air flows from the cleaning head dirty air inlet through the opening of the outer door and the second debris container; and when the cleaning apparatus is transitioned to said third mode of operation, said inner door is pivoted to a second open position together with the outer door and air flows from the second vacuum cleaner past the inner and outer doors and to the first vacuum cleaner.

In some implementations, the cleaning apparatus further comprises: a first valve configured to be moved between a closed position and an open position, said first valve in said closed position when the cleaning apparatus is in the first mode of operation and in said open position when the cleaning apparatus is in the second mode of operation, wherein the first valve blocks flow communication between the floor-based vacuum debris container and the handheld vacuum debris container when in said closed position; and a second valve configured to be moved between a closed position and an open position, said second valve in said closed position when the cleaning apparatus is in the third mode of operation and in said open position when the cleaning apparatus is in the first and second modes of operation, wherein the second valve blocks flow communication between the cleaning head dirty air inlet and each of the floor-based and handheld vacuum cleaners when in said closed position. In some implementations, the first valve is automatically moved from said closed position to said open position when the cleaning apparatus is transitioned from the first mode of operation to the third mode of operation. In some implementations, the first valve is automatically moved from said closed position to said open position when the wand, handheld vacuum cleaner, floor-based vacuum cleaner, and support member are rotated relative to the cleaning head from a first position to a second position. In some implementations, the second valve is automatically moved from said open position to said closed position when the cleaning apparatus is transitioned from the first mode of operation to the third mode of operation. In some implementations, the second valve is automatically moved from said open position to said closed position when the wand, handheld vacuum cleaner, floor-based vacuum cleaner, and support member are rotated relative to the cleaning head from a first position to a second position. In some implementations: in said first position, a first axis extending through the wand is oriented at a first angle relative to a second axis that is perpendicular to a plane extending along a bottom portion of the cleaning head and/or said surface; in said second position, said first axis is oriented at a second angle relative to said second axis; and said second angle is less than said first angle. In some implementations, said second angle is between 0 degrees and 20 degrees. In some implementations, said first angle is between 20 degrees and 60 degrees.

Disclosed herein is a cleaning apparatus comprising: a first vacuum cleaner; and a second vacuum cleaner combinable with and separable from the first vacuum cleaner, each of the first and second vacuum cleaners operable to remove debris from a surface. The first vacuum cleaner comprises a first dirty air inlet, a first debris separator, a first debris container, a first suction motor, and a first clean air outlet. The second vacuum cleaner comprises a second dirty air inlet, a second debris separator, a second debris container comprising a smaller volume than the first debris container, a second suction motor, a second clean air outlet, an auxiliary air inlet, and a bleed valve configured to be transitioned from a first state in which the auxiliary air inlet is closed to a second state in which the auxiliary air inlet is open. The cleaning apparatus is configured to operate in a mode of operation in which: the bleed valve is in said second state; and the first suction motor causes air to flow through the auxiliary air inlet, the second debris container, the first dirty air inlet, the first debris separator, and the first clean air outlet, thereby directing debris from the second debris container into the first debris container.

In some implementations, said mode of operation is a third mode of operation of the cleaning apparatus, and wherein the cleaning apparatus is further configured to operate in: a first mode of operation in which the first suction motor causes air to flow through the first dirty air inlet, the first debris separator, and the first clean air outlet, thereby directing debris through the first dirty air inlet and into the first debris container; and in a second mode of operation in which the second suction motor causes air to flow through the second dirty air inlet, the second debris separator, and the second clean air outlet, thereby directing debris through the second dirty air inlet and into the second debris container. In some implementations, the bleed valve is configured to transition from said first state to said second state when the cleaning apparatus is in said second mode of operation and a pressure within the second vacuum cleaner is greater than or equal to a threshold. In some implementations, the bleed valve is biased toward said first state. In some implementations, the cleaning apparatus further comprises a cleaning head supportable by and movable with respect to said surface and comprising a cleaning head dirty air inlet, wherein: the first suction motor causes air to flow from the cleaning head dirty air inlet through the first dirty air inlet when the cleaning apparatus is in the first mode of operation; and the second suction motor causes air to flow from the cleaning head dirty air inlet through the second dirty air inlet when the cleaning apparatus is in the second mode of operation. In some implementations, the cleaning apparatus further comprises a wand connecting the second vacuum cleaner to the cleaning head, wherein: the second suction motor causes air to flow from the cleaning head dirty air inlet through the wand when the cleaning apparatus is in the second mode of operation; and the first suction motor causes air to flow from the second vacuum cleaner through the wand when the cleaning apparatus is in the third mode of operation. In some implementations, the cleaning apparatus further comprises a support member connected to the cleaning head and the wand. In some implementations, the cleaning apparatus further comprises a valve configured to block flow communication between the cleaning head dirty air inlet and each of the first and second vacuum cleaners when the cleaning apparatus is in the third mode of operation. In some implementations, the cleaning apparatus further comprises a support member connected to the cleaning head and said wand, wherein said valve is arranged within a portion of the support member.

Disclosed herein is a cleaning apparatus comprising: a cleaning head configured to be supported by and moved with respect to a floor surface, the cleaning head comprising a dirty air inlet for collecting debris from the floor surface; a floor-based vacuum cleaner; a handheld vacuum cleaner; and a valve assembly configured to provide a first air flow path between the dirty air inlet and the floor-based vacuum cleaner, a second air flow path between the dirty air inlet and the handheld vacuum cleaner, and a third air flow path between the handheld vacuum cleaner and the floor-based vacuum cleaner. In some implementations: the valve assembly is configured to open and close the first, second, and third air flow paths; the valve assembly is configured to be transitioned between a first configuration, a second configuration, and a third configuration; in the first configuration, the first air flow path is open and the second and third air flow paths are closed, thereby allowing debris from the dirty air inlet to be directed to the floor-based vacuum cleaner; in second configuration, the second air flow path is open and the first and third air flow paths are closed, thereby allowing debris from the dirty air inlet to be directed to the handheld vacuum cleaner; and in third configuration, the third air flow path is open and the first and second air flow paths are closed, thereby allowing debris from the handheld vacuum cleaner to be directed to the floor-based vacuum cleaner.

Disclosed herein is a cleaning apparatus comprising: a cleaning head configured to be supported by and moved with respect to a floor surface, the cleaning head comprising a dirty air inlet for collecting debris from the floor surface; a floor-based vacuum cleaner; a handheld vacuum cleaner; and a valve assembly configured to provide a first air flow path between the dirty air inlet and the floor-based vacuum cleaner, a second air flow path between the dirty air inlet and the handheld vacuum cleaner, and a third air flow path between the floor-based vacuum cleaner and the handheld vacuum cleaner. In some implementations: the valve assembly is configured to open and close the first, second, and third air flow paths; the valve assembly is configured to be transitioned between a first configuration, a second configuration, and a third configuration; in the first configuration, the first air flow path is open and the second and third air flow paths are closed, thereby allowing debris from the dirty air inlet to be directed to the floor-based vacuum cleaner; in second configuration, the second air flow path is open and the first and third air flow paths are closed, thereby allowing debris from the dirty air inlet to directed to the handheld vacuum cleaner; in third configuration, the third air flow path is open and the first and second air flow paths are closed, thereby allowing debris from the handheld vacuum cleaner to be directed to the floor-based vacuum cleaner.

Disclosed herein is a handheld vacuum cleaner comprising: a housing comprising an interior; a dirty air inlet; a debris separator arranged within the housing and configured to separate debris from air flowing through the dirty air inlet; a debris container configured to receive debris separated by the debris separator; a clean air outlet; a suction motor configured to cause air to flow through the dirty air inlet, the debris separator, and the clean air outlet; a valve arranged within the interior of the housing, wherein, in a first position, the valve resists a weight of debris that have fallen from the debris container onto the valve under force of gravity. In some implementations: the valve is configured to pivot from said first position to a second position responsive to air flow in a first direction, the valve pivoting away from the dirty air inlet when pivoting from said first position to said second position; the valve is configured to pivot from said first position to a third position responsive to air flow in a second direction, the valve pivoting toward the dirty air inlet when pivoting from said first position to said third position; and a greater force is required to cause the valve to pivot from said first position to said third position than from said first position to said second position.

Disclosed herein is a cleaning apparatus comprising a handheld vacuum cleaner, a cleaning head, and a floor-based vacuum cleaner. The handheld vacuum cleaner can include any of the features described with respect to any of the handheld vacuum cleaners disclosed herein. The floor-based vacuum cleaner can include any of the features described with respect to any of the floor-based vacuum cleaners disclosed herein. The cleaning head can include any of the features described with respect to any of the cleaning head disclosed herein. The cleaning apparatus can include a wand, and such wand can include any of the features described with respect to any of the wands disclosed herein. The cleaning apparatus can include a support member, and such support member can include any of the features described with respect to any of the support members disclosed herein.

Disclosed herein is handheld vacuum cleaner, and such handheld vacuum cleaner can include any of the features described with respect to any of the handheld vacuum cleaners disclosed herein For purposes of summarizing the disclosure, certain aspects, advantages, and novel features are discussed herein. It is to be understood that not necessarily all such aspects, advantages, or features will be embodied in any particular implementation of the disclosure, and an artisan would recognize from the disclosure herein a myriad of combinations of such aspects, advantages, or features.

BRIEF DESCRIPTION OF THE DRAWINGS

Certain features of this disclosure are described below with reference to the drawings. The illustrated implementations are intended to illustrate, but not to limit, the implementations. Various features of the different disclosed implementations can be combined to form further implementations, which are part of this disclosure.

FIGS. 6A-6F illustrate another implementation of a cleaning apparatus in different modes in accordance with aspects of this disclosure.

FIGS. 10D-10L illustrate portions of the cleaning apparatus of FIGS. 10A-10C in different modes of operation in accordance with aspects of this disclosure.

FIGS. 16Y-16DD illustrate various views of a handheld vacuum cleaner of the cleaning apparatus of FIGS. 16A-16C in accordance with aspects of this disclosure.

FIGS. 16EE-16JJ illustrate various views of the cleaning apparatus of FIGS. 16A-16C in different modes of operation in accordance with aspects of this disclosure.

FIG. 16KK illustrates a table showing various schematic representations and enlarged views of portions of the cleaning apparatus of FIGS. 16A-16C in different modes of operation in accordance with aspects of this disclosure.

FIGS. 16LL-16VV illustrate various views of actuators and actuator mechanisms of the cleaning apparatus of FIGS. 16A-16C and portions of the cleaning apparatus in accordance with aspects of this disclosure.

FIGS. 16WW-16XX illustrate a valve of the handheld vacuum cleaner of FIGS. 16Y-16DD in accordance with aspects of this disclosure.

FIGS. 17Z-17KK illustrates various views of actuators and actuator mechanisms of the cleaning apparatus of FIGS. 17A-17C and portions of the cleaning apparatus in accordance with aspects of this disclosure.

DETAILED DESCRIPTION

Figure 1C:
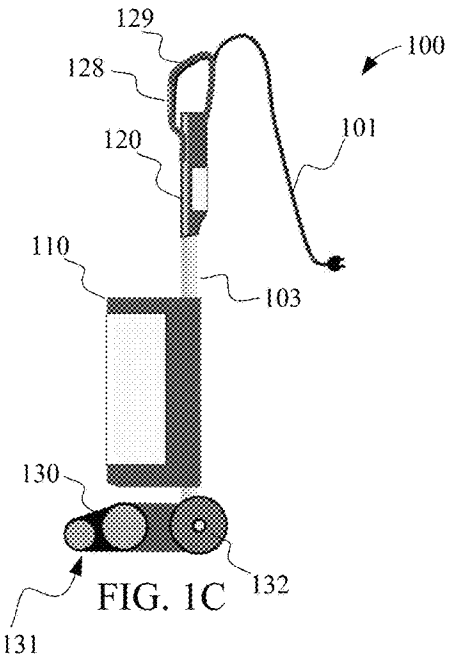
FIGS. 1A-1E illustrate various views of a cleaning apparatus or portions thereof in different modes of operation in accordance with aspects of this disclosure.

Various features and advantages of this disclosure will now be described with reference to the accompanying figures. The following description is merely illustrative in nature and is in no way intended to limit the disclosure, its application, or uses. This disclosure extends beyond the specifically disclosed implementations and/or uses and obvious modifications and equivalents thereof. Thus, it is intended that the scope of this disclosure should not be limited by any particular implementations described below. The features of the illustrated implementations can be modified, combined, removed, and/or substituted as will be apparent to those of ordinary skill in the art upon consideration of the principles disclosed herein.

FIGS. 1A-1E illustrate an example cleaning apparatus 100, or portions thereof, in various modes of operation and use as described below. Cleaning apparatus 100 can include a first vacuum cleaner 110 (which may be referred to as a "floor-based vacuum cleaner"), a second vacuum cleaner 120 (which may be referred to as a "handheld vacuum cleaner"), and a cleaning head 130 (which may be referred to as a "surface cleaning head" or "floor nozzle").

Floor-based vacuum cleaner 110, handheld vacuum cleaner 120, and cleaning head 130 can be attached and/or attachable (for example, removably attachable) to one another. Cleaning apparatus 100 can include various components to connect (mechanically, electrically, and/or fluidly) floor-based vacuum cleaner 110, handheld vacuum cleaner 120, and cleaning head 130 together. In some implementations, cleaning apparatus 100 includes a wand 103. Wand 103 can be configured to connect and/or connect to any or all of the floor-based vacuum cleaner 110, handheld vacuum cleaner 120, and cleaning head 130. Wand 103 can be elongated and/or tubular, for example, comprising a conduit and an airflow passage. Wand 103 can be extendable (for example, telescopic) or non-extendable. Wand 103 can be configured to facilitate attachment of any or all of floor-based vacuum cleaner 110, handheld vacuum cleaner 120, and cleaning head 130 to one another. For example, any or all of floor-based vacuum cleaner 110, handheld vacuum cleaner 120, and cleaning head 130 can be directly attachable to wand 103 or indirectly attachable to wand 103 (for example, via a separate component). Cleaning apparatus 100 can include a valve assembly similar or identical to any of the valve assemblies described herein, and any or all of floor-based vacuum cleaner 110, handheld vacuum cleaner 120, and cleaning head 130 can be attachable to wand 103 via such valve assembly. In some implementations, cleaning apparatus 100 includes a support member 105 (which also may be referred to as a "support", "support structure", or "neck") that is connected to cleaning head 130 (see FIGS. 1A, 1C, and 1E). In some of such implementations, support member 105 is configured to connect and/or connect to cleaning head 130, floor-based vacuum cleaner 110, and/or wand 103. In some implementations, support member 105 forms a unitary structure with cleaning head 130. In some of such implementations, support member 105 is pivotable relative to cleaning head 130. In some implementations, wand 103 is removably attachable to support member 105 and/or floor-based vacuum cleaner 110 is removably attachable to support member 105. As mentioned previously, cleaning apparatus 100 can include a valve assembly similar or identical to any of the valve assemblies described herein (for example, valve assembly 340, 440, 540). In some of such implementations, support 105 can connect to such valve assembly, and the valve assembly can connect to floor-based vacuum cleaner 110 and wand 103. In some implementations, such valve assembly is connected between floor-based vacuum cleaner 110, handheld vacuum cleaner 120, and cleaning head 130. For example, in some implementations, such valve assembly is configured to connect: to cleaning head 130 via support member 105; to floor-based vacuum cleaner 110; and/or to handheld vacuum cleaner 120 via wand 103. Wand 103, support member 105, and such valve assembly can facilitate mechanical, electrical, and fluid/flow communication between floor-based vacuum cleaner 110, handheld vacuum cleaner 120, and/or cleaning head 130 in order to allow cleaning apparatus 100 to utilize various modes of operation as described herein.

Cleaning head 130 can be supported by and/or movable with respect to a floor surface. For example, cleaning head 130 can include one or more or a plurality of wheels 132 for supporting and/or moving cleaning head 130, and any other components of cleaning apparatus 100 attached to cleaning head 130, with respect to the floor surface. Cleaning head 130 can include a dirty air inlet 131 for receiving debris from the floor surface. In some implementations, cleaning head 130 includes one or more agitators, for example, at least partially disposed in one or more agitator chambers. Such agitators can be similar or identical to agitator(s) 334 described with respect to FIG. 3E below. Cleaning head 130 can include one or more or a plurality of motors to drive wheel(s) 132 and/or agitator(s) of cleaning head 130. Such motors can be similar or identical to motor(s) 333 described with respect to FIG. 3E below. In some implementations, cleaning head 130 includes a power source (for example rechargeable or non-rechargeable batteries) that can be utilized to provide power to motor(s) of cleaning head 130. Additionally or alternatively, cleaning head 130 can be configured to receive power from another component of cleaning apparatus 100, for example, floor-based vacuum cleaner 110 or handheld vacuum cleaner 120, either or all of which may receive power (for example, AC power) via a cord 101. Cleaning head 130 can include a housing configured to at least partially enclose one or more components of cleaning head 130, and such housing can be connected to wheel(s) 132 of cleaning head 130. In various implementations and/or modes of operation of cleaning apparatus 100, cleaning head 130 may serve as an initial entry point for receiving debris from surface (for example, a floor surface). In such implementations, cleaning head 130 can be configured to direct such debris to and/or toward floor-based vacuum cleaner 110 and/or handheld vacuum cleaner 120. As mentioned previously, cleaning head 130 can include dirty air inlet 131. Cleaning head 130 can include one or more flow conduits (for example, within a housing of cleaning head 130) in flow communication with such dirty air inlet 131 and configured to direct debris to and/or toward floor-based vacuum cleaner 110 and/or handheld vacuum cleaner 120. As mentioned previously, cleaning apparatus 100 can include a support member 105 connected to cleaning head 130. Such support member 105 can be in flow communication with the dirty air inlet 131 of cleaning head 130, for example, via such one or more flow conduits of cleaning head 130. Cleaning apparatus 100 can be configured such that support member 105 is also in flow communication with a dirty air inlet 131 of floor-based vacuum cleaner 110 and/or a dirty air inlet of handheld vacuum cleaner 120, for example, during at least some modes of operation of cleaning apparatus 100. As described further below, cleaning apparatus 100 can include a valve assembly that can enable or disable flow communication between cleaning head 130, floor-based vacuum cleaner 110, and/or handheld vacuum cleaner 120. In some of such configurations, support member 105 can be connected and/or connectable to such valve assembly.

Floor-based vacuum cleaner 110 can include any of a variety of components that enable floor-based vacuum cleaner 110 to receive, separate, and collect debris from air. Floor-based vacuum cleaner 110 can include any or all of the components shown and/or described with respect to vacuum cleaner 310 in FIG. 3F. For example, floor-based vacuum cleaner 110 can include a dirty air inlet, a clean air outlet, a suction motor, a debris separator, and a debris container, each of which can be similar or identical to dirty air inlet 311, clean air outlet 312, suction motor 313, debris separator 314, and debris container 315, respectively. Floor-based vacuum cleaner 110 can be configured to receive power from another component of cleaning apparatus 100, for example, handheld vacuum cleaner 120, which may receive power via cord 101. In some variants, floor-based vacuum cleaner 110 includes a power source (for example rechargeable or non-rechargeable batteries) that can be utilized to provide power to components of floor-based vacuum cleaner 110 (for example, a suction motor and/or debris separator of floor-based vacuum cleaner 110). In some implementations, handheld vacuum cleaner 120 receives power from cord 101 and floor-based vacuum cleaner 110 includes one or more rechargeable batteries that automatically recharge when floor-based vacuum cleaner 110 is connected with handheld vacuum cleaner 120. In such cases, handheld vacuum cleaner 120 can include a charger controller configured to control such charging of the rechargeable batteries of floor-based vacuum cleaner 110 when handheld vacuum cleaner 120 and floor-based vacuum cleaner 110 are connected. In some implementations, floor-based vacuum cleaner 110 is connected with a power cord and is configured to charge one or more rechargeable batteries in handheld vacuum cleaner 120 when handheld vacuum cleaner 120 and floor-based vacuum cleaner 110 are connected. In such implementations, floor-based vacuum cleaner 110 may be configured to recharge the batteries associated with handheld vacuum cleaner 120 when floor-based vacuum cleaner 110 is coupled to an AC power source. The handheld vacuum cleaner 120 may therefore be disconnected from floor-based vacuum cleaner 110 and operated using the batteries associated with handheld vacuum cleaner 120 independently from floor-based vacuum cleaner 110. In some implementations, cleaning apparatus 100 is configured to derive power for operating in any of the modes of operation described here by drawing on power from batteries from either or both of handheld vacuum cleaner 120 and floor-based vacuum cleaner 110, which may further extend operation time of the cleaning apparatus 100. Floor-based vacuum cleaner 110 can include a housing configured to at least partially enclose any or all components of floor-based vacuum cleaner 110.

Handheld vacuum cleaner 120 can include any of a variety of components that enable handheld vacuum cleaner 120 to receive, separate, and collect debris from air. Handheld vacuum cleaner 120 can include any or all of the components shown and/or described with respect to vacuum cleaner 320 in FIG. 3G. For example, handheld vacuum cleaner 120 can include a dirty air inlet, a clean air outlet, a suction motor, a debris separator, and a debris container, each of which can be similar or identical to dirty air inlet 321, clean air outlet 322, suction motor 323, debris separator 324, and debris container 325, respectively. Handheld vacuum cleaner 120 can be configured to receive power from an external power source, for example, via a cord 101. Cord 101 can have a variety of lengths, for example, 5 ft, 10 ft, 15 ft, 20 ft, 25 ft, 20 ft, or 35 ft. In some implementations of cleaning apparatus 100, handheld vacuum cleaner 120 provides power to floor-based vacuum cleaner 110 and/or cleaning head 130, for example, in a similar or identical manner as that described with respect to cleaning apparatus 200 below. For example, in some implementations, handheld vacuum cleaner 120 provides power to a suction motor and/or debris separator of floor-based vacuum cleaner 110 and/or wheel(s), agitator(s), and/or motor(s) of cleaning head 130. In some variants, handheld vacuum cleaner 120 includes a power source (for example rechargeable or non-rechargeable batteries) that can be utilized to provide power to handheld vacuum cleaner 120 and/or floor-based vacuum cleaner 110 and/or cleaning head 130. Handheld vacuum cleaner 120 can include a housing configured to at least partially enclose any or all components of floor-based vacuum cleaner 110. Handheld vacuum cleaner 120 can include a handle 129 coupled to or formed as part of such housing. Handle 129 may be arcuate, for example, coupled at two points to the housing. In some implementations, handle 129 is pistol-shaped (for example, extending from one point of such housing). Such pistol-shaped handle may extend along a longitudinal axis of the housing of handheld vacuum cleaner 120 or at an acute angle relative to such longitudinal axis. As shown, handheld vacuum cleaner 120 can include user input device or controls 128 on a portion of such housing or handle 129. Handheld vacuum cleaner 120 can include a controller for controlling operation of handheld vacuum cleaner 120, floor-based vacuum cleaner 110, and/or cleaning head 130. Such controller can be similar or identical to controller 327 of vacuum cleaner 320 described with respect to FIG. 3G. Handheld vacuum cleaner 120 can additionally include controls 128 (including, for example, one or more buttons) for allowing a user to control operation of handheld vacuum cleaner 120, floor-based vacuum cleaner 110, and/or cleaning head 130. Controls 128 can be similar or identical to input device(s) or controls 328 described with respect to FIG. 3G. As an example, controls 128 can allow a user to turn a suction motor of handheld vacuum cleaner 120 or floor-based vacuum cleaner 110 "on" or "off" (for example, independently) and/or activate one or more motors of cleaning head 130 to rotate agitator(s) of cleaning head 130 and/or drive wheel(s) 132 of cleaning head 130.

Figure 1B:
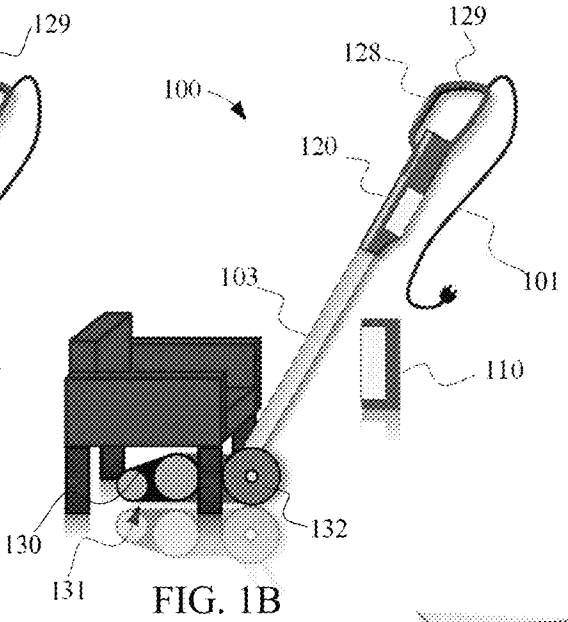
Figure 1E:
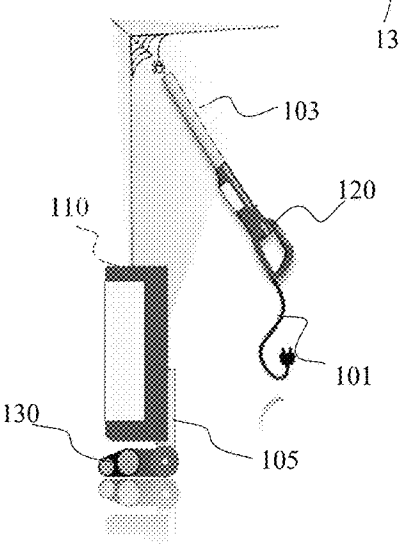
Figure 1A:
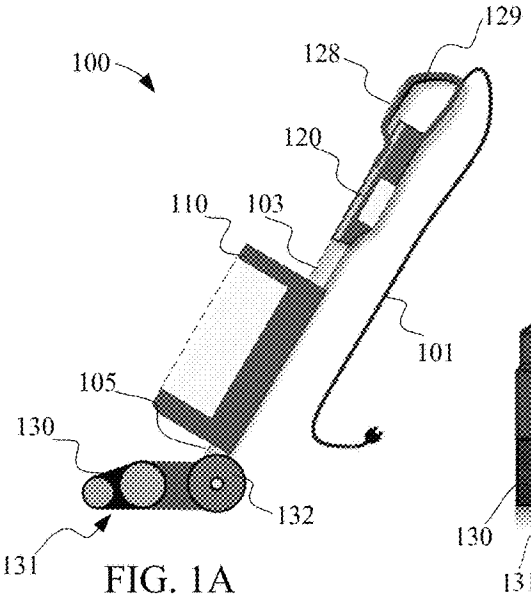

FIGS. 1A-1C illustrate cleaning apparatus 100 in different example modes of operation. FIG. 1A illustrates a mode of operation which may be referred to as an "upright cleaning mode" or "upright mode". In such mode, floor-based vacuum cleaner 110, handheld vacuum cleaner 120, and cleaning head 130 are attached to one another and are supported by and movable with respect to a surface. In such upright cleaning mode, cleaning apparatus 100 utilizes floor-based vacuum cleaner 110 to remove debris from the floor surface. In the upright cleaning mode, debris can be directed from cleaning head 130 to floor-based vacuum cleaner 110 (for example, at least partially via support member 105 and/or wand 103). FIG. 1B illustrates cleaning apparatus 100 in a mode of operation in which floor-based vacuum cleaner 110 is detached from handheld vacuum cleaner 120 and cleaning head 130 (for example, detached from wand 103 and/or support member 105). In such mode, which may be referred to as a "stick cleaning mode" or "stick mode", cleaning apparatus 100 utilizes handheld vacuum cleaner 120 to remove debris from the floor surface. In such mode, debris can be directed from cleaning head 130 to handheld vacuum cleaner 120 (for example, at least partially via support member 105 and/or wand 103). As illustrated in FIG. 1B, such cleaning mode can advantageously allow cleaning apparatus 100 to more easily maneuver under and/or around furniture, among other objects or obstacles. FIG. 1C illustrates cleaning apparatus 100 in a mode of operation in which floor-based vacuum cleaner 110 and handheld vacuum cleaner 120 are attached to one another. As illustrated, floor-based vacuum cleaner 110 and handheld vacuum cleaner 120 can also be attached to cleaning head 130 and support member 105 in such mode. In such mode, which may be referred to as an "empty mode" or "auto-empty mode", debris from handheld vacuum cleaner 120 can be transferred to ("emptied into") floor-based vacuum cleaner 110. For example, in such mode, debris from a debris container of handheld vacuum cleaner 120 can be transferred to a debris container of floor-based vacuum cleaner 110. This can be especially advantageous in cases where the debris container of handheld vacuum cleaner 120 is smaller than the debris container of floor-based vacuum cleaner 110. In some implementations, the debris container of floor-based vacuum cleaner 110 is at least 20%, at least 30%, at least 40%, at least 50%, at least 60%, at least 70%, at least 80%, at least 90%, at least 100%, at least 150%, at least 200%, at least 250%, or at least 300% larger (for example, by volume) than the debris container of handheld vacuum cleaner 120, or any value or range within or bounded by any of these values or ranges.

Cleaning apparatus 100 can include one or more valves and/or a valve assembly to facilitate transitioning between the upright cleaning mode, stick cleaning mode, and auto-empty mode. By way of non-limiting example, cleaning apparatus 100 can include valves similar to those described with respect to FIGS. 14A-14LL, one of which can be arranged in handheld vacuum cleaner 120 and the other of which can be arranged within support member 105. As another example, cleaning apparatus 100 can include valves similar to valves 1680, 1690 shown and/or described with respect to at least FIGS. 16EE-16KK and/or valves 1780, 1790 shown and/or described with respect to at least FIGS. 17CC and 17II-17KK, one of which can be arranged in handheld vacuum cleaner 120 and the other of which can be arranged within support member 105. As another example, cleaning apparatus 100 can include any of the valves described and/or illustrated with respect to cleaning apparatus 1800, 1900, 2200 and/or handheld vacuum cleaner 1820, 1920, 2020, 2120, 2220. As another example, cleaning apparatus 100 can include a valve assembly that is similar or identical to valve assembly 340 shown and described with respect to FIGS. 3A-3D. Such valve assembly can be configured to connect and/or connect to various components of cleaning apparatus 100. For example, such valve assembly can be connected to or connectable with cleaning head 130 (for example, via support member 105), floor-based vacuum cleaner 110, and/or handheld vacuum cleaner 120 (for example, via wand 103). Such valve assembly can be configured to open and close flow paths between cleaning head 130, floor-based vacuum cleaner 110, and handheld vacuum cleaner 120, wand 103, and/or support member 105. For example, such valve assembly can be transitionable between a plurality of configurations, each of which enables or disables flow communication between any two of cleaning head 130, floor-based vacuum cleaner 110, and handheld vacuum cleaner 120. For example, to allow cleaning apparatus 100 to operate in the above-described upright cleaning mode, such valve assembly can: enable flow communication between cleaning head 130 (for example, dirty air inlet 131) and floor-based vacuum cleaner 110; disable flow communication between cleaning head 130 (for example, dirty air inlet 131) and handheld vacuum cleaner 120; and disable flow communication between floor-based vacuum cleaner 110 and handheld vacuum cleaner 120. In implementations of cleaning apparatus 100 that include support member 105, the valve assembly can facilitate flow communication between dirty air inlet 131 of cleaning head 130, support member 105, and floor-based vacuum cleaner 110 in such an upright cleaning mode. As mentioned previously, floor-based vacuum cleaner 110 is detached from cleaning apparatus 100 when cleaning apparatus 100 is in the stick cleaning mode (see FIG. 1B). In such mode, the valve assembly can close a flow path that would otherwise be open if floor-based vacuum cleaner 110 was attached to cleaning apparatus 100 and enable flow communication between cleaning head 130 (for example, dirty air inlet 131) and handheld vacuum cleaner 120. In implementations of cleaning apparatus 100 that include support member 105 and/or wand 103, the valve assembly can facilitate flow communication between dirty air inlet 131 of cleaning head 130, support member 105, wand 103, and handheld vacuum cleaner 120 during the stick cleaning mode. As another example, to allow cleaning apparatus 100 to operate in the above-described empty mode, such valve assembly can: disable flow communication between cleaning head 130 (for example, dirty air inlet 131) and both of floor-based vacuum cleaner 110 and handheld vacuum cleaner 120; and enable flow communication between floor-based vacuum cleaner 110 and handheld vacuum cleaner 120. In implementations of cleaning apparatus 100 that include wand 103, the valve assembly can facilitate flow communication between floor-based vacuum cleaner 110, wand 103, and handheld vacuum cleaner 120 during the empty mode of operation. In some implementations, the empty mode of operation may be initiated by a user (for example, by pressing a button) and/or may be automatically initiated, for example, based on feedback from one or more sensors within the handheld vacuum cleaner 120 configured to detect an amount of debris in a debris container of handheld vacuum cleaner 120 and/or a fill level of such debris container. In some implementations, the empty mode of operation can be automatically initiated when attaching handheld vacuum cleaner 120 to floor-based vacuum cleaner 110.

Figure 1D:
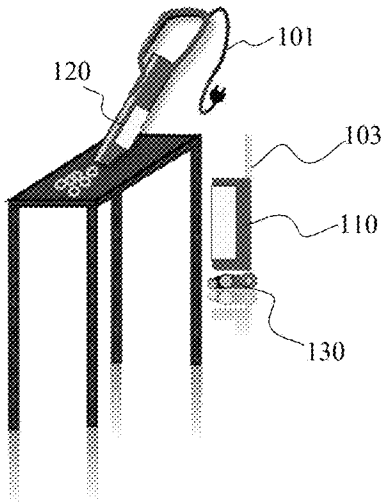

With reference to FIGS. 1D-1E, in some implementations, handheld vacuum cleaner 120 is removably attachable to wand 103, floor-based vacuum cleaner 110, and/or cleaning head 130. For example, handheld vacuum cleaner 120 can be removably attachable to wand 103 and can be utilized to collect debris from a table or other surface or region, as illustrated in FIG. 1D. As another example, handheld vacuum cleaner 120 and wand 103 can be removable from floor-based vacuum cleaner 110, cleaning head 130, and/or support member 105 and be utilized to remove debris from a wall and/or ceiling surface or region, as illustrated in FIG. 1E.

In some variants, cleaning apparatus 100 utilizes floor-based vacuum cleaner 110 along with handheld vacuum cleaner 120 for debris collection in the upright cleaning mode, and debris can be directed to, separated by, and collected by each of floor-based vacuum cleaner 110 and handheld vacuum cleaner 120.

In some implementations, cleaning apparatus 100 is configured to be secured, coupled, or otherwise mounted to a docking station. The docking station may be configured to recharge any of batteries associated with cleaning apparatus 100 (for example, batteries associated with handheld vacuum cleaner 120 and/or floor-based vacuum cleaner 110). The docking station may also be configured to automatically empty a debris container of the floor-based vacuum cleaner 110 and/or a debris container of handheld vacuum cleaner 120. Examples of docking stations which may be used to automatically empty a debris container of the floor-based vacuum cleaner 110 and/or a debris container of the handheld vacuum cleaner 120 are described in US 2024/0008699 A1, PCT/CN2024/102184 filed on Jun. 28, 2024, U.S. patent application Ser. No. 18/786,439, filed Jul. 27, 2024, WO 2024/216567 A1, US 2024/0349965 A1, WO 2024/055224 A1, U.S. Pat. No. 11,896,190 B1, all of which are incorporated by reference herein in their entireties. For example, cleaning apparatus 100 and such docking station may be configured to draw debris from a debris container of the floor-based vacuum cleaner 110, through wand 103, through a debris container of handheld vacuum cleaner 120 and into the docking station using, for example, just a suction motor of handheld vacuum cleaner 120, just a suction motor of floor-based vacuum cleaner 110, just a suction motor associated with the docking station, or any combination of these three suction motors.

Figure 2B:
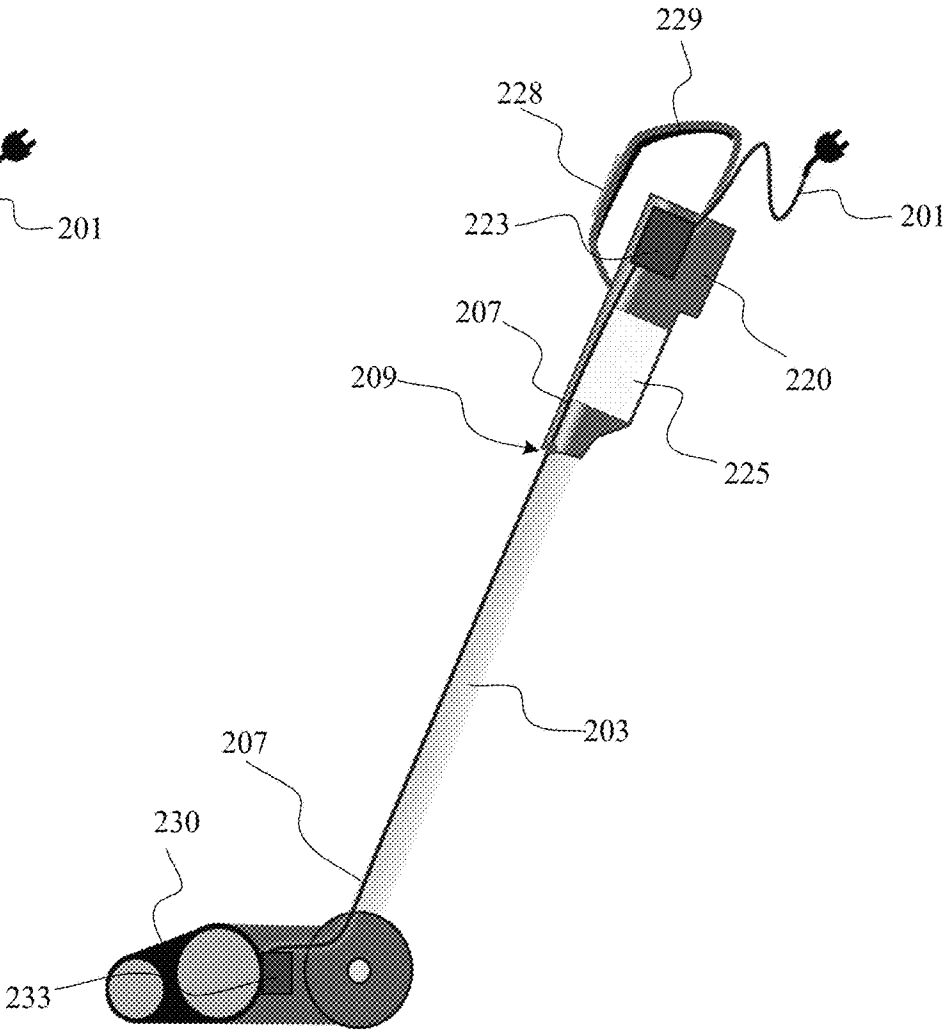
FIGS. 2A-2E illustrate various views of another implementation of a cleaning apparatus or portions thereof in different modes of operation in accordance with aspects of this disclosure.

FIGS. 2A-2E illustrate another example cleaning apparatus 200. Cleaning apparatus 200 can be similar or identical to cleaning apparatus 100 in some or many respects. For example, cleaning apparatus 200 can include a cleaning head 230, a floor-based vacuum cleaner 210, and a handheld vacuum cleaner 220, which can be similar or identical to cleaning head 130, floor-based vacuum cleaner 110, and handheld vacuum cleaner 120, respectively. Cleaning apparatus 200 can include a support member 205 and/or wand 203, which can be similar or identical to support member 105 and wand 103, respectively. Although FIG. 2B illustrates wand 203 and support 205 as a contiguous components, this is not intended to be limiting. It is to be understood that cleaning apparatus 200 can include a separate support member 205 and wand 203 that are removably attachable to one another (for example, similar to as shown and/or described with respect to implementations of cleaning apparatus disclosed herein), and such support member 205 can be connected to cleaning head 230. Handheld vacuum cleaner 220 can include a housing and a handle 229 coupled to or formed as part of such housing. Handheld vacuum cleaner 220 can include controls 228 which can be similar or identical to controls 128 and/or controls 328 described below with respect to FIG. 3G. Handheld vacuum cleaner 220 can include a controller that can be similar or identical to the controller described with respect to handheld vacuum cleaner 120 or vacuum cleaner 320 of FIG. 3G. Handheld vacuum cleaner 220 can include a dirty air inlet 221, a debris separator, a debris container 225, and a clean air outlet, which can be similar or identical to the dirty air inlet, debris separator, debris container, and clean air outlet described above (respectively) with respect to handheld vacuum cleaner 120. Handheld vacuum cleaner 220 can include a suction motor 223 which can be similar or identical to the suction motor described with respect to handheld vacuum cleaner 120 or suction motor 323 of vacuum cleaner 320 described below. Floor-based vacuum cleaner 210 can include a dirty air inlet (e.g., dirty air inlet 311 shown in FIG. 3F), a debris separator (e.g., debris separator 314 shown in FIG. 3F), a suction motor 213, a debris container 215, and a clean air outlet (e.g., clean air outlet 312 shown in FIG. 3F), which can be similar or identical to the dirty air inlet, debris separator, suction motor, debris container, and clean air outlet described with respect to floor-based vacuum cleaner 110 previously. Cleaning head 230 can be similar or identical to cleaning head 130 and/or can include any of the features described or shown with respect to cleaning head 330 in FIG. 3G.

Figure 2A:
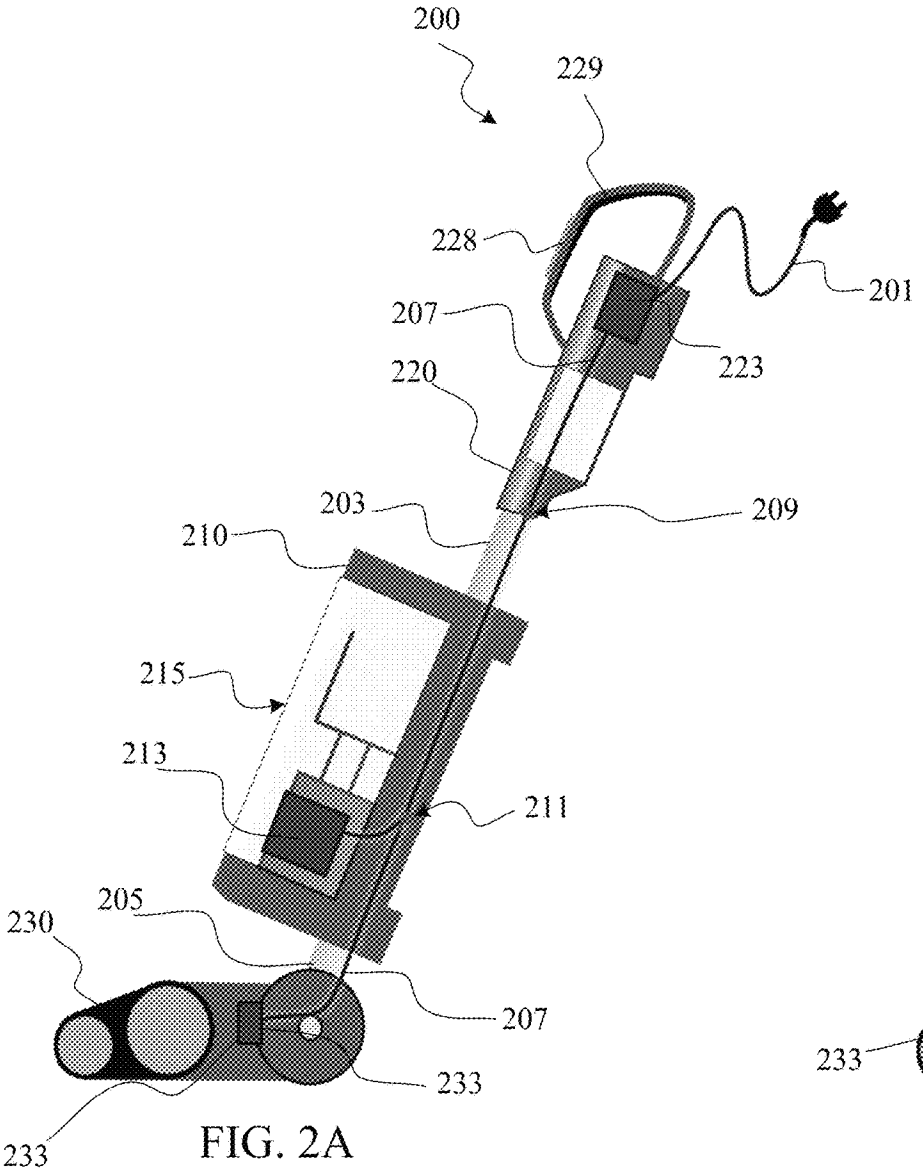
Figure 2E:
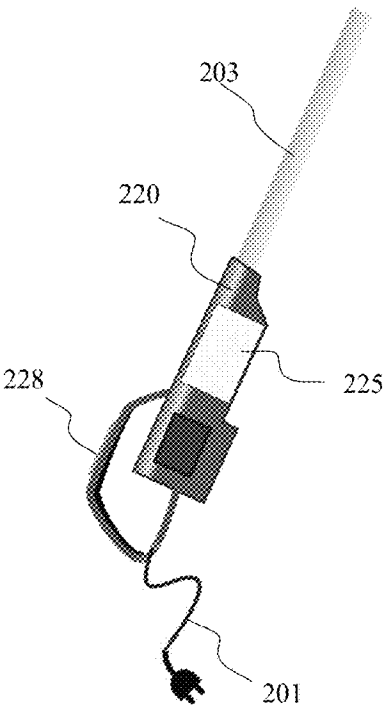
Figure 2D:
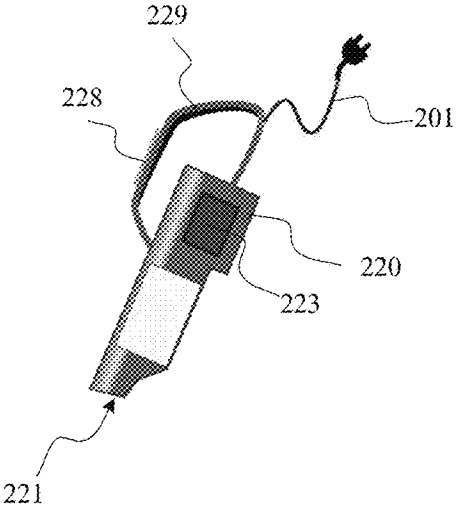
Figure 2C:
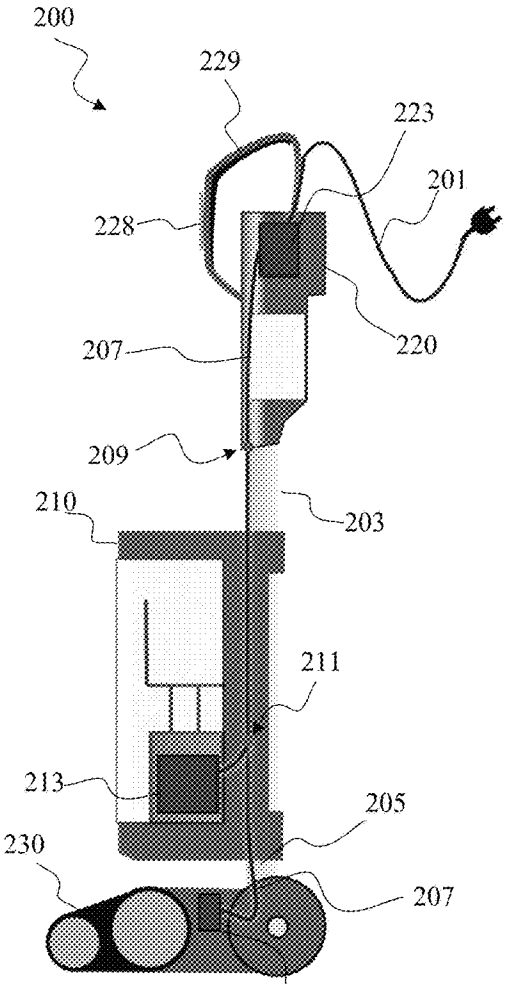

FIG. 2A illustrates cleaning apparatus 200 in an upright cleaning mode which can be similar or identical to the upright cleaning mode described above with respect to cleaning apparatus 100 and FIG. 1A. FIG. 2B illustrates cleaning apparatus 200 in a stick cleaning mode which can be similar or identical to the stick cleaning mode described above with respect to cleaning apparatus 100 and FIG. 1B. FIG. 2C illustrates cleaning apparatus 200 in an empty mode which can be similar or identical to the empty mode described above with respect to cleaning apparatus 100 and FIG. 1C. FIG. 2D illustrates handheld vacuum cleaner 220 detached from wand 203, floor-based vacuum cleaner 210, support member 205, and cleaning head 230, and usable to collect debris independent of such components. FIG. 2E illustrates handheld vacuum cleaner 220 attached to wand 203 and detached from floor-based vacuum cleaner 210, support member 205, and cleaning head 230.

FIGS. 2A-2C illustrate an example electrical connection between floor-based vacuum cleaner 210, handheld vacuum cleaner 220, and cleaning head 230 in each of the upright cleaning mode, stick cleaning mode, and empty mode. Cleaning apparatus 200 can be configured to allow removable mechanical and electrical connection of floor-based vacuum cleaner 210, handheld vacuum cleaner 220, and cleaning head 230 to one another. In implementations including wand 203 and support member 205, cleaning apparatus 200 can be configured to allow removable mechanical and electrical connection of floor-based vacuum cleaner 210, handheld vacuum cleaner 220, and cleaning head 230 to one another via one or both of wand 203 and support member 205. Cleaning apparatus 200 can include a valve assembly similar or identical to the valve assembly described with respect to cleaning apparatus 100 or any of the other valve assemblies disclosed herein. In such implementations, cleaning apparatus 200 can be configured to allow removable mechanical and electrical connection of floor-based vacuum cleaner 210, handheld vacuum cleaner 220, and cleaning head 230 to one another via one or all of wand 203, support member 205, and/or such valve assembly. In some implementations, cleaning apparatus 100 is configured to receive power from an external power source, for example, via a cord 201 connected to handheld vacuum cleaner 220. In some implementations, floor-based vacuum cleaner 210 and/or cleaning head 230 are configured to be in electrical communication with and receive power from handheld vacuum cleaner 220 when attached (directly or indirectly) to handheld vacuum cleaner 220. Such electrical communication is illustrated by electrical communication path 207 in FIGS. 2A-2C. As shown in FIG. 2A, which illustrates cleaning apparatus 200 in an upright cleaning mode, floor-based vacuum cleaner 210 and/or cleaning head 230 can be in electrical communication with handheld vacuum cleaner 220. Such electrical communication can, among other things, allow floor-based vacuum cleaner 210 and/or cleaning head 230 to receive power, which can allow, for example, operation of suction motor 213 of floor-based vacuum cleaner 210 and/or motor(s) 233 of cleaning head 230. Where cleaning apparatus 200 includes wand 203 and/or support member 205, wand 203 and/or support member 205 can facilitate such electrical communication of floor-based vacuum cleaner 210 and cleaning head 230 with handheld vacuum cleaner 220. FIG. 2C illustrates cleaning apparatus 200 in an empty mode, in which electrical communication between floor-based vacuum cleaner 210, cleaning head 230, and handheld vacuum cleaner 220 can be similar to that present in the upright cleaning mode shown and/or described with respect to FIG. 2A. FIG. 2B illustrates cleaning apparatus in a stick cleaning mode in which floor-based vacuum cleaner 210 is detached. Cleaning apparatus 200 can be configured to allow electrical communication between handheld vacuum cleaner 220 and cleaning head 230 in such mode, for example, via wand 203 and/or support member 205 (which may be integral with or attachable to wand 203). Electrical communication path 207 can be implemented with one or more or a plurality of wires and/or mechanical/electrical components and connections, and such communication path 207 can enable electrical communication between handheld vacuum cleaner 220 (for example, a controller thereof) and floor-based vacuum cleaner 210 and/or cleaning head 230.

Motor 233 can be configured to operate at various power levels, for example, 150 W, 200 W, 250 W, or 300 W. In some implementations, motor 233 operates at a smaller power level than suction motor 213 of first vacuum cleaner 210 and/or suction motor 223 of second vacuum cleaner 220. Suction motor 213 can include a motor coupled with an impeller, for example. Suction motor 213 can be configured to operate at various power levels, for example, 1050 W, 1100 W, 1150 W, 1200 W, or 1250 W. In some implementations, suction motor2 is configured to operate at a greater power level than suction motor 223 of second vacuum cleaner 220 and/or motor 233 of cleaning head 230. Suction motor 223 can include a motor coupled with an impeller, for example. Suction motor 223 can be configured to operate at various power levels, for example, 400 W, 450 W, 500 W, or 550 W. In some implementations, suction motor 213 operates at a smaller power level than suction motor 223 of second vacuum cleaner 220. In some implementations, cleaning apparatus 200 is configured to receive up to or more than 1400 W via cord 201.

In some implementations, handheld vacuum cleaner 220 and wand 203 are configured to removably electrically connect to one another, for example, at point 209 illustrated in FIGS. 2A-2C. Suitable electrical connectors can be incorporated into handheld vacuum cleaner 220 and wand 203 to facilitate electrical connection between the two components. This can advantageously allow handheld vacuum cleaner 220 to be used independently from and together with other components of cleaning apparatus 200. In implementations in which cleaning apparatus 200 includes a valve assembly (which can be similar or identical to any of the valve assemblies described herein), handheld vacuum cleaner 220 and/or wand 203 can be configured to removably electrically connect to such valve assembly. In some implementations, floor-based vacuum cleaner 210 is configured to removably electrically connect to handheld vacuum cleaner 220, for example, via wand 203 and/or support member 205 at point 211 illustrated in FIGS. 2A and 2C. Suitable electrical connectors can be incorporated into floor-based vacuum cleaner 210 and support member 205 (for example) to facilitate electrical connection between the two components. Though not illustrated, it is to be understood that where wand 203 is removably attachable to cleaning head 230 and/or support member 205, a suitable electrical connection and connectors can be included in any of such components to facilitate electrical connection between any of such components when attached to one another. For example, wand 203 can include an electrical connector (for example, at or near a bottom end thereof) that can connect to an electrical connector in a post of support member 205. In implementations in which cleaning apparatus 200 includes a valve assembly (which can be similar or identical to any of the valve assemblies described herein), floor-based vacuum cleaner 210 can be configured to removably electrically connect to handheld vacuum cleaner 220 via such valve assembly. Accordingly, any of the above-described electrical connections can facilitate electrical communication between handheld vacuum cleaner 220 and any/all of wand 203, floor-based vacuum cleaner 210, support member 205, and cleaning head 230. In implementations where cleaning apparatus 200 receives power via cord 201 connected to handheld vacuum cleaner 220, the above-described electrical connections can allow handheld vacuum cleaner 220 provide electrical power to floor-based vacuum cleaner 210 and cleaning head 230 (for example, via wand 203 and/or support member 205).

Figure 3A:
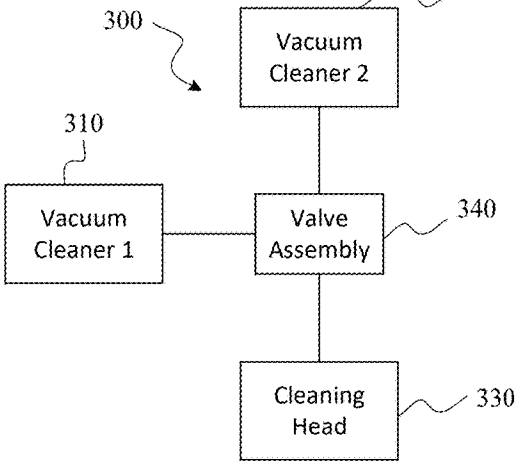
FIGS. 3A-3D illustrate schematic diagrams of another implementation of a cleaning apparatus or portions thereof in different modes of operation in accordance with aspects of this disclosure.
Figure 3B:
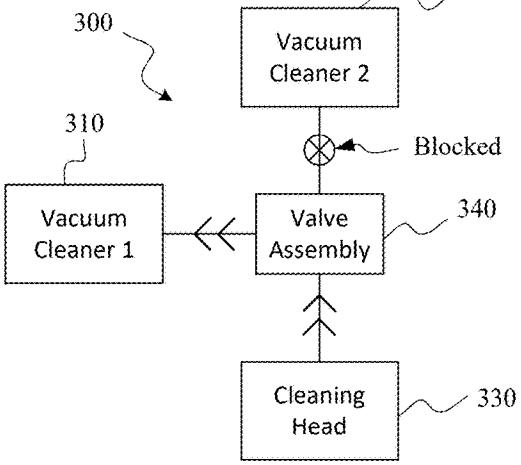
Figure 3C:
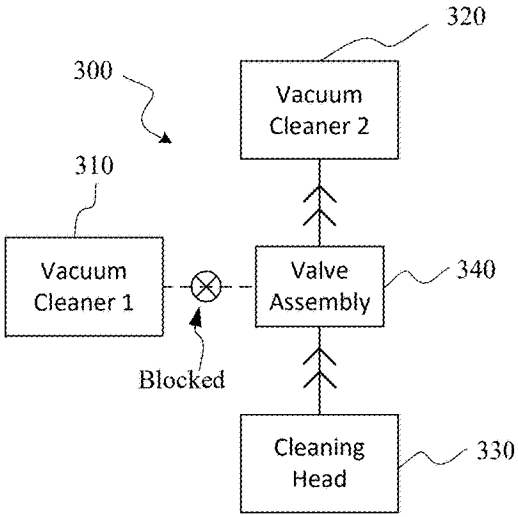
Figure 3D:
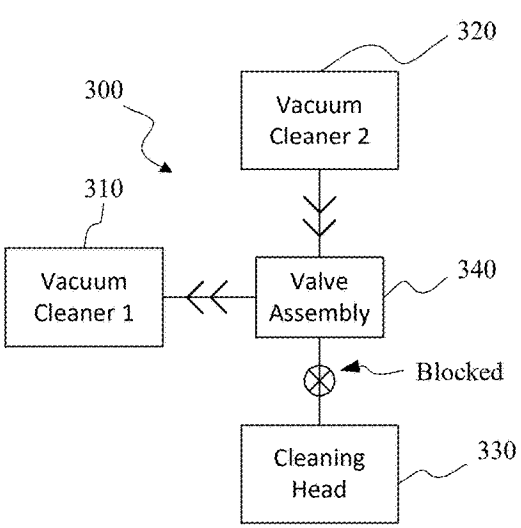

FIG. 3A illustrates a schematic block diagram of another implementation of a cleaning apparatus 300. FIGS. 3B-3D schematically illustrate cleaning apparatus 300 in different modes of operation, as described further below. As shown, cleaning apparatus 300 can include a first vacuum cleaner 310, a second vacuum cleaner 320, a cleaning head 330, and a valve assembly 340.

Figure 3E:
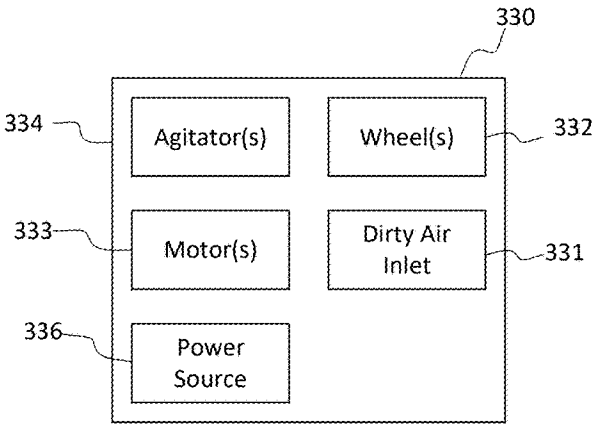
FIGS. 3E-3F illustrate schematic diagrams of a first and second vacuum cleaner of the cleaning apparatus of FIGS. 3A-3D in accordance with aspects of this disclosure.

FIG. 3E illustrates a schematic block diagram of cleaning head 330. Cleaning head 330 can be any of a variety of devices that can serve as a primary and/or initial entry point from which cleaning apparatus 300 collects debris, for example, from a floor surface. For example, cleaning head 330 can include one or more structural components that include or support a dirty air inlet that are connected to wheel(s) which allow the cleaning apparatus 300 to be supported by or moveable with respect to a floor surface. Cleaning head 330 can be similar or identical to any of the cleaning heads described herein. However, cleaning head 330 can take an alternative form yet still include a dirty air inlet for collecting debris from such surface. As shown in FIG. 3E, cleaning head 330 can include one or more or a plurality of wheels 332 for supporting and/or moving cleaning head 330, and any other components of cleaning apparatus 300 attached to cleaning head 330, with respect to a surface. Cleaning head 330 can include a dirty air inlet 331 for receiving debris from the floor surface. Dirty air inlet 331 can serve as a primary and/or initial entry point from which cleaning apparatus 300 collects debris and then directs such debris to either or both of the first or second vacuum cleaners 310, 320 (for example, via valve assembly 340 as described elsewhere herein). Dirty air inlet 331 can be in the form or a slot or other opening in a bottom portion of cleaning head 330 (for example, in a bottom portion of a housing of cleaning head 330). In some implementations, cleaning head 330 includes one or more agitators 334, for example, at least partially disposed in one or more agitator chambers. For example, cleaning head 330 may include a leading roller and a brush roller. The leading roller may include a soft roller and the brush roller may include any combination of bristle strips, bristles tufts, and/or flexible flaps. Alternatively, cleaning head 330 may include only a single agitator or no agitator. Cleaning head 330 can include one or more or a plurality of motors 333, for example, to drive the one or more wheels 332 and/or the one or more agitators 334. For example, cleaning head 330 can include a motor 333 for driving any or all wheel(s) 332. Additionally or alternatively, cleaning head 330 can include a motor 333 configured to rotate each or all agitator(s) 334. In some implementations, cleaning head 330 includes a power source 336 (for example rechargeable or non-rechargeable batteries) that can be utilized to provide power to motor(s) 333. Additionally or alternatively, cleaning head 330 can be configured to receive power from another component of cleaning apparatus 300, for example, the first vacuum cleaner 310 or second vacuum cleaner 320, either or all of which may receive power via a cord. Cleaning head 330 can include a housing configured to at least partially enclose power source 336, motor(s) 333, agitator(s) 334, and such housing can be connected to wheel(s) 332. Motor 333 can be configured to operate at various power levels, for example, 150 W, 200 W, 250 W, or 300 W. In some implementations, motor 333 operates at a smaller power level than suction motor 313 of first vacuum cleaner 310 and/or suction motor 323 of second vacuum cleaner 320. In various implementations and/or modes of operation of cleaning apparatus 300, cleaning head 330 may serve as an initial entry point for receiving debris from surface (e.g., a floor surface). In such implementations, cleaning head 330 can be configured to direct such debris to and/or toward valve assembly 340 which can in turn direct such debris to the first or second vacuum cleaners 310, 320 as described further below. Cleaning head 330 can include dirty air inlet 331 and/or one or more other flow conduits (such as a flexible conduit) configured to direct such debris in such manner. In some implementations, cleaning apparatus 300 includes a support member connected to cleaning head 330 and in flow communication with dirty air inlet 331. Such support member can be connected (removably or non-removably) to valve assembly 340 and/or integral with valve assembly 340. Such support member can include an airflow conduit in flow communication with dirty air inlet 331.

Figure 3G:
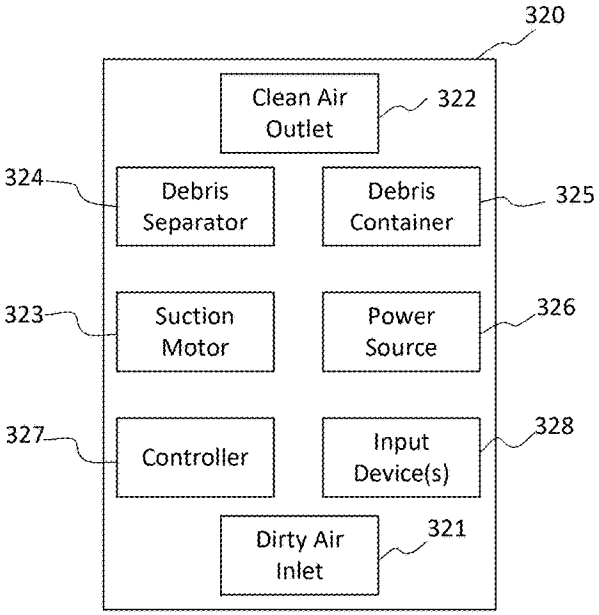
FIG. 3G illustrates a schematic diagram of a cleaning head which can be incorporated into the cleaning apparatus of FIGS. 3A-3D in accordance with aspects of this disclosure.
Figure 3F:
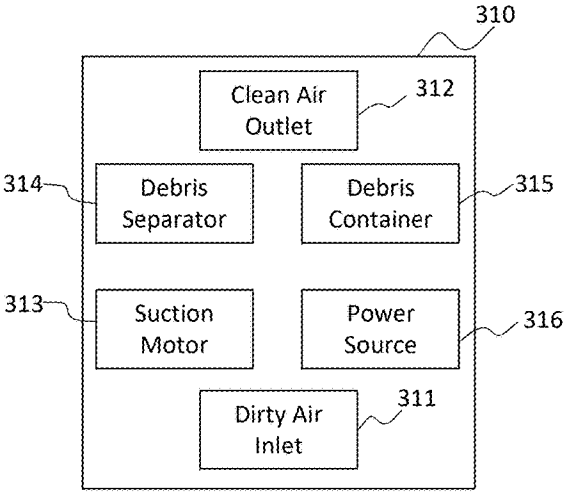

FIG. 3F illustrates a schematic block diagram of first vacuum cleaner 310. First vacuum cleaner 310 can include a dirty air inlet 311, a clean air outlet 312, a suction motor 313, a debris separator 314, and a debris container 315. In some implementations, first vacuum cleaner 310 is a floor-based vacuum cleaner, and can be similar or identical to floor-based vacuum cleaner 110. Dirty air inlet 311 can be configured to receive debris from cleaning head 330, for example, via valve assembly 340. As further described below, cleaning apparatus 300 may be in an upright cleaning mode when debris travel in such manner (from cleaning head 330 to dirty air inlet 311 of first vacuum cleaner 310. As also further described below, dirty air inlet 311 can be configured to receive debris from second vacuum cleaner 320 when cleaning apparatus 300 is in a mode of operation and valve assembly 340 enables flow communication between first and second vacuum cleaners 310, 320. Such mode may be referred to as an "empty mode" or "auto-empty mode" of cleaning apparatus 300. Regardless of where debris are received from, first vacuum cleaner 310 can be configured to separate and collect ("store") such debris. First vacuum cleaner 310 can include a suction motor 313 configured to cause air to flow through first vacuum cleaner 310, for example, from dirty air inlet 311 and through clean air outlet 312. Suction motor 313 can be of any suitable design and configuration that is sufficient to impart air flow through first vacuum cleaner 310. Suction motor 313 can include a motor coupled with an impeller, for example. Suction motor 313 can be configured to operate at various power levels, for example, 1050 W, 1100 W, 1150 W, 1200 W, or 1250 W. In some implementations, suction motor 313 is configured to operate at a greater power level than suction motor 323 of second vacuum cleaner 320 and/or motor 333 of cleaning head 330. Debris separator 314 can be positioned in an airflow path between inlet 311 and outlet 312 to separate dirt or other debris from the airflow. Debris separator 314 can comprise one or more cyclones, filters, and/or bags. In some implementations, debris separator 314 is arranged upstream from suction motor 313. Debris container 315 can comprise various structures to allow storage of debris. In some implementations, debris separator 314 is incorporated in an assembly or unit with suction motor 313 and/or debris container 315. First vacuum cleaner 310 can be configured to receive power from another component of cleaning apparatus 300, for example, from first vacuum cleaner 120, which may receive power via a cord. In some implementations, first vacuum cleaner 310 includes a power source 336 (for example rechargeable or non-rechargeable batteries) that can be utilized to provide power to suction motor 313. First vacuum cleaner 310 can include a housing configured to at least partially enclose suction motor 313, debris separator 314, debris container 315, and/or power source 316.

FIG. 3G illustrates a schematic block diagram of second vacuum cleaner 320. Second vacuum cleaner 320 can include a dirty air inlet 321, a clean air outlet 322, a suction motor 323, a debris separator 324, and a debris container 325. In some implementations, second vacuum cleaner 320 is a handheld vacuum cleaner, and can be similar or identical to handheld vacuum cleaner 120. Dirty air inlet 321 can receive debris from cleaning head 330, for example, via valve assembly 340. Where cleaning apparatus 300 includes a wand and/or support member (for example, similar or identical to wand 103 and support member 105), dirty air inlet 321 can receive debris from cleaning head 330 (for example, dirty air inlet 311 of cleaning head 330) via such support member, valve assembly 340, and such wand, as described further below with respect to FIG. 3C. As also described below, cleaning apparatus 300 may be in a stick cleaning mode when debris travel in such manner (from cleaning head 330 to dirty air inlet 321 of second vacuum cleaner 320). In some implementations, second vacuum cleaner 320 is removably attachable to valve assembly 340, first vacuum cleaner 310, cleaning head 330, and/or such wand or support member (where included). In such implementations, first vacuum cleaner 320 can collect debris independent of these components. Regardless of whether debris are received from cleaning head 330 (for example, dirty air inlet 311) or independent from cleaning head 330 (or other components of cleaning apparatus 300), second vacuum cleaner 320 can be configured to separate and collect ("store") such debris. Second vacuum cleaner 320 can include a suction motor 323 configured to cause air to flow through second vacuum cleaner 320, for example, from dirty air inlet 321 and through clean air outlet 322. Suction motor 323 can be of any suitable design and configuration that is sufficient to impart air flow through second vacuum cleaner 320. Suction motor 323 can include a motor coupled with an impeller, for example. Suction motor 323 can be configured to operate at various power levels, for example, 400 W, 450 W, 500 W, or 550 W. In some implementations, suction motor 313 operates at a smaller power level than suction motor 323 of second vacuum cleaner 320. Debris separator 324 can be positioned in an airflow path between inlet 321 and outlet 322 to separate dirt or other debris from the airflow. Debris separator 324 can comprise one or more cyclones, filters, and/or bags. In some implementations, debris separator 324 is arranged upstream from suction motor 323. Debris container 325 can comprise various structure to allow storage of debris. In some implementations, debris separator 324 is incorporated in an assembly or unit with suction motor 323 and/or debris container 325. In some implementations, second vacuum cleaner 320 is configured to receive power from an external source, for example, via a cord connected (removably or non-removably) connected to second vacuum cleaner 320. In some implementations, second vacuum cleaner 320 includes a power source 326 (for example rechargeable or non-rechargeable batteries). In some variants, second vacuum cleaner 320 is configured to receive power from another component of cleaning apparatus 300, for example, from first vacuum cleaner 310 or cleaning head 330, which may receive power via a cord. Regardless of the power source, second vacuum cleaner 320 can be configured to direct received power to suction motor 323 and/or other components of second vacuum cleaner 320 (such as controller 327 and/or input device(s) 328 described further below). In some implementations, second vacuum cleaner 320 is configured to provide power to any or all components of cleaning apparatus 300. For example, in some implementations, either or both of first vacuum cleaner 310 and cleaning head 330 receive power from second vacuum cleaner 320, when connected thereto (directly or indirectly). Second vacuum cleaner 320 can include a housing configured to at least partially enclose suction motor 323, debris separator 324, debris container 325, and/or power source 326.

Second vacuum cleaner 320 can include a controller 327 for controlling various operations of cleaning apparatus 300 or portions of components thereof. For example, controller 327 can be configured to turn any of vacuum cleaners 310, 320 and/or cleaning head 330 "on" or "off". Controller 327 can comprise one or more processors (for example, microprocessor(s)), and such processor(s) can be communicatively coupled with one or more data storage devices. Controller 327 can be embodied in a printed circuit board. Such storage device(s) can store instructions for operating cleaning apparatus 300 or portions thereof, such as suction motor 323 of vacuum cleaner 320, suction motor 313 of vacuum cleaner 310, and/or motor(s) 333 of cleaning head 330. Such storage device(s) can include one or more memory devices that store data, including without limitation, dynamic and/or static random access memory (RAM), programmable read-only memory (PROM), erasable programmable read-only memory (EPROM), electrically erasable programmable read-only memory (EEPROM), and the like. Controller 327 can comprise a single chip or multiple separate chips and circuitry. Vacuum cleaners 310, 320, cleaning head 330, and/or valve assembly 340 can include electrical circuitry (e.g., wires) and electrical connectors that provide electrical communication with controller 327, for example, when attached to vacuum cleaner 320, for example, in a similar manner as that described above with respect to cleaning apparatus 200. Second vacuum cleaner 320 can include one or more user input devices 328 that allow second vacuum cleaner 320 and/or cleaning apparatus 300 to receive input from a user. Input device(s) 328 can be communicatively coupled with controller 327. Input device(s) 328 can comprise one or more buttons (for example, comprising an actuator and/or switch) and/or one or more capacitive or resistive sensors that can be utilized to receive input from a user. In some implementations, input device(s) 328 is embodied in a user interface (e.g., a touch-screen display) that allows user input and that provides information to a user. Such provided information can include, for example, battery life of on-board batteries in vacuum cleaner 320 (where included), information pertaining to an operational mode of cleaning apparatus 300 (for example, upright cleaning mode, stick cleaning mode, empty mode), whether suction motor 313 and/or 323 is operating or malfunctioning, whether a debris clog is present in any of vacuum cleaners 310, 320 or cleaning head 330 or dirty air inlets thereof, among other things). In some implementations, vacuum cleaner 310 and/or vacuum cleaner 320 include one or more sensors configured to detect pressure and/or airflow in portions therein, and in such implementations, user interface may display such information. In some implementations, vacuum cleaner 310 and/or vacuum cleaner 320 include one or more sensors configured to measure an amount of debris in debris containers 315, 325 (for example, 10% full, 25% full, 50% full, 75% full, 100% full), and in such implementations, such user interface may display such information.

In some implementations, controller 327 is configured to control operation of valve assembly 340, transition cleaning apparatus 300 between different operational modes, and/or facilitate operation of cleaning apparatus 300 in any of such operational modes. For example, in some implementations, controller 327 is configured to control operation of valve assembly 340 and transition cleaning apparatus 300 between an upright cleaning mode, in which debris flows from dirty air inlet 331 of cleaning head 330 to vacuum cleaner 310, and an empty mode, in which debris flow from vacuum cleaner 320 to vacuum cleaner 310. As an example, controller 327 can be configured to cause a valve of valve assembly 340 to move from a first state, in which vacuum cleaner 310 and cleaning head 330 are in flow communication and vacuum cleaner 320 is not in flow communication with vacuum cleaner and cleaning head 330 (see FIG. 3B), to a second state, in which vacuum cleaners 310, 320 are in flow communication with one another but are not in flow communication with cleaning head 330 (see FIG. 3D). Controller 327 can be configured to control operation of valve assembly 340 alone or in combination with various mechanisms, such as any of those described herein.

With reference to FIG. 3A, valve assembly 340 can be connected to and between cleaning head 330, vacuum cleaner 310, and vacuum cleaner 320 in a variety of ways to facilitate flow communication therebetween and also mechanical and/or electrical connection therebetween. In some implementations, valve assembly 340 is removably connectable to vacuum cleaner 310, vacuum cleaner 320 (for example, via a wand similar or identical to wand 103), and/or cleaning head 330 (for example, via a support member similar or identical to support member 105). Valve assembly 340 can provide flow paths between any two of cleaning head 330, vacuum cleaner 310, and vacuum cleaner 320. For example, valve assembly 340 can provide a first flow path between cleaning head 330 and vacuum cleaner 310, a second flow path between cleaning head 330 and vacuum cleaner 320, and a third flow path between vacuum cleaner 310 and vacuum cleaner 320. Valve assembly 340 can include one or more flow openings that provide flow communication between cleaning head 330, vacuum cleaner 310, and vacuum cleaner 320. For example, valve assembly 340 can comprise a valve housing that includes three flow openings, each of the flow openings configured to communicate with one of cleaning head 330 (for example, dirty air inlet 331), vacuum cleaner 310, and vacuum cleaner 320. Such flow openings can be in flow communication with an interior of the valve housing. Valve assembly 340 can also include a valve (for example, within the interior of the valve housing) that can be moved between a plurality of positions to open or close such flow openings. In some implementations, valve assembly 340 includes a closure mechanism in addition to such valve that can be utilized to close one of such flow openings, for example, a lid similar or identical to lid 442 of valve assembly 440. In some implementations, such closure mechanism can close a flow opening of valve assembly 340 when vacuum cleaner 310 is detached from cleaning apparatus 300, as illustrated and described with respect to FIG. 3C below.

FIGS. 3B-3D schematically illustrate cleaning apparatus 300 in different modes of operation. FIG. 3B illustrates cleaning apparatus 300 in a first mode of operation (which may be referred to as an "upright cleaning mode") in which debris from cleaning head 330 (for example, from dirty air inlet 331 of cleaning head 330) is directed to vacuum cleaner 310, as indicated by the arrows in FIG. 3B. In some implementations of the upright cleaning mode: vacuum cleaner 310 is in flow communication with cleaning head 330 (for example, with dirty air inlet 331 of cleaning head 330); vacuum cleaner 320 is not in flow communication with vacuum cleaner 310; and vacuum cleaner 320 is not in flow communication with cleaning head 330. In the upright cleaning mode, valve assembly 340 can: provide ("open") a flow path between cleaning head 330 (for example, with dirty air inlet 331 of cleaning head 330) and vacuum cleaner 310; block a flow path between cleaning head 330 (for example, with dirty air inlet 331 of cleaning head 330) and vacuum cleaner 320; and block a flow path between vacuum cleaner 310 and vacuum cleaner 320. In the upright cleaning mode, suction motor 313 of vacuum cleaner 310 can cause air to flow through dirty air inlet 331 of cleaning head 330, valve assembly 340 (for example, a valve housing of valve assembly 340), dirty air inlet 311, debris separator 314, and clean air outlet 312, thereby directing debris through dirty air inlet 311 and into debris container 315 of vacuum cleaner 310.

As mentioned above, valve assembly 340 can include one or more flow openings that provide flow communication between cleaning head 330, vacuum cleaner 310, and vacuum cleaner 320. For example, valve assembly 340 can include a first flow opening configured to provide flow communication with cleaning head 330, a second flow opening configured to provide flow communication with vacuum cleaner 310 (for example, with dirty air inlet 311 of vacuum cleaner 310), and a third flow opening configured to provide flow communication with vacuum cleaner 320 (for example, dirty air inlet 321 of vacuum cleaner 320). In some of such implementations, when cleaning apparatus 300 is in the upright cleaning mode (as shown in FIG. 3B): the first and second flow openings are in flow communication with one another; the first flow opening is not in flow communication with the third flow opening; and the second and third flow openings are not in flow communication with one another. In some implementations, valve assembly 340 includes a valve that blocks the third flow opening of valve assembly 340 when cleaning apparatus 300 is in the above-described mode ("upright cleaning mode"). Such valve can be movable (for example, rotatable) to one or more other positions such as those described below. The valve can be in a "first position" when blocking the third flow opening of the valve assembly 340 and cleaning apparatus 300 is in the above-described mode ("upright cleaning mode").

FIG. 3C illustrates cleaning apparatus 300 in a second mode of operation (which may be referred to as a "stick cleaning mode") in which debris from cleaning head 330 (for example, from dirty air inlet 331 of cleaning head 330) are directed to vacuum cleaner 320, as indicated by the arrows in FIG. 3C. In some implementations, such mode occurs when vacuum cleaner 310 is detached from valve assembly 340 (for example, detached from a valve housing of valve assembly 340). Such detachment is schematically illustrated with the dotted line in FIG. 3C. In such stick cleaning mode: vacuum cleaner 320 is in flow communication with cleaning head 330 (for example, with dirty air inlet 331 of cleaning head 330); vacuum cleaner 310 is not in flow communication with cleaning head 330; and vacuum cleaner 310 is not in flow communication with vacuum cleaner 320. In such mode, valve assembly 340 can: provide ("open") a flow path between cleaning head 330 (for example, with dirty air inlet 331 of cleaning head 330) and vacuum cleaner 320; block a flow path between cleaning head 330 (for example, with dirty air inlet 331 of cleaning head 330) and vacuum cleaner 310; and block a flow path between vacuum cleaner 310 and vacuum cleaner 320. In the stick cleaning mode, suction motor 323 of vacuum cleaner 320 can cause air to flow through dirty air inlet 331 of cleaning head 330, valve assembly 340 (for example, a valve housing of valve assembly 340), dirty air inlet 321, debris separator 324, and clean air outlet 322, thereby directing debris through dirty air inlet 321 and into debris container 325. As mentioned above, valve assembly 340 can include a first flow opening configured to provide flow communication with cleaning head 330, a second flow opening configured to provide flow communication with vacuum cleaner 310 (for example, with dirty air inlet 311 of vacuum cleaner 310), and a third flow opening configured to provide flow communication with vacuum cleaner 320 (for example, dirty air inlet 321 of vacuum cleaner 320). In some of such implementations, when cleaning apparatus 300 is in the stick cleaning mode (as shown in FIG. 3C): the first and third flow openings are in flow communication with one another; the first flow opening is not in flow communication with the second flow opening; and the second and third flow openings are not in flow communication with one another. In some implementations, valve assembly 340 includes a closure mechanism (such as a lid) that blocks the second flow opening of valve assembly 340 when cleaning apparatus 300 is in the above-described mode ("stick cleaning mode"). In some implementations, such closure mechanism automatically blocks the second flow opening responsive to detachment of vacuum cleaner 310 from valve assembly 340 (for example, detachment from a valve housing of valve assembly 340). As described above, valve assembly 340 can include a valve that can block the above-described third flow opening when cleaning apparatus 300 is in the upright cleaning mode illustrated in FIG. 3B. Such valve can be in a "first position" when blocking such third flow opening. In some implementations, such valve is configured to be moved (for example, rotated) to a "second position", for the stick cleaning mode illustrated in FIG. 3C, in which the valve blocks the second flow opening of valve assembly 340. Such configuration for the valve can be utilized along with or as an alternative to the above-described closure mechanism. In some implementations, such valve does not block the second flow opening and the valve assembly 340 relies on the above-described closure mechanism to block such second flow opening when cleaning apparatus 300 is in the stick cleaning mode.

FIG. 3D illustrates cleaning apparatus 300 in a third mode of operation (which may be referred to as an "empty mode" or "auto-empty mode") in which debris from vacuum cleaner 320 (for example, from debris container 325 of vacuum cleaner 320) are directed to vacuum cleaner 310, as indicated by the arrows in FIG. 3D. In such mode: vacuum cleaner 310 is in flow communication with vacuum cleaner 320; vacuum cleaner 310 is in not in flow communication with cleaning head 330 (for example, with dirty air inlet 331 of cleaning head 330); and vacuum cleaner 320 is in not in flow communication with cleaning head 330 (for example, with dirty air inlet 331 of cleaning head 330). In such mode, valve assembly 340 can: provide ("open") a flow path between vacuum cleaner 310 and vacuum cleaner 320; block a flow path between cleaning head 330 (for example, with dirty air inlet 331 of cleaning head 330) and vacuum cleaner 310; and block a flow path between cleaning head 330 (for example, with dirty air inlet 331 of cleaning head 330) and vacuum cleaner 320. In the empty mode, suction motor 313 of vacuum cleaner 310 can cause air to flow through dirty air inlet 321 of vacuum cleaner 320, valve assembly 340 (for example, a valve housing of valve assembly 340), dirty air inlet 311, debris separator 314, and clean air outlet 312, thereby directing debris from the debris container 325 of vacuum cleaner 320 into debris container 315 of vacuum cleaner 310. As mentioned above, valve assembly 340 can include a first flow opening configured to provide flow communication with cleaning head 330, a second flow opening configured to provide flow communication with vacuum cleaner 310 (for example, with dirty air inlet 311 of vacuum cleaner 310), and a third flow opening configured to provide flow communication with vacuum cleaner 320 (for example, dirty air inlet 321 of vacuum cleaner 320). In some of such implementations, when cleaning apparatus 300 is in the empty mode (as shown in FIG. 3D): the second and third flow openings are in flow communication with one another; the first and second flow openings are not in flow communication with the one another; and the first and third flow openings are not in flow communication with one another. As described above, valve assembly 340 can include a valve that can block such third opening (e.g., when cleaning apparatus 300 is in the upright cleaning mode) and block such second opening (e.g., when cleaning apparatus 300 is in the stick cleaning mode). As also described above, such valve can be in a "first position" when blocking such third flow opening and a "second position" when blocking such second opening. In some implementations, such valve is moveable (e.g., rotatable) to a "third position" in which the valve blocks the above-described first opening of valve assembly 340. In some implementations, such valve is movable (e.g., rotatable) between any of the above-described, first, second, and third positions. In some implementations, such valve is movable between these positions manually (e.g., by mechanical movement of a knob or actuator). In some implementations, such valve is movable between these positions electronically, for example, responsive to user input using input device(s) 328 and using controller 327.

Cleaning apparatus 300 can be transitioned between the above-described modes in a variety of ways. For example, cleaning apparatus 300 can be transitioned from the upright cleaning mode (FIG. 3B) to the stick cleaning mode (FIG. 3C) responsive to detachment of vacuum cleaner 310 from cleaning apparatus 300 (e.g., detachment from valve assembly 340). As another example, cleaning apparatus 300 can be transitioned from the stick cleaning mode (FIG. 3C) to the upright cleaning mode (FIG. 3B) responsive to attachment of vacuum cleaner 310 to cleaning apparatus 300 (e.g., attachment to valve assembly 340). In some implementations, valve assembly 340 includes a closure mechanism (e.g., a lid) that automatically closes a flow opening of valve assembly to facilitate transitioning of cleaning apparatus 300 to the stick cleaning mode. As another example, cleaning apparatus 300 can be transitioned between the upright cleaning mode and empty mode based on movement and/or orientation of the vacuum cleaner 320, vacuum cleaner 310, and/or valve assembly 340 relative to cleaning head 330.

For example, with reference to FIGS. 1A and 1C, where vacuum cleaner 310 is a floor-based vacuum cleaner similar to floor-based vacuum cleaner 110, vacuum cleaner 320 is a handheld vacuum cleaner similar to handheld vacuum cleaner 120, and vacuum cleaners 310, 320 and/or valve assembly 340 are coupled with cleaning head 330 via a wand and/or support member (similar or identical to wand 103 and support member 105), movement of such wand and/or support member relative to cleaning head 330 can facilitate transition of cleaning apparatus 300 between an upright cleaning mode and an empty mode. In some implementations, cleaning apparatus 300 (for example, controller 327) is configured to determine an orientation of such wand (and/or vacuum cleaners 310, 320) relative to cleaning head 330, and, responsive to such determination, instruct the valve assembly 340 to transition between the upright cleaning mode and the empty mode. In some implementations, the valve housing of valve assembly 340 includes an actuator or other mechanism for transitioning between the upright cleaning mode and the empty mode. In some implementations, valve assembly 340 is biased toward the stick cleaning mode (FIG. 3C). In such implementations, valve assembly 340 can automatically cause cleaning apparatus to transition to the stick cleaning mode when, for example, vacuum cleaner 310 is detached from cleaning apparatus 300 (for example, from valve assembly 340).

Variants of the above-described modes are possible. For example, in one variant of the upright cleaning mode, vacuum cleaner 310 is in flow communication with, and can receive debris from, both of cleaning head 330 and vacuum cleaner 320. As another example, in another variant of the upright cleaning mode, both vacuum cleaners 310, 320 receive debris from cleaning head 330 (e.g., both of suction motors 313, 323 cause air to flow from cleaning head 330 (e.g., dirty air inlet 331) to and through vacuum cleaners 310, 320.

FIGS. 4A-4E illustrate a valve assembly 440 or portions thereof. Valve assembly 440 can be utilized in a cleaning apparatus including a floor-based vacuum cleaner, a handheld vacuum cleaner, and a cleaning head. For example, valve assembly 440 can be utilized in any of cleaning apparatuses 100, 200, or 300. Valve assembly 440 can be an implementation of valve assembly 340 described above. Valve assembly 440 can be configured to connect to various components of a cleaning apparatus, such as a cleaning head, a floor-based vacuum cleaner, and a handheld vacuum cleaner, and/or other components that are connected with any of such cleaning head, floor-based vacuum cleaner, and handheld vacuum cleaner (such as a wand and/or a support member of the cleaning apparatus). FIGS. 4H-4K illustrate valve assembly 440 attached with an example floor-based vacuum cleaner 410, while FIGS. 4A-4C and 4F-4G illustrate valve assembly 440 detached from such floor-based vacuum cleaner 410.

Figure 4B:
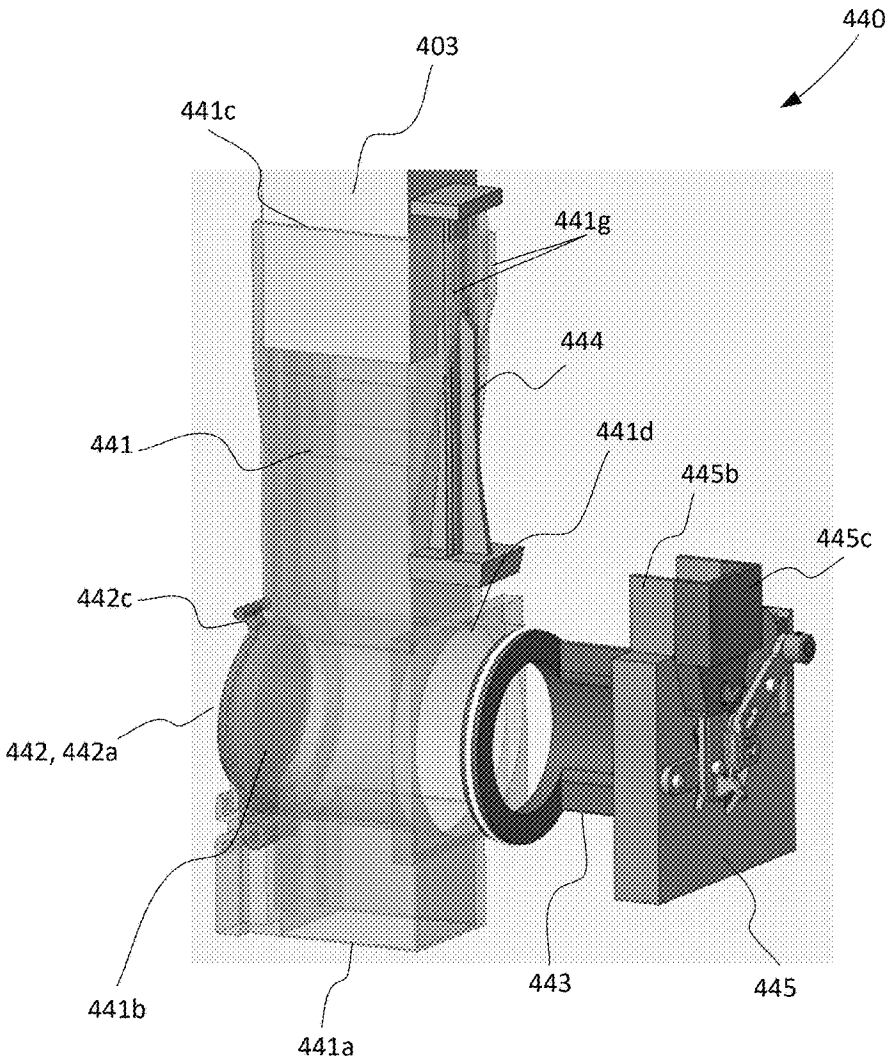
FIGS. 4A-4E illustrate various views of a valve assembly and a wand that can be incorporated into a cleaning apparatus in accordance with aspects of this disclosure.
Figure 4A:
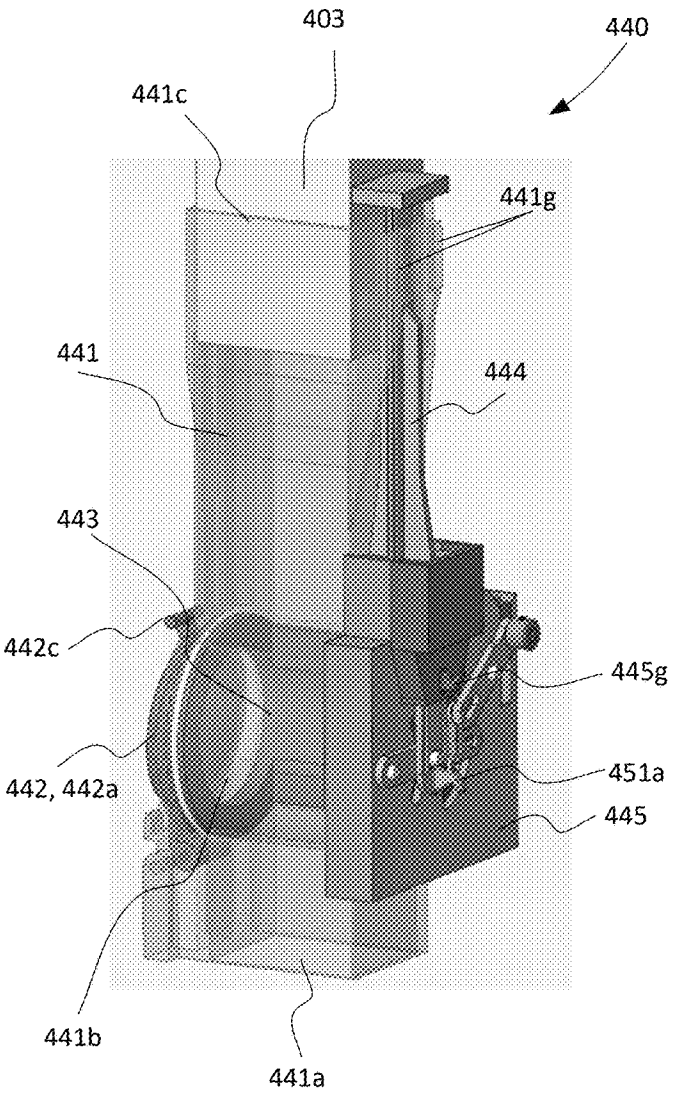
Figure 4D:
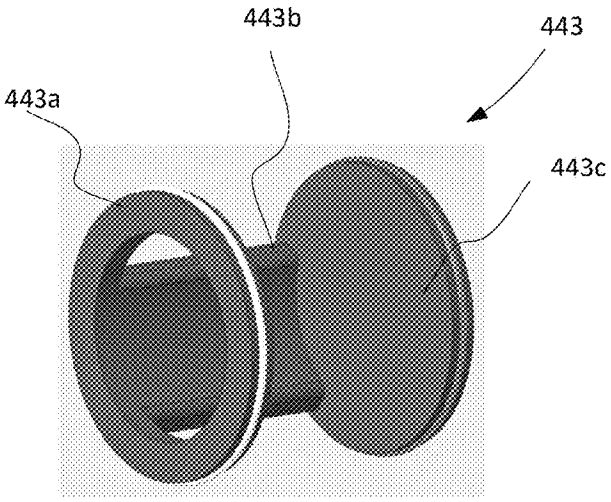
Figure 4E:
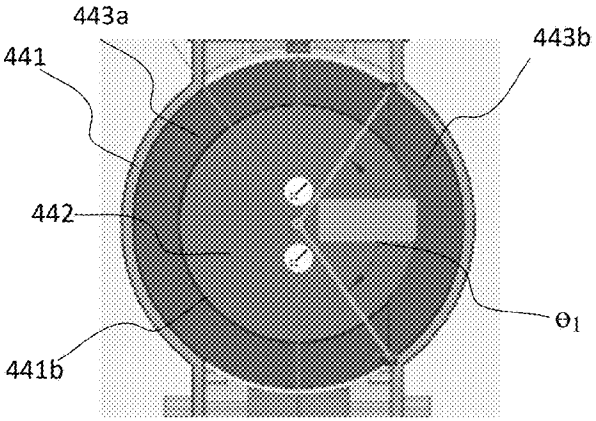
Figure 4C:
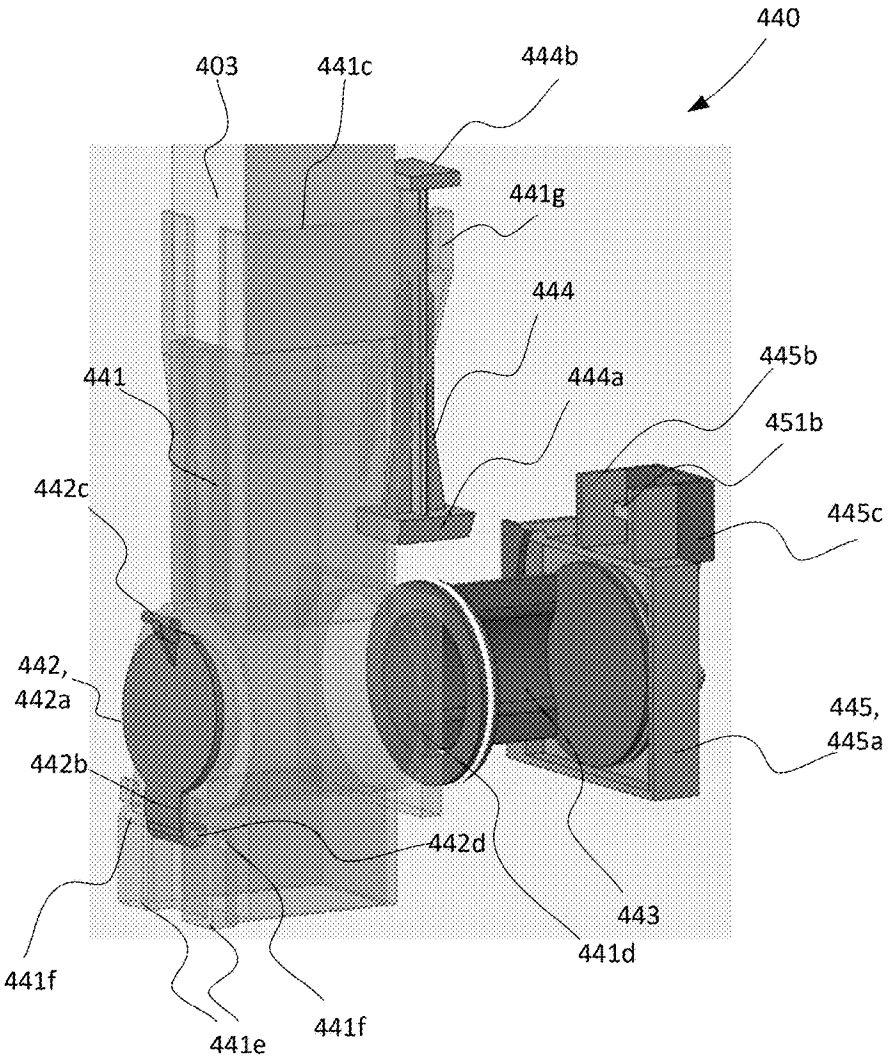

With reference to FIGS. 4A-4C, valve assembly 440 can include a valve housing 441. Valve housing 441 is shown as transparent in the figures to better illustrate other components of valve assembly 440. Valve housing 441 can include an interior and a plurality of openings configured to provide flow communication between a cleaning head, floor-based vacuum cleaner, and a handheld vacuum cleaner, and/or other components that are connected with any of such cleaning head, floor-based vacuum cleaner, and handheld vacuum cleaner (such as a wand and/or a support member of the cleaning apparatus). Valve housing 441 can include a first opening 441*a*, a second opening 441*b*, and a third opening 441*c*. First opening 441*a* can provide flow communication between an interior of valve housing 441 and a cleaning head and/or support member of a cleaning apparatus. Second opening 441*b* can provide flow communication between the interior of valve housing 441 and a floor-based vacuum cleaner of the cleaning apparatus, such as floor-based vacuum cleaner 410. Third opening 441*c* can provide flow communication between the interior of valve housing 441 and a handheld vacuum cleaner and/or wand of the cleaning apparatus. As shown, first opening 441*a* can be defined at one end of valve housing 441 and third opening 441*c* can be defined at another end of valve housing 441. As also shown, second opening 441*b* can be defined along a portion of valve housing 441 that is between such ends. An axis extending through opening 441*b* can be arranged non-parallel relative to an axis extending through openings 441*a* and/or 441*c*. For example, an axis extending through opening 441*b* can be arranged oblique or generally perpendicular relative to an axis extending through openings 441*a* and/or 441*c*. In some implementations, opening 441*b* is arranged closer to opening 441*a* than to opening 441*c*. For example, opening 441*b* can be arranged closer to an end of valve housing 441 which defines opening 441*a* than to an end of valve housing 441 which defines opening 441*c*. In some implementations, opening 441*b* can be substantially circular. Valve assembly 440 can include a closure mechanism to close (for example, cover) opening 441*b* when a floor-based vacuum cleaner is detached from valve assembly 440. For example, valve assembly 440 can include a lid 442 (which also may be referred to as a "door"). With reference to FIGS. 4A-4C, lid 442 can include a body 442*a*, an arm 442*b*, and an opening mechanism 442*c*. Lid 442 can be pivotably connected to valve housing 441 and configured to move between a closed position in which lid 442 (for example, body 442*a*) covers opening 441*b* (FIGS. 4A-4C, 4F) and an open position (FIGS. 4H-4K). With reference to at least FIGS. 4A-4C, lid 442 be pivotably connected to one or more of portions 441*e* of valve housing 441. For example, arm 442*b* can be pivotably connected to portions 441*e* via a pin 442*d*, and such pin 442*d* can extend through holes in arm 442*b* and portions 441*e*. In some implementations, lid 442 is biased toward the above-described closed position, for example, via a spring (such as a torsional spring). Opening mechanism 442*c* can extend from body 442*a* for example, in a direction that is opposite from valve housing 441. Opening mechanism 442*c* can advantageously be configured to engage a portion of floor-based vacuum cleaner 410 when floor-based vacuum cleaner 410 is attached to valve assembly 440, such that floor-based vacuum cleaner 410 pushes opening mechanism 442*c*, and thus lid 442 towards an open position (see, e.g., FIGS. 4H-4K).

FIGS. 4A-4C, 4F, and 4H illustrate a wand 403 attached to valve housing 441. In some implementations, wand 403 extends at least partially through an end of valve housing 441 and/or opening 441*c* such that wand 403 (for example, an airflow passage within wand 403) is in flow communication with the interior of valve housing 441. Wand 403 can provide flow communication between valve housing 441 and a handheld vacuum cleaner, such as any of those described herein.

As mentioned previously, valve assembly 440 can be utilized in a cleaning apparatus including a floor-based vacuum cleaner, a handheld vacuum cleaner, and a cleaning head. Valve assembly 440 can advantageously provide flow paths between any two of such floor-based vacuum cleaner, handheld vacuum cleaner, and cleaning head, so as to facilitate multiple modes of operation of the cleaning apparatus. As also mentioned previously: opening 441*a* can provide flow communication with a cleaning head and/or a support member connected with the cleaning head; opening 441*b* can provide flow communication with a floor-based vacuum cleaner when attached to valve assembly 440; and opening 441*c* can provide flow communication with a handheld vacuum cleaner, for example, via wand 403. Valve assembly 440 can provide a first flow path between openings 441*a* and 441*b* to facilitate flow communication between a cleaning head and a floor-based vacuum cleaner, which may be described as an "upright mode of operation". Valve assembly 440 can provide a second flow path between openings 441*a* and 441*c* to facilitate flow communication between the cleaning head and a handheld vacuum cleaner (and wand 403), which may be described as a "stick mode of operation". Valve assembly 440 can provide a third flow path between openings 441*b* and 441*c* to facilitate flow communication between the handheld vacuum cleaner (and wand 403) and the floor-based vacuum cleaner, which may be described as an "empty mode of operation". As explained in more detail below, valve assembly 440 can be transitioned between multiple configurations to facilitate such first, second, and third flow paths and the above-described flow communication and modes of operation. Valve assembly 440 can include a valve 443 and/or other structure to facilitate such first, second, and third flow paths and the above-described flow communication and modes of operation.

Valve assembly 440 can be transitioned to a first configuration to facilitate the above described "upright mode", in which the first flow path is open and the second and third flow paths are closed. Such first configuration can thereby allow debris collected by the cleaning head (for example, from a floor surface) to be directed to the floor-based vacuum cleaner. In some implementations, a valve of valve assembly 440 closes (e.g., blocks) the second and third flow paths when valve assembly 440 is in said first configuration. Valve assembly 440 can be transitioned to a second configuration to facilitate the above described "stick mode", in which the second flow path is open and the first and third flow paths are closed. The floor-based vacuum cleaner can be detached and lid 442 can be in a closed position (covering opening 441*b*) in such stick mode. Such second configuration can thereby allow debris collected by the cleaning head (for example, from a floor surface) to be directed to the handheld vacuum cleaner (for example, via wand 403). In some implementations, lid 442 of valve assembly 440 closes (for example, blocks) the first and third flow paths (for example, by covering opening 441*b*) when valve assembly 440 is in said second configuration. Valve assembly 440 can be transitioned to a third configuration to facilitate the above described "empty mode", in which the third flow path is open and the first and second flow paths are closed. Such third configuration can thereby allow debris from the handheld vacuum cleaner (for example, a debris container of the handheld vacuum cleaner) to be directed to the floor-based vacuum cleaner (for example, a debris container of the floor-based vacuum cleaner). In some implementations, a valve of valve assembly 440 closes (e.g., blocks) the first and second flow paths when valve assembly 440 is in said third configuration. An example of the above-described valve is valve 443.

Valve assembly 440 can include a valve 443 and various other components for moving and/or positioning valve 443, for example, to facilitate the above-described first, second, and third configurations of valve assembly 440. For example, valve assembly 440 can include a frame 445 and linkage structure movably connected to frame 445 and valve 443 to allow movement (for example, rotation) of valve 443 (for example, within a portion of an interior of valve housing 441).

FIG. 4D illustrates a perspective view of valve 443. Valve 443 can include a body 443*b* and walls 443*a*, 443*c* connected to body 443*b*. Walls 443*a*, 443*c* can be arranged at opposite ends of valve 443 and spaced from one another by valve body 443*b*. Valve 443 can be sized and/or shaped to be positioned within a portion of the interior of valve housing 441. In some implementations, valve 443 have a circular profile and/or cross-section, in which case valve 443 can be arranged in a cylindrical portion of valve housing 441 (see FIG. 4B). FIGS. 4B-4C illustrate a partially exploded view of valve assembly 440, in which valve 443, frame 445, and other components are removed from the interior of valve housing 441. Valve housing 441 can include a fourth opening 441*d* to facilitate insertion and/or removal of valve 443 within the interior of valve housing 441 (for example, a cylindrical portion of valve housing 441). In some implementations, the fourth opening 441*d* can have a circular shape, for example, in implementations in which valve 443 has a circular profile and/or cross-section. With reference to FIG. 4D, walls 443*a* and/or 443*c* can have a circular shape. Wall 443*a* can have an annular shape having an opening that is configured to be positioned adjacent to and/or aligned with opening 441*b* of valve housing 441 when valve assembly 440 is assembled. In some implementations, wall 443*a* is configured to seat and/or seal against a portion of valve housing 441 around opening 441*b*. In some implementations, wall 443*a* can have a greater diameter than opening 441*b*. Wall 443*c* can comprise a plate, for example, a circular shaped plate. Wall 443*c* can be configured to engage and/or interact with frame 445, for example, via interaction between valve pin 443*d* and slot 445*e* of frame 445 and/or slot 453*a* of link 453 as described in more detail below. Pin 443*d* can extend from (for example, perpendicularly from) wall 443*c*. In some implementations, movement of pin 443*d* can move and/or rotate wall 443*c* and valve 443 to transition the valve assembly 440 between the first, second, and/or third configuration. In some implementations, wall 443*c* is configured to seat and/or seal against a portion of valve housing 441 around opening 441*d*.

With reference to FIG. 4C, wall 443*c* can be arranged within an outer wall of frame body 445*a*. FIG. 4E illustrates a cross-sectional view taken through valve 443 and valve assembly 440. FIG. 4E illustrates valve body 443*b*, wall 443*a*, lid 442, and a portion of valve housing 441 (for example, a cylindrical portion of valve housing 441). Valve body 443*b* can have a partially cylindrical shape, as shown. With reference to FIG. 4C, valve body 443*b* can have partially cylindrical shape having a central angle $\theta_1$ that can be between 90 degrees and 120 degrees, for example, between 95 degrees and 115 degrees, between 100 degrees and 110 degrees, between 100 degrees and 120 degrees, between 105 degrees and 115 degrees, or between 108 degrees and 112 degrees, or any value or range within or bounded by any of these values or ranges.

With reference to FIGS. 4A-4C and FIG. 4G, valve assembly 440 can include an actuator 444, frame 445, links 451, 453, 455, and an actuator 446. Frame 445 can include a frame body 445*a*, slots 445*d*, 445*e*, a cavity 445*f*, and frame portions 445*b*, 445*c* that can receive a portion of actuator 444 (for example, an end 444*a* of actuator 444). Frame portion 445*c* can be connected to link 451 via a spring 477. Spring 477 (for example, a first end thereof) can be connected to frame portion 445*c* via a hook 445*g* or other spring connection mechanism. Spring 477 (for example, a second end thereof) can also be connected to link 451 via a hook 451*a* of link 451. Spring 477 can be in a retracted position when valve assembly 440 is in the configuration shown and described with respect to FIGS. 4H-4I, a first extended position when valve assembly 440 is in the configuration shown and described with respect to FIGS. 4F-4G, and a second extended position when valve assembly 440 is in the configuration shown and described with respect to FIGS. 4J-4K (spring 477 being more extended in the second extended position than when in the first extended position). Link 453 can be connected to frame body 445*a* via a pin 473. Link 453 can include a slot 453*a* configured to receive pin 443*d* of valve 443. Link 453 can be connected to link 451 via a pin 471 (see FIG. 4G). Link 455 can be connected to frame body 445*a* via a pin 475 and connected to actuator 446 via engagement of a pin 446*a* of actuator 446 within a hole 455*a* of link 455 (see FIG. 4G). A portion of actuator 446 can be arranged within cavity 445*f* of frame 445 and such portion of actuator 446 can be surrounded by a spring 479. Slots 445*d*, 445*e* can have a curved shape, which can facilitate rotational movement of valve 443 between multiple positions as described further below. As described further below, various ones of links 451, 453, 455, actuator 446, actuator 444, springs 477, 479, and valve pin 443*d* can be moved and interact with one another and with floor-based vacuum cleaner 410 (or portions thereof) to facilitate transitioning valve assembly 440 to different configurations. As shown in at least FIGS. 4A-4C, valve housing 441 can include arms 441*g* (for example, on a side of valve housing 441) that are coupled to actuator 444. Arms 441*g* can be configured to allow actuator 444 to move along a longitudinal axis of actuator 444 (for example, upward and downward) while remaining coupled to actuator 444.

Figure 4G:
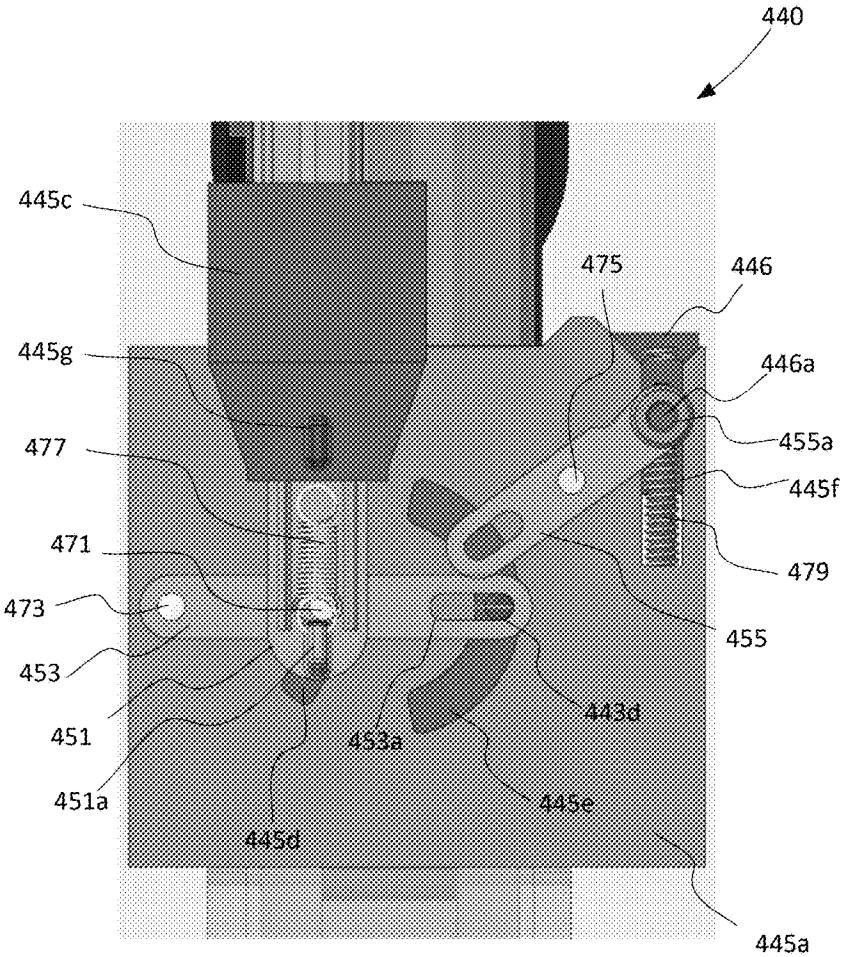
FIGS. 4F-4K illustrate various views of the valve assembly of FIGS. 4A-4E in different modes of operation in accordance with aspects of this disclosure.
Figure 4F:
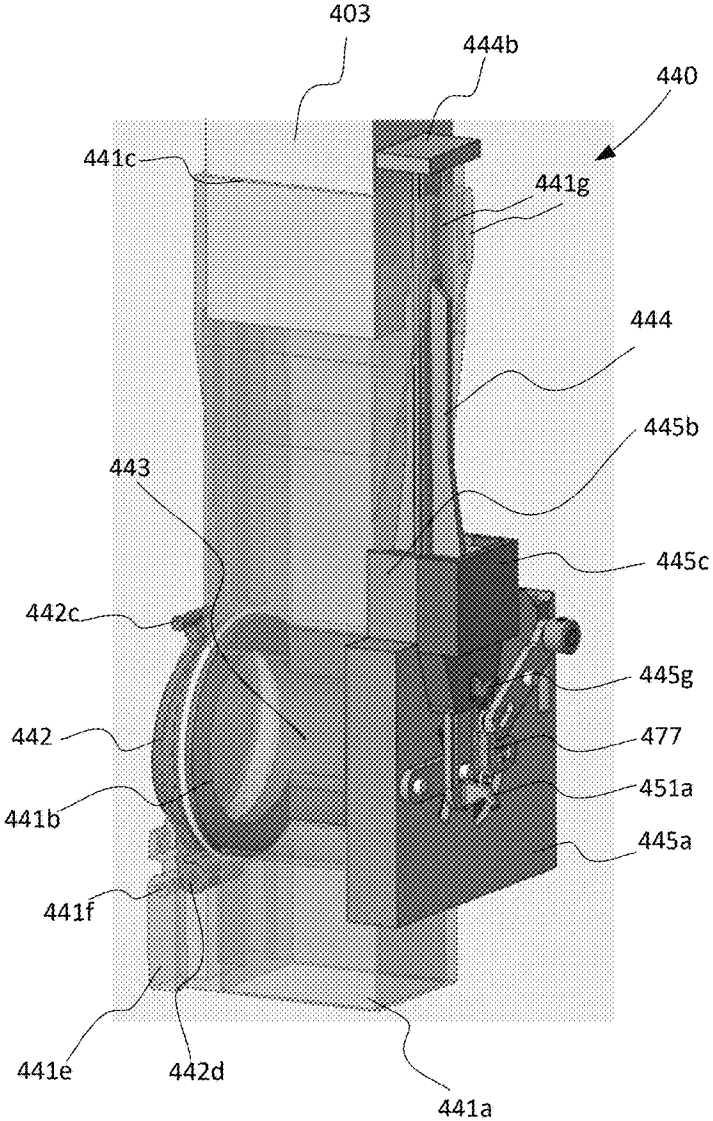

FIGS. 4F-4G illustrate valve assembly 440 in a configuration which can facilitate operation of a cleaning apparatus in a "stick mode" in which debris are collected by a cleaning head and directed to a handheld vacuum cleaner via wand 403 (for example, through a portion of the interior of valve housing 441). As shown, in such configuration, lid 442 is in a closed position and valve 443 is in a position in which valve body 443*b* does not block flow communication between openings 441*a* and 441*c*. In such configuration, wand 403 and a handheld vacuum cleaner connected to wand 403 are in flow communication with a cleaning head (for example, via a support member connected to cleaning head). FIG. 4F illustrates a perspective view of valve assembly 440 and wand 403 while FIG. 4G illustrates a side view of the valve assembly 440. Valve 443 can be held in such position by links 453, 455, 451 along with other components. As mentioned previously, valve 443 can include a valve pin 443*d* that extends through slot 445*e* of frame 445 and is received within slot 453*a* of link 453. Link 453 can be connected to frame 445 via pin 473 and connected to link 451 via pin 471. Spring 477 can connect link 451 to frame portion 445*c* (for example, via connection with hooks 445*g*, 451*a*). Spring 477 can exert a spring force on link 451 that biases link 451 in a direction towards frame portion 445*c* (for example, an "upward" direction). Such biasing can cause link 453 to pivot (for example, about an axis of pin 473) towards frame portion 445*c* (for example, in an "upward" direction) so as to move pin 443*d* to a top end of slot 445*e* (see FIG. 4G). A first end of link 455 can apply a force against link 453 so as to inhibit the upward rotational bias of link 453 imposed by spring 477 and link 451. Such force derives from a spring force applied by spring 479 against a portion of actuator 446. Actuator 446 can be connected to link 455 via engagement between a pin 446*a* of actuator and a hole 455*a* of link 455, which may be arranged at a second end of link 455 that is opposite the first end of link 455. Link 455 can be pivotably connected to frame 445*a* via pin 475 as shown. FIGS. 4F and 4G illustrate an example "rest state" of valve assembly 440 in which valve 443 is held in the above-described position. Valve assembly 440 can be biased toward the configuration described with respect to FIGS. 4F-4G. In some implementations, valve pin 443*d* is arranged at or proximate a midpoint of slot 445*e* and/or a middle of a length of slot 445*e* when valve assembly 440 is in the configuration of FIGS. 4F-4G.

Figure 4I:
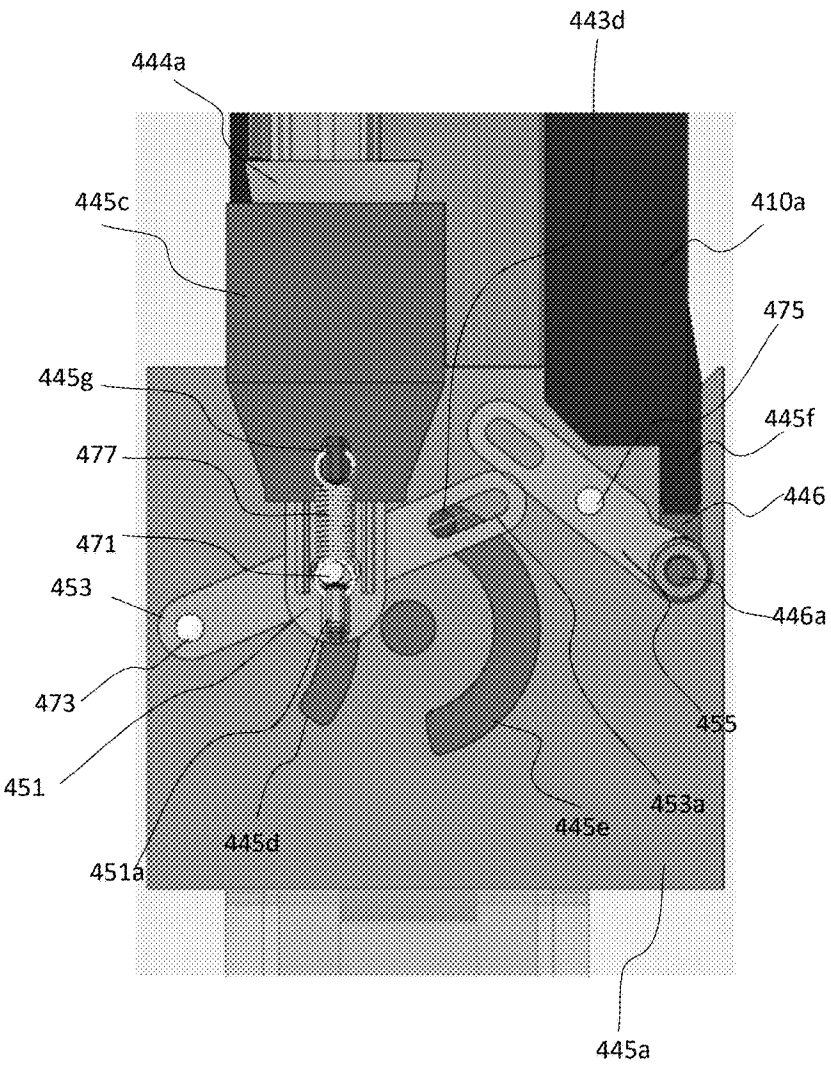
Figure 4H:
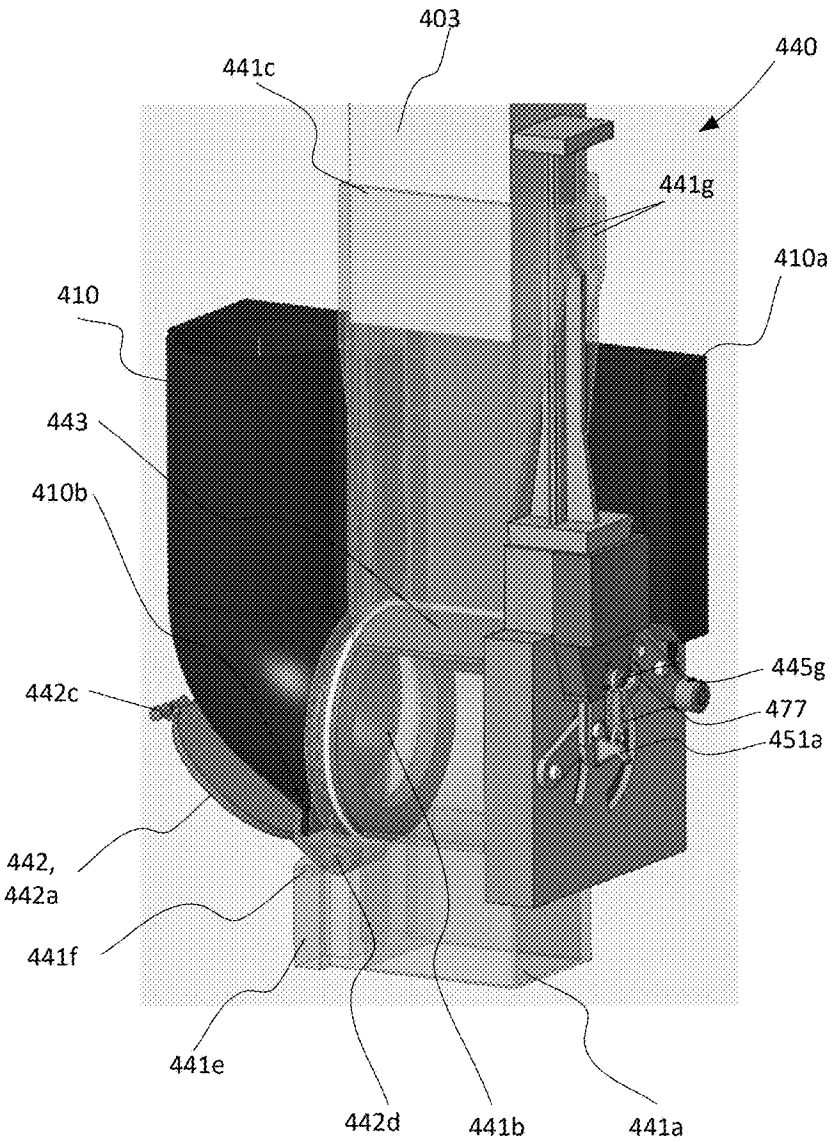

FIGS. 4H-4I illustrate valve assembly 440 attached with a floor-based vacuum cleaner 410 and a wand 403 and in another configuration. Such configuration can facilitate operation of a cleaning apparatus in an "upright mode" in which the floor-based vacuum cleaner 410 is utilized to collect debris from a floor surface, for example, as described herein. FIG. 4H illustrates a perspective view of valve assembly 440, floor-based vacuum cleaner 410, and wand 403 and FIG. 4I illustrates a side view of the same. As shown, floor-based vacuum cleaner 410 is attached to valve assembly 440 such that a dirty air inlet of the floor-based vacuum cleaner 410 is in flow communication with opening 441*b* of valve housing 441, for example, via opening 441*b*. As also shown, lid 442 is in an open position. As mentioned previously, lid 442 can be configured to be moved from a closed position (see FIGS. 4A-4C and 4F-4G) to the open position illustrated in FIG. 4H when floor-based vacuum cleaner 410 is attached to valve assembly 440. For example, a portion 410*b* of floor-based vacuum cleaner 410 can engage lid opening mechanism 442*c* when floor-based vacuum cleaner 410 is attached to valve assembly 440. During such attachment, portion 410*b* can be moved downward towards and onto lid opening mechanism 442*c*. In such cases, portion 410*b* can act as a cam surface and lid opening mechanism 442*c* can act as a cam follower. Accordingly, attachment of floor-based vacuum cleaner 410 to valve assembly 440 can cause lid 442 to pivot from the closed position to the open position. Lid opening mechanism 442*c* can be pivotably connected to valve housing 441 as described above (for example, via pin 442*d* and portions 441*f*, 441*f* of valve housing 441.).

When valve assembly 440 is in the configuration illustrated in FIGS. 4H-4I, valve 443 is in a second position in which valve body 443*b* blocks flow communication between opening 441*c* and both openings 441*a*, 441*b*. In such configuration, valve body 443*b* blocks flow communication between wand 403 (and a handheld vacuum cleaner that may be connected to wand 403) and both of floor-based vacuum cleaner 410 that may be connected to valve housing 441 at opening 441*b* and a cleaning head that may be connected to valve housing 441 at opening 441*a* (for example, via a support member such as any of those disclosed herein). In such configuration, floor-based vacuum cleaner 410 is in flow communication with such cleaning head, for example, via flow communication between openings 441*b*, 441*a*. Accordingly, this configuration enables debris to be collected by the cleaning head and directed to floor-based vacuum cleaner 410 (for example, through a portion of the interior of valve housing 441). FIG. 4I illustrates a side view of that which is shown in FIG. 4H. In the configuration illustrated in FIGS. 4H-4I, a portion 410*a* of floor-based vacuum cleaner 410 contacts actuator 446 and holds actuator 446 in a lower position relative to the position illustrated and described with respect to FIG. 4G. In such configuration, portion 410*a* overcomes the bias of spring 479 and compresses spring 479 within cavity 445*f* of frame 445, causing actuator 446 to be pushed further into cavity 445*f* (for example, "downward"). Spring 479 can be arranged within cavity 445*f* and an end (for example, a "top end") of spring 479 can be below and in contact with a bottom of actuator 446. Accordingly, spring 479 can be arranged between a bottom end of actuator 446 and a surface of cavity 479. Movement of actuator 446 in such manner causes link 455 to pivot from the position shown in FIG. 4G to the position shown in FIG. 4I, due to engagement of actuator pin 446*a* with hole 455*a* of link 455. Such pivoting of link 455 moves link 455 (for example, an end of link 455) away from link 453 (for example, an end of link 453). This in turn causes link 453 to pivot such that pin 443*d* moves to a top portion of slot 445*e* (see FIG. 4I). Movement of pin 443*d* in such manner causes valve 443 to rotate, thereby rotating valve body 443*b* to the position illustrated in FIG. 4H in which valve body 443*b* blocks flow communication between wand 403/opening 441*c* and both of openings 441*a*, 441*b*. In the configuration illustrated in FIGS. 4H-4I, pin 471, which connects links 451 and 453 to one another, can be arranged closer to a top end of slot 445*d* than to a bottom end of slot 445*d* (see FIG. 4I). In some implementations, valve pin 443*d* is arranged at or proximate a top end of slot 445*e* when valve assembly 440 is in the configuration of FIGS. 4H-4I.

Figure 4K:
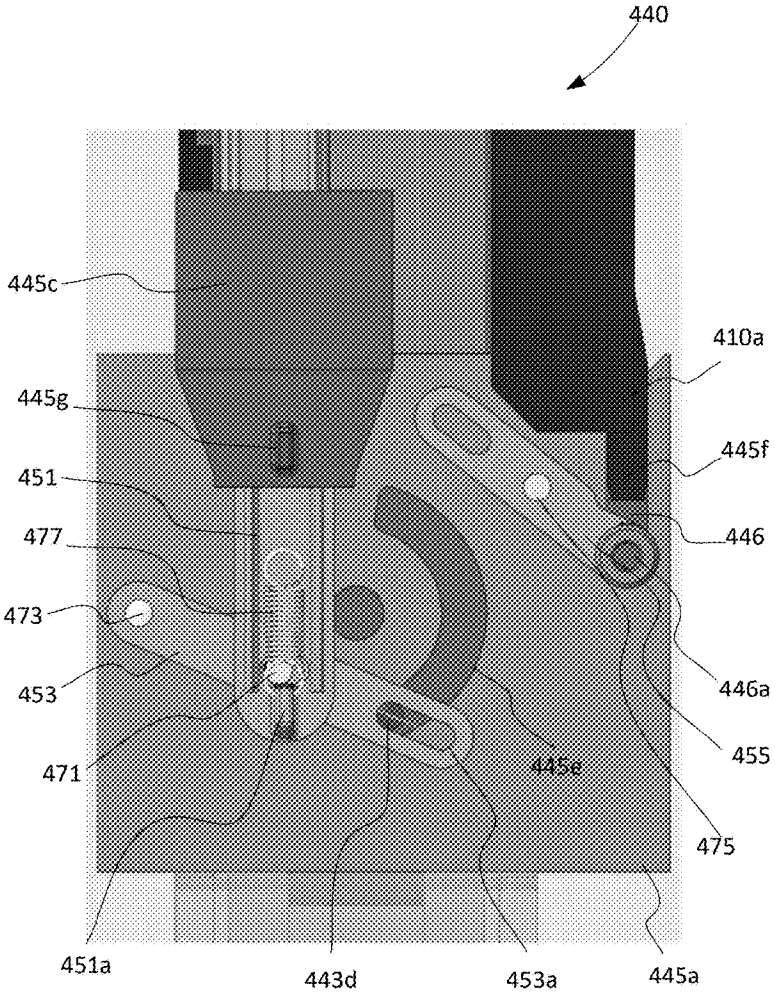
Figure 4J:
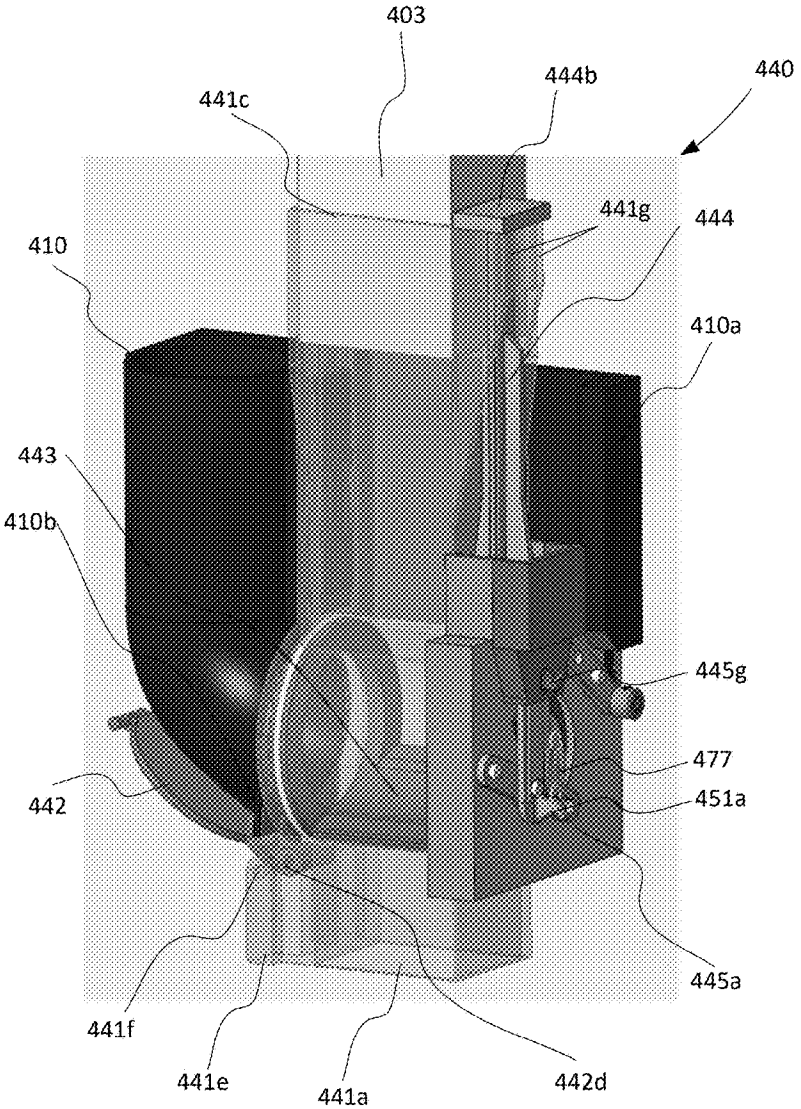

FIGS. 4J-4K illustrate valve assembly 440 attached with a floor-based vacuum cleaner 410 and a wand 403 and in another configuration. Such configuration can facilitate operation of a cleaning apparatus in an "empty mode" in which the debris from a handheld vacuum cleaner are transferred (for example, "emptied") into the floor-based vacuum cleaner 410. FIG. 4J illustrates a perspective view of valve assembly 440, floor-based vacuum cleaner 410, and wand 403 and FIG. 4K illustrates a side view of the same. As shown, floor-based vacuum cleaner 410 is attached to valve assembly 440 such that a dirty air inlet of the floor-based vacuum cleaner 410 is in flow communication with opening 441*b* of valve housing 441. As also shown, lid 442 is in an open position. When valve assembly 440 is in the configuration illustrated in FIGS. 4J-4K, valve 443 is in a third position in which valve body 443*b* blocks flow communication between opening 441*a* (and a cleaning head and/or support member connected to valve housing 441 at opening 441*a*) and both of wand 403 (and a handheld vacuum cleaner that may be connected to wand 403) and floor-based vacuum cleaner 410. In such configuration, floor-based vacuum cleaner 410 is in flow communication with wand 403 (and a handheld vacuum cleaner connected therewith), for example, via flow communication between openings 441*b*, 441*c*. Accordingly, this configuration enables debris to be directed from the handheld vacuum cleaner (for example, a debris container of the handheld vacuum cleaner) to floor-based vacuum cleaner 410 (for example, through wand 403 and a portion of the interior of valve housing 441. In the configuration illustrated in FIGS. 4J-4K, the portion 410*a* of floor-based vacuum cleaner 410 holds actuator 446 in the position described above with respect to FIG. 4I. However, actuator 444 has been moved (for example, "downward") to engage with an actuator 451*b* connected with link 451 (see FIG. 4C), thereby moving link 451 (for example, "downward") to the position illustrated in FIG. 4K. Such movement of link 451 overcomes the bias of spring 477 and causes spring 477 to be extended. Such movement of link 451 causes link 453 to be pivoted (due to the connection of links 451, 453 via pin 471) such that valve pin 443*d* is moved toward a bottom portion of slot 445*e* (due to the connection of valve pin 443*d* within slot 453*a* of link 453). Such movement of valve pin 443*d* in turn causes valve 443 to rotate, thereby rotating valve body 443*b* to the position illustrates in FIG. 4J. In such position, valve body 443*b* blocks flow communication between opening 441*a* and both of openings 441*b*, 441*c*. In some implementations, pin 443*d* can be arranged at or proximate a bottom end of slot 445*e* when valve assembly 440 is in the configuration of FIGS. 4J-4K.

Actuator 444 can include a first end 444*a* for engaging actuator 451*b* connected with link 451 (see FIG. 4C) and a second end 444*b* configured to be engaged (for example, "pushed"), for example, by a user when the user desires to transition the cleaning apparatus to the "empty mode" and empty debris from the handheld vacuum cleaner to the floor-based vacuum cleaner. In some implementations, actuator 444 can be moved in a first direction (for example, "downward") to transition the cleaning apparatus to the "empty mode" and/or be moved in a second direction substantially opposite the first direction (for example, "upward") to transition the cleaning apparatus to the "upright mode." In some implementations, actuator 444 comprises a rod. In some implementations, first end 444*a* can be sized to fit at least partially within frame portions 445*b*, 445*c*. In some implementations, the length and/or curvature of slot 445*e* can be configured to define a rotational range of rotation for valve 443 and valve body 443*b*, for example, by limiting the range of motion of pin 443*d* extending from wall 443*c* (due to the positioning of pin 443*d* within slot 445*e*). In some implementations, slot 445*e* and/or other components of valve assembly 440 are configured such that valve 443 (and valve body 443*b*) are configured to rotate less than 360 degrees, for example, 180 degrees, between the three positions described with respect to FIGS. 4A-4K.

Figure 5A:
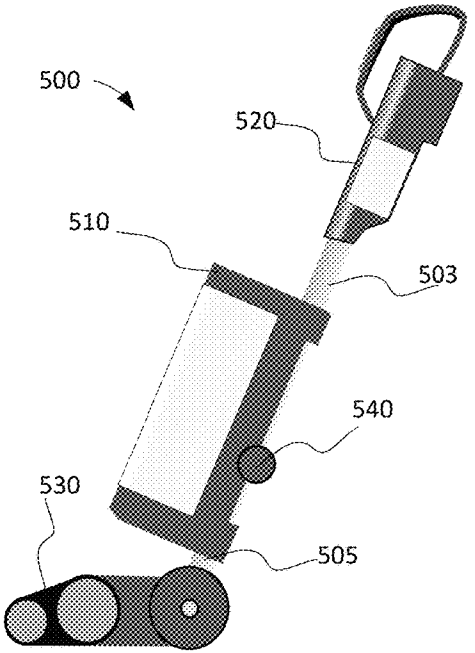
FIG. 5A illustrates another implementation of a cleaning apparatus in an example upright mode of operation in accordance with aspects of this disclosure.
Figure 5B:
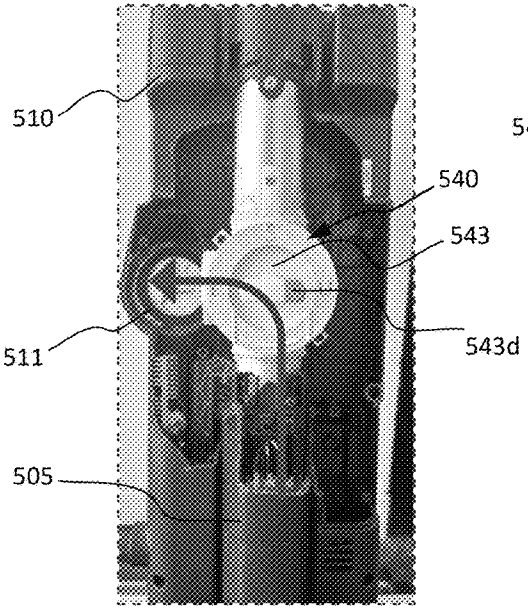
FIGS. 5B-5E illustrate portions of the cleaning apparatus of FIG. 5A in the example upright mode of operation in accordance with aspects of this disclosure.
Figure 5C:
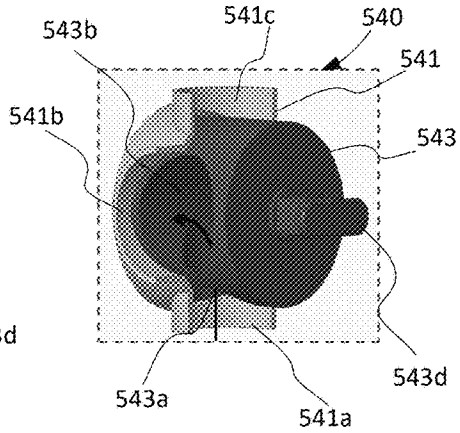
Figure 5D:
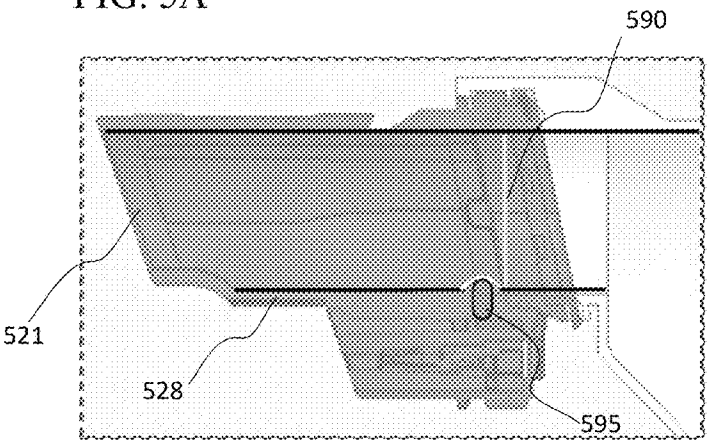
Figure 5E:
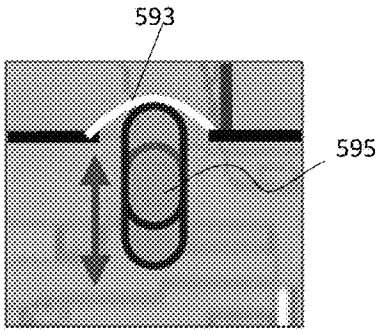
Figure 5G:
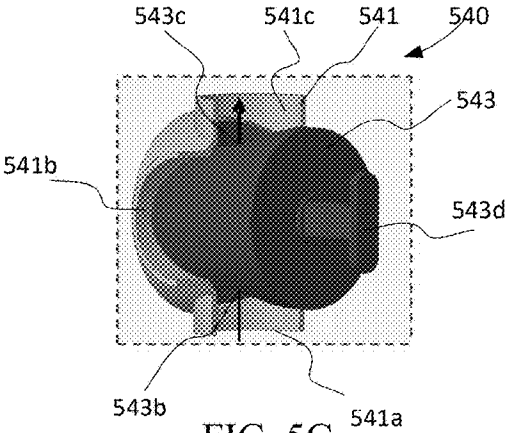
FIGS. 5G-5H illustrate portions of the cleaning apparatus of FIG. 5A in the example stick mode of operation illustrated in FIG. 5F in accordance with aspects of this disclosure.
Figure 5F:
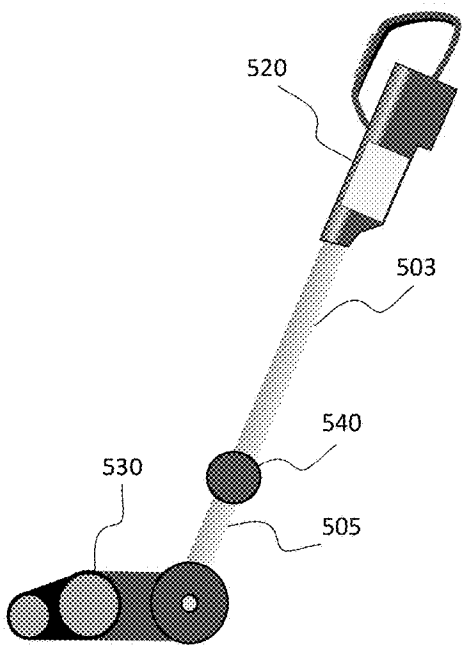
FIG. 5F illustrates the cleaning apparatus of FIG. 5A in an example stick mode of operation in accordance with aspects of this disclosure.
Figure 5H:
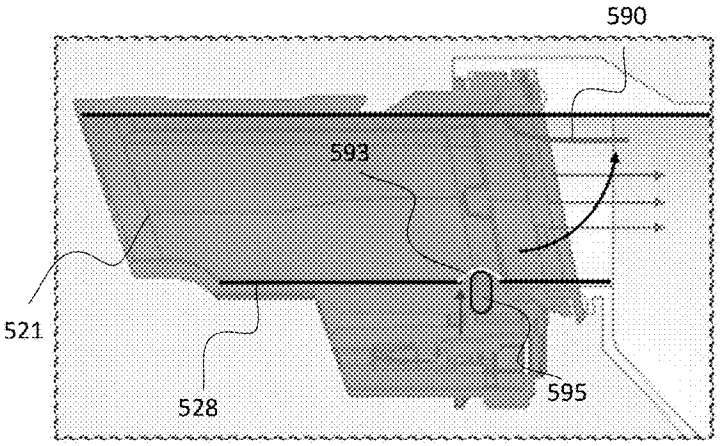
Figure 5K:
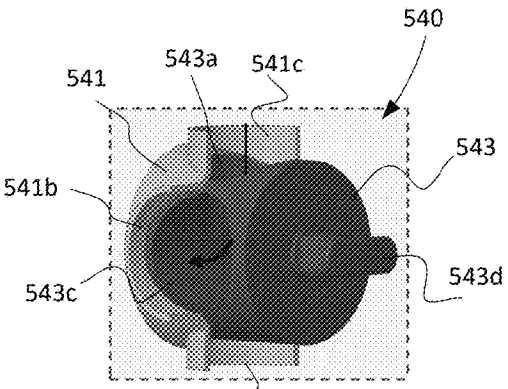
FIGS. 5J-5L illustrate portions of the cleaning apparatus of FIG. 5A in the example empty mode of operation illustrated in FIG. 5I in accordance with aspects of this disclosure.
Figure 5J:
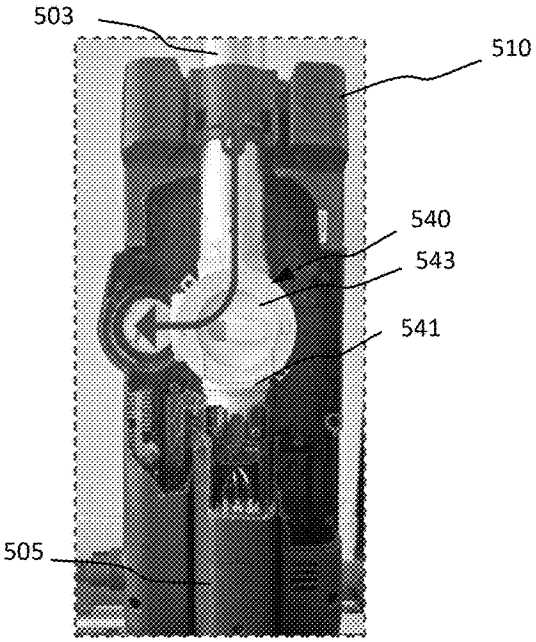
Figure 5L:
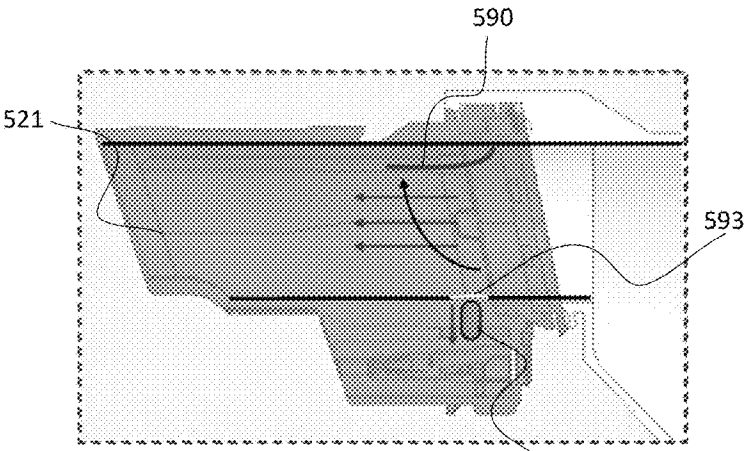
Figure 5I:
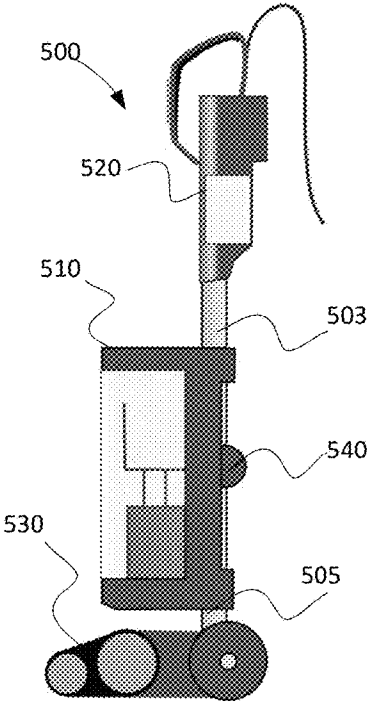
FIG. 5I illustrates the cleaning apparatus of FIG. 5A in an example empty mode of operation in accordance with aspects of this disclosure.
Figure 5M:
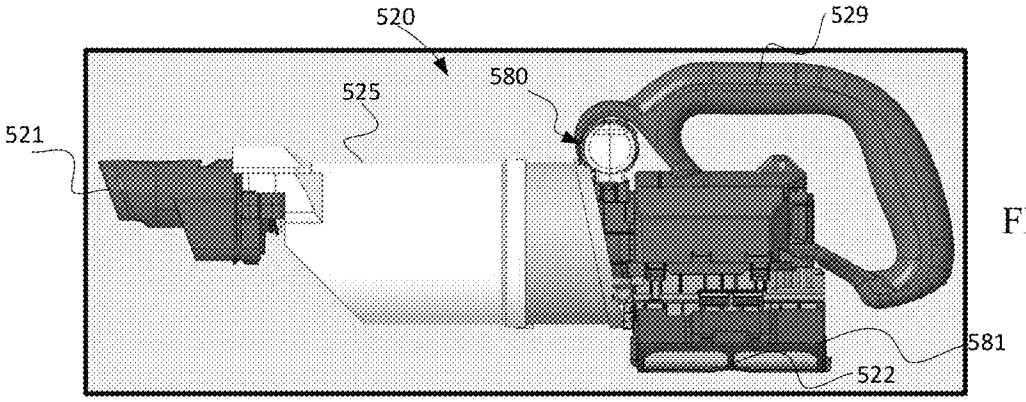
FIGS. 5M-5O illustrate a portion of a handheld vacuum cleaner and a valve in accordance with aspects of this disclosure.
Figure 5N:
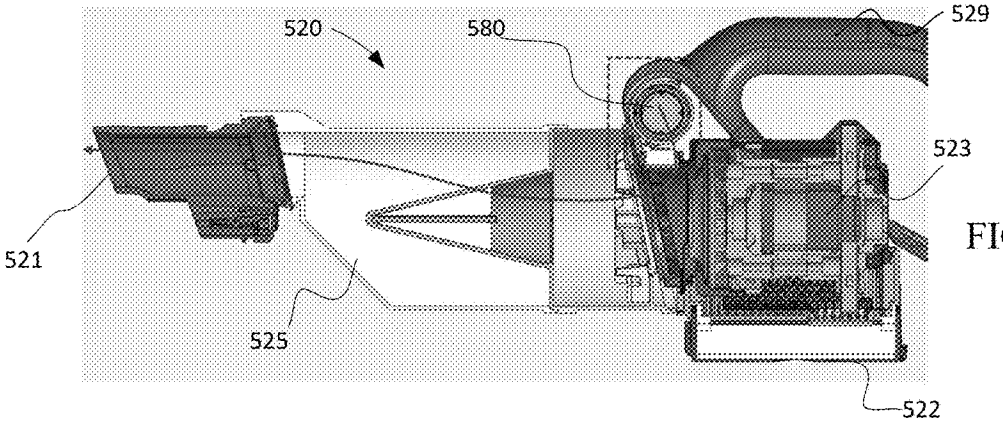
Figure 5O:
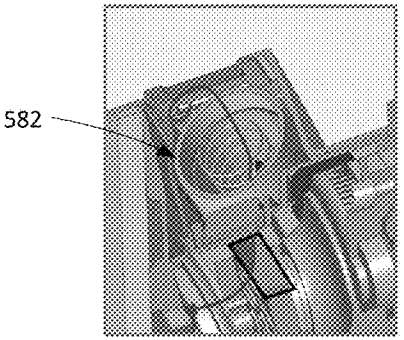

FIGS. 5A-5O illustrate another implementation of a cleaning apparatus 500. With reference to FIG. 5A, cleaning apparatus 500 can include a cleaning head 530, a floor-based vacuum cleaner 510, a handheld vacuum cleaner 520, a support member 505 connected to cleaning head 530, and a wand 503 connected between support member 505 and handheld vacuum cleaner 520. Handheld vacuum cleaner 520 and wand 503 can be removably attachable to one another. Wand 503 can be removably attachable to support member 505. Support member 505 can be pivotably connected to cleaning head 530. Cleaning head 530 can include any of all of the features described with respect to any of the cleaning heads disclosed herein, such as cleaning head 130, 230, and/or 330. Floor-based vacuum cleaner 510 can include any of all of the features described with respect to any of floor-based vacuum cleaner 110, 210 and/or vacuum cleaner 310. Handheld vacuum cleaner 520 can include any of all of the features described with respect to any of handheld vacuum cleaner 120, 220 and/or vacuum cleaner 320. Wand 503 can be similar or identical to any of wands 103, 203. Support member 505 can be similar or identical to any of support members 105, 205.

FIG. 5A schematically illustrates cleaning apparatus 500 in an upright mode of operation in which debris are collected by cleaning head 530 and directed to floor-based vacuum cleaner 510 (for example, via support member 505). FIG. 5F schematically illustrates cleaning apparatus 500 in a stick mode of operation in which debris are collected by cleaning head 530 and directed to handheld vacuum cleaner 520 (for example, via support member 505 and wand 503). FIG. 5I schematically illustrates cleaning apparatus 500 in an empty mode of operation in which debris from handheld vacuum cleaner 520 are directed ("emptied") into floor-based vacuum cleaner 510 (for example, via wand 503). FIGS. 5A, 5F, and 5I schematically illustrate a valve assembly 540 of cleaning apparatus 500. FIGS. 5B-5C, 5G, and 5J-5K illustrate an example implementation of valve assembly 540 in different configurations to facilitate the above-described three modes of operation of cleaning apparatus 500. Valve assembly 540 can include a valve housing 541 that includes openings 541*a*, 541*b*, 541*c* for providing flow paths between cleaning head 530 (via support member 505), floor-based vacuum cleaner 510, and handheld vacuum cleaner 520 (via wand 503). Valve assembly 540 also includes a valve 543 that can be moved to different positions to open or close any of such flow paths and openings 541*a*, 541*b*, 541*c*. Valve 543 can comprise a cylindrically shaped valve with openings 543*a*, 543*b*, 543*c*. In some implementations, valve 543 is arranged within a cylindrically-shaped portion of an interior of valve housing 541.

FIGS. 5B-5C illustrate a configuration for valve assembly 540 in which a flow path between openings 541*a* and 541*b* is open; a flow path between opening 541*a* and 541*c* is closed; and a flow path between opening 541*b* and 541*c* is closed. Such configuration can provide flow communication between floor-based vacuum cleaner 510 and cleaning head 530 and thereby facilitate the upright mode of operation for cleaning apparatus 500. FIG. 5B illustrates a dirty air inlet 511 of floor-based vacuum cleaner 510 which can be in flow communication with opening 541*b* of valve assembly 540 when the valve assembly 540 is in the configuration illustrated in FIGS. 5B-5C. Such dirty air inlet 511 can be coupled with opening 541*b* via a duct. FIG. 5G illustrates a configuration for valve assembly 540 in which: a flow path between openings 541*a* and 541*c* is open; a flow path between opening 541*b* and 541*a* is closed; and a flow path between opening 541*b* and 541*c* is closed. Such configuration can provide flow communication between handheld vacuum cleaner 520 and cleaning head 530 and thereby facilitate the stick mode of operation for cleaning apparatus 500. FIGS. 5J-5K illustrate a configuration for valve assembly 540 in which: a flow path between openings 541*b* and 541*c* is open; a flow path between openings 541*a* and 541*b* is closed; and a flow path between openings 541*a* and 541*c* is closed. Such configuration can provide flow communication between handheld vacuum cleaner 520 and floor-based vacuum cleaner 510 and thereby facilitate the empty mode of operation for cleaning apparatus 500.

Valve 543 can be configured to be rotated between any of the rotational positions illustrated in FIGS. 5C, 5G, and 5K to facilitate the above-described modes of operation. Valve 543 can comprise a handle 543*d* that allow a user to rotate valve 543 between any of such rotational positions.

FIGS. 5M-5N illustrate an example implementation of handheld vacuum cleaner 520. Handheld vacuum cleaner 520 can include a dirty air inlet 521, a handle 529, a clean air outlet 522, a debris container 525, a motor 523, and a filter 581 (such as a HEPA filter) arranged proximate the motor 523 and/or clean air outlet 522. Handheld vacuum cleaner 520 can include any of the features described with respect to any of the other handheld vacuum cleaners disclosed herein, such as handheld vacuum cleaner 320. Handheld vacuum cleaner 520 can include a bleed valve 580 arranged within an auxiliary inlet 582 of handheld vacuum cleaner 520 that is separate from clean air outlet 522 and dirty air inlet 521. Bleed valve 580 and such auxiliary inlet 582 can advantageously be utilized to allow air to flow into handheld vacuum cleaner 520 when cleaning apparatus 500 is in the empty mode of operation and a suction motor of floor-based vacuum cleaner 510 causes air to flow from handheld vacuum cleaner 520 to floor-based vacuum cleaner 510 (to collect debris from debris container 525 into a debris container of floor-based vacuum cleaner 510). Bleed valve 580 can also be utilized to relieve pressure within handheld vacuum cleaner 520 if there is a blockage in airflow during utilization of a suction motor 523 of handheld vacuum cleaner 520. Bleed valve 580 can be a movable member that is biased to a first state (which also may be referred to as a "closed position") in which auxiliary inlet 582 is blocked. Bleed valve 580 can be transitioned from such first state to a second state (which also may be referred to as an "open position") in which auxiliary inlet 582 is open to an FIG. 5O illustrates the auxiliary air inlet 582 with the bleed valve removed and also illustrates an airflow path (with an arrow) into and through the auxiliary air inlet 582 and into an interior portion of handheld vacuum cleaner 520. FIG. 5N illustrates an airflow path (with an arrow) through the handheld vacuum cleaner 520 and through the dirty air inlet 521.

FIGS. 5D, 5H, and 5L illustrate enlarged views of a portion of handheld vacuum cleaner 520. FIGS. 5D, 5H, and 5L illustrate dirty air inlet 521 of handheld vacuum cleaner 520 along with a portion 528 of a housing of handheld vacuum cleaner 520. As shown, handheld vacuum cleaner 520 can include a valve 590 that inhibits debris from falling out of debris container 525 of handheld vacuum cleaner 520, for example, when cleaning apparatus 500 (or handheld vacuum cleaner 520) is not being actively used to collect debris from a surface. FIG. 5D illustrates a closed position of valve 590 in which valve 590 blocks an airflow passage between dirty air inlet 521 and debris container 525. Valve 590 can be in such closed position when cleaning apparatus 500 is in the upright mode as described with respect to FIGS. 5A-5C. FIG. 5H illustrates valve 590 in a first open position in which valve 590 does not block the airflow passage between dirty air inlet 521 and debris container 525. As shown, in such first open position, valve 590 is pivoted towards debris container 525 and away from dirty air inlet 521. Such first open position can be induced via suction caused by suction motor 523 of handheld vacuum cleaner 520 when cleaning apparatus 500 is in the stick mode. Valve 590 can be pivotably connected to a portion of handheld vacuum cleaner 520 (for example, portion 528) to facilitate such movement. FIG. 5L illustrates valve 590 in a second open position in which valve 590 does not block the airflow passage between dirty air inlet 521 and debris container 525. As shown, in such second open position, valve 590 is pivoted away from debris container 525 and towards dirty air inlet 521. Such second open position can be induced via suction caused by a suction motor of floor-based vacuum cleaner 510 when cleaning apparatus 500 is in the empty mode. As shown, valve 590 can be pivoted in opposite directions for the first and second open positions. Valve 590 can be biased toward the closed position shown in FIG. 5D.

In some cases, debris from debris container 525 of handheld vacuum cleaner 520 can fall atop valve 590, for example, under force of gravity. With reference to FIG. 5D, handheld vacuum cleaner 520 can be configured to inhibit valve 590 from opening (for example, pivoting to the above-described "second open position" shown in FIG. 5L) due to weight of debris. For example, handheld vacuum cleaner 520 can include a stopper 595 that can be moved (for example, actuated) to inhibit valve 590 from opening. FIGS. 5D, 5E, and 5H illustrate stopper 595 in a first position in which stopper 595 presents a physical interference to block valve 590 from opening (for example, in the direction of the position of valve 590 illustrated in FIG. 5L). FIG. 5L illustrates stopper 595 in a second position in which stopper 595 does not block valve 590 and valve 590 is allowed to open (for example, in the direction of the position of valve 590 illustrated in FIG. 5L). Stopper 595 can be moved to the position shown in FIG. 5L to allow valve 590 to be opened via suction induced by a suction motor of floor-based vacuum cleaner 510 so that debris from handheld vacuum cleaner 520 can be directed to floor-based vacuum cleaner 510. With reference to FIGS. 5D, 5E, 5H, and 5L, handheld vacuum cleaner 520 can include a sealing member 593 to seal the air passage within handheld vacuum cleaner 520 when stopper 595 is moved into its blocking position. Stopper 595 can be movable by a user and/or may be automatically and/or electrically actuated by cleaning apparatus 500, for example, when the user desires to operate in the empty mode. In some implementations, stopper 595 is configured to be held in one of the two positions until a user applies a force to stopper 595.

As mentioned previously, handheld vacuum cleaner 520 can include a bleed valve 580. Bleed valve 580, and an auxiliary air inlet of handheld vacuum cleaner 520 in which bleed valve 580 is arranged, can advantageously provide a robust airflow path through handheld vacuum cleaner 520 when cleaning apparatus 500 is used in the empty mode of operation. As described above with respect to FIGS. 5I, 5J, and 5K, in such mode, a suction motor 523 of floor-based vacuum cleaner 510 can cause air to flow from handheld vacuum cleaner 520 through wand 503, valve assembly 540, and to floor-based vacuum cleaner 510, thereby directing debris from debris container 525 of handheld vacuum cleaner 520 to floor-based vacuum cleaner 510. More specifically, floor-base vacuum cleaner 510 can cause air to flow through a dirty air inlet, debris separator, and a clean air outlet of floor-based vacuum cleaner 510 during such mode. During such operation, bleed valve 580 can be configured to open to allow air to be sucked into the auxiliary air inlet and through one or more flow passages within handheld vacuum cleaner 520 and through debris container 525, thereby causing debris from debris container 525 to be carried towards floor-based vacuum cleaner 510. Accordingly, bleed valve 580 can not only open to relieve pressure due to an airflow clog when handheld suction motor 523 is operated (to avoid motor overheating), but also can open to facilitate the above-described empty mode of operation of cleaning apparatus 500.

FIGS. 6A-6F illustrate another implementation of cleaning apparatus 600. Cleaning apparatus 600 can be similar or identical to any of cleaning apparatus 100, 200, 300, 500 in some or many respects. Cleaning apparatus 600 includes a floor-based vacuum cleaner 610, a cleaning head 630, a handheld vacuum cleaner 620, a wand 603, a support 605, and a power cord 601, which can be similar or identical to floor-based vacuum cleaner 110, 210, 510, cleaning head 130, 230, 530, handheld vacuum cleaner 120, 220, 520, wand 103, 203, 503, support member 105, 205, 505 and power cord 101, 201, respectively. FIGS. 6B, 6D, and 6F illustrate a valve assembly 640 of cleaning apparatus 600 that can be utilized to facilitate a stick mode of operation (FIGS. 6A-6B), an upright mode of operation (FIGS. 6C-6D), and an empty mode of operation (FIGS. 6E-6F) in a similar manner as described elsewhere herein with respect to valve assemblies 440, 540. Valve assembly 640 includes a valve housing 641 that can include three openings for providing flow communication between floor-based vacuum cleaner 610, cleaning head 630 (for example, via support member 605), and handheld vacuum cleaner 620 (for example, via wand 603). FIGS. 6B, 6D, and 6F illustrate two of such openings-opening 641*c* which can provide flow communication between wand 603 and an interior of valve housing 641 and opening 641*a* which can provide flow communication between support member 605 (and cleaning head 630) and the interior of valve housing 641. Valve assembly 640 can include a valve 643 that can be moved (for example, rotated) between a plurality of positions (such as three positions) to selectively open or close flow paths between any two of floor-based vacuum cleaner 610, cleaning head 630, and handheld vacuum cleaner 620. Although FIGS. 6B, 6D, and 6F illustrate a cross-section through valve assembly 640 and valve 643, it is to be understood that valve assembly 640 and valve 643 can be configured to form an chamber to selectively open and close the above-described flow paths, for example, in a similar manner as that shown and/or described with respect to valve assembly 540. In some implementations, valve 643 can be transitioned from the position illustrated in FIGS. 6A-6B to the position illustrated in FIGS. 6C-6D automatically when floor-based vacuum cleaner 610 is attached to cleaning head 630, support member 605, and/or wand 603. In some implementations, valve 643 can be transitioned from the position illustrated in FIGS. 6C-6D to the position illustrated in FIGS. 6E-6F via pressing an actuator (for example, a button), for example, similar to actuator 444 of valve assembly 440.

Figure 8:
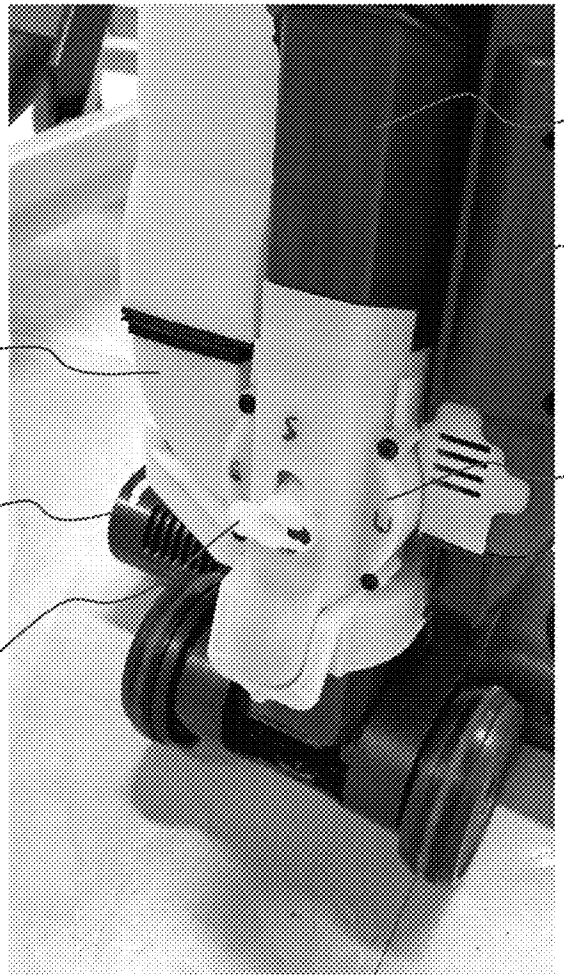
FIGS. 7-8 illustrate portions of cleaning apparatuses in accordance with aspects of this disclosure.
Figure 7:
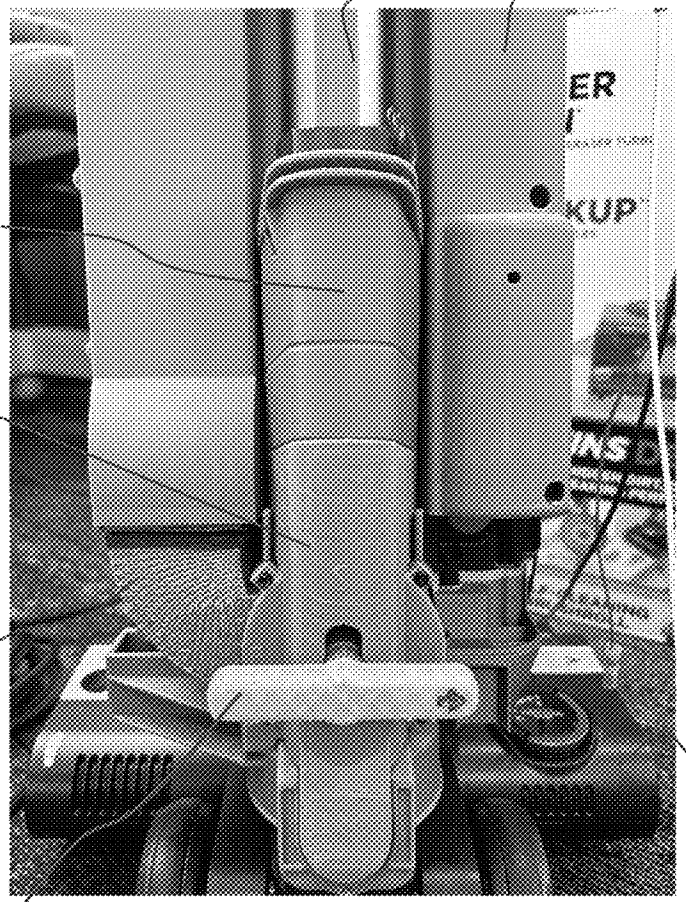

FIGS. 7-8 illustrate additional implementations of portions of cleaning apparatuses 700, 800. Cleaning apparatus 700 can include a cleaning head 730, a floor-based vacuum cleaner 710, a support member 705, a valve assembly 740, a valve within valve assembly 740, a handle 743 of valve assembly 740, and a duct 790 that can be connected to an opening of valve assembly 740 to provide flow communication between a dirty air inlet of floor-based vacuum cleaner 710 and an interior of a valve housing of valve assembly 740. Cleaning apparatus 700 can include a wand 703 connected to support member 705. Cleaning apparatus 800 can include a cleaning head 830, a floor-based vacuum cleaner 810, a support member 805, a valve assembly 840, a valve within valve assembly 840, a handle 843 of valve assembly 840, and a duct 890 that can be connected to an opening of valve assembly 840 to provide flow communication between a dirty air inlet of floor-based vacuum cleaner 810 and an interior of a valve housing of valve assembly 840. Although FIGS. 7-8 illustrate only a portion of cleaning apparatus 700, 800, cleaning apparatus 700, 800 can include a handheld vacuum cleaner such as any of those disclosed herein. Cleaning apparatus 700, 800 can be configured to operate in stick, upright, and/or empty modes such as any of those described herein.

Figure 9A:
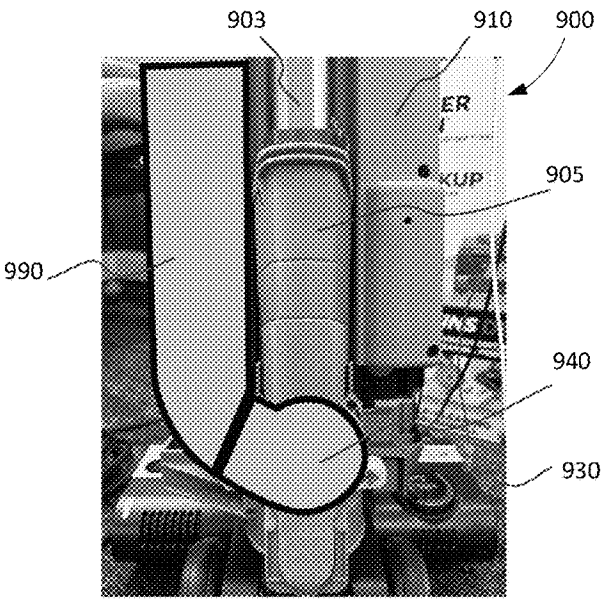
FIG. 9A illustrates portions of another implementation of a cleaning apparatus in accordance with aspects of this disclosure.
Figure 9B:
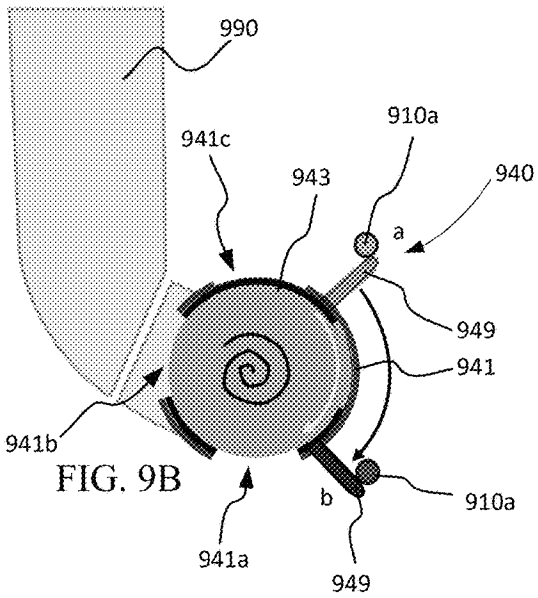
FIGS. 9B-9D illustrate schematic representations of portions of the cleaning apparatus of FIG. 9A in accordance with aspects of this disclosure.
Figure 9C:
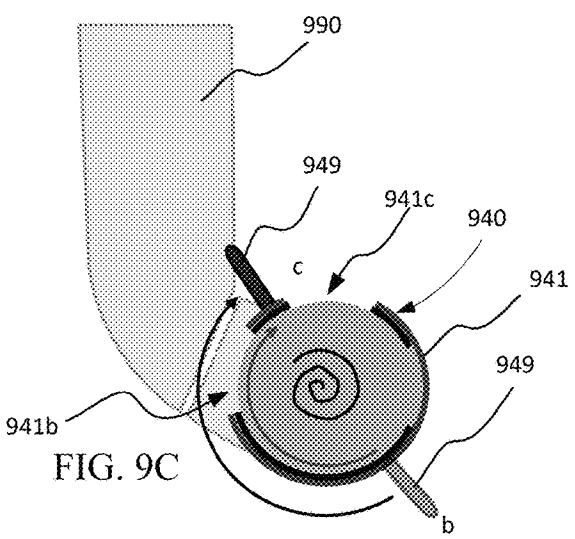
Figure 9D:
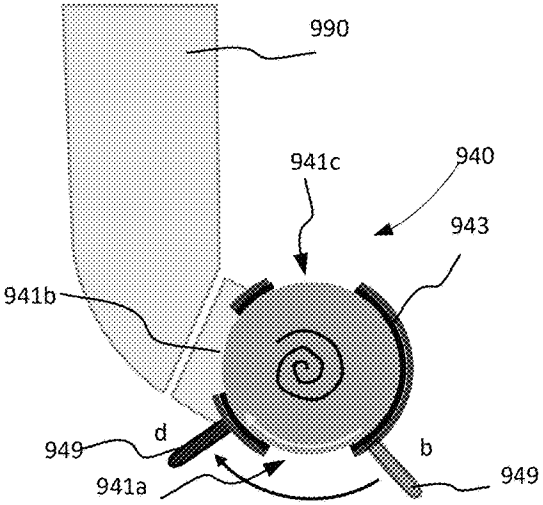

FIG. 9A illustrates a portion of another cleaning apparatus 900. Cleaning apparatus 900 can include a cleaning head 930, a floor-based vacuum cleaner 910, a wand 903, a support member 905, and a valve assembly 940. FIGS. 9B-9D schematically illustrate valve assembly 940 in various configurations, as described below. Valve assembly 940 can include a valve housing 941 which includes openings 941*a*, 941*b*, 941*c* for providing flow communication between wand 903, floor-based vacuum cleaner 910, and cleaning head 930. Cleaning apparatus 900 can include a duct 990 that can be connected to an opening of valve assembly 740 (for example, opening 941*b*) to provide flow communication between a dirty air inlet of floor-based vacuum cleaner 910 and an interior of valve housing 941 of valve assembly 940.

FIG. 9B illustrates an actuator feature 910*a* of floor-based vacuum cleaner 910 engaging a corresponding actuator feature 949 of valve assembly 940 such that the actuator features 910*a*, 949 move from the position indicated with "a" in FIG. 9B to the position indicated with "b" in FIG. 9B. Such movement can cause valve 943 to rotate to a position in which floor-based vacuum cleaner 910 is in flow communication with cleaning head 930. In the position of FIG. 9B, valve 943 blocks flow communication between wand 903 and both of floor-based vacuum cleaner 910 and cleaning head 930. Such movement can thereby facilitate an upright mode of operation of cleaning apparatus 900.

FIG. 9C illustrates actuator feature 949 being moved (for example, manually by a user) from the position indicated with a "b" in FIG. 9C to the position indicated with a "c" in FIG. 9C. Such movement can cause valve 943 to rotate to a position in which floor-based vacuum cleaner 910 is in flow communication with wand 903. In the position of FIG. 9C, valve 943 blocks flow communication between cleaning head 930 and both of floor-based vacuum cleaner 910 and wand 903, thereby facilitating an empty mode of operation of cleaning apparatus 900.

FIG. 9D illustrates actuator feature 949 being moved (for example, manually by a user) from the position indicated with a "b" in FIG. 9C to the position indicated with a "d" in FIG. 9C. As shown, such movement can cause valve 943 to rotate to a position in which floor-based vacuum cleaner 910, wand 903, and cleaning head 930 are in flow communication. In such position, as shown, openings 941*a*, 941*b*, and 941*c* are in flow communication with one another.

Valve assembly 940 can include a spring (for example, a coil spring) to cause the valve 943 to be rotated to a set position, for example, a position in which actuator feature 949 is located as indicated by "a" in FIG. 9B.

Figure 10C:
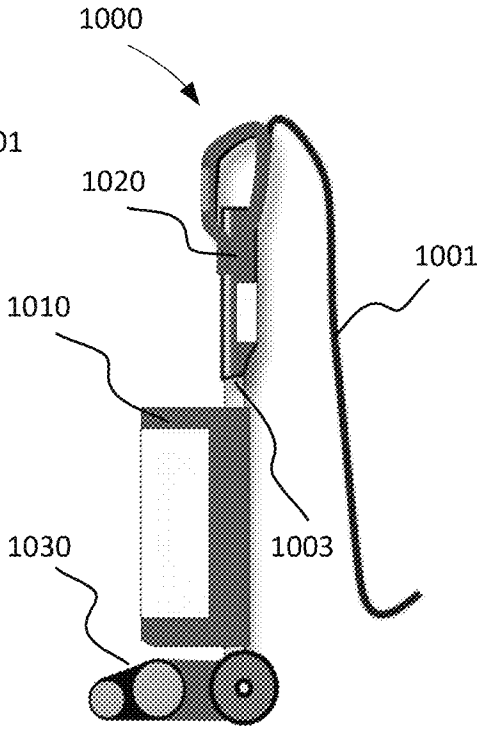
FIGS. 10A-10C illustrate another implementation of a cleaning apparatus in different modes of operation in accordance with aspects of this disclosure.
Figure 10B:
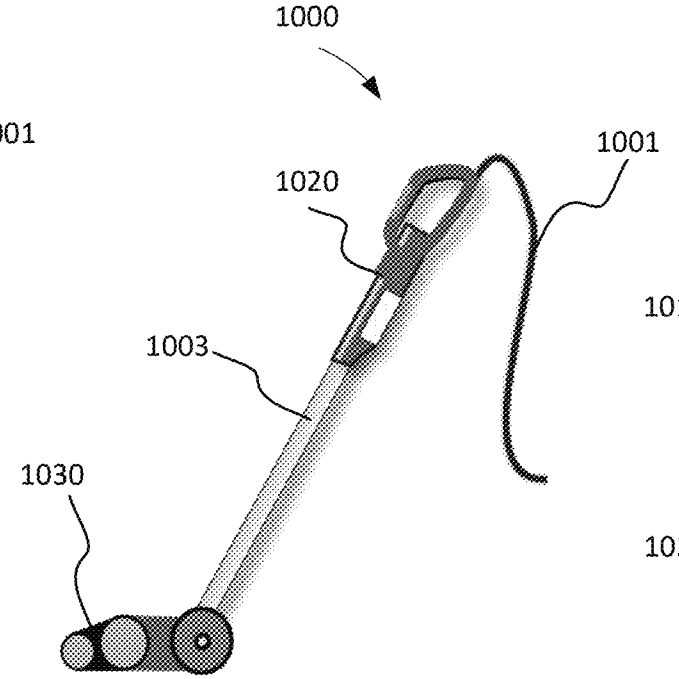
Figure 10A:
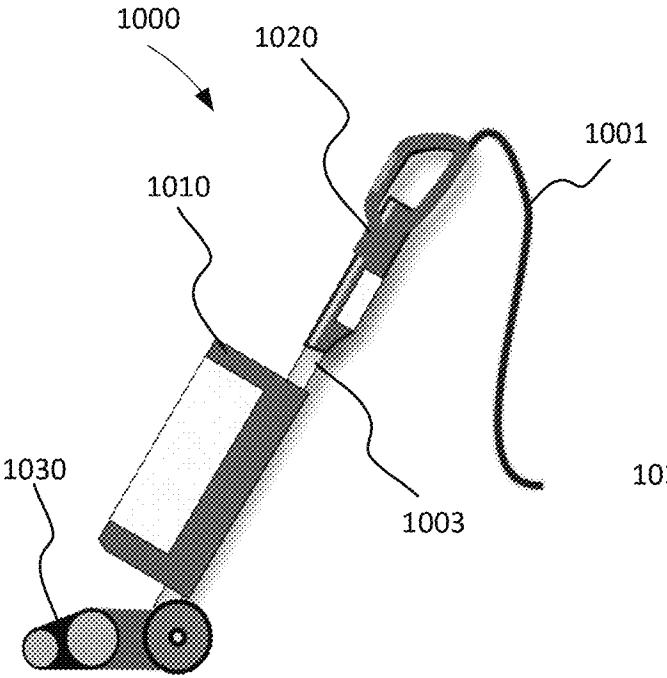

FIGS. 10A-10L illustrate another cleaning apparatus 1000 and portions thereof. With reference to FIGS. 10A-10C, cleaning apparatus 1000 can include a cleaning head 1030, a floor-based vacuum cleaner 1010, a handheld vacuum cleaner 1020, a wand 1003, and a cord 1001 connected with handheld vacuum cleaner 1020 and configured to provide power to cleaning apparatus 1000. Cleaning head 1030 can include any or all of the features described with respect to any of the cleaning heads disclosed herein, such as cleaning head 130, 230, and/or 330. Floor-based vacuum cleaner 1010 can include any or all of the features described with respect to any of floor-based vacuum cleaner 110, 210 and/or vacuum cleaner 310. Handheld vacuum cleaner 1020 can include any or all of the features described with respect to any of handheld vacuum cleaner 120, 220 and/or vacuum cleaner 320. Wand 1003 can be similar or identical to any of wands 103, 203. In some implementations, cleaning apparatus 1000 also includes a support member similar or identical to any of the other support members disclosed herein.

Figure 10L:
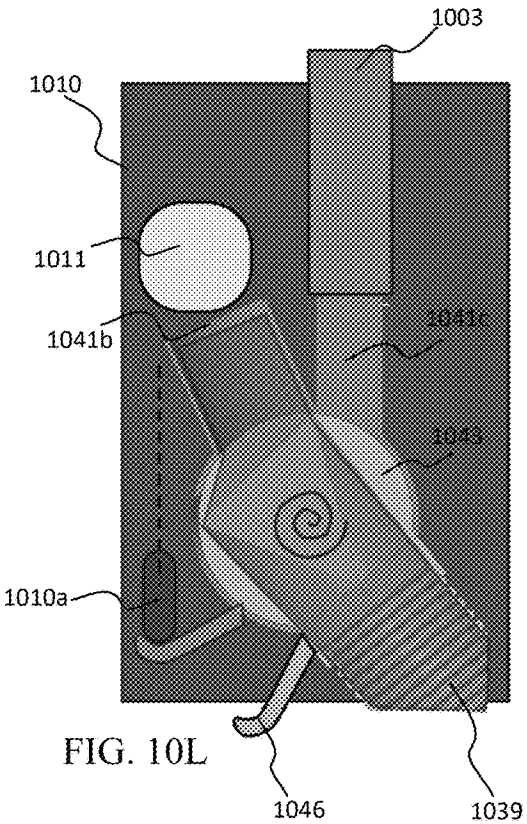
Figure 10M:
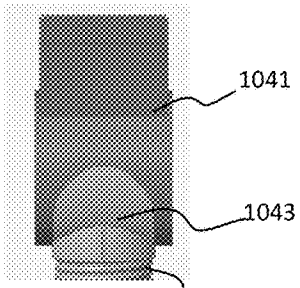
FIG. 10M illustrates a portion of the cleaning apparatus of FIGS. 10A-10C in accordance with aspects of this disclosure.

FIGS. 10A-10C illustrate cleaning apparatus 1000 in different modes of operation. More specifically, FIG. 10A illustrate cleaning apparatus 1000 in an upright mode of operation in which debris are drawn in through cleaning head 1030 and directed to floor-based vacuum cleaner 1010, FIG. 10B illustrates cleaning apparatus 1000 in a stick mode of operation in which debris are drawn in through cleaning head 1030 and directed to handheld vacuum cleaner 1020 (with floor-based vacuum cleaner 1010 being detached), and FIG. 10C illustrates cleaning apparatus 1000 in an empty mode of operation in which debris from handheld vacuum cleaner 1020 (for example, a debris container thereof) are transferred ("emptied") into floor-based vacuum cleaner 1010. FIGS. 10D-10F illustrate aspects of an example valve assembly 1040 that can be incorporated into cleaning apparatus 1000 to facilitate the above-described upright, stick, and empty modes of operation. FIGS. 10D-10F illustrate cross-sectional views taken through valve assembly 1040 and an end of a conduit 1039, each of which may reside at least partially in a portion of cleaning head 1030 or a support member connected to cleaning head 1030. Such conduit 1039 can be flexible conduit, for example, a corrugated hose that extends at least partially within a housing of cleaning head 1030 and is in flow communication with a dirty air inlet of cleaning head 1030. Valve assembly 1040 can include a valve housing 1041 having openings 1041*a*, 1041*b*, 1041*c* and an interior that receives a valve 1043. Floor-based vacuum cleaner 1010 can be fluidly connected to valve housing 1041 at opening 1041*b* (for example, via a duct). Wand 1003 (and handheld vacuum cleaner 1020, via wand 1003) can be fluidly connected to valve housing 1041 at opening 1041*c*. Valve 1043 can include a connector 1043*a* connected to an end of flexible conduit 1039. Valve 1043 can include walls 1043*b*, 1043*c* and an airflow passage extending through valve 1043 and in flow communication with conduit 1039. FIG. 10M illustrates a front view of conduit 1039, valve housing 1041, and valve 1043.

Valve 1043 and the end of conduit 1039 can be configured to be moved between different positions relative to valve housing 1041 to facilitate different flow paths for the above-described upright, stick, and empty modes of operation. FIG. 10D illustrates valve assembly 1040 in a configuration corresponding to the upright mode of operation of FIG. 10A. FIG. 10E illustrates valve assembly 1040 in a configuration corresponding to the stick mode of FIG. 10B. FIG. 10F illustrates valve assembly 1040 in a configuration corresponding to the empty mode of FIG. 10C. When valve assembly 1040 is in the configuration of FIG. 10D (for the upright mode), wall 1043*b* of valve 1043 blocks opening 1041*c* of valve housing 1041 such that flow communication between wand 1003 (and thus handheld vacuum cleaner 1020) and both of floor-based vacuum cleaner 1010 and conduit 1039 is blocked. As also shown in FIG. 10D, opening 1041*b* is in flow communication with conduit 1039 via valve flow passage 1043*d*, thereby providing flow communication between floor-based vacuum cleaner 1010 (which can be connected at opening 1041*b*) and a dirty air inlet of cleaning head 1030 (which can be in flow communication with conduit 1039). An example airflow pattern is illustrated with the arrow in FIG. 10D.

When valve assembly 1040 is in the configuration of FIG. 10E (for the stick mode), wall 1043*c* of valve 1043 blocks opening 1041*b* of valve housing 1041. Floor-based vacuum cleaner 1010 is detached from wand 1003, cleaning head 1030, and handheld vacuum cleaner 1020 when cleaning apparatus is in the stick mode of FIG. 10F (see FIG. 10B). Accordingly, opening 1041*b* is not in flow communication with both of opening 1041*c* and conduit 1039. Rather, opening 1041*c* is in flow communication with conduit 1039 via valve flow passage 1043*d*, thereby providing flow communication between wand 1003 (which can be connected at opening 1041*c*) and a dirty air inlet of cleaning head 1030 (which can be in flow communication with conduit 1039). This in turn provides flow communication between handheld vacuum cleaner 1020 and the dirty air inlet of cleaning head 1030 since handheld vacuum cleaner 1020 can be connected to wand 1003. An example airflow pattern is illustrated with the arrow in FIG. 10E.

When valve assembly 1040 is in the configuration of FIG. 10F (for the empty mode), neither of walls 1043*b*, 1043*c* block openings 1041*b*, 1041*c*, and openings 1041*b*, 1041*c* are in flow communication with one another and valve air passage 1043*d*. This can in turn allow debris to be transferred from the handheld vacuum cleaner 1020 to the floor-based vacuum cleaner 1010. An example airflow pattern is illustrated with the arrow in FIG. 10F.

FIGS. 10G-10I schematically illustrate another valve 1045 that can be incorporated into cleaning head 1030 or a support member connected with cleaning head 1030. FIGS. 10G-10H illustrate valve 1045 in an open position and FIG. 10I illustrates valve 1045 in a closed position. FIG. 10G illustrates the position of valve 1045 ("open") when cleaning apparatus 1000 is in the upright mode of FIG. 10A and FIG. 10H illustrates the position of valve 1045 ("open") when cleaning apparatus 1000 is in the stick mode of FIG. 10B. As shown, valve 1045 is open in both of these modes such that air (and debris) can flow through a dirty air inlet of cleaning head 1030 and to floor-based vacuum cleaner 1010 (for the upright mode of FIG. 10A) and handheld vacuum cleaner 1020 (for the stick mode of FIG. 10B). It is noted that FIGS. 10D and 10G illustrate portions of cleaning apparatus 1000 (as described above) corresponding the upright mode of FIG. 10A and that FIGS. 10E and 10H illustrate portions of cleaning apparatus 1000 (as described above) corresponding the upright mode of FIG. 10B.

FIG. 10I illustrates the position of valve 1045 ("closed") when cleaning apparatus 1000 is in the empty mode of FIG. 10C. In such closed position, valve 1045 inhibits floor-based vacuum cleaner 1010 from drawing in air and debris from a dirty air inlet of cleaning head 1030 so as to facilitate transfer of debris from handheld vacuum cleaner 1020 to floor-based vacuum cleaner 1010. Such closed position of valve 1045 can advantageously improve suction performance of a suction motor of floor-based vacuum cleaner 1010 and/or prevent transfer of debris from handheld vacuum cleaner 1020 to cleaning head 1030.

Valve 1045 can be pivotably connected to a portion of cleaning head 1030 or a support member connected to cleaning head 1030 such that valve 1045 can pivot between the above-described open and closed position. In such closed position, valve 1045 can block an airflow passage within cleaning head 1030 and/or within a support member connected to cleaning head 1030, and in such open position, valve 1045 can allow air (and debris) to flow through such airflow passage. In some implementations, valve 1045 is configured to pivot between the open and closed positions responsive to rotation of wand 1003, floor-based vacuum cleaner 1010, handheld vacuum cleaner 1020, and/or a support member connected to cleaning head 1030 (and to wand 1003) relative to cleaning head 1030. For example, valve 1045 can be configured to be in an open position when wand 1003 and/or a support member connected to cleaning head 1030 (and to wand 1003) are oriented at an angle that is oblique relative to a plane extending along a bottom portion of cleaning head 1030 and/or a surface on which cleaning head 1030 is supported. As another example, valve 1045 can be configured to be in the closed position when wand 1003 and/or such support member are oriented generally perpendicularly relative to such plane and/or such surface. As another example, valve 1045 can be configured to be in the closed position when wand 1003 and/or such support member are oriented such that the wand 1003 and/or such support member extend along an axis that is within 20 degrees, within 19 degrees, within 18 degrees, within 17 degrees, within 16 degrees, within 15 degrees, within 14 degrees, within 13 degrees, within 12 degrees, within 11 degrees, within 10 degrees, within 9 degrees, within 8 degrees, within 7 degrees, within 6 degrees, within 5 degrees, 4 degrees, 3 degrees, 2 degrees, or within 1 degree from perpendicular relative to such plane and/or such surface.

Figure 10K:
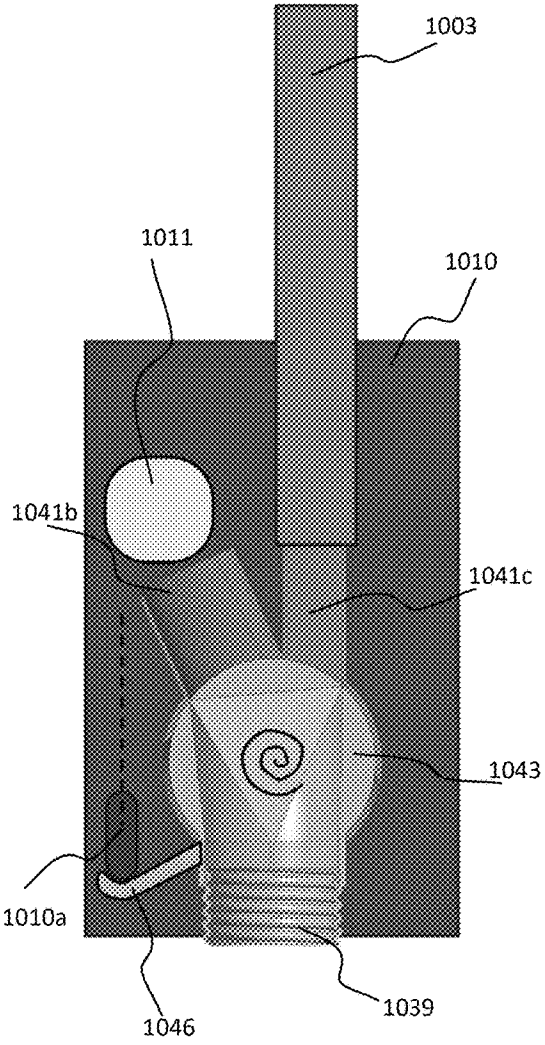
Figure 10J:
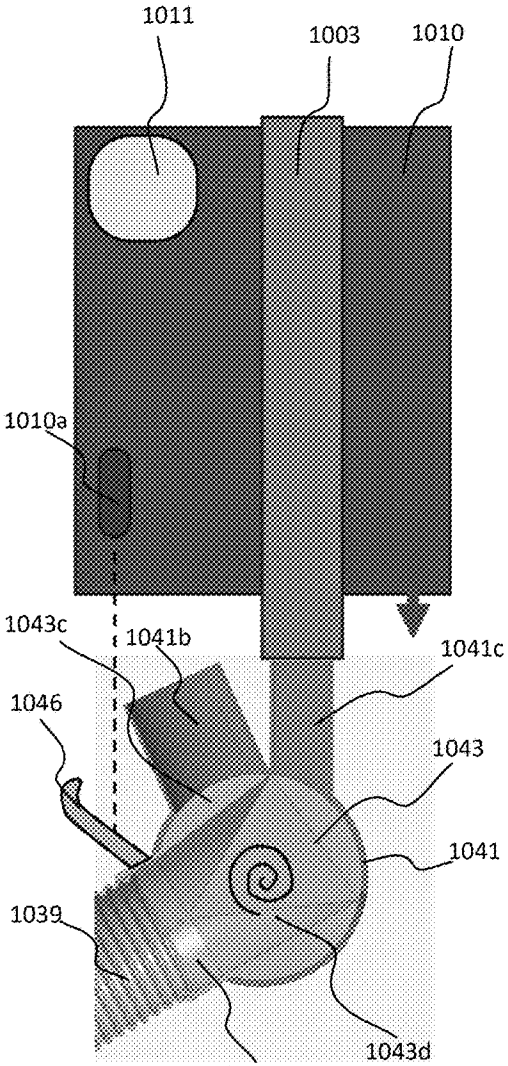

Valve 1043 can be moved between the positions described in FIGS. 10D-10F via manual means in some implementations. Additionally or alternatively, valve 1043 can be moved between the positions described in FIGS. 10D-10F automatically, for example, without manual action by a user. FIGS. 10J-10L illustrate example mechanisms to enable such automatic movement of valve 1043. FIG. 10J illustrates valve assembly 1040 and valve 1043 in the configuration of FIG. 10E (stick mode) in which opening 1041*b* is blocked by valve wall 1043*c* and opening 1041*c* is in flow communication with conduit 1039 via airflow passage 1043*d*. As shown, wand 1003 is connected to valve housing 1041 at opening 1041*c*. In some implementations, valve 1043 is biased toward this configuration (stick mode) by a biasing mechanism, such as a spring. FIG. 10J illustrates floor-based vacuum cleaner 1010 prior to attachment to cleaning head 1030, a support member of cleaning head 1030, wand 1003, and/or valve assembly 1040. Floor-based vacuum cleaner 1010 can include an actuator 1010*a* that is configured to engage and interact with an actuator 1046 of valve assembly 1040 to cause valve 1043 to move to the position illustrated in FIG. 10K when floor-based vacuum cleaner 1010 is attached. FIG. 10K illustrates the position of valve 1043 when floor-based vacuum cleaner 1010 is attached and wand 1003 is in an upright orientation in which wand 1003 is generally perpendicular to cleaning head 1030 (and/or a surface on which cleaning head 1030 rests). The position of valve in FIG. 10K is the same as that in the empty mode described with respect to FIG. 10F. To move valve 1043 to the position illustrated in FIG. 10D for the upright mode, wand 1003 and floor-based vacuum cleaner 1010 can be rotated relative to cleaning head 1030 (and/or a surface on which cleaning head 1030 rests), for example, to an inclination as illustrated in FIG. 10A. Such rotation can cause actuator 1046 to be moved from the position illustrated in FIG. 10K to the position illustrated in FIG. 10L, and in turn cause valve 1043 to move to the position illustrated in FIG. 10L (and FIG. 10D) to facilitate the upright mode in which floor-based vacuum cleaner 1010 is in flow communication with a dirty air inlet of cleaning head 1030 (via conduit 1039). FIGS. 10J-10L illustrate a dirty air inlet 1011 of floor-based vacuum cleaner 1010 which can be put into flow communication with opening 1041*b* of valve housing 1041 directly or indirectly via a duct, for example.

FIGS. 11A-11D illustrate another cleaning apparatus 1100. Cleaning apparatus 1100 can include a cleaning head 1130, a floor-based vacuum cleaner 1110, a handheld vacuum cleaner 1120, a wand 1103, and a cord 1101 connected with handheld vacuum cleaner 1120 and configured to provide power to cleaning apparatus 1100. Cleaning head 1130 can include any or all of the features described with respect to any of the cleaning heads disclosed herein, such as cleaning head 130, 230, and/or 330. Floor-based vacuum cleaner 1110 can include any or all of the features described with respect to any of floor-based vacuum cleaner 110, 210 and/or vacuum cleaner 310. Handheld vacuum cleaner 1120 can include any of all of the features described with respect to any of handheld vacuum cleaner 120, 220 and/or vacuum cleaner 320. Wand 1103 can be similar or identical to any of wands 103, 203. In some implementations, cleaning apparatus 1000 also includes a support member similar or identical to any of the other support members disclosed herein.

Figure 11C:
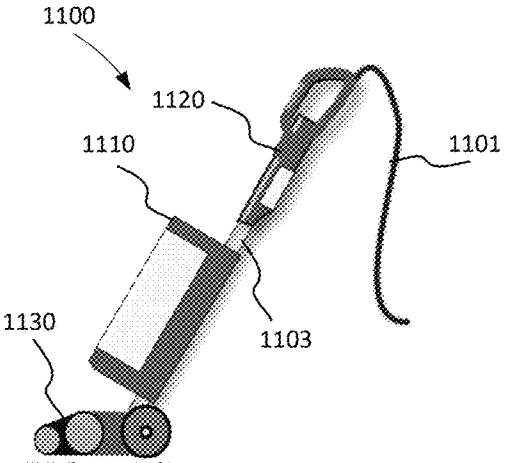
FIGS. 11A and 11C illustrate another implementation of a cleaning apparatus in different modes of operation in accordance with aspects of this disclosure.
Figure 11D:
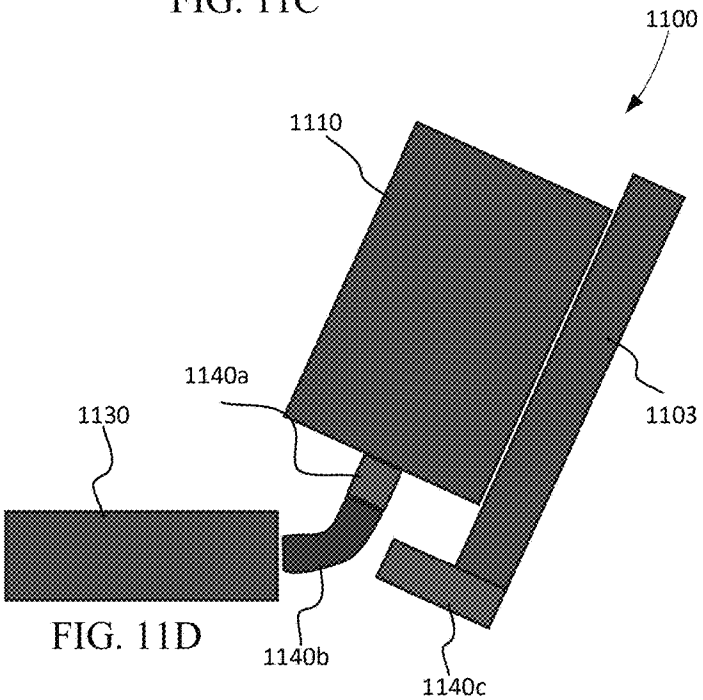
FIGS. 11B and 11D illustrate schematic representations of portions of the cleaning apparatus of FIGS. 11A and 11C in accordance with aspects of this disclosure.
Figure 11A:
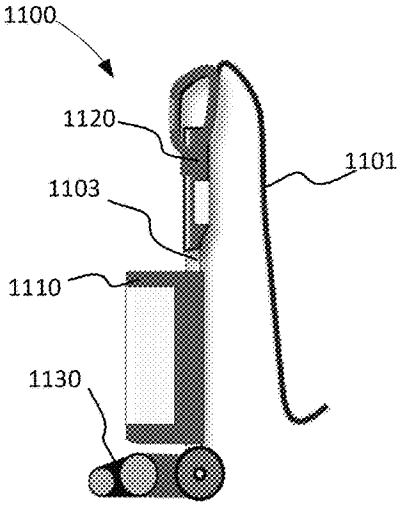
Figure 11B:
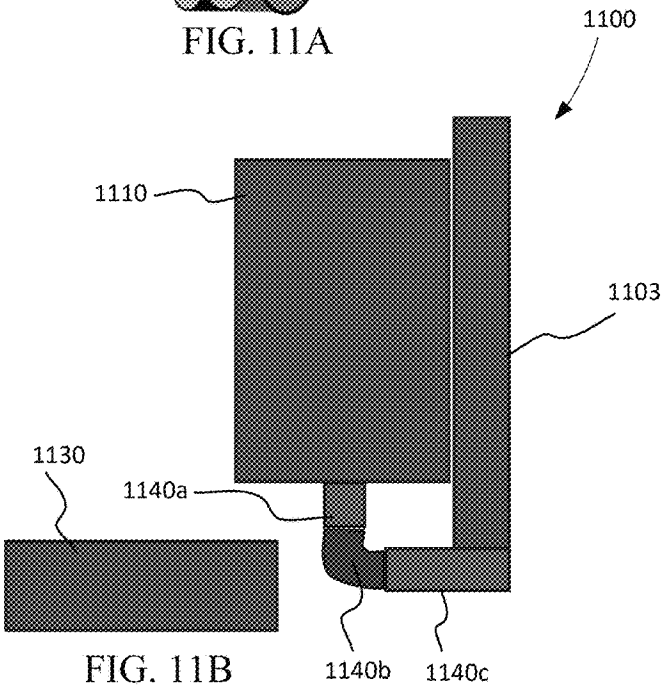

FIG. 11A illustrates cleaning apparatus 1100 in an empty mode of operation in which debris from handheld vacuum cleaner 1120 (for example, a debris container thereof) are transferred ("emptied") into floor-based vacuum cleaner 1110. FIG. 11B schematically illustrates example valve assembly portions 1140*a*, 1140*b*, 1140*c* that facilitate flow communication between floor-based vacuum cleaner 1110 and wand 1103 (and in turn, handheld vacuum cleaner 1120) in such empty mode. As shown, in such empty mode, cleaning head 1130 (for example, a dirty air inlet of cleaning head 1130) is not in flow communication with either of floor-based vacuum cleaner 1110 or wand 1103. FIG. 11C illustrates cleaning apparatus 1100 in an upright mode of operation in which debris are drawn in through cleaning head 1130 and directed to floor-based vacuum cleaner 1110. FIG. 11D schematically illustrates valve assembly portions 1140*a*, 1140*b* that facilitate flow communication between floor-based vacuum cleaner 1110 and cleaning head 1130 in such upright mode. As shown, in such upright mode, wand 1103 (and in turn, handheld vacuum cleaner 1120) is not in flow communication with either of floor-based vacuum cleaner 1110 or cleaning head 1130. Cleaning apparatus 1100 can include various actuators that facilitate connection and disconnection of valve assembly portions 1140*a*, 1140*b*, 1140*c* for the modes illustrated in FIGS. 11A-11D, for example, similar to other actuators described elsewhere herein.

Figure 12:
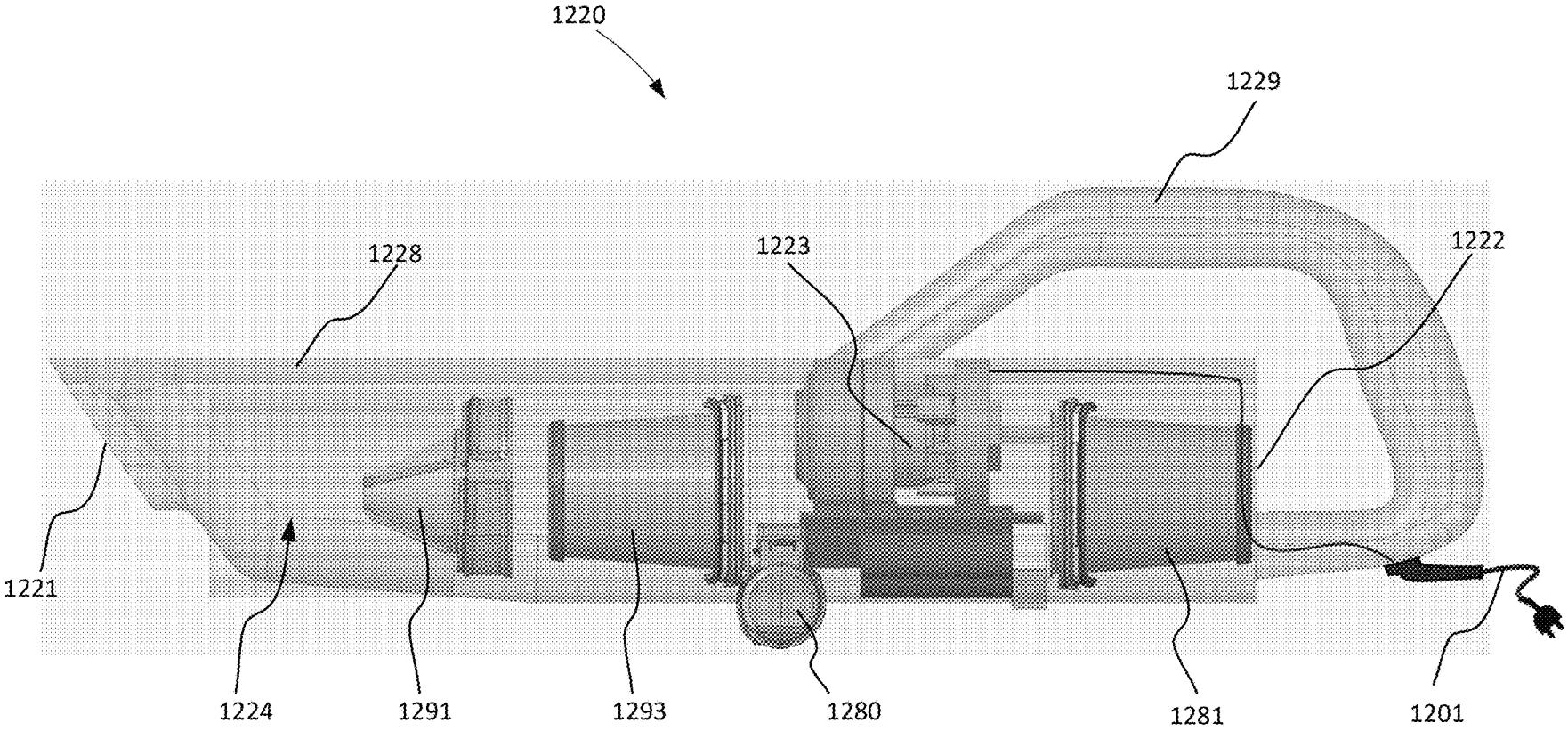
FIG. 12 illustrates an example handheld vacuum cleaner in accordance with aspects of this disclosure.

FIG. 12 illustrates a handheld vacuum cleaner 1220. Handheld vacuum cleaner 1220 can be utilized in any of the cleaning apparatus described herein. Handheld vacuum cleaner 1220 can include a housing 1228, a dirty air inlet 1221, a debris container 1224 (which may also be referred to as "debris containing region" or "debris chamber"), a filter 1291 (which may be referred to as a "fluff screen"), a pre-motor filter 1293 (for example, a pleated filter), a bleed valve 1280, a post-motor filter 1281 (for example, a HEPA filter), a handle 1229 (which can be connected to or formed as part of housing 1228), a suction motor 1223, a clean air outlet 1222, and a cord 1201 for providing power to handheld vacuum cleaner 1220 and/or other components of a cleaning apparatus to which handheld vacuum cleaner 1220 is part of. Debris container 1224 may be defined by one or more interior portions of handheld vacuum cleaner 1220 and such interior portion(s) may be at least partially formed by a debris container door of handheld vacuum cleaner 1220. Filter 1293, filter 1293, and/or other components (for example, structural components of handheld vacuum cleaner 1220) may form a debris separator of handheld vacuum cleaner 1220. Suction motor 1223 (which may include a motor coupled with an impeller) can cause air to flow through dirty air inlet 1221, through debris container 1224 and a debris separator of handheld vacuum cleaner 1220, and through clean air outlet 1222 to cause debris to be stored in debris container 1224. Bleed valve 1280 can be biased toward a closed position (which also may be referred to as a "first state") in which bleed valve 1280 blocks an auxiliary air inlet of handheld vacuum cleaner 1220 and can be configured to be open when a pressure within the handheld vacuum cleaner 1220 exceeds a threshold, for example, when airflow is clogged by debris. Advantageously, when handheld vacuum cleaner 1220 is utilized in a cleaning apparatus including a floor-based vacuum cleaner, such as those described herein, bleed valve 1280 can be configured to open (which may be referred to as a "second state" of bleed valve 1280) when the cleaning apparatus is in an empty mode and a suction motor of the floor-based vacuum cleaner causes air to flow from handheld vacuum cleaner 1220 to the floor-based vacuum cleaner (to "empty" debris from handheld vacuum cleaner 1220 into a debris container of the floor-based vacuum cleaner). Bleed valve 1280 can be similar or identical to any of the other bleed valves disclosed herein.

Figure 13C:
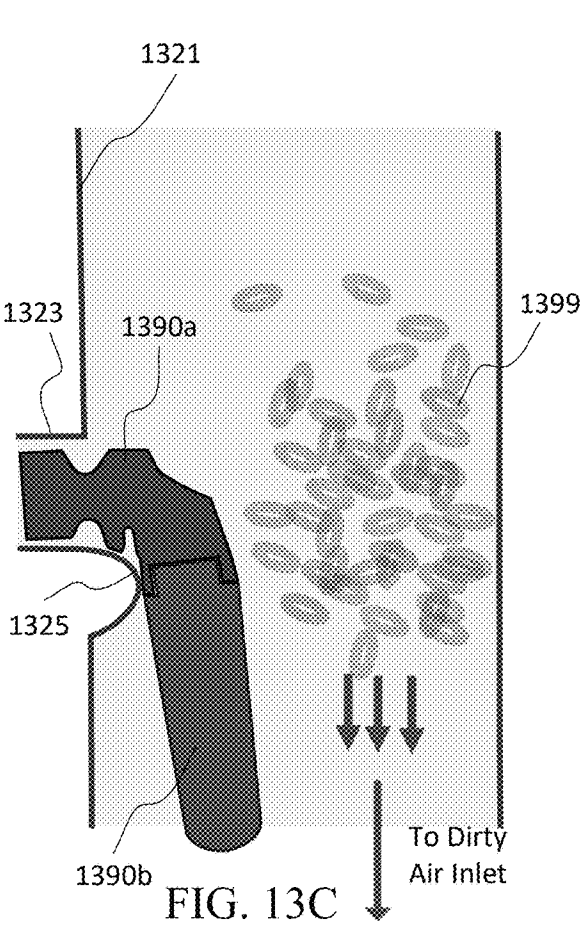
FIGS. 13A-13C illustrate an example valve and portion of a handheld vacuum cleaner in accordance with aspects of this disclosure.
Figure 13B:
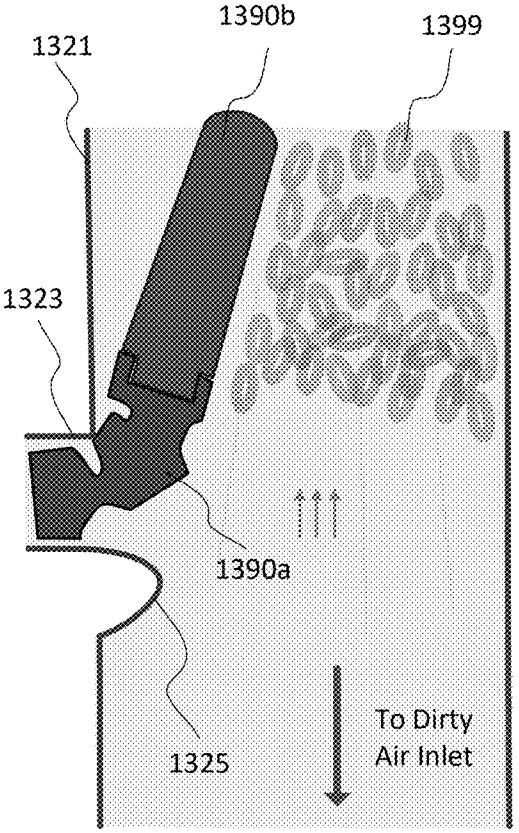
Figure 13A:
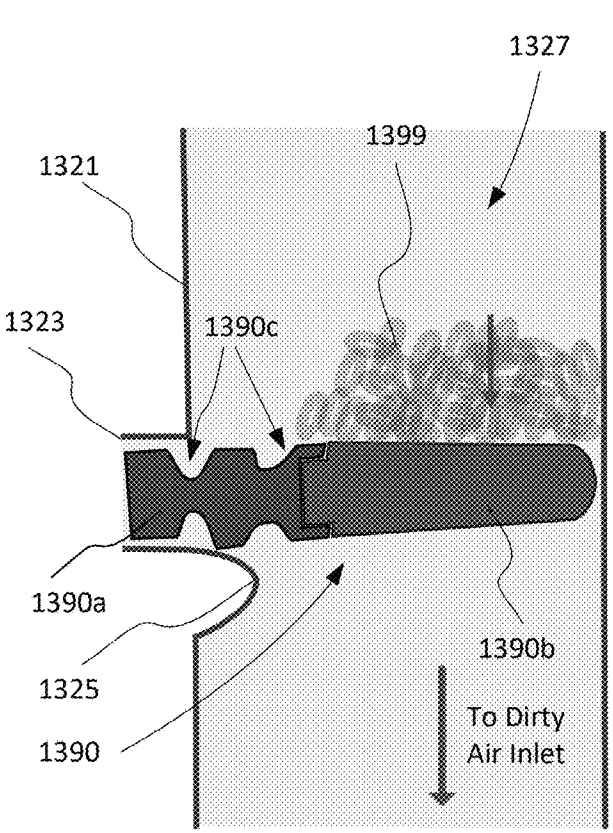
Figure 14D:
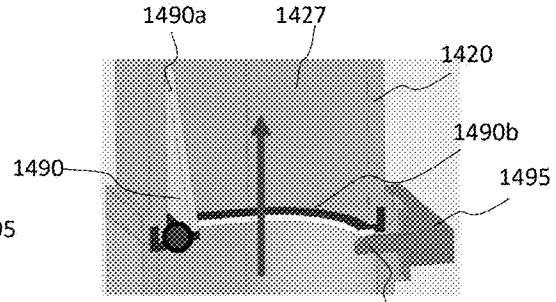
FIGS. 14A-14LL illustrate various views of portions of another implementation of a cleaning apparatus in accordance with aspects of this disclosure.
Figure 14C:
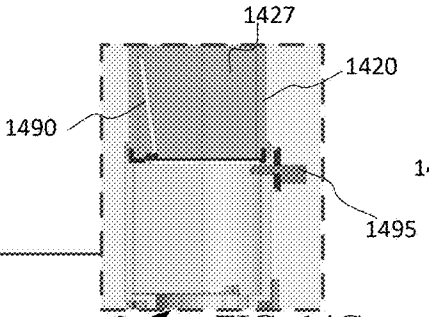
Figure 14B:
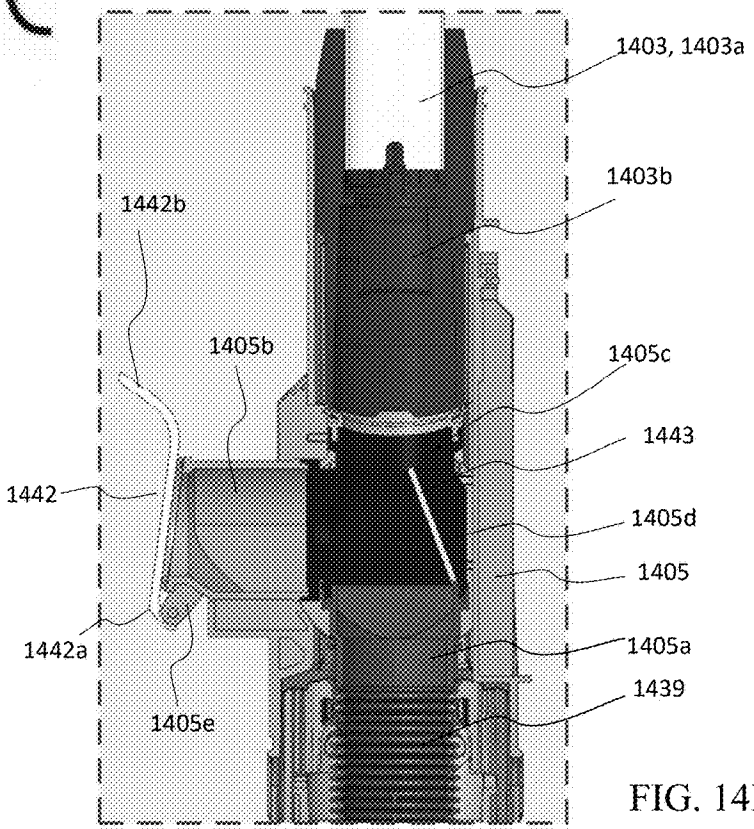
Figure 14A:
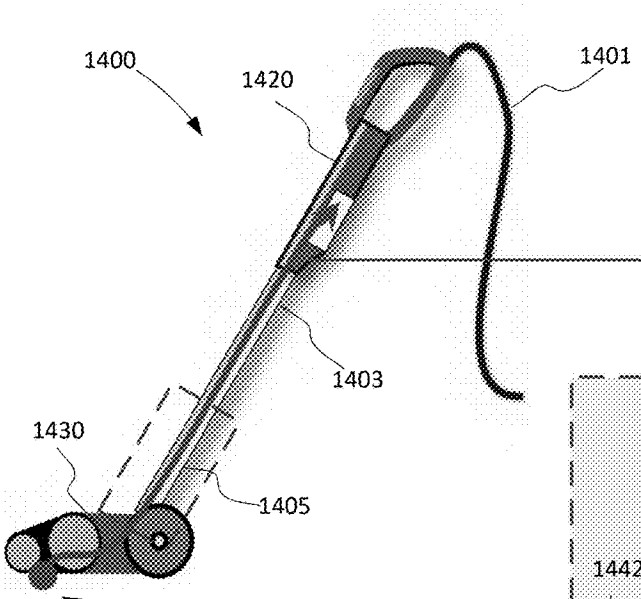
Figure 14H:
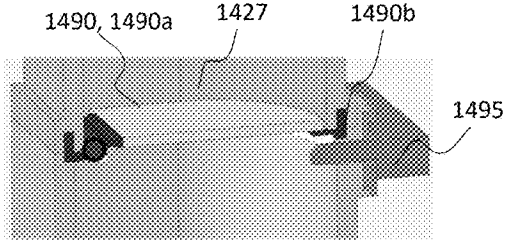

FIGS. 13A-13C illustrate an example valve 1390 that can be incorporated into a handheld vacuum cleaner such as any of those disclosed herein (e.g., a handheld vacuum cleaner 1420 as shown in FIG. 14A). FIG. 13A illustrates a portion 1321 of a housing of a handheld vacuum cleaner defining an airflow passage 1327 and valve 1390 pivotably connected thereto, for example, within a slot 1323. Valve 1390 advantageously can be configured to inhibit debris 1399 from falling out of a debris container of the handheld vacuum cleaner, for example, under force of gravity. FIG. 13A illustrates valve 1390 in a position in which valve 1390 extends across passage 1327 and supports a weight of debris 1399, thereby inhibiting the debris from falling through a dirty air inlet of the handheld vacuum cleaner. Valve 1390 can be biased to such position. FIG. 13B illustrates valve 1390 in a first open position in which valve 1390 has been moved (pivoted) under force induced by a suction motor of the handheld vacuum cleaner, thereby allowing debris 1399 to be received by the handheld vacuum cleaner and into a debris container of the handheld vacuum cleaner. FIG. 13C illustrates valve 1390 in a second open position in which valve 1390 has been moved (pivoted) under force induced by a suction motor of a floor-based vacuum cleaner (e.g., a floor-based vacuum cleaner 1410 as shown in FIG. 14I), which can be connected with handheld vacuum cleaner as described with respect to any of the cleaning apparatuses disclosed herein. As shown, valve 1390 is closer to the dirty air inlet of the handheld vacuum cleaner when in the second open position of FIG. 13C than when in the first open position of FIG. 13B. Valve 1390 can include a first portion 1390*a* connected to the housing (for example, in slot 1323) and a second portion 1390*b* connected with the first portion 1390*a*. First portion 1390*a* and second portion 1390*b* can be made of the same or a different material. First portion 1390*a* can include one or more notches 1390*c* that form living hinge(s) in valve 1390, thereby facilitating pivotable movement between the positions illustrated in FIGS. 13A-13C. In some implementations, more force is required to cause valve 1390 to move to the position of FIG. 13C (downward) than to the position illustrated in FIG. 13B. This advantageously can help valve 1390 support the weight of debris while at the same time allowing valve 1390 to be movable by the suction motor of the handheld vacuum cleaner, which may be limited in size and/or capacity. For example, the handheld vacuum cleaner can include a protrusion 1325 extending outward from a wall of portion 1321 of a housing of the handheld vacuum cleaner and that extends at least partially across passage 1327. Protrusion 1325 can be arranged between valve 1390 and a dirty air inlet of the handheld vacuum cleaner (see FIG. 13A). Protrusion 1325 can be in contact with (for example, support) valve 1390 when valve 1390 is in the closed position of FIG. 13A. When the handheld vacuum cleaner is connected with a floor-based vacuum cleaner and the suction motor of the floor-based vacuum cleaner is turned on (for example, for an empty mode of operation), the suction motor of the floor-based vacuum cleaner can be strong enough to cause the valve 1390 to overcome the support of protrusion 1325 and move to the open position of FIG. 13C. Accordingly, valve 1390 and protrusion 1325 can facilitate both modes of operation illustrated in FIG. 13B while allowing valve 1390 to stop debris 1399 from inadvertently exiting the handheld vacuum cleaner. Valve 1390 can be a passive valve biased toward the position of FIG. 13A but able to be moved to the positions of FIGS. 13A-13C under force of suction as described above.

Figure 14G:
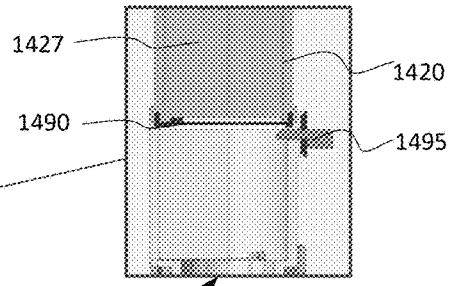
Figure 14F:
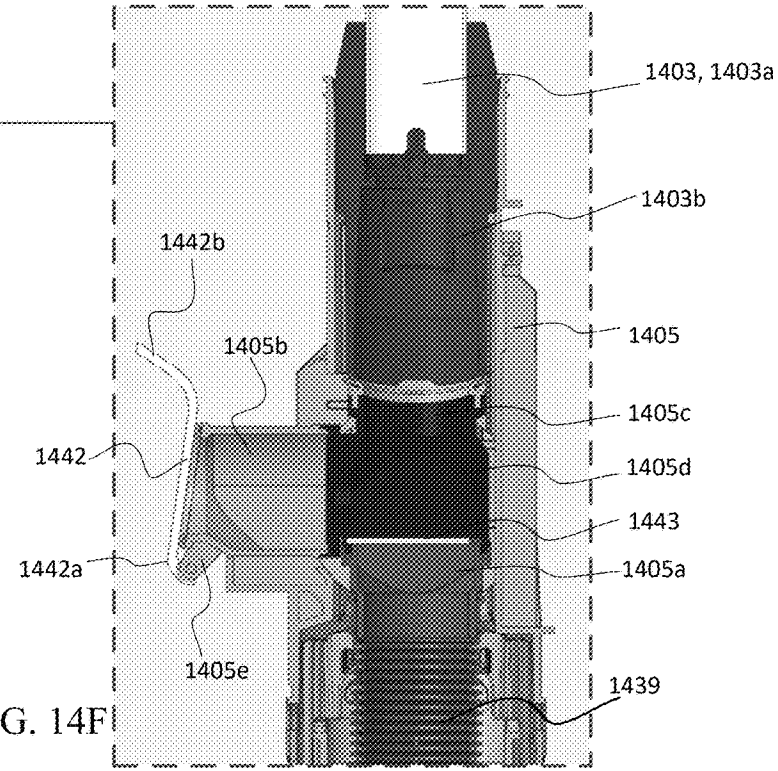
Figure 14E:
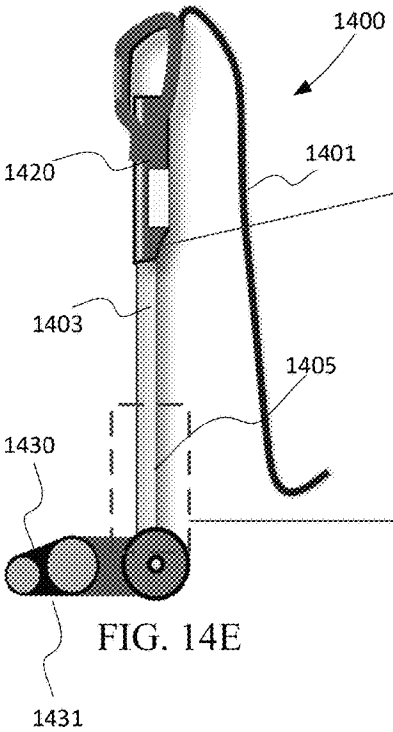
Figure 14L:
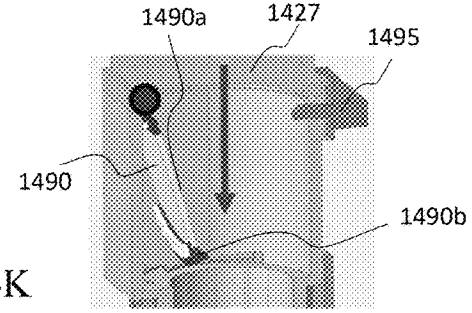
Figure 14K:
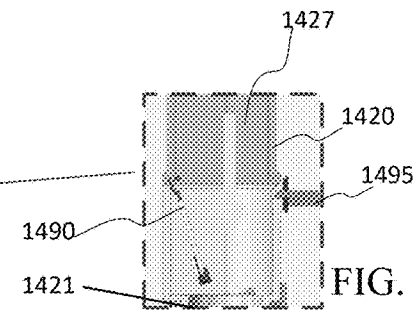
Figure 14J:
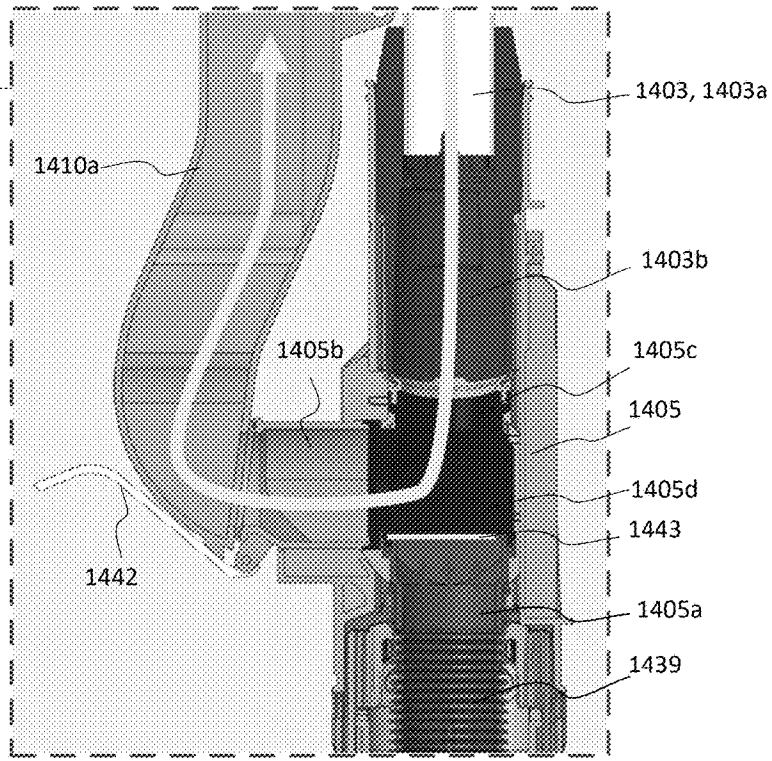
Figure 14I:
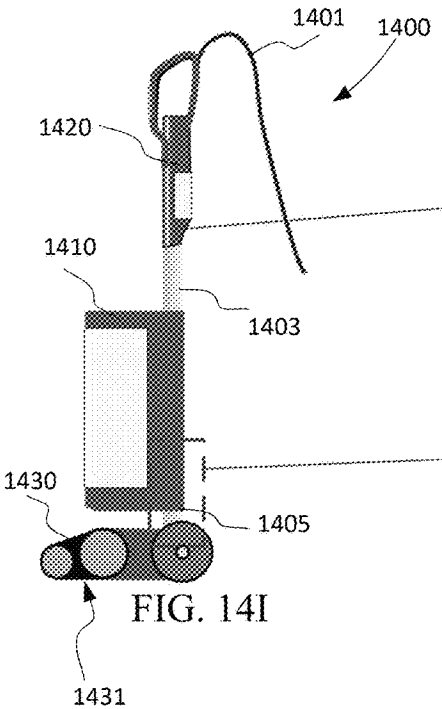
Figure 14P:
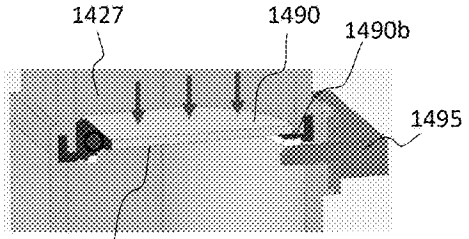
Figure 14O:
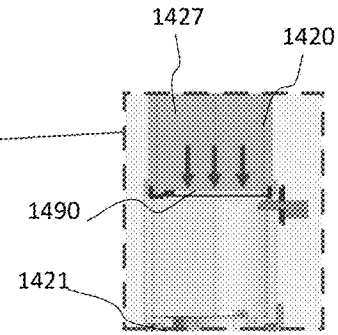
Figure 14N:
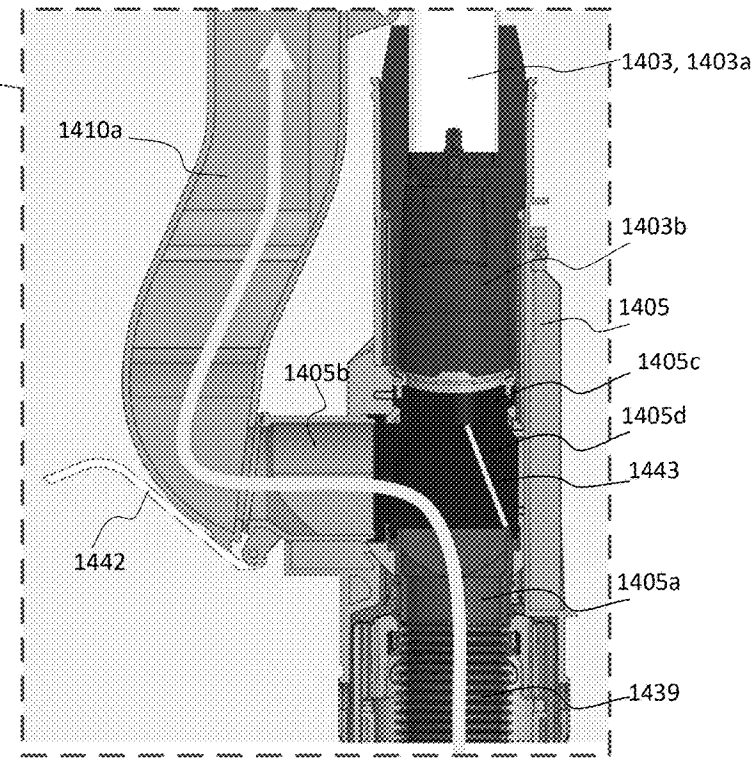

FIGS. 14A-14N illustrate another implementation of a cleaning apparatus 1400 and portions thereof. Cleaning apparatus 1400 can include a cleaning head 1430, a support member 1405, a wand 1403, a handheld vacuum cleaner 1420, a floor-based vacuum cleaner 1410, and a power cord 1401 connected to handheld vacuum cleaner 1420. Support member 1405 can be pivotably connected to cleaning head 1430 so as to be able to pivot between the positions shown in FIGS. 14A and 14M (which may be referred to as an "inclined position") and the positions shown in FIGS. 14E and 14I (which may be referred to as an "upright position"). Floor-based vacuum cleaner 1410 and/or handheld vacuum cleaner 1420 can be removably attachable to cleaning head 1430 at least partially via wand 1403 and/or support member 1405. Floor-based vacuum cleaner 1410, wand 1403, and handheld vacuum cleaner 1420 can be attachable to support member 1405, and accordingly, may pivot together with support member 1405 to such positions, and a plurality of other positions between and/or beyond such positions. Wand 1403 can be removably attachable to cleaning head 1430, support member 1405, handheld vacuum cleaner 1420, and/or floor-based vacuum cleaner 1410. Cleaning apparatus 1400 can be operated to draw air and/or debris from a surface (for example, a floor) to remove debris from the surface. Cleaning head 1430 can be supported by the surface when the cleaning apparatus 1400 is operated to remove debris from the surface. Cleaning head 1430 can be movable with respect to the surface to remove debris from different areas of the surface. Cleaning head 1430 can include any features described with respect to other cleaning heads disclosed herein, such as cleaning head 330. Floor-based vacuum cleaner 1410 can include any features described with respect to other floor-based vacuum cleaners disclosed herein, such as floor-based vacuum cleaner 110. Handheld vacuum cleaner 1420 can include any features described with respect to other handheld vacuum cleaners disclosed herein, such as handheld vacuum cleaner 120.

FIG. 14A illustrates cleaning apparatus 1400 in a stick mode of operation in which floor-based vacuum cleaner 1410 is detached and support member 1405 is inclined relative to cleaning head 1430. FIG. 14B illustrates an example cross-section taken through a portion of cleaning apparatus 1400 as indicated in FIG. 14A. FIG. 14C illustrates an example cross-section taken through a portion of handheld vacuum cleaner 1420 as indicated in FIG. 14A. FIG. 14D illustrates a perspective view of that which is shown in the cross-section view of FIG. 14C. With reference to FIG. 14B, cleaning apparatus 1400 includes support member 1405, a conduit 1439 (which may be a flexible conduit such as a corrugated hose), and wand 1403 connected to support member 1405. Wand 1403 can include a wand conduit 1403*a* and an adapter 1403*b* connected at an end (for example, a "bottom" end) of wand conduit 1403*a*. Adapter 1403*b* can be configured to secure to a portion of support member 1405, for example, within a socket of support member 1405 at or near a port 1405*c* of support member 1405. Support member 1405 can include a first port 1405*a* connected to conduit 1439, a second port 1405*b*, a third port 1405*c*, and an interior portion 1405*d* within which valve 1443 (described below) is movable. Port 1405*a* can be connected and in flow communication with conduit 1439. Conduit 1439 can be in flow communication with a dirty air inlet 1431 of cleaning head 1430, for example, via one or more flow passages within a housing of cleaning head 1430. Port 1405*b* can be configured to connect to a duct 1410*a* of floor-based vacuum cleaner 1410 to facilitate flow communication between floor-based vacuum cleaner 1410 and cleaning head 1430, wand 1403, and handheld vacuum cleaner 1420. Port 1405*c* can provide flow communication between wand 1403 and handheld vacuum cleaner 1420 (via wand 1403) and floor-based vacuum cleaner 1410 and cleaning head 1430. As shown in FIGS. 14B and 14F, cleaning apparatus 1400 (for example, support member 1405) can include a lid 1442 pivotably connected to support member 1405 via an end 1442*a*. End 1442*a* can be pivotably connected to an arm 1405*e* of support member 1405 via a pin, for example. Lid 1442 (which also may be referred to as a "door") can be configured to pivot between a closed position, illustrated in FIGS. 14B and 14F, and an open position, illustrated in FIGS. 14J and 14N. Lid 1442 can be moved to and/or held in such open position by a portion of floor-based vacuum cleaner 1410, for example, a portion of duct 1410*a*. Floor-based vacuum cleaner 1410 can include an engagement feature that engages an end 1442*b* of lid 1442 to aid in moving lid 1442 to the open position. End 1442*b* can be curved, as shown, for example, in a direction away from support member 1405.

In the mode illustrated in FIGS. 14A-14D (stick mode), handheld vacuum cleaner 1420 (for example, a suction motor thereof) can be utilized to draw in air from dirty air inlet 1431 of cleaning head 1430, through one or more flow passages in cleaning head 1430 (such as conduit 1430*a* shown in FIG. 14X), through conduit 1439, through support member 1405 (for example, through port 1405*a*, interior portion 1405*d*, and port 1405*c*), through wand 1403 (for example, through adapter 1403*b* and wand conduit 1403*a*, through a dirty air inlet 1421 of handheld vacuum cleaner 1420, through a debris container and debris separator of handheld vacuum cleaner 1420, and through a clean air outlet of handheld vacuum cleaner 1420. Such flow can cause debris to be collected from a surface (for example, a floor) through cleaning head 1430, support member 1405, wand 1403, and into a debris container of handheld vacuum cleaner 1420. As shown in FIG. 14B, in such mode, lid 1442 is closed (thereby closing port 1405*b*) and valve 1443 is open. In such mode, cleaning head 1430 (and dirty air inlet 1431) is in flow communication with handheld vacuum cleaner 1420. Since floor-based vacuum cleaner 1410 is detached (and port 1405*b* is closed by lid 1442), floor-based vacuum cleaner 1410 is not in flow communication with any of cleaning head 1430 or handheld vacuum cleaner 1420. With reference to FIGS. 14C-14D, handheld vacuum cleaner 1420 includes a valve 1490 that is pivotably connected to a portion of handheld vacuum cleaner 1420 (for example, a portion of a housing of handheld vacuum cleaner 1420). In the mode of FIGS. 14A-14D, valve 1490 is in an open position. Valve 1490 can extend across a flow passage 1427 within handheld vacuum cleaner 1420 when in a closed position. Such flow passage 1427 can be arranged between a dirty air inlet 1421 and a debris container of handheld vacuum cleaner 1420. Valve 1490 can include an inner valve portion 1490*a* (which may be referred to as an "inner door") and an outer valve portion 1490*b* (which may be referred to as an "outer door"). In the mode of FIGS. 14A-14D, inner valve portion 1490*a* is in a first open position in which inner valve portion 1490*a* is pivoted in a direction away from dirty air inlet 1421 of handheld vacuum cleaner 1420 and toward a debris container of handheld vacuum cleaner 1420. In such mode, as shown, outer valve portion 1490*b* is held in place by a stop member 1495, which can extend within a portion of a housing of handheld vacuum cleaner 1420 and inhibit outer valve portion 1490*b* from pivoting in a direction toward dirty air inlet 1421 (for example, in a clockwise direction). Outer valve portion 1490*b* can be annular and/or can comprise an opening that can be covered by inner valve portion 1490*a* when valve 1490 is closed, for example, in the modes illustrated and described with respect to FIGS. 14E-14H and FIGS. 14M-14P). In the mode of FIGS. 14A-14D, inner valve portion 1490*a* is open and therefore, valve 1490 is open, thereby allowing flow communication between handheld vacuum cleaner 1420 and wand 1403, support member 1405, and cleaning head 1430.

FIGS. 14E-14H illustrate a mode in which handheld vacuum cleaner 1420 is "off" and not performing cleaning. In such mode, the suction motor of handheld vacuum cleaner 1420 is off. FIG. 14E illustrates wand 1403 and handheld vacuum cleaner 1420 in an "upright" orientation in which wand 1403 is generally perpendicular to cleaning head 1430 (and, for example, a surface on which cleaning head 1430 rests). As shown, floor-based vacuum cleaner 1410 is not attached. As shown, valve 1443 and valve 1490 are closed. Closure of valve 1490 in such position can advantageously inhibit debris from a debris container of handheld vacuum cleaner 1420 from falling out of such debris container under force of gravity. Valves 1490, 1443 can be held in such closed positions as described in more detail below.

FIG. 14I illustrates cleaning apparatus 1400 in an empty mode of operation in which floor-based vacuum cleaner 1410 is attached. Floor-based vacuum cleaner 1420, wand 1403, support member 1405, and/or handheld vacuum cleaner 1420 can be oriented in an "upright" orientation in which wand 1403 is generally perpendicular to cleaning head 1430 (and, for example, a surface on which cleaning head 1430 rests). FIG. 14J illustrates an example cross-section taken through a portion of cleaning apparatus 1400 as indicated in FIG. 14I. FIG. 14K illustrates an example cross-section taken through a portion of handheld vacuum cleaner 1420 as indicated in FIG. 14I. FIG. 14L illustrate a perspective view of that which is shown in the cross-section view of FIG. 14K.

In the mode illustrated in FIGS. 14I-14L (empty mode), floor-based vacuum cleaner 1410 (for example, a suction motor thereof) can be utilized to draw in air from a clean air outlet and/or an auxiliary air inlet of handheld vacuum cleaner 1420, through a debris container of handheld vacuum cleaner 1420, through dirty air inlet 1421, through wand 1403 (for example, through adapter 1403*b* and wand conduit 1403*a*), through support member 1405 (for example, through port 1405*a*, interior portion 1405*d*, and port 1405*c*), through a dirty air inlet of floor-based vacuum cleaner 1410 (for example, via duct 1410*a*), through a debris container and debris separator of floor-based vacuum cleaner 1410, and/or through a clean air outlet of floor-based vacuum cleaner 1410. Such flow can cause debris to be transferred from the debris container of handheld vacuum cleaner 1420 to the debris container of floor-based vacuum cleaner 1410.

As shown in FIGS. 14J-14L, in such mode, lid 1442 is open (for example, held in such position by duct 1410*a*) and valve 1490 is open, thereby providing flow communication between floor-based vacuum cleaner 1410 and handheld vacuum cleaner 1420. As also shown, valve 1443 is closed in such mode, thereby preventing fluid communication between cleaning head 1430 and both of floor-based vacuum cleaner 1410 and handheld vacuum cleaner 1420. As shown in FIGS. 14K-14L, both of inner and outer valve portions 1490*a*, 1490*b* are open, pivoted in a direction towards dirty air inlet 1421. Inner valve portion 1490*a* may be described as being in a second open position in such mode, different from the "first open position" described above with respect to FIGS. 14C-14D for the stick mode of operation. Inner valve portion 1490*a* is pivoted in an opposite direction when in the mode of FIGS. 14K-14L than when in the mode of FIGS. 14C-14D. As shown in FIGS. 14K-14L, stop member 1495 is in a retracted position in the mode of FIGS. 14I-14L, such that the physical interference imposed by stop member 1495 in the modes of FIGS. 14C-14D and 14G-14H is removed. Retracting stop member 1495 can permit both inner and outer valve portions 1490*a*, 1490*b* to pivot in a direction towards dirty air inlet 1421, thereby allowing the inner valve portion 1490*a* to transition to the second open position. Stop member 1495 may be biased toward an extended position (FIGS. 14C-14D and 14G-14H). As described in more detail below, stop member 1495 can be moved to the retracted position responsive to an inclination/orientation of wand 1403 (for example, relative to cleaning head 1430 and/or a surface on which cleaning head 1430 rests). For example, stop member 1495 may be held in the extended position when wand 1403 is oriented as shown and/or described with respect to FIGS. 14E and 14P and may be moved to and held in the retracted position when wand 1403 is oriented as shown and/or described with respect to FIGS. 14A and 14M. With reference to FIG. 14J, valve 1443 may be held in a closed position via a stop member as described in more detail below.

Figure 14M:
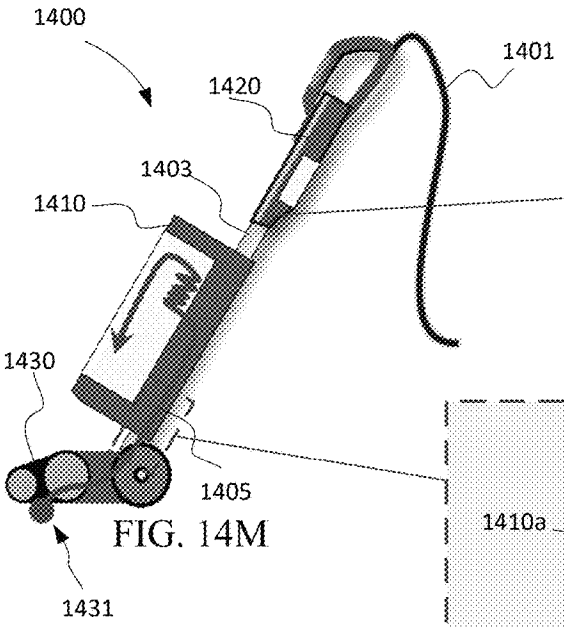

FIG. 14M illustrates cleaning apparatus 1400 in an upright mode of operation in which floor-based vacuum cleaner 1410 is attached and support member 1405 (and/or wand 1403) is inclined relative to cleaning head 1430. FIG. 14N illustrates an example cross-section taken through a portion of cleaning apparatus 1400 as indicated in FIG. 14M. FIG. 14O illustrates an example cross-section taken through a portion of handheld vacuum cleaner 1420 as indicated in FIG. 14M. FIG. 14P illustrates a perspective view of that which is shown in the cross-section view of FIG. 14O.

In the mode illustrated in FIGS. 14M-14P (upright mode), floor-based vacuum cleaner 1410 (for example, a suction motor thereof) can be utilized to draw in air from dirty air inlet 1431 of cleaning head 1430, through one or more flow passages in cleaning head 1430, through conduit 1439, through support member 1405 (for example, through port 1405*a*, interior portion 1405*d*, and port 1405*b*), through a dirty air inlet 1411 of floor-based vacuum cleaner 1410 (for example, via duct 1410*a*), through a debris container and debris separator of floor-based vacuum cleaner 1410, and/or through a clean air outlet of floor-based vacuum cleaner 1410. Such flow can cause debris to be collected from a surface (for example, a floor) through cleaning head 1430, support member 1405, and into a debris container of floor-based vacuum cleaner 1410.

As shown in FIG. 14N, in such mode, lid 1442 is open (for example, held in such position by duct 1410*a*) and valve 1443 is open, thereby providing flow communication between floor-based vacuum cleaner 1410 and cleaning head 1430. As shown in FIGS. 14O-14P, valve 1490 is closed in such mode, thereby preventing fluid communication between handheld vacuum cleaner 1420 and both of floor-based vacuum cleaner 1410 and cleaning head 1430. As shown in FIGS. 14O-14P, stop member 1495 is in an extended position, thereby preventing valve 1490 (for example, both of inner valve portion 1490*a* and outer valve portion 1490*b*) from being opened (for example, pivoted downward due to suction force generated by a suction motor of floor-based vacuum cleaner 1410). Maintaining valve 1490 in such closed position can inhibit debris from a debris container of handheld vacuum cleaner 1420 from falling out (for example, through wand 1403), but can also improve suction performance of floor-based vacuum cleaner 1410. In some variants, however, valve 1490 can be opened in the upright mode of FIGS. 14M-14P, which can allow debris from a debris container of handheld vacuum cleaner 1420 to be emptied into floor-based vacuum cleaner 1410. In some variants, floor-based vacuum cleaner 1410 and handheld vacuum cleaner 1420 can be utilized in the upright mode of FIGS. 14M-14P, for example, by operating suctions motors of both floor-based vacuum cleaner 1410 and handheld vacuum cleaner 1420. In such variants, inner valve portion 1490*a* may be allowed to open (for example, pivot upwards) to allow air and debris to flow through flow passage 1427 of handheld vacuum cleaner 1420.

Figure 14R:
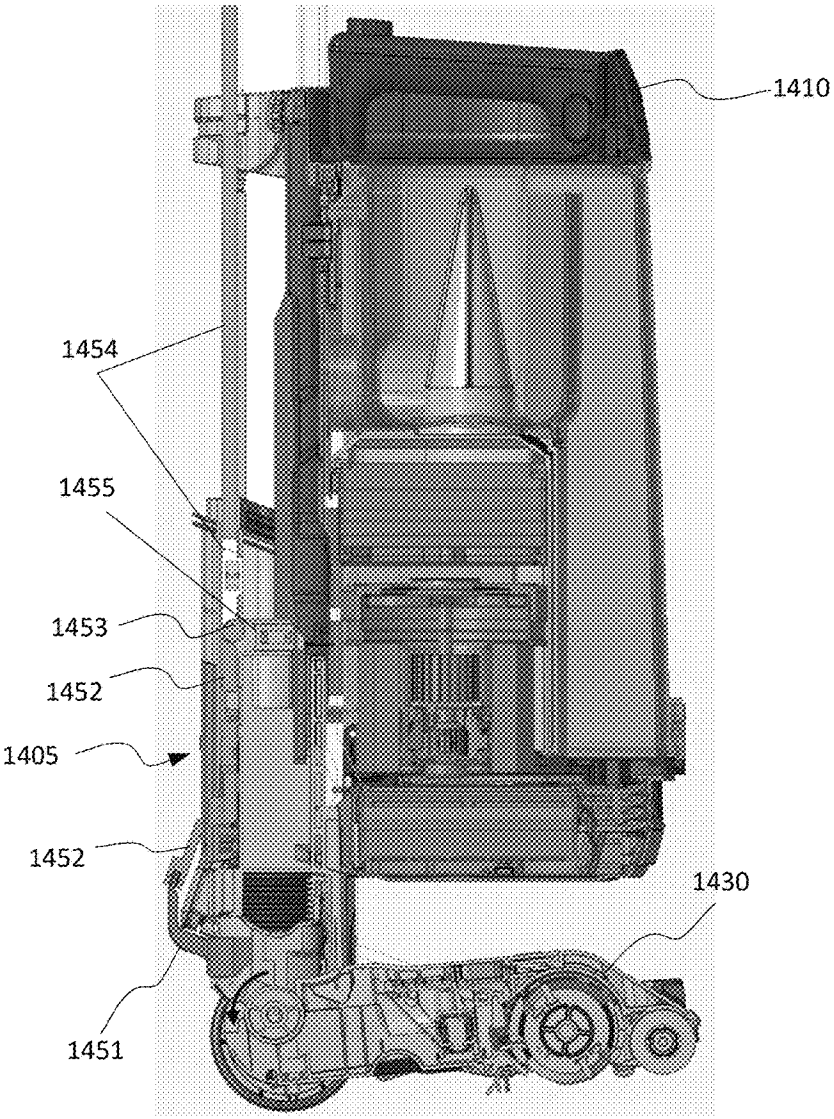
Figure 14Q:
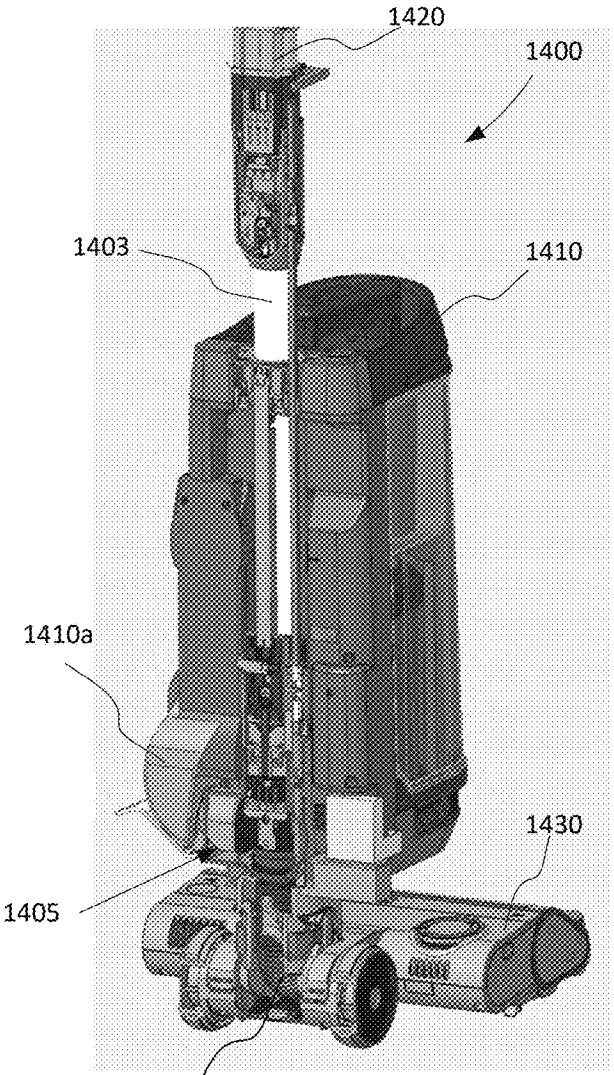
Figure 14V:
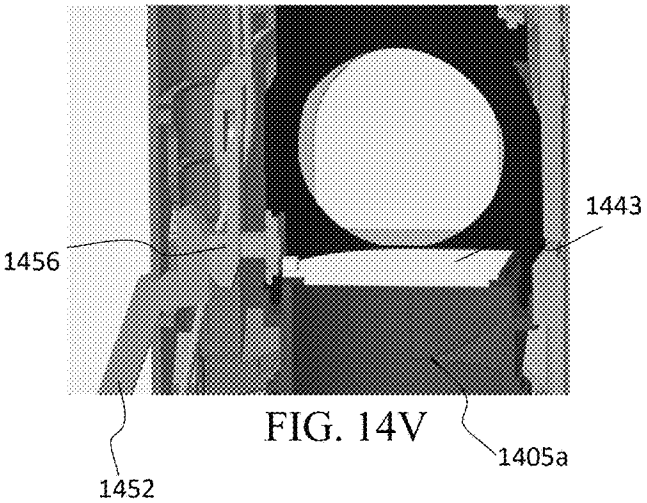
Figure 14T:
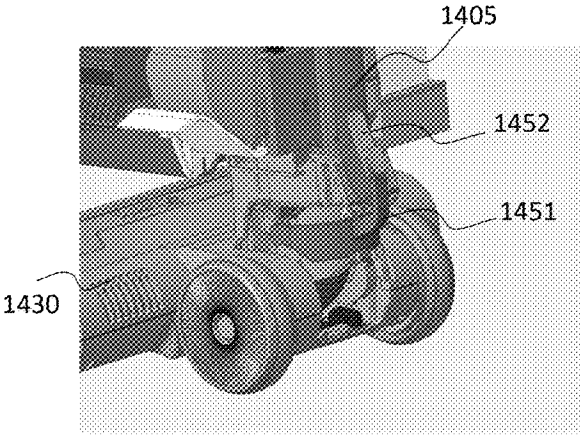

FIGS. 14Q-14FF illustrate various aspects and mechanisms of cleaning apparatus 1400 for controlling operation of valves 1490, 1443, for example, for opening and/or closing valves 1490, 1443 in the various modes of operation illustrated and described with respect to FIGS. 14A-14P. FIG. 14Q illustrates a rear perspective view of a portion of cleaning apparatus 1400, illustrating handheld vacuum cleaner 1420, wand 1403, floor-based vacuum cleaner 1410, support member 1405 (with a portion thereof removed), cleaning head 1430, and conduit 1439. FIG. 14R illustrates a side view of that which is shown in FIG. 14Q. Cleaning apparatus 1400 can include one or more actuators for moving valves 1490, 1443 between the positions illustrated and described with respect to FIGS. 14A-14P. For example, cleaning head 1430, support member 1405, wand 1403, and/or handheld vacuum cleaner 1420 can include one or more (or a plurality of) actuators that can engage and/or interact with one another to cause movement of valves 1490, 1443. Such actuators can engage one another: when floor-based vacuum cleaner 1410, cleaning head 1430, support member 1405, wand 1403, and/or handheld vacuum cleaner 1420 are attached to one another; and/or responsive to inclination and/or movement of support member 1405 and/or wand 1403 (which may be moved in tandem with any of floor-based vacuum cleaner 1410 and handheld vacuum cleaner 1420). FIGS. 14Q-14FF illustrate examples of various actuators that can be incorporated into cleaning head 1430, support member 1405, wand 1403, floor-based vacuum cleaner 1410, and handheld vacuum cleaner 1420. However, such examples are not intended to limit the scope of the disclosure. Various other actuators and/or actuator mechanisms may be utilized within cleaning apparatus 1400 in order to cause movement of valves 1490, 1443.

Figure 14U:
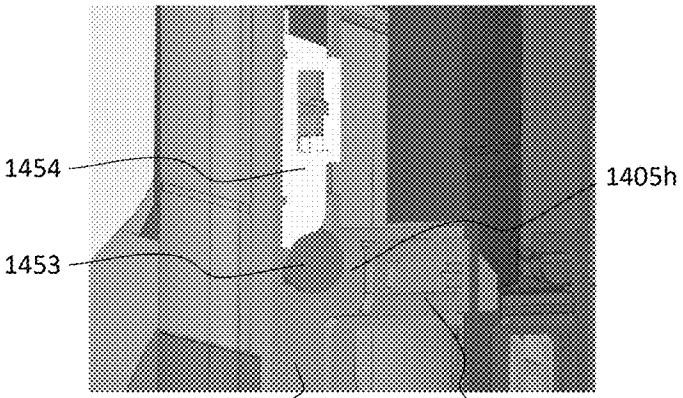
Figure 14S:
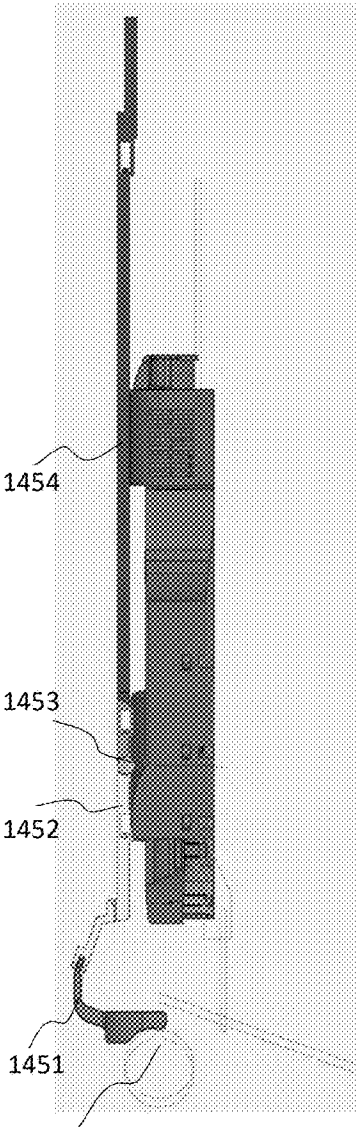

With reference to at least FIGS. 14R, 14S, 14Y, and 14BB, cleaning apparatus 1400 can include actuators 1450, 1451, 1452, 1453, 1454. FIG. 14S illustrates a side view of a portion of cleaning apparatus 1400 with certain portions hidden to better illustrate actuators 1451, 1452, 1453, 1454.

Figure 14Y:
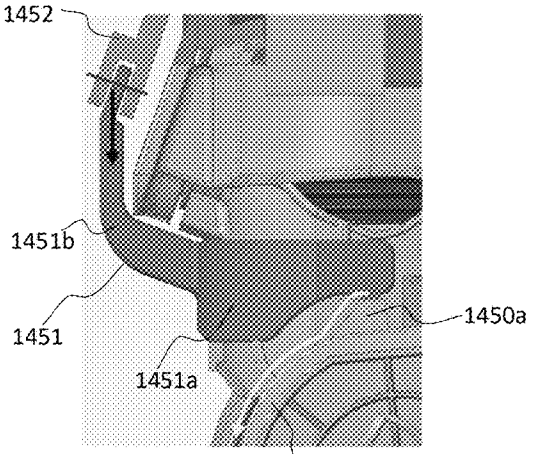
Figure 14B:
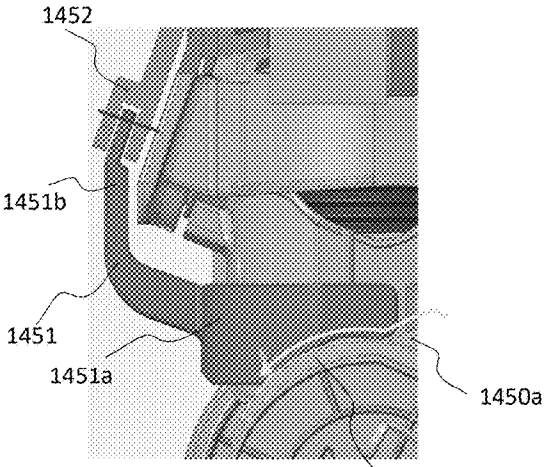

With reference to at least FIGS. 14Y and 14BB, cleaning apparatus 1400 can include actuator 1450 arranged on and/or incorporated into cleaning head 1430. Actuator 1450 can include a protrusion 1450*a* for engaging a portion of actuator 1451 (for example, a portion of body 1451*a* of actuator 1451). Protrusion 1450*a* can engage actuator 1451, for example, to cause movement of actuator 1451, when support member 1405 (and any components connected and/or pivotable thereto) is rotated relative to cleaning head 1430. With reference to at least FIGS. 14R-14T and 14W-14BB, actuator 1451 can include a body 1451*a* that is secured to and/or around a portion of support member 1405. In some implementations, actuator 1451 is connected to and forms a unitary structure with support member 1405. Actuator 1451 can be connected (for example, via an arm 1451*b*) to actuator 1452. Actuator 1452 can be connected to actuator 1451 and can extend through a wall of support member 1405 and/or along a portion of a length of support member 1405 (see FIG. 14R). Cleaning apparatus 1400 can further include actuator 1453, which can comprise a disc shaped element. Actuator 1453 can be movably arranged within a cavity 1405*h* defined within a portion of support member 1405. Actuator 1453 can be configured to be moved within cavity 1405*h*, for example, when actuator 1455 applies a force against actuator 1453 induced from contact with an actuator of floor-based vacuum cleaner 1410 when floor-based vacuum cleaner 1410 is attached to support member 1405. In some implementations, actuator 1455 is biased with a spring in a direction away from actuator 1453 and contact between a portion of floor-based vacuum cleaner 1410 overcomes the spring bias and forces actuator 1453 towards and into contact with actuator 1453 when floor-based vacuum cleaner 1410 is attached to support member 1405. With reference to at least FIGS. 14R-14S, and 14U, cleaning apparatus 1400 can include an actuator 1454 that can be connected with wand 1403 and can interact with actuator 1453. Actuator 1454 can be arranged outside a conduit of wand 1403 or alternatively, within a conduit of wand 1403 (for example, in a conduit that is isolated from an airflow conduit within wand 1403).

Figure 14X:
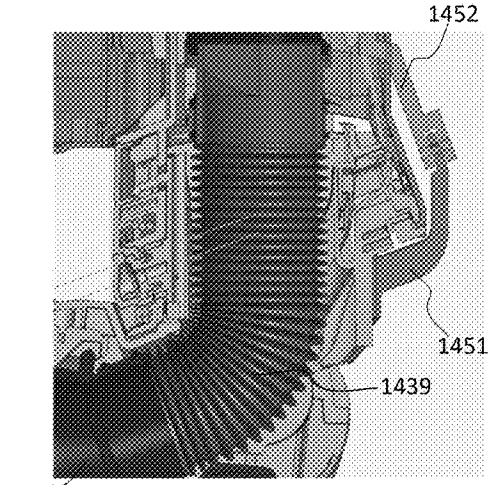
Figure 14A:
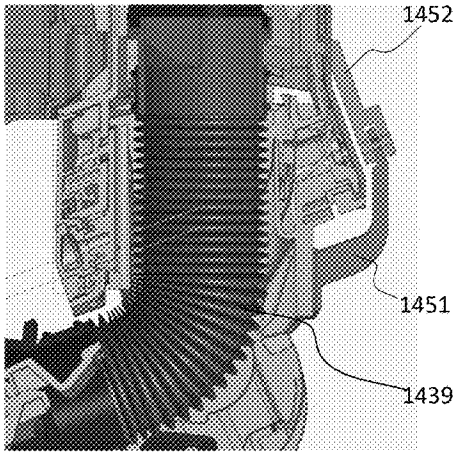
Figure 14W:
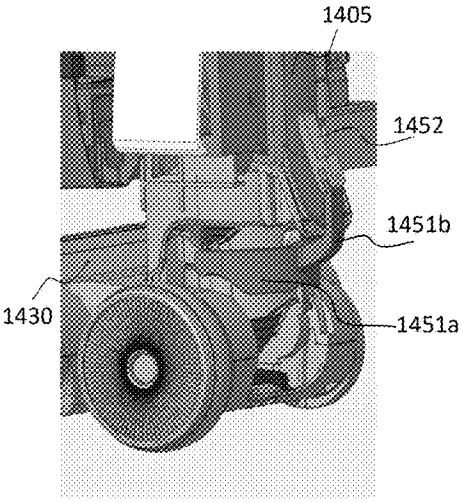
Figure 14Z:
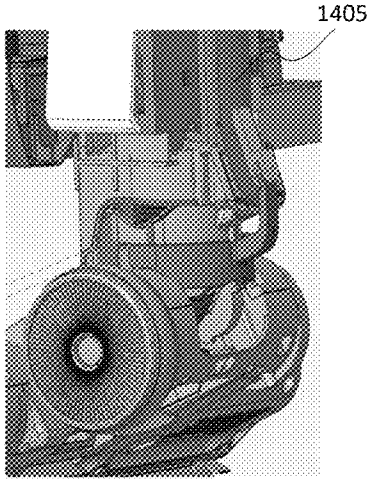
Figure 14D:
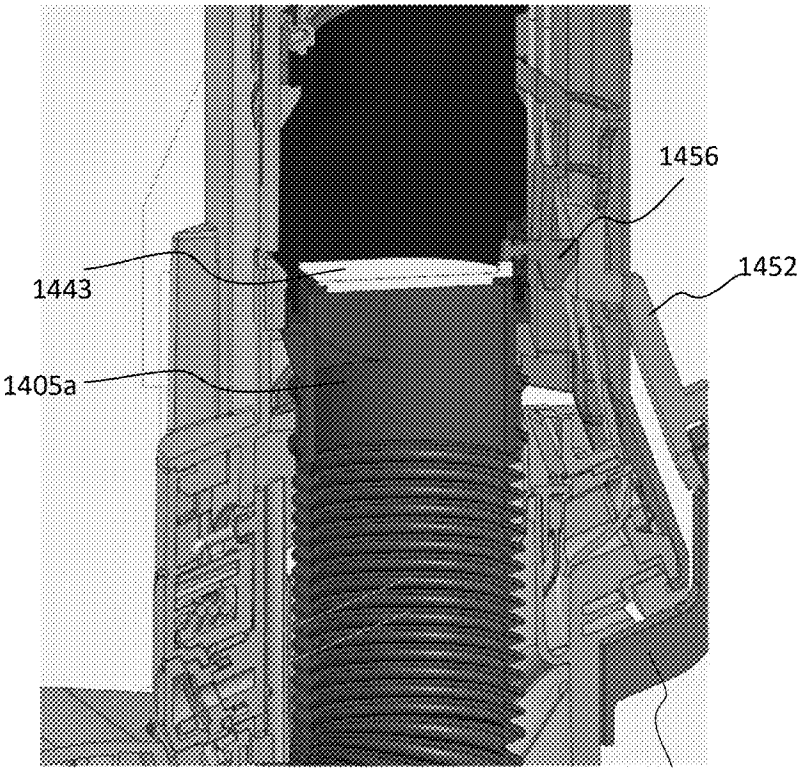
Figure 14C:
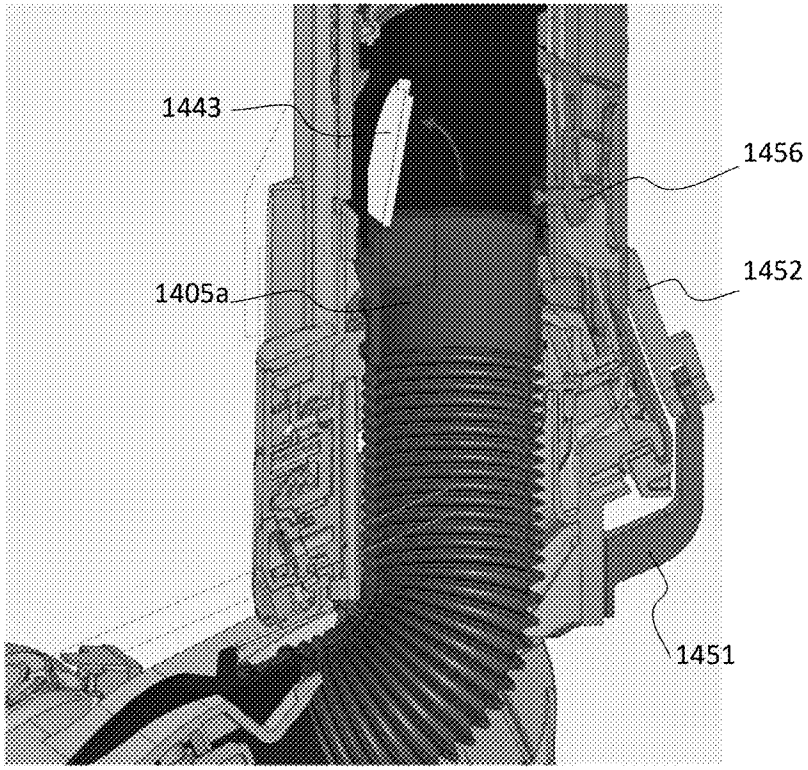
Figure 14F:
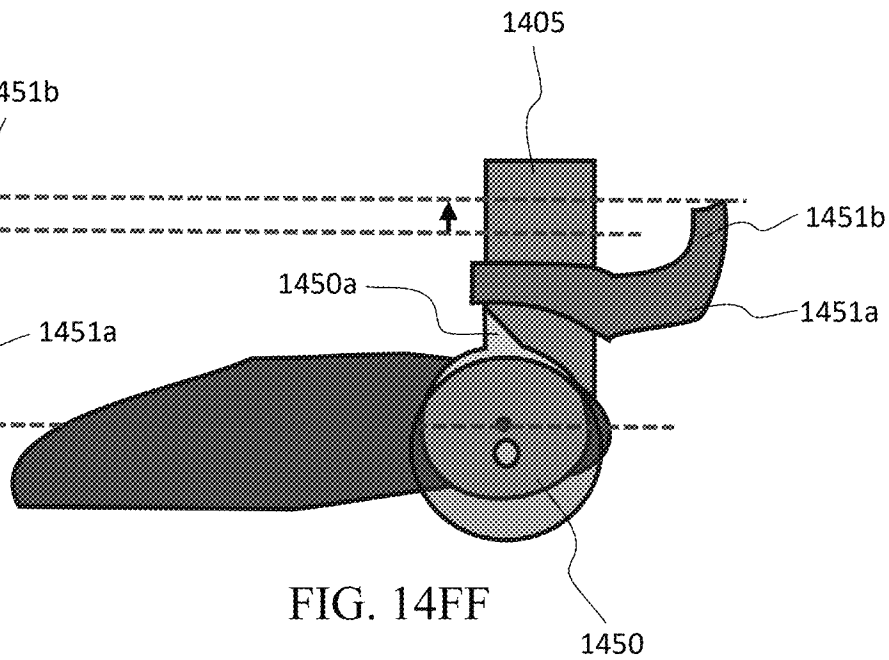
Figure 14E:
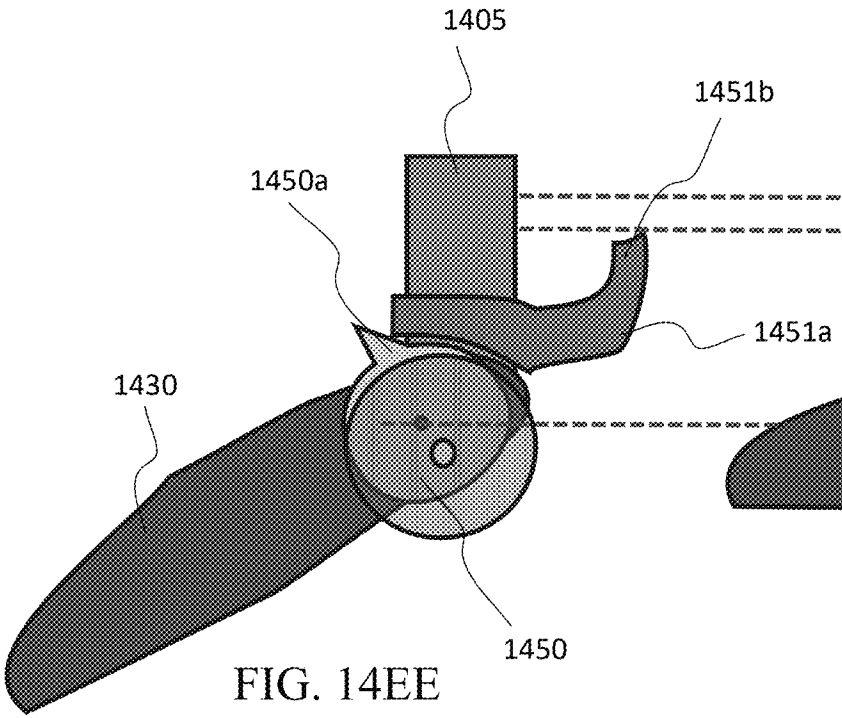
Figure 14H:
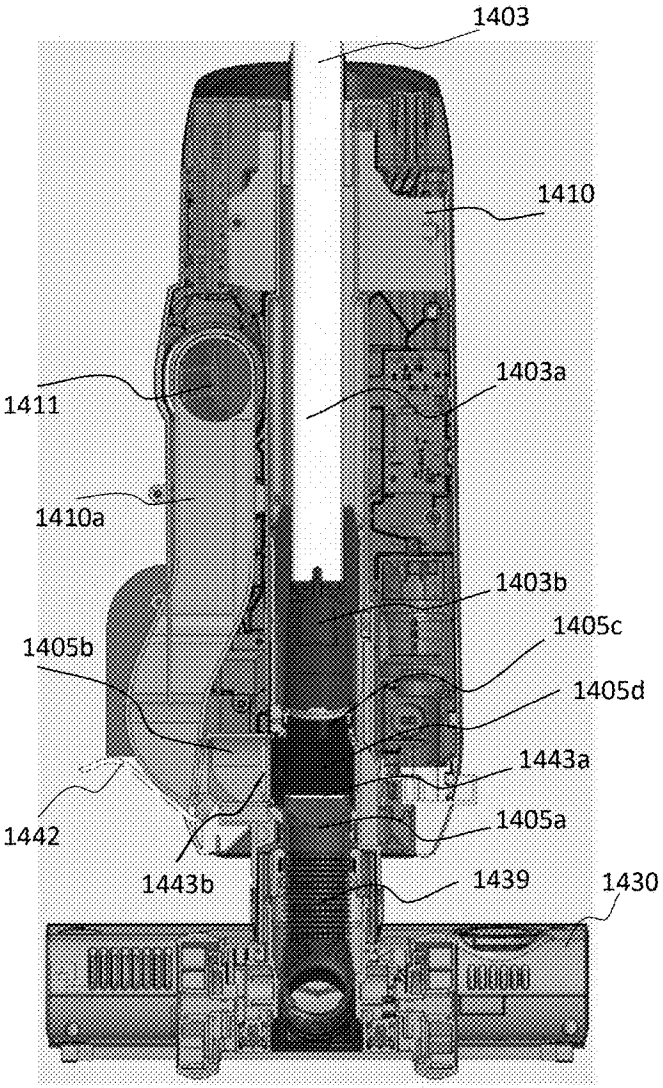
Figure 14G:
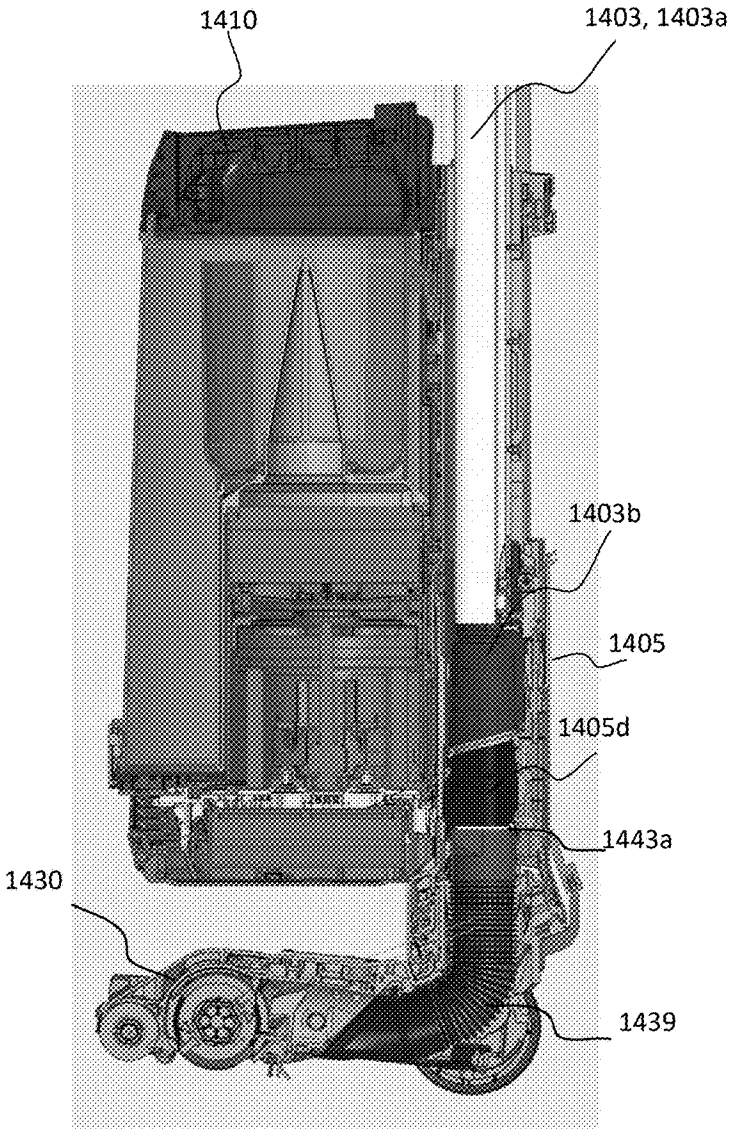
Figure 14J:
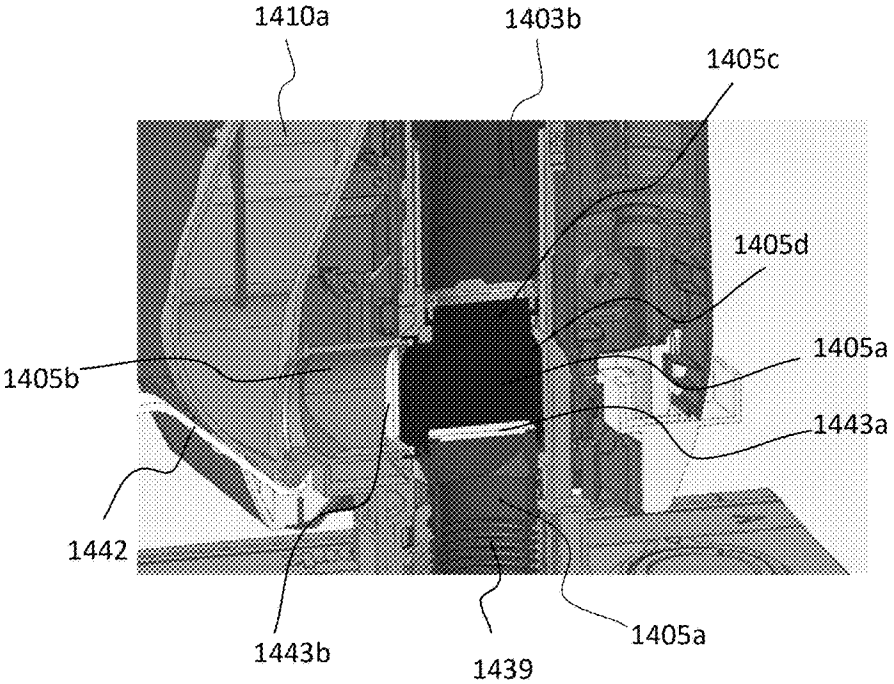
Figure 14I:
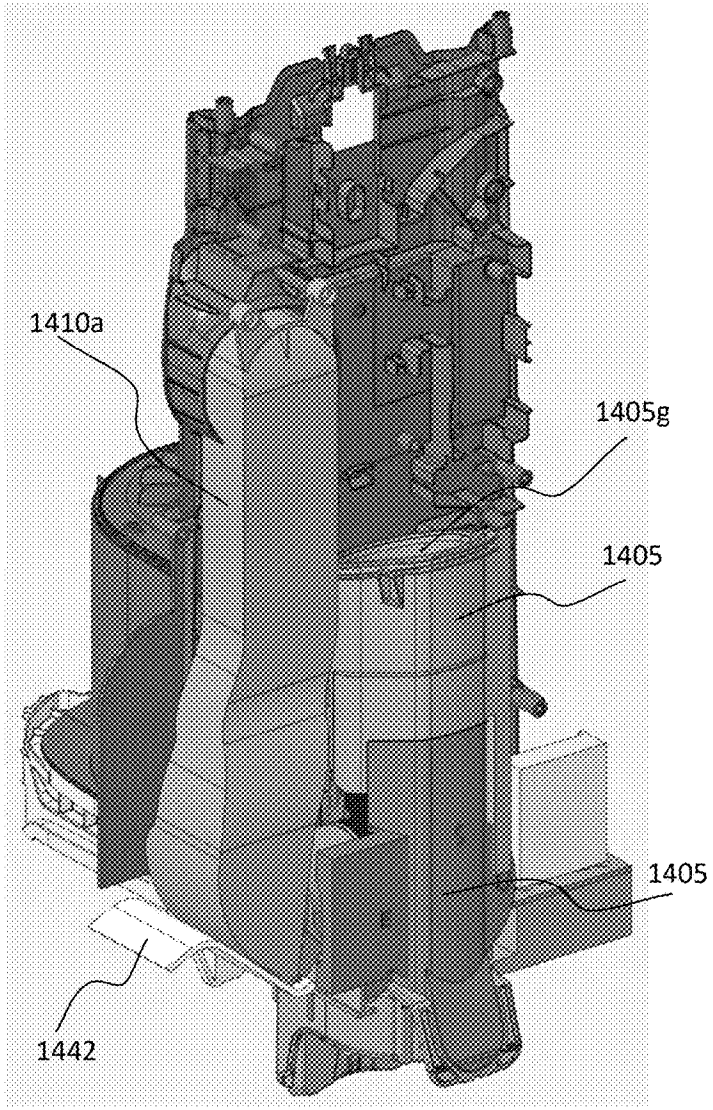
Figure 14K:
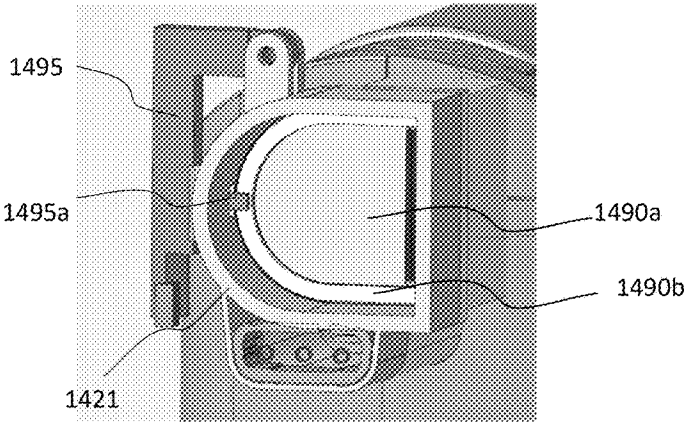
Figure 14L:
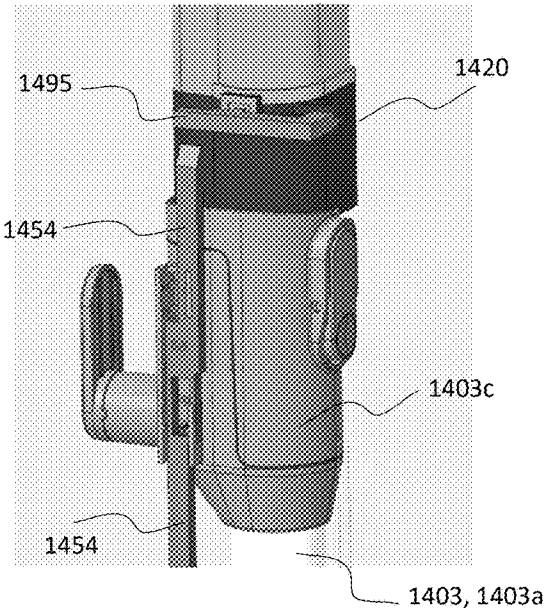

FIGS. 14Z-14BB illustrate portions of cleaning head 1430 and support member 1405 where support member 1405 is in an inclined position, for example, a position in which support member 1405 (and/or wand 1403) is oriented at an angle that is oblique relative to cleaning head 1430 (for example, oblique relative to a plane along a bottom portion of cleaning head 1430). For example, support member 1405 (and/or wand 1403) can be oriented about an axis that is greater than 20 degrees from an axis that is perpendicular to a plane of cleaning head 1430 and/or a surface upon which cleaning head 1430 rests. In such inclined positions, protrusion 1450*a* is spaced away from actuator 1451 (see FIG. 14BB). FIGS. 14W-14Y illustrate portions of cleaning head 1430 and support member 1405 where support member 1405 is in an example upright position, for example, a position in which support member 1405 (and/or wand 1403) is oriented at an angle that is generally perpendicular relative to cleaning head 1430 (for example, generally perpendicular to a plane along a bottom portion of cleaning head 1430). For example, support member 1405 (and/or wand 1403) can be oriented about an axis that is within 20 degrees from an axis that is perpendicular to a plane of cleaning head 1430 and/or a surface upon which cleaning head 1430 rests (for example, within 19 degrees, within 18 degrees, within 17 degrees, within 16 degrees, within 15 degrees, within 14 degrees, within 13 degrees, within 12 degrees, within 11 degrees, within 10 degrees, within 9 degrees, within 9 degrees, within 8 degrees, within 7 degrees, within 6 degrees, within 5 degrees, within 4 degrees, within 3 degrees, within 2 degrees, or within 1 degrees from such plane). In such upright position, protrusion 1450*a* contacts actuator 1451, for example, a portion of body 1451*a* (see FIG. 14Y). Such contact between protrusion 1450*a* and actuator 1451 causes actuator 1451 to move (for example, upward). Movement of actuator 1451 in such manner in turn causes actuator 1452 to move (for example, upward). FIGS. 14EE-14FF schematically illustrate interaction of actuator 1450 with actuator 1451 based on inclination and/or movement of support member 1405 relative to cleaning head 1430. FIG. 14EE illustrates support member 1405 in an inclined position relative to cleaning head 1430 whereas FIG. 14FF illustrates support member 1405 in an upright position relative to cleaning head 1430. As shown in FIG. 14EE, when support member 1405 is in the inclined position, protrusion 1450*a* of actuator 1450 does not engage/contact actuator 1451. As also shown, when support member 1405 is in the upright position, protrusion 1450*a* of actuator 1450 engages/contacts actuator 1451, causing actuator 1451 to move (for example, upward) as indicated by the dotted lines. In some implementations, actuator 1452 is biased with a spring in a direction away from actuator 1453 (for example, downward) and contact between cleaning head 1430 and actuator 1452 moves actuator 1452 and overcomes the spring bias and forces actuator 1452 towards and into contact with actuator 1453.

When floor-based vacuum cleaner 1410 is attached, an actuator of floor-based vacuum cleaner 1410 can push against actuator 1455, thereby causing actuator 1453 to be moved towards (for example, horizontally) actuators 1452, 1454. Actuator 1453 may be held in the position illustrated in the figures (for example, between actuators 1452, 1454) by actuator 1455, which in turn may be pushed against actuator 1453 (for example, in a horizontal direction) by the actuator of the floor-based vacuum cleaner 1410. When actuator 1453 is arranged between actuators 1452 and 1454 and actuator 1452 is pushed upward by actuator 1451 (caused by protrusion 1450*a* of actuator 1450), actuator 1454 can be moved (for example, upward). With reference to FIGS. 14R and 14LL, movement of actuator 1454 upward can cause actuator 1454 to move stop member 1495 from an extended position (in which stop member 1495 prevents valve 1490 from opening) to a retracted position (in which valve 1490 is free to move. FIG. 14KK illustrates a bottom view of handheld vacuum cleaner 1420, illustrating stop member 1495 and stop member protrusion 1495*a* which can block valve 1490 when stop member 1495 is in an extended position (for example, in which a stop member protrusion 1495*a* extends through an opening in a portion of handheld vacuum cleaner 1420). FIG. 14LL illustrates a perspective view of a portion of wand 1403 and handheld vacuum cleaner 1420 and also illustrates actuator 1454 in a first position in which it does not engage stop member 1495. Actuator 1454 can be moved from such first position to a second position (for example, upward) that causes actuator 1454 to move stop member 1495 from the extended position to the retracted position. Accordingly, when cleaning apparatus 1400 is in the above-described upright position and floor-based vacuum cleaner 1410 is attached, actuators 1450, 1451, 1452, 1453, 1455, 1454, and an actuator of floor-based vacuum cleaner 1410 can interact with one another so as to cause stop member 1495 to be retracted and thereby cause valve 1490 to be in an open position. This can advantageously facilitate the empty mode described and/or illustrated with respect to FIGS. 14I-14L above, which allows floor-based vacuum cleaner 1410 to collect debris from handheld vacuum cleaner 1420. Wand 1403 can include an adapter 1403*c* connected at an end (for example, a "top" end) of wand conduit 1403*a* (see FIG. 14LL). Adapter 1403*c* can be configured to secure to a portion of handheld vacuum cleaner 1420, for example, within a socket of handheld vacuum cleaner 1420 at or near a dirty air inlet 1421 of handheld vacuum cleaner 1420. In some implementations, actuator 1454 can be movably mounted to adapter 1403*c* (see FIG. 14LL). For example, actuator 1454 can be mounted to adapter 1403*c* such that actuator 1454 is free to move upward and downward to engage or disengage stop member 1495. With reference to at least FIG. 14R-14S, actuator 1454 may be biased with a spring in a direction towards actuator 1453 (for example, downward) and contact between actuators 1452, 1455, 1453 overcomes the spring bias and forces actuator 1454 upward and into contact with stop member 1495 (see FIG. 14LL).

In some implementations, cleaning apparatus 1400 is configured such that stop member 1495 is in the retracted position only when cleaning apparatus 1400 is in the empty mode, for example, as illustrated and/or described with respect to FIGS. 14I-14L. For example, cleaning apparatus 1400 is configured such that stop member 1495 is in the retracted position only when floor-based vacuum cleaner is attached and support member 1405 and/or wand 1403 are in upright position. For example, cleaning apparatus 1400 is configured such that stop member 1495 is in the retracted position only when: (1) actuator 1453 is moved, for example, by force applied by actuator 1455, induced by an actuator of floor-based vacuum cleaner 1410 and actuator 1453 is positioned between and/or in contact with actuators 1452, 1454; and (2) actuator 1452 is moved, for example, by force applied from actuator 1451, induced by engagement with actuator 1450 as described above. These configurations can cause actuator 1454 to be moved (for example, upward) so as to engage stop member 1495 and cause stop member 1495 (and stop member protrusion 1495*a*) to move to a retracted position. In some implementations, stop member 1495 is biased towards the extended position.

Cleaning apparatus 1400 can be configured such that valve 1443 is open when support member 1405 and/or wand 1403 are in an inclined position, for example, a position in which support member 1405 and/or wand 1403 are oriented at an angle that is oblique relative to cleaning head 1430. Such inclined position can be one in which an axis extending through support member 1405 and/or wand 1403 is oriented at an angle that is greater than 5, 10, 15, or 20 degrees from an axis that is perpendicular to a plane of cleaning head 1430 and/or a surface upon which cleaning head 1430 rests. In such inclined positions, protrusion 1450*a* can be spaced away from actuator 1451 (see FIG. 14BB) and actuator 1452 can be positioned as illustrated in FIG. 14CC. In the position illustrated in FIG. 14CC, a stop member 1456 is in a retracted position and does not prevent valve 1443 from opening (for example, pivoting). As shown in FIG. 14CC, valve 1443 is open in such case. FIG. 14DD illustrates positions of actuator 1452 and stop member 1456 when support member 1405 is in an upright position (for example, as described above). In such upright position, support member 1405 (and/or wand 1403) may be oriented about an axis that is within about 20, 15, 10, or 5 degrees from perpendicular relative to a plane of cleaning head 1430 and/or a surface upon which cleaning head 1430 rests, for example. In such upright position, actuator 1452 is moved up based on movement of actuator 1451 induced by contact between protrusion 1450*a* and actuator 1451 as described previously. As shown in FIG. 14DD, movement of actuator 1452 in such manner (for example, upward) pushes stop member 1456 inward such that stop member 1456 prevents valve 1443 from opening. In some implementations, pivoting of valve 1443 is tied to pivotable movement of support member 1405, such that valve 1443 is: pivoted to the open position when support member 1405 is moved from an upright position to an inclined position and when stop member 1456 is retracted; and pivoted to the closed position when support member 1405 is moved from an inclined position to an upright position.

FIGS. 14GG, 14HH, and 14JJ illustrate example cross-sections through portions of cleaning apparatus 1400 and FIG. 14II illustrates a rear perspective view of a portion of cleaning apparatus 1400. With reference to FIGS. 14HH and 14JJ, in some variants, cleaning apparatus can include two valves 1443*a*, 1443*b* in support member 1405. Valve 1443*b* may be pivotably connected to support member 1405 and configured to open/close port 1405*b*. Valve 1443*a* can be similar or identical in some or all aspects to valve 1443 as described above. Valve 1443*b* is an optional additional valve and in various implementations, cleaning apparatus 1400 does not include valve 1443*b*. With reference to FIG. 14II, support member 1405 can be configured to secure to wand 1403 via region 1405*g*.

Figures 15A, 15B, 15C, 15D:
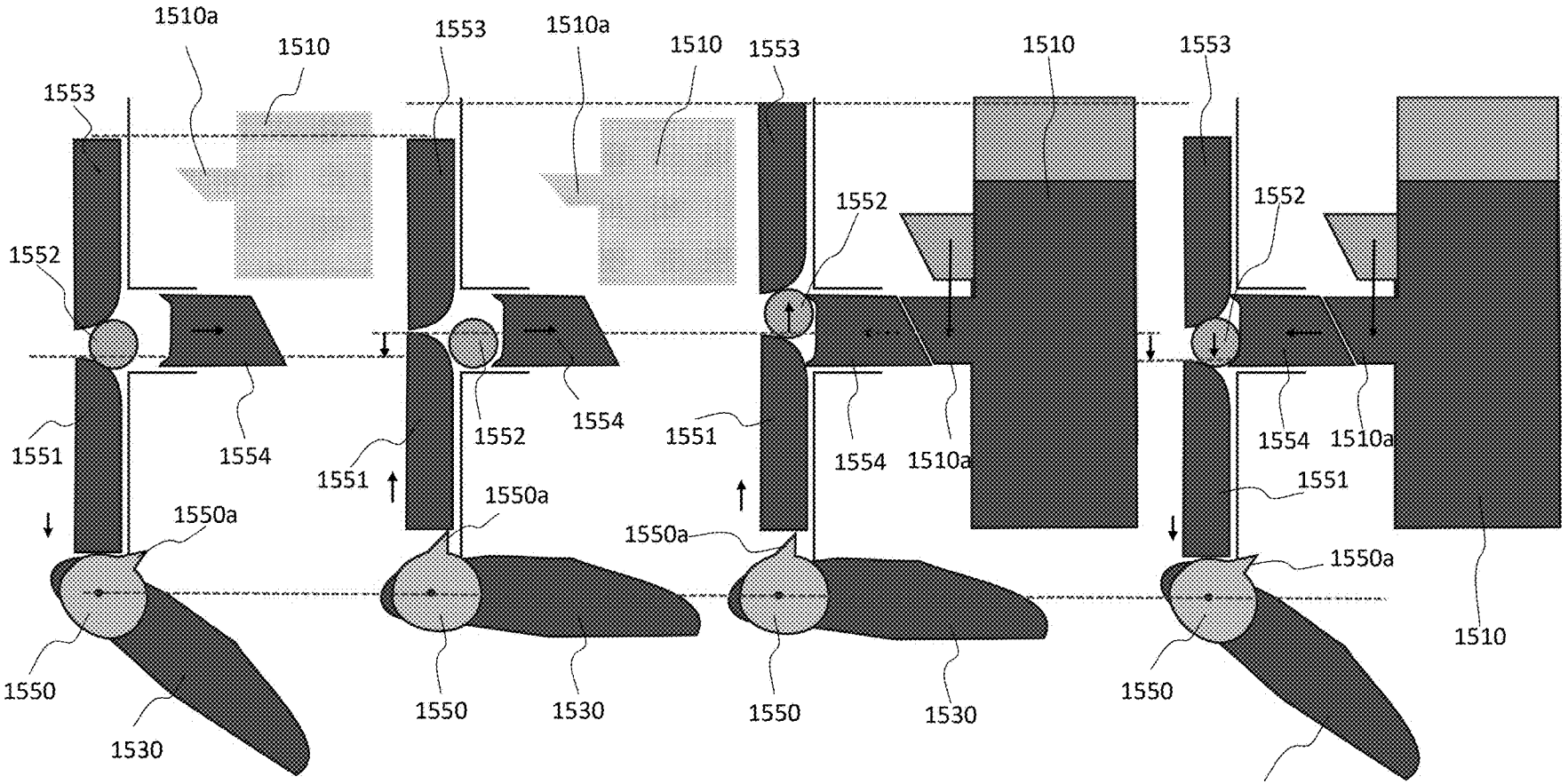
FIGS. 15A-15D illustrate schematic diagrams of certain portions of another implementation of a cleaning apparatus in accordance with aspects of this disclosure.

FIGS. 15A-15D schematically illustrate actuators that can be utilized to open and/or close valves of a cleaning apparatus. FIGS. 15A-15D illustrate a cleaning head 1530, an actuator 1550 having a protrusion 1550*a*, and actuators 1551, 1552, 1553, 1554. FIGS. 15A-15D also illustrate a floor-based vacuum cleaner 1510 having an actuator 1510*a*. The cleaning apparatus of FIGS. 15A-15D can include a handheld vacuum cleaner, a valve for opening/closing a flow path to cleaning head 1530 ("main valve"), and a valve for opening/closing a flow path to the handheld vacuum cleaner ("handvac valve"). FIG. 15A illustrates an example stick mode of operation in which a wand/support member of the cleaning apparatus is in an inclined position relative to cleaning head 1530 (which may be similar or identical to any of the inclined positions discussed previously). In some implementations, the main valve is open when the cleaning apparatus is in the inclined position of FIG. 15A. In the mode of FIG. 15A, protrusion 1550*a* does not contact actuator 1551, thereby allowing actuator 1551 to remain in a first position (which may be referred to as a "lower position"). Floor-based vacuum cleaner 1510 is detached in such mode. In some implementations, the handvac valve is open when the cleaning apparatus is in the inclined position of FIG. 15A. In the mode of FIG. 15A, cleaning head 1530 can be in flow communication with the handheld vacuum cleaner. In such mode, air can be drawn in from the cleaning head 1530 and through the handheld vacuum cleaner such that debris can be collected from a surface through cleaning head 1530 into a debris container of the handheld vacuum cleaner.

FIG. 15B illustrates an example mode in which wand/support member of the cleaning apparatus is in an upright position relative to cleaning head 1530 (which may be similar or identical to any of the upright positions discussed previously). In the mode of FIG. 15B, floor-based vacuum cleaner 1510 is detached and protrusion 1550*a* contacts actuator 1551, moving it upward. In some implementations, the main valve is closed when the cleaning apparatus is in the upright position of FIG. 15B. As shown, because floor-based vacuum cleaner 1510 is detached, actuator 1510*a* is not engaged with actuator 1554 and actuator 1554 is not pushed into engagement with actuator 1552. Accordingly, actuator 1553 is not moved. In some implementations, the handvac valve is closed when the cleaning apparatus is in the upright position and the floor-based vacuum cleaner 1510 is detached as shown in FIG. 15B such that debris is inhibited from leaving the handheld vacuum cleaner, for example, under the force of gravity.

FIG. 15C illustrates an example empty mode in which wand/support member of the cleaning apparatus is in an upright position relative to cleaning head 1530 (which may be similar or identical to any of the upright positions discussed previously) and floor-based vacuum cleaner 1510 is attached. In such empty mode, actuator 1510*a* engages actuator 1554 and pushes actuator 1552 into engagement with actuator 1553. Actuator 1551 is pushed upward due to contact with protrusion 1550*a* of actuator 1550 and into engagement with actuator 1552, causing actuators 1552, 1553 to move upward. Movement of actuator 1553 can cause actuator 1553 to engage a stop member of the handheld vacuum cleaner to a retracted position such the handvac valve is pivotable. A suction motor of floor-based vacuum cleaner 1510 can cause airflow from the handheld vacuum cleaner to the floor-based vacuum cleaner 1510, thereby causing the handvac valve to open. This mode thereby allows for debris from the handheld vacuum cleaner to be emptied into the floor-based vacuum cleaner 1510.

FIG. 15D illustrates an example upright mode in which the wand/support member of the cleaning apparatus is in an inclined position relative to cleaning head 1530 (which may be similar or identical to any of the inclined positions discussed previously) and floor-based vacuum cleaner 1510 is attached. In such upright mode, actuator 1510*a* may engage actuator 1554, but since protrusion 1550*a* does not engage and move actuator 1551, actuator 1553 is not moved (for example, not moved upward). In such mode, the stop member of the handheld vacuum cleaner is in an extended position and the handvac valve is in the closed position. In such mode, a suction motor of floor-based vacuum cleaner 1510 can cause airflow from the cleaning head 1530 to the floor-based vacuum cleaner such that debris is drawn from the cleaning head 1530 into the floor-based vacuum cleaner 1510.

FIGS. 16A-16DD illustrate another implementation of a cleaning apparatus 1600 and portions thereof. Cleaning apparatus can include any features described with respect to other cleaning apparatus described herein, such as cleaning apparatus 1400. Cleaning apparatus 1600 can include a cleaning head 1630, a support member 1605, a wand 1603, a handheld vacuum cleaner 1620, a floor-based vacuum cleaner 1610, and a power cord 1601 connected to handheld vacuum cleaner 1620. Floor-based vacuum cleaner 1610 and handheld vacuum cleaner 1620 may be referred to as a "first vacuum cleaner" of cleaning apparatus 1600 and handheld vacuum cleaner 1620 may be referred to as a "second vacuum cleaner" of cleaning apparatus 1600. Cleaning apparatus 1600 can be operated to draw air and/or debris from a surface (for example, a floor) to remove debris from the surface. Cleaning head 1630 (which also may be referred to as a "surface cleaning head" or "floor nozzle") can be supported by the surface when the cleaning apparatus 1600 is operated to remove debris from the surface. Cleaning head 1630 can be movable with respect to the surface to remove debris from different areas of the surface. Cleaning head 1630 can include any features described with respect to other cleaning heads disclosed herein, such as cleaning head 330. Floor-based vacuum cleaner 1610 can include any features described with respect to other floor-based vacuum cleaners disclosed herein, such as floor-based vacuum cleaner 310. Handheld vacuum cleaner 1620 can include any features described with respect to other handheld vacuum cleaners disclosed herein, such as handheld vacuum cleaner 320. Support member 1605 (which also may be referred to as a "support" or "support structure" or "neck") can be pivotably connected to cleaning head 1630 so as to be pivotable between the positions shown in FIGS. 16EE-16JJ (described in more detail below), among other positions. In some implementations, support member 1605 forms a unitary structure with cleaning head 1630, for example, that is removably attachable to wand 1603 and/or floor-based vacuum cleaner 1610.

Figure 16B:
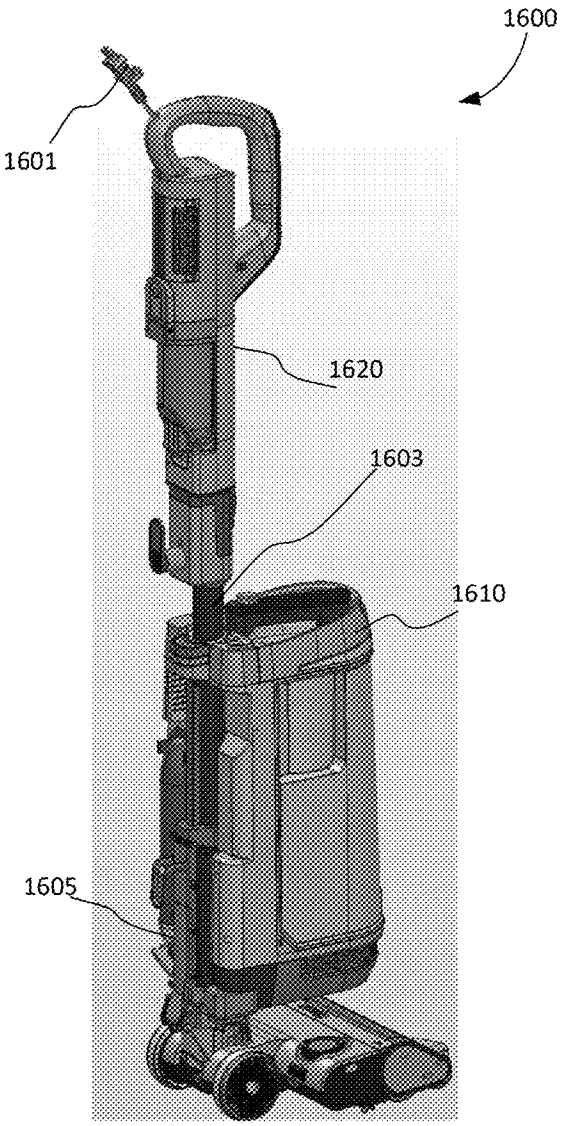
FIGS. 16A-16C illustrate perspective views of another implementation of a cleaning apparatus in accordance with aspects of this disclosure.
Figure 16A:
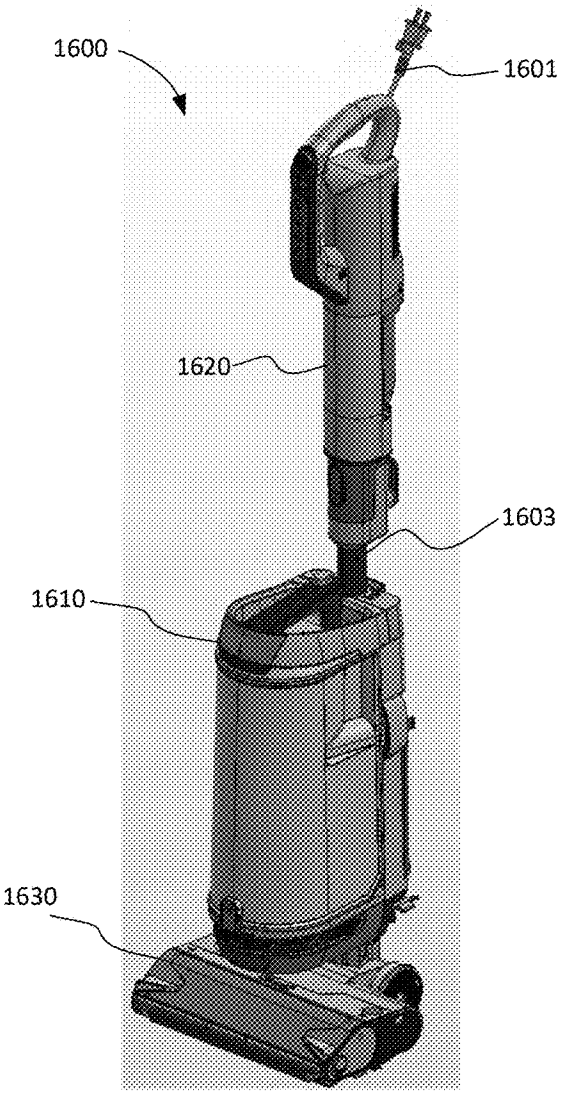
Figure 16E:
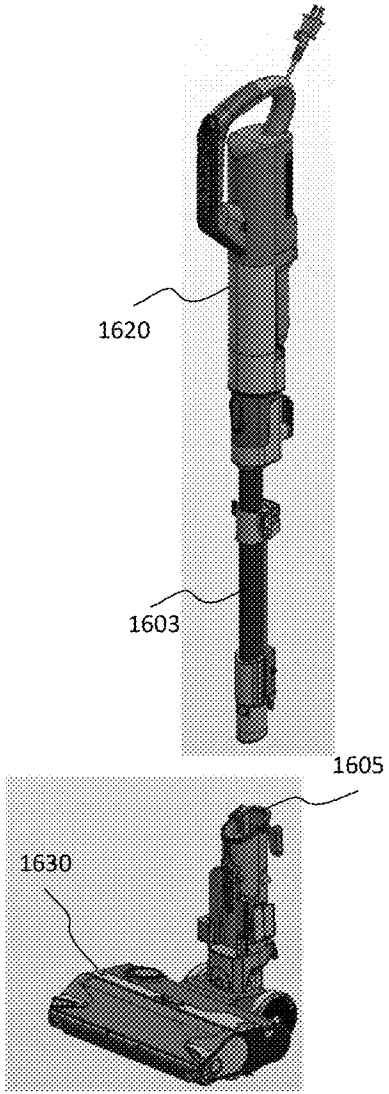
FIGS. 16D-16E illustrate portions of the cleaning apparatus of FIGS. 16A-16C with a floor-based vacuum cleaner detached in accordance with aspects of this disclosure.
Figure 16D:
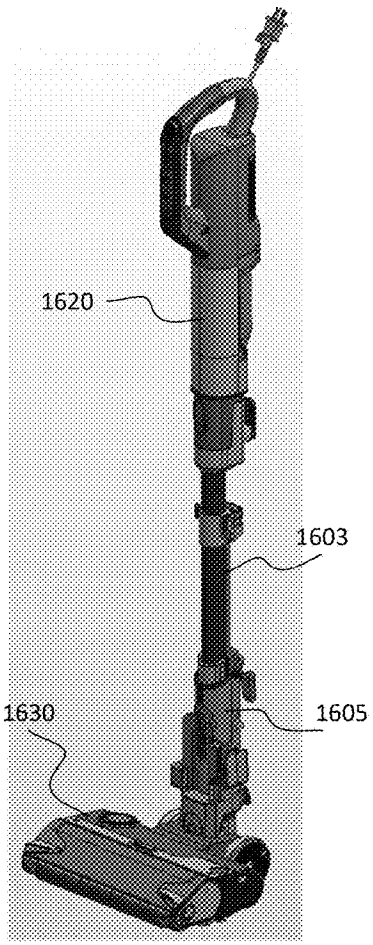
Figure 16C:
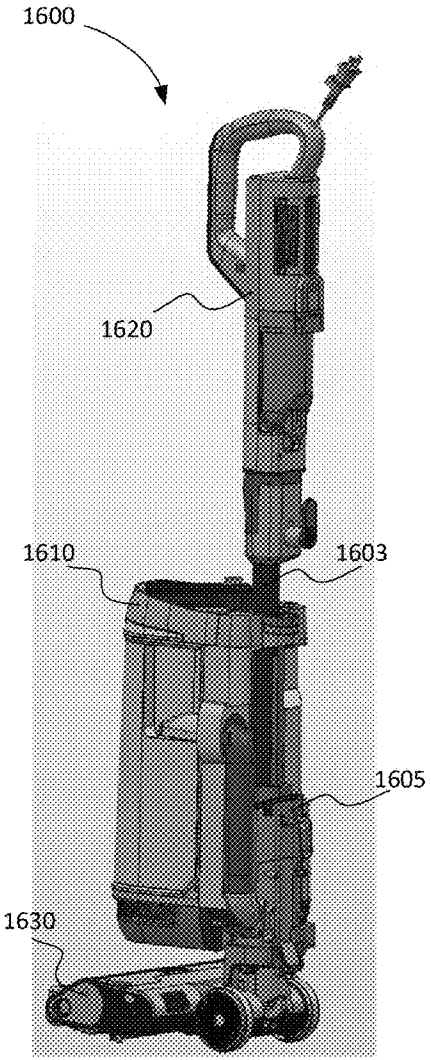

Floor-based vacuum cleaner 1610 and/or handheld vacuum cleaner 1620 can be removably attachable to cleaning head 1630 at least partially via wand 1603 and/or support member 1605. Floor-based vacuum cleaner 1610, wand 1603, and handheld vacuum cleaner 1620 can be attachable to support member 1605, and accordingly, may pivot together with support member 1605 to and between the positions shown in FIGS. 16EE-16JJ, and a plurality of other positions between and/or beyond such positions. Wand 1603 can be removably attachable to cleaning head 1630, support member 1605, handheld vacuum cleaner 1620, and/or floor-based vacuum cleaner 1610. FIGS. 16A-16C illustrate floor-based vacuum cleaner 1610, handheld vacuum cleaner 1620, support member 1605, wand 1603, and cleaning head 1630 attached to one another. FIG. 16D illustrates floor-based vacuum cleaner 1610 detached from support member 1605, wand 1603, cleaning head 1630, and handheld vacuum cleaner 1620. FIG. 16E illustrates handheld vacuum cleaner 1620 and wand 1603 detached from support member 1605 and cleaning head 1630.

Figure 16G:
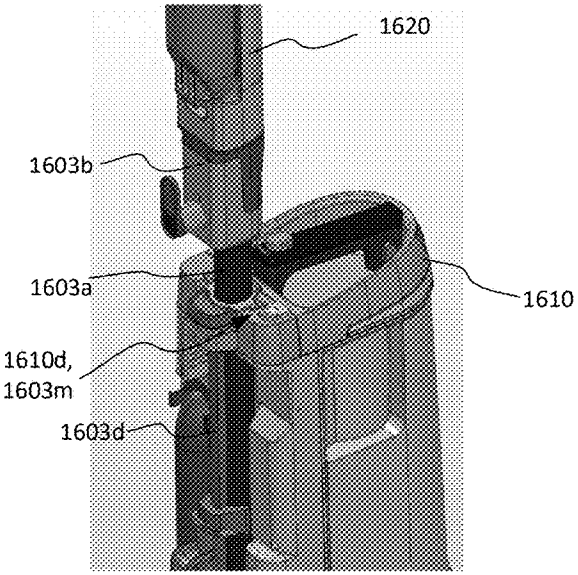
FIGS. 16F-16L illustrate various enlarged views of portions of the cleaning apparatus of FIGS. 16A-16C in accordance with aspects of this disclosure.
Figure 16I:
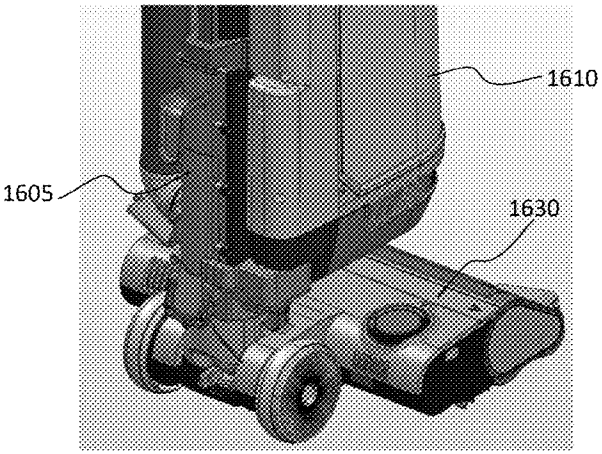
Figure 16F:
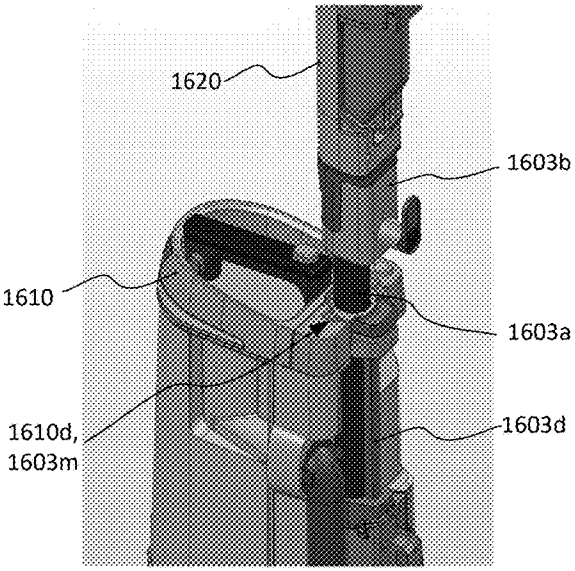
Figure 16H:
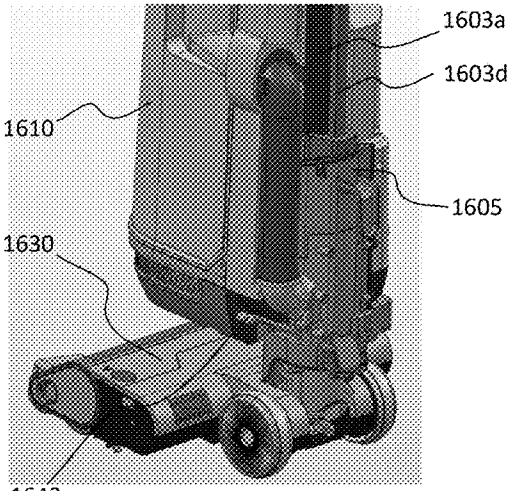
Figure 16K:
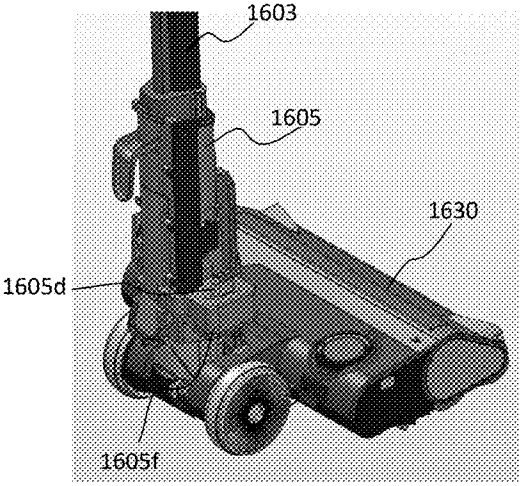
Figure 16J:
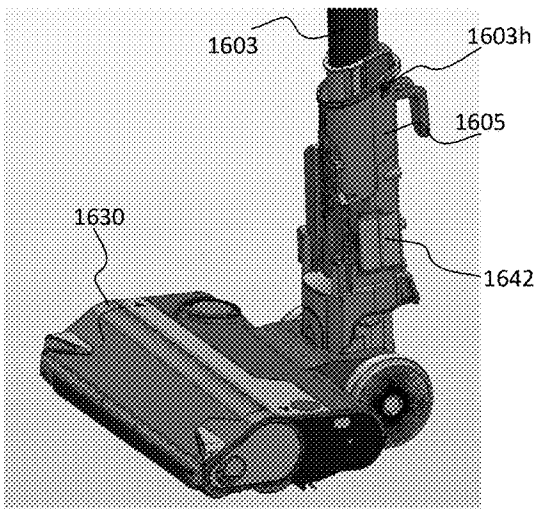
Figure 16M:
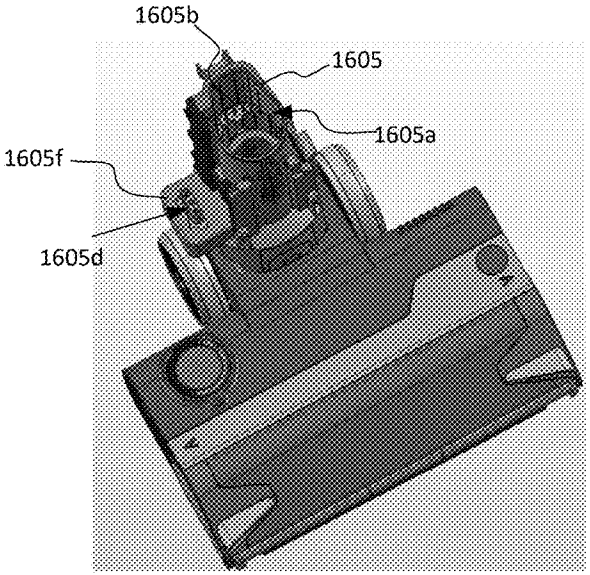
FIG. 16M illustrates a top perspective view of a support member and cleaning head of the cleaning apparatus of FIGS. 16A-16C in accordance with aspects of this disclosure.
Figure 16L:
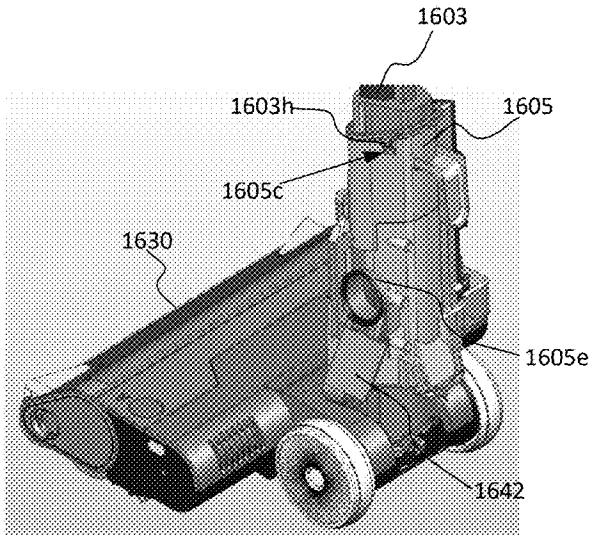
Figure 16O:
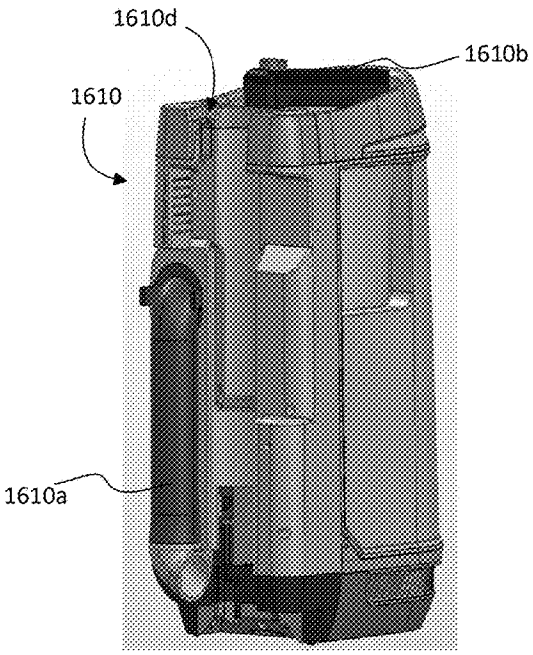
FIGS. 16N-16P illustrate various views of a floor-based vacuum cleaner of the cleaning apparatus of FIGS. 16A-16C in accordance with aspects of this disclosure.
Figure 16P:
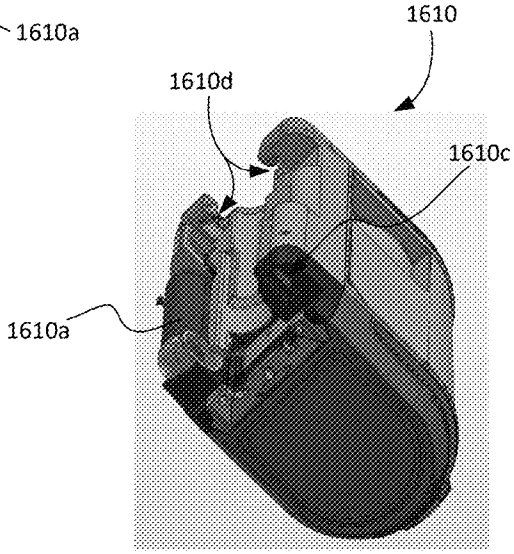
Figure 16N:
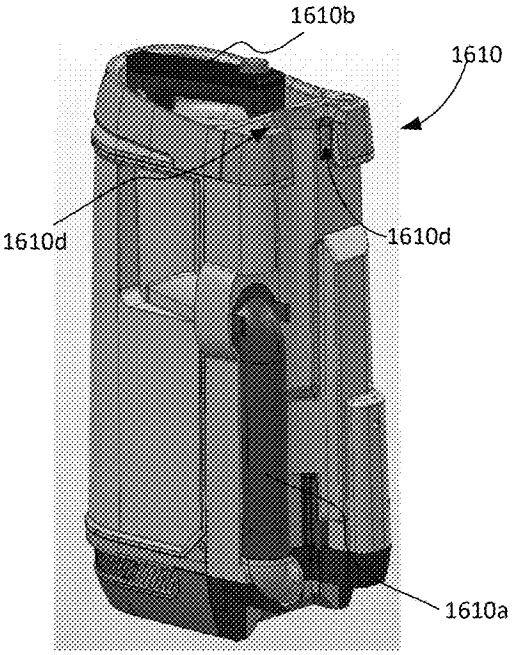

FIGS. 16F-16I illustrate enlarged views of portions of cleaning apparatus 1600 with floor-based vacuum cleaner 1610, handheld vacuum cleaner 1620, support member 1605, wand 1603, and cleaning head 1630 attached to one another. FIGS. 16J-16L illustrate portions of support member 1605, wand 1603, and cleaning head 1630 attached to one another. FIG. 16M illustrates a top perspective view of support member 1605 and cleaning head 1630. FIGS. 16N-16P illustrate various views of floor-based vacuum cleaner 1610 and portions thereof and FIGS. 16Q-16U illustrate various views of wand 1603 and portions thereof.

With reference to FIGS. 16Q-16U, wand 1603 can include a wand conduit 1603*a*, a first adapter 1603*b* for connecting to handheld vacuum cleaner 1620, and a second adapter 1603*c* for connecting to support member 1605. Wand conduit 1603*a* can be tubular. First and second adapters 1603*b*, 1603*c* can be arranged at opposite ends of wand 1603 and attached to "top" and "bottom" ends of wand conduit 1603*a*. Wand 1603 can include an airflow passage extending through wand conduit 1603*a* and first and second adapters

Figure 16T:
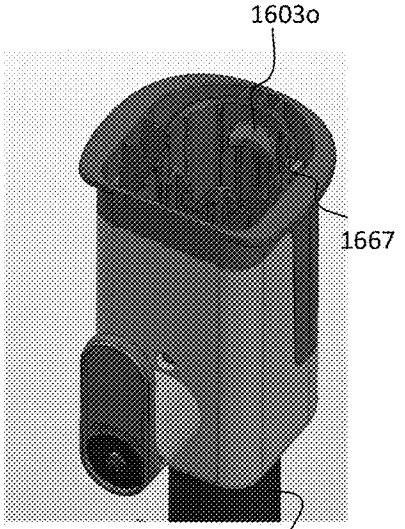
FIGS. 16Q-16U illustrate various views of a wand of the cleaning apparatus of FIGS. 16A-16C in accordance with aspects of this disclosure.
Figure 16S:
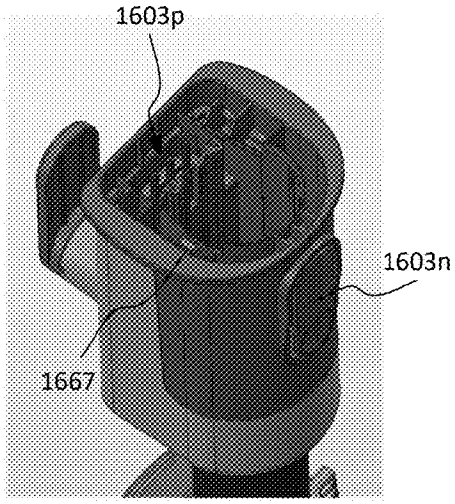
Figure 16U:
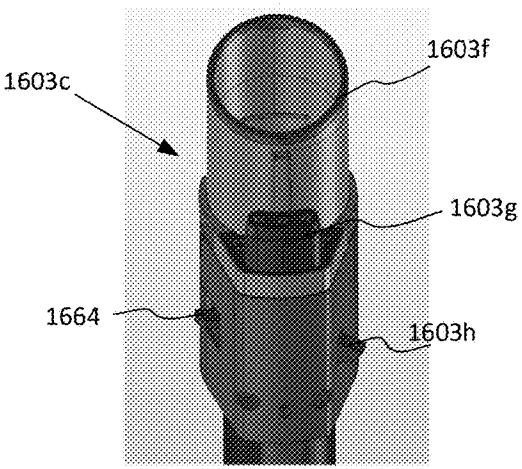
Figure 16R:
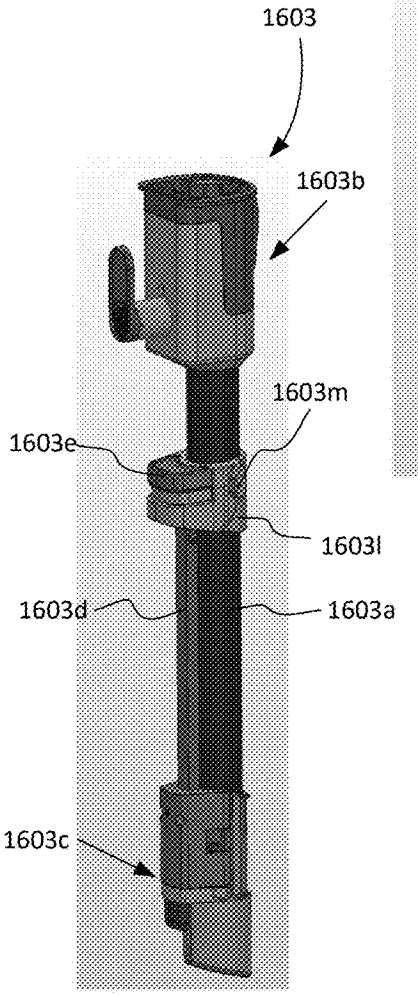
Figure 16Q:
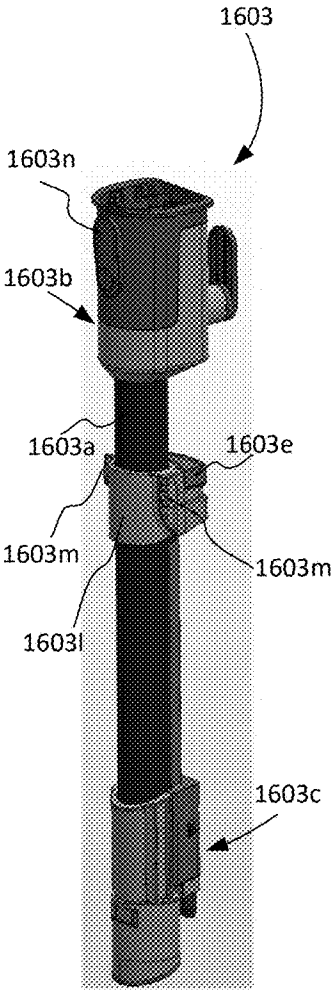
Figure 16V:
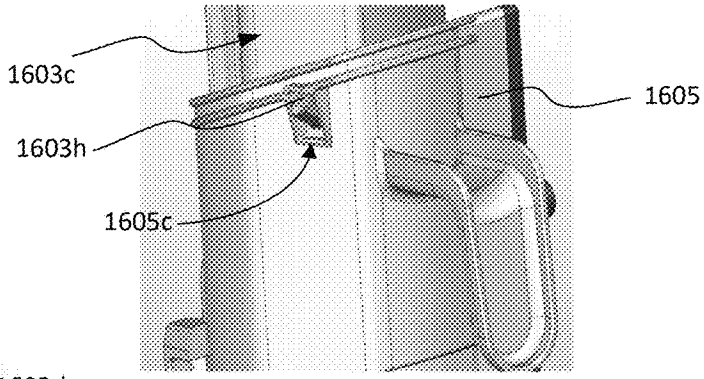
FIG. 16V illustrates an enlarged view of a portion of a wand and a support member of the cleaning apparatus of FIGS. 16A-16C in accordance with aspects of this disclosure.
Figure 16X:
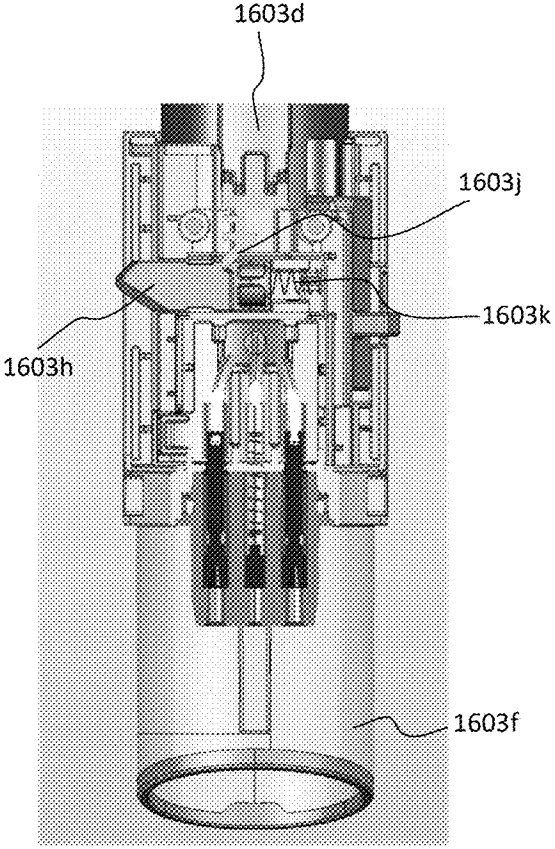
FIGS. 16W-16X illustrate enlarged views of a portion of the wand of FIGS. 16Q-16U in accordance with aspects of this disclosure.
Figure 16W:
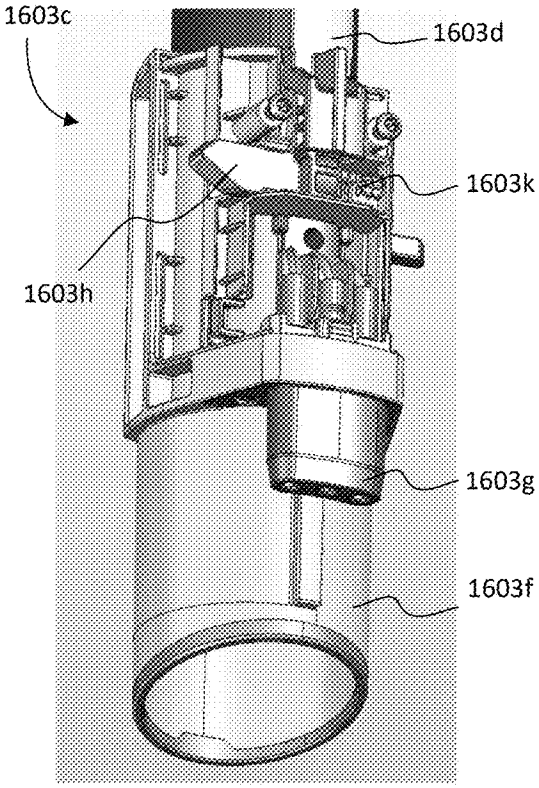

1603*b*, 1603*c*. Adapter 1603*c* can be configured to secure to a portion of support member 1605, for example, within a socket 1605*a* of support member 1605 (see FIG. 16M). In some variants, adapter 1603*c* and support member 1605 are configured such that support member 1605 (for example, an end thereof) is received and secured within a portion of adapter 1603*c*. With reference to FIG. 16U, adapter 1603*c* can include a snout 1603*f* that can be at least partially tubular and an electrical connector 1603*g* configured to mechanically and electrically connect to an electrical connector 1605*b* of support member 1605 (see FIG. 16M). Wand 1603 and/or support member 1605 can include one or more latch mechanisms to inhibit detachment of wand 1603 from support member 1605. For example, wand 1603 can include a latch 1603*h* that can be received by a latch opening 1605*c* in support member 1605 (see FIGS. 16J, 16L, and 16V). Wand 1603 can include one or more mechanisms to move latch 1603*h*, for example, horizontally so as to move latch 1603*h* into (through) and out of latch opening 1605*c*. For example, with reference to at least FIGS. 16Q-16R, wand 1603 can include a rod 1603*d* that can be moved to cause movement of latch 1603*h*. Rod 1603*d* can be coupled to wand conduit 1603*a*, for example, to an outer portion thereof. Rod 1603*d* can include an engagement feature 1603*e*, for example, at an end of rod 1603*d* that facilitates movement of rod 1603*d* (for example, downward). In some implementations, wand 1603 includes a coupler 16031 that can facilitate coupling of wand 1603 to floor-based vacuum cleaner 1610, for example, via engagement of protrusions 1603*m* within slots 1610*d* as described in more detail below. In some of such implementations, rod 1603*d* can be coupled to wand conduit 1603*a* via such coupler 16031 (see FIGS. 16Q-16R). FIG. 16W illustrates an enlarged view of a portion of wand 1603 with a portion of adapter 1603*c* removed to better illustrate latch 1603*h* and a portion of rod 1603*d*. Latch 1603*h* can be arranged within structure of adapter 1603*c* and in some implementations, is biased to an extended position by a biasing member such as spring 1603*k*. FIG. 16X illustrates a partial cross-sectional view taken through a portion of adapter 1603*c*. Rod 1603*d* can be configured to push latch 1603*h* from its extended position (illustrated in the figures) in which latch 1603*h* extends through latch opening 1605*c* (when wand 1603 is attached to support member 1605) to a retracted position in which latch 1603*h* does not extend through latch opening 1605*c*. In such retracted position, latch 1603*h* can compress spring 1603*k*. Rod 1603*d* can be configured to cause latch 1603*h* to move to such retracted position when moved in a downward direction, for example. With reference to FIG. 16X, rod 1603*d* can include an inclined surface 1603*j* configured to cause latch 1603*h* to move to such retracted position when rod 1603*d* is moved downward.

Figure 16Z:
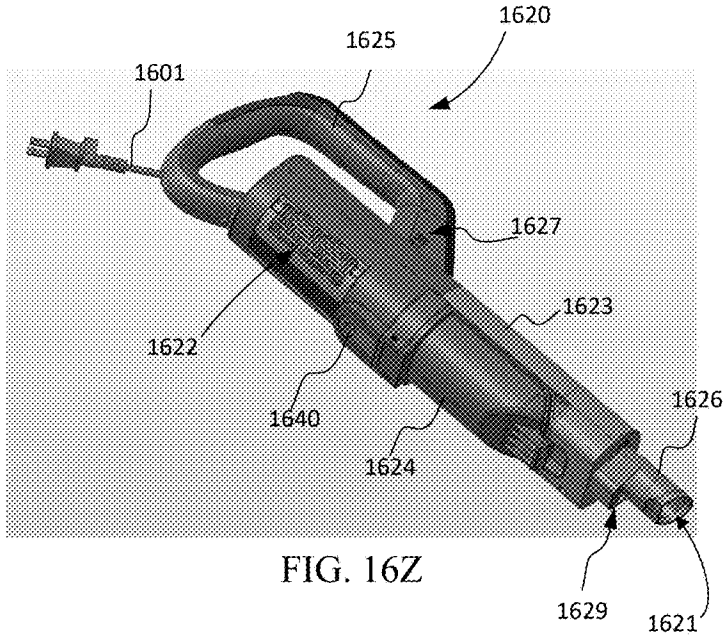

Adapter 1603*b* can be configured to attach to handheld vacuum cleaner 1620. Adapter 1603*b* can include one or more latch mechanisms configured to inhibit detachment of adapter 1603*b* (and thus, wand 1603) from handheld vacuum cleaner 1620. For example, with reference to at least FIGS. 16Q-16T, adapter 1603*b* can include a latch 1603*n* having a locking feature 16030 configured to engage within a portion of handheld vacuum cleaner 1620 (for example, groove 1626*a* in a portion of snout 1626 (see FIG. 16BB). Latch 1603*h* can be pivotably connected to a portion of adapter 1603*b* and can be pushed (for example, by a user) between an extended position (see FIG. 16T) and a retracted position. In such extended position, locking feature 16030 is arranged within groove 1626*a* when adapter 1603*b* is attached to handheld vacuum cleaner 1620. In some implementations, latch 1603*n* is biased toward such extended position. With reference to FIG. 16S, adapter 1603*b* can include an electrical connector 1603*p* configured to mechanically and electrically connect to an electrical connector 1629 of handheld vacuum cleaner 1620 (see FIGS. 16Z and 16AA) when adapter 1603*b* is attached to handheld vacuum cleaner 1620.

FIGS. 16N-16P illustrate various views of floor-based vacuum cleaner 1610. Floor-based vacuum cleaner 1610 can include a duct 1610*a* configured to fluidly connect to an outlet 1605*e* of support member 1605 as shown in FIG. 16L. FIG. 16L illustrates lid/door 1642 in an open position to better illustrate outlet 1605*e*, however, it is to be understood that lid/door 1642 may be biased closed (as shown in FIG. 16J) by a biasing member (such as a torsional spring) when floor-based vacuum cleaner 1610 is detached. Duct 1610*a* can fluidly connect a dirty air inlet of floor-based vacuum cleaner 1610 to outlet 1605*e*. In some variants, floor-based vacuum cleaner 1610 does not include duct 1610*a*, and in such variants, a dirty air inlet (for example, formed by a port and/or opening in floor-based vacuum cleaner 1610) is directly connected to outlet 1605*e*. As shown, floor-based vacuum cleaner 1610 can include a handle 1610*b* that can facilitate detachment of floor-based vacuum cleaner 1610 and/or holding floor-based vacuum cleaner 1610 when detached. Floor-based vacuum cleaner 1610 can be configured to receive and/or secure to wand 1603. As mentioned previously, floor-based vacuum cleaner 1610 can include slots 1610*d* configured to receive protrusions 1603*m* of coupler 16031 (see FIGS. 16Q-16R). FIGS. 16F-16G illustrate protrusions 1603*m* within slots 1610*d*. Protrusions 1603*m* can be configured to be inserted within slots 1610*d* vertically, for example, when floor-based vacuum cleaner 1610 is moved downward when attached to wand 1603. Arrangement of protrusions 1603*m* within slots 1610*d* may inhibit detachment of floor-based vacuum cleaner 1610 from wand 1603 (for example, lateral detachment).

Floor-based vacuum cleaner 1610 and support member 1605 can be configured to electrically connect to one another, which can allow floor-based vacuum cleaner 1610 to receive electrical power from support member 1605. For example, floor-based vacuum cleaner 1610 can include an electrical connector 1610*c* configured to mechanically and electrically connect to an electrical connector 1605*d* of support member 1605 (see FIG. 16M). In some implementations, support member 1605 includes a leg 1605*f* on which electrical connector 1605*d* is arranged. Such leg 1605*f* can be configured to support a portion of floor-based vacuum cleaner 1610 which includes electrical connector 1610*c* (see FIG. 16P). FIGS. 16H-16I illustrate portions of floor-based vacuum cleaner 1610, wand 1603, support member 1605, and cleaning head 1630 when attached to one another.

Figure 16Y:
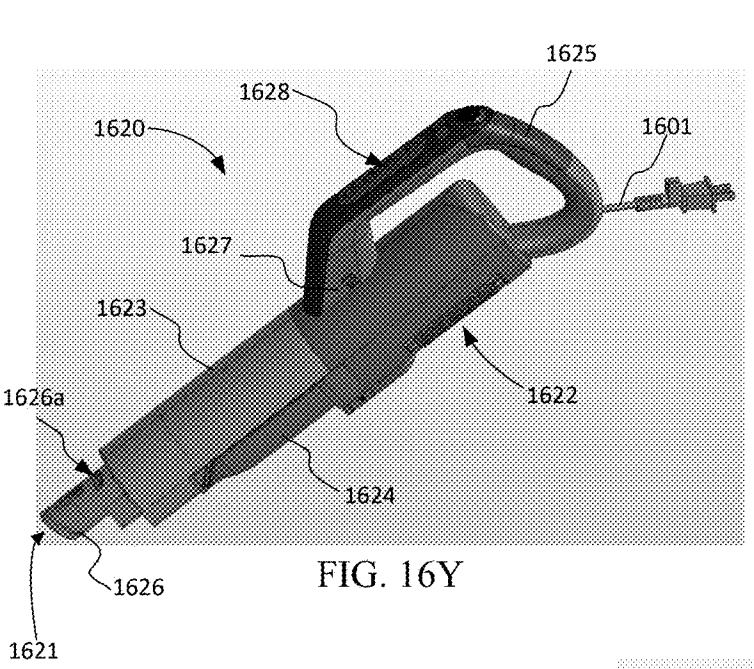
Figure 16A:
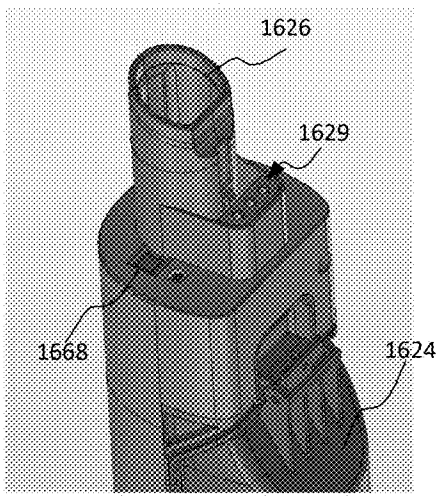
Figure 16B:
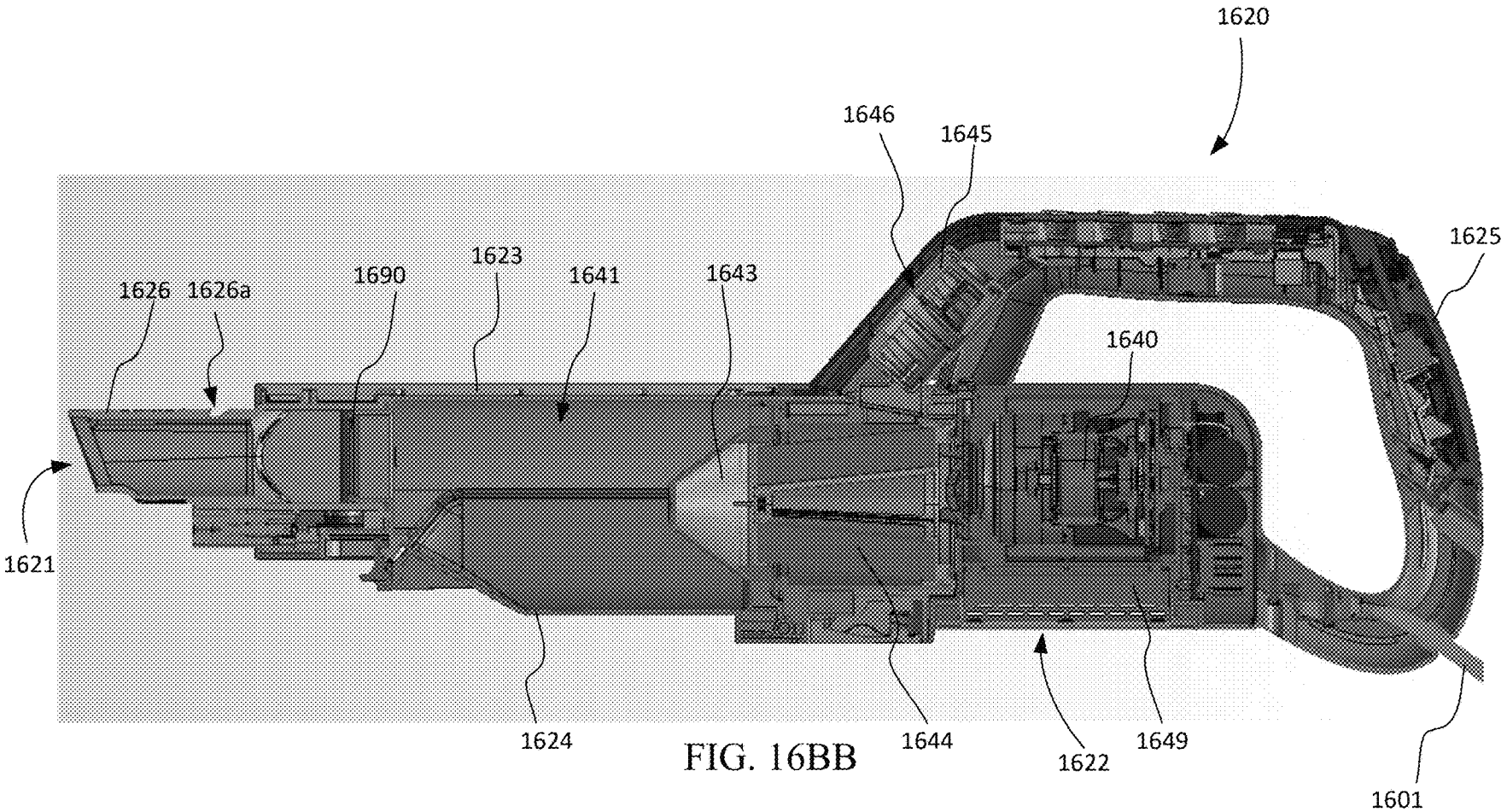
Figure 16D:
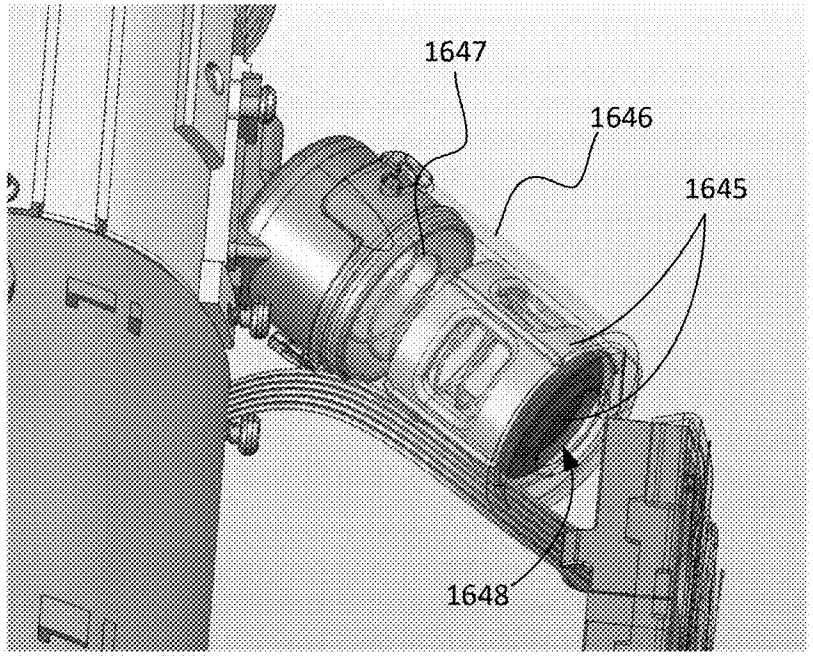
Figure 16C:
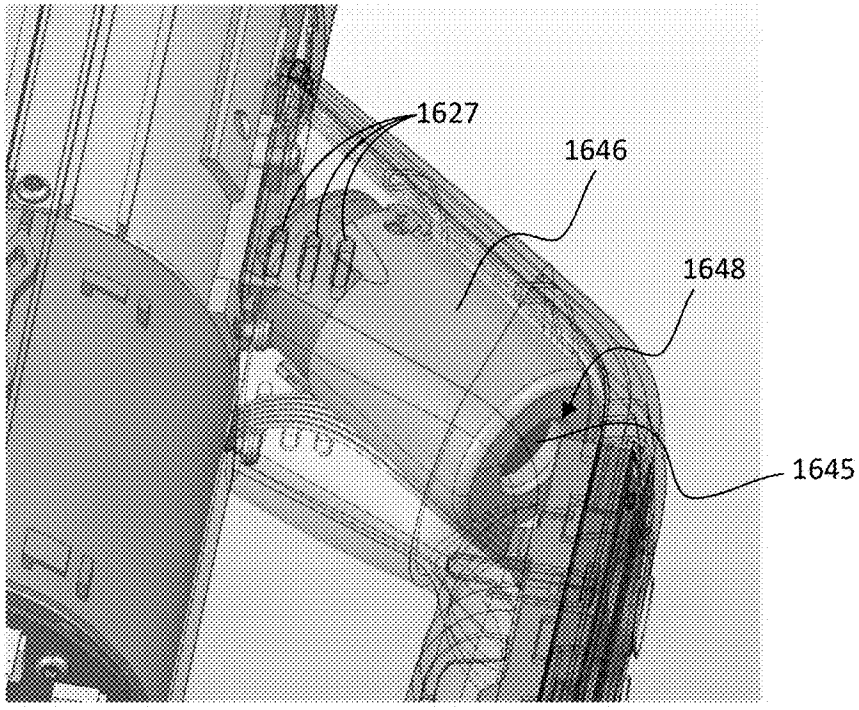
Figure 16F:
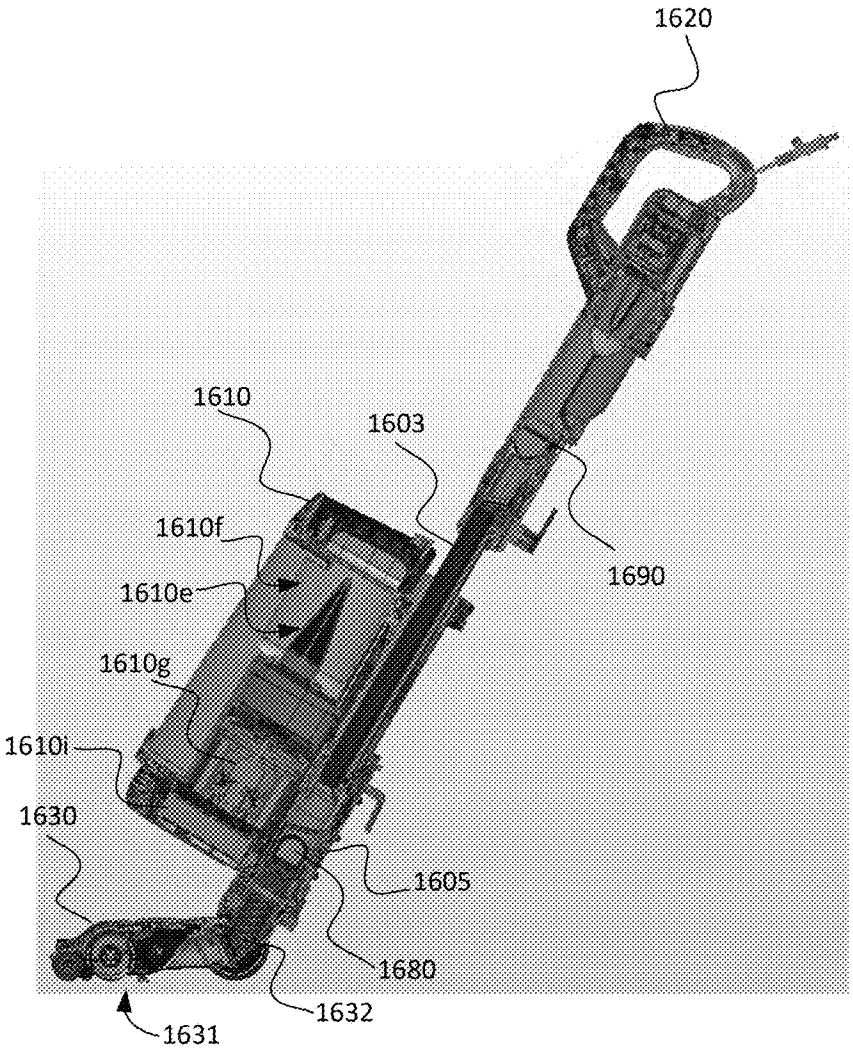
Figure 16E:
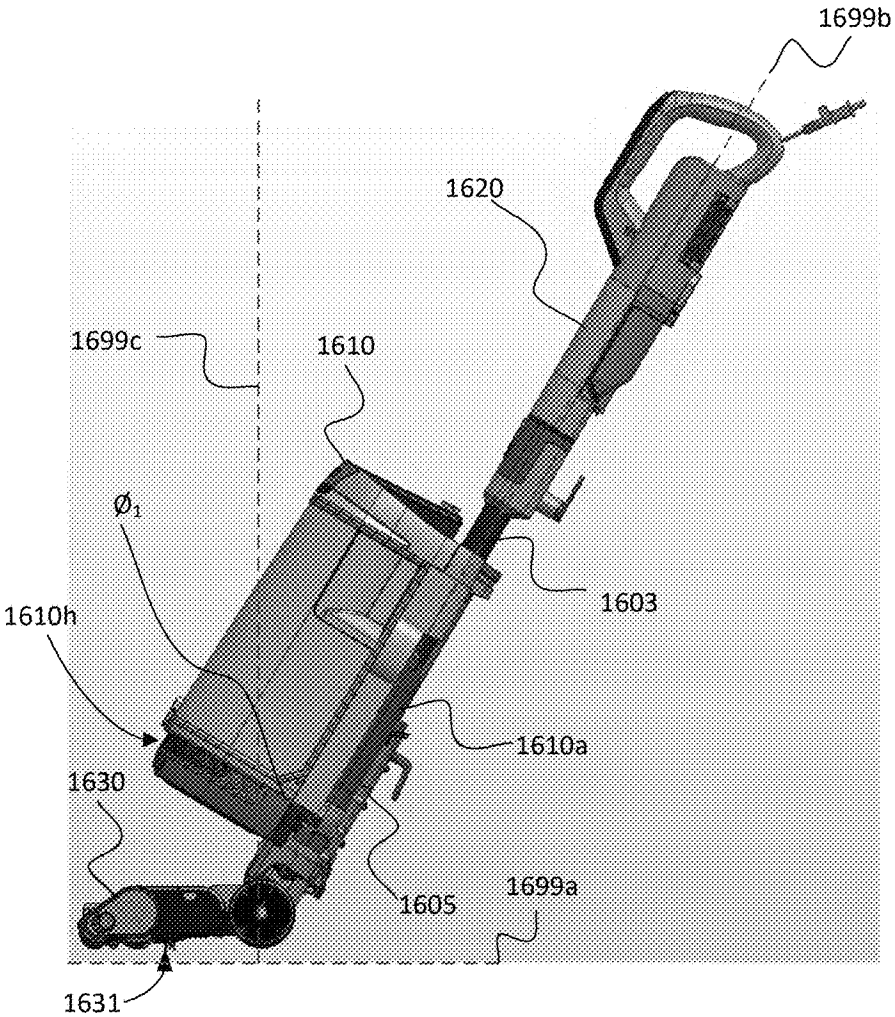
Figure 16H:
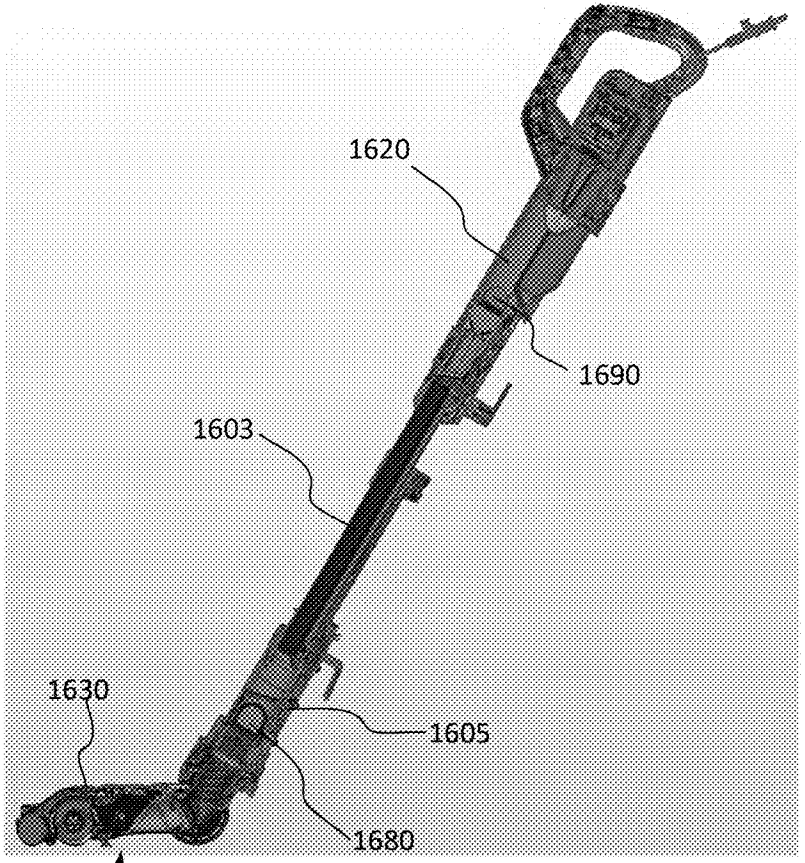
Figure 16G:
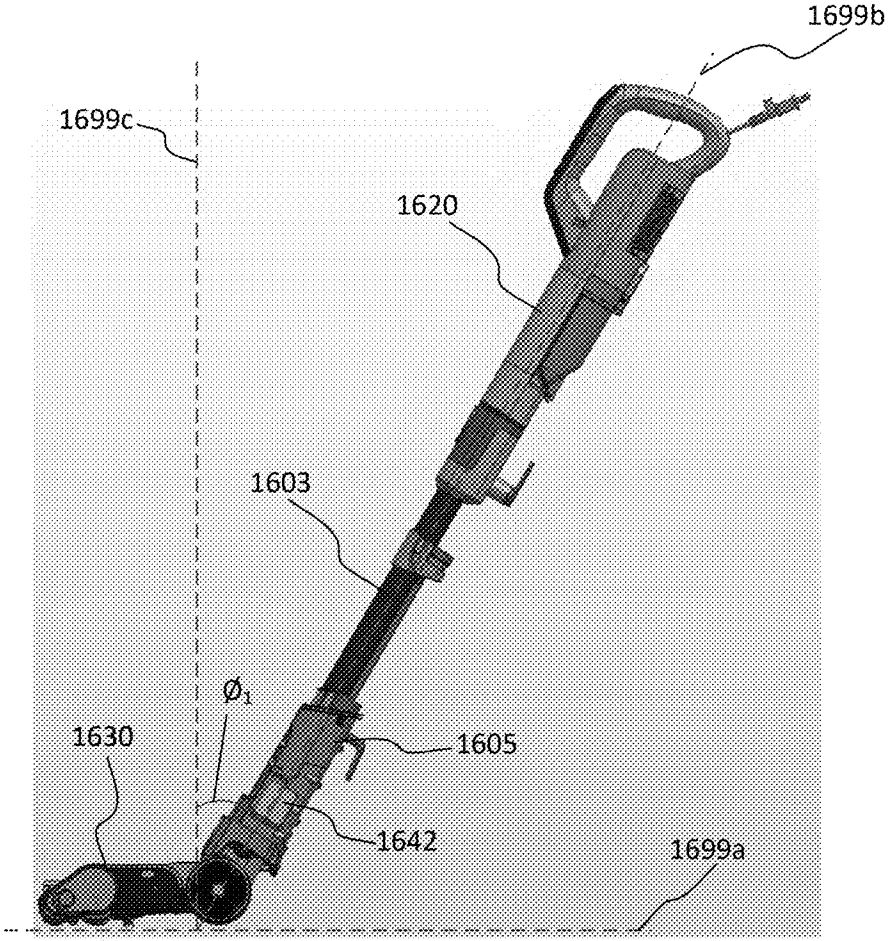
Figure 16J:
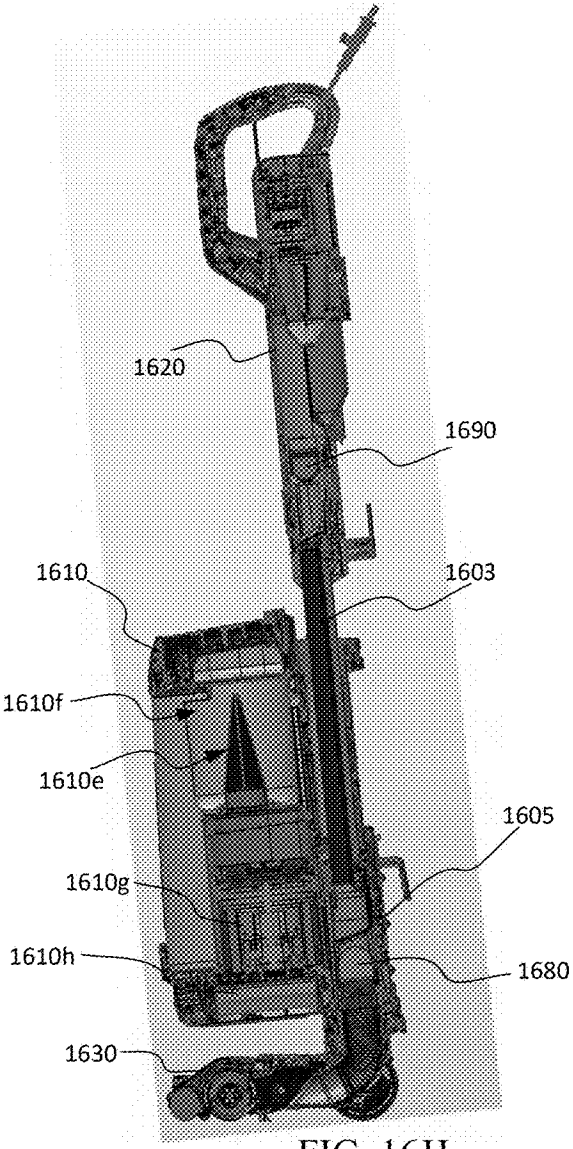
Figure 16I:
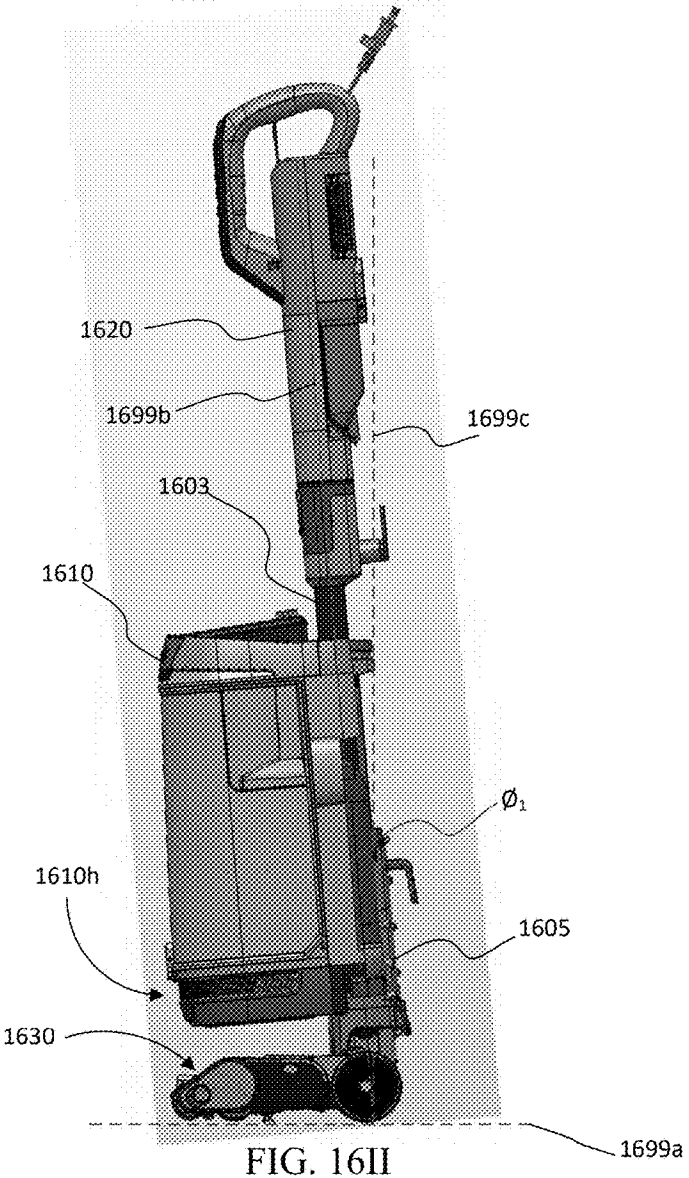
Figure 16K:
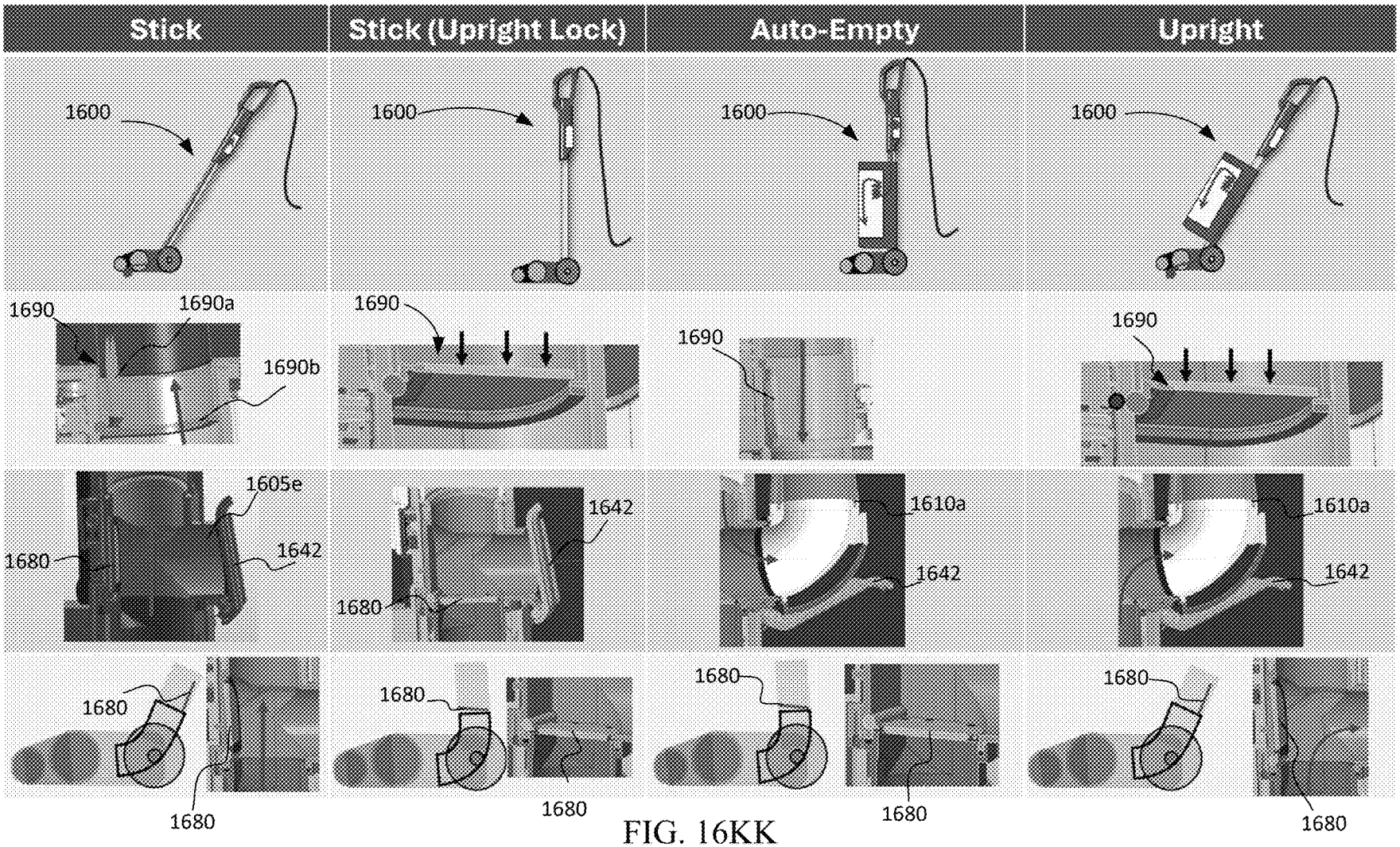
Figure 16M:
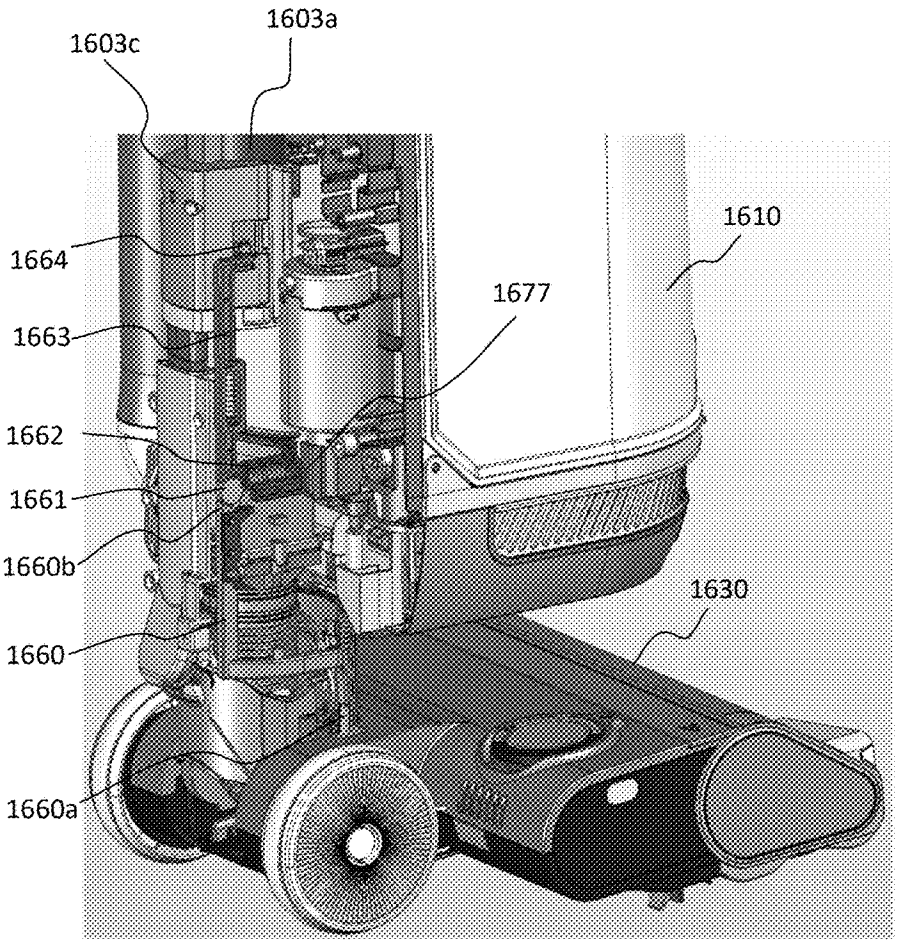
Figure 16L:
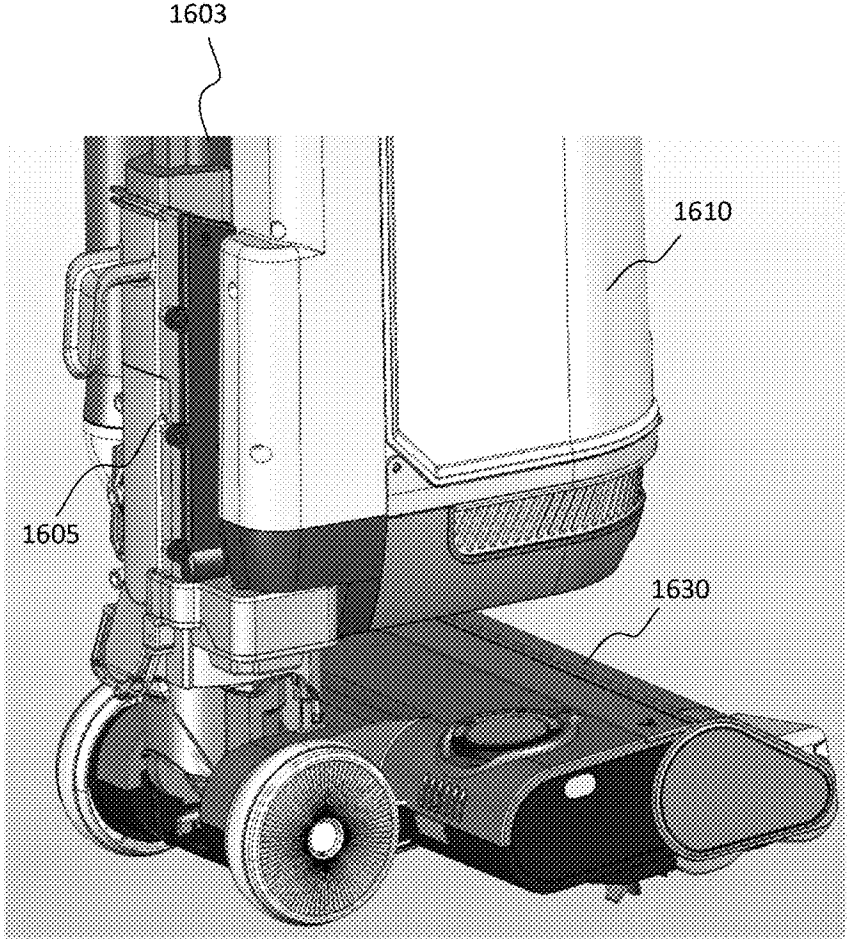
Figure 16O:
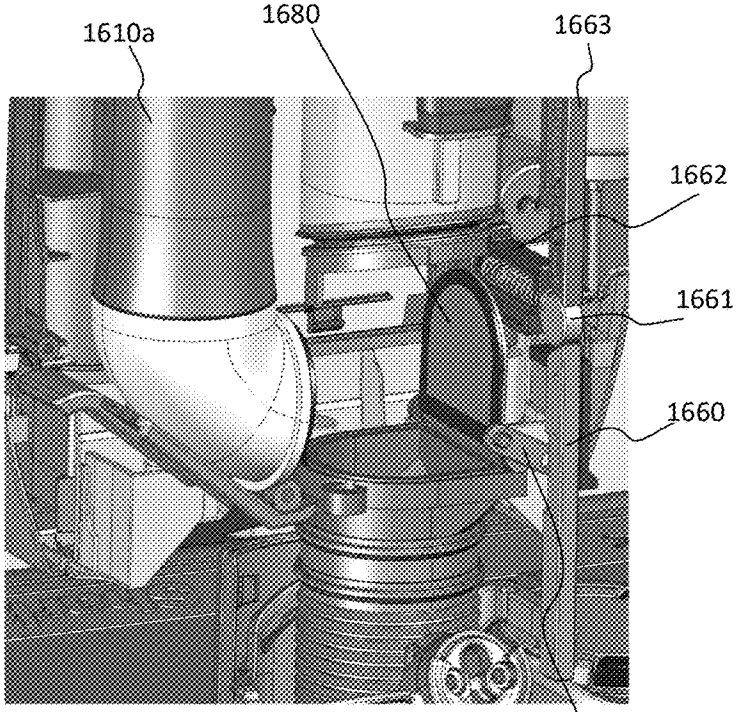
Figure 16N:
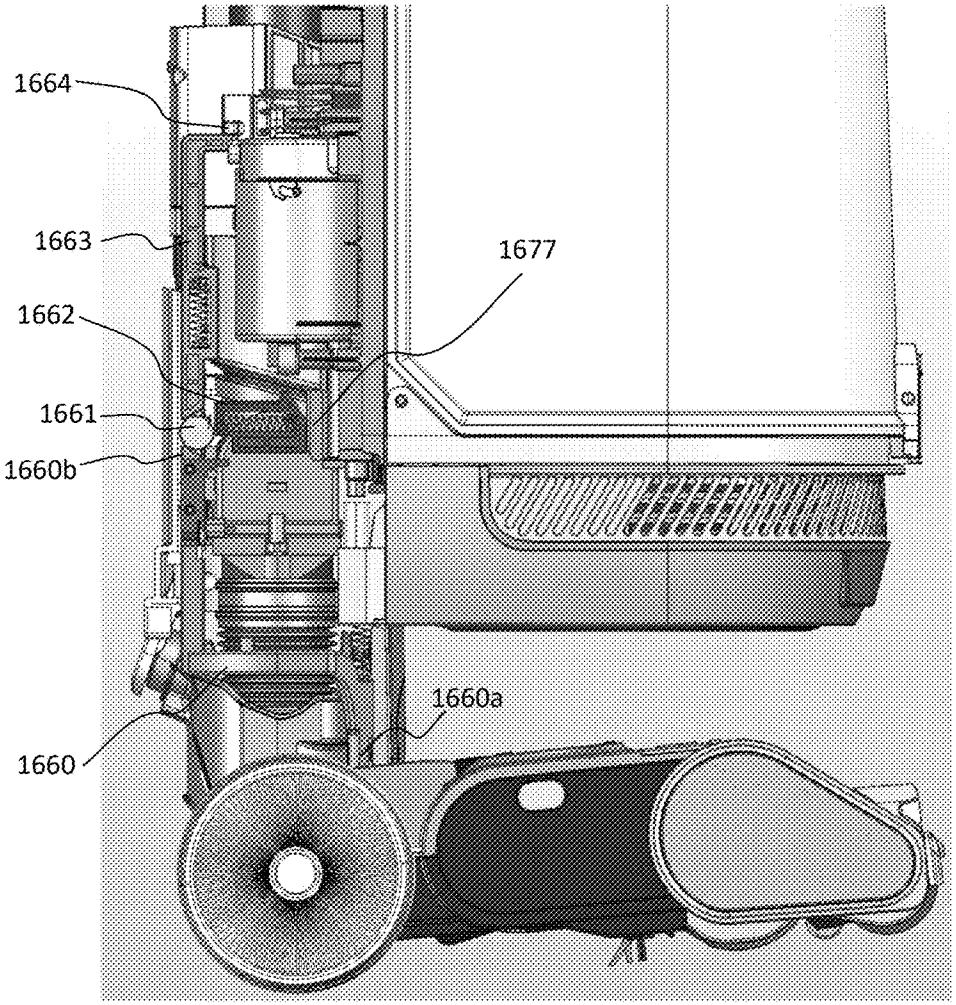
Figure 16R:
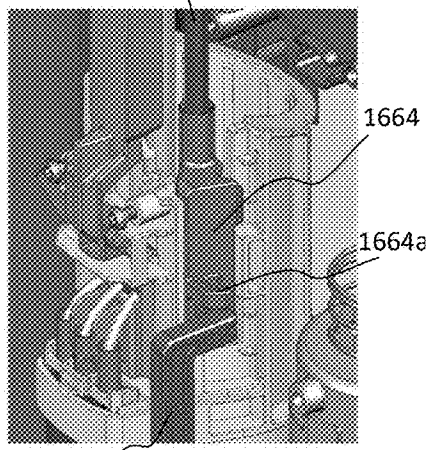
Figure 16Q:
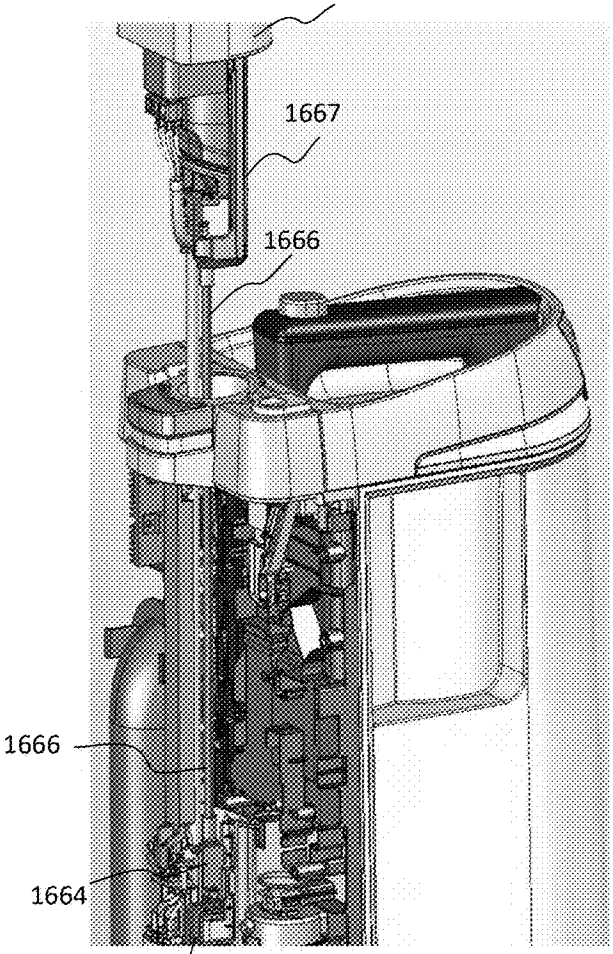
Figure 16P:
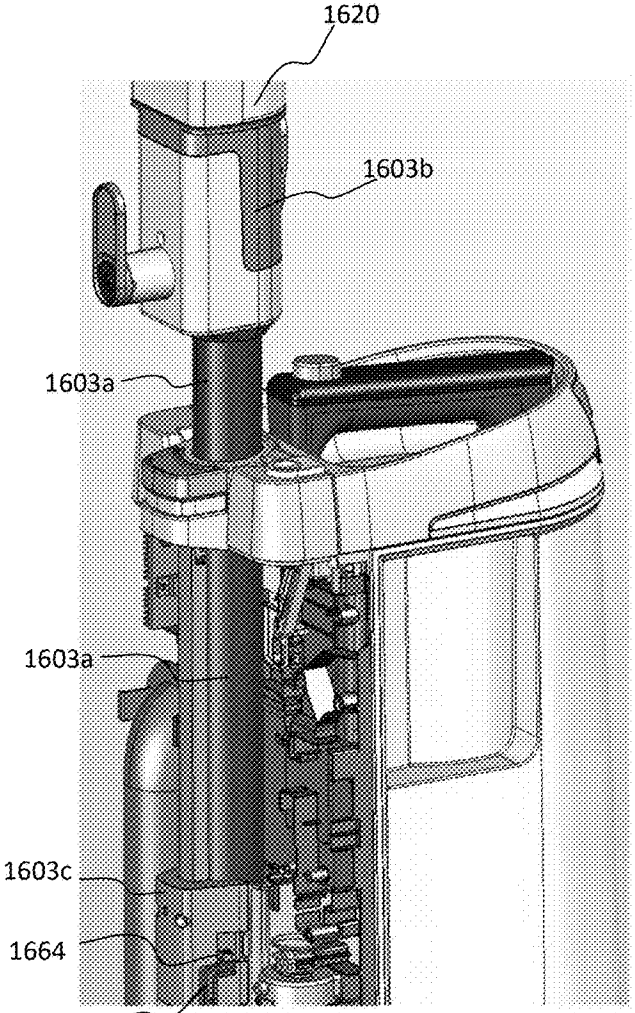
Figure 16T:
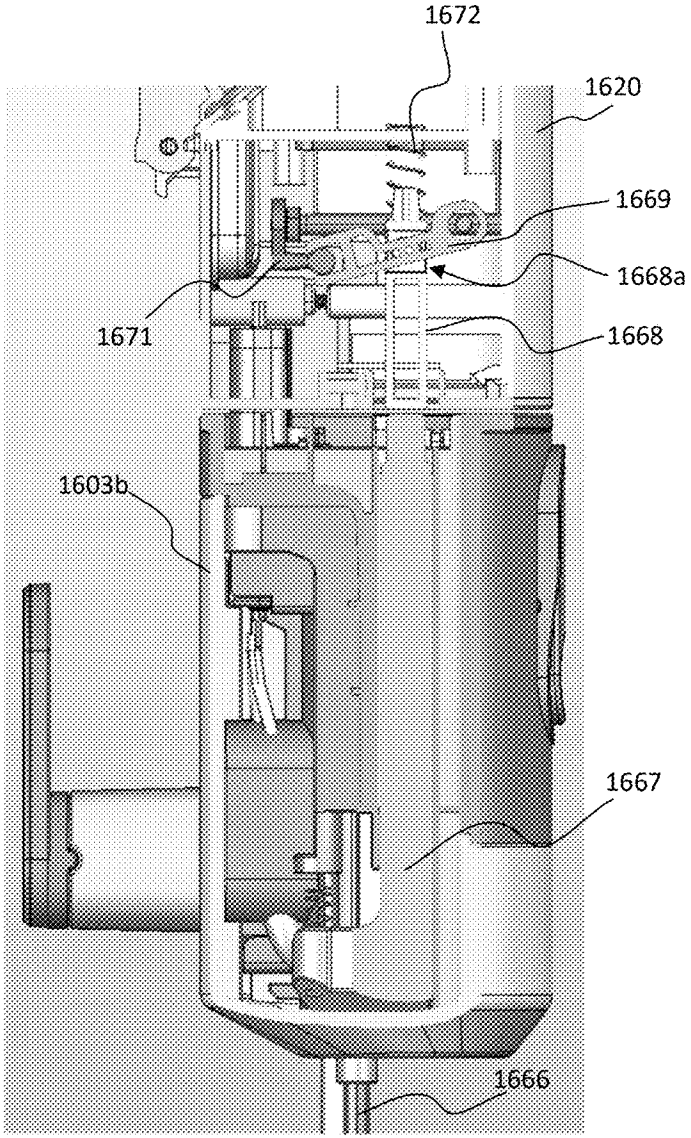
Figure 16S:
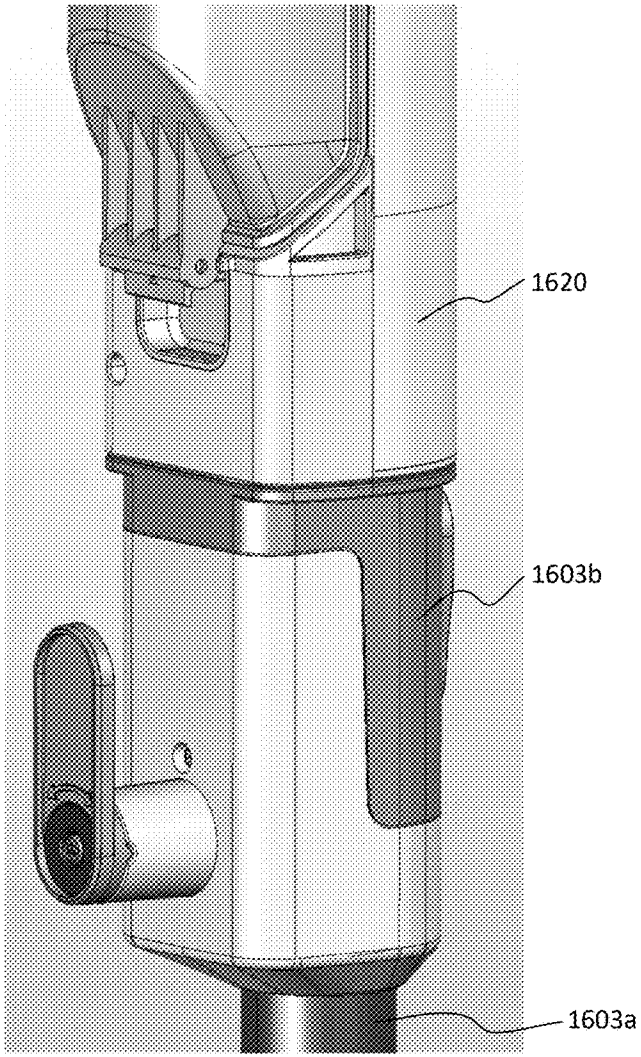
Figure 16V:
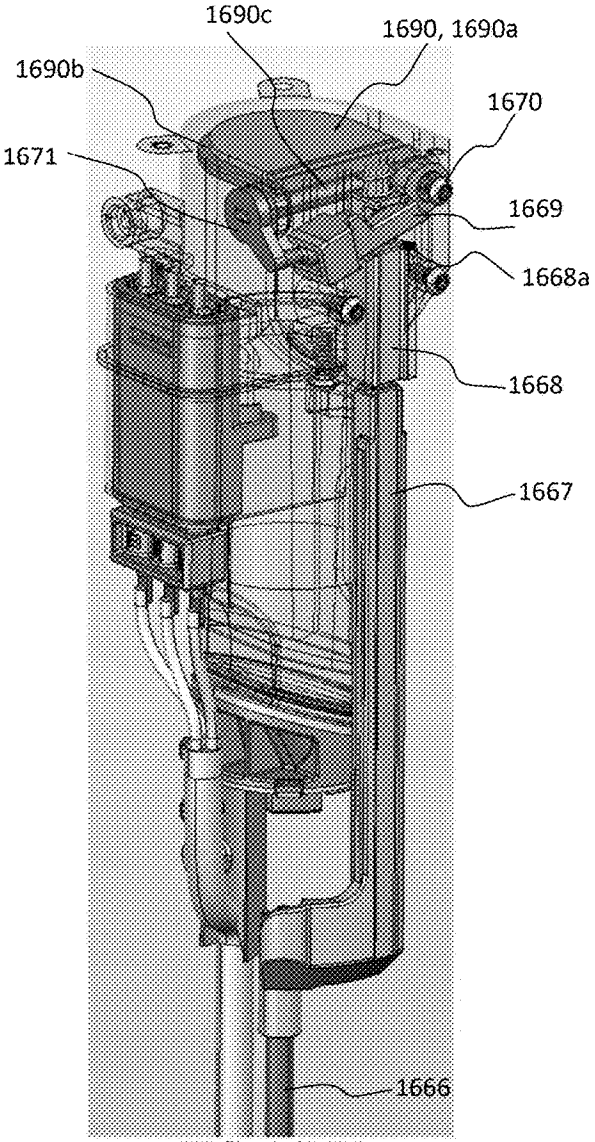
Figure 16U:
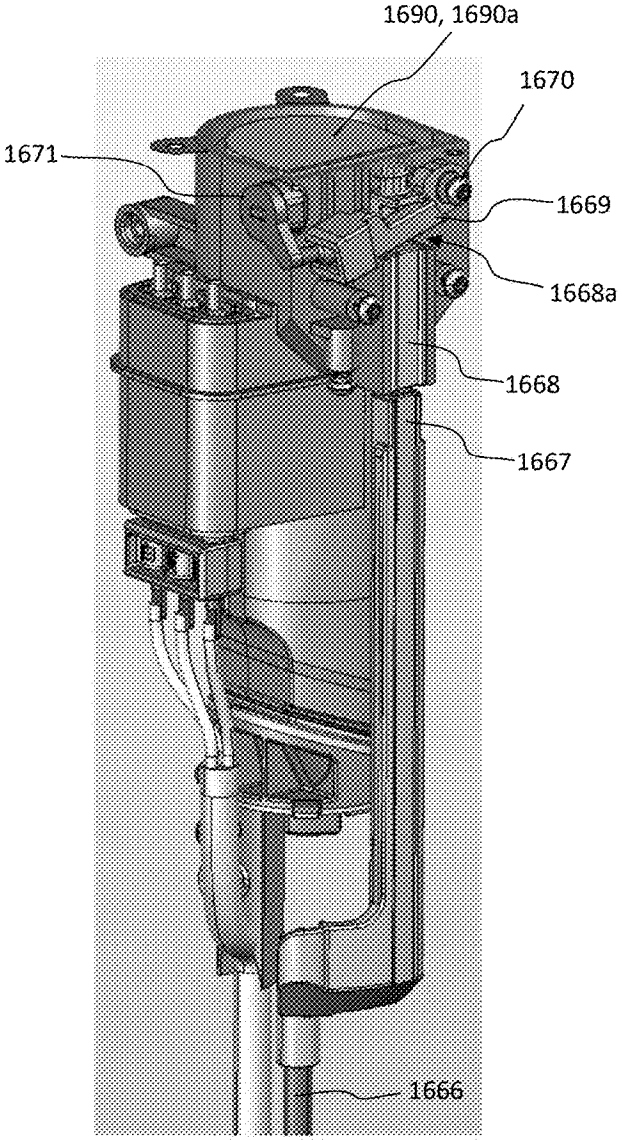
Figure 16X:
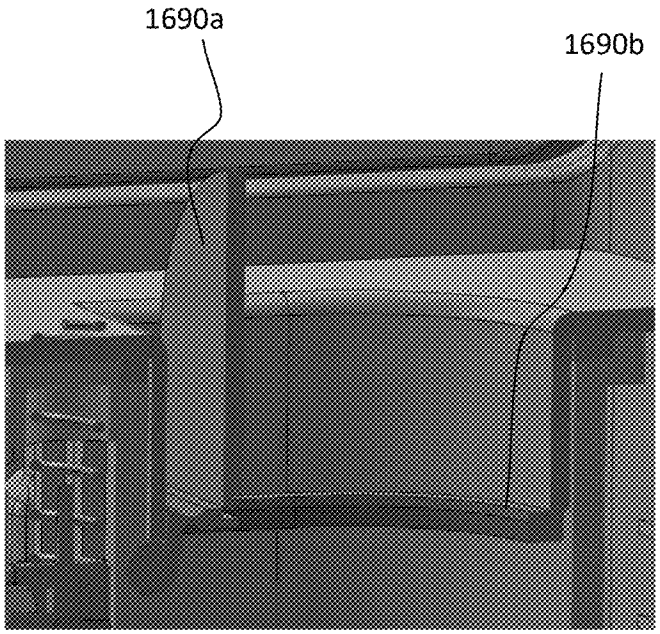
Figure 16W:
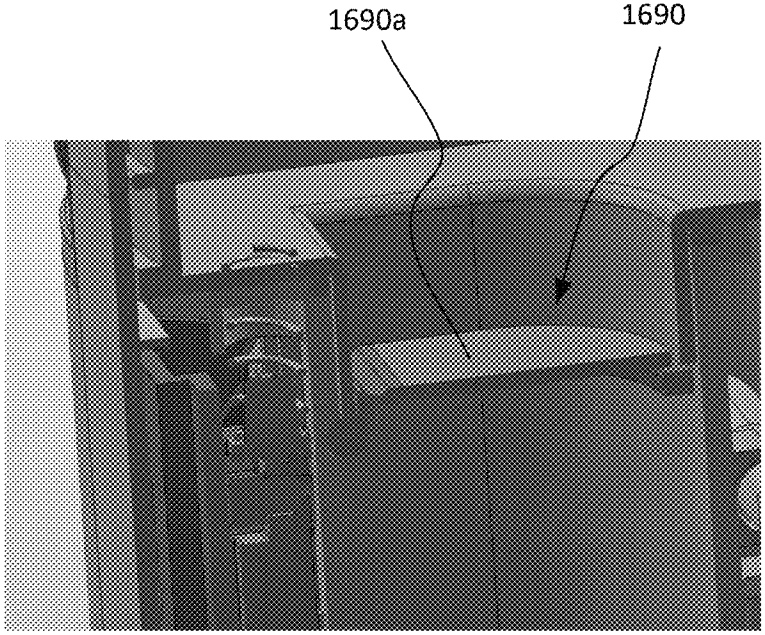

FIGS. 16Y-16AA illustrate perspective views of handheld vacuum cleaner 1620 or portions thereof. FIG. 16BB illustrates a cross-sectional view taken through handheld vacuum cleaner 1620. Handheld vacuum cleaner 1620 can include a dirty air inlet 1621, a snout 1626, a groove 1626*a* (discussed previously), a housing 1623, a debris container door 1624 (which may also be referred to as "debris containing region" or "debris chamber"), a debris container 1641 which may be defined by debris container door 1624 and one or more portions of housing 1623, a handle 1625, a clean air outlet 1622, one or more controls 1628, and a motor 1640 (which may also be referred to as a suction motor). Debris container 1624 may be defined by one or more interior portions of handheld vacuum cleaner 1620 and such interior portion(s) may be at least partially formed by a debris container door

1624. Handheld vacuum cleaner 1620 can include a debris separator for separating debris from air suctioned through handheld vacuum cleaner 1620. With reference to FIG. 16BB, handheld vacuum cleaner 1620 can include a mesh filter 1643 (which may also be referred to as a "fluff screen"), a pre-motor filter 1644 (which may be conical), and/or a post-motor filter 1649 (for example, a HEPA filter). Filter 1643, filter 1644, and/or other components (for example, structural components of handheld vacuum cleaner 1620) may form a debris separator of handheld vacuum cleaner 1220. Filter 1644 can be a radial filter and handheld vacuum cleaner 1620 can be configured such that air flowing through handheld vacuum cleaner 1620 (in any of the modes described herein) flows through a wall of the radial filter and at least partially through an interior of filter 1644. In some implementations, handheld vacuum cleaner 1620 includes a filter support and/or a filter cap similar or identical to filter support 1896, 2296 and filter cap 1897, 2297. As also shown in FIG. 16BB, handheld vacuum cleaner 1620 can include a valve 1690. Valve 1690 can be arranged within an airflow passage of handheld vacuum cleaner 1620 that extends between dirty air inlet 1621 and debris container 1641. Valve 1690 can be configured to be moved between various positions, such as open and closed positions, and can advantageously inhibit debris from falling out of debris container 1641 when in a closed position (for example, a position in which valve 1690 blocks the airflow passage extending between dirty air inlet 1621 and debris container 1641. Valve 1690 can be similar or identical to valve 1490 in some or many respects. For example, valve 1690 can include an inner door 1690*a* and an outer door 1690*b* that can be similar or identical to inner door 1490*a* and outer door 1490*b* (respectively). Debris container 1641 may also be referred to as "debris containing region" or "debris chamber" and may be defined by one or more portions of an interior of handheld vacuum cleaner 1620.

In some cases, during operation of the handheld vacuum cleaner 1620, an airflow path between dirty air inlet 1621 and clean air outlet 1622 may be blocked, for example, by a buildup of debris on filter 1643 (see FIG. 16BB). Handheld vacuum cleaner 1620 can advantageously include a bleed valve 1645 that can be configured to open to allow air to flow through an auxiliary air inlet of handheld vacuum cleaner 1620, into an interior of handheld vacuum cleaner 1620, and out through clean air outlet 1622, when pressure within handheld vacuum cleaner 1220 exceeds a threshold (for example, when the above-described debris buildup occurs). Handheld vacuum cleaner 1620 can include vents 1627 (see FIGS. 16Y-16Z) in a portion of housing 1623 that are in fluid communication with an interior of handheld vacuum cleaner 1620. FIGS. 16CC-16DD illustrate enlarged views of a portion of handle 1625 of handheld vacuum cleaner 1620 with portions of handle 1625 in transparent. As shown handheld vacuum cleaner 1620 can include a chamber 1646 (which may also be referred to as a "bleed valve chamber") and an auxiliary air inlet 1648. Chamber 1646 can be arranged in a portion of handle 1625 and can be in fluid communication with an interior of handheld vacuum cleaner 1620 and an airflow passage of handheld vacuum cleaner 1620 (see FIG. 16BB). Bleed valve 1645 can be arranged within chamber 1646 and configured to be transitioned between a first state in which auxiliary air inlet 1648 is closed to a second state in which auxiliary air inlet 1648 is open. FIGS. 16CC-16DD illustrate such first state. Bleed valve 1645 can be moved from a first position in which a portion of bleed valve 1645 blocks auxiliary air inlet 1648 to a second position in which bleed valve 1645 does not block/close auxiliary air inlet 1648. When bleed valve 1645 is transitioned to such second state/position, auxiliary air inlet 1648 can provide fluid communication between an airflow passage in handheld vacuum cleaner 1620 (for example, an airflow passage in flow communication with dirty air inlet 1621, debris container 1641, and/or clean air outlet 1622) and ambient, via one or more interior portions of handheld vacuum cleaner 1620 and vents 1627 (see FIGS. 16Y-16Z and 16BB-16DD). As shown, bleed valve 1645 can be biased toward such first state and first position by a biasing member, such as spring 1647. In some implementations, bleed valve 1645 is transitioned from such first state/position to the second state/position when pressure within handheld vacuum cleaner 1220 exceeds a threshold (for example, between 0.5 psi and 5 psi, between 0.5 psi and 4.5 psi, between 0.5 psi and 4 psi, between 0.5 psi and 3.5 psi, between 0.5 psi and 3 psi, between 0.5 psi and 2.5 psi, between 0.5 psi and 2 psi, between 0.5 psi and 1.5 psi, between 0.5 psi and 1 psi, between 1 psi and 3 psi, between 2 psi and 3 psi, or between 2 psi and 2.5 psi, or any value or range within or bounded by any of these values or ranges). This can advantageously allow air to flow into handheld vacuum cleaner 1620 through auxiliary air inlet 1648, around/through motor 1640, and out through clean air outlet 1622, thereby reducing or eliminating motor overheating when there is a blockage in airflow through handheld vacuum cleaner 1620. In such scenario, air may flow through bleed valve chamber 1646, through filter 1644, towards/around motor 1640, and out clean air outlet 1622. Bleed valve 1645 can also be configured to move to such second state/position (thereby opening auxiliary air inlet 1648) when cleaning apparatus 1600 is in an empty mode and a suction motor of floor-based vacuum cleaner 1610 causes air to flow from handheld vacuum cleaner 1220 to the floor-based vacuum cleaner 1610 (to "empty" debris from handheld vacuum cleaner 1620 into a debris container of floor-based vacuum cleaner 1610). For example, in the empty mode, bleed valve 1645 can open and allow air to flow into handheld vacuum cleaner 1620 through auxiliary air inlet 1648, past and/or around filter 1644 (for example, an end thereof), through filter 1643, through debris container 1641, and out of handheld vacuum cleaner 1620 via dirty air inlet 1621. In some implementations of such empty mode, air flows into handheld vacuum cleaner 1620 via both auxiliary air inlet 1648 and clean air outlet 1622, and such air flow exits handheld vacuum cleaner 1620 via dirty air inlet 1621. Accordingly, such bleed valve can have a dual purpose. Bleed valve 1645 and spring 1647 can be similar or identical to bleed valve 1845 and spring 1847 described below with respect to handheld vacuum cleaner 1820.

Cleaning apparatus 1600 can be configured to operate in a plurality of modes similar or identical to any of the modes described with respect to any of the other cleaning apparatuses disclosed herein. FIGS. 16EE-16FF illustrate cleaning apparatus 1600 in an example upright mode in which floor-based vacuum cleaner 1610 is utilized to collect debris from a floor surface. FIG. 16FF illustrates a cross-sectional view of that shown in FIG. 16EE. Floor-based vacuum cleaner 1610 can include a debris separator 1610*e* (for example, a cyclone separator), a debris container 1610*f*, a suction motor 1610*g*, a filter 1610*i* (for example, a HEPA filter), and a clean air outlet 1610*h*. In the upright mode illustrated in FIGS. 16EE-16FF, suction motor 1610*g* can cause air to flow in through a dirty air inlet 1631 of cleaning head 1630, support member 1605 (for example, outlet 1605*e*), a dirty air inlet of floor-based vacuum cleaner 1610 (for example, via duct 1610*a*), debris separator 1610*e*, debris container 1610*f*, and through clean air outlet 1610*h*, thereby causing debris to flow into debris container 1610*f*. Cleaning head 1630 can include one or more airflow passages to facilitate flow communication between dirty air inlet 1631 and support member 1605. Cleaning apparatus 1600 can include a flexible and/or corrugated conduit 1632 within a portion of cleaning head 1630 and support member 1605 (see FIG. 16FF). Similar to as described with respect to other cleaning apparatus disclosed herein, cleaning apparatus 1600 can include a valve 1680 in a portion of support member 1605 that can be opened and closed to allow or inhibit flow communication between dirty air inlet 1631 and other portions of cleaning apparatus 1600. Valve 1680 can be similar or identical to valve 1480 described above in some or many respects. Valve 1680 is open in the upright mode illustrated in FIGS. 16EE-16FF, thereby allowing flow communication between dirty air inlet 1631 and support member 1605 and floor-based vacuum cleaner 1610. Similar to as described with respect to other cleaning apparatus disclosed herein, cleaning apparatus 1600 can include a valve 1690 in a portion of handheld vacuum cleaner 1620 that can be opened and closed to allow or inhibit flow communication between handheld vacuum cleaner 1620 and other portions of cleaning apparatus 1600. As mentioned previously, such valve 1690 can advantageously inhibit debris from falling out of debris container 1641 of handheld vacuum cleaner 1620, for example, into wand 1603 when handheld vacuum cleaner 1620 is attached thereto and also from falling out of handheld vacuum cleaner 1620 when used independently from wand 1603 and/or other portions of cleaning apparatus 1600. Valve 1690 can be closed when cleaning apparatus 1600 is in the upright mode illustrated in FIGS. 16EE-16FF.

FIGS. 16GG-16HH illustrate an example stick mode of cleaning apparatus 1600, with FIG. 16HH illustrating a cross-sectional view of that shown in FIG. 16GG. As shown, floor-based vacuum cleaner 1610 is detached and handheld vacuum cleaner 1620 is utilized to collect debris from the floor surface. As shown, both of valves 1680, 1690 are open in such mode, thereby allowing flow communication between dirty air inlet 1631 handheld vacuum cleaner 1620, via support member 1605 and wand 1603. Suction motor 1640 of handheld vacuum cleaner 1620 can be operated in such mode to cause air to flow in through dirty air inlet 1631, support member 1605, wand 1603, a debris separator of handheld vacuum cleaner 1620 (for example, filters 1643, 1644, 1649), debris container 1641, and through clean air outlet 1622, thereby causing debris to flow into debris container 1641.

FIGS. 16II-16JJ illustrate an example empty mode of cleaning apparatus 1600 (which also may be referred to as an "auto-empty mode"), with FIG. 16JJ illustrating a cross-sectional view of that shown in FIG. 16II. In such mode, debris from handheld vacuum cleaner 1620 are transferred ("emptied") into floor-based vacuum cleaner 1610. Valve 1690 can be opened in such mode to facilitate flow communication between handheld vacuum cleaner 1620 and floor-based vacuum cleaner 1610. In such mode, suction motor 1610*g* of floor-based vacuum cleaner 1610 can cause air to flow from handheld vacuum cleaner 1610 to and through floor-based vacuum cleaner 1610, for example, via wand 1603 and at least a portion of support member 1605 (for example, through outlet 1605*e* of support member 1605 (see FIG. 16L). In some implementations, bleed valve 1645 of handheld vacuum cleaner 1620 (discussed previously) is opened when cleaning apparatus 1600 is in the auto-empty mode (for example, opened via suction induced by suction motor 1610*g*) and air flows through auxiliary air inlet 1648 (for example, from vents 1627), through handheld vacuum cleaner 1620, dirty air inlet 1621, wand 1603, support member 1605, and to and through floor-based vacuum cleaner 1610. In some implementations, air flows into and through clean air outlet 1622 and through handheld vacuum cleaner 1620 when cleaning apparatus 1600 is in the auto-empty mode. In some implementations, valve 1680 is closed in the auto-empty mode as illustrated in the figures, which can prevent floor-based vacuum cleaner 1610 from suctioning air/debris from dirty air inlet 1631 of cleaning head 1630 and can increase suction efficiency/power of suction motor 1610*g* (so as to better collect debris from handheld vacuum cleaner 1620).

FIGS. 16EE, 16GG, and 16II illustrate a plane 1699*a* extending along a bottom portion of cleaning head and/or a surface upon which cleaning apparatus 1600 rests, an axis 1699*b* extending through wand 1603 and/or support member 1605, an axis 1699*c* that is perpendicular to plane 1699*a*, and an angle $\theta_1$ between axes 1699*b*, 1699*c*. In some implementations, valve 1680 is in a closed position when angle $\theta_1$ is less than 30 degrees, for example, less than 25 degrees, less than 20 degrees, less than 15 degrees, less than 10 degrees, less than 5 degrees, between 0 and 30 degrees, between 0 and 25 degrees, between 0 and 20 degrees, between 0 and 15 degrees, between 0 and 10 degrees, or between 0 and 5 degrees, or any value or range within or bounded by any of these values or ranges. In some implementations, valve 1680 is automatically closed when wand 1603 and/or support member 1605 are moved (for example, rotated relative to cleaning head 1630) to a position in which angle $\theta_1$ is less than 30 degrees (for example, less than 25 degrees, less than 20 degrees, less than 15 degrees, less than 10 degrees, or less than 5 degrees). Such implementations can thereby cause valve 1680 to be closed when cleaning apparatus 1600 is in the auto-empty mode discussed above (FIGS. 16II-16JJ). In some implementations, valve 1680 is in an open position when angle $\theta_1$ is greater than 5 degrees for example, greater than 10 degrees, greater than 15 degrees, greater than 20 degrees, greater than 25 degrees, or greater than 30 degrees, between 5 degrees and 90 degrees, between 10 degrees and 90 degrees, between 15 degrees and 90 degrees, between 20 degrees and 90 degrees, between 25 degrees and 90 degrees, between 30 degrees and 90 degrees, or any value or range within or bounded by any of these values or ranges. In some implementations, valve 1680 is automatically opened when wand 1603 and/or support member 1605 are moved (for example, rotated relative to cleaning head 1630) to a position in which angle $\theta_1$ is greater than 5 degrees (for example, greater than 10 degrees, greater than 15 degrees, greater than 20 degrees, greater than 25 degrees, or greater than 30 degrees). Such implementations can thereby cause valve 1680 to be open when cleaning apparatus 1600 is in the stick and/or upright modes (FIGS. 16EE, 16GG).

In some implementations, valve 1690 is in an open position when floor-based vacuum cleaner 1610 is attached and angle $\theta_1$ is less than 30 degrees, for example, less than 25 degrees, less than 20 degrees, less than 15 degrees, less than 10 degrees, less than 5 degrees, between 0 and 30 degrees, between 0 and 25 degrees, between 0 and 20 degrees, between 0 and 15 degrees, between 0 and 10 degrees, or between 0 and 5 degrees, or any value or range within or bounded by any of these values or ranges. In some implementations, valve 1690 is automatically opened when floor-based vacuum cleaner 1610 is attached and wand 1603 and/or support member 1605 are moved (for example, rotated relative to cleaning head 1630) to a position in which angle $\theta_1$ is less than 30 degrees (for example, less than 25 degrees, less than 20 degrees, less than 15 degrees, less than 10 degrees, or less than 5 degrees). Such implementations can thereby cause valve 1690 to be open when cleaning apparatus 1600 is in the auto-empty mode discussed above (FIGS. 16II-16JJ).

FIG. 16KK includes a table illustrating various portions of cleaning apparatus 1600 and simplified, schematic representations thereof in various the stick mode, auto-empty mode, upright mode, and another mode ("stick (upright lock)"). As shown, when cleaning apparatus 1600 is in the stick mode: valve 1690 (for example, an inner door 1690*a* thereof) is open; valve 1680 is open; and lid 1642 is closed. When cleaning apparatus 1600 is in the auto-empty mode: valve 1690 is open; floor-based vacuum cleaner 1610 is attached, thereby opening lid 1642; and valve 1680 is closed. When cleaning apparatus 1600 is in the upright mode, valve 1690 is closed; floor-based vacuum cleaner 1610 is attached, thereby opening lid 1642; and valve 1680 is open. When cleaning apparatus is in the "stick (upright lock)" mode: valve 1690 is closed; lid 1642 is closed; and valve 1680 is closed.

FIGS. 16LL-16VV illustrate various aspects and mechanisms of cleaning apparatus 1600 for controlling operation of valves 1680, 1690, for example, for opening and/or closing valves 1680, 1690 in accordance with certain modes of operation. Such examples are not intended to limit the scope of the disclosure. Various other actuators and/or actuator mechanisms may be utilized within cleaning apparatus 1600 in order to cause movement of valves 1680, 1690. Each of cleaning head 1630, support member 1605, wand 1603, and/or handheld vacuum cleaner 1620 can include one or more (for example, a plurality) of actuators that can interact with one another (and/or floor-based vacuum cleaner 1610 or portions thereof) to cause valve 1680 and/or valve 1690 to open and/or close to facilitate any of the modes of operation described herein.

FIG. 16LL illustrates an enlarged view of a portion of cleaning apparatus 1600, illustrating a portion of floor-based vacuum cleaner 1610, a portion of wand 1603, support member 1605, and cleaning head 1630. FIG. 16MM shows a similar view as shown in FIG. 16LL with certain portions removed. FIG. 16NN illustrates a side view of that which is shown in FIG. 16MM. With reference to FIG. 16MM, cleaning apparatus 1600 can include actuators 1660, 1661, 1662, 1663, and 1664. Actuator 1660 can be coupled with and/or inside a portion of support member 1605. Actuator 1660 can include a first end or portion 1660*a* and a second end or portion 1660*b*. Actuator 1660 (for example, portion 1660*a*) can be configured to contact a portion of cleaning head 1630, for example, when cleaning apparatus 1600 is in the auto-empty mode (for example, when wand 1603 and/or support member 1605 are oriented generally perpendicular relative to a floor surface or within 20 degrees from perpendicular). Contact between actuator 1660 and cleaning head 1630 can cause actuator 1660 to move up, thereby causing portion 1660*b* to contact and move (for example, push upward) actuator 1661. FIG. 1600 illustrates support member 1605 with various portions removed so as to show valve 1680. Movement of actuator 1660 as described above can cause valve 1680 to move from an open position to a closed position. For example, actuator 1660 can be coupled with actuator 1665 (which also may be referred to as "link"), and movement (for example, upward movement of actuator 1660) can cause actuator 1665 to move and cause valve 1680 to pivot from the position illustrated in FIG. 1600 (an "open" position) to a closed position which blocks flow communication with cleaning head 1630. Actuator 1661 (which can have a disc shape) can be pushed laterally (for example, between actuators 1660, 1663) by actuator 1662 which itself may be pushed by a portion 1677 of floor-based vacuum cleaner 1610 when floor-based vacuum cleaner 1610 is attached to support member 1605 (see FIG. 16MM-16NN). This in turn can cause actuator 1663 to be moved (for example, upward). Movement (for example, upward movement) of actuator 1663 can cause movement (for example, upward movement) of actuator 1664.

FIG. 16PP-16QQ illustrate portions of floor-based vacuum cleaner 1610 and support member 1605 with portions removed, while also illustrating wand 1603 and a bottom portion of handheld vacuum cleaner 1620. Wand 1603 can include actuator 1664, for example, in adapter 1603*c*. Actuator 1664 can include a leg 1664*a* (see FIGS. 16PP-16RR) that extends through an opening in adapter 1603*c* so that leg 1664*a* is accessible for engagement with actuator 1663 (when wand 1603 is attached to support member 1605). With reference to FIGS. 16QQ-16RR, wand 1603 can include an actuator rod 1666 connected to actuator 1664. Actuator rod 1666 can be arranged within wand conduit 1603*a*. FIG. 16PP illustrate wand conduit 1603*a* while FIGS. 16QQ-16RR do not show wand conduit 1603*a*, so as to better illustrate actuator rod 1666. Movement of actuator 1664 and/or leg 1664*a* (for example, upward movement) can cause actuator rod 1666 to move (for example, upward). FIG. 16QQ illustrates another actuator 1667 which can be arranged at least partially within adapter 1603*b* of wand 1603. Adapter 1603*b* is not shown in FIG. 16QQ (in contrast to FIG. 16PP) to better illustrate actuator 1667. Movement of actuator rod 1666 (for example, upward) can cause actuator 1667 to also move (for example, upward).

FIG. 16SS illustrates portions of handheld vacuum cleaner 1620 and wand 1603. FIG. 16TT illustrates a partial cross-sectional view of that which is shown in FIG. 16SS, illustrating actuator 1667. FIGS. 16UU-16VV illustrate handheld vacuum cleaner 1620 and adapter 1603*b* of wand 1603 with various portions removed to illustrate actuators 1666, 1667, 1668, 1669 of cleaning apparatus 1600. FIGS. 16UU-16VV also illustrate actuator 1668 arranged within a portion of handheld vacuum cleaner 1620. Movement of actuator 1667 (for example, upward) can cause actuator 1668 to move (for example, upward). Actuator 1668 can be coupled with actuator 1669, for example, via a slot 1668*a* formed in actuator 1668 that can receive a portion of actuator 1669. Movement of actuator 1668 can cause actuator 1669 to pivot about a pin 1670. In some implementations, actuator 1668 is biased downward by a spring 1672. Contact and movement induced by actuator 1667 can overcome the bias of spring 1672 and cause actuator 1668 to move (for example, upward). Movement (for example, pivotable movement) of actuator 1669 can cause movement (for example, pivotable movement) of actuator 1671. Actuator 1671 can be pivotably mounted to a portion of handheld vacuum cleaner 1620 proximate valve 1690. Pivotable movement of actuator 1671 can cause valve 1690 (for example, inner and outer doors 1690*a*, 1690*b* thereof) to open, for example, by pivoting downward. Valve 1690 can include a pivot or rod member 1690*c* that is coupled with actuator 1671 and with outer and/or inner doors 1690*a*, 1690*b*.

Accordingly, valve 1690 can be opened (for example, automatically opened) by the above-described interaction between actuators 1660-1669, 1671 when floor-based vacuum cleaner 1610 is attached and wand 1603 and support member 1605 are oriented as described above. Such interaction can cause valve 1680 to be closed and valve 1690 to be opened, thereby facilitating the auto-empty mode of operation in which floor-based vacuum cleaner 1610 is in flow communication with handheld vacuum cleaner 1620 and debris from handheld vacuum cleaner 1620 can be transferred to floor-based vacuum cleaner 1610.

FIG. 16WW-16XX illustrate cross-sectional views through a portion of handheld vacuum cleaner 1620, showing valve 1690. As mentioned previously, valve 1690 can include an inner door 1690*a* and an outer door 1690*b*. FIG. 16WW illustrates valve 1690 in a closed position. Valve 1690 can be in such closed position when cleaning apparatus 1600 is in the "stick (upright lock)" mode and a suction motor of handheld vacuum cleaner 1620 is off and when cleaning apparatus 1600 is in an upright mode in which floor-based vacuum cleaner 1610 is utilized. FIG. 16XX illustrates valve 1690 in an open position in which inner door 1690*a* is opened (for example, when cleaning apparatus 1600 is in the above-described stick mode). As shown, outer door 1690*b* can extend across the airflow passageway in the position of FIG. 16XX but does not block such airflow passageway since outer door 1690*b* has an opening therethrough. Outer door 1690*b* can be biased to the position shown in FIGS. 16WW-16XX which supports inner door 1690*a* when the suction motor of handheld vacuum cleaner 1620 is off and thereby prevents debris from a debris container of handheld vacuum cleaner 1620 from falling out. However, since outer door 1690*b* includes an opening therethrough, when the suction motor of handheld vacuum cleaner 1620 is turned on, inner door 1690*a* can be pivoted upward (via suction induced by the suction motor) to allow air and debris to travel through the opening in the outer door 1690*b* to be collected by handheld vacuum cleaner 1620. Inner and outer doors 1690*a*, 1690*b* can be automatically opened via interaction between actuators 1660-1669, 1671 when floor-based vacuum cleaner 1610 is attached and wand 1603 and support member 1605 are oriented as described above.

Although valves 1680, 1690 have been described above as being movable (for example, between open and closed positions) via mechanical actuators and mechanisms, in some variants, any or all of valves 1680, 1690 can be additionally or alternatively controlled by electronic means. For example, cleaning apparatus 1600 can be configured to allow for electronic control of valves 1680, 1690 via controls of handheld vacuum cleaner 1620 that may be utilized by a user. For example, a user may open and/or close valves 1680, 1690 by pressing a button or a portion of a user interface on handheld vacuum cleaner 1620. Such electronic controls can be in communication with and configured to cause any of the actuators described herein to move to open and/or close valves 1680, 1690, for example, regardless of the orientation (e.g., inclination) of wand 1603 and/or support member 1605 relative to cleaning head 1630 (or a surface on which cleaning head 1630 rests). Cleaning apparatus 1600 can include one or more motors to facilitate electro-mechanical operation of valves 1680, 1690 in such manner, for example, one or more motors in handheld vacuum cleaner 1620, one or more motors in wand 1603, and/or one or more motors in support member 1605. Such motor(s) can be coupled with any of the mechanical actuators and mechanisms described herein to facilitate such operation.

Cleaning head 1630, support member 1605, wand 1603, handheld vacuum cleaner 1620, and floor-based vacuum cleaner 1610 can be electrically connectable to one another via one or more electrical connectors to facilitate electrical communication and/or power. For example, in some implementations in which cleaning apparatus 1600 includes a power cord 1601 connected to handheld vacuum cleaner 1620, electrical power can be provided from handheld vacuum cleaner 1620 to floor-based vacuum cleaner 1610 and/or cleaning head 1630 (for example, via wand 1603 and/or support member 1605) to allow control of any electrical components of floor-based vacuum cleaner 1610 and/or cleaning head 1630 (such as a suction motor of floor-based vacuum cleaner 1610). In some variants, cleaning apparatus 1600 does not include a cord 1601, and, in such variants, any of handheld vacuum cleaner 1620, floor-based vacuum cleaner 1610, and/or cleaning head 1630 include a battery. Handheld vacuum cleaner 1620 can include a controller and/or input device (similar or identical to controller 327, input device 328) which can allow control of handheld vacuum cleaner 1620 (for example, a suction motor thereof), floor-based vacuum cleaner 1610 (for example, a suction motor thereof), and/or cleaning head 1630 (for example, a motor and/or agitator thereof). Such implementations can allow suction motors of handheld vacuum cleaner 1620 and floor-based vacuum cleaner 1610 to be operated (for example, turned "on" or "off") to facilitate any of the various operational modes described herein. In some implementations, handheld vacuum cleaner 1620 includes a battery and is removably connectable to cord 1601 so as to allow cleaning apparatus 1600 to be operated with cord 1601 connected and/or disconnected. In the disconnected state of such implementation, cleaning apparatus 1600 (or any portion thereof) may derive electrical power from such battery in handheld vacuum cleaner 1620 and/or a battery in floor-based vacuum cleaner 1610. Any of such batteries may be charged via cord 1601. Such implementations can advantageously allow for convenient operation of cleaning apparatus 1600 without cord 1601 attached.

Figure 17B:
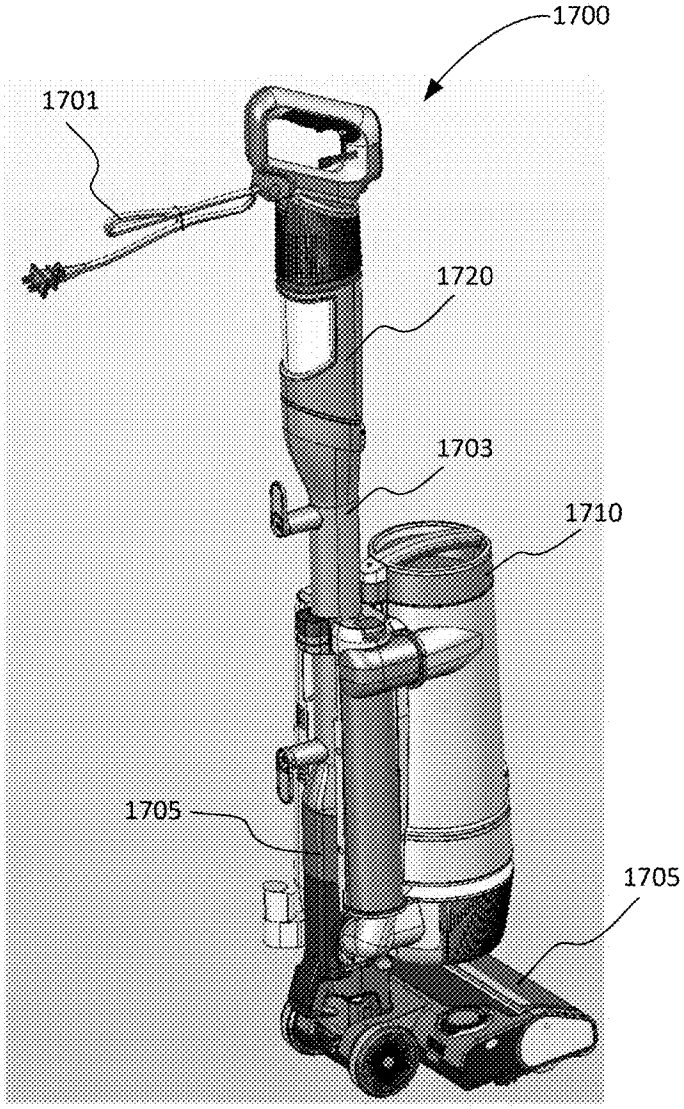
FIGS. 17A-17C illustrate perspective views of another implementation of a cleaning apparatus in accordance with aspects of this disclosure.
Figure 17A:
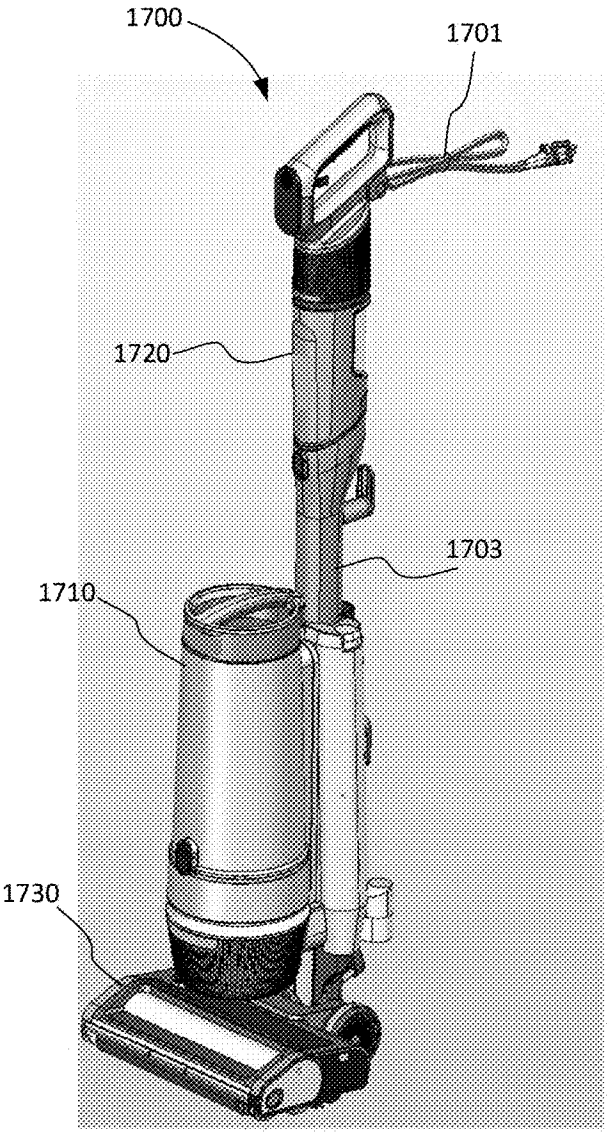
Figure 17E:
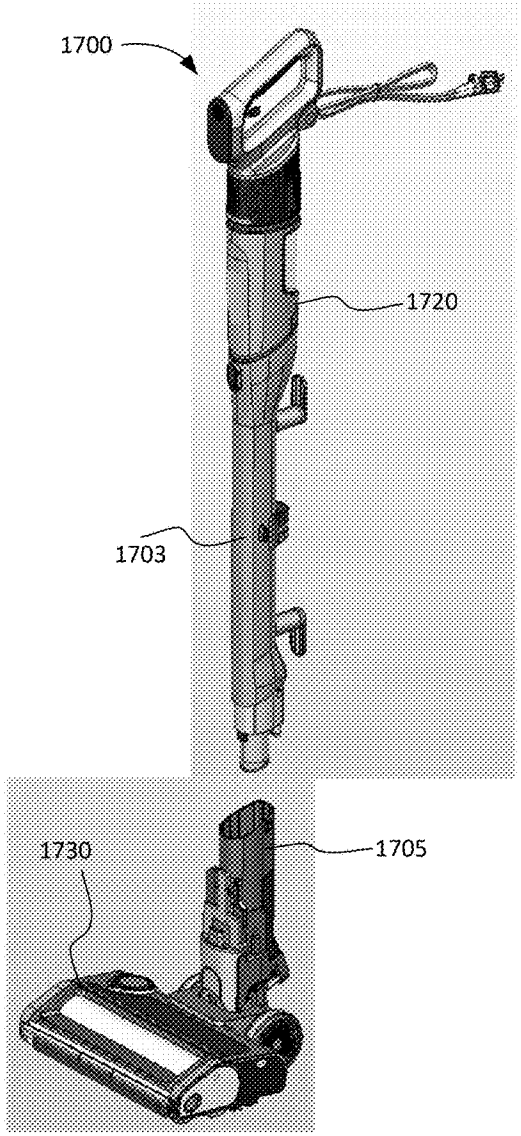
FIGS. 17D-17E illustrate portions of the cleaning apparatus of FIGS. 17A-17C with a floor-based vacuum cleaner detached in accordance with aspects of this disclosure.
Figure 17D:
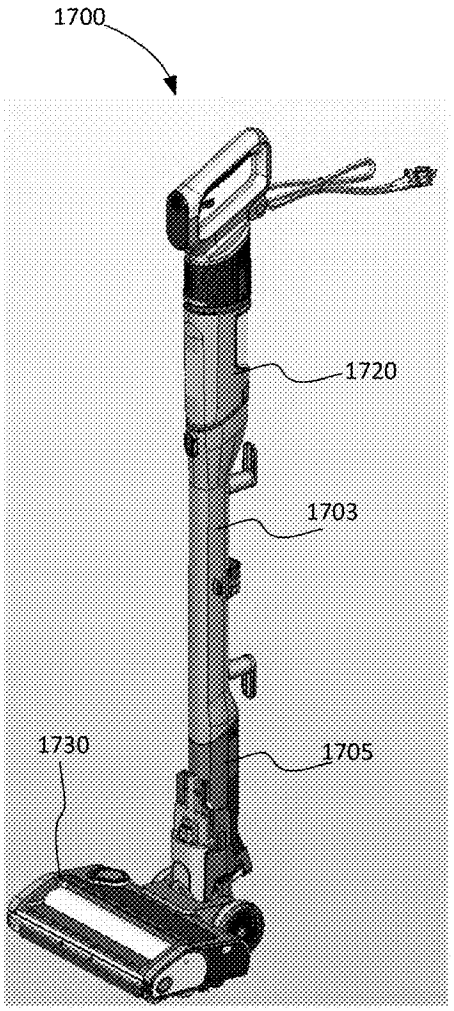
Figure 17C:
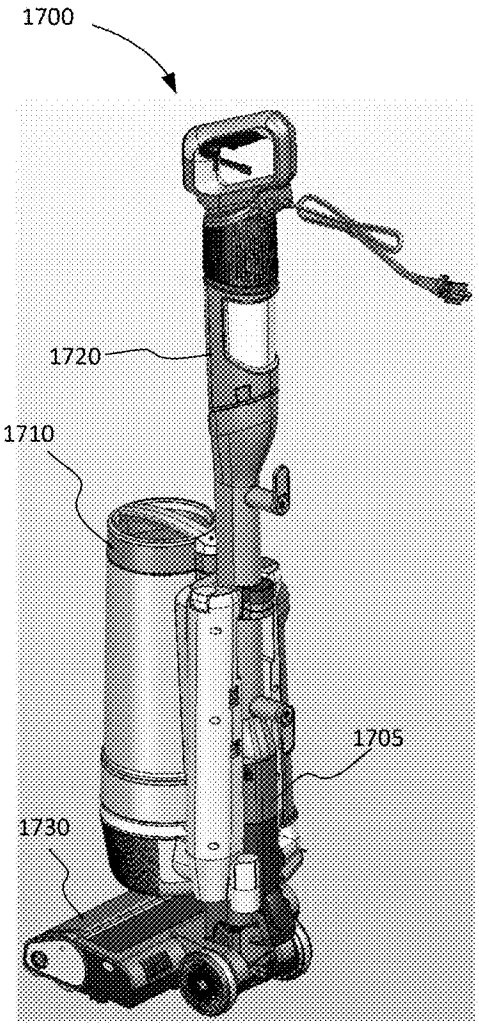

FIGS. 17A-17KK illustrate another implementation of a cleaning apparatus 1700 and portions thereof. Cleaning apparatus 1700 can be similar or identical to any of the cleaning apparatus described herein in some or many respects (for example, cleaning apparatus 1600). Cleaning apparatus 1700 can include a floor-based vacuum cleaner 1710, a wand 1703, a support member 1705 (which also may be referred to as a "support", "support structure", or "neck"), a cleaning head 1730 (which may be referred to as a "surface cleaning head" or "floor nozzle"), a handheld vacuum cleaner 1720, and a cord 1701. FIGS. 17A-17C illustrate views of cleaning apparatus 1700 with floor-based vacuum cleaner 1710 attached while FIG. 17D illustrates cleaning apparatus 1700 with floor-based vacuum cleaner 1710 detached. FIG. 17E illustrates handheld vacuum cleaner 1720 and wand 1703 detached from support member 1705 and cleaning head 1730. Floor-based vacuum cleaner 1710, wand 1703, support member 1705, cleaning head 1730, and handheld vacuum cleaner 1720 can be attached and detached from one another similarly to that described above with respect to any of the cleaning apparatus disclosed herein (for example, cleaning apparatus 1600). Cleaning apparatus 1700 can be configured to operate in a plurality of modes similar or identical to any of the modes described with respect to any of the other cleaning apparatuses disclosed herein (for example, cleaning apparatus 1600). Cleaning head 1730 can include any features described with respect to other cleaning heads disclosed herein (such as cleaning head 330). Floor-based vacuum cleaner 1710 can include any features described with respect to other floor-based vacuum cleaners disclosed herein (such as floor-based vacuum cleaner 310). Handheld vacuum cleaner 1720 can include any features described with respect to other handheld vacuum cleaners disclosed herein (such as handheld vacuum cleaners 320, 1620).

Figure 17G:
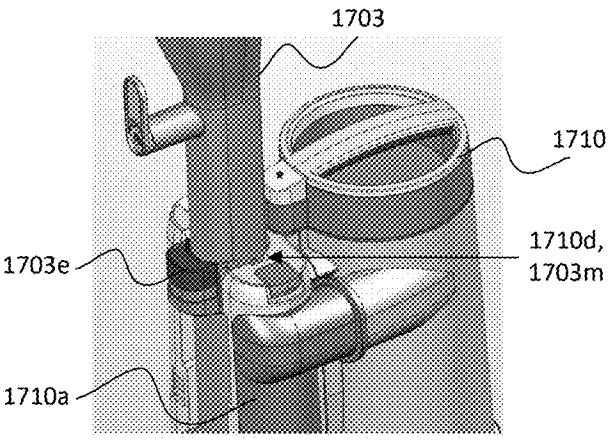
FIGS. 17F-17L illustrate various enlarged views of portions of the cleaning apparatus of FIGS. 17A-17C in accordance with aspects of this disclosure.
Figure 17I:
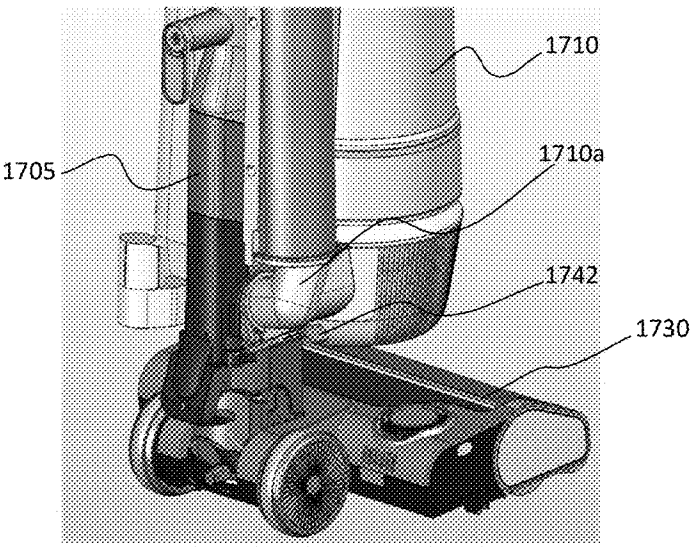
Figure 17F:
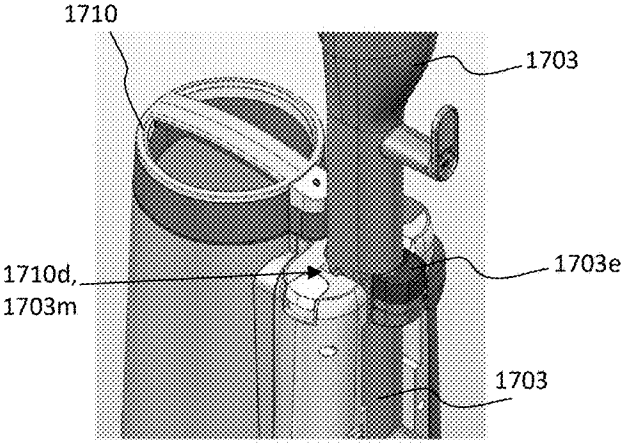
Figure 17H:
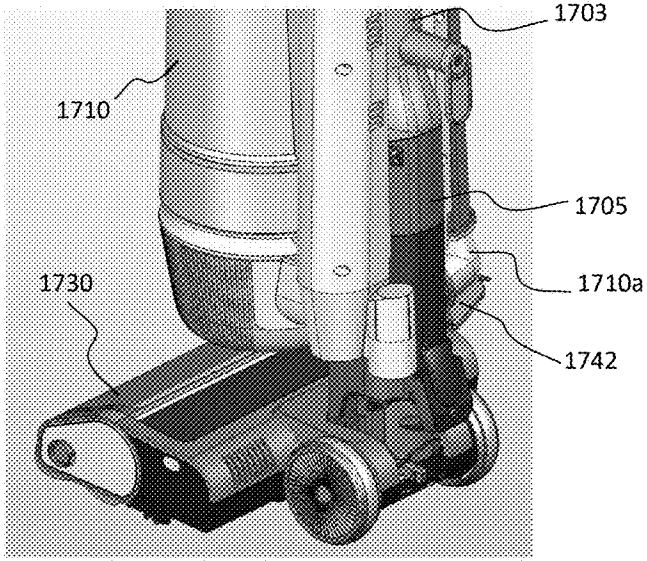
Figure 17K:
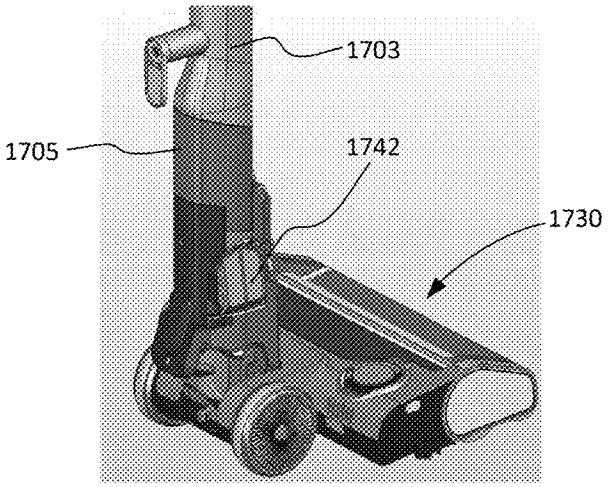
Figure 17M:
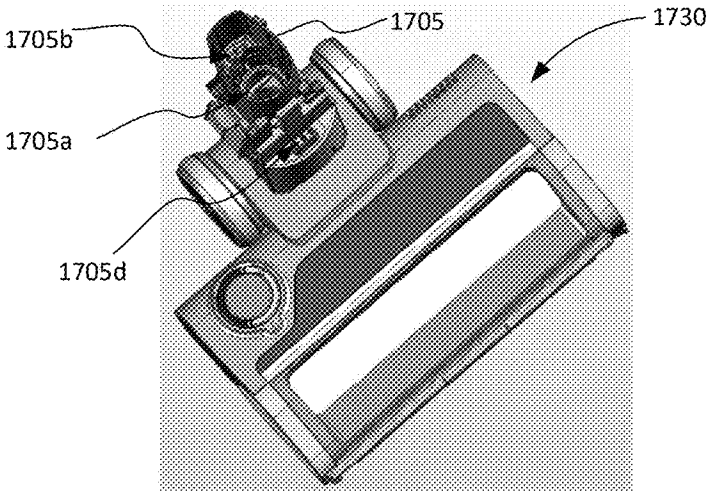
FIG. 17M illustrates a top perspective view of a support member and cleaning head of the cleaning apparatus of FIGS. 17A-17C in accordance with aspects of this disclosure.
Figure 17J:
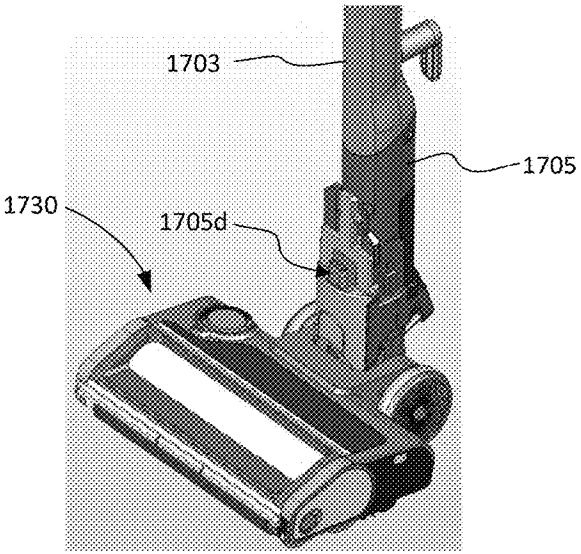
Figure 17L:
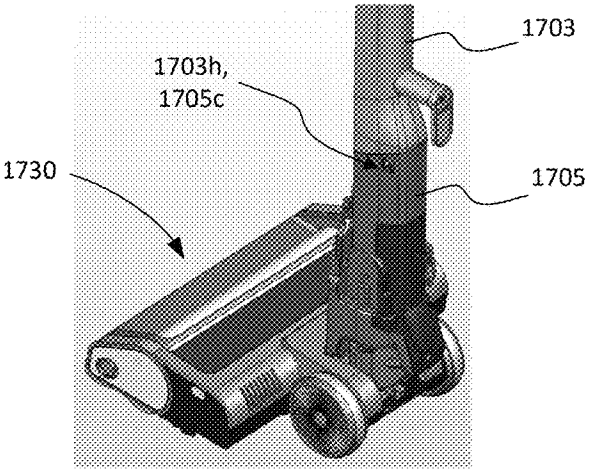
Figure 17O:
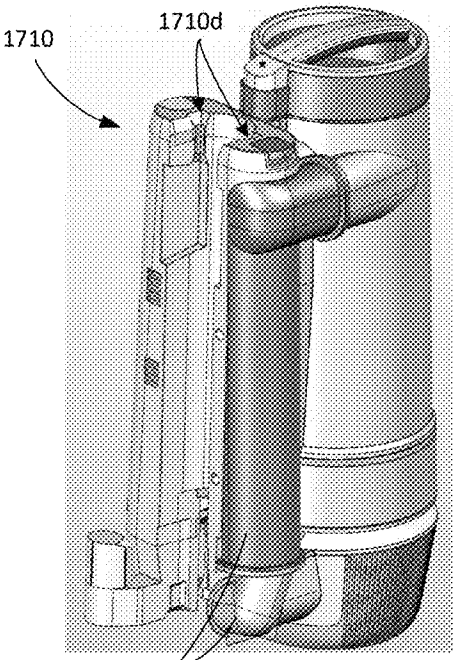
FIGS. 17N-17P illustrate various views of a floor-based vacuum cleaner of the cleaning apparatus of FIGS. 17A-17C in accordance with aspects of this disclosure.
Figure 17P:
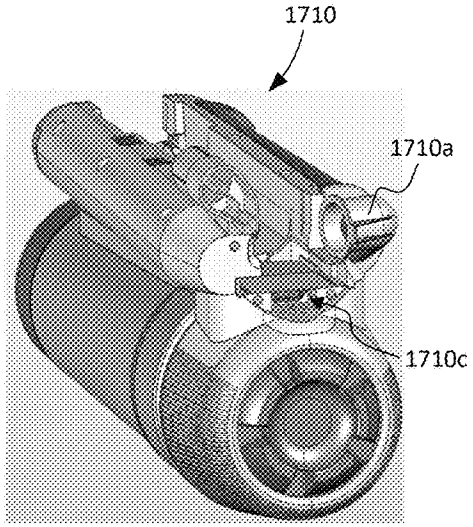
Figure 17N:
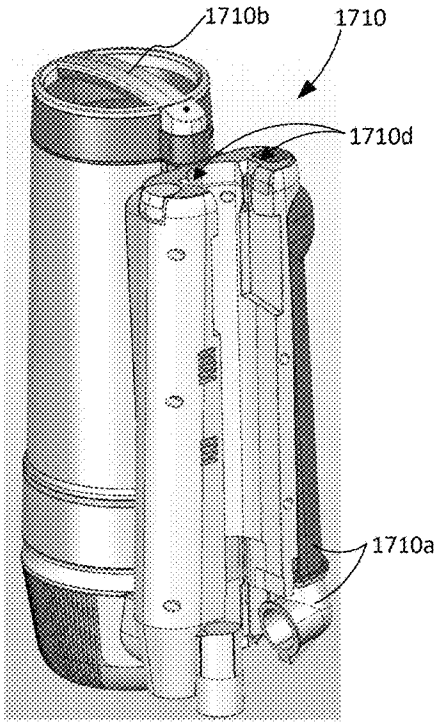
Figure 17T:
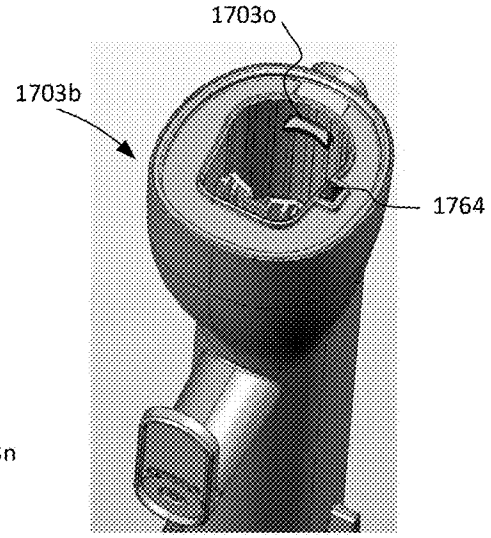
FIGS. 17Q-17U illustrate various views of a wand of the cleaning apparatus of FIGS. 17A-17C and portions thereof in accordance with aspects of this disclosure.
Figure 17S:
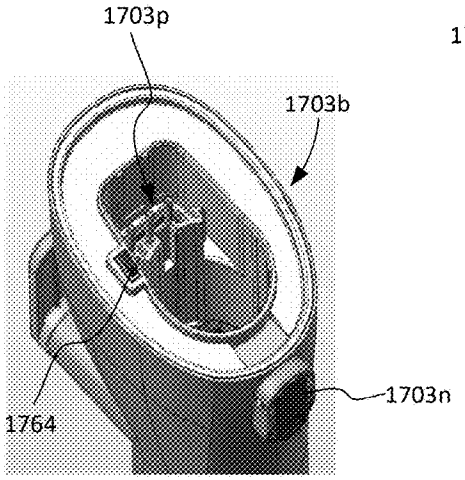

FIGS. 17F-17I illustrate various enlarged views of portions of cleaning apparatus 1700 with floor-based vacuum cleaner 1710 attached while FIGS. 17J-17L illustrate views of portions of cleaning apparatus 1700 with floor-based vacuum cleaner 1710 detached. FIG. 17M illustrates a top perspective view of support member 1705 and cleaning head 1730. FIGS. 17N-17P illustrate various views of floor-based vacuum cleaner 1710. FIGS. 17Q-17U illustrate various views of wand 1703 and portions thereof. FIGS. 17V-17X illustrate various views of handheld vacuum cleaner 1720 or portions thereof. FIG. 17Y illustrates a cross-sectional view taken through handheld vacuum cleaner 1720.

With reference to FIG. 17M, support member 1705 can include an electrical connector 1705*b* configured to electrically and mechanically connect to an electrical connector 1703*g* of wand 1703 (see FIG. 17U) and an electrical connector 1705*d* configured to electrically and mechanically connect to an electrical connector 1710*c* of floor-based vacuum cleaner 1710. With reference to FIGS. 17Q-17R, wand 1703 can include a first adapter 1703*b* configured to attach to a portion of handheld vacuum cleaner 1720 (for example, to snout 1726) and a second adapter 1703*c* configured to attach to (for example, within) support member 1705. Wand 1703 can include a main body 1703*a* extending between adapters 1703*b*, 1703*c*. Main body 1703*a* may form a seamless component with adapter 1703*b* in some implementations. Adapter 1703*c* can include a snout 1703*f* (which may be tubular). With reference to FIGS. 17S-17T and 17V, adapter 1703*b* can include a latch 1703*n* with a locking feature 17030 which can engage a groove 1726*a* on snout 1726 of handheld vacuum cleaner 1720 in a similar or identical manner as that described above with respect to latch 1603, locking feature 16030, groove 1626*a*, and handheld vacuum cleaner 1620. Adapter 1703*b* can include an electrical connector 1703*p* configured to electrically and mechanically connect to an electrical connector 1729 of handheld vacuum cleaner (see FIGS. 17S and 17X). With reference to FIGS. 17Q-17R, 17N-170, and 17F-17G, wand 1703 can include protrusions 1703*m* (for example, on main body 1703*a*) configured to engage within slots 1710*d* of floor-based vacuum cleaner 1710, and such engagement can be similar or identical to that described above with respect to protrusions 1603*m* and slots 1610*d* of wand 1603 and floor-based vacuum cleaner 1610. Wand 1703 can include an engagement feature 1703*e* and a connected rod (similar or identical to rod 1603*d*) that is inside wand body 1703*a* and can be pushed to retract a latch 1703*h* (see FIG. 17U). Latch 1703*h* can interact with an opening 1705*c* on support member 1705 (see FIG. 17L) in a similar or identical manner as that described with respect to latch 1603*h* and opening 1605*c*. With reference to FIGS. 17K, cleaning apparatus can include a lid/cover 1742 that can be similar or identical to lid/cover 1642 and can close an outlet of support member 1705 that is configured to be in flow communication with floor-based vacuum cleaner 1710 when attached to support member 1705. Floor-based vacuum cleaner 1710 can include a duct 1710*a* that can be similar to duct 1610*a* described above, and such duct 1710*a* can provide flow communication between a dirty air inlet of floor-based vacuum cleaner 1710 and support member 1705. With reference to FIG. 17N, floor-based vacuum cleaner 1710 can include a handle 1710*b* that can facilitate detachment of floor-based vacuum cleaner 1710 and/or holding floor-based vacuum cleaner 1710 when detached.

FIGS. 17F-17I illustrate enlarged views of portions of cleaning apparatus 1700 with floor-based vacuum cleaner 1710, handheld vacuum cleaner 1720, support member 1705, wand 1703, and cleaning head 1730 attached to one another. FIGS. 17J-17L illustrate portions of support member 1705, wand 1703, and cleaning head 1730 attached to one another. FIG. 17M illustrates a top perspective view of support member 1705 and cleaning head 1730. FIGS. 17N-17P illustrate various views of floor-based vacuum cleaner 1710 and portions thereof and FIGS. 17Q-17U illustrate various views of wand 1703 and portions thereof.

Figure 17U:
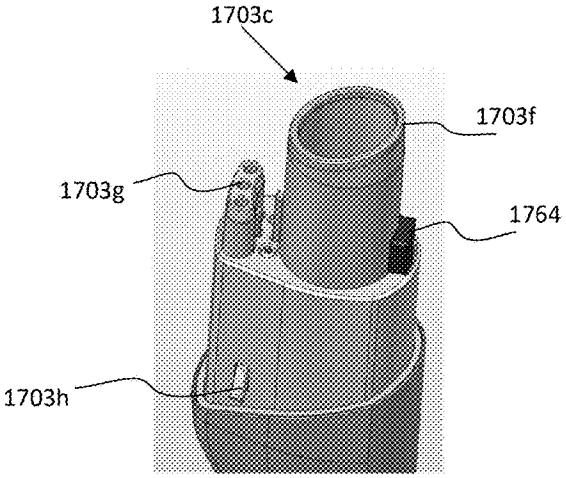
Figure 17R:
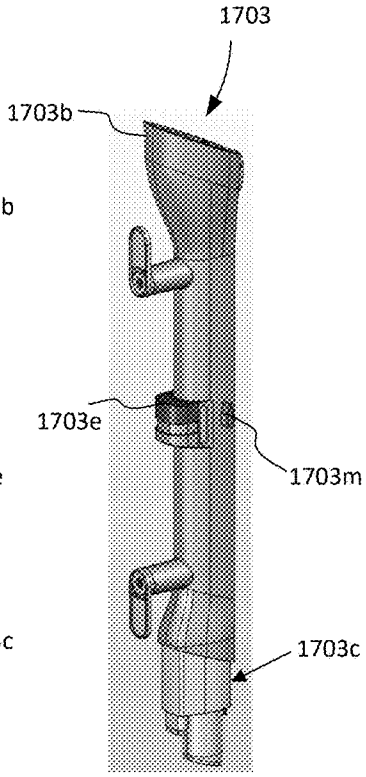
Figure 17Q:
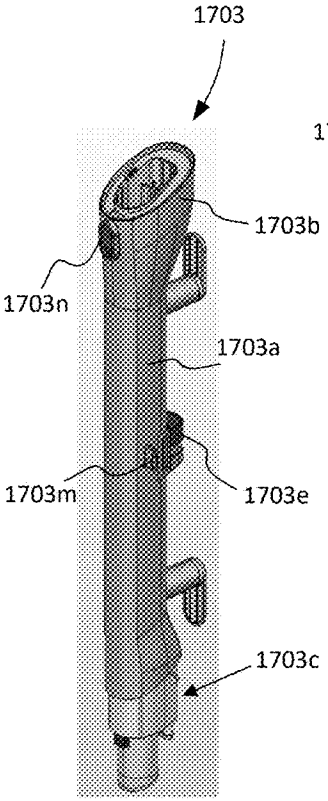
Figure 17W:
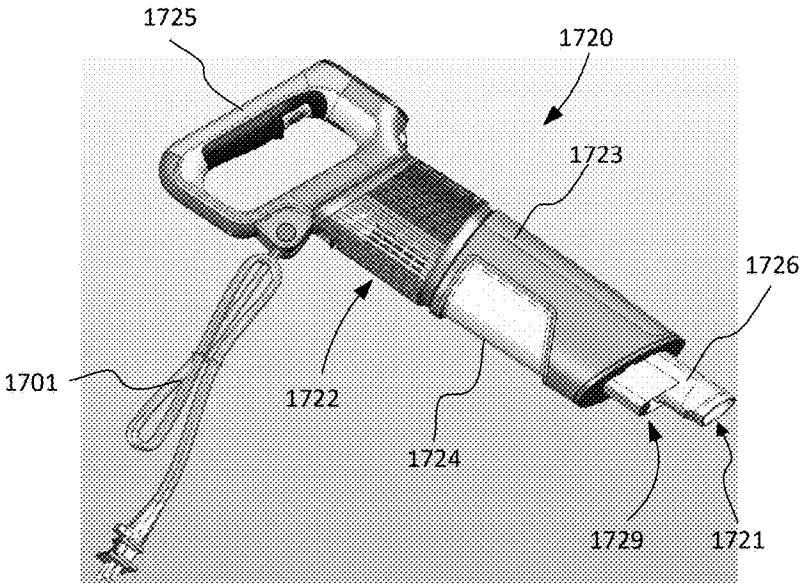
FIGS. 17V-17Y illustrate various views of a handheld vacuum cleaner of the cleaning apparatus of FIGS. 17A-17C in accordance with aspects of this disclosure.
Figure 17V:
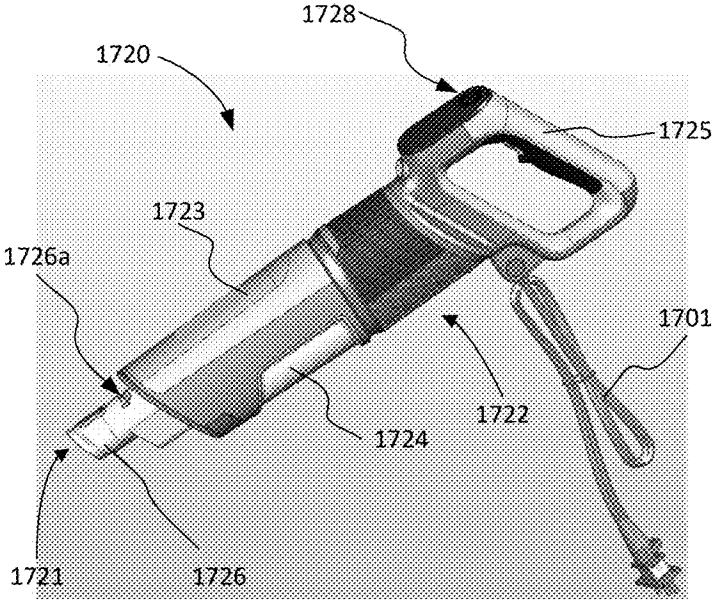
Figure 17X:
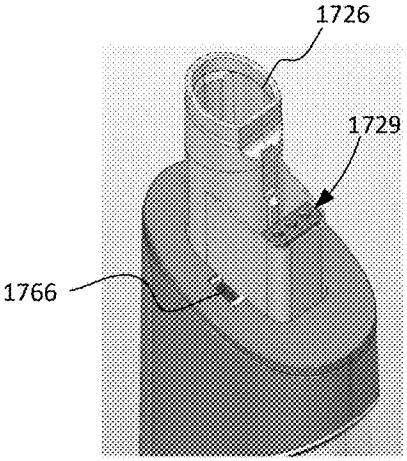
Figure 17Y:
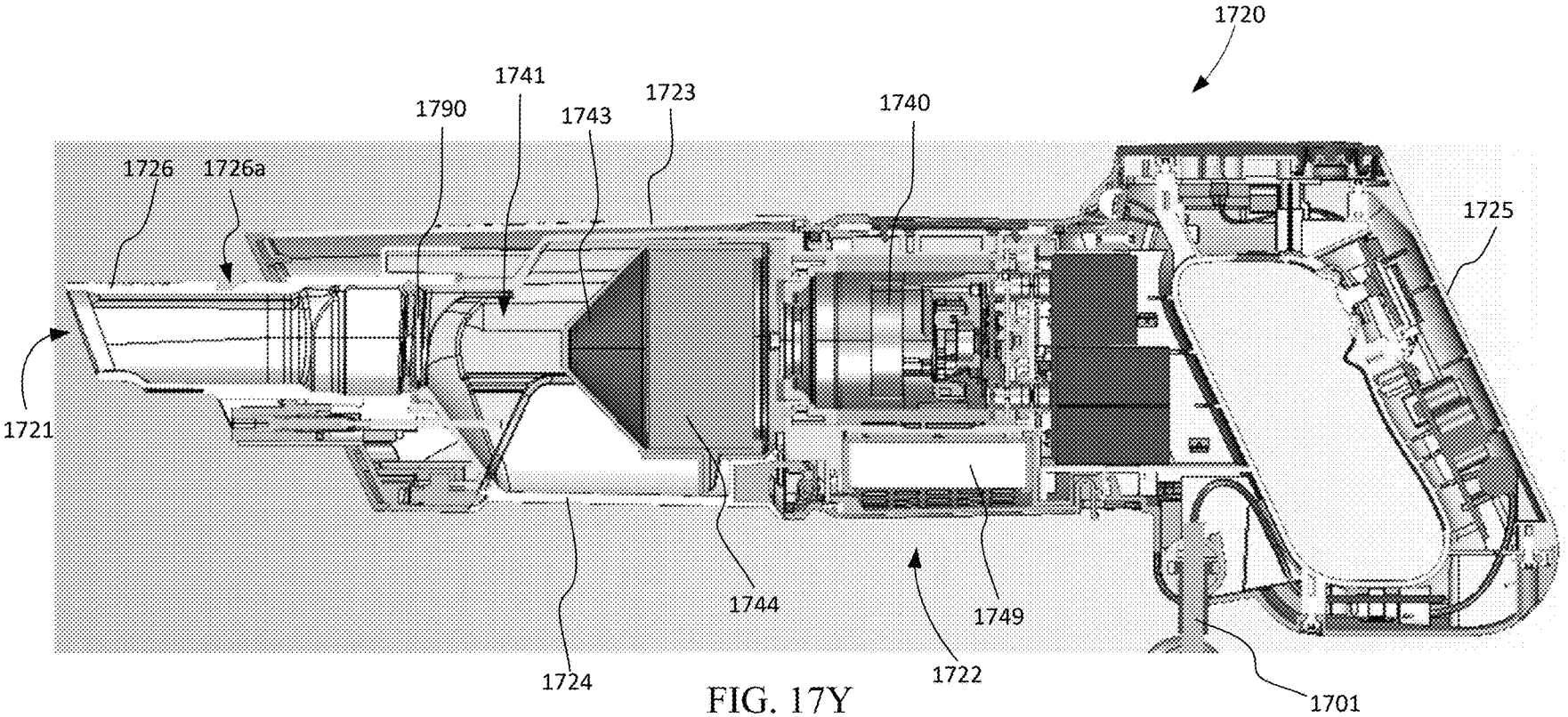

With reference to FIGS. 17Q-17U, wand 1703 can include a main body 1703*a* extending between a first adapter 1703*b* configured to attach to a portion of handheld vacuum cleaner 1720 (for example, to snout 1726) and a second adapter 1703*c* configured to attach to (for example, within) support member 1705. Main body 1703*a* may form a seamless component with adapter 1703*b* in some implementations. Main body 1703*a* can be tubular. Wand 1703 can include a wand conduit 1703*d* arranged at least partially within main body 1703*a* (see FIGS. 17EE and 17FF). Wand conduit 1703*d* can be tubular. First and second adapters 1703*b*, 1703*c* can be arranged at opposite ends of wand 1703 and attached to "top" and "bottom" ends of main body 1703*a*. Wand 1703 can include an airflow passage extending through main body 1703*a*, wand conduit 1703*d*, and/or first and second adapters 1703*b*, 1703*c*. Adapter 1703*c* can be configured to secure to a portion of support member 1705, for example, within a socket 1705*a* of support member 1705 (see FIG. 17M). In some variants, adapter 1703*c* and support member 1705 are configured such that support member 1705 (for example, an end thereof) is received and secured within a portion of adapter 1703*c*. With reference to FIG. 17U, adapter 1703*c* can include a snout 1703*f* that can be at least partially tubular and an electrical connector 1703*g* configured to mechanically and electrically connect to an electrical connector 1705*b* of support member 1705 (see FIG. 17M). Wand 1703 and/or support member 1705 can include one or more latch mechanisms to inhibit detachment of wand 1703 from support member 1705. For example, wand 1703 can include a latch 1703*h* that can be received by a latch opening 1705*c* in support member 1705 (see FIG. 17L). Wand 1703 can include one or more mechanisms to move latch 1703*h*, for example, horizontally so as to move latch 1703*h* into (through) and out of latch opening 1705*c*.

Adapter 1703*b* can be configured to attach to handheld vacuum cleaner 1720. Adapter 1703*b* can include one or more latch mechanisms configured to inhibit detachment of adapter 1703*b* (and thus, wand 1703) from handheld vacuum cleaner 1720. For example, with reference to at least FIGS. 17Q-17T, adapter 1703*b* can include a latch 1703*n* having a locking feature 17030 configured to engage within a portion of handheld vacuum cleaner 1720 (for example, groove 1726*a* in a portion of snout 1726 (see FIG. 17Y). Latch 1703*h* can be pivotably connected to a portion of adapter 1703*b* and can be pushed (for example, by a user) between an extended position (see FIG. 17T) and a retracted position. In such extended position, locking feature 17030 is arranged within groove 1726*a* when adapter 1703*b* is attached to handheld vacuum cleaner 1720. In some implementations, latch 1703*n* is biased toward such extended position. With reference to FIG. 17S, adapter 1703*b* can include an electrical connector 1703*p* configured to mechanically and electrically connect to an electrical connector 1729 of handheld vacuum cleaner 1720 (see FIGS.

17W and 17X) when adapter 1703*b* is attached to handheld vacuum cleaner 1720. With reference to FIGS. 17Q-17R, 17N-170, and 17F-17G, wand 1703 can include protrusions 1703*m* (for example, on main body 1703*a*) configured to engage within slots 1710*d* of floor-based vacuum cleaner 1710, and such engagement can be similar or identical to that described above with respect to protrusions 1603*m* and slots 1610*d* of wand 1603 and floor-based vacuum cleaner 1610. Wand 1703 can include an engagement feature 1703*e* and a connected rod (similar or identical to rod 1603*d*) that is inside wand body 1703*a* and can be pushed to retract latch 1703*h* (see FIG. 17U). Latch 1703*h* can interact with an opening 1705*c* on support member 1705 (see FIG. 17L) in a similar or identical manner as that described with respect to latch 1603*h* and opening 1605*c*. With reference to FIGS. 17K, cleaning apparatus can include a lid/cover 1742 that can be similar or identical to lid/cover 1642 and can close an outlet of support member 1705 that is configured to be in flow communication with floor-based vacuum cleaner 1710 when floor-based vacuum cleaner 1710 is attached to support member 1705.

FIGS. 17N-17P illustrate various views of floor-based vacuum cleaner 1710. Floor-based vacuum cleaner 1710 can include a duct 1710*a* configured to fluidly connect to an outlet of support member 1705 which can be similar or identical to outlet 1605*e*. Duct 1710*a* can fluidly connect a dirty air inlet of floor-based vacuum cleaner 1710 to the outlet of support member 1705. In some variants, floor-based vacuum cleaner 1710 does not include duct 1710*a*, and in such variants, a dirty air inlet (for example, formed by a port and/or opening in floor-based vacuum cleaner 1710) is directly connected to the outlet of support member 1705. As shown, floor-based vacuum cleaner 1710 can include a handle 1710*b* that can facilitate detachment of floor-based vacuum cleaner 1710 and/or holding floor-based vacuum cleaner 1710 when detached. Floor-based vacuum cleaner 1710 can be configured to receive and/or secure to wand 1703. As mentioned previously, floor-based vacuum cleaner 1710 can include slots 1710*d* configured to receive protrusions 1703*m* of main body 1703*a* (see FIGS. 17Q-17R). FIGS. 17F-17G illustrate protrusions 1703*m* within slots 1710*d*. Protrusions 1703*m* can be configured to be inserted within slots 1710*d* vertically, for example, when floor-based vacuum cleaner 1710 is moved downward when attached to wand 1703. Arrangement of protrusions 1703*m* within slots 1710*d* may inhibit detachment of floor-based vacuum cleaner 1710 from wand 1703 (for example, lateral detachment).

Floor-based vacuum cleaner 1710 and support member 1705 can be configured to electrically connect to one another, which can allow floor-based vacuum cleaner 1710 to receive electrical power from support member 1705 (and, for example, from handheld vacuum cleaner 1720 and cord 1701 via support member 1705). For example, floor-based vacuum cleaner 1710 can include an electrical connector 1710*c* configured to mechanically and electrically connect to an electrical connector 1705*d* of support member 1705 (see FIG. 17M). In some implementations, support member 1705 includes a leg which can be similar or identical to leg 1605*f* on which electrical connector 1705*d* is arranged. Such leg can be configured to support a portion of floor-based vacuum cleaner 1710 which includes electrical connector 1710*c* (see FIG. 17P). FIGS. 17H-17I illustrate portions of floor-based vacuum cleaner 1710, wand 1703, support member 1705, and cleaning head 1730 when attached to one another.

FIGS. 17V-17X illustrate perspective views of handheld vacuum cleaner 1720 or portions thereof. FIG. 17Y illustrates a cross-sectional view taken through handheld vacuum cleaner 1720. Handheld vacuum cleaner 1720 can include a dirty air inlet 1721, a snout 1726, a groove 1726*a* (described above), a housing 1723, a debris container door 1724 (which may be opened to allow debris to be emptied), a debris container 1741 (which may be formed by debris container door 1724 and one or more portions of housing 1723), a handle 1725, a clean air outlet 1722, one or more controls 1728, and a motor 1740 (which may also be referred to as a suction motor), and electrical connector 1729, among other components. Debris container 1741 may also be referred to as "debris containing region" or "debris chamber" and may be defined by one or more portions of an interior of handheld vacuum cleaner 1720, and such interior portion(s) may be at least partially formed by debris container door 1724. Handheld vacuum cleaner 1720 can include a debris separator for separating debris from air suctioned through handheld vacuum cleaner 1720. With reference to FIG. 17Y, handheld vacuum cleaner 1720 can include a mesh filter 1743 (which may also be referred to as a "fluff screen"), a pre-motor filter 1744 (which may be cylindrical), and/or a post-motor filter 1749 (for example, a HEPA filter). Filter 1743, filter 1744, and/or other components (for example, structural components of handheld vacuum cleaner 1720) may form a debris separator that separates debris from air flowing through handheld vacuum cleaner 1720. As also shown in FIG. 17Y, handheld vacuum cleaner 1720 can include a valve 1790. Valve 1790 can be arranged within an airflow passage of handheld vacuum cleaner 1720 that extends between dirty air inlet 1721 and debris container 1741. Valve 1790 can be configured to be moved between various positions, such as open and closed positions, and can advantageously inhibit debris from falling out of debris container 1741 when in a closed position (for example, a position in which valve 1790 blocks an airflow passage extending between dirty air inlet 1721 and debris container 1741). Valve 1790 can be similar or identical to valve 1490 and/or valve 1690 in some or all respects. For example, valve 1790 can include an inner door 1790*a* and an outer door 1790*b* that can be similar or identical to inner door 1490*a* and outer door 1490*b* (respectively).

When cleaning apparatus 1700 is in an empty mode (which also may be referred to as an "auto-empty mode"), debris from handheld vacuum cleaner 1720 can be transferred ("emptied") into floor-based vacuum cleaner 1710 (for example, as described with respect to any of the other cleaning apparatuses disclosed herein). Valve 1790 can be opened in such mode to facilitate flow communication between handheld vacuum cleaner 1720 and floor-based vacuum cleaner 1710. Lid/cover 1742 can be opened when cleaning apparatus 1700 is in the empty mode to allow flow communication through an outlet of support member 1705 (for example, a side outlet of support member 1705). For example, a portion of floor-based vacuum cleaner 1710 can contact and/or move lid/cover 1742 to an open position when attached to the support member 1705 (for example, as described with respect to any of the other cleaning apparatuses disclosed herein). In such mode, a suction motor of floor-based vacuum cleaner 1710 can cause air to flow from handheld vacuum cleaner 1710 to and through floor-based vacuum cleaner 1710, for example, via wand 1703 and at least a portion of support member 1705 (for example, through an outlet of support member 1705). In some implementations, air flows into and through clean air outlet 1722, through handheld vacuum cleaner 1720, dirty air inlet 1721, wand 1703, support member 1705, and to and through floor-based vacuum cleaner 1710. In some implementations, handheld vacuum cleaner 1720 includes a bleed valve which can be similar or identical to bleed valve 1645. In some implementations, air flows into and through an auxiliary air path of such bleed valve and through handheld vacuum cleaner 1720 when cleaning apparatus 1700 is in the auto-empty mode for example, in a similar or identical manner as that described above with respect to handheld vacuum cleaner 1620.

Figure 17Z:
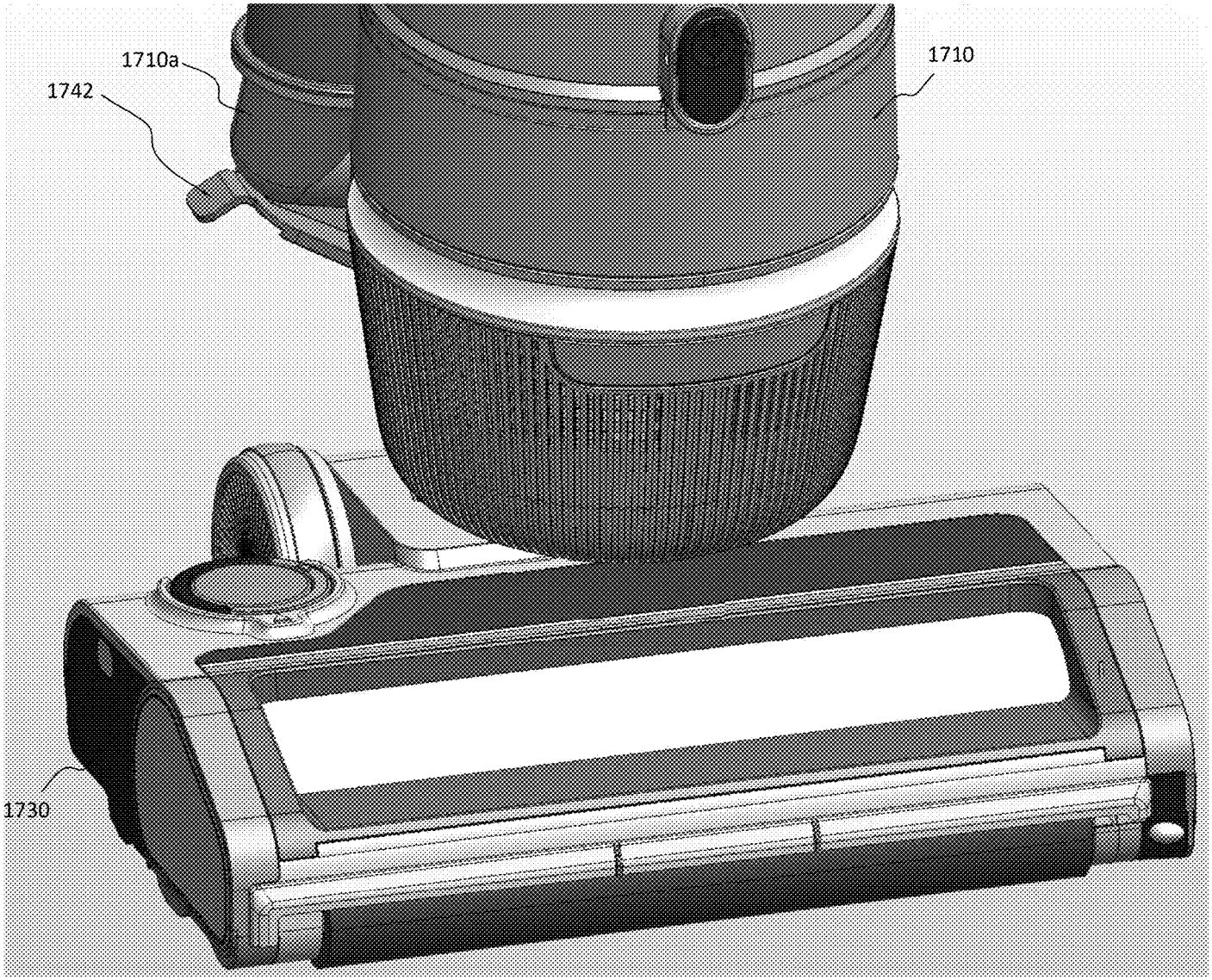
Figure 17A:
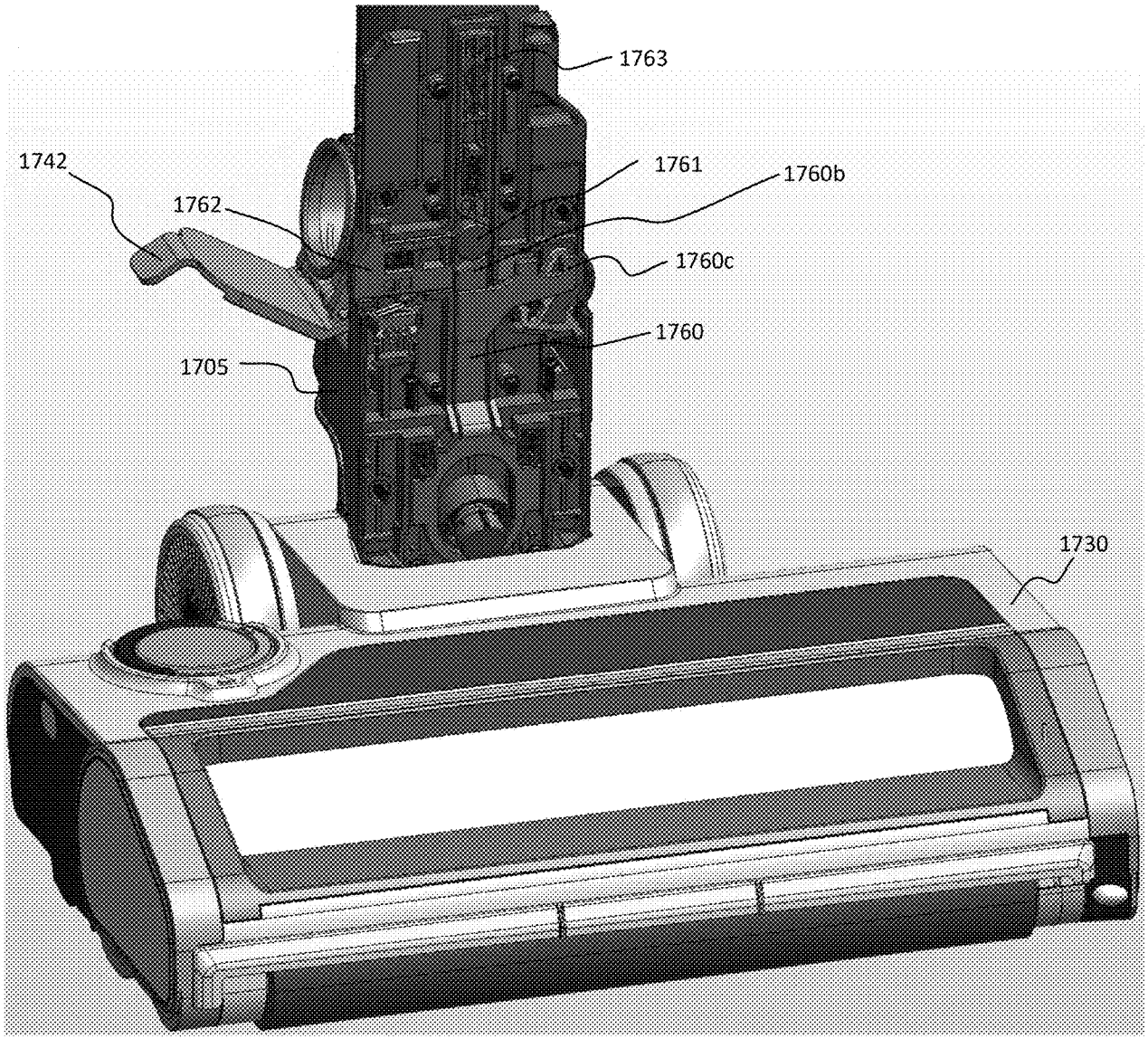
Figure 17C:
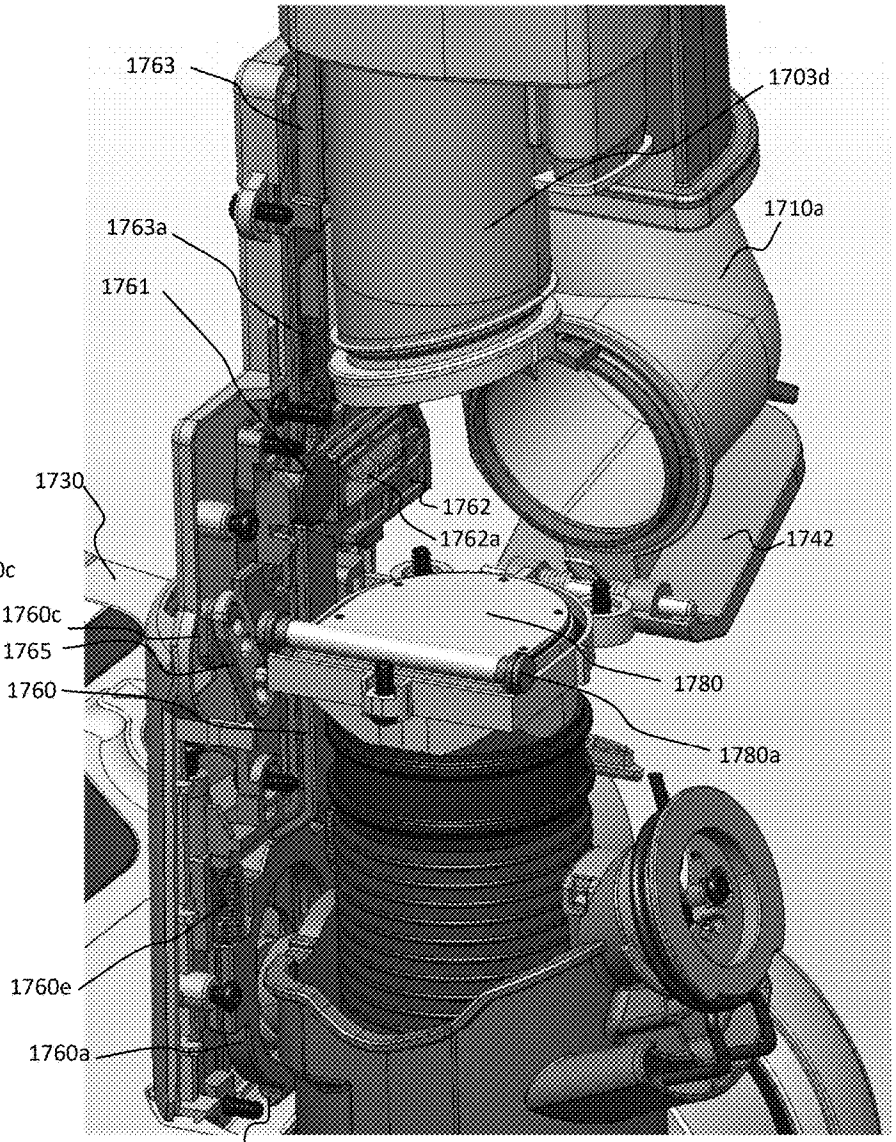
Figure 17B:
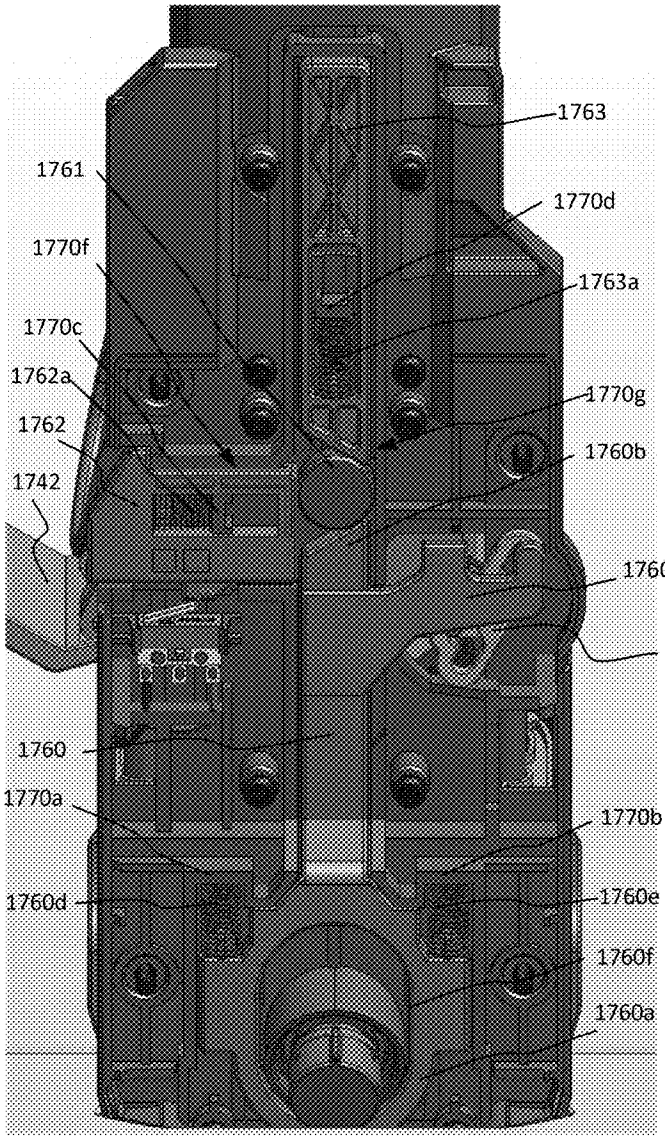
Figure 17D:
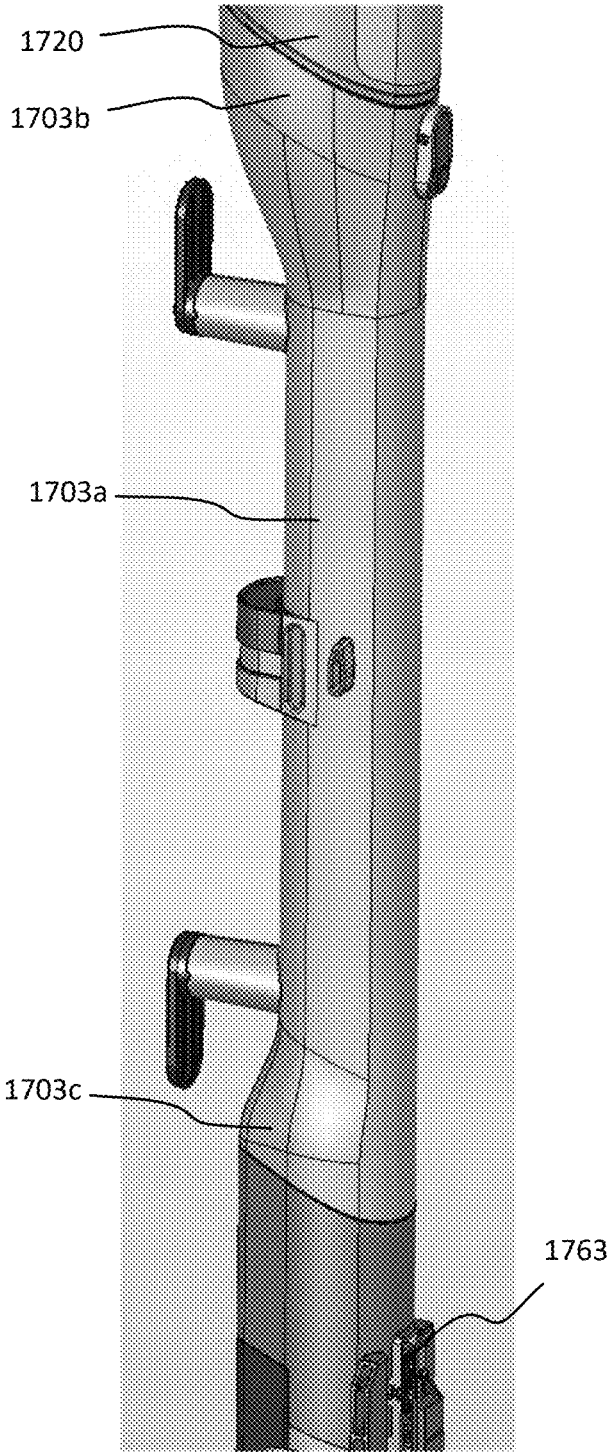
Figure 17E:
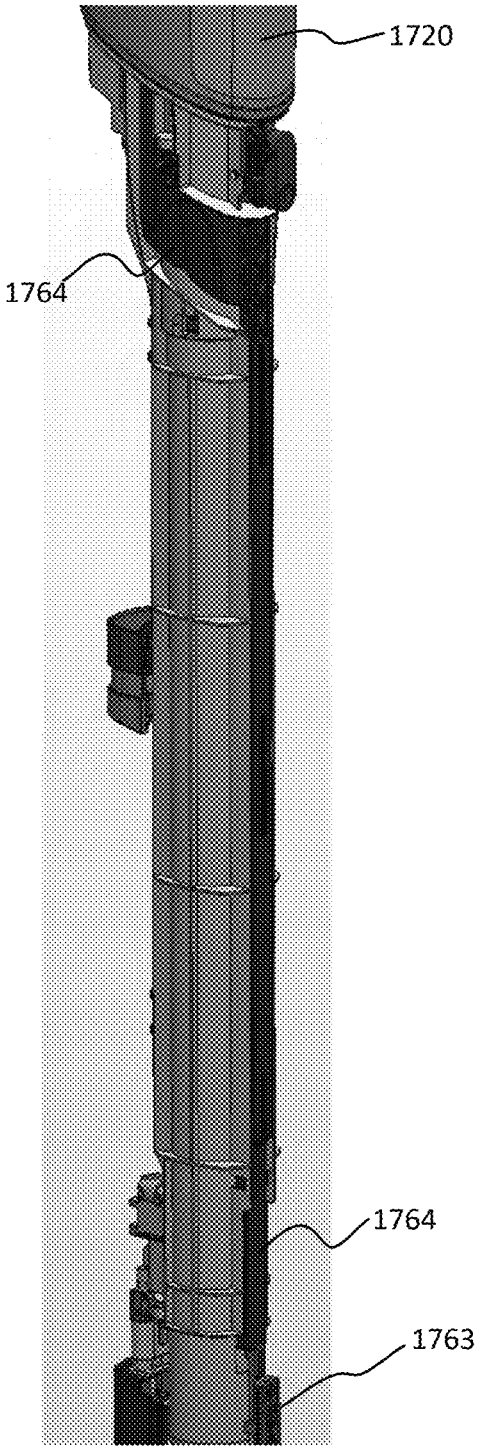
Figure 17F:
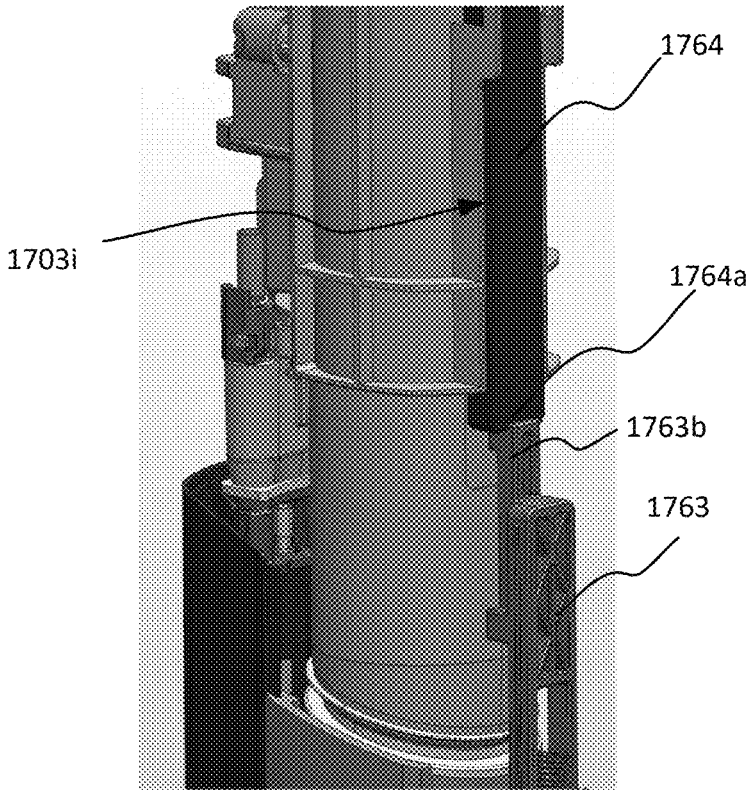
Figure 17H:
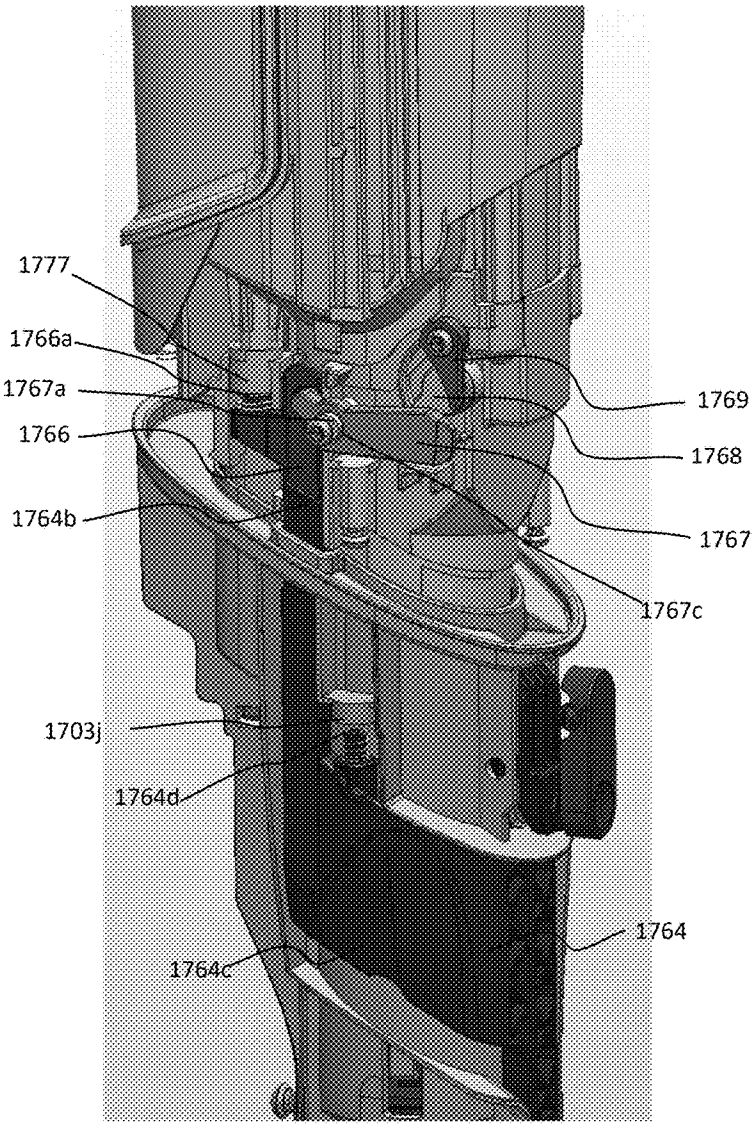
Figure 17G:
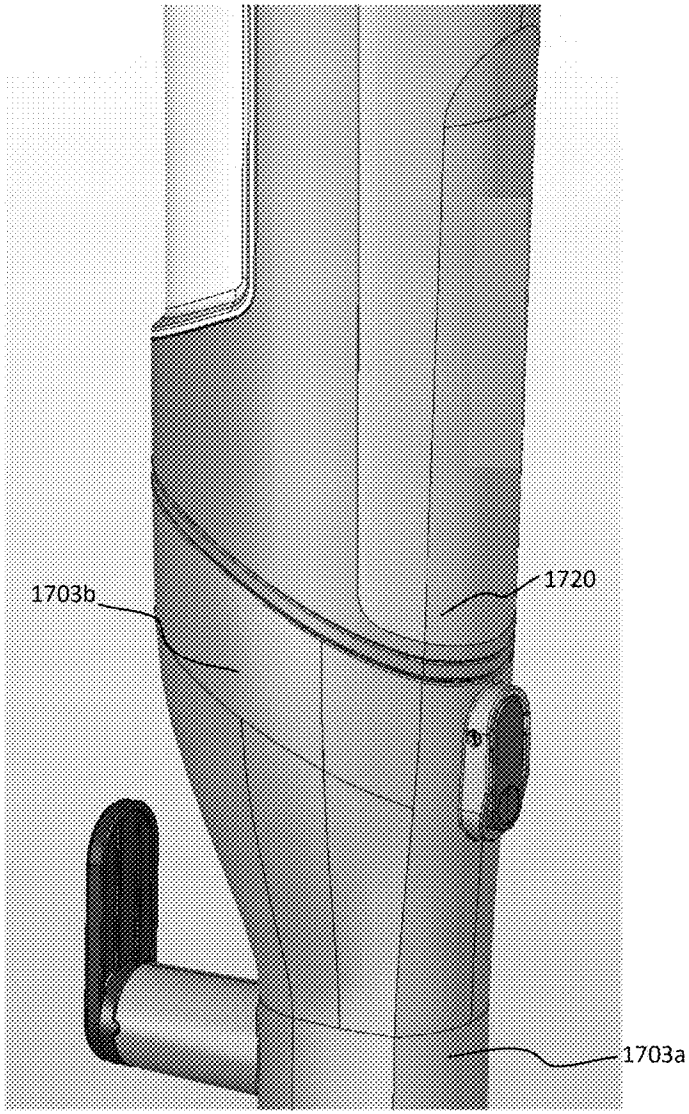
Figure 17J:
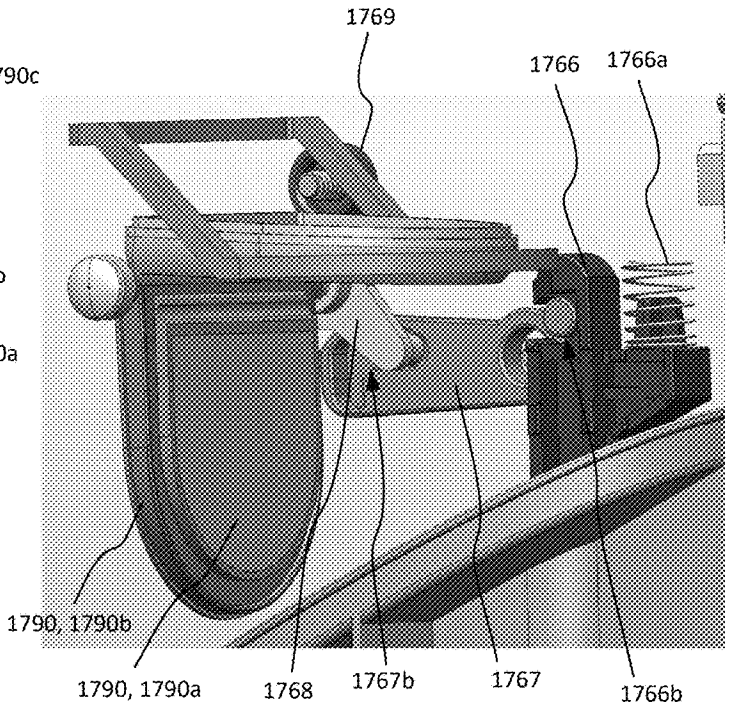
Figure 17I:
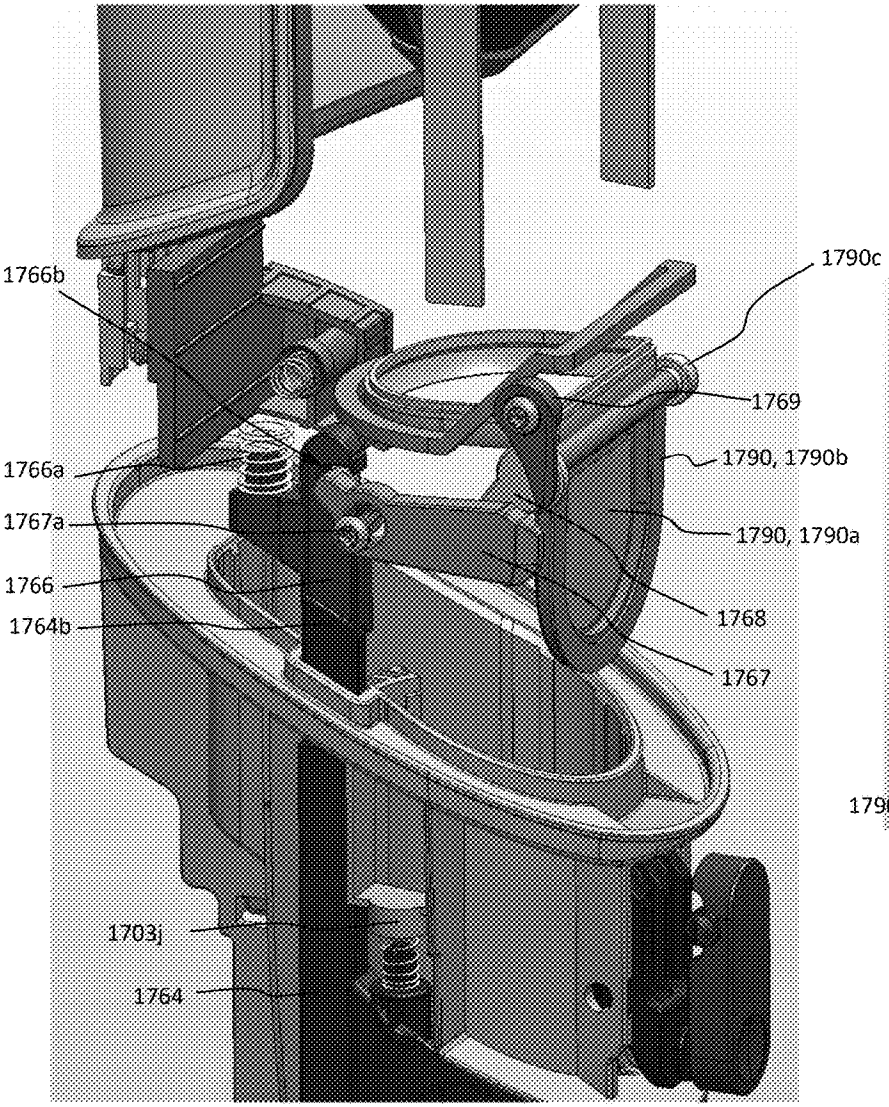
Figure 17K:
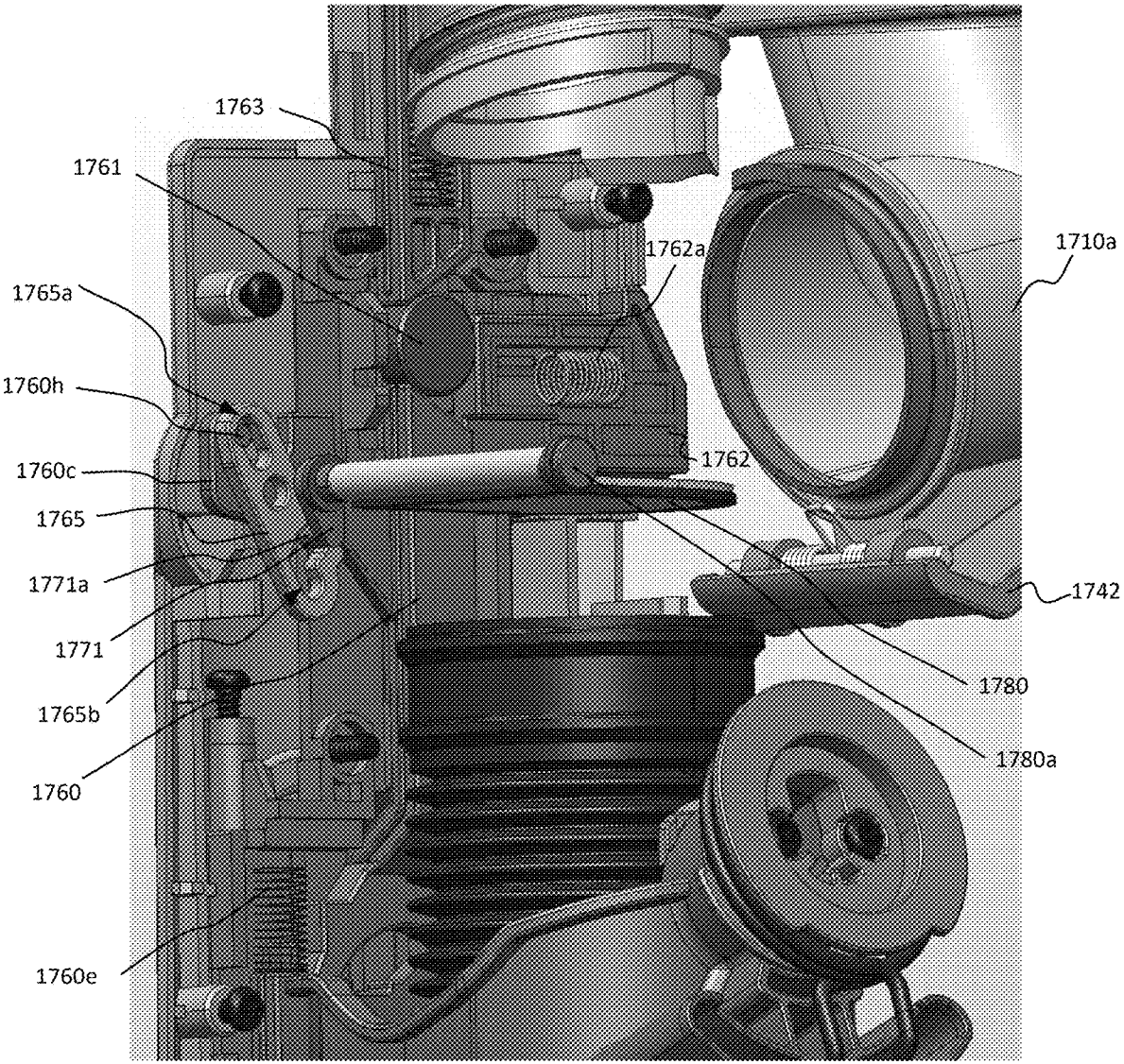

As mentioned previously, cleaning apparatus 1700 can be configured to operate in a plurality of modes similar or identical to any of the modes described with respect to any of the other cleaning apparatuses disclosed herein (for example, cleaning apparatus 1600). For example, cleaning apparatus 1700 can be operated in and transitioned between upright, stick, and/or empty modes of operation as described and/or illustrated with respect to FIGS. 16EE-16KK and cleaning apparatus 1600. FIGS. 17Z-17JJ illustrate various aspects and mechanisms of cleaning apparatus 1700 for controlling operation of valves 1780, 1790, for example, for opening and/or closing valves 1780, 1790 in accordance with certain modes of operation. Such examples are not intended to limit the scope of the disclosure. Various other actuators and/or actuator mechanisms may be utilized within cleaning apparatus 1700 in order to cause movement of valves 1780, 1790 to facilitate operation of cleaning apparatus 1700 in any of the modes described herein. Each of cleaning head 1730, support member 1705, wand 1703, and/or handheld vacuum cleaner 1720 can include one or more (for example, a plurality) of actuators that can interact with one another (and/or floor-based vacuum cleaner 1710 or portions thereof) to cause valve 1780 and/or valve 1790 to open and/or close to facilitate any of the modes of operation described herein.

FIG. 17Z shows an enlarged view of a portion of floor-based vacuum cleaner 1710, duct 1710*a*, support member 1705, cleaning head 1730, and lid/cover 1742. FIG. 17AA shows a similar view as shown in FIG. 17Z with certain portions removed. FIG. 17BB illustrates a front view of a portion of that which is shown in FIG. 17AA. FIGS. 17CC and 17KK illustrate support member 1705 with various portions removed to show valve 1780 and various other components. With reference to FIGS. 17AA-17CC and 17KK, cleaning apparatus 1700 can include actuators 1760, 1761, 1762, and 1763. Actuator 1760 can be coupled with and/or inside a portion of support member 1705. Actuator 1760 or portions thereof can be arranged at least partially within one or more recesses or grooves of support member 1705 that can guide and/or limit movement of actuator 1760. Actuator 1760 can include a first end or portion 1760*a*, a second end or portion 1760*b*, and/or a leg 1760*c*. Leg 1760*c* can extend laterally and/or at an angle from a body of actuator 1760 (for example, at a location that is between ends 1760*a*, 1760*b*). Actuator 1760 can include an opening 1760*f* that surrounds and/or receives a portion of support member 1705. Actuator 1760 (for example, an engagement feature 1760*g* (see FIG. 17CC) can be configured to contact a portion of cleaning head 1730, for example, when wand 1703 and/or support member 1705 are oriented generally perpendicular relative to a floor surface or within 20 degrees from perpendicular (for example, to facilitate the auto-empty mode). Contact between actuator 1760 and cleaning head 1730 can cause actuator 1760 to move upward, thereby causing actuator 1760 (for example, portion 1760*b*) to contact and move (for example, push upward) actuator 1761 (which can have a disc shape). In some implementations, actuator 1760 is biased downward, for example, by one or more springs 1760*d*, 1760*e*. The one or more springs 1760*d*, 1760*e* can contact and/or engage one or more structures 1770*a*, 1770*b* of the support member 1705 to bias the actuator 1760 downward. Springs 1760*e*, 1760*d* can be coupled to actuator 1760 via pins of actuator 1760 that extend through portions of springs 1760*e*, 1760*d* as shown (see FIG. 17BB). Contact and movement induced by cleaning head 1730 can overcome the bias of one or more springs 1760*d*, 1760*e* and cause actuator 1760 to move (for example, upward).

Movement of actuator 1760 as described above can cause valve 1780 to move, for example, from an open position to the closed position shown in FIG. 17CC. Actuator 1760 can be coupled with valve 1780 via actuator 1765 (which also may be referred to as "link"). For example, leg 1760*c* of actuator 1760 can be coupled with actuator 1765. Leg 1760*c* can be coupled with actuator 1765 via a pin 1760*h* arranged within a slot 1765*a* of actuator 1765 (see FIG. 17KK). Movement (for example, upward movement) of actuator 1760 can cause leg 1760*c* to move upward and cause actuator 1765 to move (for example, rotate and/or pivot) to cause valve 1780 to pivot from an "open" position (which can be similar in some or many aspects to the "open" position illustrated in FIG. 1600) to a "closed" position as illustrated in FIG. 17CC which blocks flow communication with cleaning head 1730. Valve 1780 can include a pivot member 1780*a* (for example, a rod) that is coupled with actuator 1765 via actuator 1771 that is coupled to actuator 1765 via a pin 1771*a* arranged within a slot 1765*b* of actuator 1765 (see FIG. 17KK). Closing valve 1780 can facilitate flow communication between handheld vacuum cleaner 1720 and floor-based vacuum cleaner 1710, for example, in accordance with the empty mode of operation described herein. In some implementations, air flows into and from handheld vacuum cleaner 1720, through wand 1703 (for example, wand conduit 1703*d*), support member 1705, duct 1710*a*, and to and through floor-based vacuum cleaner 1710.

Actuators 1761, 1762, 1763 can be coupled with and/or inside a portion of support member 1705. Actuators 1761, 1762, 1763 can be arranged at least partially within a recess or groove of support member 1705 that can guide and/or limit movement of 1761, 1762, 1763. Actuator 1761 can be pushed laterally between actuators 1760, 1763 (for example, to the "right" given the view shown in FIG. 17BB) by actuator 1762 which itself may be pushed by a portion of floor-based vacuum cleaner 1710 when floor-based vacuum cleaner 1710 is attached to support member 1705. This in turn can cause actuator 1763 to be moved (for example, upward). For example, actuator 1761 can be moved upward via contact with actuator 1760 when actuator 1760 moves upward and when actuator 1762 pushes actuator 1762 laterally between actuators 1760, 1763. Actuator 1763 can be moved upward via contact with actuator 1761 when actuator 1761 moves upward (for example, due to contact and movement induced by actuator 1760). In some implementations, actuator 1762 is biased laterally (for example, away from actuator 1761) by a spring 1762*a* (see FIG. 17BB). Spring 1762*a* can contact and/or engage structure 1770*c* of support member 1705 to bias actuator 1762 laterally (for example, away from actuator 1761). Spring 1762*a* can be arranged within a slot of actuator 1762 and can be coupled to actuator 1762 via a pin of actuator 1762 that extends through a portion of spring 1762*a* as shown (see FIG. 17BB). Contact and movement induced by a portion of the floor-based vacuum cleaner 1710 when floor-based vacuum cleaner 1710 is attached to support member 1705 can overcome the bias of spring 1762*a* and cause actuator 1762 to move (for example, laterally toward actuator 1761). In some implementations, actuator 1763 is biased downward by a spring 1763*a*. Spring 1763*a* can contact and/or engage structure 1770*d* of support member 1705 to bias actuator 1763 downward. Spring 1763*a* can be arranged within a slot of actuator 1763 and can be coupled to actuator 1763 via a pin of actuator 1763 that extends through a portion of spring 1763*a* as shown (see FIG. 17BB). Contact and movement induced by actuator 1761 can overcome the bias of spring 1763*a* and cause actuator 1763 to move (for example, upward). With reference to FIG. 17BB, support member 1705 can include channels 1770*f*, 1770*g* that can receive and/or guide movement of actuators 1760, 1761, 1762, 1763 or portions thereof.

FIGS. 17DD-17FF illustrate portions of support member 1705 and wand 1703 with portions removed, while also illustrating a bottom portion of handheld vacuum cleaner 1720. Wand 1703 can include an actuator 1764, for example, in main body 1703*a*. Actuator 1764 can be arranged at least partially within a channel 1703*i* that can guide and/or limit movement of actuator 1764. Actuator 1763 can include an arm 1763*b* that can contact actuator 1764 (for example, at a first end or portion 1764*a*) such that movement (for example, upward movement) of actuator 1763 can cause movement (for example, upward movement) of actuator 1764.

FIG. 17GG illustrates portions of handheld vacuum cleaner 1720 and wand 1703. FIGS. 17HH-17JJ illustrate portions of handheld vacuum cleaner 1720 and wand 1703 with various portions removed to illustrate actuators 1764, 1766, 1767, 1768 of cleaning apparatus 1700. Actuator 1764 can include first end or portion 1764*a* (described previously), a second end or portion 1764*b*, and/or a third portion 1764*c* which may be between portions 1764*a*, 1764*b*. First portion 1764*a* and/or second portion 1764*b* can be substantially linear. First portion 1764*a* and/or second portion 1764*b* can extend at least partially along the length of wand 1703 (for example, in the upward/downward direction). Portion 1764*c* can extend between and/or connect portions 1764*a*, 1764*b*. Portion 1764*c* can extend between portions 1764*a*, 1764*b* at an angle to portions 1764*a*, 1764*b* and/or wand 1703. Actuator 1764 (for example, portion 1764*b*) can at least partially extend beyond wand 1703 and/or at least partially into handheld vacuum cleaner 1720 when actuator 1764 is moved (for example, upward) by actuator 1763. In some implementations, actuator 1764 is biased downward by a spring 1764*d* which may be coupled around a pin of actuator 1764 as shown in FIG. 17HH. Spring 1764*d* can contact and/or engage structure 1703*j* of wand 1703 to bias actuator 1764 downward. Contact and movement induced by actuator 1763 on actuator 1764 can overcome the bias of spring 1764*d* and cause actuator 1764 to move (for example, upward).

FIGS. 17HH-17JJ also illustrate an actuator 1766 that can be arranged at least partially within a recess or groove of handheld vacuum cleaner 1720 that can guide or limit movement of actuator 1766. Movement of actuator 1764 (for example, upward) can cause actuator 1766 to move (for example, upward). For example, portion 1764*b* can contact and move actuator 1766 by moving at least partially into handheld vacuum cleaner 1720 (see FIG. 17HH). In some implementations, actuator 1766 is biased downward by a spring 1766*a*. Spring 1766*a* can contact and/or engage structure 1777 of handheld vacuum cleaner 1720 to bias actuator 1766 downward (see FIG. 17HH). Spring 1766*a* can be coupled around a pin of actuator 1766 as shown in FIG. 17HH. Contact and movement induced by actuator 1764 on actuator 1766 can overcome the bias of spring 1766*a* and cause actuator 1766 to move (for example, upward). With reference to FIG. 17II, actuator 1766 can be coupled with actuator 1767 (which also may be referred to as "link"), for example, via a slot or hole 1766*b* formed in actuator 1766 that can receive a portion of actuator 1767 (for example, a pin of actuator 1767). Movement of actuator 1766 can cause actuator 1767 to move or pivot about structure 1767*a* that extends through a hole 1767*c* of actuator 1767 (see FIG. 17HH). In some implementations, cleaning apparatus 1700 includes an alignment guide 1769 that can guide and/or guard actuator 1767 (for example, an end thereof), for example, when actuator 1767 is in an upward position (in contrast to the position shown in FIGS. 17HH-17JJ). Actuator 1767 can be coupled with actuator 1768 (which also may be referred to as "link"), for example, via a recess 1767*b* formed in actuator 1767 that can receive a portion of actuator 1768 (for example, a pin of actuator 1768 as shown) (see FIG. 17JJ). Movement (for example, pivotable movement) of actuator 1767 can cause movement (for example, pivotable movement) of actuator 1768. Actuator 1768 can be pivotably mounted to a portion of handheld vacuum cleaner 1720 proximate valve 1790. Pivotable movement of actuator 1768 can cause valve 1790 (for example, inner and/or outer doors 1790*a*, 1790*b* thereof) to open, for example, by pivoting downward as shown in FIGS. 17II-17JJ. Valve 1790 can include a pivot or rod member 1790*c* that is coupled with actuator 1768 and with outer and/or inner doors 1790*a*, 1790*b*.

Accordingly, valve 1790 can be opened (for example, automatically opened) by the above-described interaction between actuators 1760-1768 when floor-based vacuum cleaner 1710 is attached and wand 1703 and support member 1705 are oriented as described above. Such interaction can cause valve 1780 to be closed and valve 1790 to be opened, thereby facilitating the empty mode of operation in which floor-based vacuum cleaner 1710 is in flow communication with handheld vacuum cleaner 1720 and debris from handheld vacuum cleaner 1720 can be transferred to floor-based vacuum cleaner 1710. Valve 1790 can be in an open position when cleaning apparatus is in the empty mode. Inner and outer doors 1790*a*, 1790*b* can be automatically opened via interaction between actuators 1760-1768 when floor-based vacuum cleaner 1710 is attached and wand 1703 and support member 1705 are oriented as described above.

Valve 1790 can be in a closed position (which can be similar or identical to the "closed" position described with respect to FIG. 16WW) when cleaning apparatus 1700 is in a "stick (upright lock)" mode and a suction motor of handheld vacuum cleaner 1720 is off and when cleaning apparatus 1700 is in an upright mode in which floor-based vacuum cleaner 1710 is utilized, similar to as described above with respect to cleaning apparatus 1600. Outer door 1790*b* can be biased toward the "closed" position in which outer door 1790*b* supports inner door 1790*a* when the suction motor of handheld vacuum cleaner 1720 is off, thereby preventing debris from falling out of a debris container of handheld vacuum cleaner 1720. However, since outer door 1790*b* includes an opening therethrough, when the suction motor of handheld vacuum cleaner 1720 is turned on, inner door 1790*a* can be pivoted upward (via suction induced by the suction motor) to allow air and debris to travel through the opening in the outer door 1790*b* to be collected by handheld vacuum cleaner 1720.

Although valves 1780, 1790 have been described above as being movable (for example, between open and closed positions) via mechanical actuators and mechanisms, in some variants, any or all of valves 1780, 1790 can be additionally or alternatively controlled by electronic means. For example, cleaning apparatus 1700 can be configured to allow for electronic control of valves 1780, 1790 via controls of handheld vacuum cleaner 1720 that may be utilized by a user. For example, a user may open and/or close valves 1780, 1790 by pressing a button or a portion of a user interface on handheld vacuum cleaner 1720. Such electronic controls can be in communication with and configured to cause any of the actuators described herein to move to open and/or close valves 1780, 1790, for example, regardless of the orientation (e.g., inclination) of wand 1703 and/or support member 1705 relative to cleaning head 1730 (or a surface on which cleaning head 1730 rests). Cleaning apparatus 1700 can include one or more motors to facilitate electro-mechanical operation of valves 1780, 1790 in such manner, for example, one or more motors in handheld vacuum cleaner 1720, one or more motors in wand 1703, and/or one or more motors in support member 1705. Such motor(s) can be coupled with any of the mechanical actuators and mechanisms described herein to facilitate such operation.

Cleaning head 1730, support member 1705, wand 1703, handheld vacuum cleaner 1720, and floor-based vacuum cleaner 1710 can be electrically connectable to one another via one or more electrical connectors to facilitate electrical communication and/or power. For example, in some implementations in which cleaning apparatus 1700 includes a power cord 1701 connected to handheld vacuum cleaner 1720, electrical power can be provided from handheld vacuum cleaner 1720 to floor-based vacuum cleaner 1710 and/or cleaning head 1730 (for example, via wand 1703 and/or support member 1705) to allow control of any electrical components of floor-based vacuum cleaner 1710 and/or cleaning head 1730 (such as a suction motor of floor-based vacuum cleaner 1710). In some variants, cleaning apparatus 1700 does not include a cord 1701, and in such variants, any of handheld vacuum cleaner 1720, floor-based vacuum cleaner 1710, and/or cleaning head 1730 include a battery. Handheld vacuum cleaner 1720 can include a controller and/or input device (similar or identical to controller 327, input device 328) which can allow control of handheld vacuum cleaner 1720 (for example, a suction motor thereof), floor-based vacuum cleaner 1710 (for example, a suction motor thereof), and/or cleaning head 1730 (for example, a motor and/or agitator thereof). Such implementations can allow suction motors of handheld vacuum cleaner 1720 and floor-based vacuum cleaner 1710 to be operated (for example, turned "on" or "off") to facilitate any of the various operational modes described herein. In some implementations, handheld vacuum cleaner 1720 includes a battery and is removably connectable to cord 1701 so as to allow cleaning apparatus 1700 to be operated with cord 1701 connected and/or disconnected. In the disconnected state of such implementation, cleaning apparatus 1700 (or any portion thereof) may derive electrical power from such battery in handheld vacuum cleaner 1720 and/or a battery in floor-based vacuum cleaner 1710. Any of such batteries may be charged via cord 1701. Such implementations can advantageously allow for convenient operation of cleaning apparatus 1700 without cord 1701 attached.

Figure 18A:
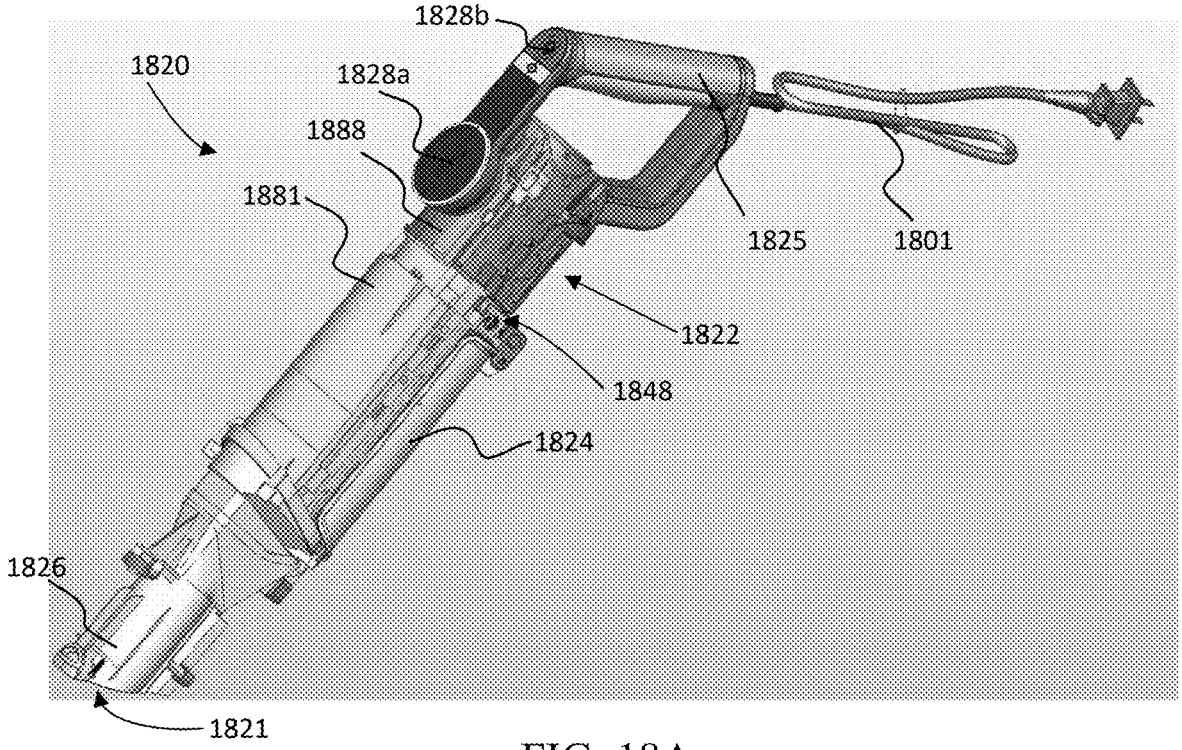
FIGS. 18A-18U illustrate various views of another implementation of a handheld vacuum cleaner and portions thereof in accordance with aspects of this disclosure.
Figure 18B:
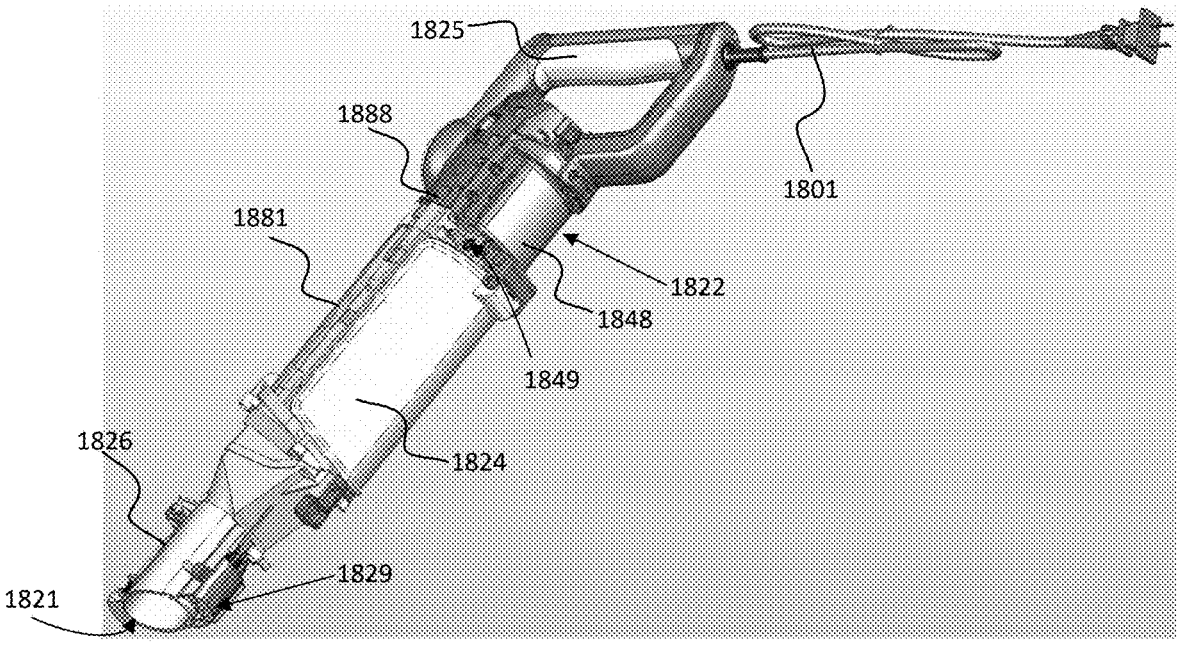
FIG. 18V illustrates a table showing various schematic representations and enlarged views of portions of a cleaning apparatus in different modes of operation in accordance with aspects of this disclosure.
FIGS. 18W-18EE illustrate various views of portions of the handheld vacuum cleaner of FIGS. 18A-18U in accordance with aspects of this disclosure.
Figure 18C:
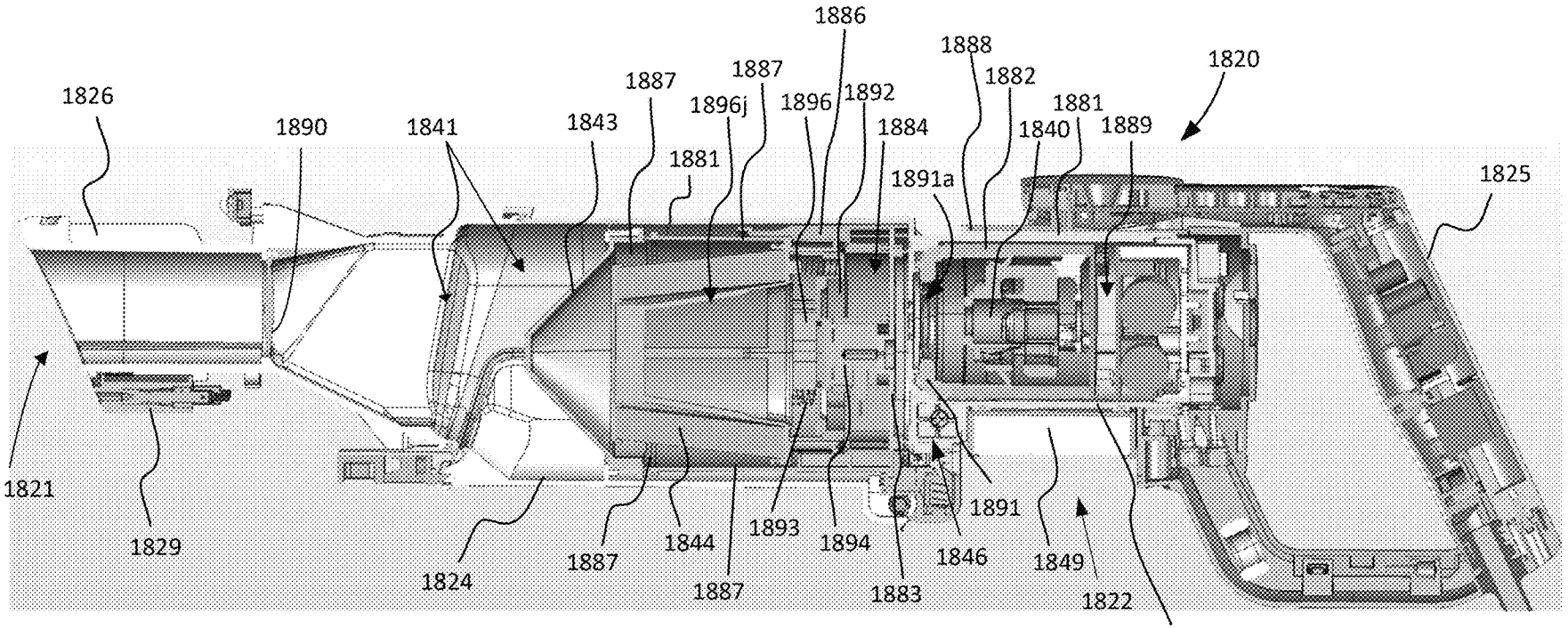
Figure 18D:
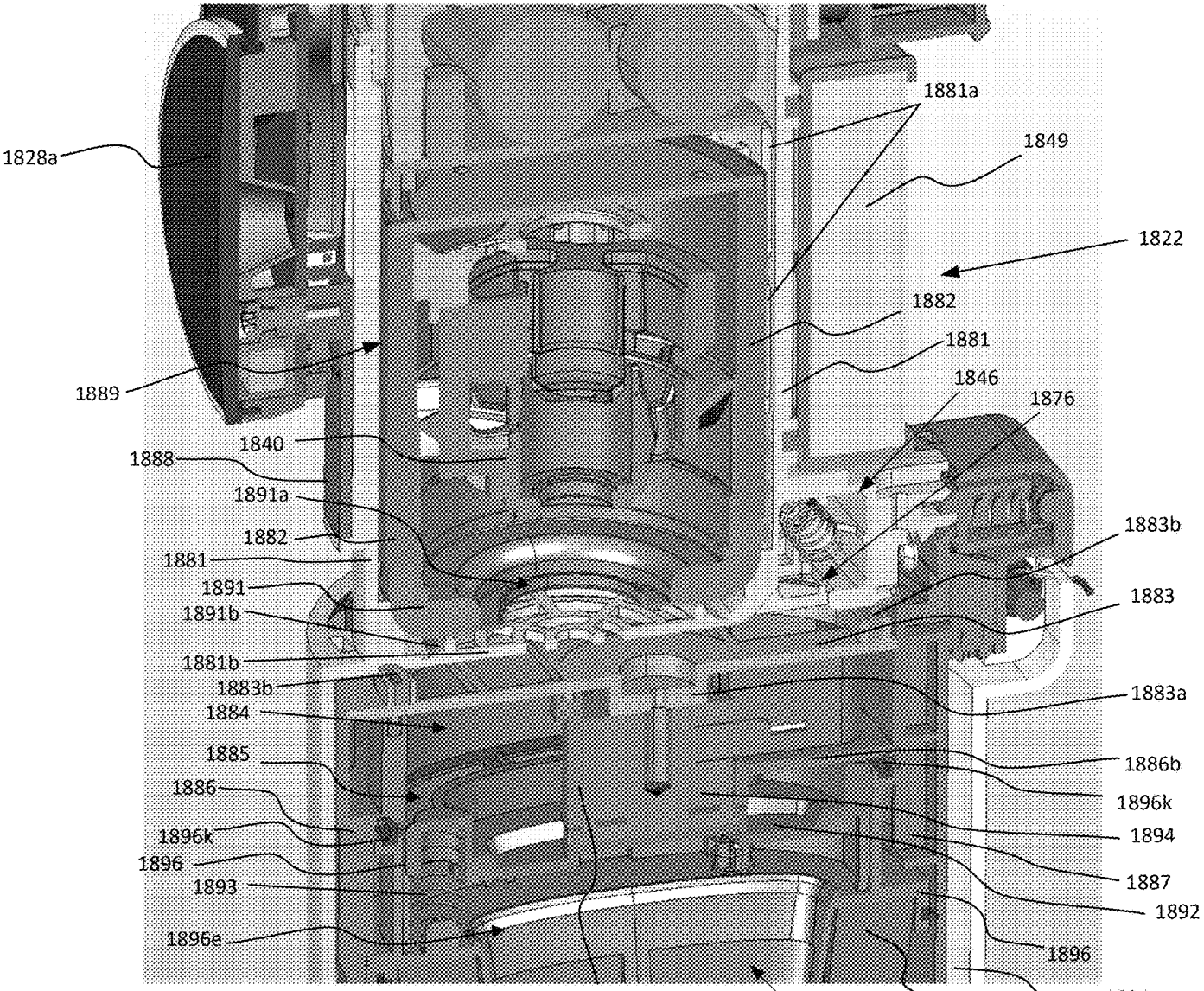
Figure 18F:
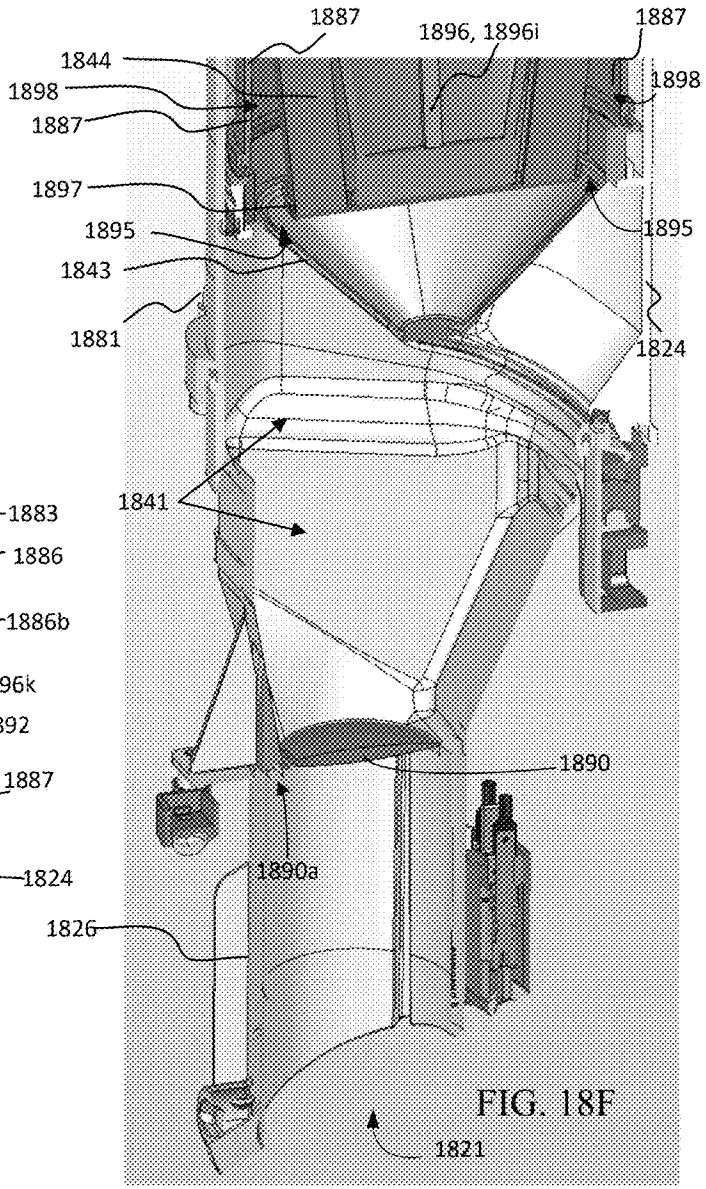
Figure 18E:
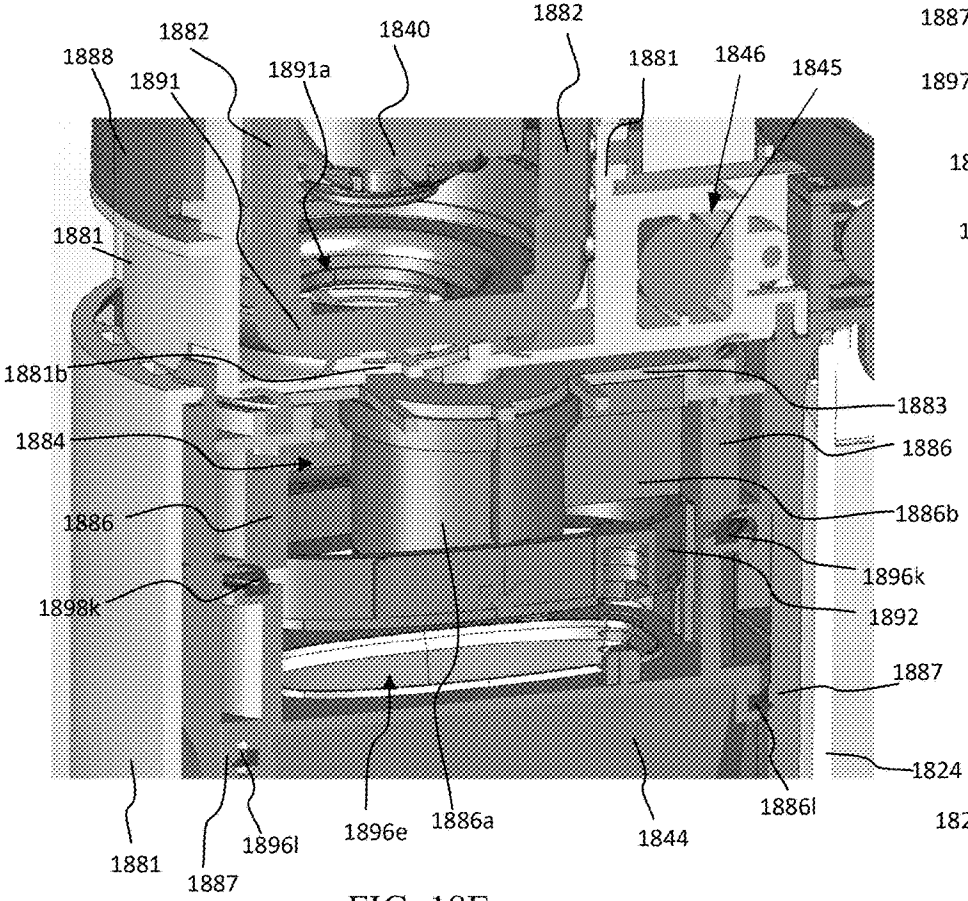

FIGS. 18A-18B illustrate perspective views of another implementation of a handheld vacuum cleaner 1820 and FIG. 18C illustrates a cross-section through handheld vacuum cleaner 1820. Handheld vacuum cleaner 1820 can include any of the features described with respect to other handheld vacuum cleaners disclosed herein. Handheld vacuum cleaner 1820 can be part of a cleaning apparatus that is similar to any of the cleaning apparatuses disclosed herein. For example, handheld vacuum cleaner 1820 can be part of cleaning apparatus 1800 shown and described with respect to FIG. 18Y. With reference to FIG. 18Y, handheld vacuum cleaner 1820 can be coupled with a wand 1803, a support member 1805, a floor-based vacuum cleaner 1810, and/or a cleaning head 1830, each of which can be similar or identical in any respect to any of the wands, support members, floor-based vacuum cleaners, and cleaning heads disclosed herein (such as wand 1603, 1703, support member 1605, 1705, floor-based vacuum cleaner 1610, 1710, cleaning head 1630, 1730). Handheld vacuum cleaner 1820 can be utilized along with wand 1803, support member 1805, floor-based vacuum cleaner 1810, and/or cleaning head 1830 in any of a variety of operational modes, including the stick mode, auto-empty mode, and/or upright mode shown and described in more detail below with respect to FIG. 18Y.

With reference to FIGS. 18A-18B, handheld vacuum cleaner 1820 can include a dirty air inlet 1821, a snout 1826, a debris container door 1824, a clean air outlet 1822, a handle 1825, a display 1828*a*, one or more controls 1828*b* (such as a button), and a power cord 1801. Control(s) 1828*b* can be utilized for turning handheld vacuum cleaner 1820 (and/or another portion of cleaning apparatus 1800) "on" or "off" and/or utilized for other functions. Display 1828*a* can be configured to display any of a variety of information relating to handheld vacuum cleaner 1820 and/or cleaning apparatus 1800, for example, whether cleaning apparatus 1800 is "on"/"off", a current operational mode (for example, stick, auto-empty, or upright mode), status message(s) (for example, fill level of debris containers of handheld vacuum cleaner 1820 or floor-based vacuum cleaner 1810, electrical and/or mechanical connection status of handheld vacuum cleaner 1820, floor-based vacuum cleaner 1810, wand 1803, support member 1805, and/or cleaning head 1830), among other things. Handheld vacuum cleaner 1820 can include a controller that can be similar or identical to controller 327 described elsewhere herein. As shown in FIG. 18B, handheld vacuum cleaner 1820 can include an electrical connector 1829 to allow electrical communication with and/or power transmission to wand 1803, and any other component of cleaning apparatus 1800, for example, via wand 1803 (for example, support member 1805, floor-based vacuum cleaner 1810, and/or cleaning head 1830).

With reference to FIG. 18C, handheld vacuum cleaner 1820 can include a debris container door 1824, a mesh filter 1843 (which may also be referred to as a "fluff screen"), a pre-motor filter 1844 (for example, a radial filter), a suction motor 1840 (which can be similar or identical to any of the other suction motors disclosed herein), a post-motor filter 1849 (for example, a HEPA filter) proximate clean air outlet 1822, and/or a debris container 1841 (which may also be referred to as "debris containing region" or "debris chamber"). Any of such components, along with others, can be arranged in various portions of an interior of handheld vacuum cleaner 1820 as shown. Debris container 1841 may be defined by one or more interior portions of handheld vacuum cleaner 1820 (which may be at least partially formed by debris container door 1824). Filter 1843, filter 1844, and/or other components (for example, filter support 1896, filter cap 1897, structural component 1887, and/or other components) may form a debris separator that separates debris from air flowing through handheld vacuum cleaner 1820. Handheld vacuum cleaner 1820 can include one or a plurality of structural components that help form such interior along with any of the various flow passages described herein (for example, with respect to any of the operational modes shown and/or described herein). For example, handheld vacuum cleaner 1820 can include structural members 1881, 1886, 1887, 1888 that can at least partially form one or more interior regions of handheld vacuum cleaner 1820 and/or can help support, enclose, and/or operably position various components of handheld vacuum cleaner 1820 (see FIGS. 18A-18F). With reference to FIGS. 18C-18D, motor 1840 can be coupled with an air-permeable membrane 1882 (for example, comprising a foam material), and motor 1840 and membrane 1882 can be arranged within an interior region 1889 of handheld vacuum cleaner 1820 (which may be at least partially defined by structural component 1881). Interior region 1889 can be in fluid communication with clean air outlet 1822 (and thus ambient) via one or a plurality of vents 1881*a* in structural component 1881 (see FIG. 18D). Membrane 1882 can include an interior that surrounds a portion of motor 1840 and can be coupled to a motor casing 1891 (see FIGS. 18D-18E) and interior region 1889 can be in fluid communication with such interior since membrane 1882 is air permeable. Structural component 1881 can include an inner wall having one or more openings, for example, a grill 1881*b*, which can be in fluid communication with an interior region 1884 of handheld vacuum cleaner 1820 (see FIGS. 18D-18E). Grill 1881*b* can be arranged below an opening 1891*a* of motor casing 1891 as shown. Motor casing 1891 can include a seal member 1891*b* that surrounds opening 1891*a*, grill 1881*b*, and contacts the inner wall of structural component 1881 which grill 1881*b* is formed, thereby sealing around the flow passage through/between such components. Interior region 1884 may be at least partially defined by structural component 1886. As shown in FIG. 18D, handheld vacuum cleaner 1820 can include a frame 1883 connected to a portion of structural component 1886 and having a plurality of openings that provide access to interior region 1884. Frame 1883 can include a seal member 1883*b* that can surround the openings in frame 1883, grille 1881*b*, and contact the inner wall of structural component 1881 in which grill 1881*b* resides, thereby sealing around the flow passage through/between such components. With continued reference to FIG. 18D, when valve 1892 is in an open position (described in more detail elsewhere herein), interior region 1884 can be in fluid communication with opening 1896*e* in filter support 1896 (and filter interior 1844*c*) via a gap 1885 which allows air to flow around valve 1892. Air flowing through opening 1896*e* and filter interior 1844*c* can flow through a wall of filter 1844, in interior region 1898 (which may be defined between filter 1844 and structural component 1887), and through a gap/spacing 1885 between filter 1843 and filter 1844 and/or cap 1897 (see FIG. 18F). Air can flow through filter 1843 and debris container 1841 from either direction, depending on the operational mode (for example, stick mode or auto-empty mode). FIG. 18F also illustrates valve 1890 in an example closed position. Valve 1890 can be opened to allow airflow through dirty air inlet 1821 from either direction, depending on the operational mode as described in more detail below. With reference to FIGS. 18D-18E, filter support 1896 can include a seal member 1896*k* that can contact and form a seal with portions of structural component 1886 and a seal member 1896L that can contact and form a seal with portions of structural component 1887. Although not shown, handheld vacuum cleaner 1820 may include one or more additional housing cover portions that enclose or surround portions of that which is illustrated in FIGS. 18A-18B, such as any of cover portions 2223*a*-2223*g* shown and/or described with respect to FIGS. 22A and 22C. Additionally, handheld vacuum cleaner 1820 may include a grill and/or vent(s) at clean air outlet 1822, similar or identical to those illustrated with reference to handheld vacuum cleaner 1620, 1720.

FIGS. 18D-18E illustrate perspective, cross-sectional views taken through portions of handheld vacuum cleaner 1820. Structural component 1886 can at least partially define interior region 1884 (for example, along with frame 1883, structural component 1881, and grill 1881*b*) and can at least partially surround valve 1892 and an electromagnet 1894. Structural component 1886 can be configured to receive, secure, and/or operably position electromagnet 1894. With reference to FIG. 18E, which shows a partial cross-section taken through handheld vacuum cleaner 1820, structural component 1886 can include a socket 1886*a* that receives, secures, and/or operably positions electromagnet 1894 (see also FIG. 18D). Socket 1886*a* and/or electromagnet 1894 can have a corresponding shape (for example, cylindrical shape). Structural component 1886 can include an arm 1886*b*, extending from portion of structural component 1886 (for example, a perimeter portion) and connecting to socket 1886*a*. Electromagnet 1894 can be couple with one or more wires which can be enclosed and/or operably positioned by portion(s) of structural component 1886 (for example, within arm 1886*b* as shown in FIG. 18D). Such wiring can be in electrically communication with a controller and/or power cord 1801 of handheld vacuum cleaner 1820 via direct and/or indirect electrical connection. With reference to FIG. 18D, frame 1883 can include a protruding portion 1883*a* that extends into socket 1886*a*. FIGS. 18D-18E also illustrate filter support 1896 and filter 1844, each of which are described in more detail below along with valve 1892. FIG. 18F illustrates another cross-sectional view taken through a portion of handheld vacuum cleaner 1820, illustrating, among other things, debris container 1841, valve 1890, snout 1826, dirty air inlet 1821, structural components 1881, 1887, filter 1844, filter support 1896, and gap/spacing 1885 between cap 1897 and filter 1844 and filter 1881. Valve 1890 can be similar to other valves disclosed herein (such as valve 1390). Valve 1890 can comprise a flexible member that is pivotably connected to a portion of handheld vacuum cleaner 1820 and arranged within an interior of handheld vacuum cleaner 1820, for example, proximate dirty air inlet 1821. Valve 1890 can be configured to inhibit debris from falling out of debris container 1841 when handheld vacuum cleaner 1820 is not in use (for example, during an upright mode or when handheld vacuum cleaner 1820 is "off"). Valve 1890 can extend across a flow passage when handheld vacuum cleaner 1820 is not in use. Although FIG. 18F illustrates valve 1890 connected at pivot connection point 1890*a* to a top portion/side of handheld vacuum cleaner 1820, valve 1890 can be connected opposite such location (for example, at a location that is diametrically opposed to the location of connection point 1890*a* with reference to a cross-section taken through snout 1826). For example, valve 1890 can be connected to a bottom portion/side of handheld vacuum cleaner 1820 that is configured to be vertically lower when handheld vacuum cleaner 1820 is in use (for example, held by a user and used alone or with wand 1803 and cleaning head 1830 such as in a stick mode). Valve 1890 can be pivotably connected as shown and/or described with respect to FIGS. 20A-20B. such variants can allow valve 1890 to catch debris from falling out of dirty air inlet 1821 when handheld vacuum cleaner 1820 transitions from a stick mode (such as that described herein) and a mode in which valve 1890 blocks flow through dirty air inlet 1821 (for example, an upright mode or a mode in which cleaning apparatus is off).

Figure 18H:
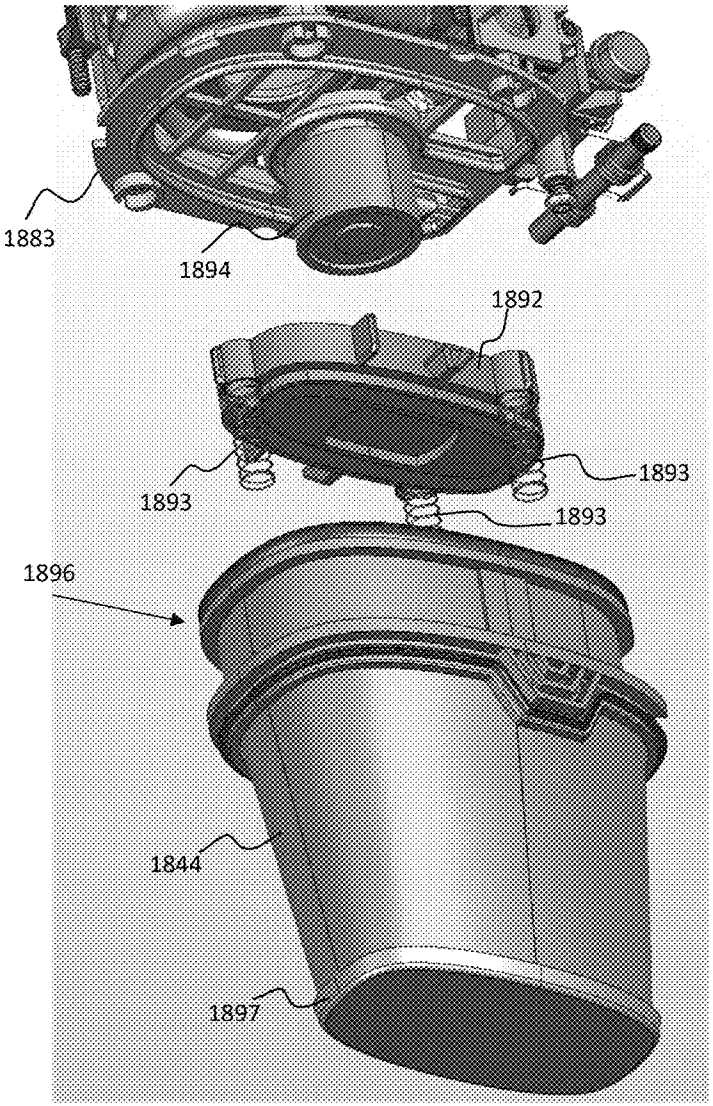
Figure 18G:
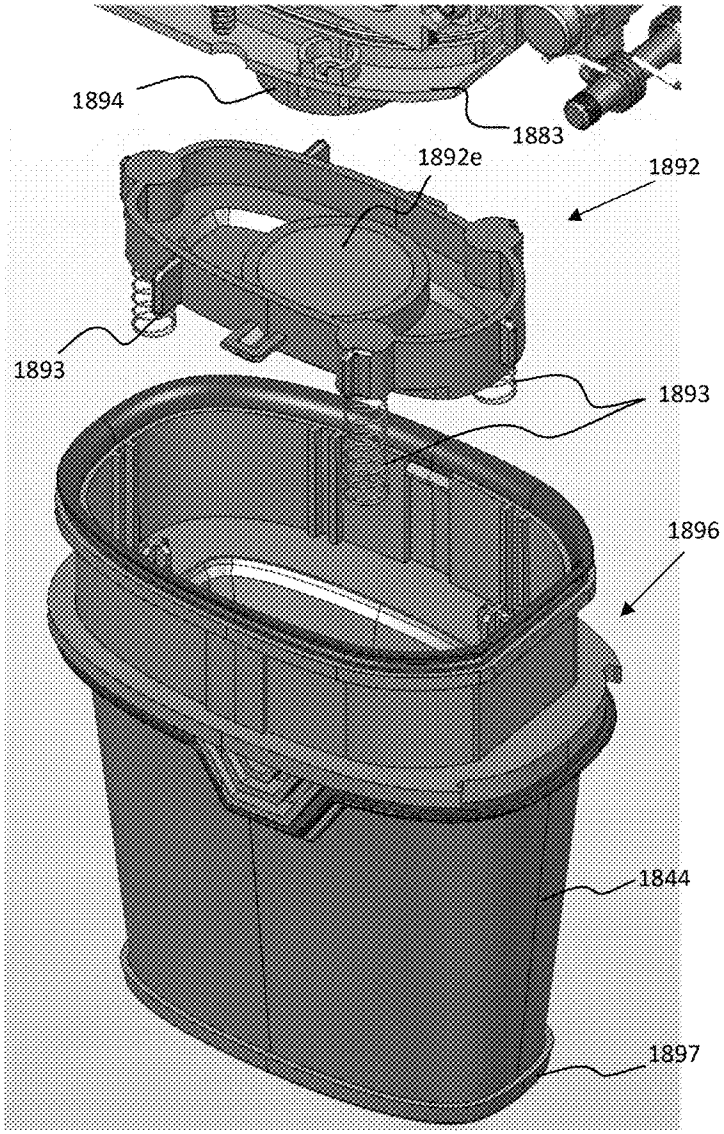

FIGS. 18G-18H illustrate partially exploded perspective views of a portion of handheld vacuum cleaner 1820 with various components removed to better illustrate valve 1892, electromagnetic 1894, filter support 1896, filter 1844, and frame 1883.

Figure 18I:
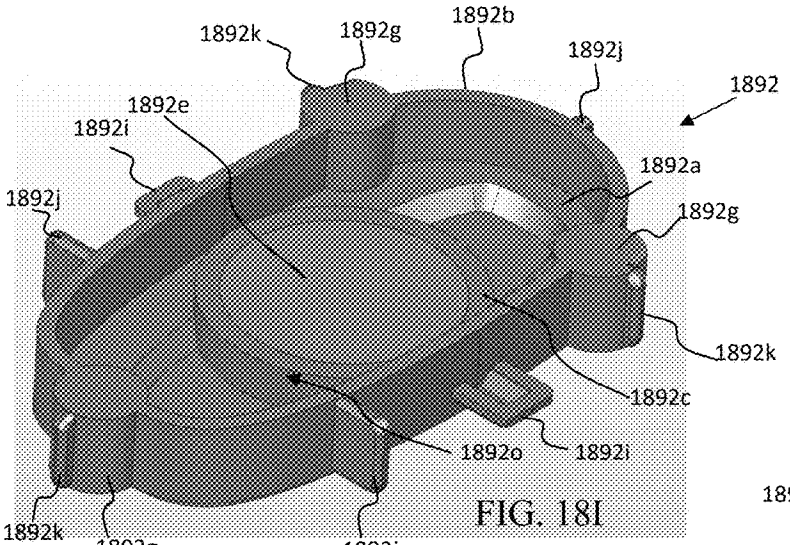
Figure 18J:
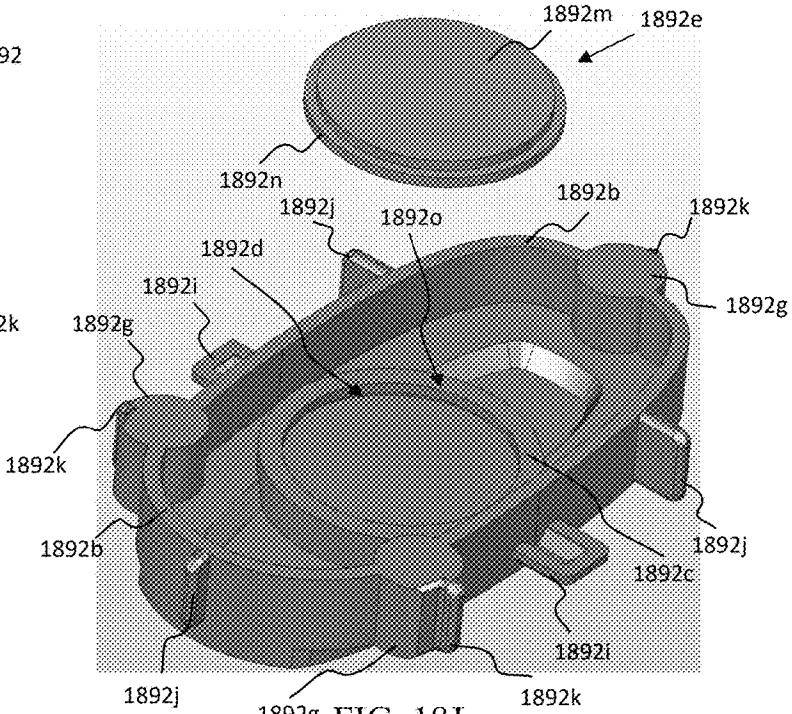
Figure 18L:
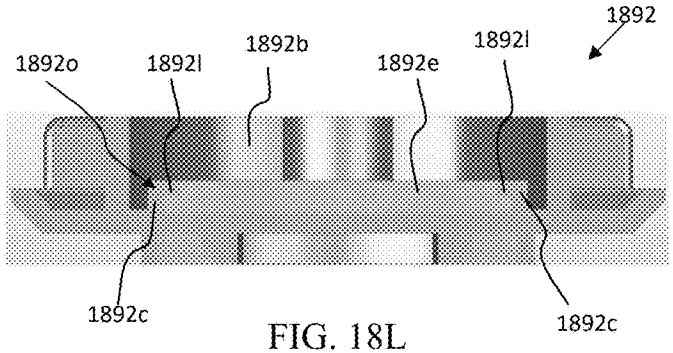
Figure 18K:
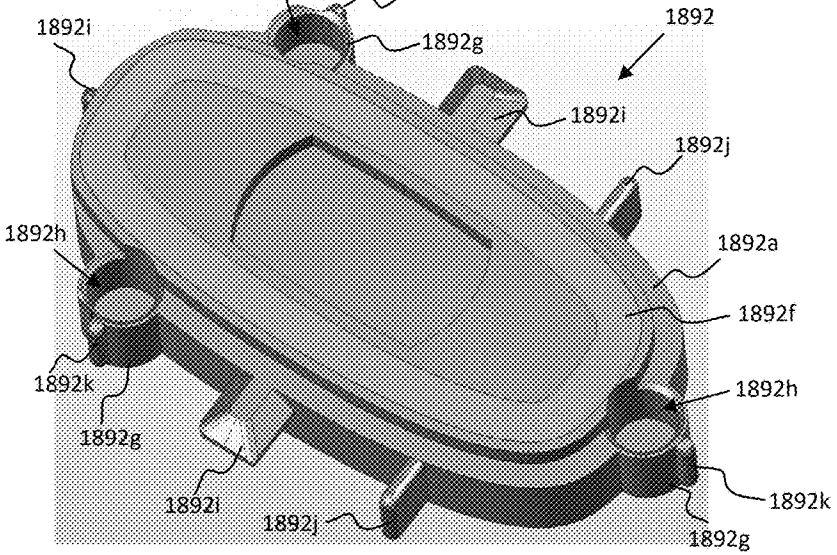

FIGS. 18I-18J illustrates top perspective views of valve 1892, with FIG. 18J illustrating magnet 1892*e* spaced from other portions of valve 1892. Magnet 1892*e* advantageously allows valve 1892 to be moved and/or held in place by electromagnet 1894, as described in more detail below. Valve 1892 can include a base 1892*a*, a wall 1892*b* extending outward from base 1892*a* (for example, along all or a portion of a perimeter of base 1892*a*), magnet 1892*e*, and a magnet holder 18920 arranged on and/or extending from base 1892*a*. Such magnet holder 18920 can be sized and/or shaped to secure magnet 1892*e* in place. Such magnet holder 18920 can be formed from an inner wall 1892*c* (for example, having a cylindrical shape) having a lip 18921 (for example, at an end and/or top portion thereof) that receives a rim portion 1892*n* of magnet 1892*e* which extends outward and/or around an inner portion 1892*m* of magnet 1892*e* (see FIGS. 18J-18L). Wall 1892*c* can define a cavity 1892*d* for receiving magnet 1892*e* (see FIG. 18J). In some implementations, magnet 1892*e* is molded with other portions of valve 1892 (such as base 1892*a*, wall 1892*b*, and/or inner wall 1892*c*) which comprise a different material. Magnet 1892*e* can comprise any of a variety of magnetic materials. Magnet 1892*e* can be secured to base 1892*a* and/or magnet holder 18920 such that magnet 1892*e* is not movable relative to either of such components. Such implementations advantageously allow valve 1892 to move with magnet 1892*e* via magnetic attraction to electromagnet 1894, which can facilitate an auto-empty mode of operation as described below. Valve 1892 can include guide protrusions 1892*j*, 1892*k*, and/or guide arms 1892*i*, the function of which is described in more detail below. Valve 1892 can include spring chambers 1892*g* including cavities 1892*h* for receiving portions or springs 1893 as described further below. Any or all of guide protrusions 1892*j*, 1892*k*, guide arms 1892*i*, and/or spring chambers 1892*g* may be arranged along a perimeter of valve 1892, for example, connected to and/or extending from wall 1892*b*. As shown, guide protrusions 1892*k* can be arranged on spring chambers 1892*g*. With reference to FIG. 18K (which shows a bottom perspective view of valve 1892), valve 1892 can include a seal member 1892*f* for sealing an opening of filter support 1896 (for example, opening 1896*e*) and/or an opening of filter 1844 (for example, opening 1844*a*) when valve 1892 is in a closed position (described in more detail below). Seal member 1892*f* can create a seal around any of such openings, for example, when contacting a surface 1896*d* of filter support 1896 (see FIGS. 18M-18N). In some implementations, filter support 1896 includes a skirt wall that extends outward from surface 1896*d* and around opening 1896*e*, and such skirt wall engages seal member 1892*f* when valve 1892 is in a closed position. Seal member 1892*f* can comprise an annular shape in some implementations. Seal member 1892*f* may be made of a flexible and/or resilient material. Seal member 1892*f* can be arranged on an opposite side of valve 1892 than magnet 1892*e* (for example, a "bottom" side of valve 1892). Although valve 1892 has been described above as including magnet 1892*e* connected with other portions of valve 1892 (base 1892*a*, wall 1892*b*), valve 1892 can be configured in a variety of ways to allow magnetic interaction with electromagnet 1894 (described elsewhere herein). In some implementations, base 1892*a*, wall 1892*b* and/or any or all portions of valve 1892 (other than magnet 1892*e*) can comprise a material that is non-magnetic. Any or all other portions of valve 1892 other than magnet 1892*e* can comprise, for example, a plastic material.

Figure 18N:
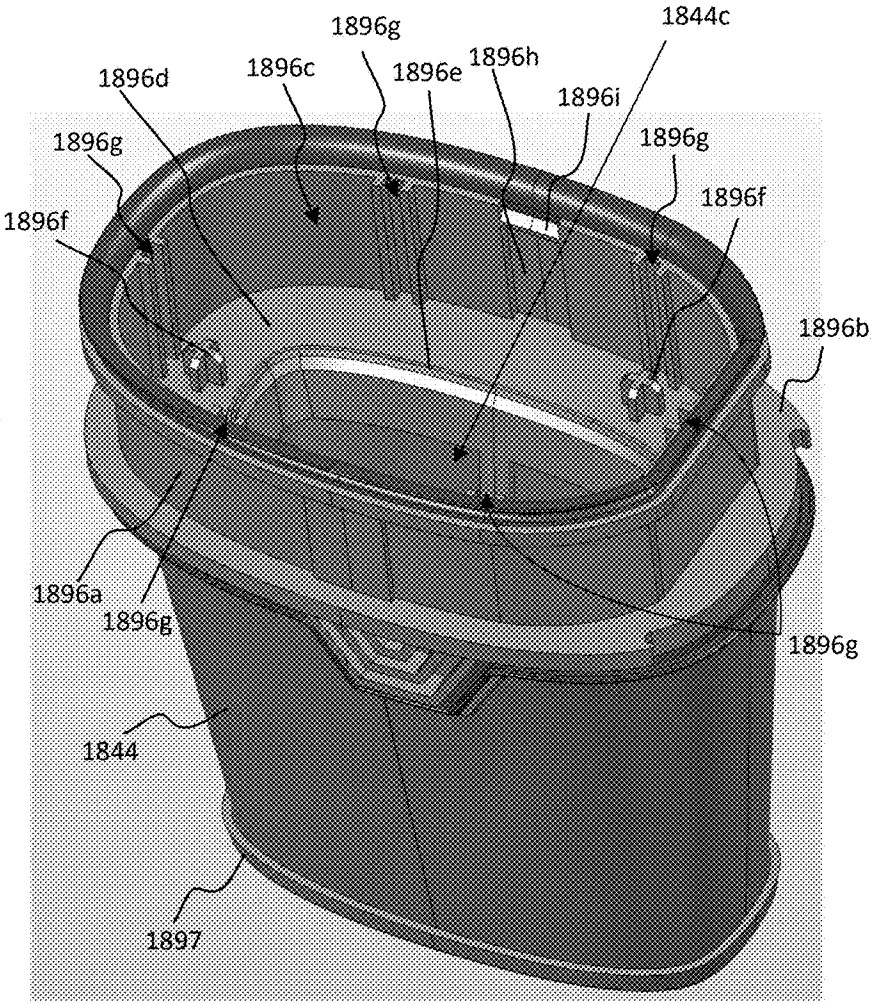
Figure 18M:
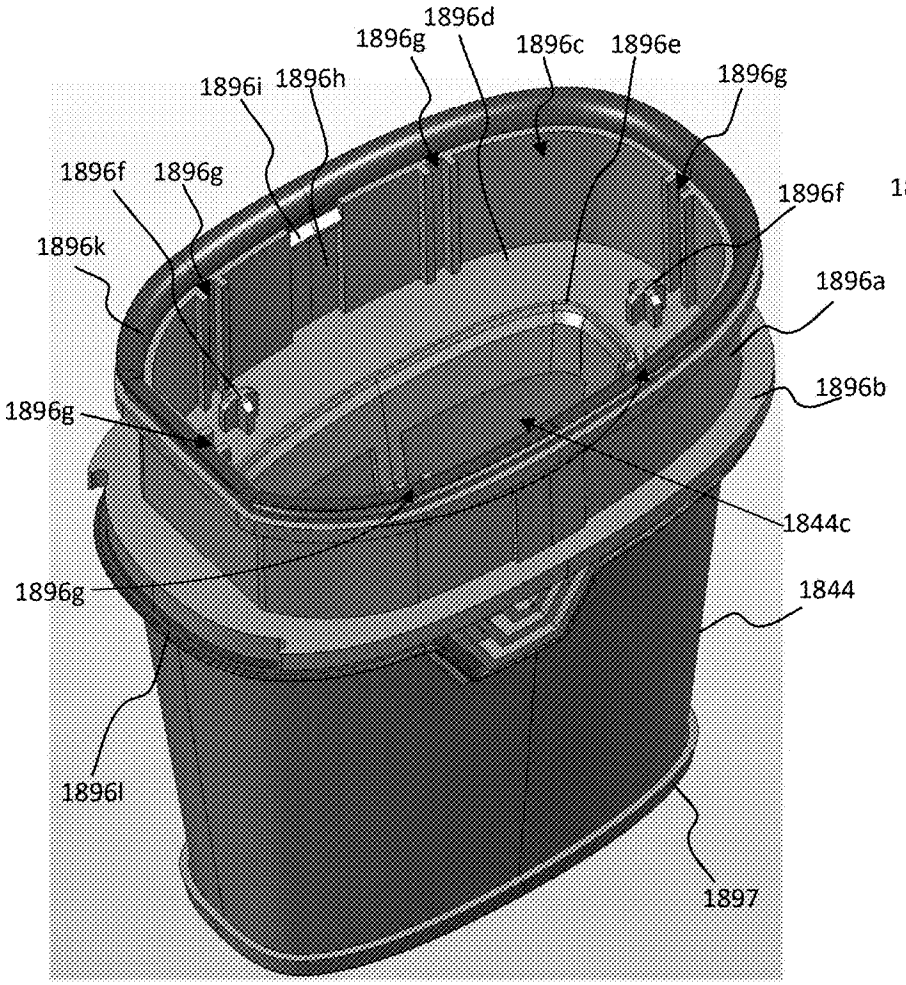
Figure 18P:
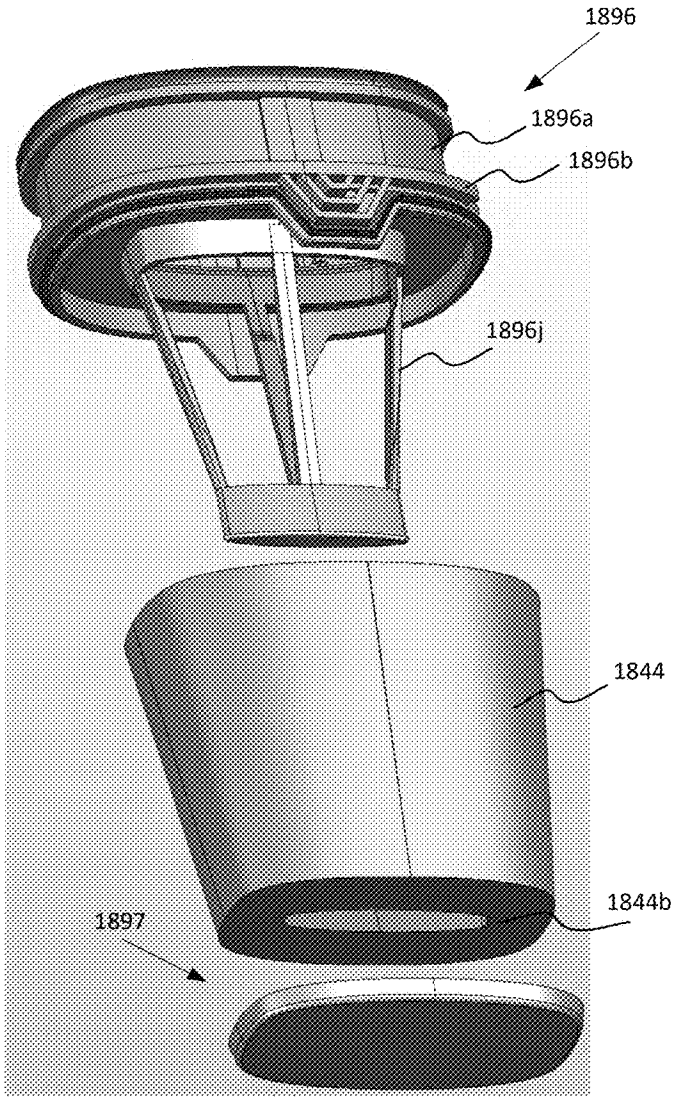
Figure 18O:
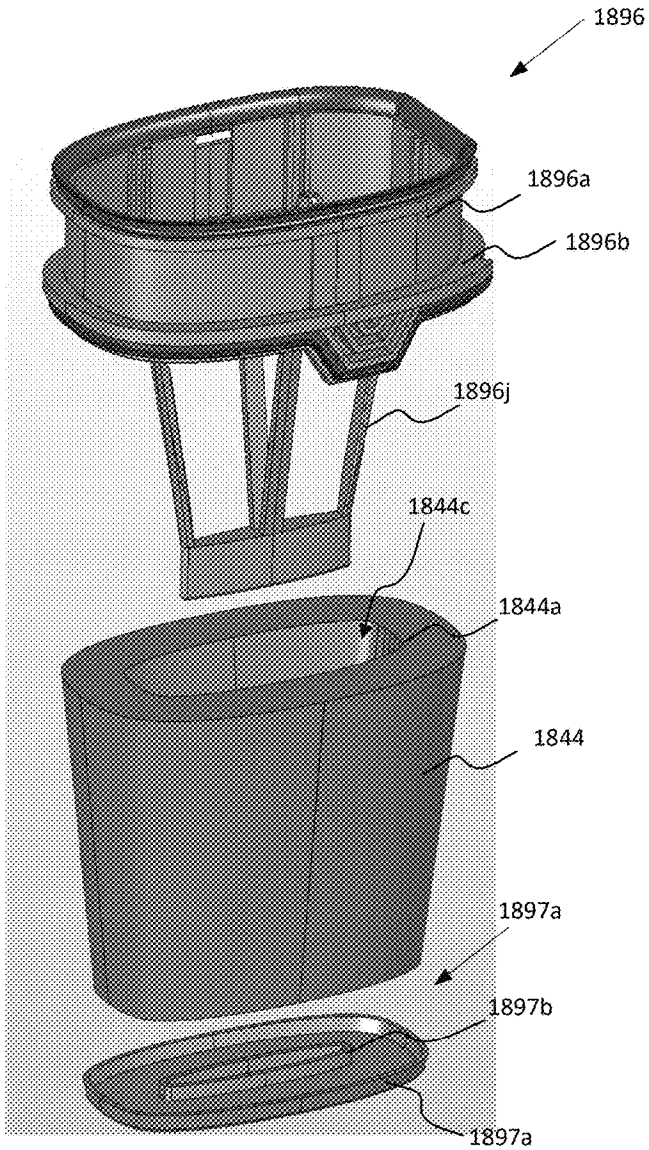

FIGS. 18M-18N illustrate filter 1844, filter support 1896, and filter cap 1897 connected to one another while FIGS. 180-18P illustrate such components disconnected from one another. Filter 1844, filter support 1896, and filter cap 1897 may form a filter assembly when connected to one another (which may be referred to as a "pre-motor filter assembly"). Filter 1844 (which may be referred to as a "pre-motor filter") can comprise a frustoconical shape, among others. Filter 1844 can be a radial filter. Filter 1844 can comprise any of a variety of materials that filter debris (for example, fine debris) from air. Filter 1844 may be a pleated filter. Filter 1844 can be formed from a wall including openings 1844*a*, 1844*b* that provide access to an interior 1844*c* of filter 1844, and openings 1844*a*, 1844*b* may be arranged at opposite ends of filter 1844 (see FIGS. 180-18P). Filter cap 1897 can include a base 1897*a* and a protrusion 1897*b* that extends from base 1897*a* and is sized and/or shaped to fit within and/or through opening 1844 (into a portion of interior 1844*c*). Cap 1897 can block and/or cover opening 1844*b*.

Filter support 1896 can connect to and provide support for filter 1844. With reference to FIGS. 18M-18N, filter support 1896 can include a wall 1896*a*, a base 1896*b*, an opening 1896*e* in base 1896*b*. Wall 1896*a* can extend outward from base 1896*b* and around opening 1896*e*. Wall 1896*a* and base 1896*a* can define an interior 1896*c* for receiving valve 1892, as shown in at least FIGS. 18Q-18R. In some implementations, wall 1896*a* is spaced inward from an exterior perimeter of base 1896*b* (see FIGS. 18M-18N). As shown in FIGS. 180-18P, filter support 1896 can include a frame 1896*j* extending from base 1896*b* and configured to fit within interior 1844*c* of filter 1844 to secure filter 1844 to filter support 1896.

Figure 18R:
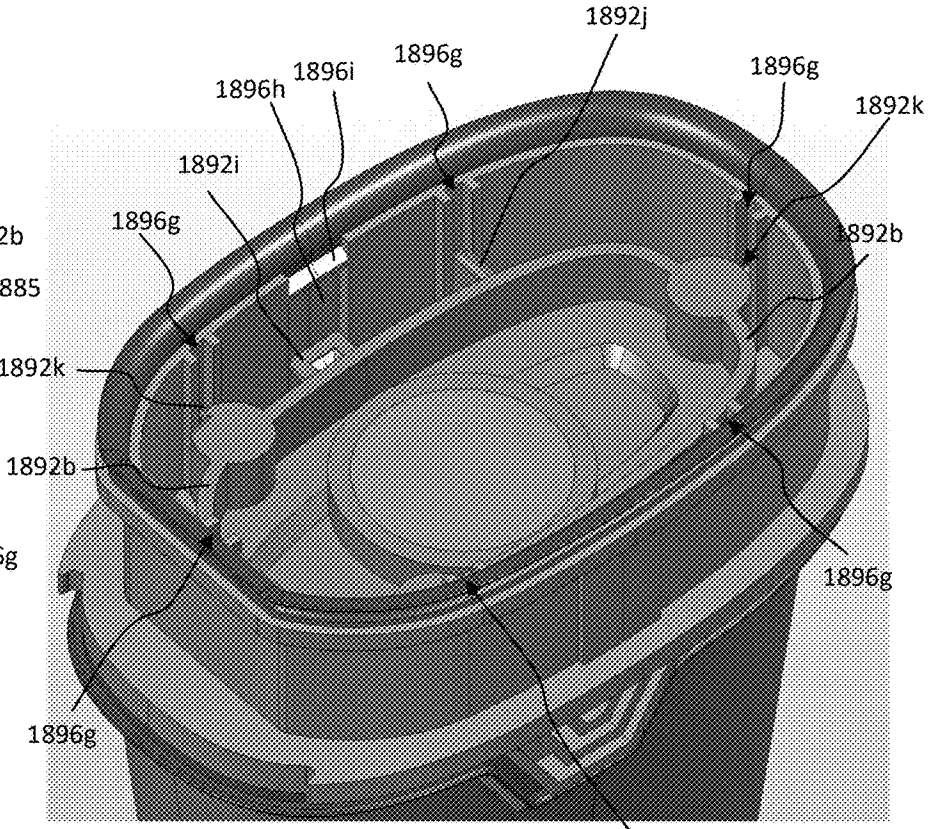
Figure 18Q:
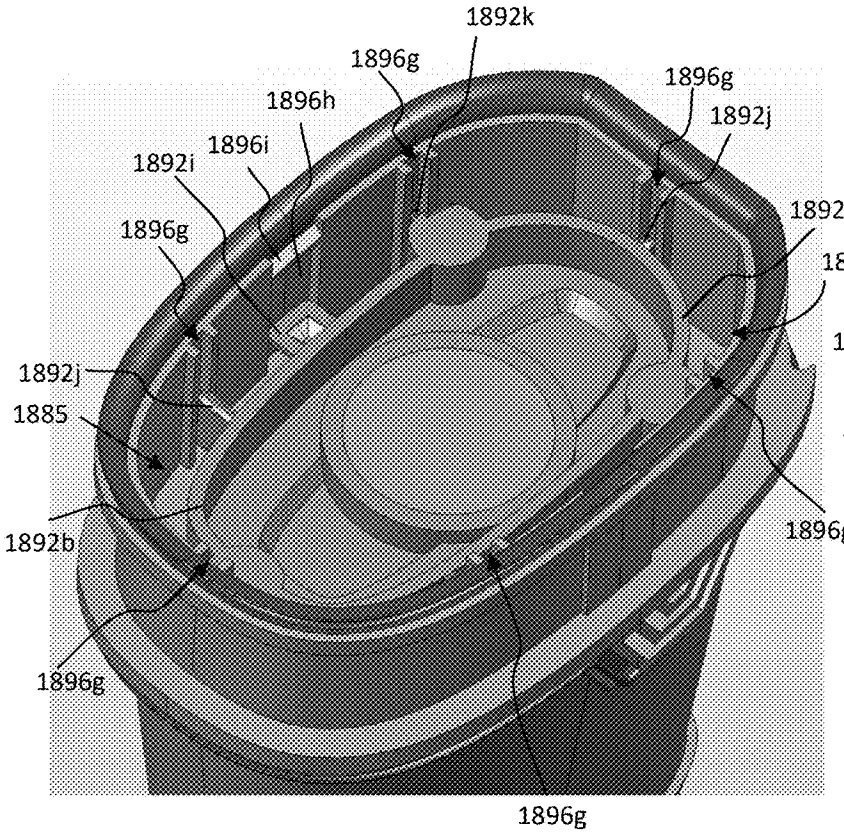

Filter support 1896 can include one or more features that allow valve 1892 to be movably coupled to filter support 1896 and to move relative to filter support 1896 and openings 1896*e*, 1844*a*, for example, to facilitate the various modes of operation described further below. As shown in FIGS. 18M-18N, filter support 1896 can include one or a plurality of channels 1896*g* formed by inner walls extending from an inner surface of wall 1896*a*, and such channel(s) 1896*g* can be configured to receive guide protrusions 1892*j*, 1892*k* of valve 1892 (see FIGS. 18Q-18R). As also shown, filter support 1896 can include one or both of recessed channels 1896*h* configured to receive guide arms 1892*i* of valve 1892 (see FIGS. 18M-18N and 18Q-18R). Channels 1896*g*, 1896*h* can be configured to allow movement of protrusions 1892*j*, 1892*k*, and arms 1892*i* when valve 1892 moves between a first position in which valve 1892 covers openings 1896*e*, 1844*a* (which may be referred to as a "closed position") to a second position in which valve 1892 is spaced from openings 1896*e*, 1844*a* (which may be referred to as an "open position"). In some implementations, filter support 1896 includes stops 1896*i* at an end of channels 1896*h* which can inhibit arms 1892*i* from exiting channels 1896*h* and in turn inhibit valve 1892 from disconnecting from filter support 1896. As also shown in FIGS. 18M-18N, filter support 1896 can include one or a plurality of posts 1896*f* for coupling and/or supporting springs 1893. Posts 1896*f* can be cross shaped, as shown. Posts 1896*f* can extend from a surface 1896*d* of base 1896*b*. With reference to FIGS. 18Q-18R, filter support 1896 and valve 1892 can be sized and/or shaped to allow air to flow around valve 1892 and through opening 1896*e* when valve 1892 is positioned away from opening 1896*e*, to facilitate an operational mode in which air flows through handheld vacuum cleaner 1820 (for example, stick mode or auto-empty mode). As shown in FIGS. 18Q-18R one or more gaps 1885 can exist between wall 1892*b* of valve 1892 and inner surfaces of wall 1896*a* of filter support 1896.

Figure 18S:
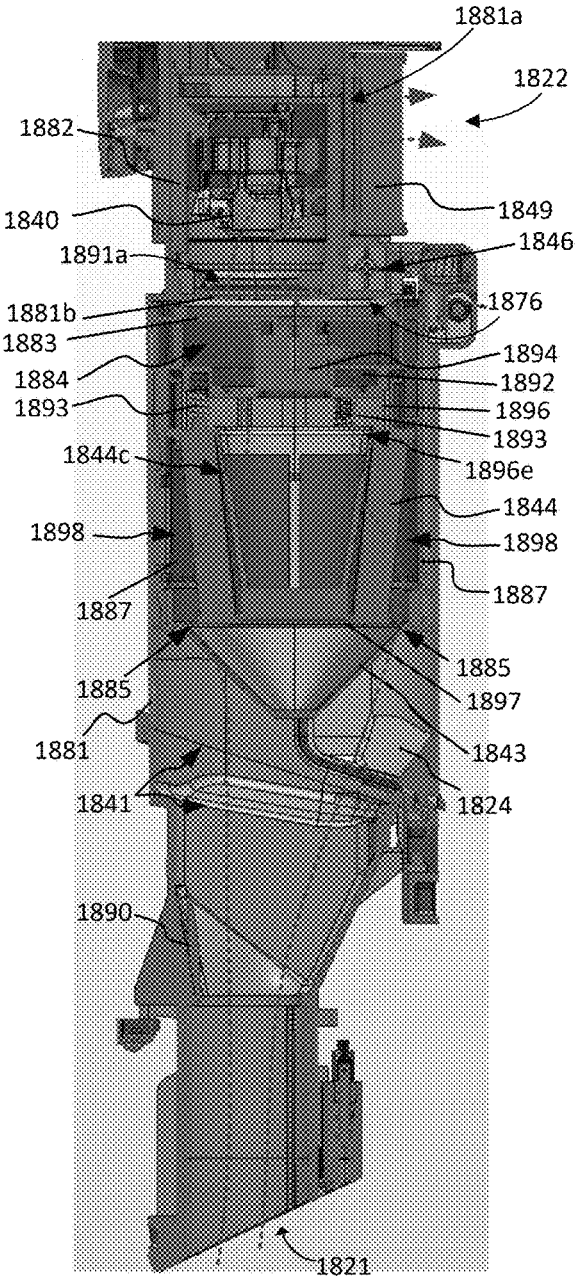
Figure 18T:
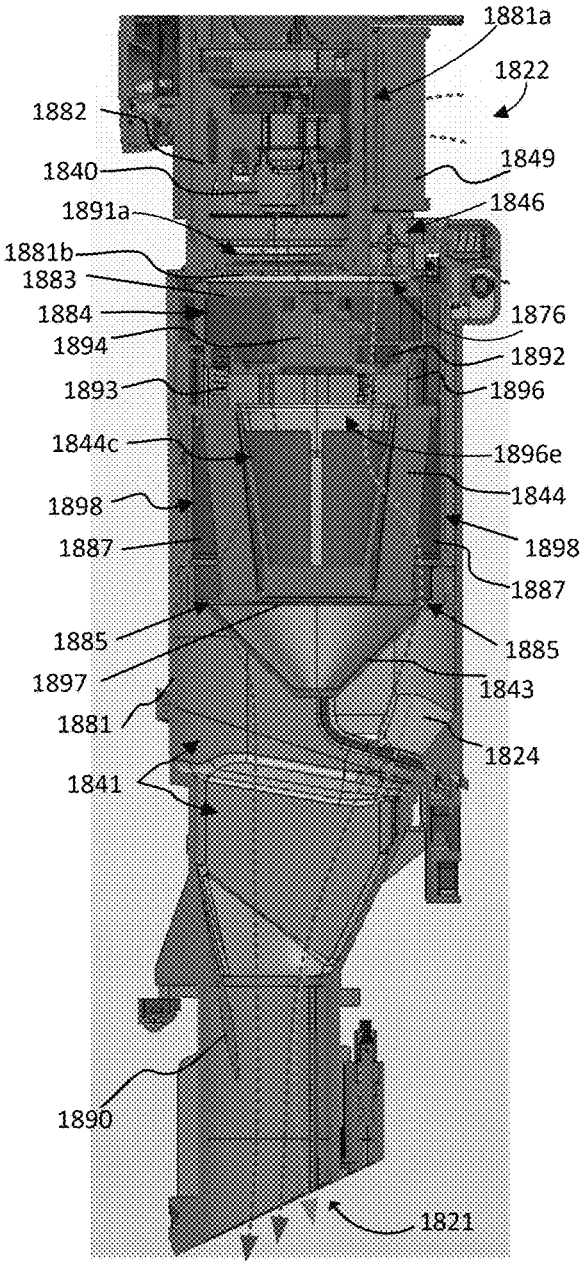
Figure 18U:
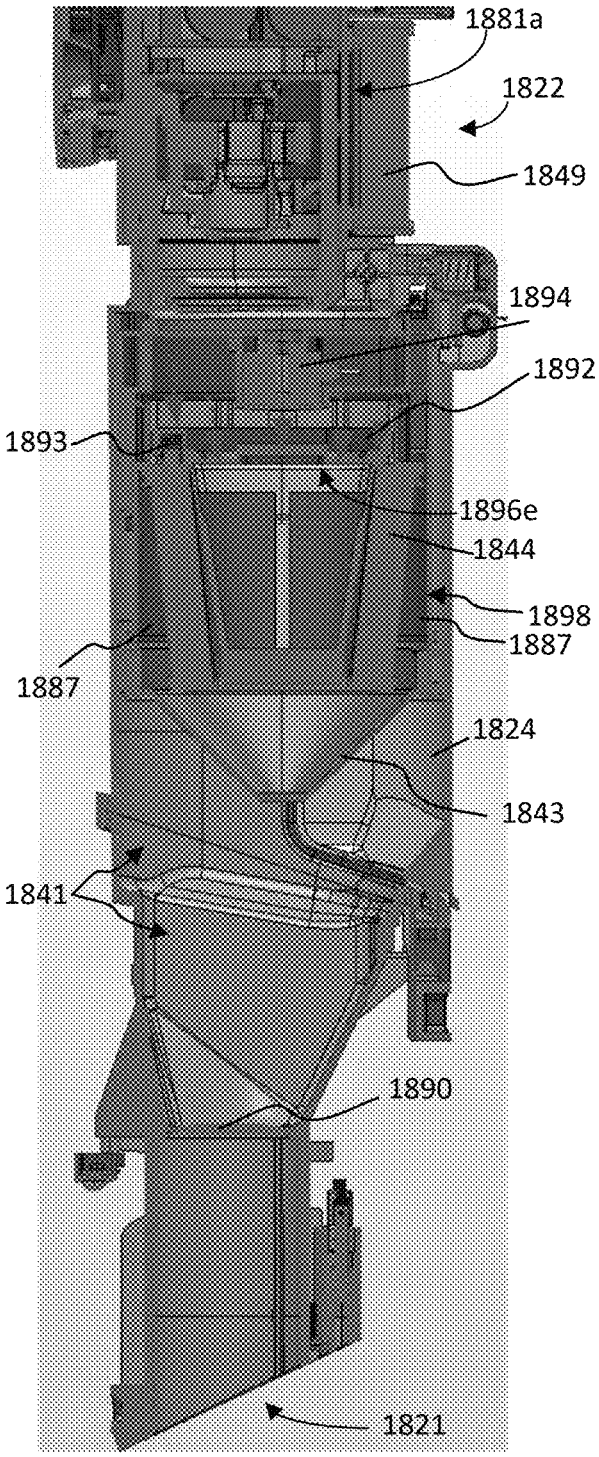
Figure 18V:
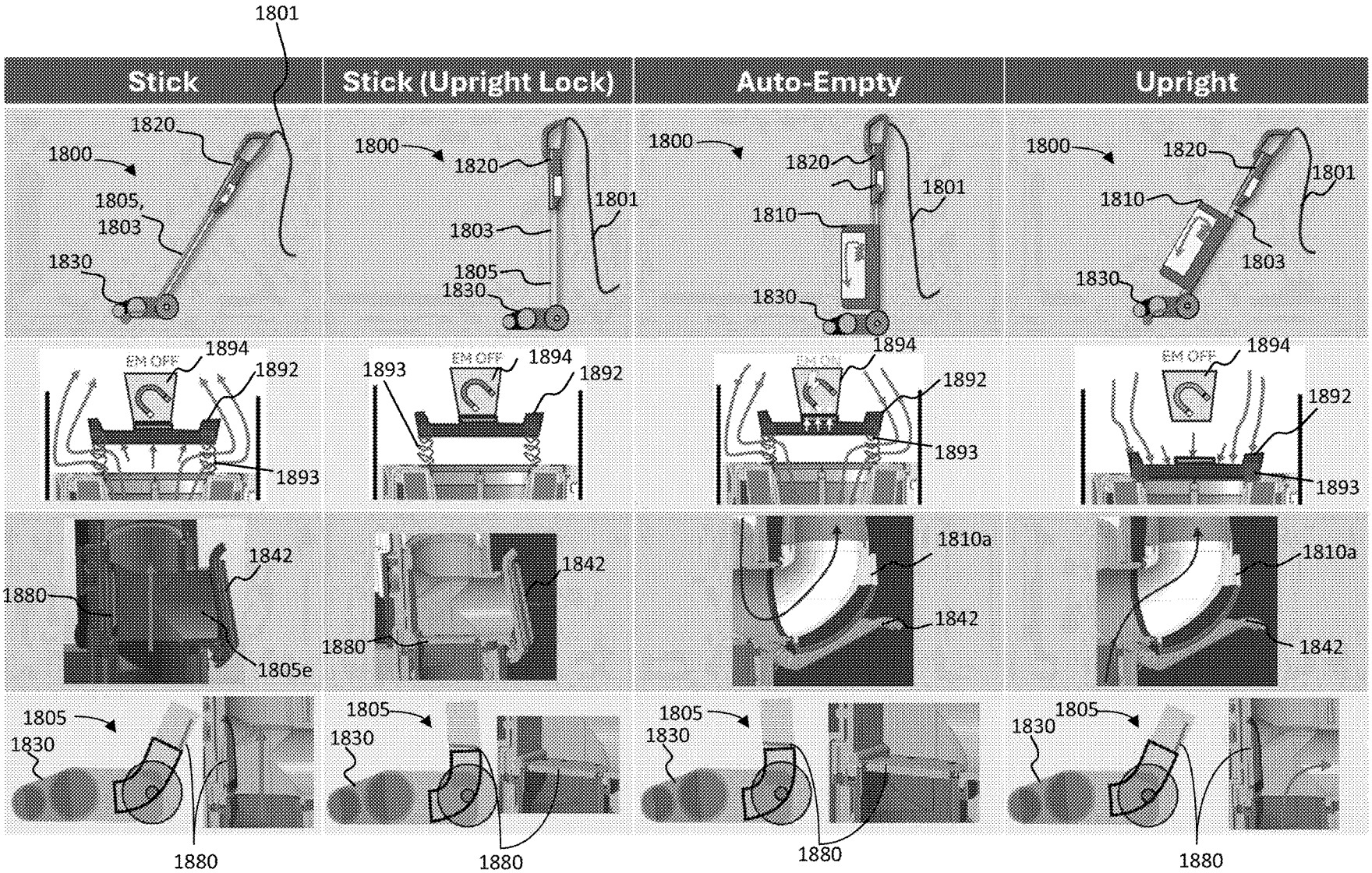
Figure 18X:
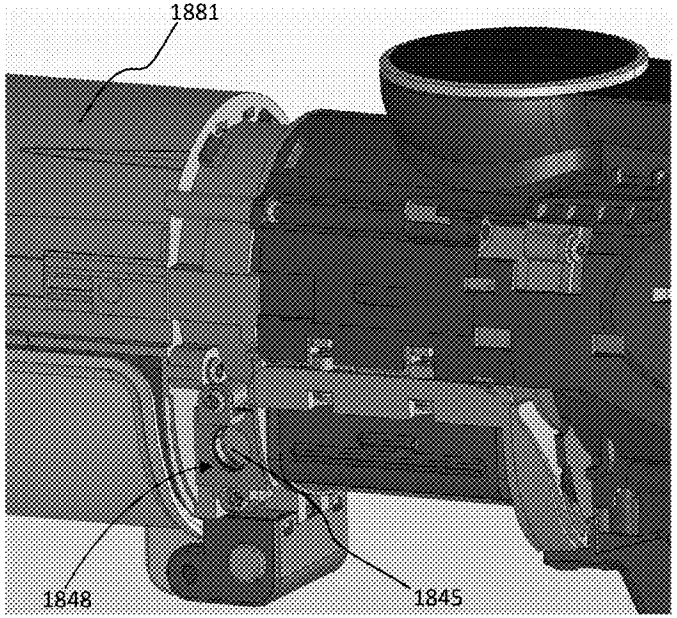

FIGS. 18S-18U illustrate handheld vacuum cleaner 1820 in example stick, auto-empty, and upright modes of operation (respectively). FIG. 18V shows a table illustrating schematic representations of cleaning apparatus 1800 (and portions thereof) in such modes of operation (as well as a "Stick (Upright Lock)" mode). FIG. 18V illustrates cross-sections through portions of support member 1805 and floor-based vacuum cleaner 1810, which may be similar or identical to that illustrated and/or described with respect to support member 1605 and floor-based vacuum cleaner 1610. As described in more detail below, valve 1892 can be configured to be moved between a closed position (see FIG. 18U) and an open position (see FIGS. 18S-18T). In such closed position, valve 1892 can block a flow path between dirty air inlet 1821 and either or both of clean air outlet 1822 and bleed valve chamber 1846 (thus, auxiliary air inlet 1848). In such open position, such flow path is open (not blocked by valve 1892). Such flow path may be at least partially defined by filter 1844 (for example, interior cavity 1844*c*), and valve 1892 can be arranged between filter 1844 and suction motor 1840. In some implementations, valve 1892 covers opening 1896*e* and/or opening 1844*a* when in such closed position.

FIG. 18S illustrates a cross-section taken through a portion of handheld vacuum cleaner 1820 when in an example "stick" mode of operation which corresponds to that illustrated in in the "Stick" column in the table of FIG. 18V. Example air flow paths in such mode are illustrated in dotted lines (with arrows) in FIG. 18S. In such mode, valve 1890 can be pivoted to a first open position (for example, away from dirty air inlet 1821). Valve 1890 can be moved to such position by suction force induced by suction motor 1840 of handheld vacuum cleaner 1820, thereby allowing debris to enter into debris container 1841. In such stick mode, air can flow into handheld vacuum cleaner 1820 (for example, via wand 1803) through dirty air inlet 1821 and out of handheld vacuum cleaner 1820 via clean air outlet 1822. In such stick mode, air may flow through dirty air inlet 1821, past valve 1890, through debris container 1841, through filter 1843, through gap 1885 (for example, around an end of filter 1422 and/or cap 1897), into interior region 1898, through a wall/sidewall of filter 1844, into interior 1844*c* of filter 1844, through opening 1844*a* of filter 1844 and/or opening 1896*e* of filter support 1896, past valve 1892 (for example, through gap/spacing 1885 between valve 1892 and filter support 1896 as discussed above), in interior region 1884, through openings in frame 1883, through grill 1881*b*, through motor casing opening 1891*a*, through at least a portion of an interior within membrane 1882, through vent(s) 1881*a*, through filter 1849, and through clean air outlet 1822 (which may be defined by one or more vents in an outlet cover similar to that shown in FIG. 16Y-16Z or 17V-17W with respect to clean air outlet 1622, 1722. It is to be understood that air may flow in an alternative manner when flowing through handheld vacuum cleaner 1820 in such stick mode, and the example flow path described above is not intended to be limiting. It is also to be understood that handheld vacuum cleaner 1820 may not include all of the components described with respect to such example flow path in some variants.

In the example stick mode illustrated in FIG. 18S, valve 1892 is spaced from (does not cover) opening 1896*e*, 1844*a*. Valve 1892 can be biased in such open position via springs 1893 even when air does not flow in the above-described manner. In some implementations, valve 1892 is proximate or in contact with electromagnet 1894 when handheld vacuum cleaner 1820 is in such mode. In some implementations, electromagnet 1894 is not activated (energized to a magnetic state) when handheld vacuum cleaner 1820 is in such stick mode (as represented by "EM OFF" in FIG. 18V). With reference to FIG. 18V and similar to that described with respect to cleaning apparatus 1600 and FIG. 16KK, when cleaning apparatus 1800 is in such stick mode, a valve 1880 within support member 1805 is open, thereby allowing air to flow from a dirty air inlet of cleaning head 1830, through support member 1805 and/or wand 1803 and to and through handheld vacuum cleaner 1820 (for example, as described above). With reference to FIG. 18V, and as shown and as described with respect to cleaning apparatus 1600 and FIG. 16KK, a lid 1842 of cleaning apparatus 1800 (which may be pivotably connected to support member 1805) can be closed when floor-based vacuum cleaner 1810 is detached, thereby closing an outlet port 1805*e*.

FIG. 18T illustrates a cross-section taken through a portion of handheld vacuum cleaner 1820 when in an example "auto-empty" mode of operation which corresponds to that illustrated in the "Auto-Empty" column in the table of FIG. 18V. Example air flow paths in such mode are illustrated in dotted lines (with arrows) in FIG. 18U. In such mode, valve 1890 can be pivoted to a second open position (for example, towards dirty air inlet 1821). Valve 1890 can be moved to such position by suction force induced by a suction motor of floor-based vacuum cleaner 1810, thereby allowing debris within debris container 1841 to be transferred to floor-based vacuum cleaner 1810 (for example, via wand 1803 and/or support member 1805). In such auto-empty mode, air can flow into handheld vacuum cleaner 1820 through clean air outlet 1822 and out of handheld vacuum cleaner 1820 via dirty air inlet 1821. In the auto-empty mode, air may flow through clean air outlet 1822, through filter 1849, through vent(s) 1881*a*, through at least a portion of an interior within membrane 1882, through motor casing opening 1891*a*, through grill 1881*b*, through openings in frame 1883, in interior region 1884, past valve 1892 (for example, through gap/spacing 1885 between valve 1892 and filter support 1896 as discussed above), through opening 1844*a* of filter 1844 and/or opening 1896*e* of filter support 1896, into interior 1844*c* of filter 1844, through a wall of filter 1844, into interior region 1898, through gap 1885 (for example, around an end of filter 1422 and/or cap 1897), through filter 1843, through debris container 1841, past valve 1890, and through dirty air inlet 1821. Air may then flow through wand 1803, support member 1805, and floor-based vacuum cleaner 1810 in order to transfer debris from handheld vacuum cleaner 1820 to floor-based vacuum cleaner 1810 as described herein.

Figure 18W:
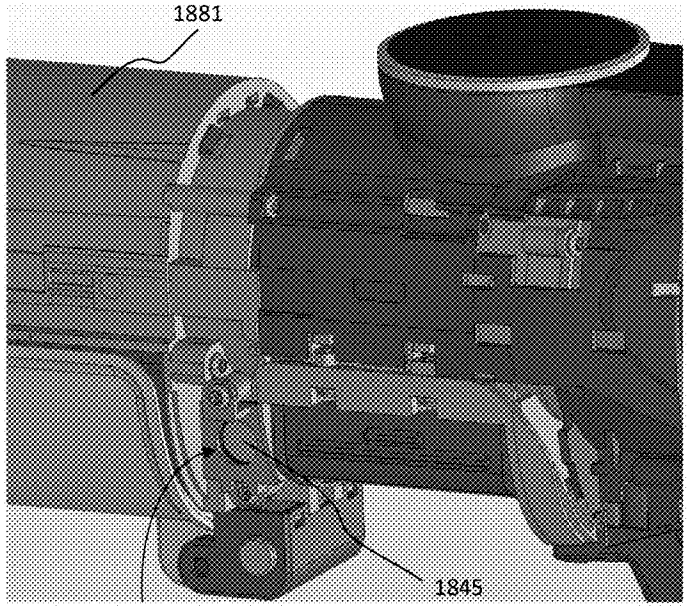
Figure 18Y:
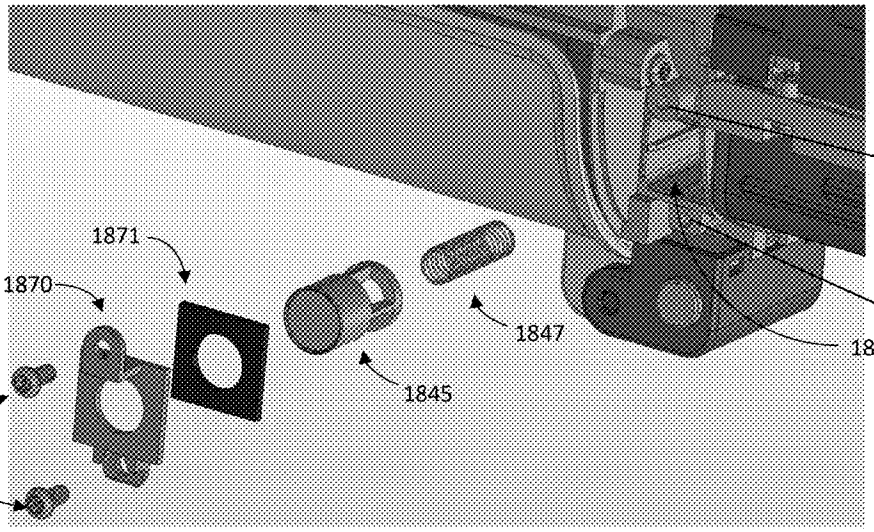
Figure 18A:
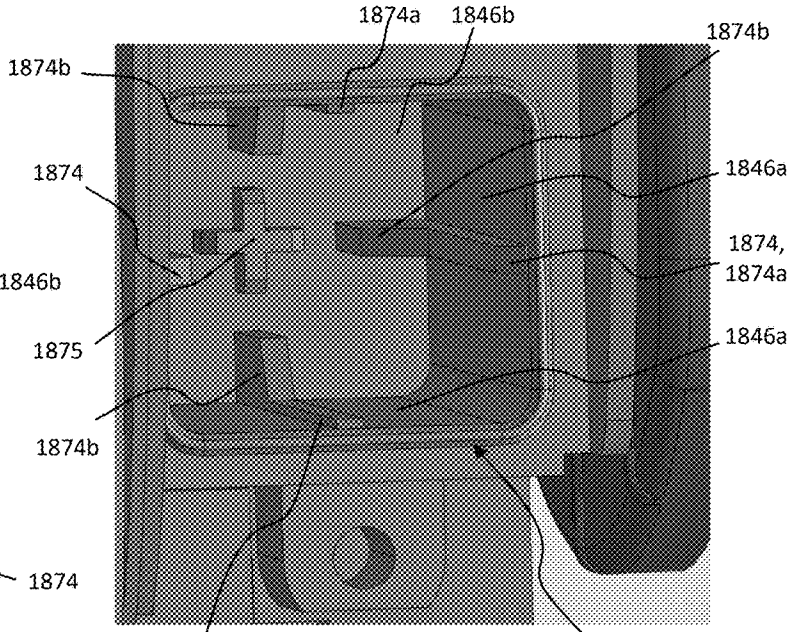

In some implementations, and as described in more detail with respect to FIGS. 18W-18EE, handheld vacuum cleaner 1820 includes an auxiliary air inlet 1848 and a bleed valve 1845. In some of such implementations, air can flow into handheld vacuum cleaner 1820 through either one or both of clean air outlet 1822 and auxiliary air inlet 1848 when handheld vacuum cleaner 1820 is in the auto-empty mode. In some implementations of the auto-empty mode, air flows through auxiliary air inlet 1848, through bleed valve chamber 1846, through chamber opening 1876, through openings in frame 1883, in interior region 1884, past valve 1892 (for example, through gap/spacing 1885 between valve 1892 and filter support 1896 as discussed above), through opening 1844*a* of filter 1844 and/or opening 1896*e* of filter support 1896, into interior 1844*c* of filter 1844, through a wall of filter 1844, into interior region 1898, through gap 1885 (for example, around an end of filter 1422 and/or cap 1897), through filter 1843, through debris container 1841, past valve 1890, and through dirty air inlet 1821. It is to be understood that air may flow in an alternative manner when flowing through handheld vacuum cleaner 1820 in such auto-empty mode, and the example flow path described above is not intended to be limiting. It is also to be understood that handheld vacuum cleaner 1820 may not include all of the components described with respect to such example flow path in some variants. In some implementations, handheld vacuum cleaner 1820 is configured such that, during auto-empty mode, a majority of the air flowing into handheld vacuum cleaner 1820 (from ambient) comes from the auxiliary air inlet 1848 instead of from clean air outlet 1822.

In the example auto-empty mode illustrated in FIG. 18T, valve 1892 is spaced from (does not cover) opening 1896*e*, 1844*a*. In some implementations, valve 1892 is proximate or in contact with electromagnet 1894 when handheld vacuum cleaner 1820 is in such mode. In some implementations, electromagnet 1894 is activated (energized to a magnetic state) when handheld vacuum cleaner 1820 is in such auto-empty mode (as represented by "EM ON" in FIG. 18V), thereby causing electromagnet 1894 to become magnetized and magnetically couple and secure to magnet 1892*e* of valve 1892. This advantageously allows valve 1892 to remain in the open position even when air flowing toward and/or past valve 1892 applies a force on valve 1892 (attempting to move valve 1892 to the closed position). In some implementations, electromagnet 1894 is only activated when cleaning apparatus 1800 is in the auto-empty mode and is not activated when cleaning apparatus 1800 is in the stick mode and/or the upright mode (and/or the "Stick (Upright Lock)" mode described below and illustrated in FIG. 18V). With reference to FIG. 18V and similar to that described with respect to cleaning apparatus 1600 and FIG. 16KK, when cleaning apparatus 1800 is in such auto-empty mode, valve 1880 may be closed, thereby preventing air/debris from being pulled in from a dirty air inlet of cleaning head 1830. Additionally, lid 1842 can be opened when floor-based vacuum cleaner 1810 is attached, thereby allowing air/debris to flow into floor-based vacuum cleaner 1810 (for example, via duct 1810*a*).

FIG. 18U illustrates a cross-section taken through a portion of handheld vacuum cleaner 1820 when in an example "upright" mode of operation which corresponds to that illustrated in the "Upright" column in the table of FIG. 18V. As shown in FIG. 18U, valve 1890 can be in a closed position when in the upright mode, which advantageously inhibits debris that may be within debris container 1841 from falling out of handheld vacuum cleaner 1820 (for example, through dirty air inlet 1821). In the upright mode, floor-based vacuum cleaner 1810 is utilized for vacuuming, and a suction motor of floor-based vacuum cleaner 1810 induces a suction pressure and force (represented by the dotted line and arrows in FIG. 18U) that moves valve 1892 to a closed position in which valve 1892 covers openings 1896*e*, 1844*a*. This advantageously prevents air from flowing into handheld vacuum cleaner 1820 (for example, via clean air outlet 1822 and/or auxiliary air inlet 1848) when cleaning apparatus 1800 is in the upright mode and focuses suction (induced by a suction motor of floor-based vacuum cleaner 1810) to draw air in through the dirty air inlet of cleaning head 1830. This can result in more efficient vacuuming with floor-based vacuum cleaner 1810. Valve 1892, springs 1893, and the suction motor of floor-based vacuum cleaner 1810 can be configured such that the suction motor induces a suction force that overcomes the biasing force of springs 1893 (which bias valve 1892 aways from openings 1896*e*, 1844*a*). In some implementations, valve 1892 seals openings 1896*e*, 1844*a* when cleaning apparatus 1800 is in such the upright mode, for example, via engagement of seal member 1892*f* with surface 1896*d* and/or the above-described skirt wall of filter support 1896 (see FIGS. 18K and 18M-18N). In some implementations, electromagnet 1894 is not activated (energized to a magnetic state) when handheld vacuum cleaner 1820 is in such upright mode (as represented by "EM OFF" in FIG. 18V). With reference to FIG. 18V and similar to that described with respect to cleaning apparatus 1600 and FIG. 16KK, when cleaning apparatus 1800 is in such upright mode, valve 1880 is open, thereby allowing air to flow from a dirty air inlet of cleaning head 1830, through support member 1805, and to floor-based vacuum cleaner 1810 (for example, via duct 1810*a*).

FIG. 18V also illustrates cleaning apparatus 1800 in an example "Stick (Upright Lock)" mode in which floor-based vacuum cleaner 1810 is detached and handheld vacuum cleaner 1820 is off. In such mode, electromagnet 1894 is off, valve 1892 is in an open position, lid 1842 is closed (since floor-based vacuum cleaner 1810 is detached), and valve 1880 is also closed.

With reference to FIG. 18V, in some implementations, electromagnet 1894 is "off" when cleaning apparatus 1800 is in: the stick mode; the "Stick (Upright Lock)" mode; and/or the upright mode. However, in some implementations, electromagnet 1894 is "on" when cleaning apparatus 1800 is in the stick mode and/or the "Stick (Upright Lock)" mode. In some implementations, electromagnet 1894 is "on" when handheld vacuum cleaner 1820 is detached from support member 1805, floor-based vacuum cleaner 1810, and/or cleaning head 1830, for example, for use in a mode that may be referred to as a "handheld" mode. It is to be understood that handheld vacuum cleaner 1820 may be utilized in such "handheld" mode while being attached to wand 1803 but detached from support member 1805, floor-based vacuum cleaner 1810, and cleaning head 1830. With reference to FIG. 18T, in some implementations, electromagnetic 1894 is only "off" when cleaning apparatus 1800 is in the upright mode.

Cleaning head 1830, support member 1805, valve 1880, lid 1842, outlet 1805*e* can be similar or identical in any respect to cleaning head 1630, support member 1605, valve 1680, lid 1642, and/or outlet 1605*e* (respectively). Cleaning head 1830, support member 1805, valve 1880, lid 1842, outlet 1805*e* can operate in a similar or identical manner as that described with respect to cleaning head 1630, support member 1605, valve 1680, lid 1642, and/or outlet 1605*e* (respectively). By way of non-limiting example, valve 1880 can be configured to move to and between open and closed positions based on inclination of support member 1805 and/or wand 1803 in a similar or identical manner as that described with reset to valve 1680 and cleaning apparatus 1600. Although FIGS. 18S-18U illustrate valve 1890 pivotably connected to what may be referred to as a "top" side or portion of handheld vacuum cleaner 1820, valve 1890 may be pivotably connected to an opposite, "bottom" side or portion instead.

Cleaning apparatus 1800 (for example, handheld vacuum cleaner 1820) can be configured in a variety of ways to activate (by providing energy to) and deactivate (by not providing energy to) electromagnet 1894 for any of the above-described operational modes. As described above, cleaning apparatus 1800 (for example, handheld vacuum cleaner 1820) activates electromagnet 1894 when cleaning apparatus 1800 is transitioned to the auto-empty mode. For example, when in an "on" state (for example, via a user's pressing of a power button on handheld vacuum cleaner 1820) cleaning apparatus 1800 (for example, handheld vacuum cleaner 1820) can activate electromagnet 1894 after determining that: (1) floor-based vacuum cleaner 1810 is attached to wand 1803, support member 1805, handheld vacuum cleaner 1820, and/or cleaning head 1830; and (2) wand 1803 and/or support member 1805 is in an inclined orientation associated with the auto-empty mode (which can be similar to that discussed with respect to cleaning apparatus 1600 above).

Cleaning apparatus 1800 (for example, handheld vacuum cleaner 1820) can be configured to determine "(1)" based on whether electrical connectors of floor-based vacuum cleaner 1810, wand 1803, support member 1805, and handheld vacuum cleaner 1820 are in electrical communication with one another (e.g., when floor-based vacuum cleaner 1810, wand 1803, support member 1805, and handheld vacuum cleaner 1820 are attached to one another). Such electrical connectors can be similar or identical to any of the electrical connectors described herein with respect to any of the floor-based vacuum cleaners, wands, support members, and handheld vacuum cleaners disclosed herein. When attached, signal(s) may be transmitted from electrical connectors of floor-based vacuum cleaner 1810, wand 1803, support member 1805 to an electrical connector of handheld vacuum cleaner 1820 (for example, electrical connector 1829) and to a controller of handheld vacuum cleaner 1820 via electrical circuitry and/or wiring in any of such components.

Cleaning apparatus 1800 (for example, handheld vacuum cleaner 1820) can determine "(2)" (described above) in a variety of ways. For example, cleaning apparatus 1800 (for example, a controller of handheld vacuum cleaner 1820) can be configured to activate electromagnet 1984 after determining that: (a) floor-based vacuum cleaner 1810 is attached to wand 1803, support member 1805, handheld vacuum cleaner 1820, and/or cleaning head 1830; and (b) that valve 1880 is in the closed position, which can aid in differentiating the empty mode from the upright mode (see FIG. 18V). To determine "(b)", cleaning apparatus 1800 may include one or more switches or other electromechanical mechanisms that are engaged and/or disengaged with valve 1880 (or mechanical structure coupled with valve 1880) when valve 1880 is in the open or closed position. For example, cleaning apparatus 1800 can include a switch that is engaged when valve 1880 is in the closed position and not engaged when valve 1880 is in the open position, and such switch may transmit a signal to a controller of handheld vacuum cleaner 1820 (for example, via any of the electrical connectors and/or circuitry/wiring of cleaning apparatus 1800). As another example, to determine cleaning apparatus 1800 may include one or more accelerometers or other sensors, and such accelerometers or other sensors may be arranged in any or all of floor-based vacuum cleaner 1810, wand 1803, support member 1805, handheld vacuum cleaner 1820, and/or cleaning head 1830. Various other mechanisms and techniques may be utilized to allow cleaning apparatus 1800 to determine whether to activate electromagnet 1984 for the auto-empty mode.

In some implementations, electromagnet 1894 is not activated when cleaning apparatus 1800 (for example, handheld vacuum cleaner 1820) determines that handheld vacuum cleaner 1820 is not attached with support member 1805, cleaning head 1830, and/or floor-based vacuum cleaner 1810, for example, when handheld vacuum cleaner 1820 is being used to clean surfaces other than a floor surface (e.g., furniture, ceiling, or wall surfaces) or during stick mode. In some implementations, cleaning apparatus 1800 (for example, handheld vacuum cleaner 1820) automatically turns on suction motor 1840 of handheld vacuum cleaner 1820 upon determination that handheld vacuum cleaner 1820 is not attached to floor-based vacuum cleaner 1810 and/or cleaning head 1830 (for example, via support member 1805). In some implementations, cleaning apparatus 1800 (for example, handheld vacuum cleaner 1820) maintains suction motor 1840 of handheld vacuum cleaner in an "on" state until: cleaning apparatus 1800 is turned "off" (e.g., via a power button on handheld vacuum cleaner 1820); and/or both of floor-based vacuum cleaner 1810 and cleaning head 1830 are attached with handheld vacuum cleaner 1820 (for example, via wand 1803 and support member 1805).

In some implementations, cleaning apparatus 1800 (for example, handheld vacuum cleaner 1820) automatically turns off a suction motor of handheld vacuum cleaner 1820 and turns on a suction motor of floor-based vacuum cleaner 1810 upon determination that handheld vacuum cleaner 1820 is attached to floor-based vacuum cleaner 1810 and cleaning head 1830 (for example, via support member 1805). This can advantageously facilitate the upright and empty modes in which the suction motor of floor-based vacuum cleaner 1810 is utilized. In some implementations, when cleaning apparatus 1800 is transitioned to the auto-empty mode, cleaning apparatus 1800 (for example, handheld vacuum cleaner 1820) automatically turns on a suction motor of floor-based vacuum cleaner 1810 for a pre-determined time period and then turns such suction motor off after such time period. Such time period can be, for example, 2 seconds, 5 seconds, 10 seconds, 15 seconds, 20 seconds, 25 seconds, or 30 seconds, or any value or range within or bounded by any of these values or ranges. Handheld vacuum cleaner 1820 can determine transitioning to the auto-empty mode as explained above with respect to electromagnet 1894 and "(1)" and "(2)". In some implementations, cleaning apparatus 1800 cycles suction motor 1840 of handheld vacuum cleaner 1820 through one or more "on"/"off" cycles prior to turning the floor-based vacuum cleaner 1810 suction motor on for auto-empty mode, which may help loosen debris or otherwise facilitate debris transport from handheld vacuum cleaner 1820 to floor-based vacuum cleaner 1810 during such mode. In some implementations, cleaning apparatus 1800 (for example, handheld vacuum cleaner 1820) maintains the suction motor of floor-based vacuum cleaner 1810 in an "on" state when in the upright cleaning mode until: cleaning apparatus 1800 is transitioned to the auto-empty mode (in which such suction motor may be turned "on" only for a pre-determined time period); cleaning apparatus 1800 is turned "off" (e.g., via a power button on handheld vacuum cleaner 1820); and/or floor-based vacuum cleaner 1810 or cleaning head 1830 is detached from handheld vacuum cleaner 1820 (for example, detached from wand 1803).

Cleaning apparatus 1800 (for example, handheld vacuum cleaner 1820) can determine attachment of any of handheld vacuum cleaner 1820, wand 1803, support member 1805, cleaning head 1830, and/or floor-based vacuum cleaner 1810 based on receipt or lack of receipt of signal(s) transmitted via electrical connectors and/or circuitry thereof, as described previously.

Cleaning head 1830, support member 1805, wand 1803, handheld vacuum cleaner 1820, and floor-based vacuum cleaner 1810 can be electrically connectable to one another via one or more electrical connectors to facilitate electrical communication and/or power. For example, in some implementations in which cleaning apparatus 1800 includes a power cord 1801 connected to handheld vacuum cleaner 1820, electrical power can be provided from handheld vacuum cleaner 1820 to floor-based vacuum cleaner 1810 and/or cleaning head 1830 (for example, via wand 1803 and/or support member 1805) to allow control of any electrical components of floor-based vacuum cleaner 1810 and/or cleaning head 1830 (such as a suction motor of floor-based vacuum cleaner 1810). In some variants, cleaning apparatus 1800 does not include a cord 1801, and in such variants, any of handheld vacuum cleaner 1820, floor-based vacuum cleaner 1810, and/or cleaning head 1830 include a battery. Handheld vacuum cleaner 1820 can include a controller and/or input device (similar or identical to controller 327, input device 328) which can allow control of handheld vacuum cleaner 1820 (for example, a suction motor thereof), floor-based vacuum cleaner 1810 (for example, a suction motor thereof), and/or cleaning head 1830 (for example, a motor and/or agitator thereof). Such implementations can allow suction motors of handheld vacuum cleaner 1820 and floor-based vacuum cleaner 1810 to be operated (for example, turned "on" or "off") to facilitate any of the various operational modes described herein. In some implementations, handheld vacuum cleaner 1820 includes a battery and is removably connectable to cord 1801 so as to allow cleaning apparatus 1800 to be operated with cord 1801 connected and/or disconnected. In the disconnected state of such implementation, cleaning apparatus 1800 (or any portion thereof) may derive electrical power from such battery in handheld vacuum cleaner 1820 and/or a battery in floor-based vacuum cleaner 1810. Any of such batteries may be charged via cord 1801. Such implementations can advantageously allow for convenient operation of cleaning apparatus 1800 without cord 1801 attached.

FIGS. 18W-18X illustrate perspective views of a portion of handheld vacuum cleaner 1820 and, among other things, auxiliary air inlet 1848, bleed valve 1845, and bleed valve chamber 1846. Auxiliary air inlet 1848 and bleed valve 1845 can be utilized in the auto-empty mode as described above. Auxiliary air inlet 1848 and bleed valve 1845 can also be utilized to allow air into handheld vacuum cleaner 1820 if there is a clog of debris that inhibits or prevents air from flowing through handheld vacuum cleaner 1820 (for example, when in a stick mode or when handheld vacuum cleaner 1820 is used independent of wand 1803, support member 1805, floor-based vacuum cleaner 1810, and/or cleaning head 1830). FIG. 18W illustrates bleed valve 1845 in an example closed position in which auxiliary air inlet 1848 is blocked, while FIG. 18X illustrates bleed valve 1845 in an example open position in which auxiliary air inlet 1848 is open. FIG. 18CC illustrates a cross-section taken through a portion of handheld vacuum cleaner 1820 when bleed valve 1845 in the closed position of FIG. 18W, while FIG. 18DD illustrates a similar cross-section when bleed valve 1845 is in the open position of FIG. 18X. FIG. 18Y illustrates a partially exploded view of handheld vacuum cleaner 1820, illustrating bleed valve 1845, spring 1847, seal member 1871, plate 1870, and fasteners 1872 spaced from bleed valve chamber 1846. Bleed valve 1845 can be arranged within chamber 1846 by plate 1870 which can be secured to portions 1873 of structural component 1871 via fasteners 1872 as shown. Portions 1873 can be threaded holes configured to secure to threads on fasteners 1872. Seal member 1871 can comprise a flexible and/or resilient material that facilitates a seal between a portion of bleed valve 1845 (for example, an end thereof) and an opening in plate 1870 when bleed valve 1845 is in the closed position. As shown, seal member 1871 and plate 1870 can include an opening (for example, a circular opening as shown), either or both of which may define auxiliary air inlet 1848, for example, along with an open end of chamber 1846.

Figure 18Z:
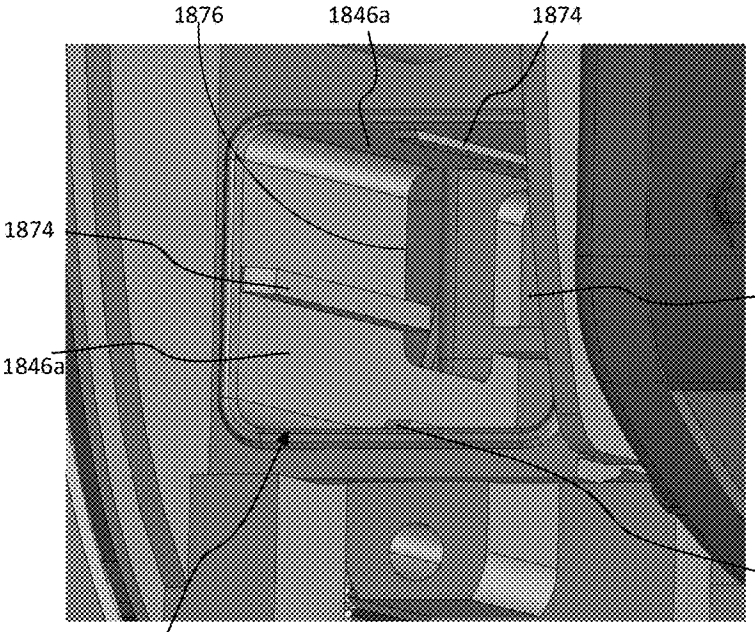
Figure 18B:
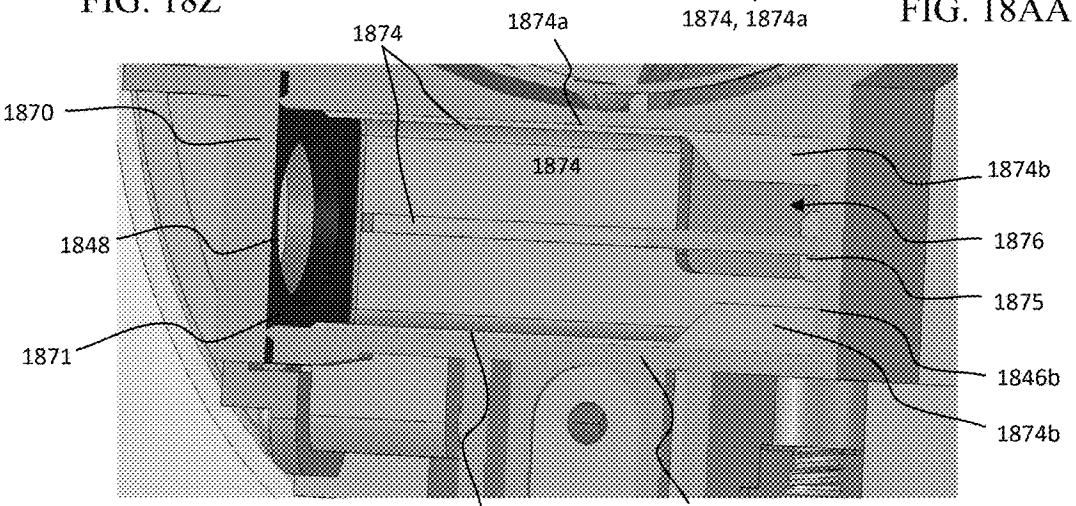
Figure 18C:
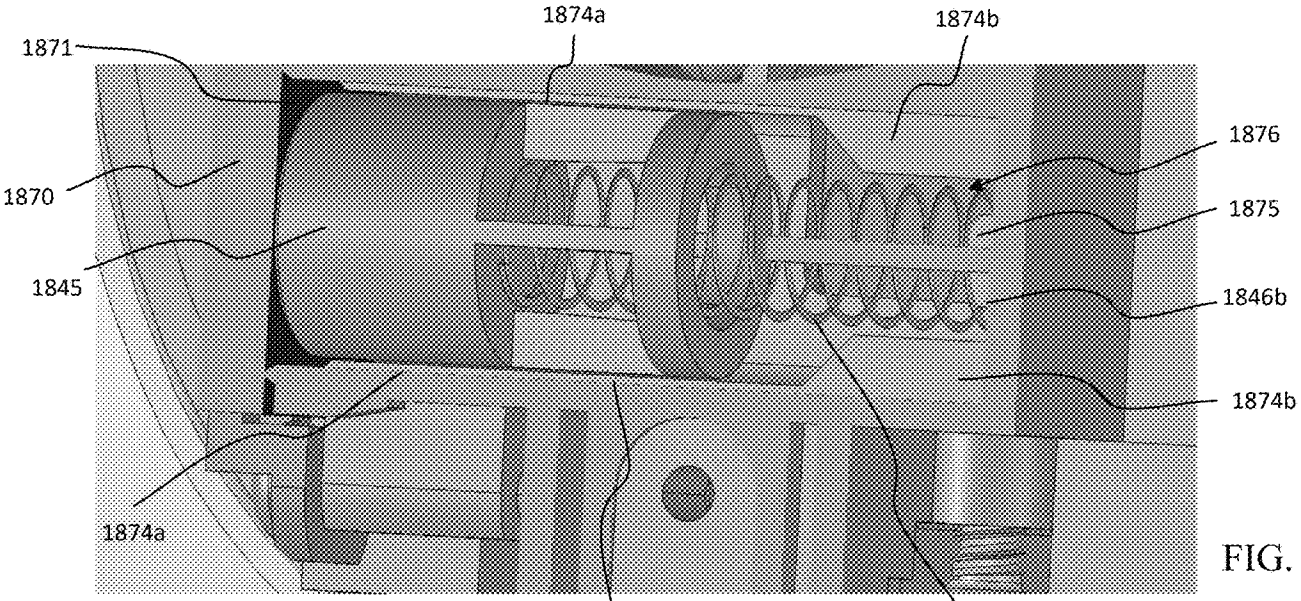
Figure 18D:
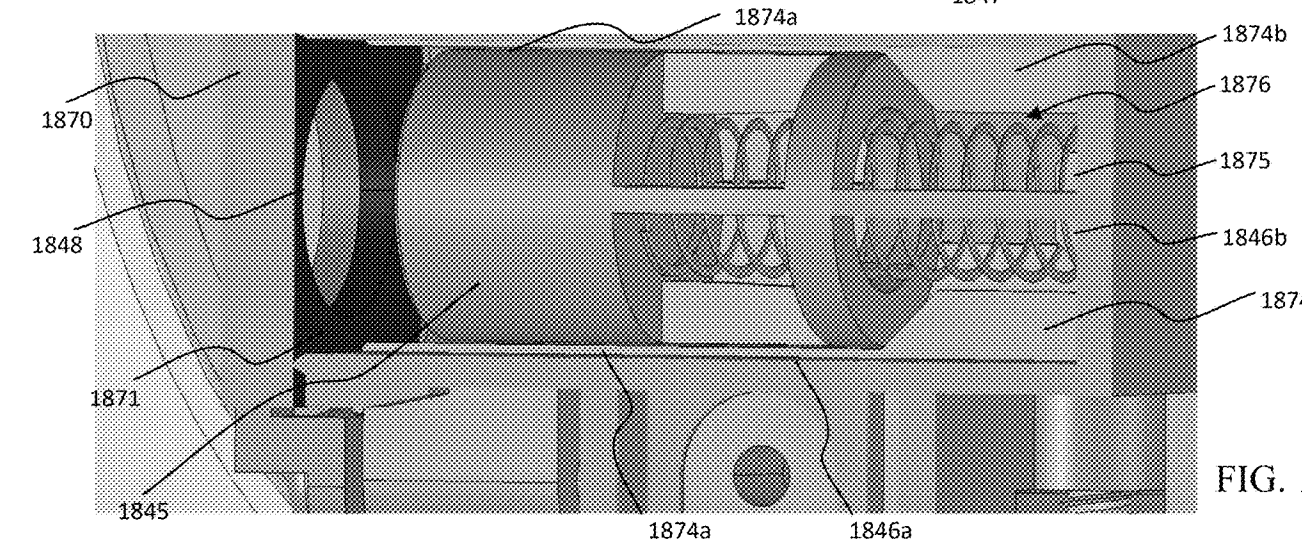
Figure 18E:
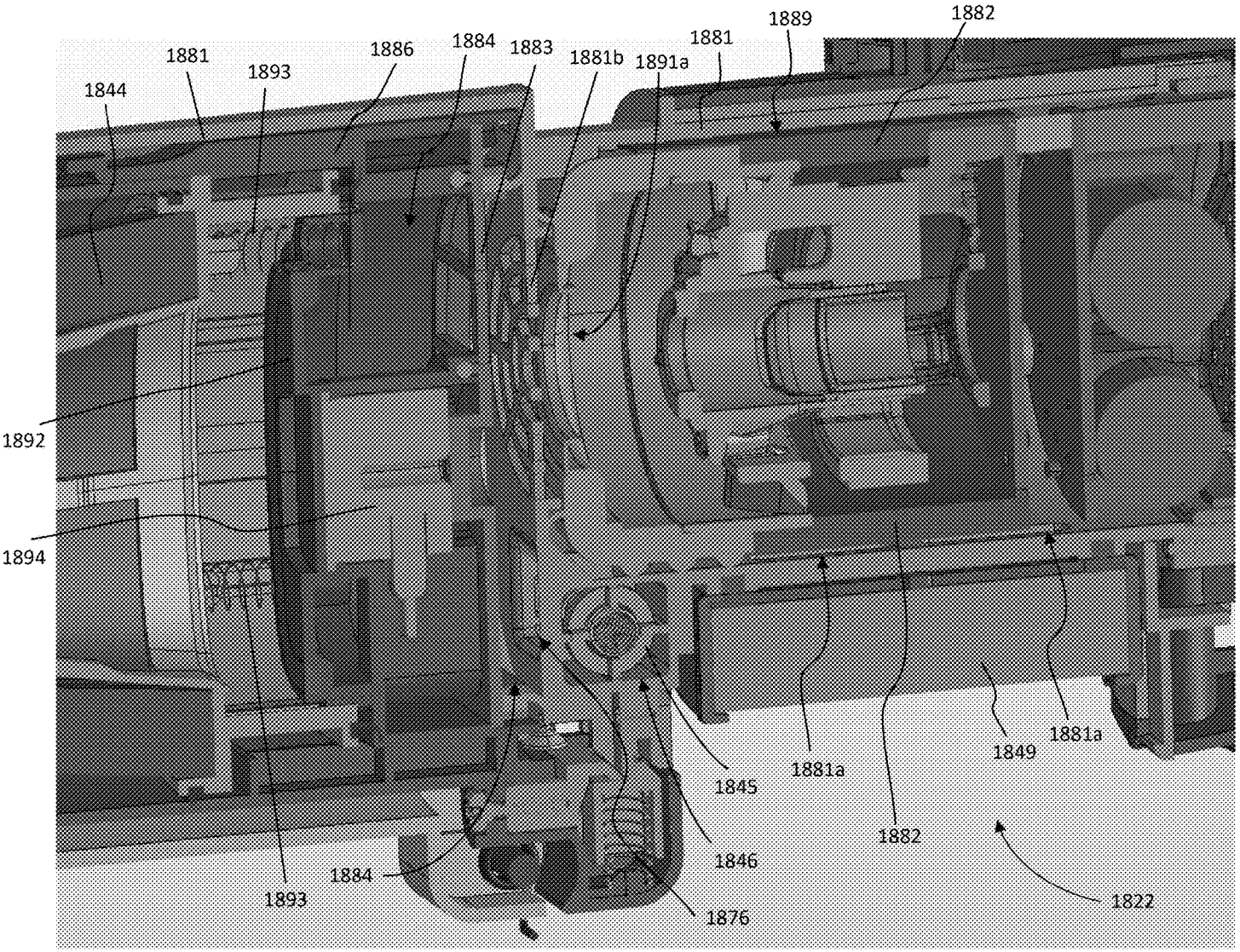

FIGS. 18Z-18AA illustrate perspective views, and FIG. 18BB illustrate a cross-sectional view, of chamber 1846 with spring 1847, bleed valve 1845, seal member 1871, plate 1870, and fasteners 1872 removed. In some implementations, chamber 1846 is formed by a portion of structural component 1881. Chamber 1846 can include walls 1846*a* (for example, four walls as shown), an end wall 1846*b* (which also may be referred to as a "rear wall"), and an open end opposite the end wall 1846*b* to which plate 1870 and seal member 1871 may be secured. With reference to at least FIGS. 18X, 18BB, and 18CC-18DD, chamber 1846 can include an opening 1876 that provides fluid communication between an interior of chamber 1846 and an interior portion of handheld vacuum cleaner 1820 (for example, interior region 1884). Opening 1876 can be arranged in one of walls 1846*a* as shown. Chamber 1846 can include protrusions 1874 extending outward from walls 1846*a* and partially across the interior of chamber 1846. Protrusions 1874 can advantageously contact, operably position, and/or guide bleed valve 1845 in a manner that allows air to flow around bleed valve 1845 (for example, between outer surfaces of bleed valve 1845 and surfaces of chamber 1846). This in turn allows air to flow through auxiliary air inlet 1848, past bleed valve 1845, and through opening 1876. As shown, protrusion 1874 can include a first portion 1874*a* and a second portion 1874*b* that has a greater height/length than first portion 1874*a*, and protrusion 1874 can gradually transition from the first portion 1874*a* to the second portion 1874*b* at a transition ramp. Second portion 1874*b* can abut and/or act as a stop for a portion of bleed valve 1845 (for example, an end thereof) and inhibit bleed valve 1845 from contacting post 1875 and/or end wall 1846*b*. Spring 1847 can bias bleed valve 1845 to the closed position. Spring 1847 can be coupled to a post 1875 (which may be cross-shaped) that extends outward from end wall 1846*b*. Spring 1847 can be arranged within an interior formed by one or more openings extending through bleed valve 1845 (see FIGS. 18CC-18DD).

FIG. 18EE illustrates a perspective cross-section view of a portion of handheld vacuum cleaner 1820, illustrating how bleed valve chamber 1846 can be in fluid communication with one or more interior portions of handheld vacuum cleaner 1820. As shown, chamber 1846 can be in fluid communication with interior region 1884 via opening 1876. Bleed valve 1845 can be configured to open (for example, move to the position illustrated in FIGS. 18X and 18DD) when pressure within handheld vacuum cleaner 1820 exceeds a threshold (for example, between 0.5 psi and 5 psi, between 0.5 psi and 4.5 psi, between 0.5 psi and 4 psi, between 0.5 psi and 3.5 psi, between 0.5 psi and 3 psi, between 0.5 psi and 2.5 psi, between 0.5 psi and 2 psi, between 0.5 psi and 1.5 psi, between 0.5 psi and 1 psi, between 1 psi and 3 psi, between 2 psi and 3 psi, or between 2 psi and 2.5 psi, or any value or range within or bounded by any of these values or ranges). This can advantageously allow air to flow into handheld vacuum cleaner 1820 through auxiliary air inlet 1848, around/through motor 1840, and out through clean air outlet 1822, thereby reducing or eliminating motor overheating when there is a blockage in airflow through handheld vacuum cleaner 1820 (for example, when debris covers/blocks filter 1823). In some implementations of such scenario, air flows through auxiliary air inlet 1848, through chamber 1846, through opening 1876, at least partially in interior region 1884 (for example, at, near, and/or above frame 1883), through grille 1881*b*, through motor casing opening 1891*a*, through an interior within membrane 1882, through membrane 1882, through vent(s) 1881, through filter 1849, and out through clean air outlet 1822. As described previously with respect to FIG. 18T, bleed valve 1845 can be configured to open when handheld vacuum cleaner 1820 (and cleaning apparatus 1800) is an auto-empty mode and a suction motor of floor-based vacuum cleaner 1810 causes air to flow from handheld vacuum cleaner 1820 to the floor-based vacuum cleaner 1810. Air flow in such scenarios can be similar or identical to that described above with respect to FIG. 18T.

Figure 19A:
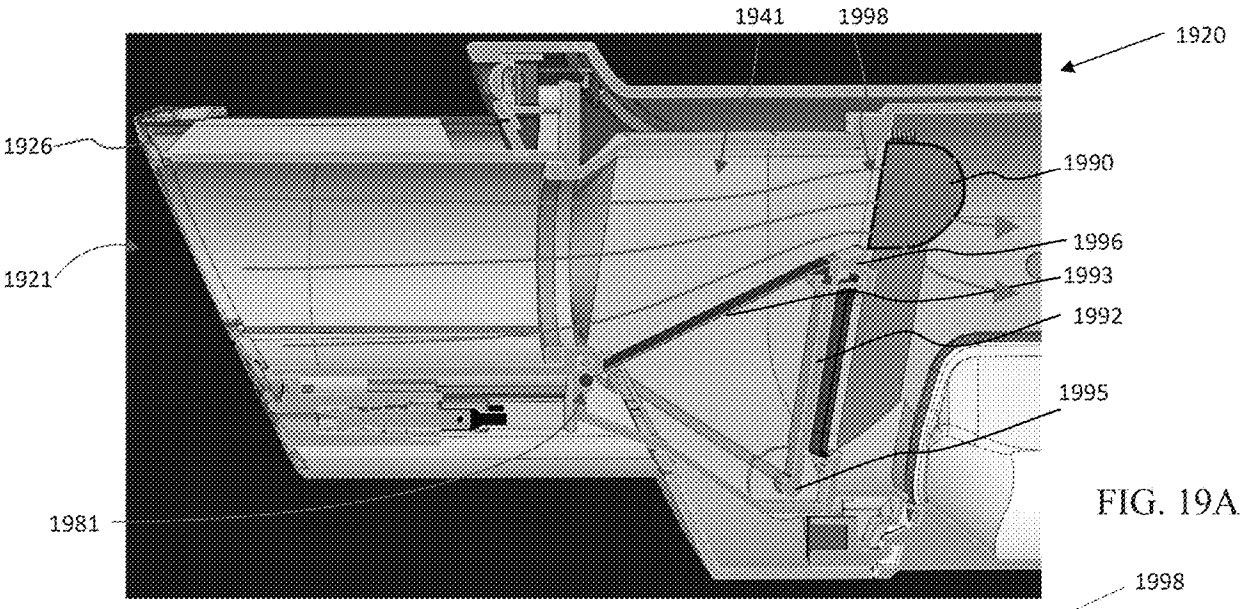
FIGS. 19A-19B illustrate cross-sectional views of portions of another implementation of a handheld vacuum cleaner in accordance with aspects of this disclosure
Figure 19B:
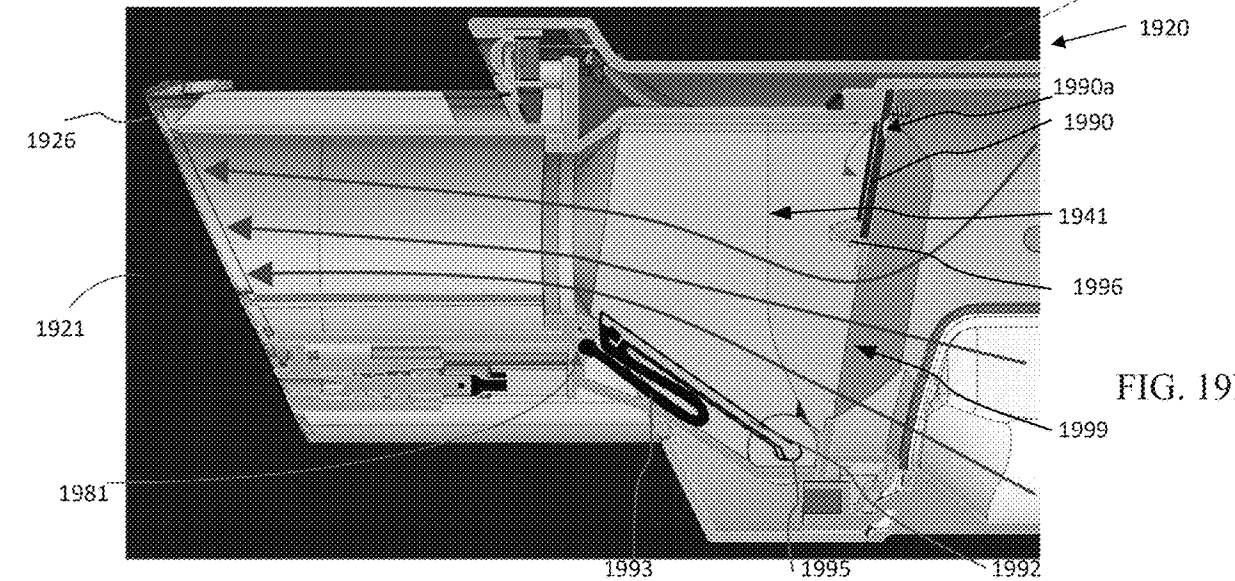

FIGS. 19A-19B illustrate another implementation of a handheld vacuum cleaner 1920. Handheld vacuum cleaner 1920 can include any feature described with respect to any of the other handheld vacuum cleaners disclosed herein. Although FIGS. 19A-19B illustrate a front portion of handheld vacuum cleaner 1920, handheld vacuum cleaner 1920 can include any of a variety of other components shown and/or described with respect to other handheld vacuum cleaners disclosed herein. Handheld vacuum cleaner 1920 can be a variant of handheld vacuum cleaner 1820. For example, handheld vacuum cleaner 1920 can include valves 1990, 1992 (and other components/structure described below) as an alternative to valves 1890, 1892, and electromagnet 1894. Handheld vacuum cleaner 1920 can include a dirty air inlet 1921, snout 1926, and a debris container 1941. Valve 1990 can be configured to pivot between an open position (FIG. 19A) and a closed position (FIG. 19B). In the open position (FIG. 19A), valve 1990 does not block/cover opening 1998, whereas in the closed position (FIG. 19B), valve 1990 blocks/covers opening 1998. Valve 1992 can be configured to pivot between a closed position (FIG. 19A) and an open position (FIG. 19B). In the closed position (FIG. 19A), valve 1992 blocks/covers opening 1999, whereas in the open position (FIG. 19B), valve 1990 does not block/cover opening 1999. Valve 1990 can be pivotably connected to a portion of handheld vacuum cleaner 1920. Valve 1990 can comprise a flexible and/or resilient material. Valve 1990 can include a hinge 1990*a*, for example, a living hinge formed out of the material of valve 1990, that allows valve 1990 to pivot. Handheld vacuum cleaner 1920 can be configured to allow valve 1990 to pivot in only one direction (such as the direction shown in FIG. 19A). For example, in some implementations, inner wall 1996 acts as a stop that prevents valve 1990 from pivoting in a direction at least partially toward dirty air inlet 1921.

Valve 1992 can be pivotably connected to a portion of handheld vacuum cleaner 1920, for example, via pivot point 1995 (which may be a pin). Valve 1992 can comprise a rigid material, for example, a material that is more rigid than a material of valve 1990. Handheld vacuum cleaner 1920 can be configured to allow valve 1992 to pivot in only one direction (such as the direction shown in FIG. 19B). For example, in some implementations, inner wall 1996 acts as a stop that prevents valve 1992 from pivoting in a direction away from dirty air inlet 1921. In some implementations, handheld vacuum cleaner 1920 includes a flap 1993 connected to valve 1992. Flap 1993 can advantageously reduce void volume in an interior portion of handheld vacuum cleaner 1920 (for example, including debris container 1941) when air flows from dirty air inlet 1921 through opening 1998 and through handheld vacuum cleaner 1920 (for example, when handheld vacuum cleaner 1920 is used in a stick operational mode with a cleaning apparatus and/or when used independently). Flap 1993 can help guide airflow through opening 1998 when in the mode of FIG. 19A. Flap 1993 can be connected to a connection point 1981 on a portion of handheld vacuum cleaner 1920 and also to a portion of valve 1992 (for example, an end of valve 1992). Flap 1993 can comprise a flexible and/or resilient material that allows flap 1993 to fold when valve 1992 is opened as shown in FIG. 19B.

Figure 19C:
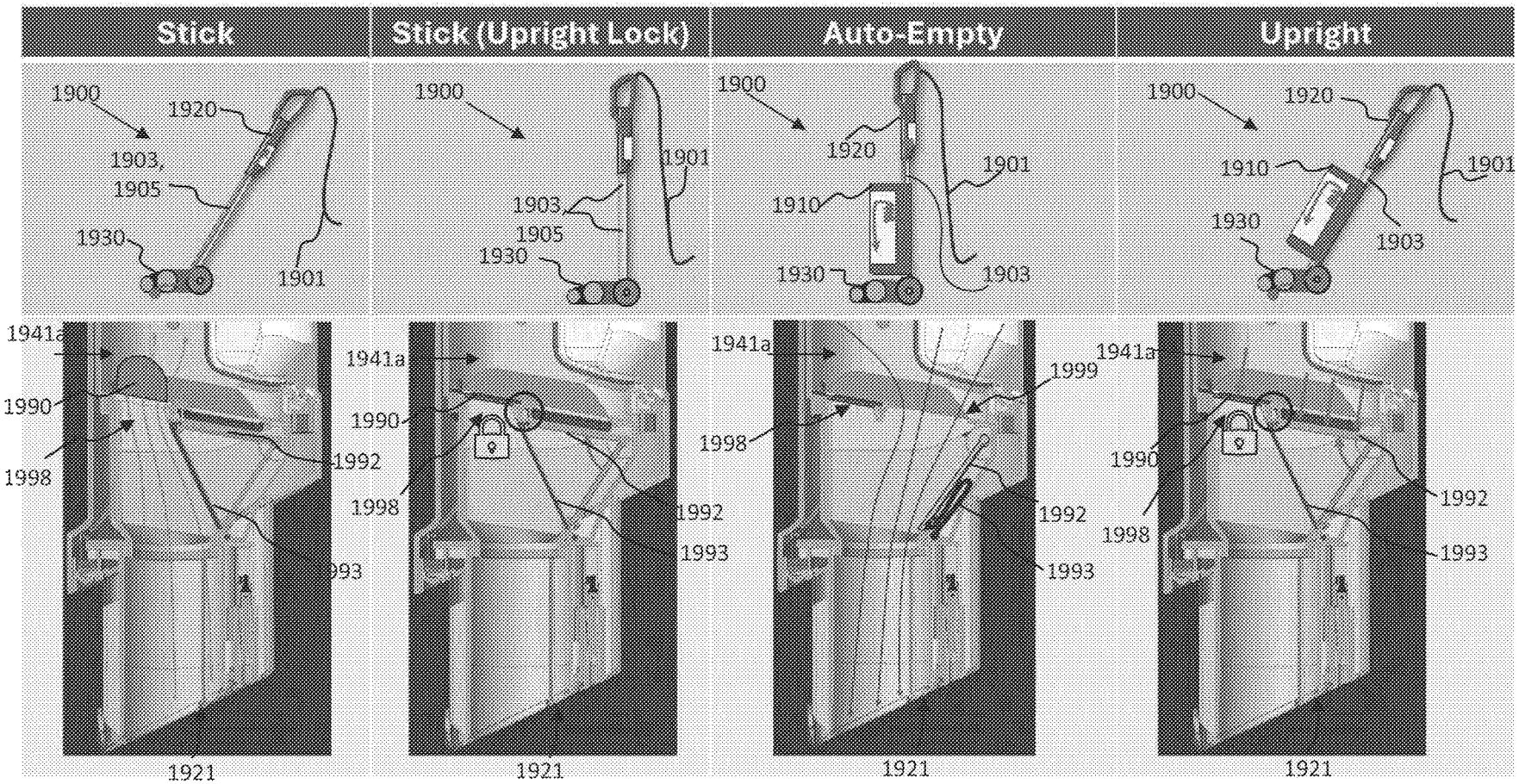
FIG. 19C illustrates a table showing various schematic representations and enlarged views of portions of a cleaning apparatus in different modes of operation in accordance with aspects of this disclosure.

FIG. 19C illustrates a table showing a schematic representation of a cleaning apparatus 1900 which can include handheld vacuum cleaner 1920 along with any or all of a wand 1903, support member 1905, cleaning head 1930, and a floor-based vacuum cleaner 1910. Each of wand 1903, support member 1905, cleaning head 1930, and floor-based vacuum cleaner 1910 can be similar or identical to any of the wands, support members, cleaning heads, and floor-based vacuum cleaners disclosed herein (respectively). FIG. 19C illustrates positions of valves 1990, 1992 when cleaning apparatus 1900 and handheld vacuum cleaner 1920 are in an example "stick" mode, in which handheld vacuum cleaner 1920 is utilized for floor vacuuming. In such stick mode, air flows into dirty air inlet 1921, through debris container 1941, through opening 1998, and out a clean air outlet of handheld vacuum cleaner 1920, thereby carrying debris into debris container 1941. Although not shown, air can also flow through one or more filters and/or interior regions of handheld vacuum cleaner 1920 (such as any of those disclosed herein). In such mode, airflow may be guided and/or directed by flap 1993 towards opening 1998. Valve 1992 can be closed in such mode, thereby keeping opening 1999 closed.

FIG. 19C also illustrates positions of valves 1990, 1992 when cleaning apparatus 1900 and handheld vacuum cleaner 1920 are in an example mode ("Stick (Upright Lock))" in which floor-based vacuum cleaner 1910 is detached and handheld vacuum cleaner 1920 is off. In such example mode, valve 1992 can be locked to prevent debris from falling out of debris container 1941 through opening 1999. In some implementations, valve 1992 can be locked via a lock mechanism that is triggered based on inclination of wand 1903, for example, in the orientation illustrated in the schematic representation of cleaning apparatus 1900 in FIG. 19C for such mode. As mentioned previously, valve 1990 can be prevented from opening (in the downward direction) by inner wall 1996 which can act as a stop for valve 1990.

FIG. 19C further illustrates positions of valves 1990, 1992 when cleaning apparatus 1900 and handheld vacuum cleaner 1920 are in an example auto-empty mode, in which debris from handheld vacuum cleaner 1920 can be transferred to floor-based vacuum cleaner 1910. In such auto-empty mode, air flows into handheld vacuum cleaner 1920 (for example, via a clean air outlet thereof), flows through debris container 1941, through opening 1999, and through dirty air inlet 1921, thereby allowing debris to be transferred from debris container 1941 to a debris container of floor-based vacuum cleaner 1910, for example, via wand 1903 and/or support member 1905. Although not shown, air can also flow through one or more filters and/or interior regions of handheld vacuum cleaner 1920 (such as any of those disclosed herein) in such auto-empty mode. As shown, valve 1992 can be pivoted open (towards dirty air inlet 1921) and flap 1993 can be folded.

FIG. 19C also illustrates positions of valves 1990, 1992 when cleaning apparatus 1900 and handheld vacuum cleaner 1920 are in an example upright mode, in which floor-based vacuum cleaner 1910 is utilized for floor vacuuming. In such upright mode, valves 1990, 1992 can be closed. Valve 1990 can be prevented from opening in a downward direction due to suction pressure by inner wall 1996. Valve 1992 can be locked in such mode, for example, as described previously. Closure of valves 1990, 1992 in the upright mode can advantageously prevent air from flowing into handheld vacuum cleaner 1920, thereby focusing suction efforts (induced by a suction motor of floor-based vacuum cleaner 1910) to draw air in through the dirty air inlet of cleaning head 1930.

Figures 20A, 20B:
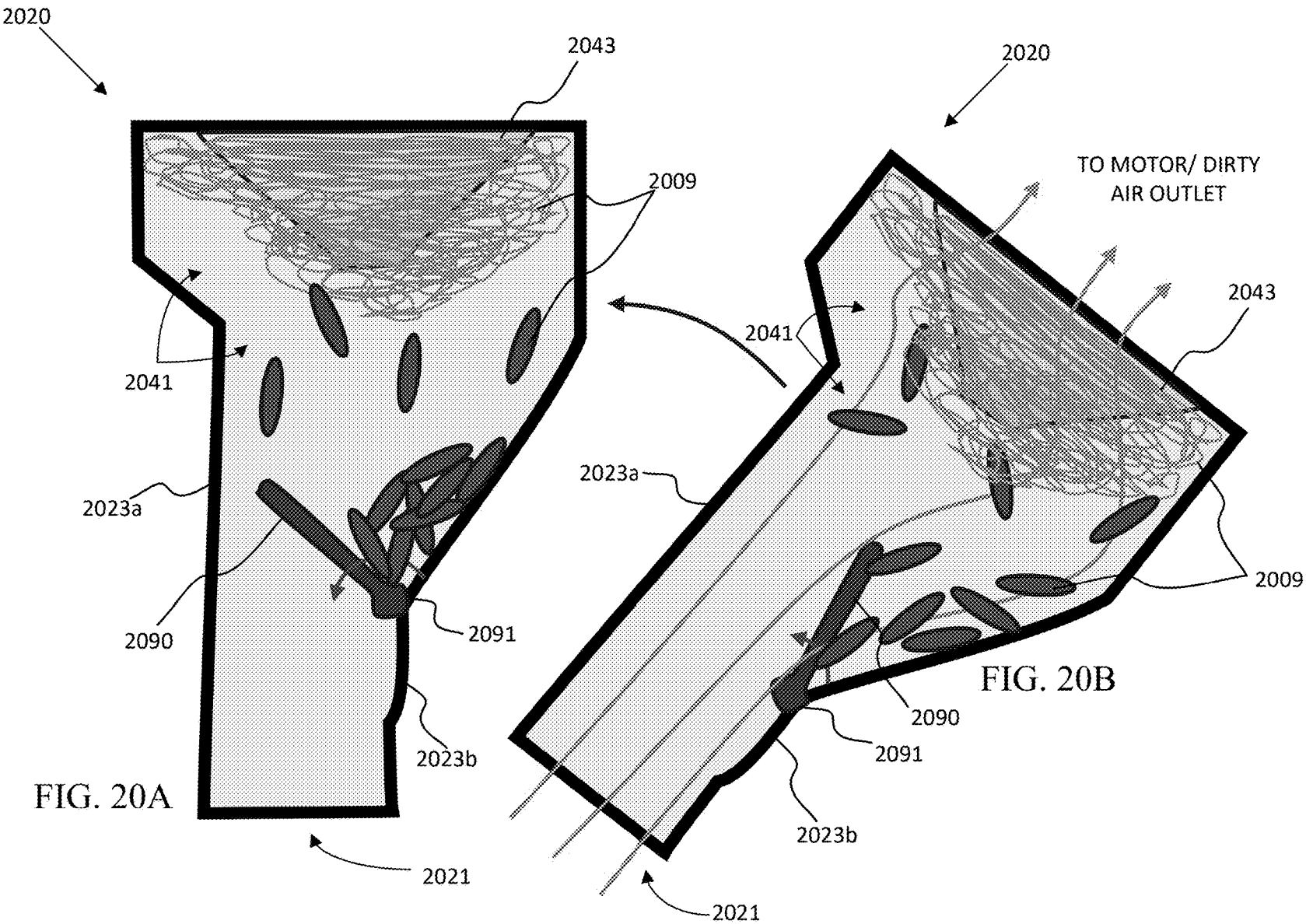
FIGS. 20A-20B illustrate schematic representations of portions of another implementation of a handheld vacuum cleaner in accordance with aspects of this disclosure

FIG. 20A-20B illustrates a schematic representation of a portion of a handheld vacuum cleaner 2020. Handheld vacuum cleaner 2020 can include any of the features described with respect to any of the handheld vacuum cleaners disclosed herein. Handheld vacuum cleaner 2020 includes a filter 2043, a debris container 2041, a dirty air inlet 2021, and a valve 2091 which is pivotably connected to a portion of handheld vacuum cleaner 2020. Valve 2091 is pivotably connected to a portion or side 2023*b* of handheld vacuum cleaner 2020 that is positioned vertically below an opposite portion or side 2023*a* of handheld vacuum cleaner 2020 when handheld vacuum cleaner 2020 is rotated (for example, declined) during use, for example, in a stick mode of operation. For example, valve 2091 can be pivotably connected to a lower/bottom side or portion of handheld vacuum cleaner 2020. Arranging valve 2090 in such manner can advantageously allow valve 2090 to better "catch" and stop debris 2009 from inadvertently falling past valve 2090 when valve 2090 is transitioned from the mode illustrated in FIG. 20B (which may be a stick mode) to an "off" mode" or an "upright mode" in which valve 2090 moves back to a position in which is blocks debris 2009 from falling out of dirty air inlet 2021 (for example, FIG. 20A). Valve 2090 can be pivotably connected to a portion of handheld vacuum cleaner 2020 such that it rotates in the same rotational direction as the handheld vacuum cleaner 2020 (and/or a connected wand) when transitioned from an upright position (in which an axis of handheld vacuum cleaner 2020 and/or a connected wand is generally perpendicular to the ground and/or within 10 degrees of such axis) to an inclined position such as that illustrated in FIG. 20B and/or other inclined positions illustrated with respect to other cleaning apparatuses disclosed herein (for example, with respect to stick or upright modes).

Figures 21A, 21B, 21C, 21D:
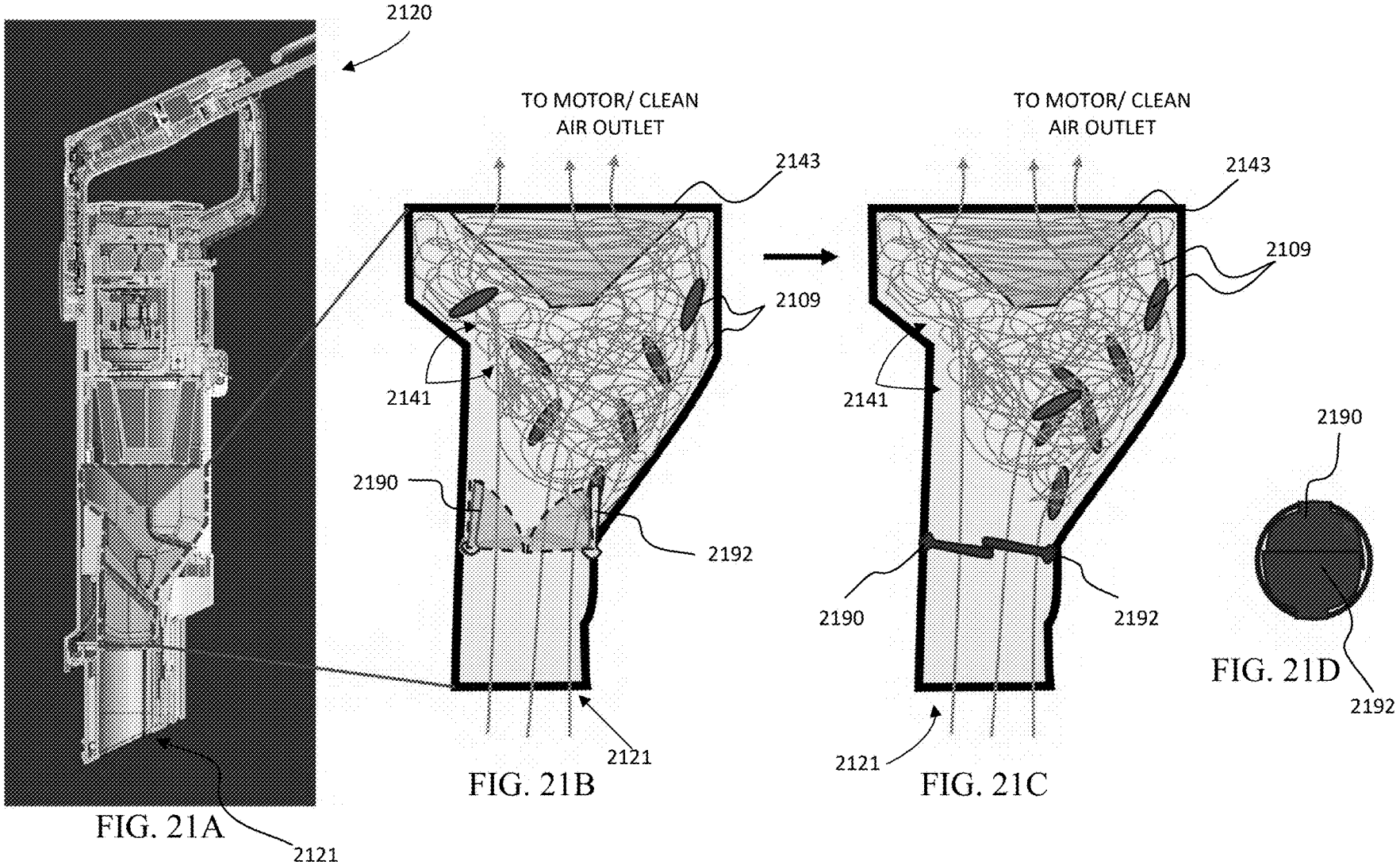
FIGS. 21A-21D illustrate another implementation of a handheld vacuum cleaner in accordance with aspects of this disclosure.

FIG. 21A illustrates a cross-sectional view of another implementation of a handheld vacuum cleaner 2120. Handheld vacuum cleaner 2120 can include any of the features described with respect to any of the handheld vacuum cleaners disclosed herein. FIGS. 21B-21C illustrate schematic representations of a portion of handheld vacuum cleaner 2120. Handheld vacuum cleaner 2120 includes a dirty air inlet 2121, a filter 2143, a debris container 2141, and two valves 2190, 2192 pivotable connected to opposite sides/portions of handheld vacuum cleaner 2120 which together can open and/or close a flow passage through dirty air inlet 2121. FIG. 21D illustrates a schematic bottom view of handheld vacuum cleaner 2120 and valves 2190, 2192 in a closed position. With reference to FIGS. 21C-21D, valves 2190, 2192 can overlap when in the closed position. Valves 2190, 2192 can be configured to resist weight of debris 2109 under force of gravity when in the closed position. Valves 2190, 2192 can be configured to pivot upward when a suction motor of handheld vacuum cleaner 2120 is on (for example, during a stick mode) and pivot downward when a suction motor of a connected floor-based vacuum cleaner is turned on (for example, during an auto-empty mode).

Figure 22A:
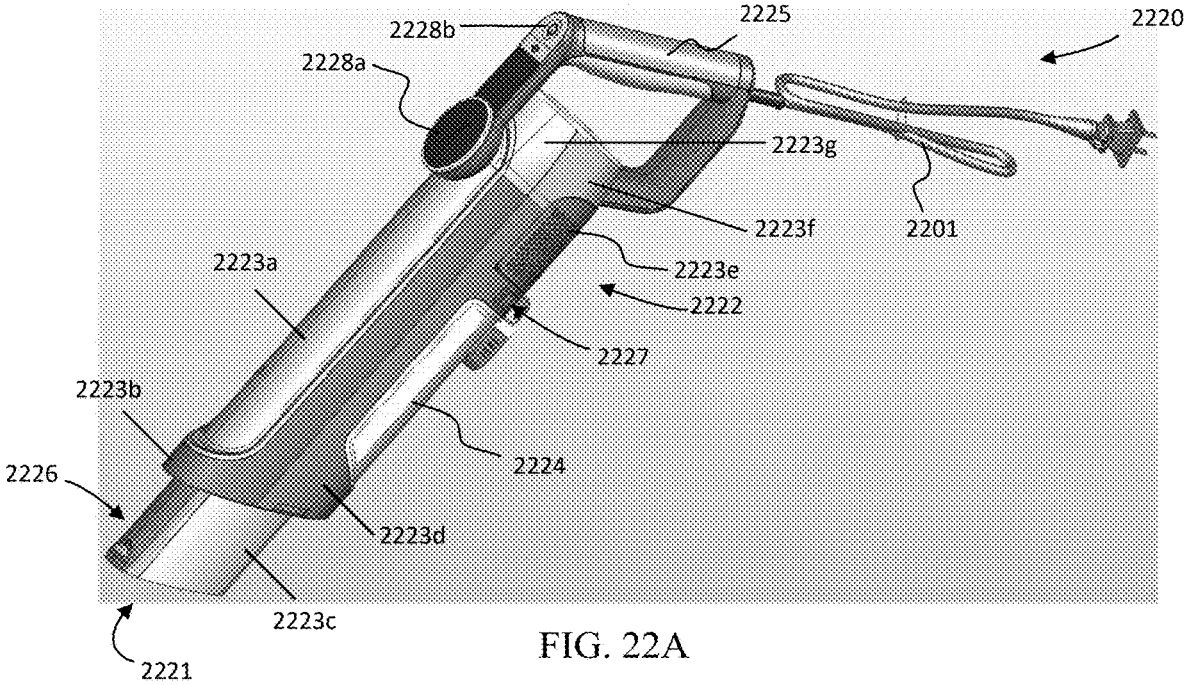
FIGS. 22A-22S illustrate various views of another implementation of a handheld vacuum cleaner and portions thereof in accordance with aspects of this disclosure.
Figure 22B:
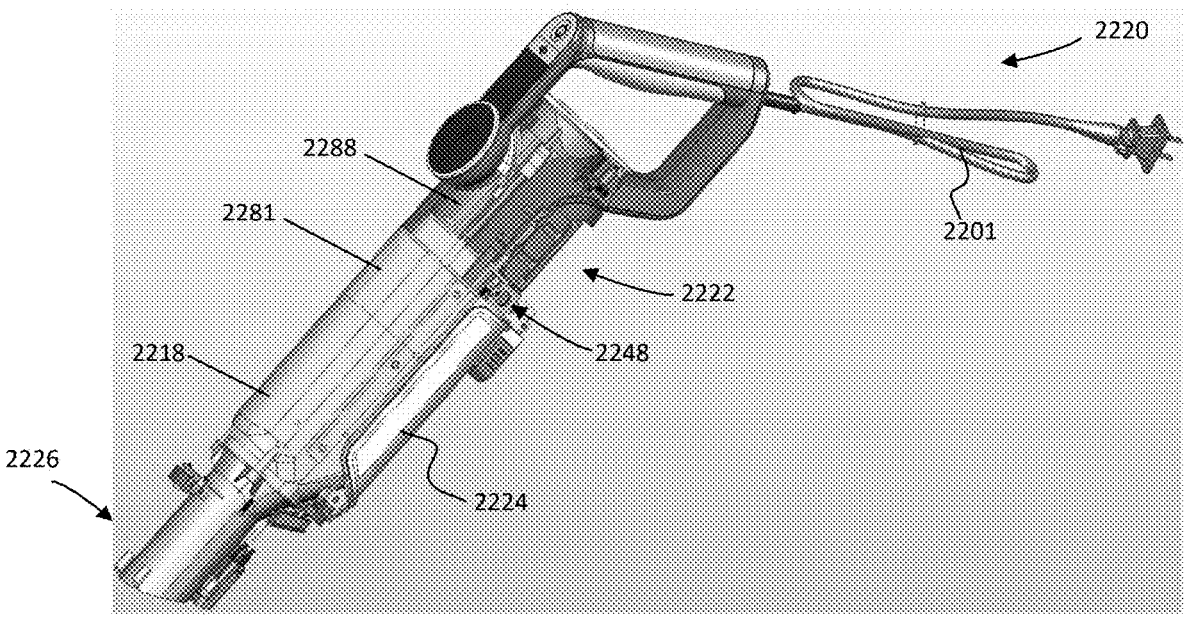
FIG. 22T illustrates a table showing various schematic representations and enlarged views of portions of a cleaning apparatus in different modes of operation in accordance with aspects of this disclosure.
FIGS. 22U-22GG illustrate various views of another implementation of a handheld vacuum cleaner and portions thereof in accordance with aspects of this disclosure.
FIGS. 22HH-22XX illustrate various views of another implementation of a handheld vacuum cleaner and portions thereof in accordance with aspects of this disclosure.
Figure 22C:
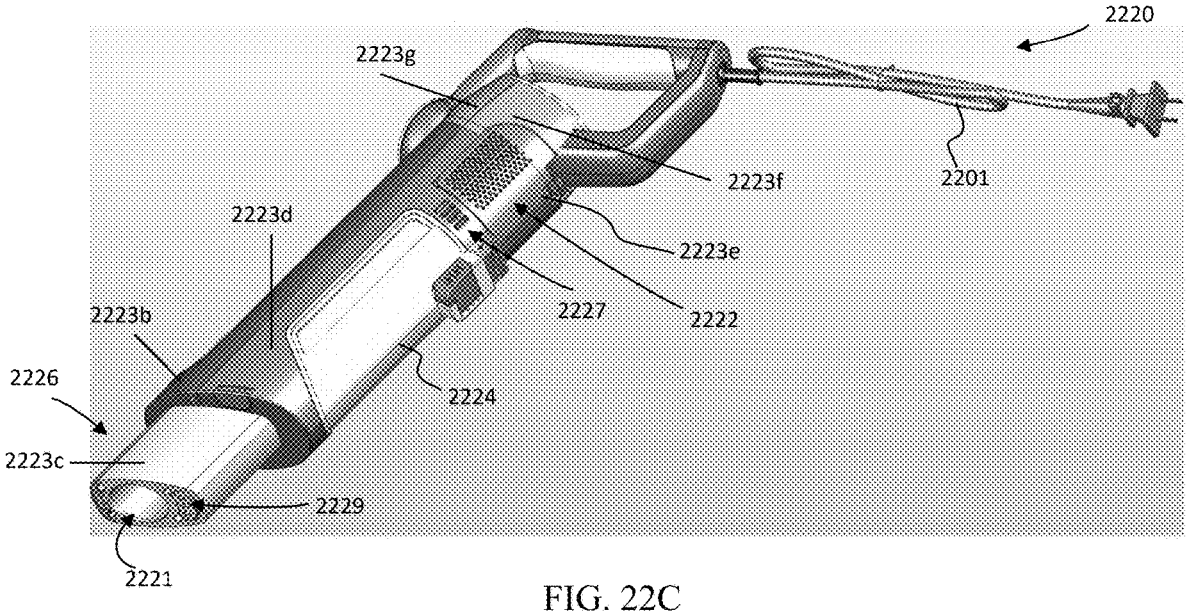
Figure 22D:
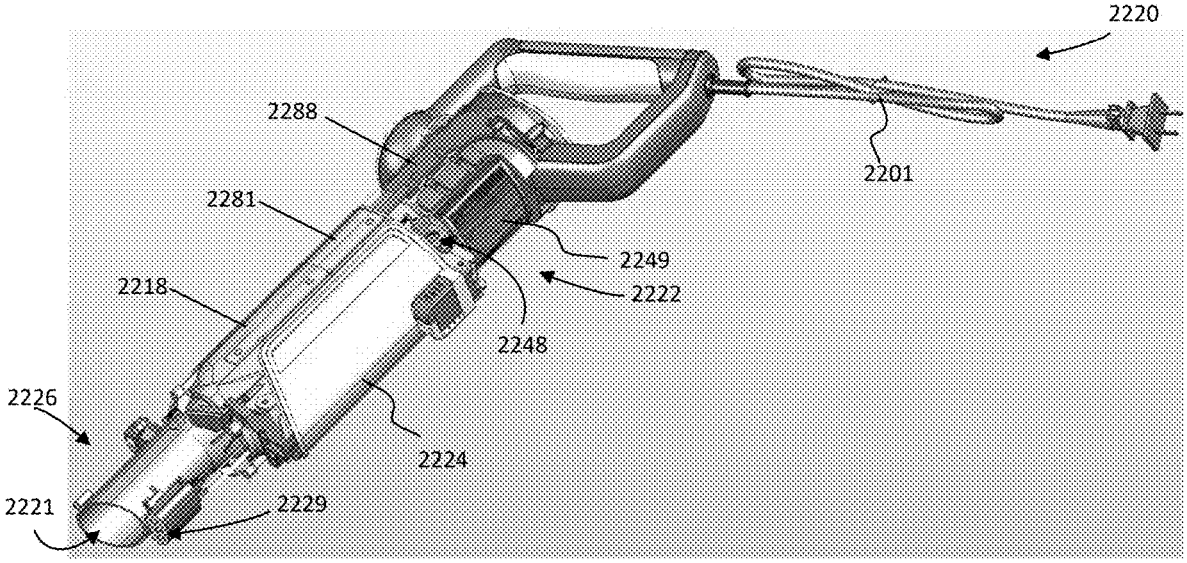

FIGS. 22A-22D illustrate perspective views of another implementation of a handheld vacuum cleaner 2220. Handheld vacuum cleaner 2220 can include any of the features described with respect to other handheld vacuum cleaners disclosed herein. Handheld vacuum cleaner 2220 can be part of a cleaning apparatus that is similar to any of the cleaning apparatuses disclosed herein. For example, handheld vacuum cleaner 2220 can be part of cleaning apparatus 2200 shown and described with respect to FIG. 22T. With reference to FIG. 22T, handheld vacuum cleaner 2220 can be coupled with a wand 2203, a support member 2205, a floor-based vacuum cleaner 2210, and/or a cleaning head 2230, each of which can be similar or identical in any respect to any of the wands, support members, floor-based vacuum cleaners, and cleaning heads disclosed herein (such as wand 1603, 1703, support member 1605, 1705, floor-based vacuum cleaner 1610, 1710, cleaning head 1630, 1730). Handheld vacuum cleaner 2220 can be utilized along with wand 2203, support member 2205, floor-based vacuum cleaner 2210, and/or cleaning head 2230 in any of a variety of operational modes, including the stick mode, auto-empty mode, and/or upright mode shown and described in more detail below with respect to FIG. 22T.

Handheld vacuum cleaner 2220 can be similar or identical to handheld vacuum cleaner 1820 in some or many respects. With reference to FIGS. 22A-22D, handheld vacuum cleaner 2220 can include a dirty air inlet 2221, a snout 2226, a debris container door 2224, a clean air outlet 2222, a handle 2225, a display 2228*a*, one or more controls 2228*b* (such as a button), and a power cord 2201. Controls 2228*b* and display 2228*a* can be similar or identical to controls 1828*b* and display 1828*a* described above with respect to handheld vacuum cleaner 1820. Handheld vacuum cleaner 2220 can include a controller that can be similar or identical to controller 327 described elsewhere herein. As shown in FIGS. 22C-22D, handheld vacuum cleaner 2220 can include an electrical connector 2229 to allow electrical communication with and/or power transmission to wand 2203, and any other component of cleaning apparatus 2200, for example, via wand 2203 (for example, support member 2205, floor-based vacuum cleaner 2210, and/or cleaning head 2230). Handheld vacuum cleaner 2220 can include various structural components that define structure and/or interior portions thereof. Handheld vacuum cleaner 2220 can include cover portions (which also may be referred to as "housing portions") 2223*a*, 2223*b*, 2223*c*, 223*d*, 2223*e*, 2223*f*, 2223*g* (see FIGS. 22A and 22C), which are removed in FIGS. 22B and 22D). Cover portion 2223*e* can include one or a plurality of openings which can define (alone or in combination with other components) clean air outlet 2222. Cover portion 2223*e* can be arranged to cover filter 2249 (which may be referred to as a "post-motor filter"). With reference to FIGS. 22C-22D, handheld vacuum cleaner 2220 can include vents 2227, for example, in cover portion 2223*d*, which can provide fluid communication between auxiliary air inlet 2248. Auxiliary air inlet 2248 can be similar or identical to auxiliary air inlet 1848. Handheld vacuum cleaner 2220 can include a bleed valve chamber and bleed valve that are similar or identical to bleed valve chamber 1846 and bleed valve 1845 described above with respect to handheld vacuum cleaner 1820, and handheld vacuum cleaner 2220 can include any of the other components or features described with respect to bleed valve chamber 1846 and bleed valve 1845.

Figure 22E:
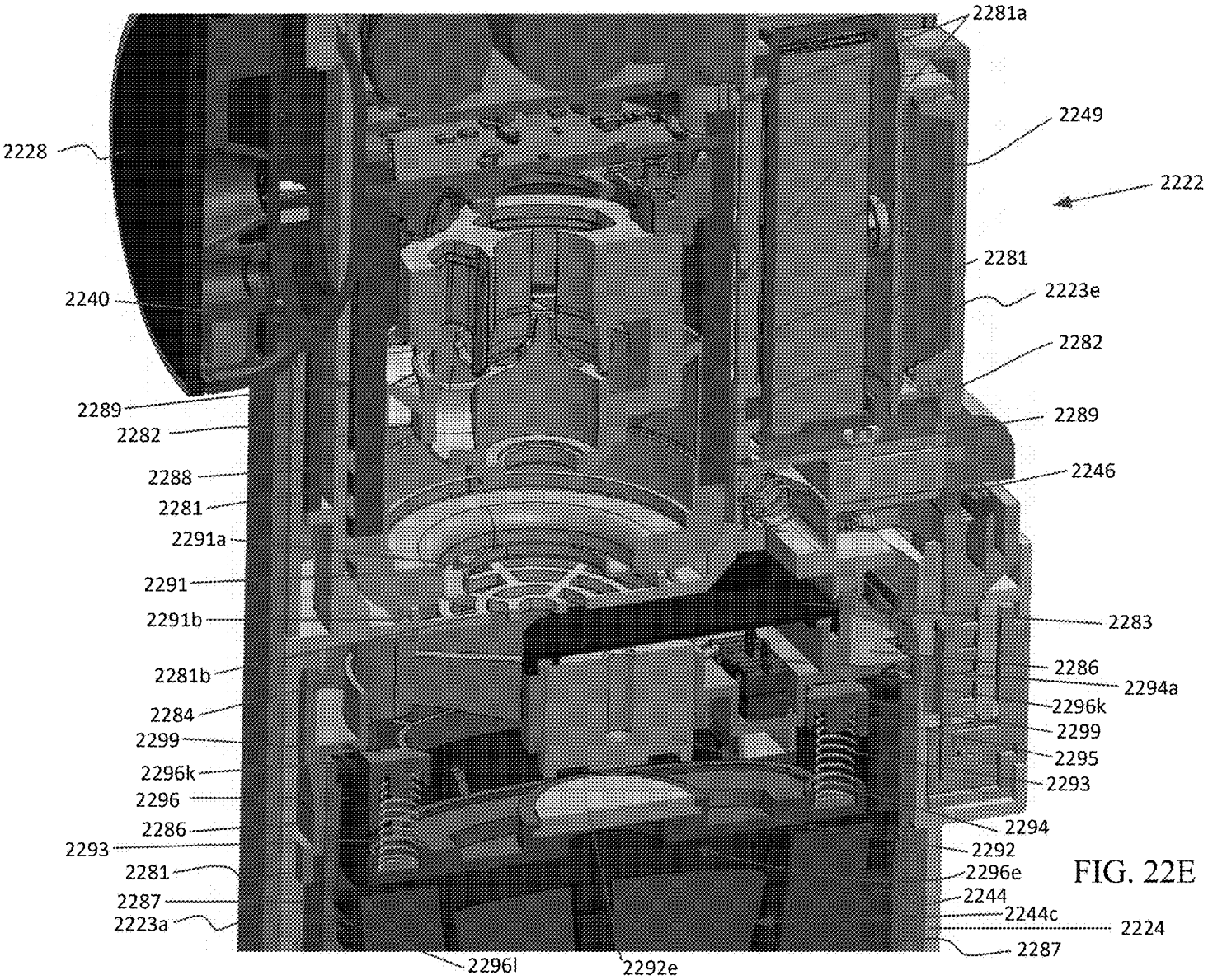
Figure 22F:
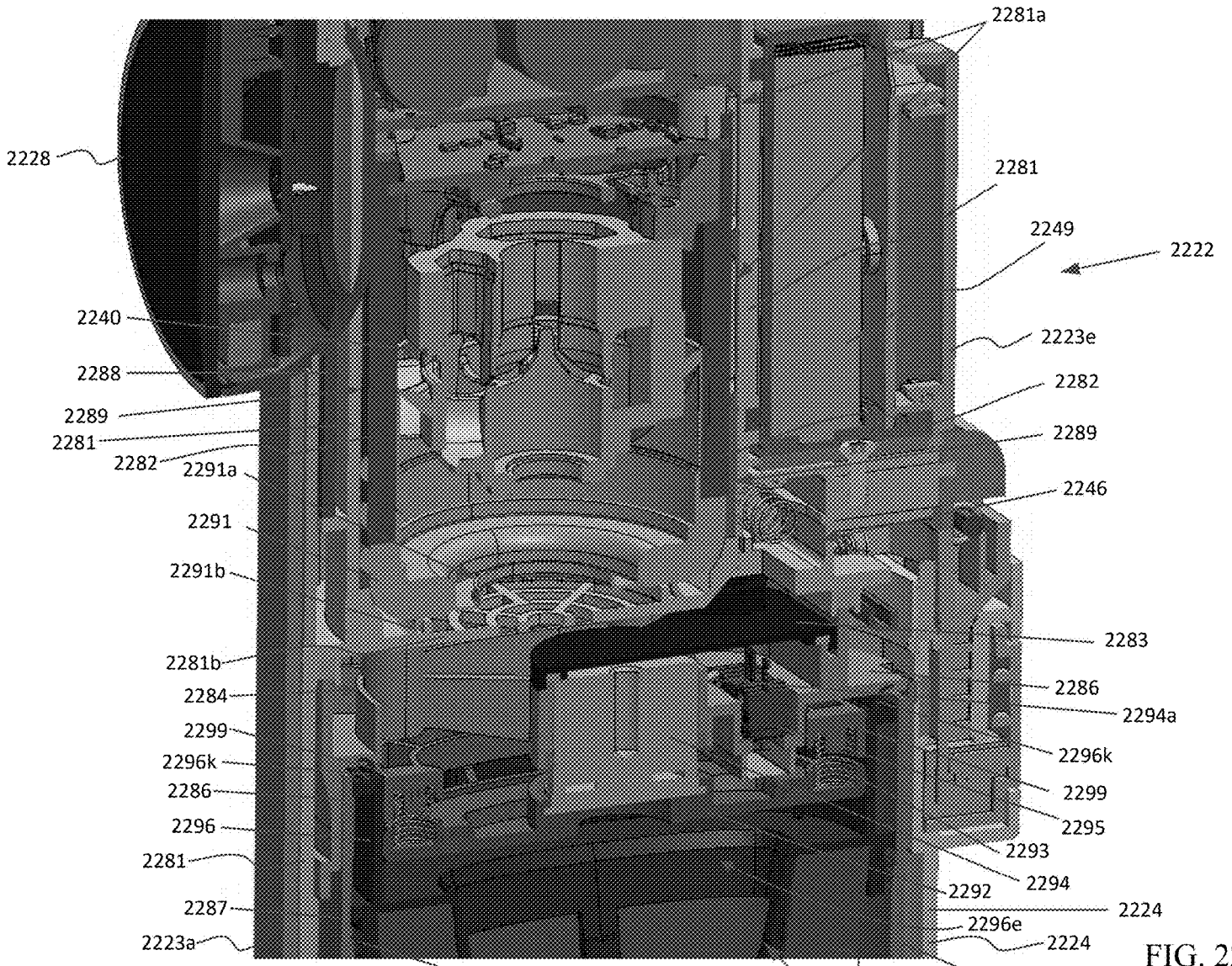

FIGS. 22E-22F illustrate perspective, cross-sectional views taken through a portion of handheld vacuum cleaner 2220. FIGS. 22Q-22S illustrate cross-sectional views taken through a portion of handheld vacuum cleaner 2220 during stick, auto-empty, and upright modes of operation as described further below. As shown, handheld vacuum cleaner 2220 can include a mesh filter 2243 (which may also be referred to as a "fluff screen"), a pre-motor filter 2244 (for example, a radial filter), a suction motor 2240 (which can be similar or identical to any of the other suction motors disclosed herein), a post-motor filter 2249 (for example, a HEPA filter) proximate clean air outlet 2222, and/or a debris container 2241 (which may also be referred to as "debris containing region" or "debris chamber"). Any of such components, along with others, can be arranged in various portions of an interior of handheld vacuum cleaner 1820 as shown. Debris container 2241 may be defined by one or more interior portions of handheld vacuum cleaner 2220 (which may be at least partially formed by debris container door 2224). Filter 2243, filter 2244, and/or other components (for example, filter support 2296, filter cap 2297, structural component 2287, and/or other components) may form a debris separator that separates debris from air flowing through handheld vacuum cleaner 2220. Handheld vacuum cleaner 2220 can include one or a plurality of structural components that help form such interior along with any of the various flow passages described herein (for example, with respect to any of the operational modes shown and/or described herein). For example, handheld vacuum cleaner 2220 can include structural members 2281, 2286, 2287, 2288, 2218 that can at least partially form one or more interior regions of handheld vacuum cleaner 1820 and/or can help support, enclose, and/or operably position various components of handheld vacuum cleaner 2220 (see FIGS. 22E-22H and 22Q-22S). Structural components 2281 and 2218 can be integral or non-integral with one another. As shown, motor 2240 can be coupled with an air-permeable membrane 2282 (for example, comprising a foam material), and motor 2240 and membrane 2282 can be arranged within an interior region 2289 of handheld vacuum cleaner 2220 (which may be at least partially defined by structural component 2281). Interior region 2289 can be in fluid communication with clean air outlet 2222 (and thus ambient) via one or a plurality of vents 2281*a* in structural component 1881 (see FIG. 22E-22F). Membrane 2282 can include an interior that surrounds a portion of motor 2240 and can be coupled to a motor casing 2291 (see FIGS. 22E-22F) and interior region 2289 can be in fluid communication with such interior since membrane 2282 is air permeable. Structural component 2281 can include an inner wall having one or more openings, for example, a grill 2281*b*, which can be in fluid communication with an interior region 2284 of handheld vacuum cleaner 2220 (see FIGS. 22E-22F and 22H). Grill 2281*b* can be arranged below an opening 2291*a* of motor casing 2291 as shown. Motor casing 2291 can include a seal member 2291*b* that surrounds opening 2291*a*, grill 2281*b*, and contacts the inner wall of structural component 2281 which grill 2281*b* is formed, thereby sealing around the flow passage through/between such components. Interior region 2284 may be at least partially defined by structural component 2286 and 2281. As shown in FIG. 18D, handheld vacuum cleaner 1820 can include a cover 2283 connected to a portion of structural component 2286, for example, over electromagnet 2294 as shown.

FIGS. 22E-22F also illustrate electromagnet 2294, valve 2292, a valve biasing member 2299, springs 2293, among other components. FIG. 22E illustrates valve 2292 in an example closed position while FIG. 22F illustrates valve 2292 in an example open position. When valve 2292 is in an open position (described in more detail elsewhere herein), interior region 2284 can be in fluid communication with opening 2296*e* in filter support 2296 (and filter interior 2244*c*) via a gap between portions of valve 2292 and portions of filter support 2296, which allows air to flow around valve 2292. Air flowing through opening 2296*e* and filter interior 2244*c* can flow through a wall of filter 2244, in interior region 2298 (which may be defined between filter 2244 and structural component 2287), and through a gap/spacing 2285 between filter 2243 and filter 2244 and/or cap 2297 (see FIGS. 22Q-22R). Air can flow through filter 2243 and debris container 2241 from either direction, depending on the operational mode (for example, stick mode or auto-empty mode). Handheld vacuum cleaner 2220 can include a valve 2290 for preventing debris from falling out of debris container 2241. Valve 2290 can be similar or identical to valve 1890, 2090, in any respect. FIG. 22S illustrates valve 2290 in an example closed position (for example, during an upright mode). Valve 2290 can be opened to allow airflow through dirty air inlet 2221 from either direction, depending on the operational mode as described in more detail below. With reference to FIGS. 22E-22F and 22K, filter support 2296 can include a seal member 2296*k* that can contact and form a seal with portions of structural component 2286 and a seal member 22961 that can contact and form a seal with portions of structural component 2287.

Figure 22H:
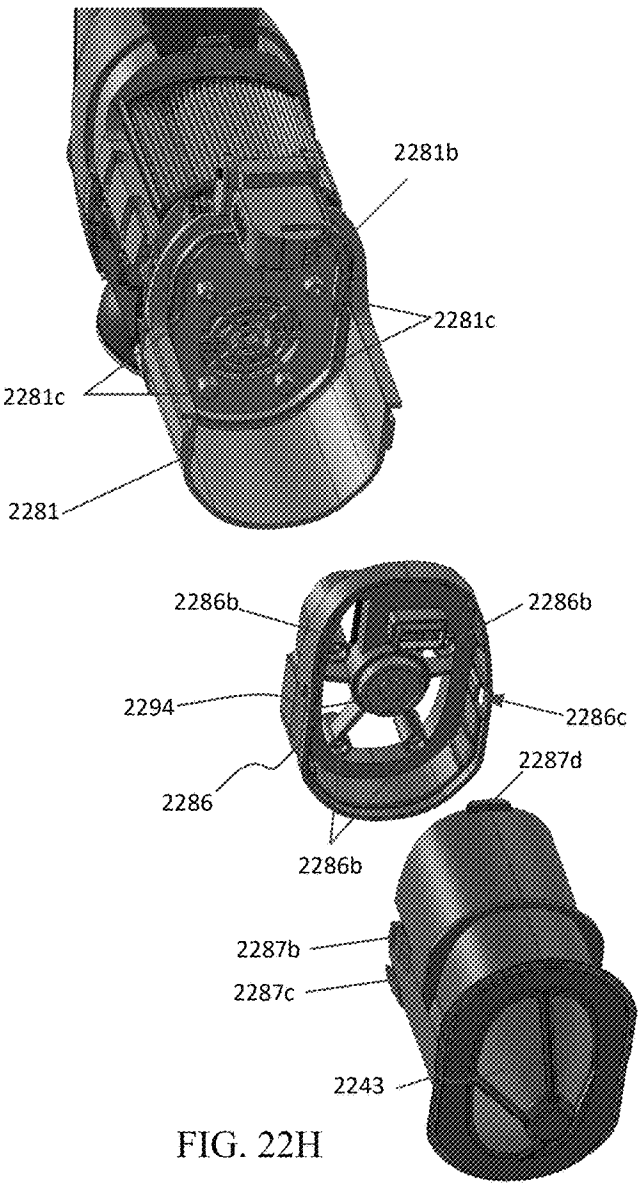
Figure 22G:
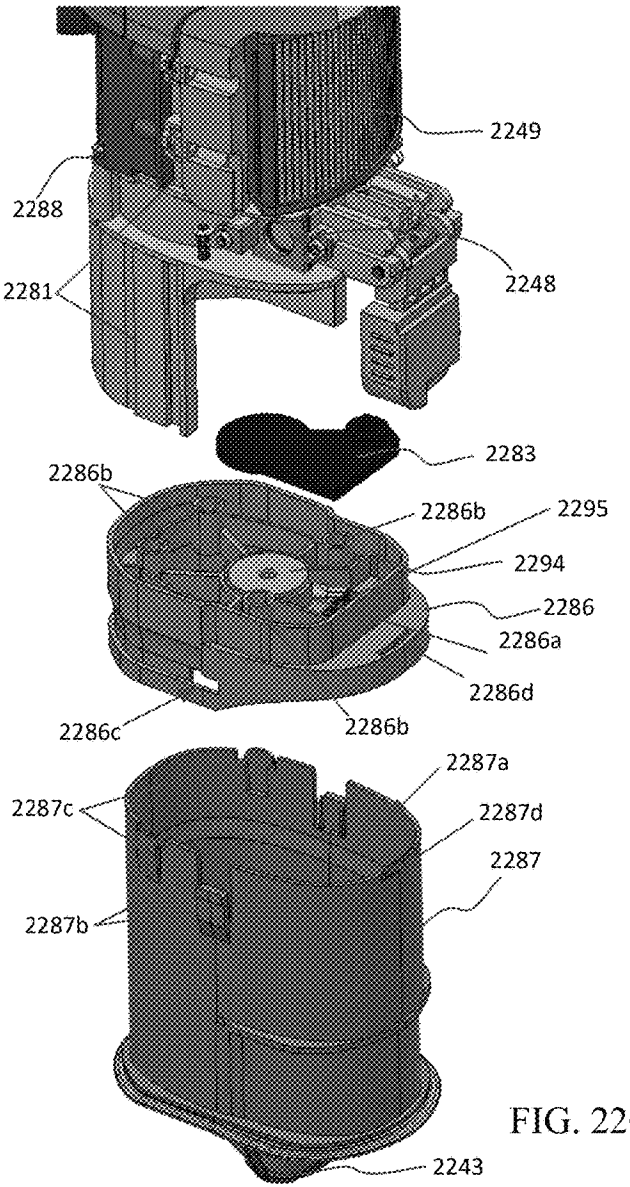

FIGS. 22G-22H illustrate perspective exploded views of portions of handheld vacuum cleaner 2220, illustrating, among other things, structural components 2281, 2286, and 2287. Structural component 2281 can include one or a plurality of posts 2281*c* configured to secure to chambers 2286*b* of structural component 2286. One of such posts 2281*c* may also secure to a chamber on cover 2283 (see FIG. 22G). Structural component 2286 can be configured to operably position and/or house electromagnet 2286 and any of a variety of electrical components coupled with electromagnet 2294, such as electrical component 2295 which can facilitate transmission of electrical energy to electromagnet 2294 (see FIGS. 22E-22G). Electrical component 2295 can be coupled to electromagnet 2294 via one or more wires 2294*a* (see FIGS. 22E-22F). Electrical component 2295 can be a power supply. Electrical component 2295 can be configured to supply DC power to electromagnet 2294, for example, 5V DC power. Electromagnet 2294 can be in electrical communication with a controller and/or power cord 2201 of handheld vacuum cleaner 2220 via direct and/or indirect electrical connection via electrical component 2295 and/or a variety of other electrical components (such as wiring). Structural component 2286 can include a socket 2286*a* sized and/or shaped to receive electromagnet 2294 (see FIG. 22G). Structural component 2287 can be formed by one or more walls that form an interior 2287*a* which can receive filter support 2096, filter 2244, filter cap 2297, valve 2292, valve biasing member 2299, and springs 2293 (see FIGS. 22Q-22S and 22E-22H). Structural component 2287 can include arms 2287*b* configured to secure to and/or within openings 2286*c* of structural component 2286 and/or an arm 2287*d* configured to secure to and/or within opening 2285*d* of structural component 2286. Structural component 2287 may include arms 2287*c* configured to engage portions of structural component 2286 (for example, within channels formed on interior surfaces of structural component 2286).

Figure 22J:
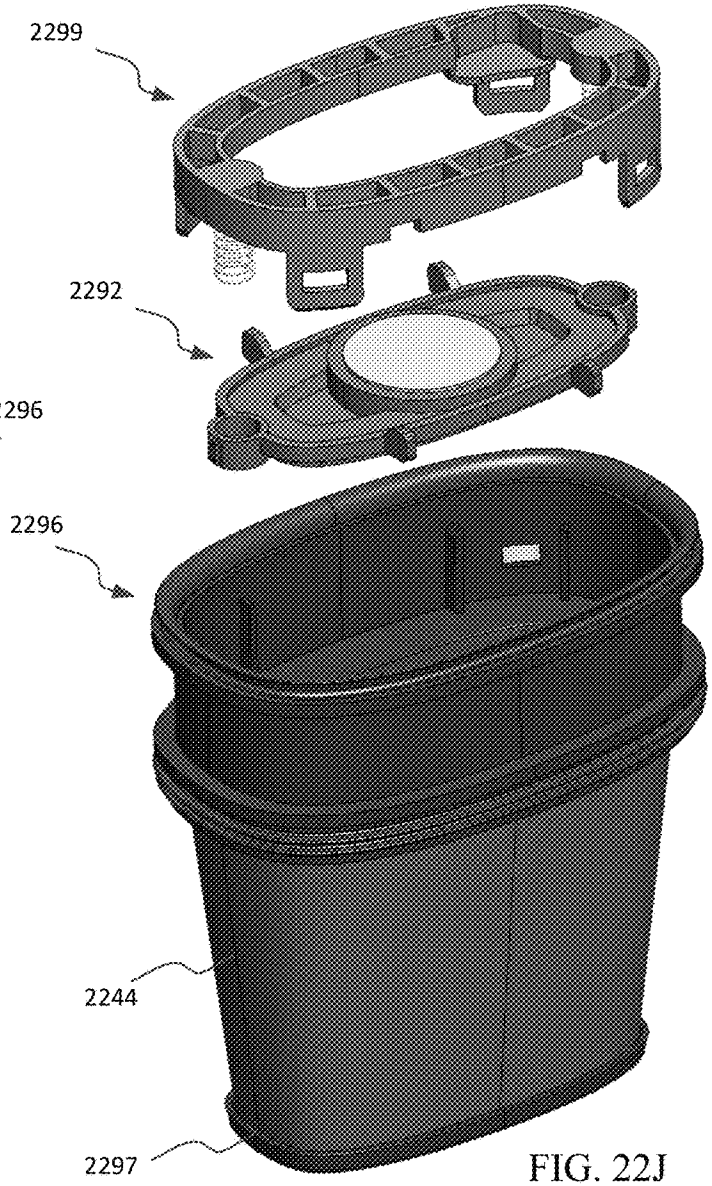
Figure 22I:
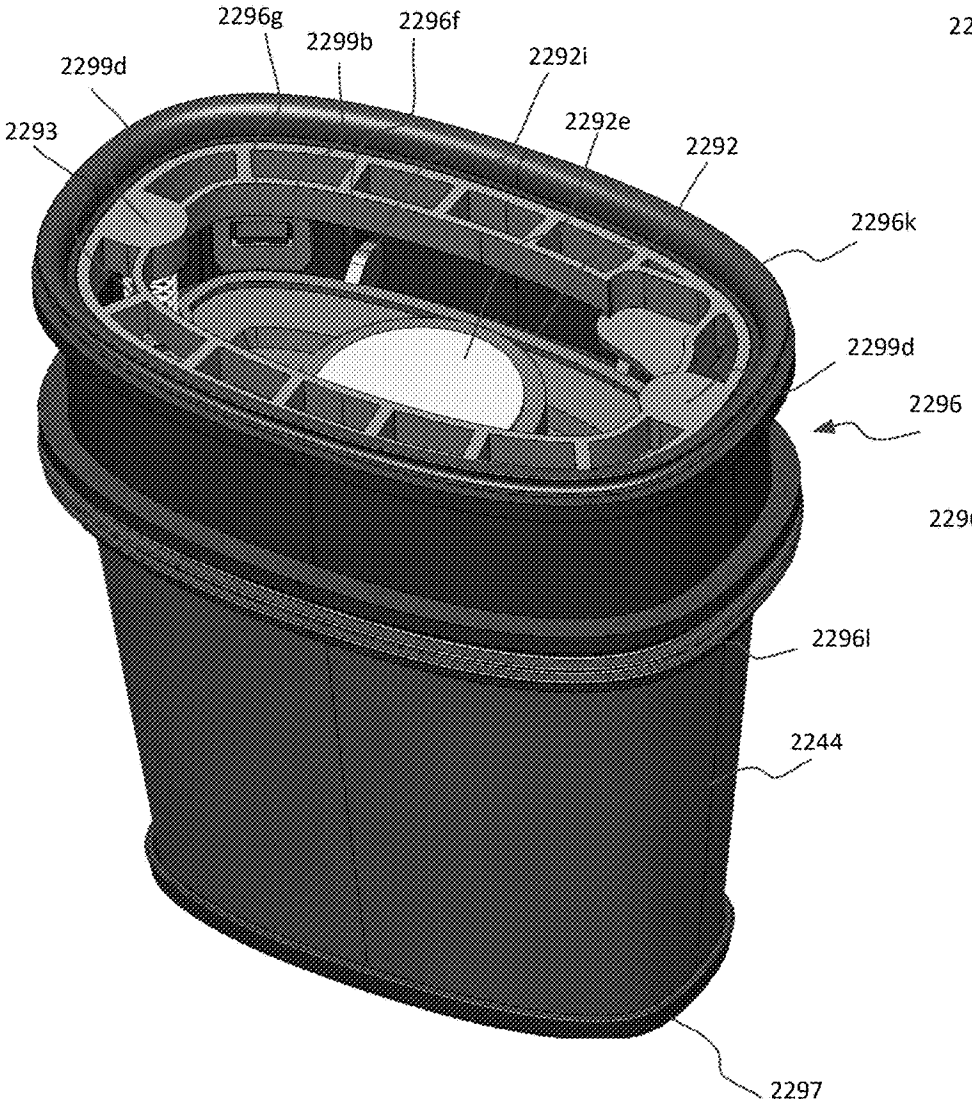
Figure 22K:
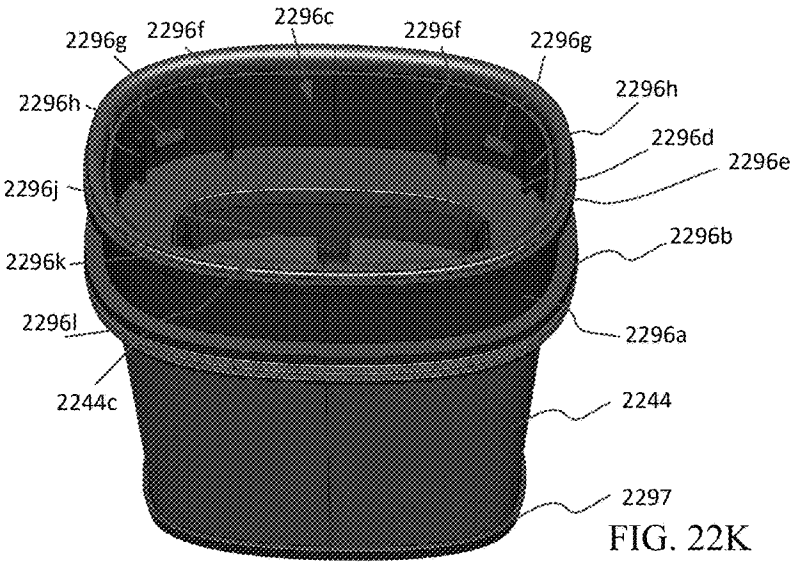
Figure 22L:
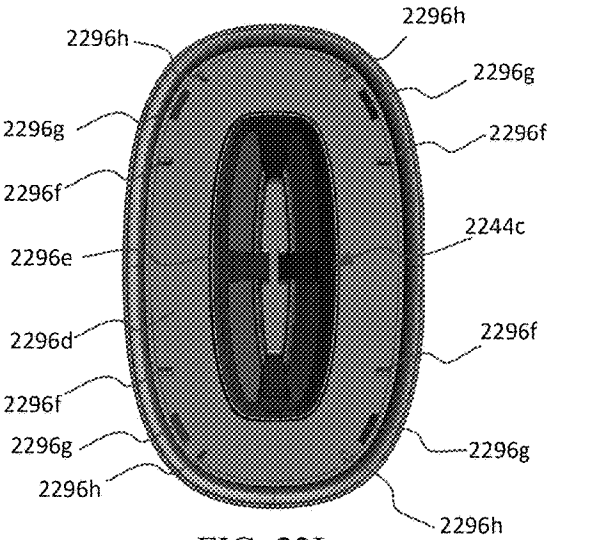

FIG. 22I illustrates a perspective view of filter support 2296, filter 2244, cap 2297, valve 2292, and valve biasing member 2299 in an assembled state while FIG. 22J illustrates valve 2292 and valve biasing member 2299 in a disassembled state. FIGS. 22K and 22L illustrate top perspective and top views (respectively) of filter support 2296, filter 2244, and cap 2297, which may form a filter assembly (which may be referred to as a "pre-motor filter assembly"). Filter support 2296 can be similar to filter support 1896 in some or many respects. Filter 2244 can be identical to filter 1844 and can include openings identical to openings 1844*a*, 1844*b* and an interior 2244*c* that can be identical to interior 1844*c*. Filter cap 2297 can be identical to filter cap 1897. Filter support 2296 can connect to and provide support for filter 2244 and can include a wall 2296*a*, a base 2296*b*, an opening 2296*e* in base 2296*b*, each of which can be similar or identical to wall 1896*a*, 1896*b*, and opening 1896*e* (respectively). Wall 2296*a* and base 2296*b* can define an interior 2296*c* for receiving valve 2292 and valve biasing member 2299 (see FIG. 22I). Filter support 2296 can include a frame 2296*j* that can be identical to frame 1896*j* (see FIG. 22K).

Figure 22M:
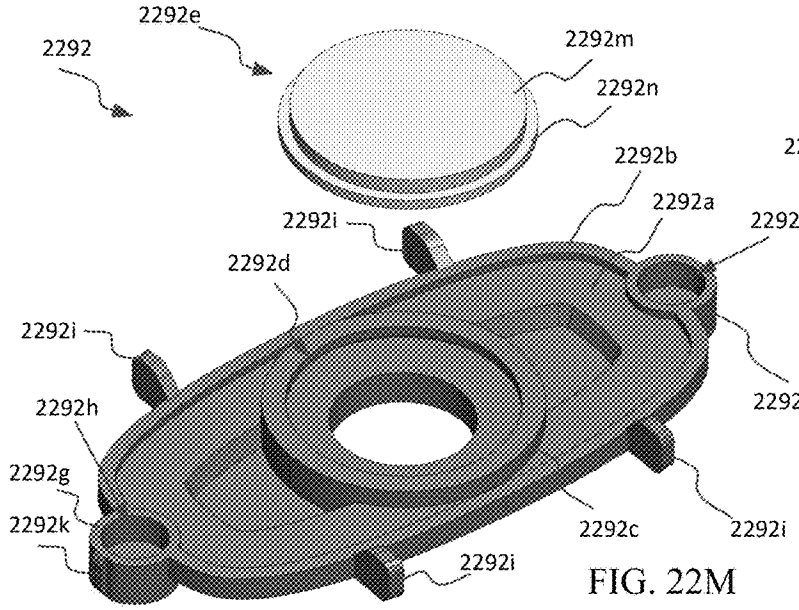
Figure 22N:
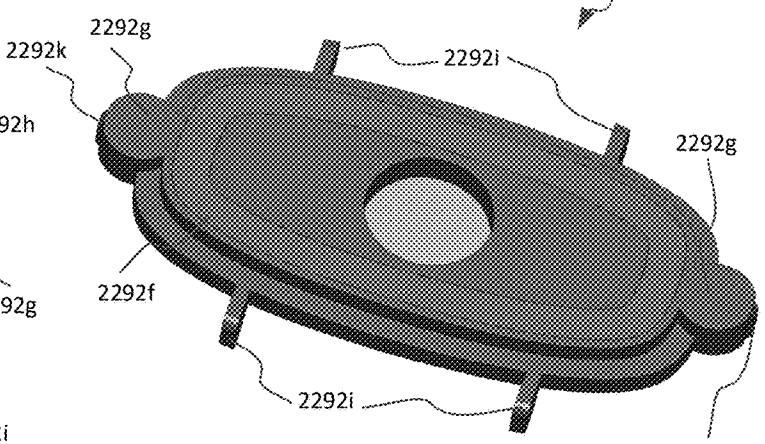
Figure 22O:
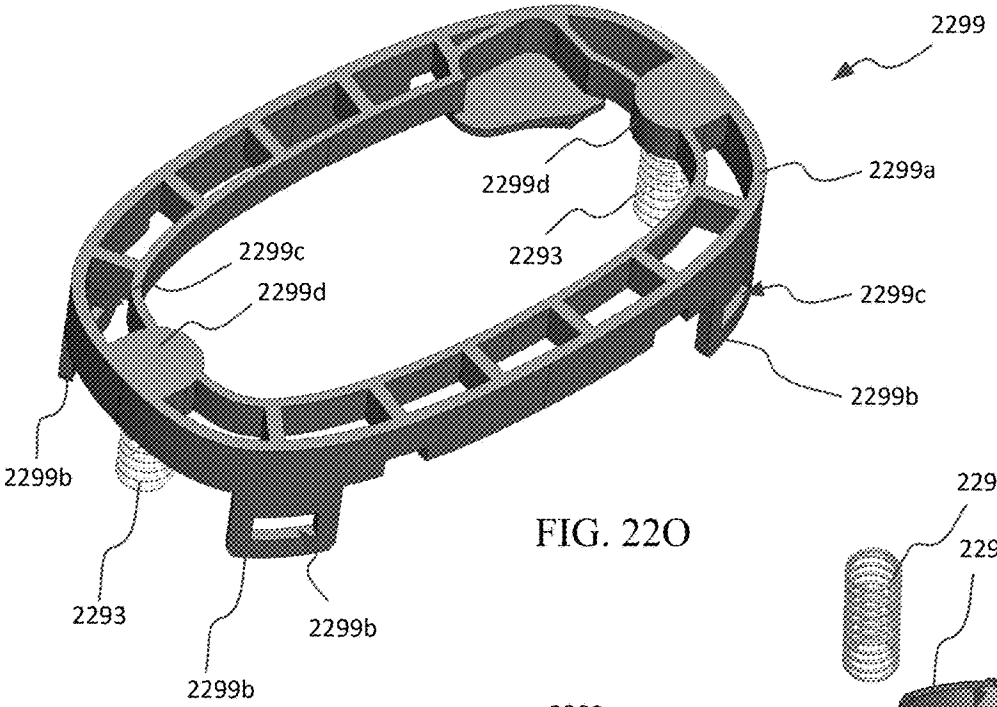

FIGS. 22M-22N illustrate top (exploded) and bottom perspective views of valve 2292. Valve 2292 can include a base 2292*a*, a wall 2292*b*, magnet 2292*e*, and a magnet holder arranged on and/or extending from base 2292*a*. Magnet 2292*e* can be identical to magnet 1892*e*. Magnet 2292*e* advantageously allows valve 2292 to be moved and/or held in place by electromagnet 2294, as described in more detail below. Such magnet holder can be sized and/or shaped to secure magnet 2292*e* in place and can be similar or identical to the magnet holder described with respect to valve 1892. Such magnet holder can be formed from an inner wall 2292*c* (for example, having a cylindrical shape) having a lip (for example, at an end and/or top portion thereof) that receives a rim portion 2292*n* of magnet 2292*e*. Wall 2292*c* can define a cavity 2292*d* for receiving magnet 2292*e*. Magnet 2292*e* can be secured to other portions of valve 2292 in a similar or identical manner as that described above with respect to magnet 1892*e* and valve 1892 (for example, to cause valve 2292 to move with magnet 2292*e* under magnetic force induced by electromagnet 2294). Valve 2292 can include guide protrusions 2292*k*, guide arms 2292*i*, and/or spring chambers 2292*g* including cavities 2292*h* for receiving portions or springs 2293. Any or all of guide protrusions guide protrusions 2292*k*, guide arms 2292*i*, and/or spring chambers 2292*g* may be arranged along a perimeter of valve 2292, as shown. With reference to FIG. 22N, valve 2292 can include a seal member 2292*f* for sealing an opening of filter support 2296 (for example, opening 2296*e*) and/or an opening of filter 2244 (for example, opening 2244*a*) when valve 2292 is in a closed position. Seal member 2292*f* can create a seal around any of such openings, for example, when contacting a surface 2296*d* of filter support 2296 (see FIGS. 22E and 22K-22L). In some implementations, filter support 2296 includes a skirt wall that extends outward from surface 2296*d* and around opening 2296*e*, and such skirt wall engages seal member 2292*f* when valve 2292 is in a closed position. Seal member 2292*f* can be identical to seal member 1892*f*.

Figure 22P:
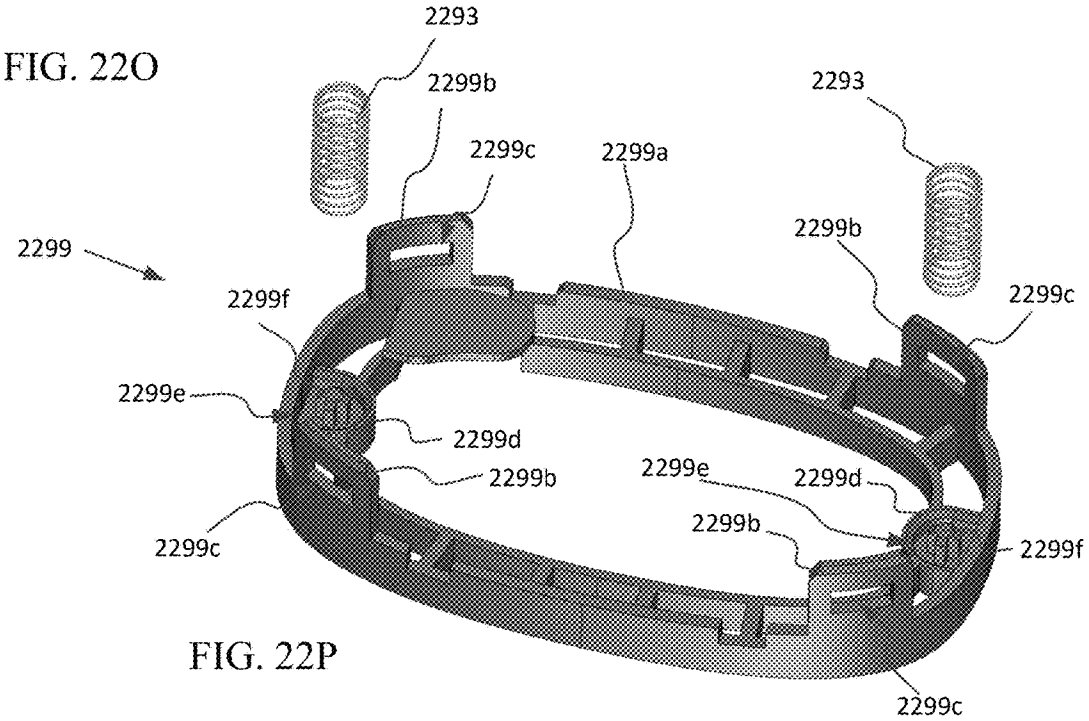
Figure 22Q:
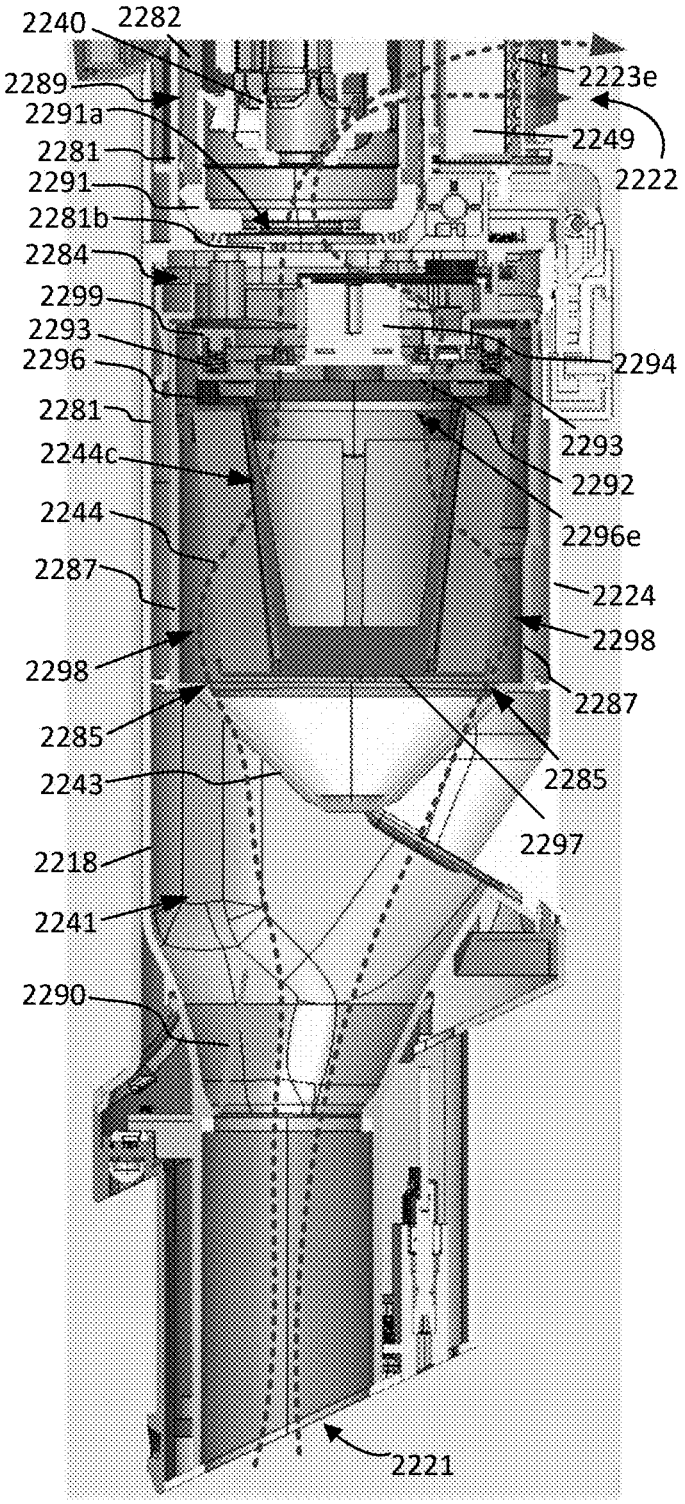
Figure 22R:
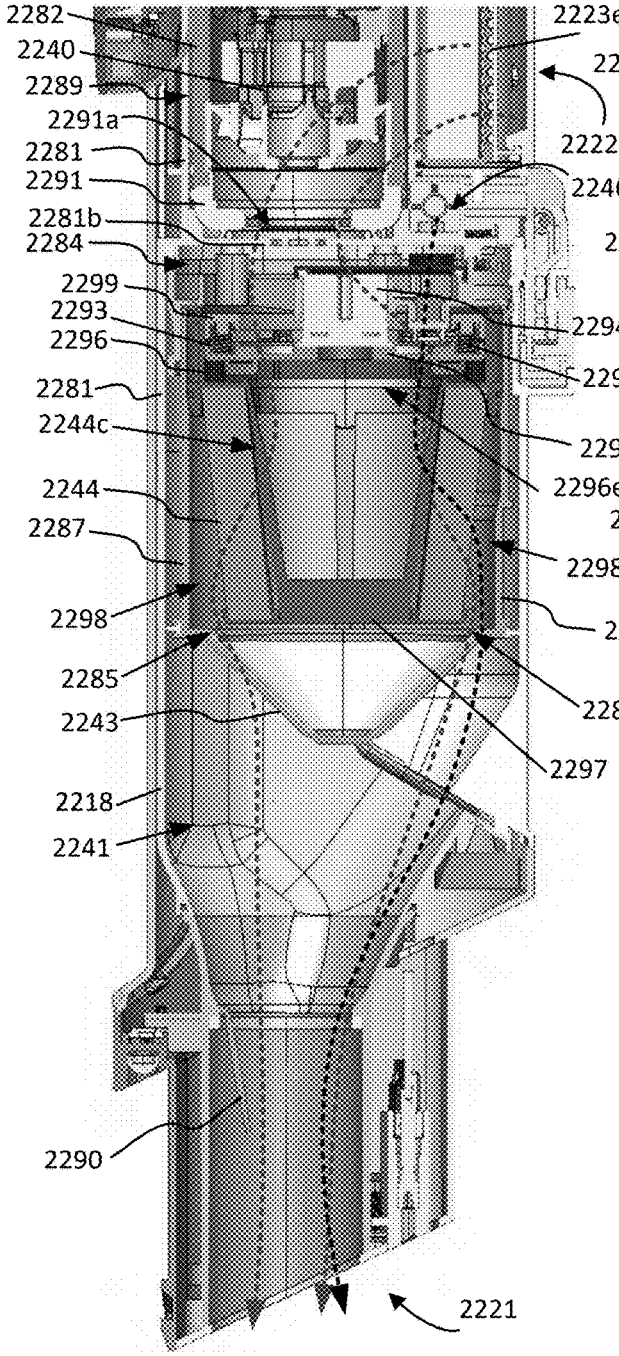
Figure 22S:
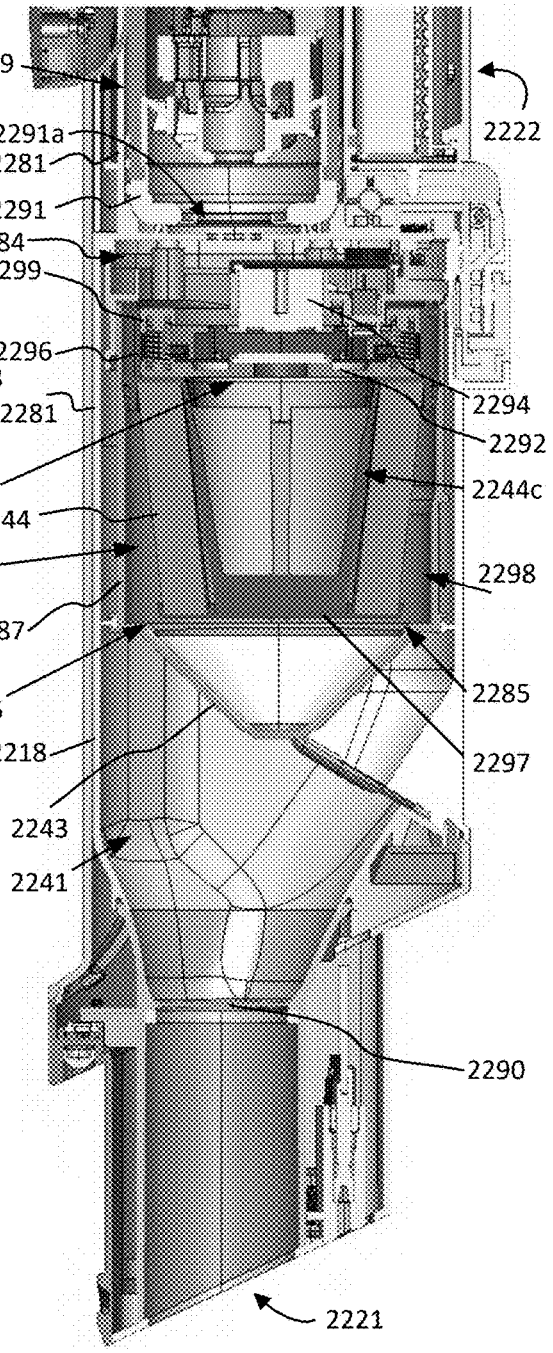
Figure 22T:
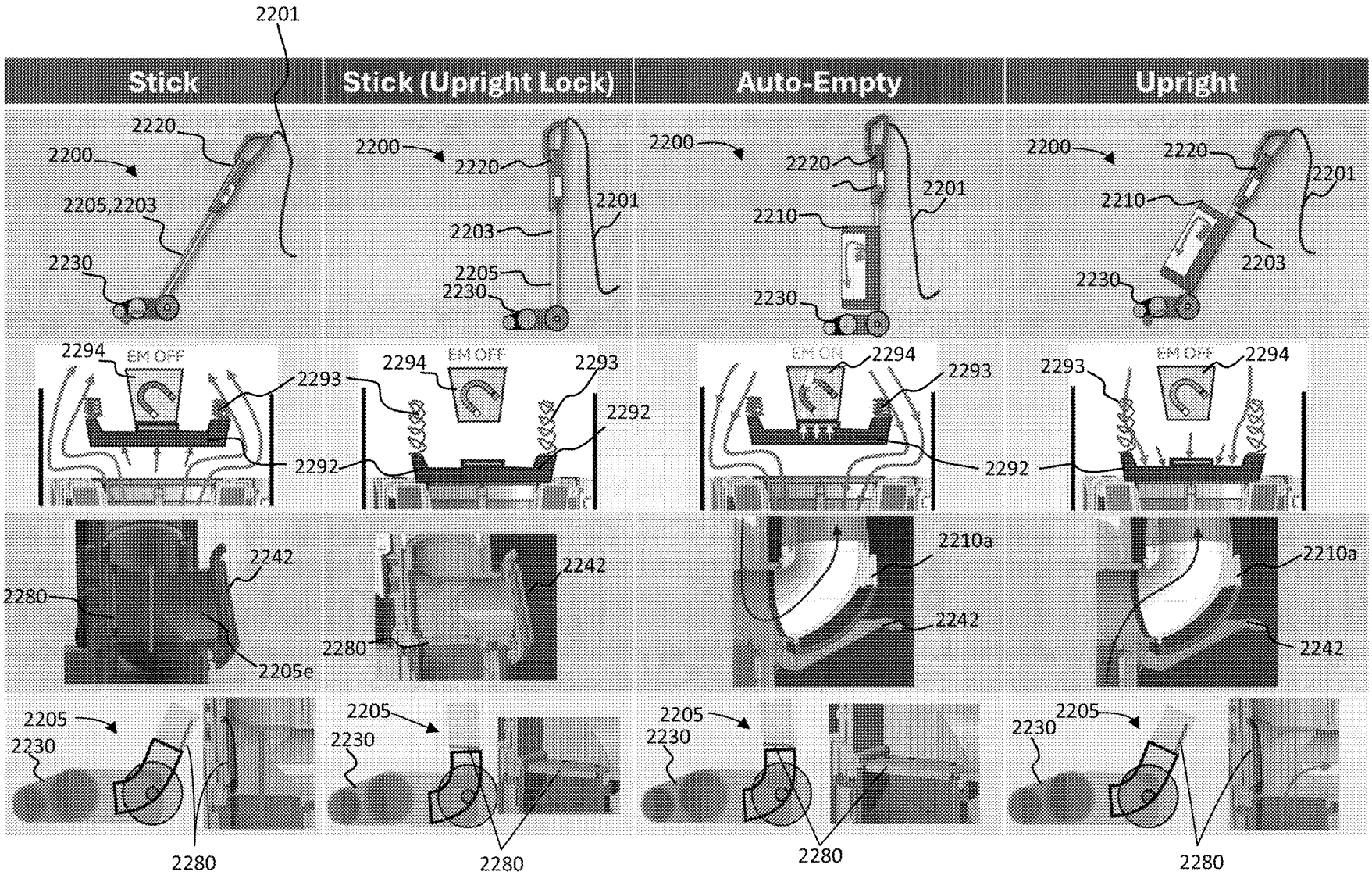

FIGS. 220-22P illustrate top and bottom perspective views of valve biasing member 2299. Valve biasing member 2299 can be configured to bias valve 2292 towards a closed position in which valve 2292 covers opening 2296*e* and/or an opening of filter 2244. In such closed position, valve 2292 can block a flow path between dirty air inlet 2221 and either or both of clean air outlet 2222 and auxiliary air inlet 2248. Valve biasing member 2299 can include a body 2299*a* which may have a frame structure with a plurality of openings (as shown). Body 2299*a* may comprise an annular shape. Valve biasing member 2299 can include arms 2299*b* having openings 2299*c*. Valve biasing member 2299 can include spring chambers 2299*d* having cavities 2299*e* and posts 2299*f* to receive and engage ends of springs 2293. Valve biasing member 2299 can be coupled with filter support 2296 via engagement of protrusions 2296*g* within openings 2299*c* (see FIGS. 22K-22L and 22I). In some implementations, relative movement of valve biasing member 2299 and filter support 2296 is inhibited (for example, prevented) when coupled to one another. Arms 2299*b* can be arranged adjacent walls 2296*h* extending from an inner surface of wall 2296*a* (see FIGS. 22K-22L and 22I).

Valve 2292, valve biasing member 2299, and filter support 2296 can be configured to allow valve 2292 to move relative to valve biasing member 2299 and filter support 2296 between the open and closed positions, such as those described herein. Each of springs 2293 can have a first end arranged within a cavity 2299*e* around post 2299*f* and a second end arranged within a cavity 2292*h*. Springs 2293 can apply a biasing force against valve 2292 to bias valve 2292 towards the closed position described above. Valve 2292 can be configured to move to an open position during various operational modes of cleaning apparatus 2200, for example, during a stick mode in which suction motor 2240 causes valve 2292 to move via suction force and/or during an auto-empty mode in which electromagnet 2294 is activated and magnetically attracts magnet 2292*e*. Valve guide arms 2292*i* can be arranged between and/or adjacent walls 2296*f* of filter support to guide and/or define movement of valve 2292. Walls 2296*f* can extend from the inner surface of wall 2296. Guide arms 2292*i* and/or protrusions 2292*k* can also serve the function of spacing valve wall 2292*b* and base 2292*a* away from the inner surface of wall 2296*a* of filter support 2296 (for example, causing gap(s) to exist) to allow air to flow around valve 2292 and through opening 2296*e*, as described elsewhere herein.

FIGS. 22Q-22S illustrate handheld vacuum cleaner 2220 in example stick, auto-empty, and upright modes of operation (respectively). FIG. 22T shows a table illustrating schematic representations of cleaning apparatus 2200 (and portions thereof) in such modes of operation (as well as a "Stick (Upright Lock)" mode). FIG. 22T illustrates cross-sections through portions of support member 2205 and floor-based vacuum cleaner 2210, which may be similar or identical to that illustrated and/or described with respect to support member 2205 and floor-based vacuum cleaner 2210. As described in more detail below, valve 2292 can be configured to be moved between a closed position (see FIG. 22S) and an open position (see FIGS. 22Q-22R). In such closed position, valve 2292 can block a flow path between dirty air inlet 2221 and either or both of clean air outlet 2222 and bleed valve chamber 2246 (thus, auxiliary air inlet 2248). In such open position, such flow path is open (not blocked by valve 2292). Such flow path may be at least partially defined by filter 2244 (for example, interior cavity 2244*c*), and valve 2292 can be arranged between filter 2244 and suction motor 2240. In some implementations, valve 2292 covers opening 2296*e* and/or an opening of filter 2244 when in such closed position.

FIG. 22Q illustrates a cross-section taken through a portion of handheld vacuum cleaner 2220 when in an example "stick" mode of operation which corresponds to that illustrated in in the "Stick" column in the table of FIG. 22T. Example air flow paths in such mode are illustrated in dotted lines (with arrows) in FIG. 22Q. In such mode, valve 2290 can be pivoted to a first open position (for example, away from dirty air inlet 2221). Valve 2290 can be moved to such position by suction force induced by suction motor 2240, thereby allowing debris to enter into debris container 2241. In such stick mode, air can flow into handheld vacuum cleaner 2220 (for example, via wand 2203) through dirty air inlet 2221 and out of handheld vacuum cleaner 2220 via clean air outlet 2222. In such stick mode, air may flow through dirty air inlet 2221, past valve 2290, through debris container 2241, through filter 2243, through gap 2285 (for example, around an end of filter 2222 and/or cap 2297), into interior region 2298, through a wall/sidewall of filter 2244, into interior 2244*c*, through an opening of filter 2244 and/or opening 2296*e*, past valve 2292 (for example, through a gap/spacing between valve 2292 and filter support 2296 as discussed above), in interior region 2284, through grill 2281*b*, through motor casing opening 2291*a*, through at least a portion of an interior within membrane 2282, through vent(s) 2281*a*, through filter 2249, and through clean air outlet 2222 (which may be defined by openings in cover portion 2223*e*). It is to be understood that air may flow in an alternative manner when flowing through handheld vacuum cleaner 2220 in such stick mode, and the example flow path described above is not intended to be limiting. It is also to be understood that handheld vacuum cleaner 2220 may not include all of the components described with respect to such example flow path in some variants.

In the example stick mode illustrated in FIG. 22Q, valve 2292 is spaced from (does not cover) opening 2296*e* (and/or an opening of filter 2244). Valve 2292 can be moved to such open position via suction force/pressure induced by suction motor 2240, which can oppose the biasing force from springs 2293 (thereby causing springs 2293 to compress as shown). In some implementations, valve 2292 is proximate or in contact with electromagnet 2294 when handheld vacuum cleaner 2220 is in such mode. In some implementations, electromagnet 2294 is not activated (energized to a magnetic state) when handheld vacuum cleaner 2220 is in such stick mode (as represented by "EM OFF" in FIG. 22T). With reference to FIG. 22T and similar to that described with respect to cleaning apparatus 1600 and FIG. 16KK, when cleaning apparatus 2200 is in such stick mode, a valve 2280 within support member 2205 is open, thereby allowing air to flow from a dirty air inlet of cleaning head 2230, through support member 2205 and/or wand 2203 and to and through handheld vacuum cleaner 2220 (for example, as described above). With reference to FIG. 22T, and as shown and as described with respect to cleaning apparatus 1600 and FIG. 16KK, a lid 2242 of cleaning apparatus 2200 (which may be pivotably connected to support member 2205) can be closed when floor-based vacuum cleaner 2210 is detached, thereby closing an outlet port 2205*e*.

FIG. 22R illustrates a cross-section taken through a portion of handheld vacuum cleaner 2220 when in an example "auto-empty" mode of operation which corresponds to that illustrated in the "Auto-Empty" column in the table of FIG. 22T. Example air flow paths in such mode are illustrated in dotted lines (with arrows) in FIG. 22R. In such mode, valve 2290 can be pivoted to a second open position (for example, towards dirty air inlet 2221). Valve 2290 can be moved to such position by suction force induced by a suction motor of floor-based vacuum cleaner 2210, thereby allowing debris within debris container 2241 to be transferred to floor-based vacuum cleaner 2210 (for example, via wand 2203 and/or support member 2205). In such mode, air can flow into handheld vacuum cleaner 2220 through clean air outlet 2222 and out of handheld vacuum cleaner 2220 via dirty air inlet 2221. In the auto-empty mode, air may flow through clean air outlet 2222 (for example, through openings in cover portion 2223*e*), through filter 2249, through vent(s) 2281*a*, through at least a portion of an interior within membrane 2282, through motor casing opening 2291*a*, through grill 2281*b*, in interior region 2284, past valve 2292 (for example, through a gap/spacing between valve 2292 and filter support 2296 as discussed above), through an opening of filter 2244 and/or opening 2296*e*, into interior 2244*c*, through a wall of filter 2244, into interior region 2298, through gap 2285 (for example, around an end of filter 2244 and/or cap 2297), through filter 2243, through debris container 2241, past valve 2290, and through dirty air inlet 2221. Air may then flow through wand 2203, support member 2205, and floor-based vacuum cleaner 2210 in order to transfer debris from handheld vacuum cleaner 2220 to floor-based vacuum cleaner 2210 as described herein.

In some implementations, handheld vacuum cleaner 2220 includes an auxiliary air inlet 2248, a bleed valve, and a bleed valve chamber 2246, each of which can be similar or identical to the auxiliary air inlet 1848, bleed valve 1845, and bleed valve chamber 1846 (respectively) described with respect to handheld vacuum cleaner 1820. Handheld vacuum cleaner 2220 can include any of the features, structure, or components described with respect to auxiliary air inlet 1848, bleed valve 1845, and bleed valve chamber 1846 and FIGS. 18W-18EE. In some of such implementations, when handheld vacuum cleaner 2220 is in the auto-empty mode, air can flow into handheld vacuum cleaner 2220 through either one or both of clean air outlet 2222 and auxiliary air inlet 2248. In some implementations of the auto-empty mode, air flows through auxiliary air inlet 2248, through bleed valve chamber 2246, through a chamber opening (similar or identical to chamber opening 1876), in interior region 2284, past valve 2292 (for example, through a gap/spacing between valve 2292 and filter support 2296 as discussed above), through an opening of filter 2244 and/or opening 2296*e*, into interior 2244*c*, through a wall of filter 2244, into interior region 2298, through gap 2285 (for example, around an end of filter 2244 and/or cap 2297), through filter 2243, through debris container 2241, past valve 2290, and through dirty air inlet 2221. It is to be understood that air may flow in an alternative manner when flowing through handheld vacuum cleaner 2220 in such auto-empty mode, and the example flow path described above is not intended to be limiting. It is also to be understood that handheld vacuum cleaner 2220 may not include all of the components described with respect to such example flow path in some variants. In some implementations, handheld vacuum cleaner 2220 is configured such that, during auto-empty mode, a majority of the air flowing into handheld vacuum cleaner 2220 (from ambient) comes from the auxiliary air inlet 2248 instead of from clean air outlet 2222.

In the example auto-empty mode illustrated in FIG. 22R, valve 1892 is spaced from (does not cover) opening 2296*e* (and/or an opening of filter 2244). In some implementations, valve 2292 is proximate or in contact with electromagnet 2294 when handheld vacuum cleaner 2220 is in such mode. In some implementations, electromagnet 2294 is activated (energized to a magnetic state) when handheld vacuum cleaner 2220 is in such auto-empty mode (as represented by "EM ON" in FIG. 22T), thereby causing electromagnet 2294 to become magnetized and magnetically couple and secure to magnet 2292*e* of valve 2292. This advantageously allows valve 2292 to remain in the open position even when air flowing toward and/or past valve 2292 applies a force on valve 2292 (attempting to move valve 2292 to the closed position). The electromagnet 2294 can be configured to apply a magnetic force that is greater than such airflow-induced force and a biasing force applied by springs 2293. In some implementations, electromagnet 2294 is only activated when cleaning apparatus 2200 is in the auto-empty mode and is not activated when cleaning apparatus 2200 is in the stick mode and/or the upright mode (and/or the "Stick (Upright Lock)" mode described below and illustrated in FIG. 22T). With reference to FIG. 22T and similar to that described with respect to cleaning apparatus 1600 and FIG. 16KK, when cleaning apparatus 2200 is in such auto-empty mode, valve 2280 may be closed, thereby preventing air/debris from being pulled in from a dirty air inlet of cleaning head 2230. Additionally, lid 2242 can be opened when floor-based vacuum cleaner 2210 is attached, thereby allowing air/debris to flow into floor-based vacuum cleaner 2210 (for example, via duct 2210*a*).

FIG. 22S illustrates a cross-section taken through a portion of handheld vacuum cleaner 2220 when in an example "upright" mode of operation which corresponds to that illustrated in the "Upright" column in the table of FIG. 22T. As shown in FIG. 22S, valve 2290 can be in a closed position when in the upright mode, which advantageously inhibits debris that may be within debris container 2241 from falling out of handheld vacuum cleaner 2220 (for example, through dirty air inlet 2221). When in the upright mode, valve 2292 can be closed, which advantageously prevents air from flowing into handheld vacuum cleaner 2220 (for example, via clean air outlet 2222 and/or auxiliary air inlet 2248) and focuses suction (induced by a suction motor of floor-based vacuum cleaner 2210) to draw air in through the dirty air inlet of cleaning head 2230. This can result in more efficient vacuuming with floor-based vacuum cleaner 2210. As described previously, valve 2292 can be biased towards the closed position via springs 2293 and valve biasing member 2299. In some implementations, valve 2292 seals opening 2296*e* and/or an opening of filter 2244 when cleaning apparatus 2200 is in such the upright mode, for example, via engagement of seal member 2292*f* with surface 2296*d* and/or the above-described skirt wall of filter support 2296 (see FIGS. 22K and 22E). In some implementations, electromagnet 2294 is not activated (energized to a magnetic state) when handheld vacuum cleaner 2220 is in such upright mode (as represented by "EM OFF" in FIG. 22T). With reference to FIG. 22T and similar to that described with respect to cleaning apparatus 1600 and FIG. 16KK, when cleaning apparatus 2200 is in such upright mode, valve 2280 is open, thereby allowing air to flow from a dirty air inlet of cleaning head 2230, through support member 2205, and to floor-based vacuum cleaner 2210 (for example, via duct 2210*a*). With reference to FIG. 22S, in some implementations, valve 2290 is configured to remain in such closed position when cleaning apparatus 2200 is in the upright mode (for example, is configured to withstand suction force/pressure that may be induced by a suction motor of floor-based vacuum cleaner 2210).

FIG. 22T also illustrates cleaning apparatus 2200 in an example "Stick (Upright Lock)" mode in which floor-based vacuum cleaner 2210 is detached and handheld vacuum cleaner 2220 is off. In such mode, electromagnet 2294 is off, valve 2292 is in an open position, lid 2242 is closed (since floor-based vacuum cleaner 2210 is detached), and valve 2280 is also closed.

With reference to FIG. 22T, in some implementations, electromagnet 2294 is "off" (deactivated) when cleaning apparatus 2200 is in: the stick mode; the "Stick (Upright Lock)" mode; and/or the upright mode. However, in some implementations, electromagnet 2294 is "on" (activated) when cleaning apparatus 2200 is in the stick mode and/or the "Stick (Upright Lock)" mode. In some implementations, electromagnet 2294 is "on" when handheld vacuum cleaner 2220 is detached from support member 2205, floor-based vacuum cleaner 2210, and/or cleaning head 2230, for example, for use in a mode that may be referred to as a "handheld" mode. It is to be understood that handheld vacuum cleaner 2220 may be utilized in such "handheld" mode while being attached to wand 2203 but detached from support member 2205, floor-based vacuum cleaner 2210, and cleaning head 2230. With reference to FIG. 22T, in some implementations, electromagnetic 2294 is only "off" when cleaning apparatus 2200 is in the upright mode.

Cleaning head 2230, support member 2205, valve 2280, lid 2242, outlet 2205*e* can be similar or identical, and can be configured to operate in a similar manner, to cleaning head 1630, support member 1605, valve 1680, lid 1642, and/or outlet 1605*e* (respectively). By way of non-limiting example, valve 2280 can be configured to move to and between open and closed positions based on inclination of support member 2205 and/or wand 2203 in a similar or identical manner as that described with reset to valve 1680 and cleaning apparatus 1600. Although FIGS. 22Q-22S illustrate valve 2290 pivotably connected to what may be referred to as a "top" side or portion of handheld vacuum cleaner 2220, valve 2290 may be pivotably connected to an opposite, "bottom" side or portion instead.

Cleaning apparatus 2200 (for example, handheld vacuum cleaner 2220) can be configured in a variety of ways to activate (by providing energy to) and deactivate (by not providing energy to) electromagnet 2294 for any of the above-described operational modes, such as any of that described above with respect to cleaning apparatus 1800, electromagnet 1894, handheld vacuum cleaner 1820, and the auto-empty mode described with respect to these components and others. Cleaning apparatus 2200 (for example, handheld vacuum cleaner 2220) can utilize electrical communications between electrical connectors of handheld vacuum cleaner 2220, wand 2203, support member 2205, floor-based vacuum cleaner 2210, and/or cleaning head 2230 for determining whether to activate electromagnet 2294 in a similar or identical manner as that described above with respect to cleaning apparatus 1800. Cleaning apparatus 2200 (for example, via handheld vacuum cleaner 2220) can be configured to turn on and/or off suction motors of handheld vacuum cleaner 2220 and/or floor-based vacuum cleaner 2210 in a similar or identical manner to facilitate various operational modes as described above with respect to cleaning apparatus 1800.

Cleaning head 2230, support member 2205, wand 2203, handheld vacuum cleaner 2220, and floor-based vacuum cleaner 2210 can be electrically connectable to one another via one or more electrical connectors to facilitate electrical communication and/or power. For example, in some implementations in which cleaning apparatus 2200 includes a power cord 2201 connected to handheld vacuum cleaner 2220, electrical power can be provided from handheld vacuum cleaner 2220 to floor-based vacuum cleaner 2210 and/or cleaning head 2230 (for example, via wand 2203 and/or support member 2205) to allow control of any electrical components of floor-based vacuum cleaner 2210 and/or cleaning head 2230 (such as a suction motor of floor-based vacuum cleaner 2210). In some variants, cleaning apparatus 2200 does not include a cord 2201, and in such variants, any of handheld vacuum cleaner 2220, floor-based vacuum cleaner 2210, and/or cleaning head 2230 include a battery. Handheld vacuum cleaner 2220 can include a controller and/or input device (similar or identical to controller 327, input device 328) which can allow control of handheld vacuum cleaner 2220 (for example, a suction motor thereof), floor-based vacuum cleaner 2210 (for example, a suction motor thereof), and/or cleaning head 2230 (for example, a motor and/or agitator thereof). Such implementations can allow suction motors of handheld vacuum cleaner 2220 and floor-based vacuum cleaner 2210 to be operated (for example, turned "on" or "off") to facilitate any of the various operational modes described herein. In some implementations, handheld vacuum cleaner 2220 includes a battery and is removably connectable to cord 2201 so as to allow cleaning apparatus 2200 to be operated with cord 2201 connected and/or disconnected. In the disconnected state of such implementation, cleaning apparatus 2200 (or any portion thereof) may derive electrical power from such battery in handheld vacuum cleaner 2220 and/or a battery in floor-based vacuum cleaner 2210. Any of such batteries may be charged via cord 2201. Such implementations can advantageously allow for convenient operation of cleaning apparatus 2200 without cord 2201 attached.

Any of the cleaning apparatuses disclosed herein can be configured to automatically activate suction motors thereof based on whether the cleaning apparatus is in an "on" state, whether various components are attached, and orientation of any of such components. For example, any of the disclosed cleaning apparatuses, when in an "on" state (for example, via activation of a button on the handheld vacuum cleaner by a user), can: automatically activate a suction motor of the handheld vacuum cleaner when the floor-based vacuum cleaner is detached (thereby enabling "stick" mode); and/or automatically activate a suction motor of the floor-based vacuum cleaner when the floor-based vacuum cleaner is attached (thereby enabling either "upright" or "auto-empty" modes). Any of the disclosed cleaning apparatus can automatically control operation of other components thereof (for example, valve(s) in the handheld vacuum cleaner and/or a valve in the support member) to facilitate the "upright" or "auto-empty" modes, as described herein. As also described herein, valve(s) the handheld vacuum cleaner and/or support member can be controlled (for example, opened or closed) based on orientation of the wand and/or support member relative to a ground surface and/or a plane upon which the cleaning head rests. Accordingly, the disclosed cleaning apparatus can conveniently and efficiently switch between any of the disclosed operational modes during user operation.

Figure 22U:
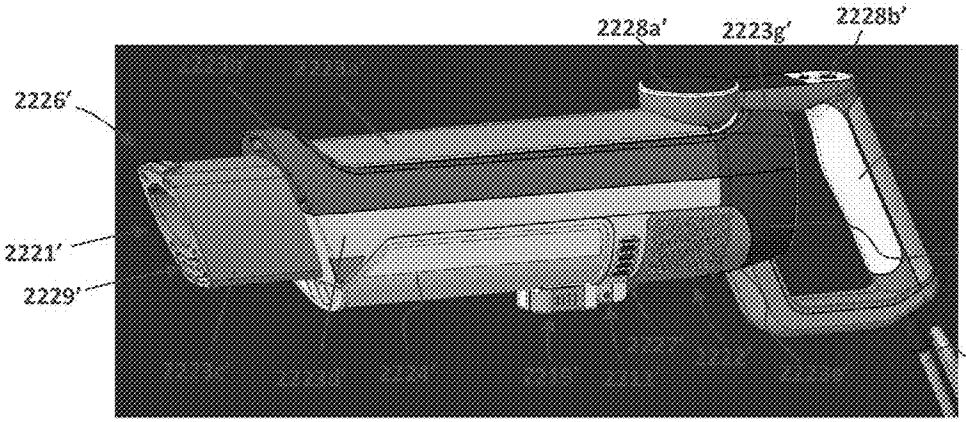
Figure 22V:
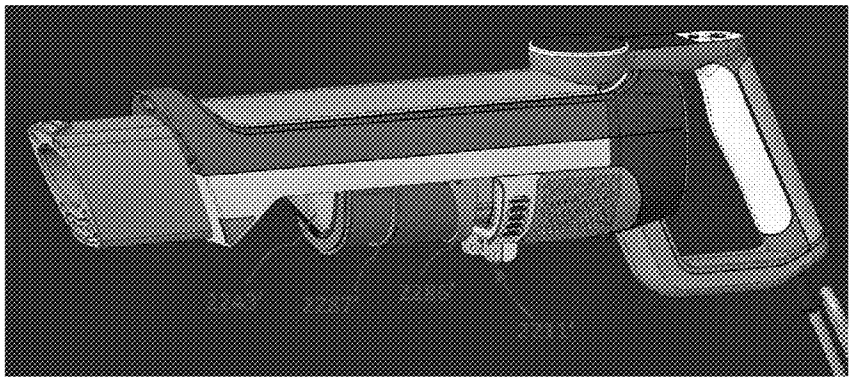
Figure 22W:
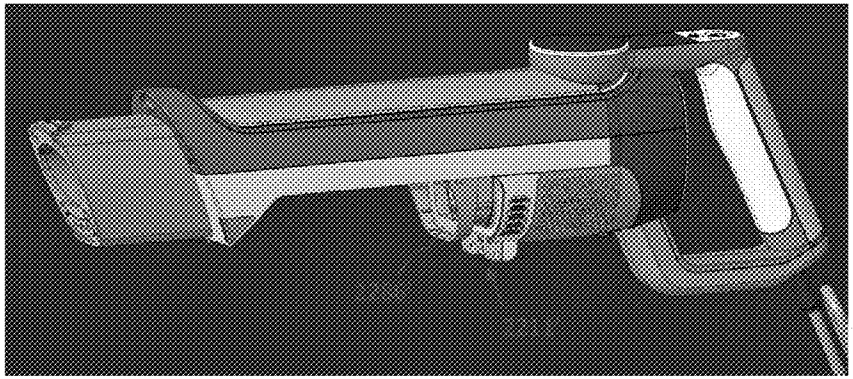
Figure 22X:
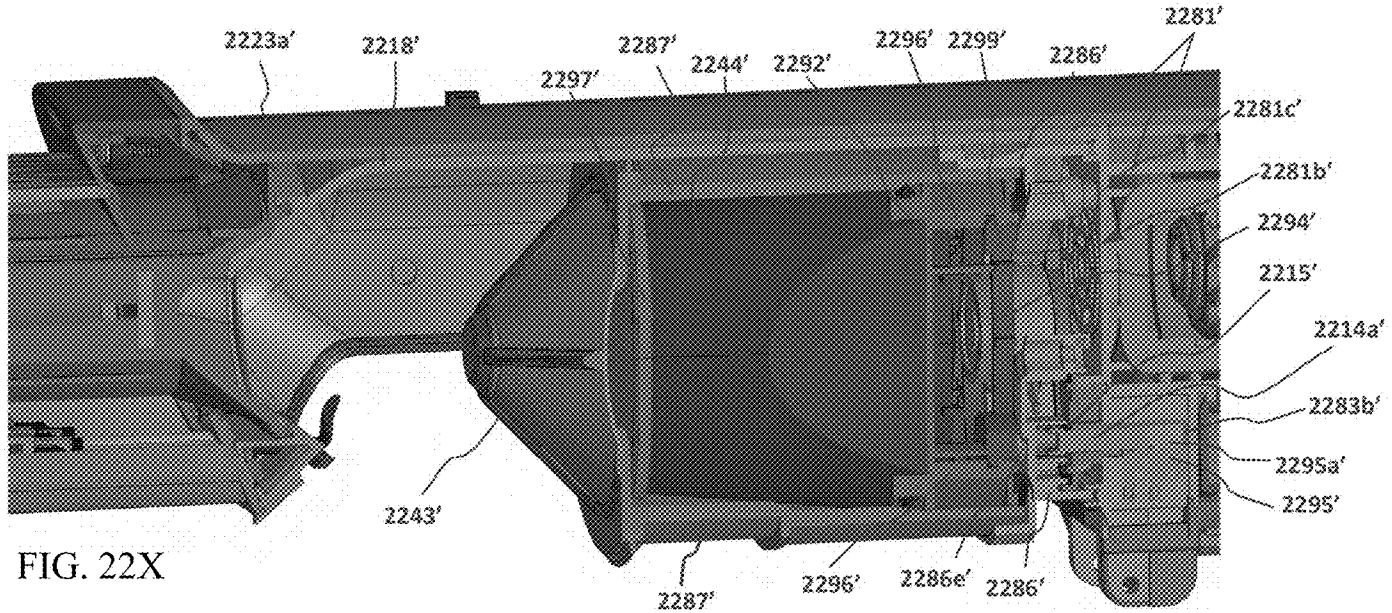
Figure 22Y:
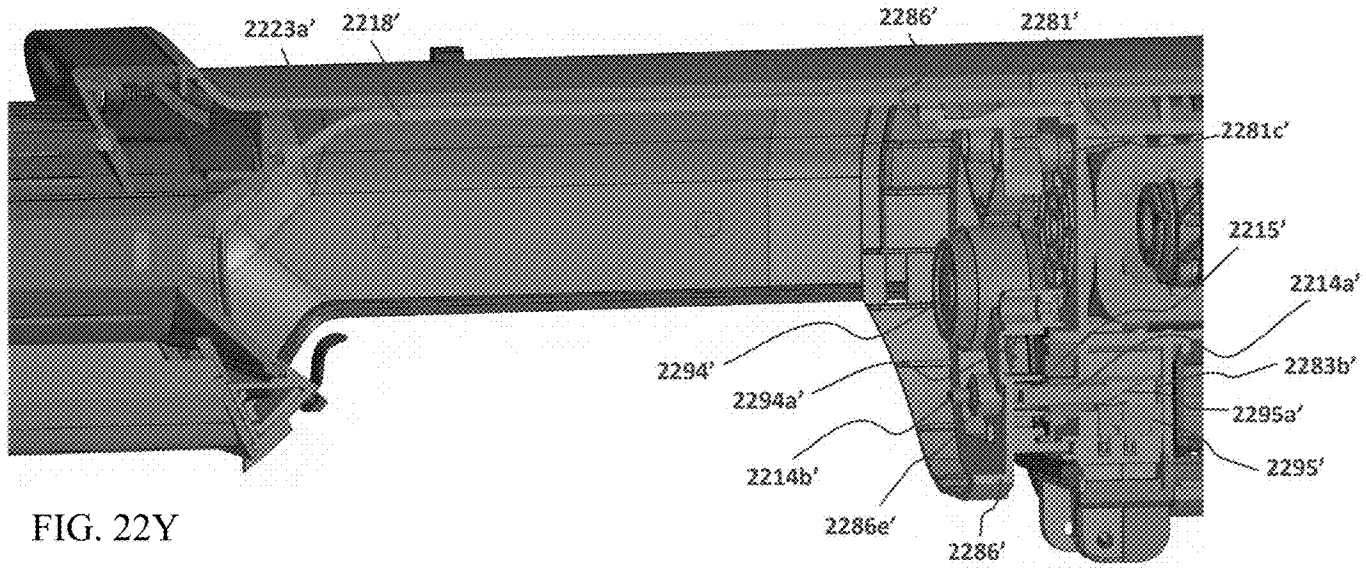
Figure 22A:
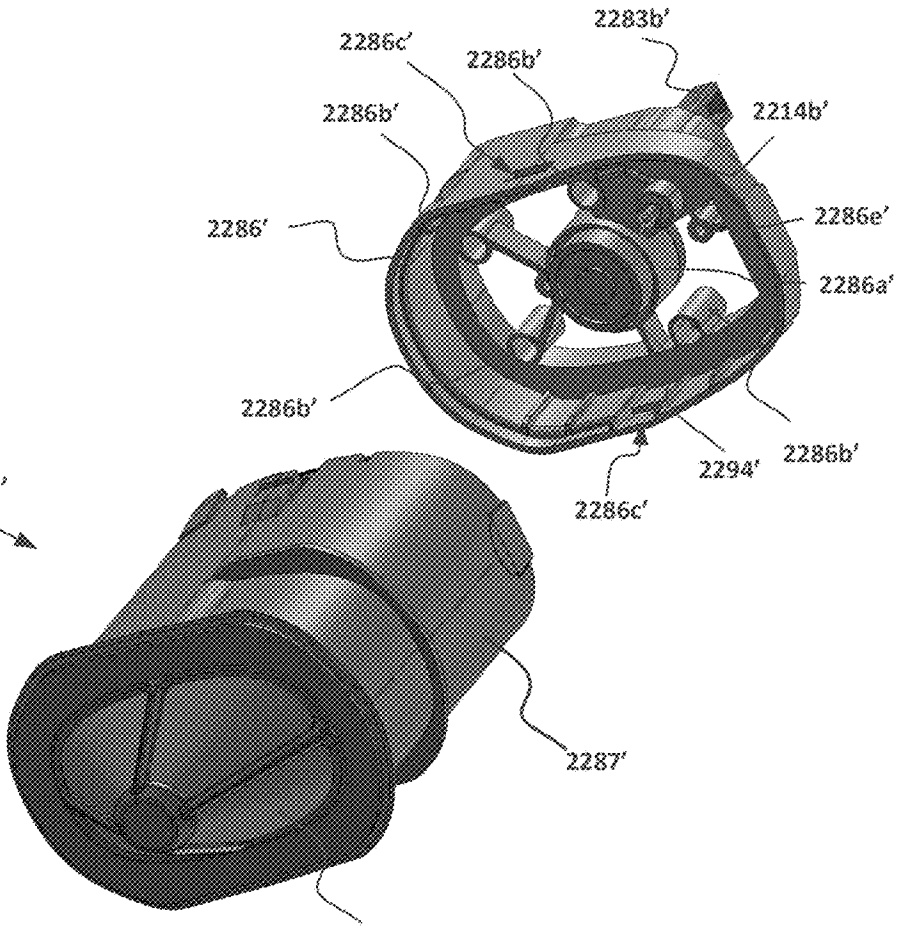

FIGS. 22U-22GG illustrate another implementation of a handheld vacuum cleaner 2220' and portions thereof. Handheld vacuum cleaner 2220' can include any of the features described with respect to other handheld vacuum cleaners disclosed herein. Handheld vacuum cleaner 2220' can be similar or identical to handheld vacuum cleaner 2220 described above in many respects, for example, except with respect to certain features or aspects described below with respect to FIGS. 22U-22GG. Handheld vacuum cleaner 2220' can be part of a cleaning apparatus that is similar to any of the cleaning apparatuses disclosed herein and can be used and coupled with any of the wands, support members, floor-based vacuum cleaners, and/or cleaning heads disclosed herein in any of the operational modes disclosed herein. With reference to FIGS. 22U-22Y, handheld vacuum cleaner 2220' can include a dirty air inlet 2221', a snout 2226', a debris container door 2224', a debris container 2241' (which may also be referred to as "debris containing region" or "debris chamber"), a clean air outlet 2222', a handle 2225', a display 2228*a*', control(s) 2228*b*', a power cord 2201', an electrical connector 2229', cover portions 2223*a*', 2223*b*', 2223*c*', 2223*d*', 2223*e*', 2223*f*', 2223*g*', vent(s) 2227', filter 2243', filter 2244', valve 2292', valve biasing member 2299', electromagnet 2294', structural components 2281', 2218', 2287', 2286', and/or filter support 2296', which can be similar or identical to dirty air inlet 2221, snout 2226, debris container door 2224, debris container 2241, clean air outlet 2222, handle 2225, display 2228*a*, control(s) 2228*b*, power cord 2201, electrical connector 2229, cover portions 2223*a*, 2223*b*, 2223*c*, 2223*d*, 2223*e*, 2223*f*, 2223*g*, vent(s) 2227, filter 2243, filter 2244, valve 2292, valve biasing member 2299, electromagnet 2294, structural components 2281, 2218, 2288, 2287, 2286, and/or filter support 2296, respectively. Handheld vacuum cleaner 2220' can include a controller that can be similar or identical to controller 327 and/or any of the controllers disclosed herein. FIG. 22U illustrates a perspective view of handheld vacuum cleaner 2220', FIG. 22V illustrates the same view but with debris container door 2224' removed, and FIG. 22W illustrates the same view but with filter 2243', structural component 2287', filter 2244', filter support 2296', valve 2292', and valve biasing member 2299' additionally removed. FIGS. 22X and 22Y illustrate perspective, partial cross-sectional views through handheld vacuum cleaner 2220' that correspond to FIGS. 22V and 22W respectively.

With reference to FIGS. 22U and 22EE-22GG, debris container door 2224' can be pivotably and/or removably attached to a portion of handheld vacuum cleaner 2220', for example, via attachment mechanisms 2219', 2211'. In some implementations, debris container door 2224' includes a first end or portion (for example, a "front end") that can mechanically engage (for example, via a snap fit) a portion of handheld vacuum cleaner 2220' and a second end or portion (for example, a "rear end") at which attachment mechanism 2219' is arranged. Attachment mechanism 2219' is connected to debris container door 2224' and can comprise an actuator 2219*a*' (for example, a pushable button), an actuator 2219*b*', a base portion 2219*c*', and a spring 2219*d*' which can bias actuator 2219*a*' to an extended position which is illustrated in FIGS. 22EE-22FF. Actuator 2219*b*' can be coupled to a pin 2219*e*' which can extend through holes 2211*a*' in attachment mechanism 2211' (which can be at least partially formed by a portion of structural component 2281'). In some implementations, engagement of actuator 2219*a*' (against the bias of spring 2219*d*') causes debris container door 2224' to detach. In some implementations, engagement of actuator 2219*a*' (against the bias of spring 2219*d*') moves actuator 2219*a*' and/or causes pin 2219*e*' to disengage and/or exit holes 2211*a*'. For example, engagement of actuator 2219*a*' can cause actuator 2219*b*' to retract pin 2219*e*', thereby allowing attachment mechanism 2219' (and debris container door 2224') to disengage from attachment mechanism 2211'. In some implementations, handheld vacuum cleaner 2220' includes a biasing member 2219*f*' (such as a torsional spring) that biases debris container door 2224' open when attachment mechanism 2219' is disengaged from attachment mechanism 2211'. Detachment of debris container door 2224' from handheld vacuum cleaner 2220' can in turn allow filter 2243', structural component 2287' (which may be referred to as a "filter container"), filter 2244', filter support 2296', valve 2292', and valve biasing member 2299' to be removed (for example, for inspection or replacement) (see FIGS. 22V-22W). Filter 2243', structural component 2287', filter 2244', filter support 2296', valve 2292', and valve biasing member 2299' (or portions thereof) may be referred to as a "pre-motor filter assembly", "filter assembly", or "removable filter assembly" (represented as "2213'''" in FIGS. 22Z and 22AA). Opening of debris container door 2224' can allow emptying of debris (manually) if desired and/or inspection of inner components of handheld vacuum cleaner 2220'. Filter 2243', filter 2244', and/or other components (for example, filter support 2296', filter cap 2297', structural component 2287', and/or other components) may form a debris separator that separates debris from air flowing through handheld vacuum cleaner 2220'. Any of the other handheld vacuum cleaners disclosed herein can incorporate attachment mechanisms similar or identical to attachment mechanisms 2219', 2211'.

Figure 22Z:
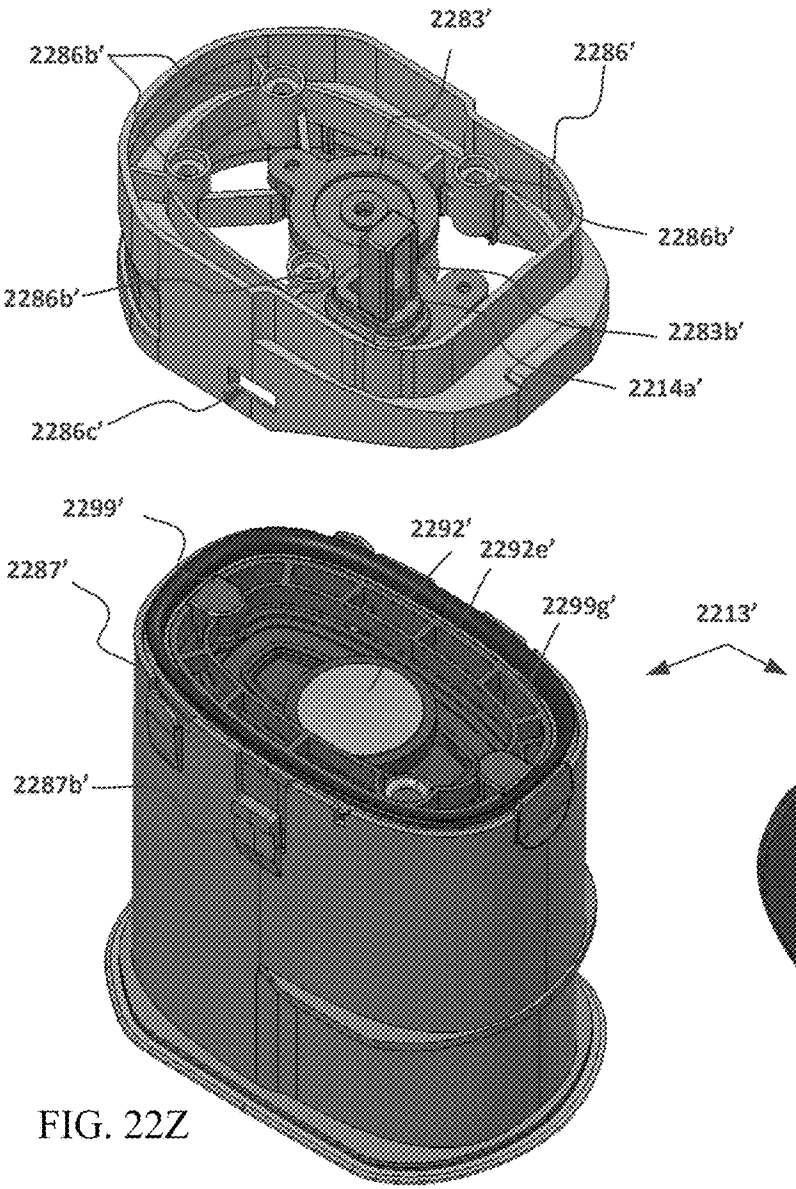
Figure 22C:
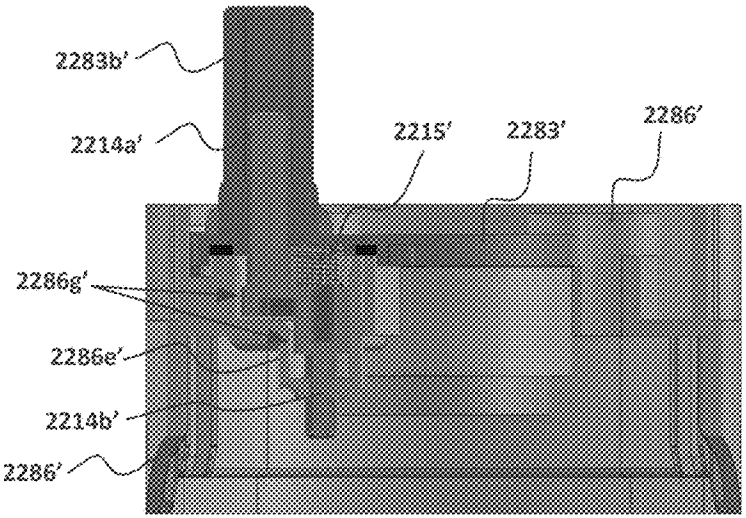
Figure 22D:
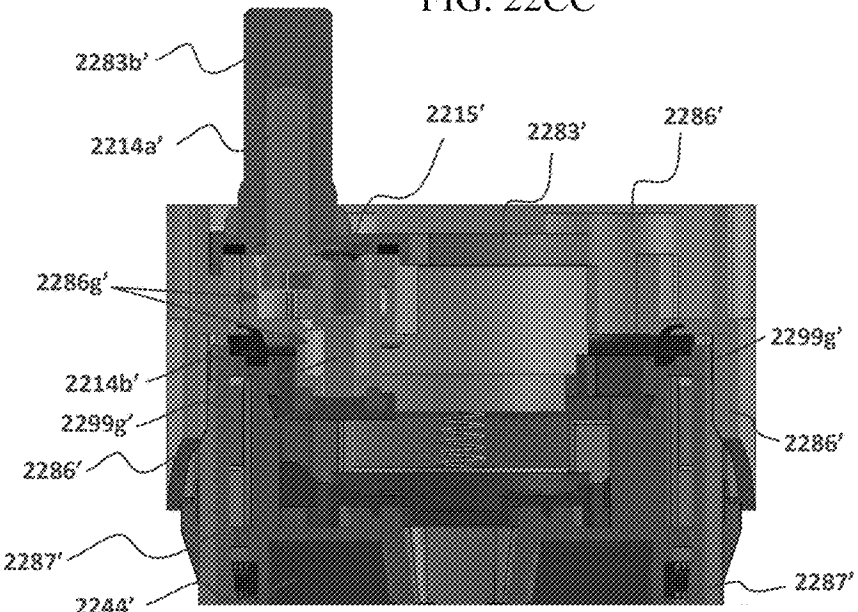
Figure 22B:
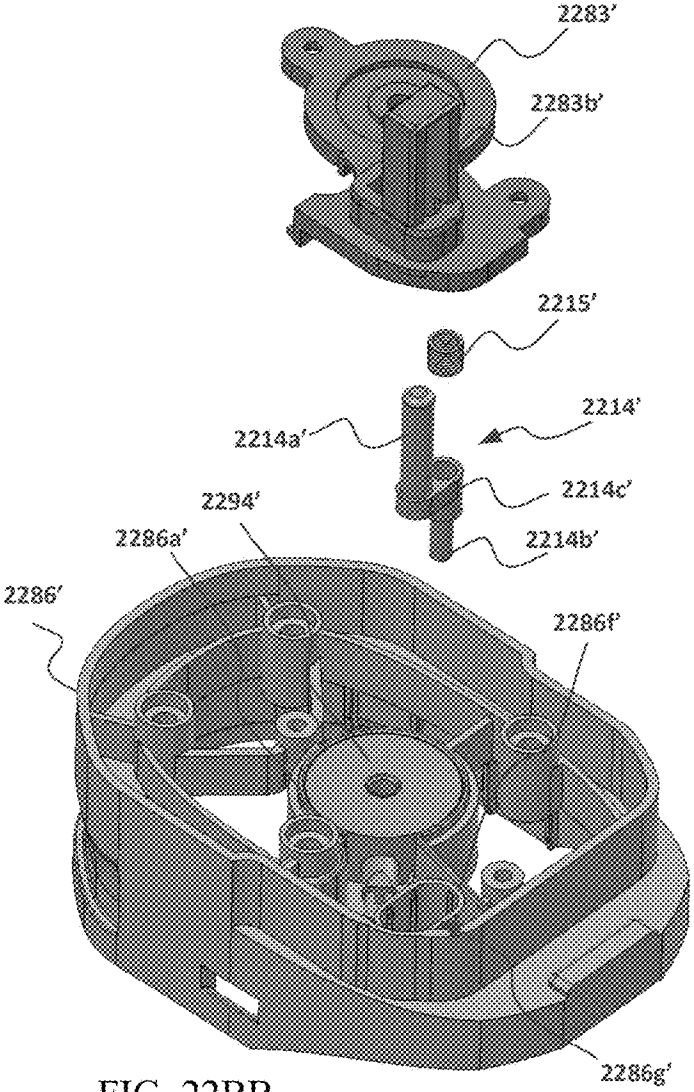
Figure 22F:
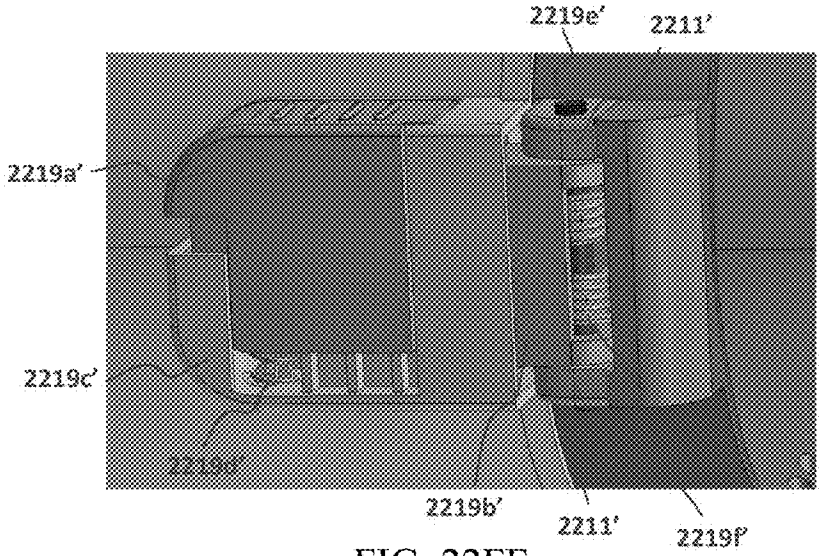
Figure 22E:
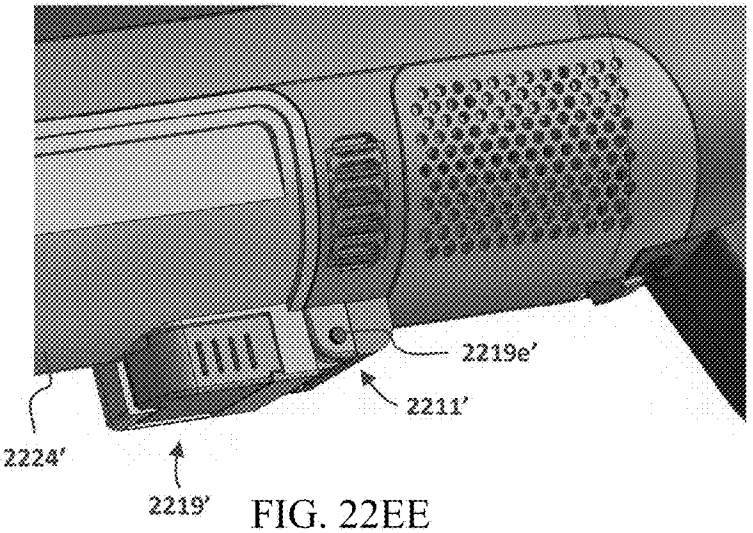
Figure 22G:
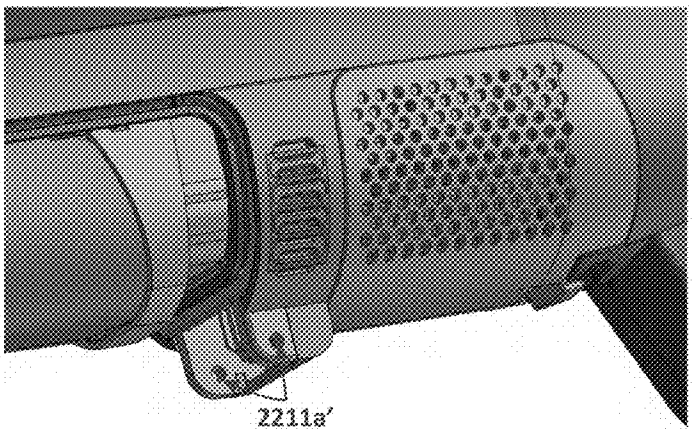
Figure 22H:
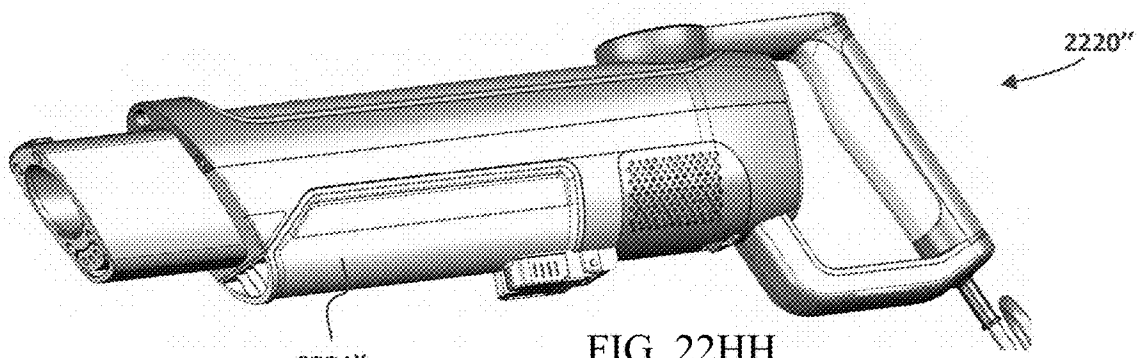
Figure 22I:
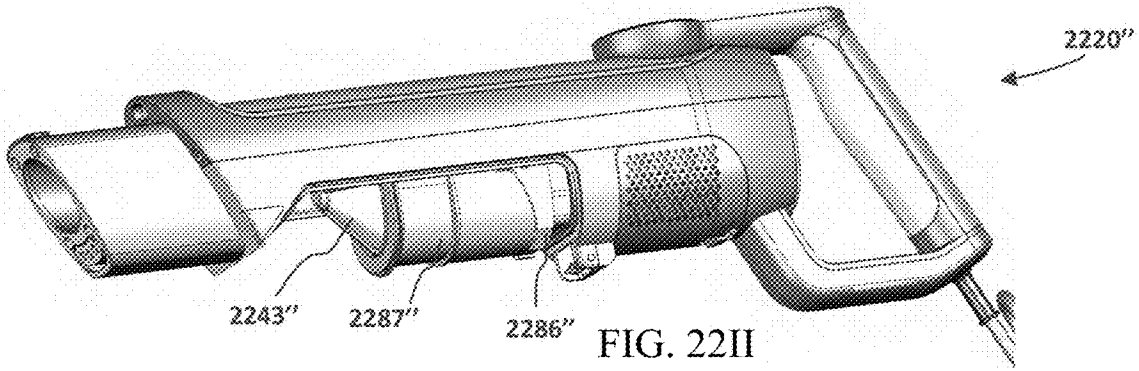
Figure 22J:
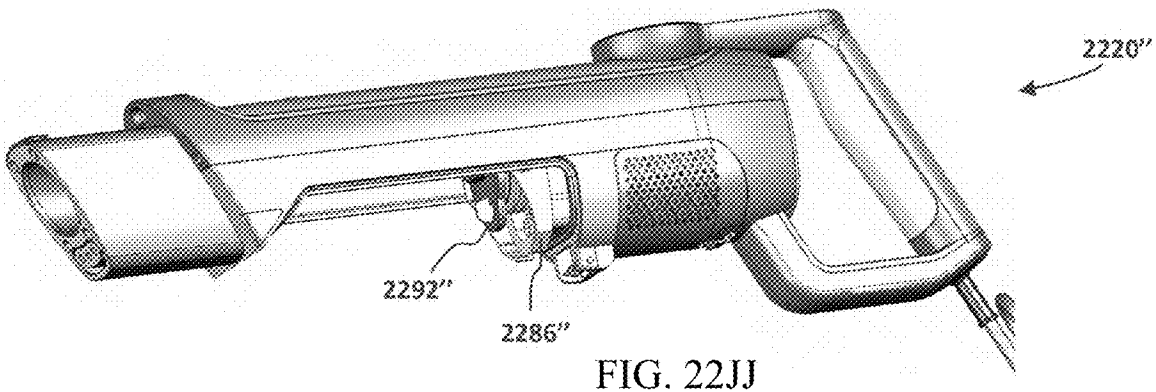
Figure 22K:
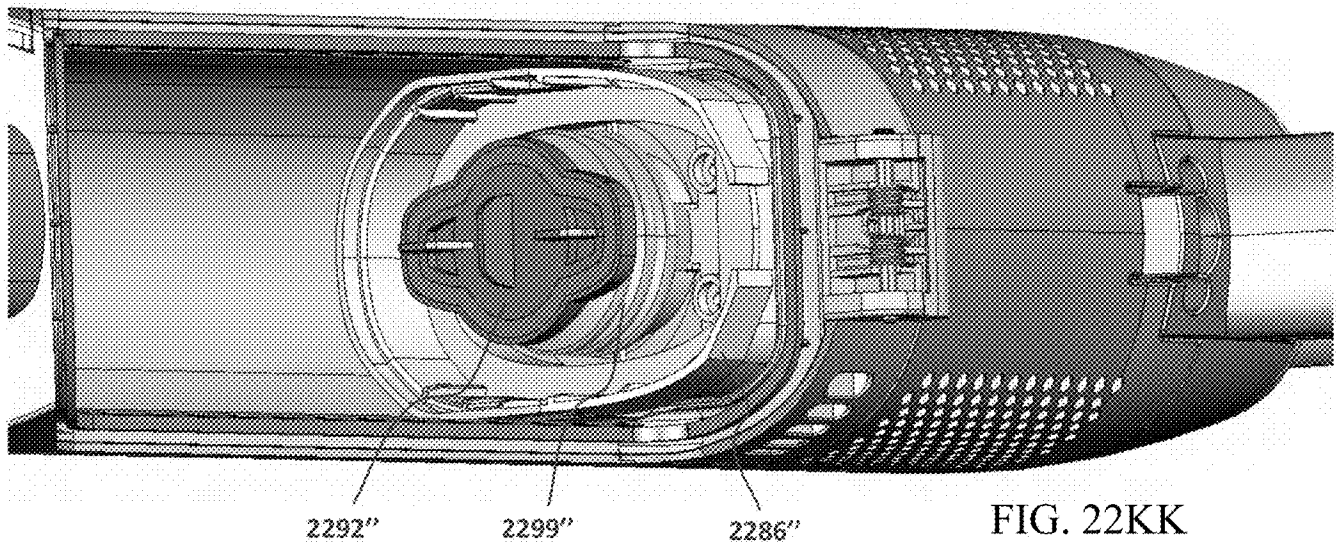
Figure 22L:
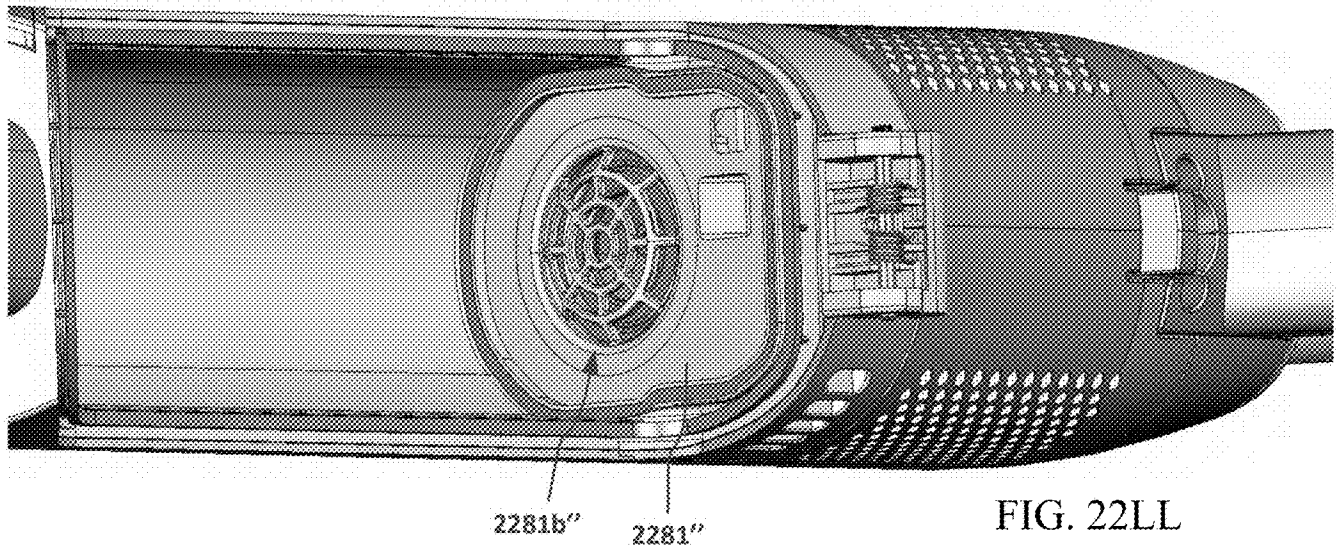
Figure 22N:
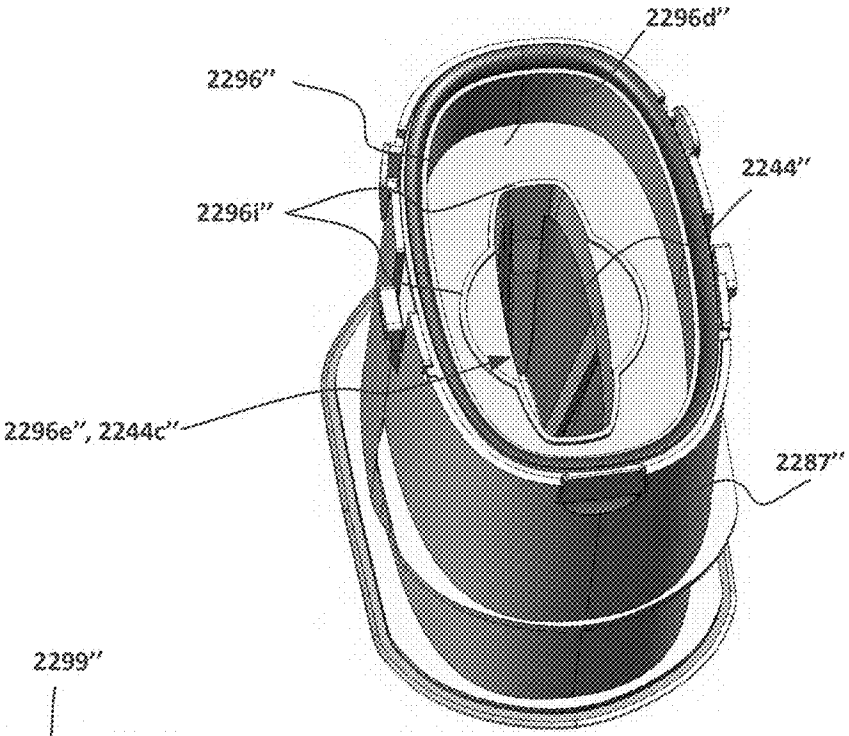
Figure 22O:
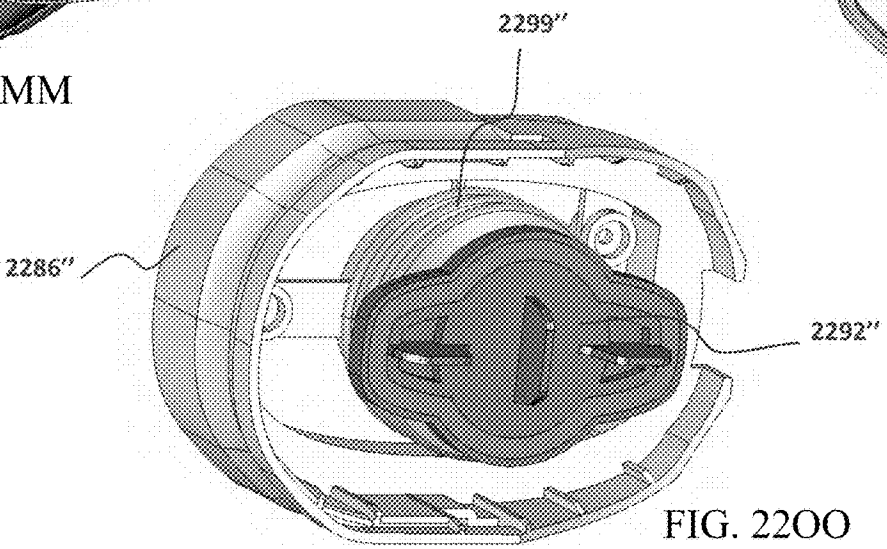
Figure 22M:
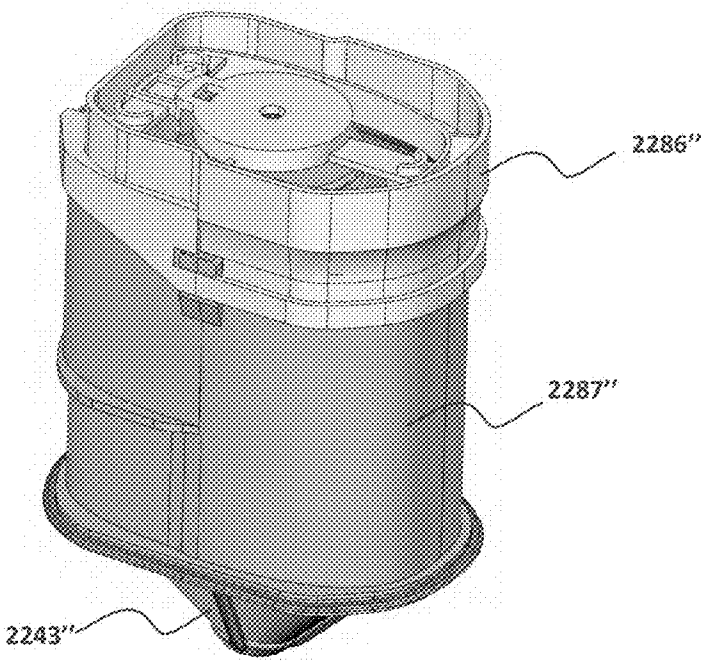
Figure 22P:
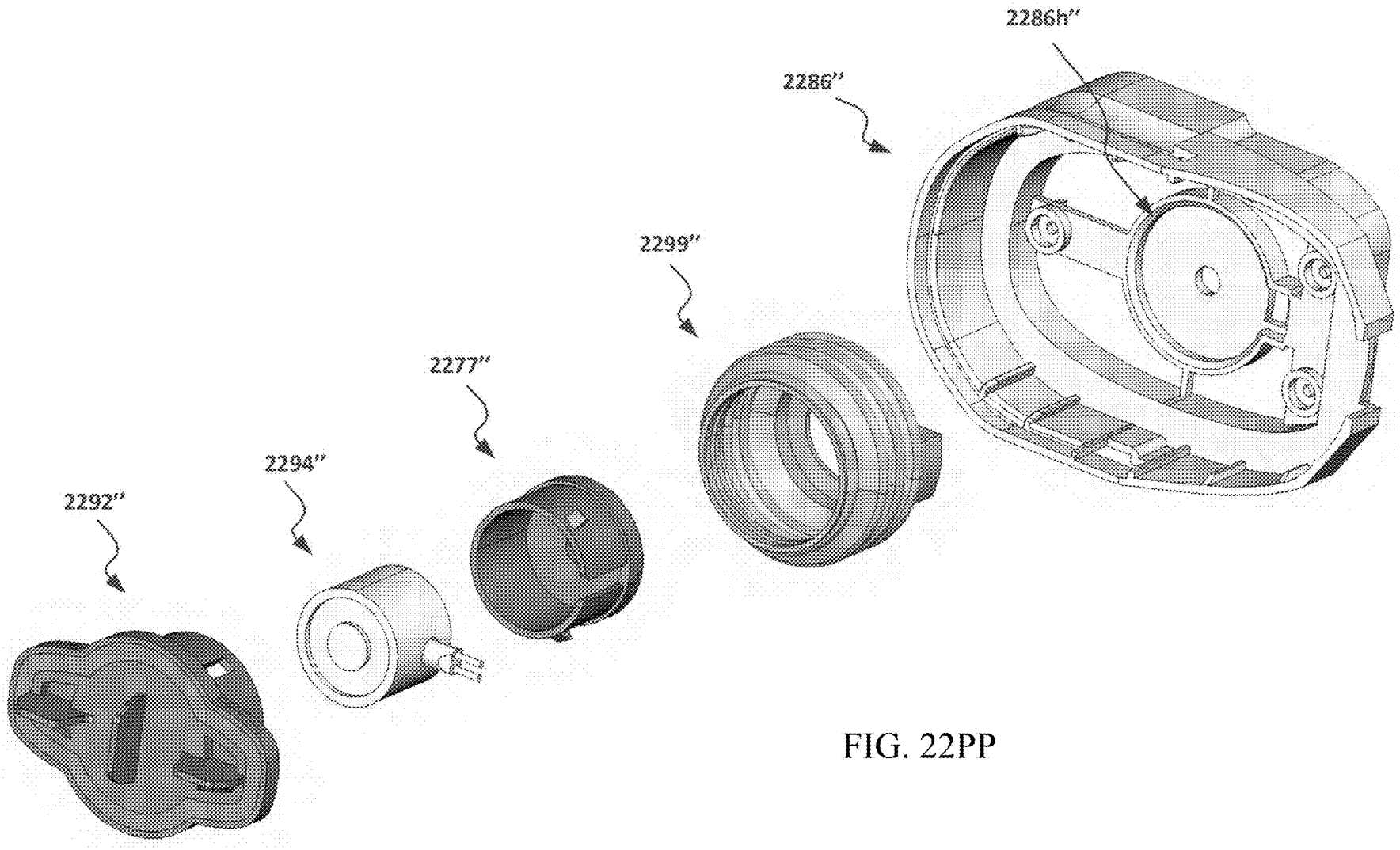
Figure 22R:
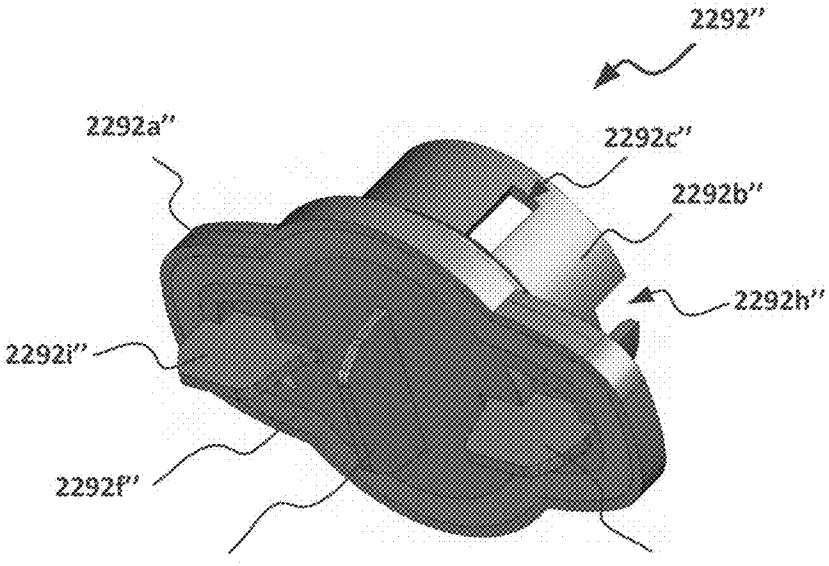
Figure 22Q:
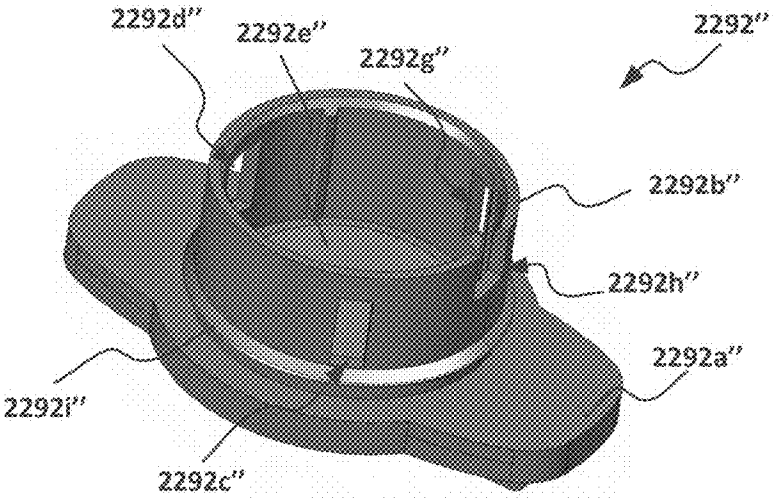
Figure 22U:
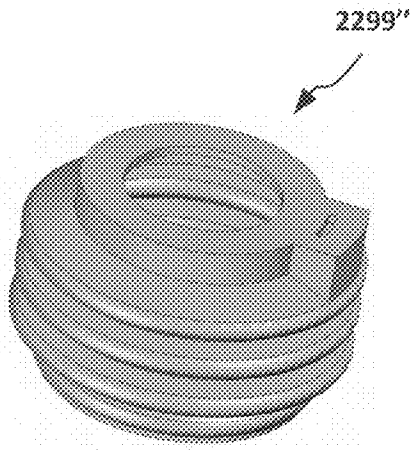
Figure 22T:
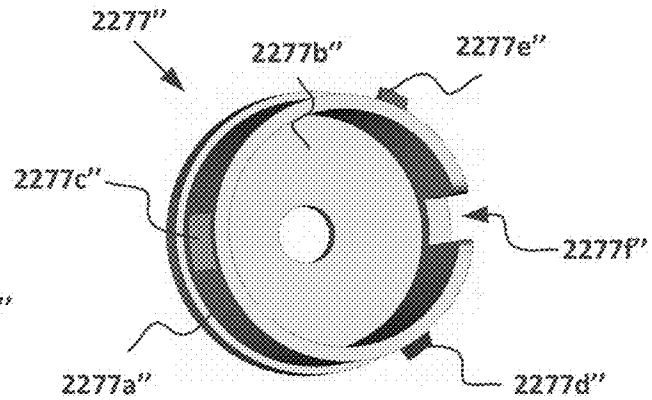
Figure 22S:
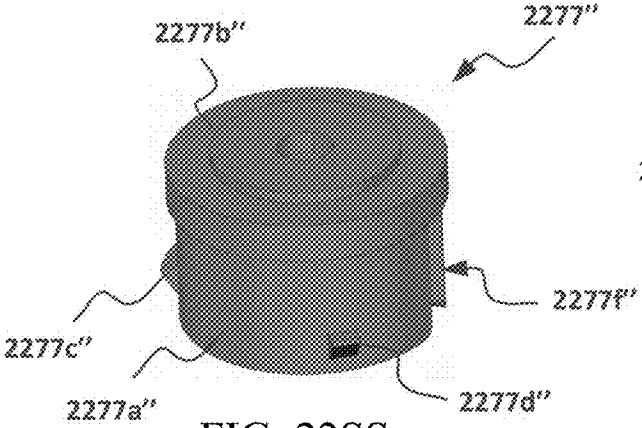
Figure 22W:
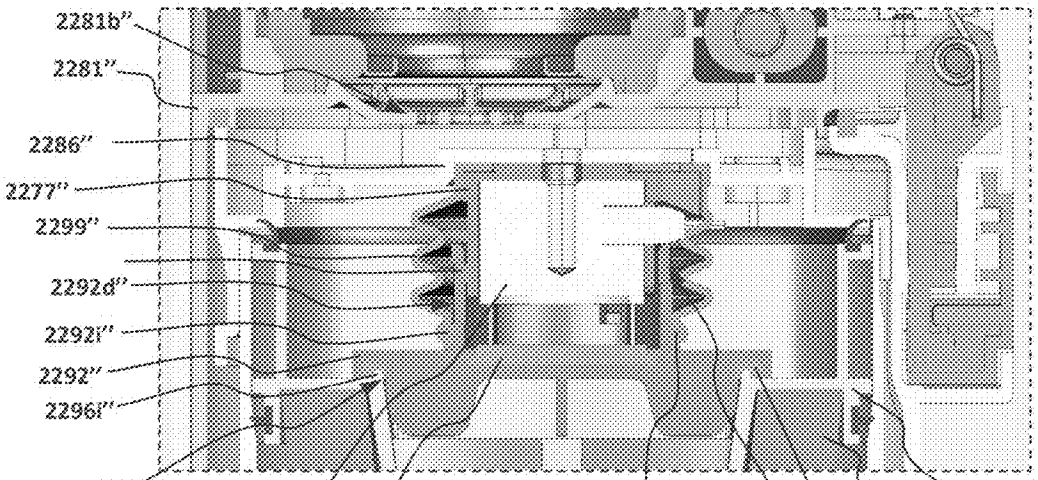
Figure 22X:
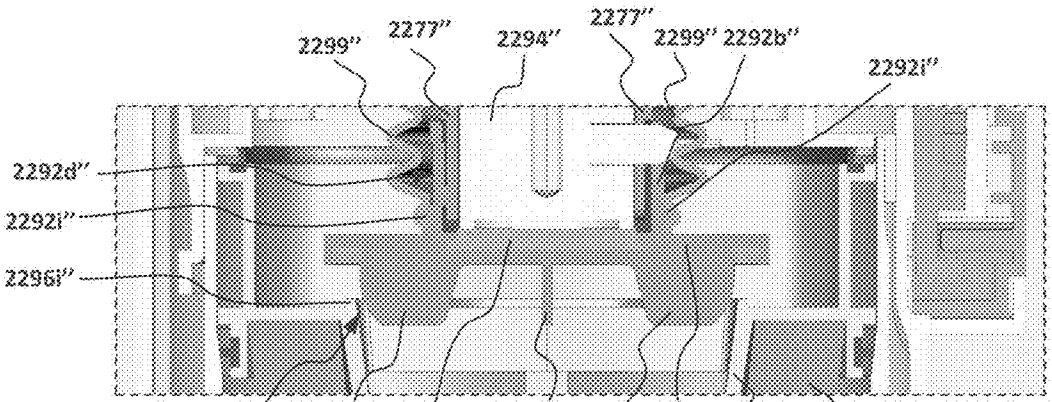
Figure 22V:
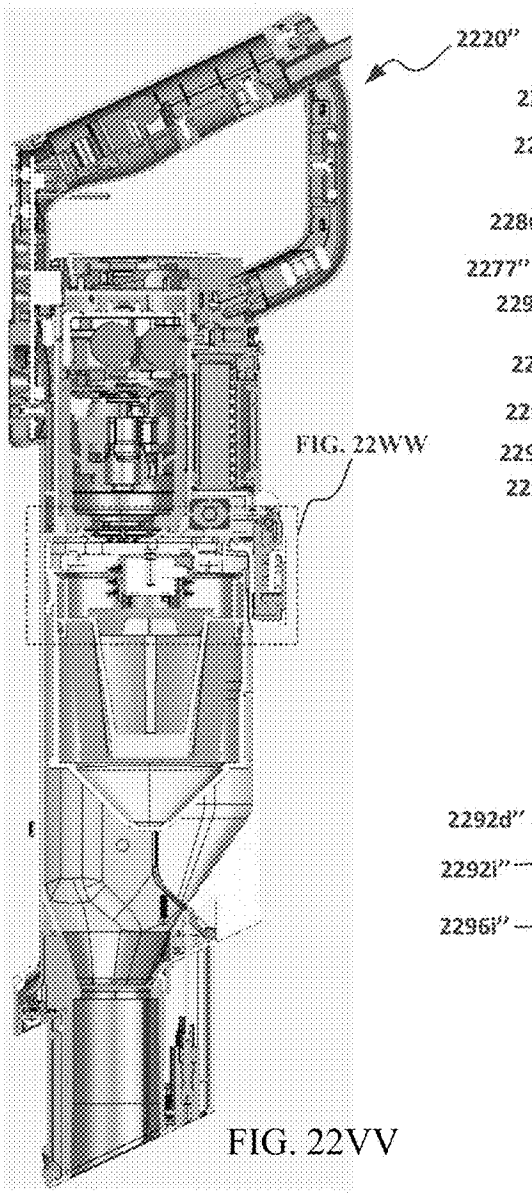

FIGS. 22Z-22A illustrate top and bottom perspective views of structural component 2286', cover 2283', structural component 2287' (which may be referred to as a "filter housing"), filter 2243', valve biasing member 2299', valve 2292', and magnet 2293*e'*. Filter support 2286' and filter 2244' can be arranged within filter housing 2287' (see FIG. 22X). As mentioned previously, structural component 2287', filter 2243', valve biasing member 2299', valve 2292' (and filter 2244') may be part of a filter assembly 2213', and such filter assembly 2213' is shown in an assembled state in FIGS. 22Z-22AA. FIG. 22BB illustrates a top perspective view of structural component 2286' and electromagnet 2294' spaced from an actuator 2214', spring 2215', and cover 2283' (which also may be referred to as "cover portion"). FIGS. 22Z-22AA illustrates such components in an example assembled state. FIG. 22CC illustrates a cross-sectional view taken through a portion of structural component 2286', actuator 2214', and cover portion 2283', while FIG. 22DD illustrates the same view but with such components in an example connected state with filter assembly 2213'. Structural component 2286' can be similar in many respects to structural component 2286'. Structural component 2286' can include a socket 2286*a'* sized and/or shaped to receive electromagnet 2294', chamber(s) 2286*b'* configured to secure to posts 2281*c'* of structural component 2281' (for example, proximate to grill 2281*b'*), and openings 2286*c'* configured to receive arms 2287*b'* of structural component 2287'. With reference to FIGS. 22AA-22DD, structural component 2286' can include chambers 2286*e'*, 2286*f'* which can form cavities 2286*g'* for receiving portions of actuator 2214*a'*. Cover portion 2283' can secure to structural component 2286' atop electromagnet 2294' and socket 2286*a'* as shown. As shown in FIG. 22Z, valve biasing member 2299*g'* can include an engagement portion 2299*g'* (which may be formed on a surface of a ledge or plate thereof) configured to engage actuator 2214' (for example, actuator pin 2214*b'*) when filter assembly 2213' is attached to handheld vacuum cleaner 2220' as described below. Cover portion 2283' can include a guide chamber 2283*b'* that includes a channel that receives a portion of actuator 2214' (for example, actuator pin 2214*a'*) and a portion of a switch 2295*a'* (see FIGS. 22BB-22DD and 22X-22Y). With reference to FIGS. 22X-22Y, handheld vacuum cleaner 2220' can include an electrical component 2295' configured to facilitate transmission of electrical energy to electromagnet 2294' via one or more wires 2294*a'*. Electromagnet 2294' can be in electrical communication with a controller and/or power cord 2201' of handheld vacuum cleaner 2220' via direct and/or indirect electrical connection via electrical component 2295' and/or a variety of other electrical components (such as wiring), for example, as described with respect to electrical component 2295. Electrical component 2295' can include a switch 2295' (for example, a cantilevered switch). FIG. 22X illustrates switch 2295*a'* in an example position in which switch 2295*a'* is engaged (for example, at least partially "depressed") by actuator pin 2214*a'*, while FIG. 22Y illustrates switch 2295*a'* in an example position in which switch 2295*a'* is not engaged by actuator pin 2214*a'*.

In some cases, it may be desirable to temporarily eliminate electrical connection to the electromagnet 2294' when filter assembly 2213' is removed, given that electromagnet 2294' may be exposed (see FIG. 22Y). Handheld vacuum cleaner 2220' can be configured such that, when filter assembly 2213' is removed, electromagnet 2294' does not receive power (electrical energy) and/or is not in electrical communication with electrical component 2295' and/or a power source (for example, a battery in handheld vacuum cleaner 2220' and/or power cord 2201'). As mentioned previously, handheld vacuum cleaner 2220' can include an actuator 2214', and such actuator 2214' can be configured to be moved between a first position (see FIGS. 22Y and 22CC) and a second position (FIGS. 22X and 22DD). Such first position can be a "neutral" or "rest" position/state of actuator 2214'. Actuator 2214' can be biased to such first position via spring 2215'. When filter assembly 2213' is attached (for example, connected via engagement of structural component 2287' with structural component 2286'), actuator 2214' can be moved from the first position to the second position via engagement by a portion of filter assembly 2213' (for example, engagement portion 2299*g'*). As shown in FIG. 22X, movement of actuator 2214' to the second position can cause actuator 2214' (for example, actuator pin 2214*a'*) to engage switch 2295*a'*. Handheld vacuum cleaner 2220' can be configured such that electromagnet 2294' does not receive electrical energy unless switch 2295*a'* is engaged and/or actuator 2214' is in the second position. In some implementations, electrical communication between electromagnet 2294' and electrical component 2295' is prevented when switch 2295*a'* is not engaged (for example, rendering electromagnet 2294' inoperative). Electrical communication between electromagnet 2294' and electrical component 2295' can be enabled when switch 2295*a'* is engaged, which in turn can allow electromagnet 2294' to be activated/deactivated as described elsewhere herein for various operational modes of handheld vacuum cleaner 2220' (and a cleaning apparatus to which it forms part of), such as the auto-empty modes disclosed herein.

FIGS. 22HH-22XX illustrate another implementation of a handheld vacuum cleaner 2220" and portions thereof. Handheld vacuum cleaner 2220" can include any of the features described with respect to other handheld vacuum cleaners disclosed herein. Handheld vacuum cleaner 2220" can be similar or identical to handheld vacuum cleaner 2220 and/or 2220' described above in many respects, for example, except with respect to certain features or aspects described below with respect to FIGS. 22HH-22XX. Handheld vacuum cleaner 2220" can be part of a cleaning apparatus that is similar to any of the cleaning apparatuses disclosed herein and can be used and coupled with any of the wands, support members, floor-based vacuum cleaners, and/or cleaning heads disclosed herein in any of the operational modes disclosed herein.

FIG. 22HH illustrates a perspective view of handheld vacuum cleaner 2220" with a debris container door 2224"

attached, FIG. 22II illustrates the same view but with debris container door 2224" removed, and FIG. 22JJ illustrates the same view but with a filter 2243", a structural component 2287", a filter 2244", and a filter support 2296" removed. Filter 2243", structural component 2287", filter 2244", and filter support 2296" are illustrated in FIG. 22NN and can be similar or identical to filter 2243, 2243', structural component 2287, 2287', filter 2244, 2244', and filter support 2296" (respectively) in any respect. FIG. 22KK illustrates a bottom perspective view of a portion of handheld vacuum cleaner 2220" that corresponds with the partially disassembled state of FIG. 22JJ. FIG. 22LL illustrates the same view as FIG. 22KK but with a structural component 2286", valve 2292", valve biasing member 2299", socket 2277", and electromagnet 2294" removed, illustrating grill 2281*b*" of structural component 2281" (which can be similar or identical to grill 2281*b*, 2281*b*' and structural component 2281, 2281', respectively).

FIG. 22MM illustrates structural component 2286" (which can be similar in many respects to structural component 2286, 2286') connected with structural component 2287" and filter 2243". FIG. 22NN illustrates a perspective view of filter support 2296", structural component 2287", filter 2244" (which can include an interior 2244*c*"), a surface 2296*d*" of filter support 2296", an opening 2296*e*" in surface 2296*d*", and a rim 2296*i*" extending from surface 2296*d*" and around opening 2296*e*". Filter 2243", structural component 2287", filter 2244", filter support 2296", opening 2296*e*", and filter interior 2244*c*" can function in a similar or identical manner as described and/or illustrated herein with respect to filter 2243, structural component 2287, filter 2244, filter support 2296, opening 2296*e*, and filter interior 2244*c* (respectively). FIG. 2200 illustrates structural component 2286", valve 2292", and valve biasing member 2299" in an assembled state, while FIG. 22PP illustrates such components in a disassembled state along with socket 2277" and electromagnet 2294". Electromagnet 2294" can be similar or identical to electromagnet 2294, 2294'. Handheld vacuum cleaner 2220" can include an electrical component similar or identical to electrical component 2295. FIGS. 22QQ-22RR illustrate top and bottom perspective views (respectively) of valve 2292". FIGS. 22SS-22TT illustrate top and bottom perspective views (respectively) of socket 2277". FIG. 22UU illustrates a top perspective view of valve biasing member 2299".

FIG. 22VV illustrates a cross-sectional view through handheld vacuum cleaner 2220" with valve 2292" in a closed position, with FIG. 22WW illustrating an enlarged view of a portion of that shown in FIG. 22VV. Such closed position may be associated with an upright mode and/or a stick (upright lock/standby) mode of a cleaning apparatus incorporating handheld vacuum cleaner 2220", which may be similar or identical to any of the upright and stick (upright lock/standby) modes (respectively) disclosed herein. FIG. 22XX illustrates valve 2292" in an example open position. Such open position may be associated with a stick mode and/or an auto-empty mode of a cleaning apparatus incorporating handheld vacuum cleaner 2220", which may be similar or identical to any of the stick and auto-empty modes (respectively) disclosed herein. Such open position may also be associated with an above floor mode such as those disclosed herein. Valve biasing member 2299" can be configured to bias valve 2292" to the above described closed position, in which valve 2292" can cover/block opening 2296*e*" (see FIGS. 22VV-22WW), for example, in a similar manner as that described herein with respect to valve biasing member 2299 and valve 2292.

Valve 2292" can be similar to valve 2292, 2292' in various respects. With reference to FIGS. 22QQ-22RR, valve 2292" can include a base 2292*a*" and a stem 2292*b*" extending outward from base 2292*a*". Stem 2292*b*" can be configured to receive at least a portion of socket 2277" and/or electromagnet 2294" (see FIGS. 22VV-22XX). Stem 2292*b*" can have a cylindrical shape, for example, or have a shape that otherwise corresponds to a size and/or shape of socket 2277' and/or electromagnet 294". Socket 2277" can be configured to receive and/or secure electromagnet 2294". Socket 2277" can include a body 2277*a*" (which can have a cylindrical shape) and a top portion 2277*b*". such top portion 2277*b*" can be arranged at a first end of socket 2277" and a second end of socket 2277" can comprise an open end which allows electromagnet 2294" to be inserted into an interior defined by body 2277*a*". Socket 2277" can include a slot 2277*f*" in the body 2277*a*" that accommodates a portion of electromagnet 2294", for example, wires of electromagnet 2294". Valve 2292" can be coupled (for example, movably coupled) to socket 2277". Socket 2277" can include one or more of protrusions 2277*c*", 2277*d*", 2277*e*" extending outward from body 2277*a*" and which can be arranged within openings 2292*d*", 2292*c*", 2292*g*" (for example, respectively), and openings 2292*d*", 2292*c*", 2292*g*" can be sized and/or shaped to allow protrusions 2277*c*", 2277*d*", 2277*e*" to move therewithin to allow relative movement of valve 2292" and socket 2277". This allows valve 2292" to move between a closed position (FIGS. 22VV-22WW) and an open position (FIG. 22XX) while socket 2299" and valve 2292" are coupled to one another and/or while socket 2299" is secured to a portion of structural component 2286" (for example, a cover portion 2286*h*' via a threaded screw as discussed herein). Protrusions 2277*c*", 2277*d*", 2277*e*" may be tapered, as shown.

Valve 2292" can include a magnet 2292*e*" that can be similar or identical to magnet 2292*e*, 2292*e*'. Valve 2292" can include a seal member 2292*f*'" (see FIG. 22RR) for sealing opening 2296*e*" when valve 2292" is in a closed position (FIGS. 22VV-22WW). Seal member 2292*f*'" can contact surface 2296*d*" around opening 2296*e*" and/or can engage a skirt wall 2296*i*" of filter support 2296" when in the closed position (see FIGS. 22NN and 22WW). Such skirt wall 2296*i*" and seal member 2292*f*" can have corresponding shapes in some implementations (see FIGS. 22NN and 22RR). Valve 2292" can include a slot 2292*h*" (for example, in stem 2292*b*") for accommodating a portion of electromagnet 2294", for example, wires of electromagnet 2294". With reference to FIG. 22RR, in some implementations, valve 2292" includes guide flanges 2292*i*" and/or guide flange 2292*j*" extending from base 2292*a*". Guide flanges 2292*i*", 2292*j*" can be configured to guide, position, and/or align valve 2292" when in and/or moved between closed and open positions. For example, guide flanges 2292*i*", 2292*j*" can engage with portions of filter support 2296" so as to guide, position, and/or align valve 2292" relative to opening 2296*e*". Guide flanges 2292*i*" can be arranged parallel to one another and/or perpendicular relative to 2292*j*" which can help guide, position, and/or align valve 2292" in two orthogonal directions.

Valve biasing member 2299" can be configured to move between an extended state (which may be a neutral and/or biased state of valve biasing member 2299") and a compressed/retracted state to facilitate closed and open positions of valve 2292". Valve biasing member 2299" can comprise a flexible and/or resilient material (for example, an elastomeric material) that accommodates such behavior. Valve biasing member 2299" can comprise a corrugated and/or an accordion shape. Valve biasing member 2299" can comprise an interior configured to receive socket 2277" and electromagnet 2294" (see FIGS. 22VV-22XX). Accordingly, valve biasing member 2299" can enclose and/or protect electromagnet 2294". Valve biasing member 2299" can be secured to structural component 2286" (for example, cover portion 2286*h*") and/or a portion of socket 2277" (for example, top portion 2277*b*"). Socket 2277" and electromagnet 2294" can be secured to structural component 2286" via a fastener (for example, a threaded screw) that extends through an opening in cover portion 2286*h*", an opening in top portion 2277*b*", and a threaded hole (for example, a blind hole) in electromagnet 2294" (see FIGS. 22PP, 22SS-22TT, and 22WW). In some implementations, valve biasing member 2299" (for example, an end portion thereof) is sandwiched between top portion 2277*b*" and cover portion 2286*h*" (see FIG. 22WW). Valve biasing member 2299" can be coupled with valve 2292", for example, via engagement between a portion of valve biasing member 2299" and a rim 2292*i*" protruding outward from stem 2292*b*". Rim 2282*i*" can extend along at least a portion of a circumference of stem 2292*b*" (see FIGS. 22QQ and 22WW-22XX). In some implementations, rim 2292*i*" extends along an entirety of an outer surface of stem 2292*i*" (for example, having an annular shape).

As mentioned previously, FIGS. 22VV-22WW illustrate valve 2292" in a closed position. In such closed position, valve 2292" can block a flow path extending through handheld vacuum cleaner 2220", for example, a flow path that is at least partially defined through opening 2296*e*" and/or filter 2242" (for example, filter interior 2244*c*"). Such closed position can facilitate an upright mode and/or a stick (upright lock) mode which can be similar or identical to the upright and stick (upright lock) modes disclosed herein. As also mentioned previously, FIG. 22X illustrates valve 2292" in an example open position in which such flow path is not blocked. Such open position can facilitate a stick mode and/or an auto-empty mode which can be similar or identical to the stick and auto-empty modes disclosed herein. Air can flow through handheld vacuum cleaner 2220" in any of such upright, stick, and auto-empty modes in a similar or identical manner as that described herein with respect to handheld vacuum cleaner 2220. Valve biasing member 2299" can be configured to bias valve 2292" to the closed position and can compress/retract for example, under suction force induced by a suction motor of handheld vacuum cleaner 2220" (for example, during a stick mode) and/or when electromagnet 2294" is activated and magnetically coupled with magnet 2292*e*" of valve 2292" (for example, during auto-empty mode). Handheld vacuum cleaner 2220" can include a controller that can be similar or identical to controller 327 and/or any of the controllers disclosed herein. Handheld vacuum cleaner 2220" can be configured to control operation of electromagnet 2294" in a similar or identical manner as that described herein with respect to any of the other disclosed handheld vacuum cleaners.

FIG. 23 illustrates an example method 2300 of controlling operation of a cleaning apparatus, such as any of the cleaning apparatuses disclosed herein. The cleaning apparatus described with respect to FIG. 23 can include a handheld vacuum cleaner, a floor-based vacuum cleaner, a cleaning head, a wand, and a support member, each of which can be similar or identical to any of the handheld vacuum cleaners, floor-based vacuum cleaners, cleaning heads, wands, and support members disclosed herein (respectively). When the cleaning apparatus is "on", see "2301" (for example, when a power button on the handheld vacuum cleaner is pressed), the cleaning apparatus can determine, at step 2302, whether the handheld vacuum cleaner is connected to the cleaning head. Upon determination that the handheld vacuum cleaner is not connected to the cleaning head at step 2302, the cleaning apparatus can, at step 2304, initiate (or maintain) a handheld mode of operation in which a suction motor of the handheld vacuum cleaner is "on". Such handheld mode may also be referred to as an "above-floor" mode where the handheld vacuum cleaner is used to clean surfaces above the floor/ground surface. The wand may be connected or disconnected when in such mode. In some implementations, the handheld vacuum cleaner includes a valve that can open and close a flow path extending through the handheld vacuum cleaner (for example, extending through a dirty air inlet and a clean air outlet and/or auxiliary air inlet). For example, the handheld vacuum cleaner can be similar or identical to handheld vacuum cleaner 2220 and include a valve similar or identical to valve 2292 and/or can include an electromagnet similar or identical to electromagnet 2294. In such implementations, such valve is "open" when the handheld vacuum cleaner is in the handheld mode (for example, via suction induced by the handheld vacuum suction motor) and such electromagnet is "off". In some variants, such electromagnet is "on" in the handheld mode.

Upon determination that the handheld vacuum cleaner is connected to the cleaning head at step 2302, the cleaning apparatus can determine, at step 2306, whether the floor-based vacuum cleaner is connected (for example, connected to the support member and/or wand). If the cleaning apparatus determines that the floor-based vacuum cleaner is not connected, the cleaning apparatus can, at step 2308, determine whether the wand and/or support member are in an upright orientation and/or locked position. The cleaning apparatus can be configured to detect whether the wand and/or support member are in such upright orientation and/or locked position via utilization of a switch. For example, the cleaning head can include a switch that is engaged or disengaged when the support member and/or wand are in a substantially perpendicular position (for example, relative to the floor and/or a plane of the cleaning head) or within a certain degree range relative to an axis that is perpendicular to the floor or plane of the cleaning head (for example, within 5, 10, 15, or 20 degrees from perpendicular). An example of such switch is switch 2590, described and illustrated with respect to FIGS. 25A-25D. Such switch can be configured to transmit one or more signals to a controller of the cleaning apparatus (such as a controller in the handheld vacuum cleaner) via electrical connectors and/or circuitry within any of the cleaning head, support member, wand, and/or handheld vacuum cleaner, such as any of those disclosed herein, which allows the controller to make the determination at step 2308. As another example, the cleaning apparatus can include a valve in the support member that opens/closes based on inclination of the support member and/or wand (similar or identical to valve 1680) and a switch that is engaged (or disengaged) when such valve is closed. Such switch can transmit signal(s) to the controller in a similar manner as that described above.

With reference to step 2310, upon determining that the wand and/or support member are not in an upright orientation and/or locked position, the cleaning apparatus can initiate a stick mode of operation in which the suction motor of the handheld vacuum cleaner is "on". Such stick mode can be similar or identical to any of the stick modes described and/or illustrated herein. In implementations in which the handheld vacuum cleaner includes a valve similar or identical to valve 2292 and/or an electromagnet similar or identical to electromagnet 2294, such valve is "open" and such electromagnet can be "on" (or "off") in the stick mode. With reference to step 2312, upon determining that the wand and/or support member are in an upright orientation and/or locked position, the cleaning apparatus can initiate (or maintain) a mode of operation in which the suction motor of the handheld vacuum cleaner is "off". Such mode can be similar or identical to any of the "Stick (Upright Lock)" modes described and/or illustrated herein, and such mode may also be referred to as a "Standby" or "Stick (Standby)" mode (or similar). In implementations in which the handheld vacuum cleaner includes a valve similar or identical to valve 2292 and/or an electromagnet similar or identical to electromagnet 2294, such valve can be "closed" (for example, via spring(s) like springs 2293) and such electromagnet can be "off" in the stick, standby mode.

With continued reference to FIG. 23, upon determination that the floor-based vacuum cleaner is connected at step 2306, the cleaning apparatus may (optionally) deactivate the suction motor of the handheld vacuum cleaner at step 2314, if such suction motor was previously "on". In some cases, a user may attach the floor-based vacuum cleaner (for example, to the support member and/or wand) while the cleaning apparatus is operating in the stick mode or while the cleaning apparatus is in the stick, standby mode. In such cases, the cleaning apparatus can detect such attachment (via step 2306, and after determining a "Yes" at step 2302) and automatically turn "off" the handheld suction motor (at step 2314). In some implementations, the cleaning apparatus automatically turns "on" a suction motor of the floor-based vacuum cleaner after determining a "Yes" at step 2306, for example, simultaneously with or after turning the handheld vacuum cleaner suction motor "off".

After carrying out step 2306 (and, optionally, step 2314), the cleaning apparatus can determine whether the wand and/or support member are in an upright orientation and/or locked position at step 2316. Such determination at step 2316 can be similar or identical to that described above with respect to step 2308. Upon determination that the wand and/or support member are not an upright orientation and/or locked position at step 2316, the cleaning apparatus can initiate (or maintain) an upright mode of operation (step 2318) in which the suction motor of the floor-based vacuum cleaner is "on". Such upright mode can be similar or identical to any of the upright modes described and/or illustrated herein. In implementations in which the handheld vacuum cleaner includes a valve similar or identical to valve 2292 and/or an electromagnet similar or identical to electromagnet 2294, such valve can be "closed" (for example, via spring(s) like springs 2293 and/or via suction force induced by the floor-based vacuum suction motor) and such electromagnet can be "off" in the upright mode.

Figure 23A:
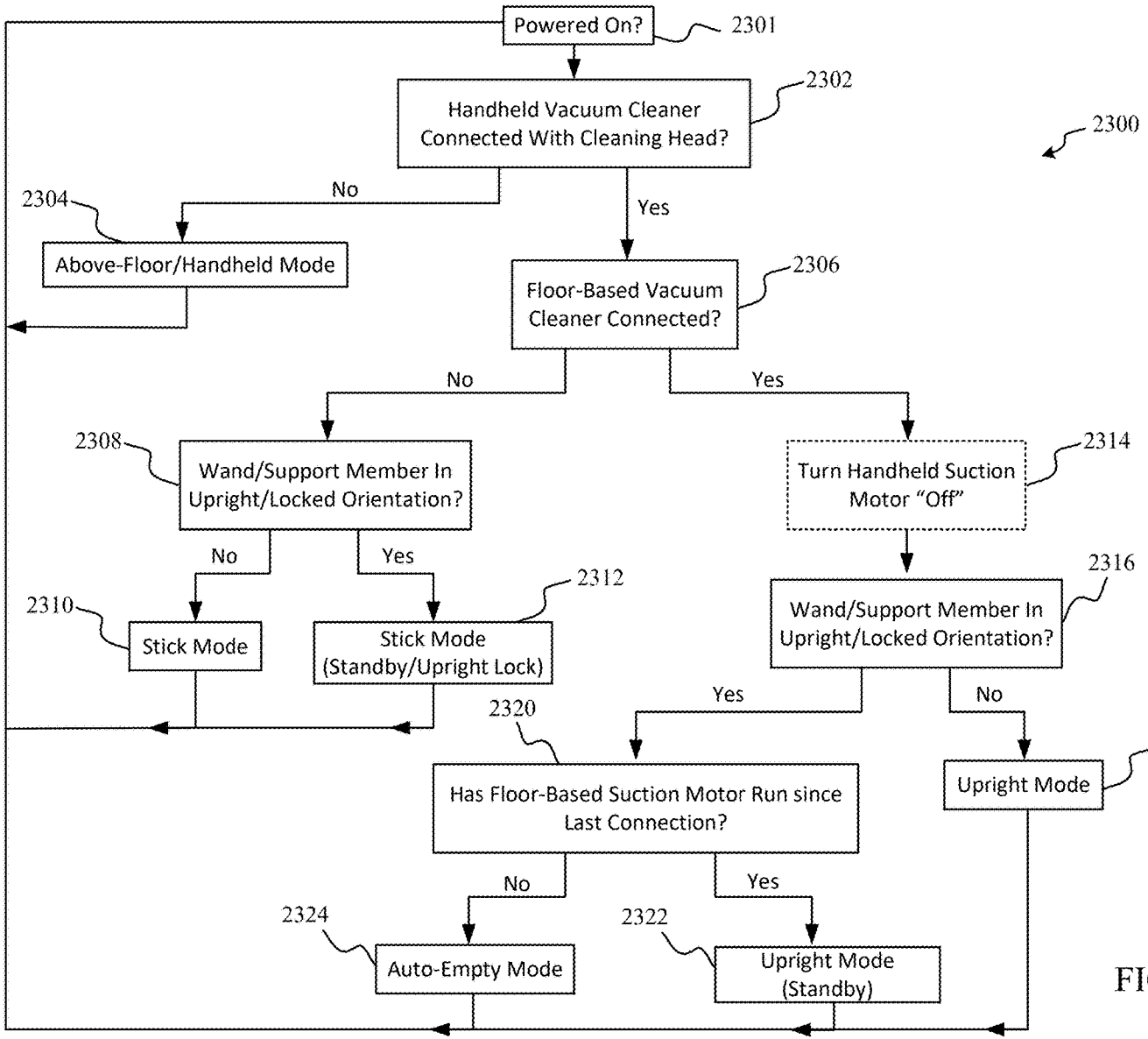
FIG. 23A illustrates an example method of controlling operation of a cleaning apparatus in accordance with aspects of this disclosure.
Figure 23B:
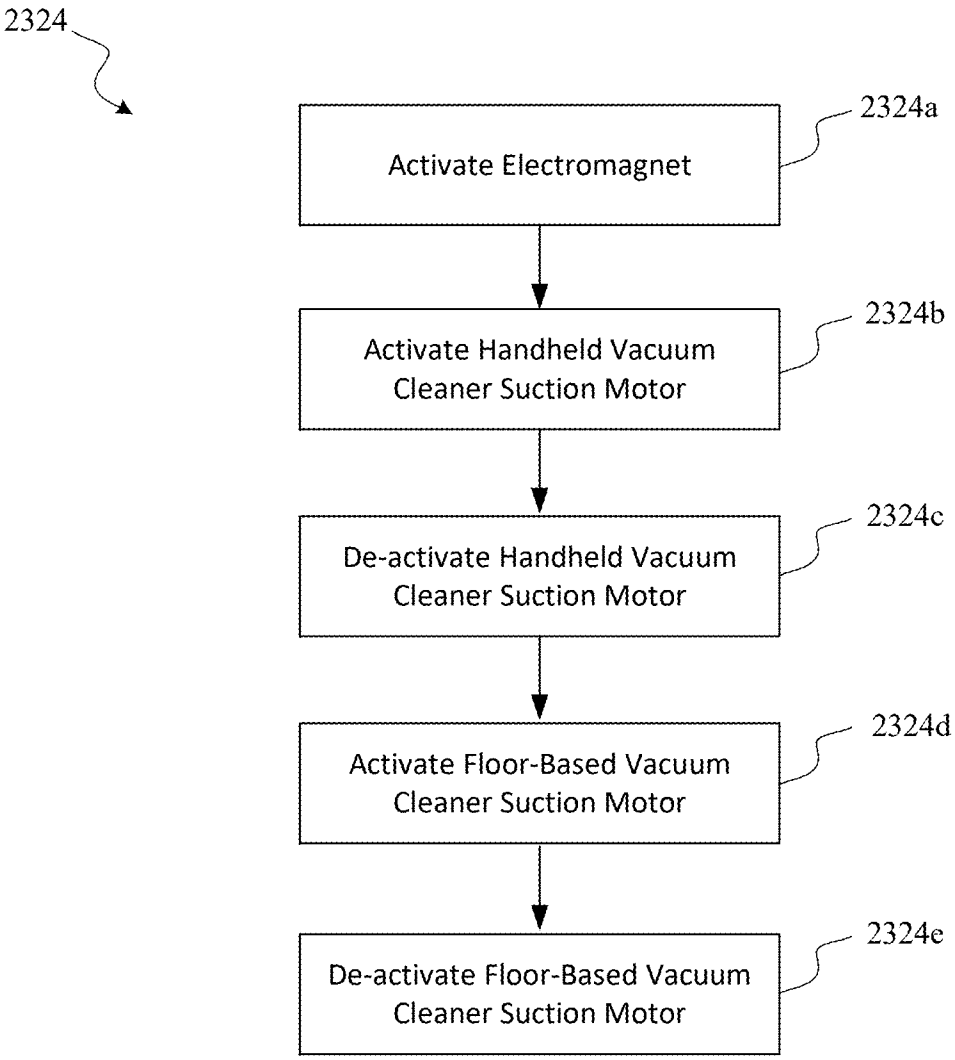
FIG. 23B illustrates an example auto-empty mode for a cleaning apparatus in accordance with aspects of this disclosure.

As shown in FIG. 23, upon determination that the wand and/or support member are in an upright orientation and/or locked position at step 2316, the cleaning apparatus can carry out step 2320. At step 2320, the cleaning apparatus can determine whether the floor-based vacuum cleaner suction motor has run since the last time the floor-based vacuum cleaner was attached. The cleaning apparatus can make such determination in a variety of ways. For example, the cleaning apparatus (for example, a controller of handheld vacuum cleaner) can be configured to store information relating to operation of the floor-based vacuum suction motor over time in combination with information relating to connection status of the floor-based vacuum cleaner, and use such information to carry out step 2320. The cleaning apparatus can receive signal(s) indicative of electrical connection of the floor-based vacuum cleaner with the cleaning head, support member, wand, and/or handheld vacuum cleaner, and such signal(s) can be utilized for such information. Upon determining that the floor-based suction motor has not run since the last connection, the cleaning apparatus can initiate an auto-empty mode of operation (step 2324). Such auto-empty mode can be similar or identical to any of the auto-empty modes described and/or illustrated herein and/or may be as described below with respect to FIG. 23B. Upon determining that the floor-based suction motor has run since the last connection, the cleaning apparatus can initiate an upright, standby mode of operation (step 2322) in which the floor-based vacuum cleaner suction motor is "off". In implementations in which the handheld vacuum cleaner includes a valve similar or identical to valve 2292 and/or an electromagnet similar or identical to electromagnet 2294, such valve can be "closed" (for example, via spring(s) like springs 2293) and such electromagnet can be "off" in the upright, standby mode.

The cleaning apparatus (for example, a controller in handheld vacuum cleaner) can determine whether any of the handheld vacuum cleaner, wand, support member, floor-based vacuum cleaner, and cleaning head are connected (to carry out aspects of method 2300) based on mechanical and/or electrical engagement of electrical connector(s) of any of such components, for example, as described and/or illustrated herein, and such components can transmit one or more electrical signal(s) to the controller when connected with one another.

FIG. 23B illustrates an example implementation of the auto-empty mode of step 2324. The handheld vacuum cleaner of the cleaning apparatus can include a valve similar or identical to valve 2292 and/or an electromagnet similar or identical to electromagnet 2294. At step 2324*a*, the cleaning apparatus (for example, a controller of the handheld vacuum cleaner) activates (for example, automatically) the electromagnet. In some implementations, activation of the electromagnet causes the valve to move (and be held in) the open position, for example, as described with respect to electromagnet 2294 and valve 2292 of handheld vacuum cleaner 2220. In some implementations, the handheld vacuum cleaner includes spring(s) like springs 2293, which bias the valve to the closed position as also described above with respect to electromagnet 2294 and valve 2292. In some of such implementations, as shown in FIG. 23B, the cleaning apparatus activates the suction motor of the handheld vacuum cleaner during at least a portion of the auto-empty mode, which advantageously causes the valve to move closer to the electromagnet (overcoming the spring forces biasing the valve to a closed position) to facilitate magnetic coupling therebetween. For example, the cleaning apparatus can activate the handheld vacuum cleaner suction motor for a first time period at the beginning of the auto-empty mode. Such first time period can be between 1 and 20 seconds, for example, between 1 and 15 seconds, between 1 and 10 seconds, between 1 and 5 seconds, 1 second, 2 seconds, 3 seconds, 4 seconds, or 5 seconds, or any value or range within or bounded by any of these values or ranges. After such first time period expires, the cleaning apparatus can de-activate the handheld vacuum cleaner suction motor at step 2324*c*. At step 2324*d*, the cleaning apparatus can activate the floor-based vacuum cleaner suction motor to facilitate transfer of debris from the handheld vacuum cleaner to the floor-based vacuum cleaner. The floor-based vacuum cleaner suction motor can be operated for a second time period during the auto-empty mode. Such second time period can be between 1 and 60 seconds, for example, between 1 and 50 seconds, between 1 and 40 seconds, between 1 and 30 seconds, between 1 and 20 seconds, between 5 and 30 seconds, between 5 and 25 seconds, between 10 and 30 seconds, between 10 and 20 seconds, 10, 15 seconds, or 20 seconds, or any value or range within or bounded by any of these values or ranges. After such second time period expires, the cleaning apparatus can de-activate the floor-based vacuum cleaner suction motor at step 2320*e*. Steps 2324*a*-2324*e* described with respect to FIG. 23B may also be referred to as an "auto-empty cycle", and such auto-empty cycle can be initiated by the cleaning apparatus (for example, a controller of handheld vacuum cleaner) at any time upon determination of the parameters described above with respect to FIG. 23A. The example implementation of the auto-empty mode of FIG. 23B (or any aspect thereof) can be utilized by any of the cleaning apparatuses disclosed herein. For example, any of the disclosed cleaning apparatus can be configured to operate handheld and floor-based vacuum cleaners thereof as described above with respect to steps 2324*a*-2324*e*.

Variants of the method described above with reference to FIG. 23A are possible. For example, as an alternative to determining whether the floor-based vacuum suction motor has run since the last connection (to the wand, support member, cleaning head, and/or handheld vacuum cleaner), in some variants, step 2320 includes determining whether the auto-empty mode has occurred (for example, an auto-empty cycle as described in steps 2324*a*-2324*e*) since the last connection of the floor-based vacuum cleaner. The cleaning apparatus can be configured to make such determination in a variety of ways, for example, by storing occurrences of the auto-empty mode and connections states/status of the floor-based vacuum cleaner. For example, a controller of the cleaning apparatus can store occurrences of electromagnet activation and/or use of the handheld vacuum and floor-based vacuum suction motors (as described in steps 2324*a*-2324*e*), and such information can allow the controller to store occurrences of the auto-empty mode. The controller can also store occurrences of states/statuses of floor-based vacuum cleaner to the wand, support member, cleaning head, and/or handheld vacuum cleaner based on signal(s) received via electrical connectors and/or circuitry thereof. In such variants of step 2320, upon determining that the auto-empty mode has not occurred since the last connection of the floor-based vacuum cleaner, the cleaning apparatus can be configured to initiate the auto-empty mode (for example, step 2324). Further, upon determining that the auto-empty mode has occurred since the last connection of the floor-based vacuum cleaner, the cleaning apparatus can be configured to initiate the upright, standby mode described above with respect to step 2322.

With continued reference to FIG. 23A, the cleaning apparatus can carry out method 2300 at certain time intervals (for example, at 50 millisecond, 100 millisecond, 200 millisecond, 500 millisecond, or 1, 2, 5 second intervals, or any value or range within or bounded by any of these values or ranges), for example, to determine whether to maintain a given operational mode. Additionally or alternatively, the cleaning apparatus can carry out method 2300 when a state/status of the cleaning apparatus is changed (for example, wand/support member is moved to "upright"/"locked" position, floor-based vacuum cleaner attached/detached, handheld vacuum cleaner is attached, etc.). This can allow cleaning apparatus to determine whether to change a state/status of components thereof, such as the handheld vacuum suction motor, the floor-based vacuum suction motor, the electromagnet, and/or other components thereof (for example, agitator(s) or motor(s) of the cleaning head during stick or upright modes). As an example, the cleaning apparatus can carry out method 2300 when the handheld vacuum cleaner (being used in an above-floor mode) is attached to the wand (see arrow/lines leading from block 2304 to block 2301). If the wand, support member, and cleaning head are attached, the floor-based vacuum cleaner is detached, and the wand is not in the upright/locked position, the cleaning apparatus can initiate the stick mode as described above. If the wand, support member, cleaning head, and floor-based vacuum cleaner are attached, and the wand is not in the upright/locked position, the cleaning apparatus can initiate the upright mode as described above. As another example, the cleaning apparatus can carry out method 2300 when the wand is moved (during stick or upright mode) from an inclined position to the upright/locked position (see arrow/lines leading from block 2310 and 2318 to block 2301). The cleaning apparatus can transition to the stick standby mode, upright standby mode, or auto-empty mode depending on whether the floor-based vacuum cleaner is attached and/or whether the floor-based suction motor has been run since the last connection (or whether the auto-empty mode has occurred since the last connection as described above). In some implementations, the cleaning apparatus is configured to activate agitator(s) and/or motor(s) of the cleaning head when in the stick and/or upright modes.

Figure 24:
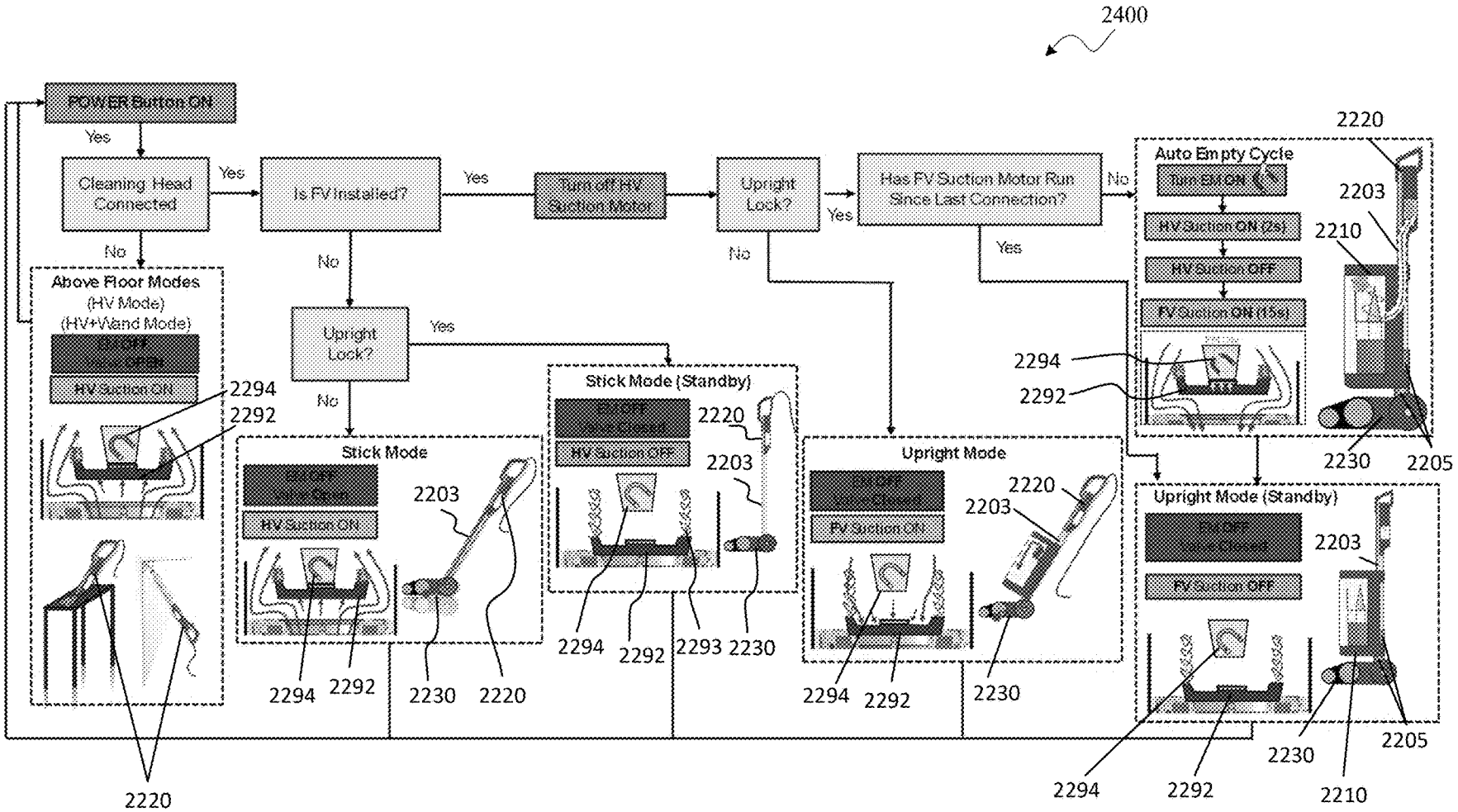
FIG. 24 illustrates an example method of controlling operation of a cleaning apparatus in accordance with aspects of this disclosure.

FIG. 24A illustrates an example method 2400 of controlling operation of cleaning apparatus 2200 and also illustrates various schematic representations of portions of cleaning apparatus 2200, including handheld vacuum cleaner 2220 ("HV"), wand 2203, support member 2205, cleaning head 2230, floor-based vacuum cleaner 2210 ("FV"), valve 2292, electromagnet 2294 ("EM"), and springs 2293. Method 2400 can be similar or identical to method 2300 in any respect. As illustrated, cleaning apparatus 2200 can carry out method 2400 to determine whether to initiate (or maintain): an above-floor mode (which also may be referred to as a "handheld" or "HV" mode, or an "HV+Wand" mode when wand 2203 is attached); a stick mode; a stick, standby mode; an upright mode; and upright, standby mode; and an auto-empty mode. As shown, and as discussed with respect to method 2300, such determination can be made based on determining: whether cleaning head 2230 is connected to handheld vacuum cleaner 2220; whether floor-based vacuum cleaner 2210 is connected to handheld vacuum cleaner 2220; whether wand 2203 and/or support member 2205 are in an upright/lock position; and/or whether floor-based vacuum suction motor 2210 has been run since the last connection (and/or whether the auto-empty mode has occurred since the last connection). As shown, in the above-floor and stick modes, electromagnet 2294 is "off", the handheld vacuum cleaner 2220 suction motor is "on", and valve 2292 is in an open position (as described elsewhere herein). In some variants, electromagnet 2294 is "on" during the above-floor and/or stick modes. As also shown, in the stick, standby mode, electromagnet 2294 is "off", the handheld vacuum cleaner 2220 suction motor is "off", and valve 2292 is in the closed position (as described elsewhere herein). As also shown, in the upright mode, electromagnet 2294 is "off", the floor-based vacuum cleaner 2210 suction motor is "on", and valve 2292 is in the closed position (as described elsewhere herein). The handheld vacuum cleaner 2220 suction motor can be "off" in such upright mode. In the upright, standby mode, the electromagnet 2294 is "off", the floor-based vacuum cleaner 2210 suction motor is "off", and valve 2292 is in the closed position. In the example auto-empty mode/cycle illustrated in FIG. 24, electromagnet 2294 is turned "on", the handheld vacuum suction motor is turned on for 2 seconds then turned off, and then the floor-based vacuum suction motor is turned on for 15 seconds and then turned off. Such 2 and 15 second time periods can be different in other implementations, such as described above with respect to the "first" and "second" time periods and FIG. 23B.

Figure 25A:
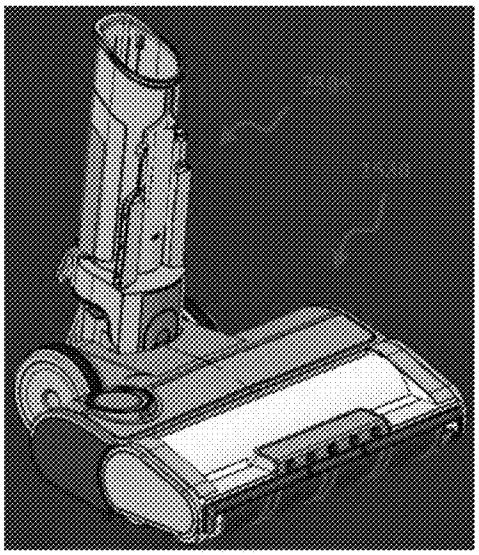
FIGS. 25A-25D illustrate an example cleaning head and support member in accordance with aspects of this disclosure.
Figure 25B:
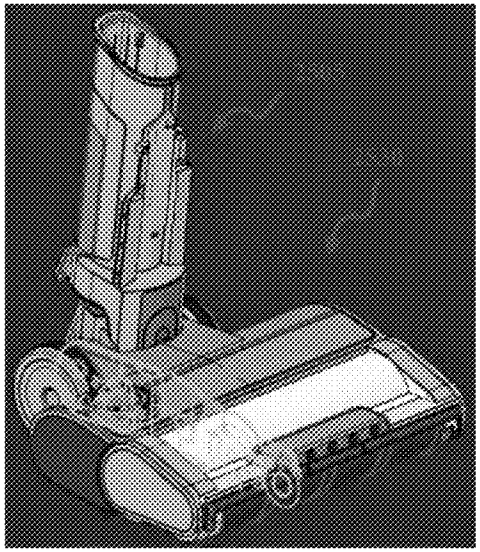
Figure 25C:
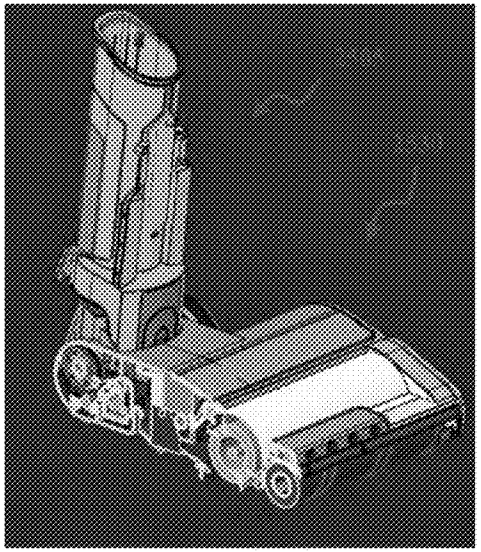
Figure 25D:
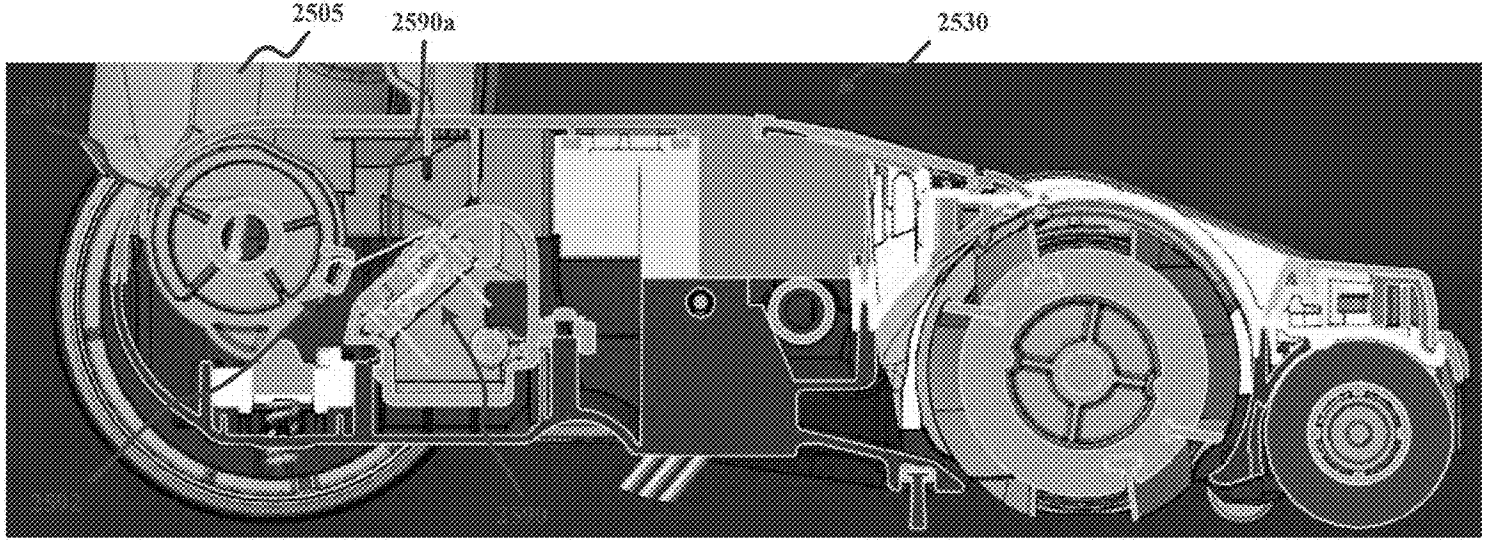

Any of the cleaning apparatuses disclosed herein can include a switch that allows the cleaning apparatus to determine whether the wand (and/or support member) is in the upright/locked position described herein. As described above, such determination can in turn be utilized to determine whether to initiate (or maintain) the stick standby mode, the upright standby mode, and/or the auto-empty mode. FIGS. 25A-25D illustrate an example support member 2505 and a cleaning head 2530 that includes a switch 2590. FIG. 25C illustrates a perspective cross-section and FIG. 25D illustrates an enlarged view of such cross-section (the location of the cross-section being identified in FIG. 25B). FIGS. 25A-25D illustrate support member 2505 (which may be connected to any of the wands disclosed herein) in an example upright/locked position. Cleaning head 2530 can include a moveable (rotatable) mechanism 2591 that includes a switch engagement member 2592 (for example, a protrusion extending from a portion of mechanism 2591) that moves (rotates) with mechanism 2591 based on rotation of support member 2505 (and, for example, a wand connected thereto). When rotated to the upright/locked position, switch engagement member 2592 engages (for example, depresses) a portion (for example, a button 2590*a*, which may be cantilevered) of switch 2590. (A cantilevered end of button 2590*a* can be positioned below engagement member 2592 when in the position of FIG. 25D). Switch 2590, when engaged in such manner, may send one or more signal(s) to a controller of the cleaning apparatus (for example, a controller of a handheld vacuum cleaner), which can be utilized to determine that the cleaning apparatus is in the upright/locked position. Any of the cleaning heads disclosed herein can incorporate switch 2590 and any of the other aspects described with respect to FIGS. 25A-25D.

Additional Considerations and Terminology

Although this disclosure has been described in the context of certain examples, it will be understood by those skilled in the art that the present disclosure extends beyond the specifically disclosed examples to other alternative examples and/or uses of the disclosure and modifications and equivalents thereof. In addition, while a number of variations of the disclosure have been shown and described in detail, other modifications, which are within the scope of this disclosure, will be readily apparent to those of skill in the art based upon this disclosure. It is also contemplated that various combinations or sub-combinations of the specific features and aspects of the examples may be made and still fall within the scope of the disclosure. Accordingly, it should be understood that various features and aspects of the disclosure can be combined with or substituted for one another in order to form varying modes of the disclosed.

Features, materials, characteristics, or groups described in conjunction with a particular aspect or example are to be understood to be applicable to any other aspect or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing examples of devices or systems. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that the actual steps taken in the processes illustrated and/or disclosed may differ from those shown in the figures. Depending on the system, certain of the steps described above may be removed, others may be added. Furthermore, the features and attributes of the specific examples disclosed above may be combined in different ways to form additional examples of systems, all of which fall within the scope of the present disclosure. Also, the separation of various system components in the implementations described above should not be understood as requiring such separation in all implementations, and it should be understood that the described components and systems can generally be integrated together in a single product or packaged into multiple products.

The various illustrative logical blocks, modules, and methods described in connection with the implementations disclosed herein can be implemented or performed by a machine, such as a processor configured with specific instructions, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A processor can be a microprocessor, for example. A processor can also be implemented as a combination of computing devices, e.g., a combination of a DSP and a microprocessor, a plurality of microprocessors, one or more microprocessors in conjunction with a DSP core, or any other such configuration.

The elements of the implementations disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of computer-readable storage medium known in the art. An example storage medium can be coupled to the processor such that the processor can read information from, and write information to, the storage medium. In the alternative, the storage medium can be integral to the processor. The processor and the storage medium can reside in an ASIC. A software module can comprise computer-executable instructions which cause a hardware processor to execute the computer-executable instructions.

Conditional language used herein, such as, among others, "can," "could," "might," "may," "e.g.," and the like, unless specifically stated otherwise, or otherwise understood within the context as used, is generally intended to convey that certain features, elements, and/or steps are optional. Thus, such conditional language is not generally intended to imply that features, elements, and/or steps are in any way required or that one or more embodiments necessarily include logic for deciding, with or without other input or prompting, whether these features, elements, and/or steps are included or are to be always performed. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each" as used herein, in addition to having its ordinary meaning, can mean any subset of a set of elements to which the term "each" is applied.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally", and "substantially" may refer to an amount that is within less than or equal to 10% of, within less than or equal to 5% of, or within less than or equal to 1% of the stated value, amount, or characteristic. As another example, in certain embodiments, the terms "generally parallel" and "substantially parallel" refer to a value, amount, or characteristic that departs from exactly parallel by less than or equal to 10 degrees, 5 degrees, 3 degrees, or 1 degree. As another example, in certain embodiments, the terms "generally perpendicular" and "substantially perpendicular" refer to a value, amount, or characteristic that departs from exactly perpendicular by less than or equal to 10 degrees, 5 degrees, 3 degrees, or 1 degree.

While the above detailed description has shown, described, and pointed out novel features, it can be understood that various omissions, substitutions, and changes in the form and details of the devices or systems illustrated can be made without departing from the spirit of the disclosure. As can be recognized, certain portions of the description herein can be embodied within a form that does not provide all of the features and benefits set forth herein, as some features can be used or practiced separately from others. The scope of certain embodiments disclosed herein is indicated by the appended claims rather than by the foregoing description. All changes which come within the meaning and range of equivalency of the claims are to be embraced within their scope.

What is claimed is:

1. A cleaning apparatus comprising:

a first vacuum cleaner; and a second vacuum cleaner combinable with and separable from the first vacuum cleaner, each of the first and second vacuum cleaners operable to remove debris from a surface;

the first vacuum cleaner comprising a first dirty air inlet, a first debris separator, a first debris container, a first suction motor, and a first clean air outlet; and the second vacuum cleaner comprising a second dirty air inlet, a second debris separator, a second debris container, a second suction motor, and a second clean air outlet, wherein the second debris container comprises a smaller volume than the first debris container;

wherein the cleaning apparatus is configured to be transitioned between a first mode of operation, a second mode of operation, and a third mode of operation, and wherein:

in the first mode of operation, the first suction motor causes air to flow through the first dirty air inlet, the first debris separator, and the first clean air outlet, thereby directing debris through the first dirty air inlet and into the first debris container;

in the second mode of operation, the second suction motor causes air to flow through the second dirty air inlet, the second debris separator, and the second clean air outlet, thereby directing debris through the second dirty air inlet and into the second debris container; and in the third mode of operation, the first suction motor causes air to flow into and through the second vacuum cleaner and through the first dirty air inlet, the first debris separator, and the first clean air outlet, thereby directing debris from the second debris container into the first debris container.

2. The cleaning apparatus of claim 1, further comprising a cleaning head supportable by and movable with respect to said surface and comprising a cleaning head dirty air inlet, wherein:

the first suction motor causes air to flow from the cleaning head dirty air inlet through the first dirty air inlet when the cleaning apparatus is in the first mode of operation; and the second suction motor causes air to flow from the cleaning head dirty air inlet through the second dirty air inlet when the cleaning apparatus is in the second mode of operation.

3. The cleaning apparatus of claim 2, further comprising a wand connecting the second vacuum cleaner to the cleaning head, wherein:

the second suction motor causes air to flow from the cleaning head dirty air inlet through the wand when the cleaning apparatus is in the second mode of operation; and the first suction motor causes air to flow from the second vacuum cleaner through the wand when the cleaning apparatus is in the third mode of operation.

4. The cleaning apparatus of claim 3, wherein, when the cleaning apparatus is in the third mode of operation, flow communication between the cleaning head dirty air inlet and each of the first and second vacuum cleaners is blocked.

5. The cleaning apparatus of claim 4, further comprising:

a support member connected to the cleaning head and configured to attach to the wand; and a valve arranged within the support member and configured to move between an open position and a closed position, wherein the valve is in said closed position and blocks flow communication between the cleaning head dirty air inlet and each of the first and second vacuum cleaners when the cleaning apparatus is in the third mode of operation, and wherein the valve is in the said open position when the cleaning apparatus is in the first and second modes of operation, said valve allowing flow communication between the cleaning head dirty air inlet and each of the first and second vacuum cleaners when in said open position.

6. The cleaning apparatus of claim 1, wherein, in the first mode of operation, the first and second vacuum cleaners are attached to one another but flow communication between the first and second debris containers is blocked.

7. A cleaning apparatus comprising:

a floor-based vacuum cleaner removably attachable to at least one of a wand and a cleaning head, the cleaning head supportable by and movable with respect to a surface, the wand attachable to the cleaning head, the floor-based vacuum cleaner movable with the cleaning head to remove debris from said surface and comprising a floor-based vacuum dirty air inlet, a floor-based vacuum debris separator, a floor-based vacuum debris container, a floor-based vacuum suction motor, and a floor-based vacuum clean air outlet; and a handheld vacuum cleaner removably attachable to the wand, the handheld vacuum cleaner comprising a handheld vacuum dirty air inlet, a handheld vacuum debris separator, a handheld vacuum debris container, a handheld vacuum suction motor, and a handheld vacuum clean air outlet, wherein the handheld vacuum debris container comprises a smaller volume than the floor-based vacuum debris container;

wherein the cleaning apparatus is configured to be transitioned between at least a first mode of operation and a second mode of operation, and wherein:

in the first mode of operation, the floor-based vacuum suction motor causes air to flow from a cleaning head dirty air inlet of the cleaning head and through the floor-based vacuum dirty air inlet, the floor-based vacuum debris separator, and the floor-based vacuum clean air outlet, thereby directing debris from said surface through the floor-based vacuum dirty air inlet and into the floor-based vacuum debris container; and in second mode of operation, the handheld vacuum suction motor causes air to flow from the cleaning head dirty air inlet and through the handheld vacuum dirty air inlet, the handheld vacuum debris separator, and the handheld vacuum clean air outlet, thereby directing debris from said surface through the handheld vacuum dirty air inlet and into the handheld vacuum debris container.

8. The cleaning apparatus of claim 7, wherein the cleaning apparatus is further configured to be transitioned to a third mode of operation in which the floor-based vacuum suction motor causes air to flow into and through the handheld vacuum cleaner, the wand, the floor-based vacuum dirty air inlet, the floor-based vacuum debris separator, and the floor-based vacuum clean air outlet, thereby directing debris from the handheld vacuum debris container into the floor-based vacuum debris container.

9. The cleaning apparatus of claim 8, wherein, in the third mode of operation, the floor-based vacuum suction motor causes air to flow into the handheld vacuum cleaner via the handheld vacuum clean air outlet and/or an auxiliary air inlet of the handheld vacuum cleaner.

10. The cleaning apparatus of claim 8, further comprising a valve arranged within the handheld vacuum cleaner and configured to be moved between a closed position and an open position, said valve in said closed position when the cleaning apparatus is in the first mode of operation and in said open position when the cleaning apparatus is in the second mode of operation, wherein, when in said closed position the valve blocks at least one flow path extending through the handheld vacuum cleaner, and wherein said at least one flow path is open when the valve is in said open position.

11. The cleaning apparatus of claim 10, wherein the valve is biased toward said closed position.

12. The cleaning apparatus of claim 10, wherein, when the cleaning apparatus is in the second mode of operation, the handheld vacuum suction motor causes the valve to move to said open position.

13. The cleaning apparatus of claim 10, wherein the handheld vacuum cleaner comprises a filter and the valve is arranged between the filter and the handheld vacuum suction motor.

14. The cleaning apparatus of claim 13, wherein said at least one flow path is defined by at least a portion of an interior cavity of the filter.

15. The cleaning apparatus of claim 14, wherein the filter comprises an opening in fluid communication with the interior cavity, and wherein the valve covers said opening when in said closed position and is spaced from the opening when in said open position.

16. The cleaning apparatus of claim 10, wherein the valve is in said open position when the cleaning apparatus is in the third mode of operation.

17. The cleaning apparatus of claim 10, wherein:

the valve comprises a magnet; and the handheld vacuum cleaner further comprises an electromagnet configured magnetically couple with the magnet of the valve and cause the valve to remain in said open position when the cleaning apparatus is in the third mode of operation.

18. The cleaning apparatus of claim 17, wherein the electromagnet is activated when the cleaning apparatus is in the third mode of operation and deactivated when the cleaning apparatus is in the first and/or second modes of operation.

19. The cleaning apparatus of claim 10, wherein:

said valve is a first valve of the cleaning apparatus; and the cleaning apparatus further comprises a second valve arranged within the handheld vacuum cleaner, the second valve configured to inhibit debris from falling out of the handheld vacuum debris container through the handheld vacuum dirty air inlet when the cleaning apparatus is in the first mode of operation.

20. The cleaning apparatus of claim 19, wherein:

when the cleaning apparatus is in the first mode of operation, the second valve is in a first position in which the second valve blocks a flow passage that extends through the handheld vacuum dirty air inlet;

the second valve is moved from said first position to a second position when the cleaning apparatus is transitioned from the first mode of operation to the second mode of operation;

the second valve is moved from said first position to a third position when the cleaning apparatus is transitioned from the first mode of operation to the third mode of operation; and the second valve does not block said flow passage when in said second and third position.

* * * * *